US010472614B2

(12) United States Patent
Chivukula et al.

(10) Patent No.: US 10,472,614 B2
(45) Date of Patent: Nov. 12, 2019

(54) MESSENGER UNA MOLECULES AND USES THEREOF

(71) Applicant: Arcturus Therapeutics, Inc., San Diego, CA (US)

(72) Inventors: Padmanabh Chivukula, San Diego, CA (US); Luigi Warren, San Diego, CA (US); Kiyoshi Tachikawa, San Diego, CA (US); Joseph E. Payne, San Diego, CA (US)

(73) Assignee: ARCTURUS THERAPEUTICS, INC., San Diego, CA (US)

( * ) Notice: Subject to any disclaimer, the term of this patent is extended or adjusted under 35 U.S.C. 154(b) by 0 days.

(21) Appl. No.: 15/806,096

(22) Filed: Nov. 7, 2017

(65) Prior Publication Data

US 2018/0051262 A1 Feb. 22, 2018

Related U.S. Application Data

(63) Continuation of application No. 14/929,366, filed on Nov. 1, 2015, now abandoned.

(60) Provisional application No. 62/074,046, filed on Nov. 2, 2014.

(51) Int. Cl.

| | |
|---|---|
| ***A61K 48/00*** | (2006.01) |
| ***C07H 21/02*** | (2006.01) |
| ***C07H 21/04*** | (2006.01) |
| ***C12N 9/10*** | (2006.01) |
| ***C12N 9/64*** | (2006.01) |
| ***C07K 14/505*** | (2006.01) |
| ***C07K 14/81*** | (2006.01) |
| ***C07K 14/705*** | (2006.01) |
| ***C12N 9/88*** | (2006.01) |
| ***C12N 9/02*** | (2006.01) |
| ***C07K 14/575*** | (2006.01) |
| ***C07K 14/47*** | (2006.01) |
| ***C12N 9/12*** | (2006.01) |
| ***C07K 14/445*** | (2006.01) |
| ***C12N 9/44*** | (2006.01) |
| ***C07K 14/52*** | (2006.01) |
| ***C07K 14/745*** | (2006.01) |
| ***C07K 14/805*** | (2006.01) |
| ***C07K 14/46*** | (2006.01) |
| *A61K 39/00* | (2006.01) |

(52) U.S. Cl.

CPC ..... *C12N 9/1018* (2013.01); *C07K 14/445* (2013.01); *C07K 14/463* (2013.01); *C07K 14/47* (2013.01); *C07K 14/4712* (2013.01); *C07K 14/4717* (2013.01); *C07K 14/505* (2013.01); *C07K 14/524* (2013.01); *C07K 14/575* (2013.01); *C07K 14/705* (2013.01); *C07K 14/745* (2013.01); *C07K 14/805* (2013.01); *C07K 14/8125* (2013.01); *C12N 9/0071* (2013.01); *C12N 9/1051* (2013.01); *C12N 9/1205* (2013.01); *C12N 9/2451* (2013.01); *C12N 9/644* (2013.01); *C12N 9/88* (2013.01); *C12Y 114/16001* (2013.01); *C12Y 201/03003* (2013.01); *C12Y 204/01025* (2013.01); *C12Y 207/0104* (2013.01); *C12Y 302/01033* (2013.01); *C12Y 304/21022* (2013.01); *C12Y 403/02001* (2013.01); *A61K 39/00* (2013.01); *A61K 48/00* (2013.01); *C12N 2740/16222* (2013.01); *C12N 2840/105* (2013.01); *C12N 2840/60* (2013.01)

(58) Field of Classification Search

CPC .... C12N 15/111; C12N 15/113; A61K 31/713

See application file for complete search history.

(56) References Cited

U.S. PATENT DOCUMENTS

| | | | |
|---|---|---|---|
| 8,278,036 | B2 | 10/2012 | Kariko |
| 8,454,948 | B2 | 6/2013 | Pearlman |
| 8,691,966 | B2 | 4/2014 | Kariko |
| 2002/0064812 | A1 | 5/2002 | Connelly |
| 2008/0167219 | A1 | 7/2008 | Lin |
| 2009/0286852 | A1 | 11/2009 | Kariko |
| 2011/0105734 | A1 | 5/2011 | Kawasaki |
| 2011/0143397 | A1 | 6/2011 | Kariko |
| 2013/0096289 | A1 | 4/2013 | Wengel |
| 2013/0123481 | A1 | 5/2013 | De Fougerolles |
| 2013/0259923 | A1 | 10/2013 | Bancel et al. |
| 2014/0371302 | A1 | 12/2014 | Afeyan et al. |
| 2016/0022774 | A1 | 1/2016 | Bancel |
| 2016/0032316 | A1 | 2/2016 | Weissman et al. |

FOREIGN PATENT DOCUMENTS

| | | | |
|---|---|---|---|
| WO | 2007003582 | A2 | 1/2007 |
| WO | 2011012316 | | 2/2011 |
| WO | 2012145624 | A2 | 10/2012 |
| WO | 2013149140 | A1 | 10/2013 |
| WO | 2014003580 | A1 | 1/2014 |
| WO | 2015051169 | A2 | 4/2015 |
| WO | 2015117021 | A1 | 8/2015 |
| WO | 2015196128 | A2 | 12/2015 |
| WO | 2016131052 | A1 | 8/2016 |

OTHER PUBLICATIONS

Kertesz et al. (Developmental Biology, 276, 2004, 101-110).*

(Continued)

*Primary Examiner* — Amy H Bowman

(74) *Attorney, Agent, or Firm* — Mintz, Levin, Cohn, Ferris, Glovsky and Popeo, P.C.

(57) ABSTRACT

This invention provides a range of translatable messenger UNA (mUNA) molecules. The mUNA molecules can be translated in vitro and in vivo to provide an active polypeptide or protein, or to provide an immunization agent or vaccine component. The mUNA molecules can be used as an active agent to express an active polypeptide or protein in cells or subjects. Among other things, the mUNA molecules are useful in methods for treating rare diseases.

19 Claims, 14 Drawing Sheets

Specification includes a Sequence Listing.

(56) References Cited

OTHER PUBLICATIONS

Suto, Dominant-negative mutant of c-Jun gene transfer: a novel therapeutic strategy for colorectal cancer, 2004, Gene Therapy, vol. 11, pp. 187-193.
Benjannet, Loss- and Gain-of-function PCSK9 Variants, 2012, J Biol Chem, vol. 287, pp. 33745-33755.
Niu, Gene Therapy with Dominant-negative Stat3 Suppresses Growth of the Murine Melanoma B16 Tumor in Vivo, 1999, Cancer Research, vol. 59, pp. 5059-5063.
Silva, Meganucleases and Other Tools for Targeted Genome Engineering: Perspectives and Challenges for Gene Therapy, 2011, Current Gene Therapy, vol. 11, pp. 11-27.
Kariko, Increased Erythropoiesis in Mice Injected With Submicrogram Quantities of Pseudouridinecontaining mRNA Encoding Erythropoietin, Molecular Therapy, vol. 20 No. 5, 948-953 May 2012.
Kariko, Incorporation of Pseudouridine Into mRNA Yields Superior Nonimmunogenic Vector with Increased Translational Capacity and Biological Stability, Mol Ther. Nov. 2008 ; 16(11): 1833-1840.
Thess, Sequence-engineered mRNA without Chemical Nucleoside Modifications Enables an Effective Protein Therapy in Large Animals, Molecular Therapy, online publication Jun. 30, 2015, pp. 1-9.
Thess, Sequence-engineered mRNA without Chemical Nucleoside Modifications Enables an Effective Protein Therapy in Large Animals, Molecular Therapy, online publication Jun. 30, 2015, supplementary material pp. 1-11.
Kotkowiak, Unlocked Nucleic Acids: Implications of Increased Conformational Flexibility for RNA/DNA Triplex Formation, Biochemical Journal, Sep. 2014, vol. 464, No. 2; pp. 203-211.
Ferri, Aminoacylase I Deficiency Due to ACY1 mRNA Exon Skipping, Clinical Genetics, Nov. 17, 2013, vol. 86, No. 4; pp. 367-372.
Campbell, Locked vs. unlocked nucleic acids (LNA vs. UNA): contrasting structures work towards common therapeutic goals, Chem Soc Rev, 2011, vol. 40, pp. 5680-5689.
Collins, Generation and initial analysis of more than 15,000 full-length human and mouse cDNA sequences, Proc Nat Academy Sci, 2002, vol. 99, pp. 16899-16903.
Seth, RNAi-based Therapeutics Targeting Survivin and PLK1 for Treatment of Bladder Cancer, Molecular Therapy, 2011, vol. 19, pp. 928-935.
Lucchiari, Molecular Characterisation of GSD III Subjects and Identification of Six Novel Mutations in AGL, Human Mutation, 2002, #564 Online, pp. 1-6.

* cited by examiner

Untreated nGFP-$A_{30}$ Mock Ligated nGFP-$A_{30}$ Ligated nGFP-$A_{30}$

MESSENGER UNA MOLECULES AND USES THEREOF

SEQUENCE LISTING

This application includes a Sequence Listing submitted electronically herewith as an ASCII file created on Nov. 7, 2017, named ARC3146US2_SL.txt, which is 347,990 bytes in size, and is hereby incorporated by reference in its entirety.

BACKGROUND OF THE INVENTION

It has long been difficult to utilize messenger RNA molecules in medicines. Synthetic mRNA can be designed with inherent translational activity for making an active protein, which could be used in various therapeutic strategies. However, the expression of protein involves a number of steps that are localized and/or regulated. Further, plentiful RNase enzymes can degrade mRNA. Moreover, use of a synthetic mRNA requires clinical formulation and delivery to cells. These steps of mRNA delivery, partitioning and dynamics increase the need for stability and longevity of the synthetic mRNA.

For efficient translation, natural mRNA transcripts incorporate a 5' 7-methylguanosine cap and a 3' polyA tail. PolyA binding proteins (PABPs) bind to the tail and cooperate with the 5' cap via looping interactions to recruit the machinery of translation. A 3' polyA tail of at least about 20 nucleotides is needed to activate the mRNA for translation. Translational activity can decrease to low levels in the absence of either the 5' cap or the 3' polyA tail.

One drawback in using mRNA molecules in medicines is that the lifetime of the molecule in the cytoplasm of mammalian cells is relatively short. In general, ubiquitous mRNA degradation pathways actively clear out transcripts from the mRNA pool. The principle pathways for mRNA degradation involve deadenylation or trimming of the 3' polyA tail by 3'-exoribonucleases and cleavage of the 5'-5' triphosphate linkage that attaches the methylguanosine cap by a decapping complex.

One way to increase mRNA longevity might be to increase 3'-nuclease resistance by incorporating nucleotide analogues or chemical modifications in either the phosphodiester backbone or the nucleotides, which are localized to the 3' end to be compatible with enzymatic synthesis and efficient translation. A drawback of this approach is that it may not be possible to selectively incorporate such chemical modifications at 3' termini, or to retain activity.

There is an urgent need for molecules, structures and compositions having specific translational activity to provide active peptides and proteins, both in vitro and in vivo. Such new molecules having functional cytoplasmic half-life for producing active peptides and proteins can yield new drug molecules, therapeutic modalities, vaccines, and immunotherapies.

What is needed are translatable molecules that have increased specific activity and/or lifetime over native mRNA, to be used in methods and compositions for producing and delivering active peptides and proteins in medicines.

BRIEF SUMMARY

This invention relates to the fields of molecular biology and genetics, as well as to biopharmaceuticals and therapeutics generated from translatable molecules. More particularly, this invention relates to methods, structures and compositions for molecules having translational activity for making active peptides or proteins in vivo.

This invention provides methods and compositions for novel molecules having translational activity, which can be used to provide active peptides and proteins.

The molecules of this invention can have functional cytoplasmic half-life for producing peptides and proteins. The peptides and proteins can be active for therapeutic modalities, as well as in vaccines and immunotherapies.

The molecules of this invention can be translatable messenger molecules, which can have long half-life, particularly in the cytoplasm of a cell. The longer duration of the translatable messenger molecules of this invention can be significant for providing a translation product that is active for ameliorating, preventing or treating various diseases. The diseases can be associated with undesirable modulation of protein concentration, or undesirable activity of a protein.

This disclosure provides a range of structures for translatable molecules that have increased specific activity and/or lifetime over native mRNA. The translatable molecules of this invention can be used in medicines, and for methods and compositions for producing and delivering active peptides and proteins.

Embodiments of this disclosure provide a wide range of novel, translatable messenger molecules. The translatable messenger molecules can contain monomers that are unlocked nucleomonomers (UNA monomers). The long duration of translatable messenger UNA molecules (mUNA molecules) of this invention can be useful for providing an active peptide or protein translation product. The mUNA molecules of this invention can be used in medicines for ameliorating, preventing or treating disease.

The translatable mUNA molecules of this invention can be used to provide peptides or proteins in vitro, ex vivo, or in vivo.

The translatable mUNA molecules of this invention can provide high-efficiency expression of virtually any protein.

In some embodiments, the mUNA molecules of this invention have increased cytoplasmic half-life over a native, mature mRNA that provides the same peptide or protein. The mUNA structures and compositions of this invention can provide increased functional half-life with respect to native, mature mRNAs.

In further aspects, a mUNA molecule of this invention can provide increased activity as a drug providing a peptide or protein product, as compared to a native, mature mRNA. In some embodiments, a mUNA molecule can reduce the expected dose level that would be required for efficacious therapy.

Additional embodiments of this invention can provide vaccine compositions for immunization and immunotherapies using mUNA molecules.

Embodiments of this invention include the following:

A mUNA molecule, containing one or more UNA monomers, and containing nucleic acid monomers, wherein the mUNA molecule is translatable to express a polypeptide or protein. The molecule may have from 200 to 12,000 monomers, or from 200 to 4,000 monomers. In some embodiments, the molecule can have from 1 to 8,000 UNA monomers, or from 1 to 100 UNA monomers, or from 1 to 20 UNA monomers.

A mUNA molecule can have one or more modified nucleic acid nucleotides, and/or one or more chemically-modified nucleic acid nucleotides.

In some embodiments, a mUNA molecule can contain a 5' cap, a 5' untranslated region of monomers, a coding region of monomers, a 3' untranslated region of monomers, and a tail region of monomers. In certain embodiments, the molecule can contain a translation enhancer in a 5' or 3' untranslated region.

The mUNA molecules of this invention can be translatable in vivo, or in vitro, or in a mammalian cell, or in a human in vivo. In some embodiments, a translation product of a mUNA molecule can be an active peptide or protein.

In certain embodiments, a translation product of a mUNA molecule is human EPO, human Factor IX, human alpha-1-antitrypsin, human CFTR, human ASL, human PAH, human NIS, or human hepcidin.

In another aspect, a mUNA molecule can exhibit at least 2-fold, 3-fold, 5-fold, or 10-fold increased translation efficiency in vivo as compared to a native mRNA that encodes the same translation product.

In certain embodiments, a mUNA molecule can have a cytoplasmic half-life in a cell at least 2-fold greater than a native mRNA of the cell that encodes the same translation product.

Embodiments of this invention further contemplate therapeutic mUNA agents for a rare disease, a liver disease, or a cancer. A mUNA molecule can be an immunization agent or vaccine component for a rare disease, a liver disease, or a cancer.

This invention further provides compositions containing a mUNA molecule and a pharmaceutically acceptable carrier, and vaccine or immunization compositions containing a mUNA molecule. The carrier can be a nanoparticle or liposome.

In additional embodiments, this invention provides methods for ameliorating, preventing or treating a disease or condition in a subject comprising administering to the subject a composition containing a mUNA molecule. The disease or condition can be a rare disease, liver disease, or cancer.

In certain embodiments, this invention provides methods for producing a polypeptide or protein in vivo, by administering to a mammal a composition containing a mUNA molecule. The polypeptide or protein may be deficient in a disease or condition of a subject or mammal. The protein can be human EPO, human Factor IX, human alpha-1-antitrypsin, human CFTR, human ASL, human PAH, human NIS, or human hepcidin.

This invention further provides methods for producing a polypeptide or protein in vitro, by transfecting a cell with a mUNA molecule. The polypeptide or protein can be deficient in a disease or condition of a subject or mammal. The protein can be human EPO, human Factor IX, human alpha-1-antitrypsin, human CFTR, human ASL, human PAH, human NIS, or human hepcidin.

BRIEF DESCRIPTION OF THE DRAWINGS

FIG. 1 shows the results of expressing human Factor IX (F9) in vivo using a translatable mUNA molecule of this invention, as compared to expression of a native mRNA of Factor IX. FIG. 1 shows that the translation efficiency of this mUNA molecule was doubled as compared to the native mRNA of F9. The mUNA molecule of this embodiment was translated in C57BL/c mouse to produce human F9.

FIG. 2 shows the results of expressing human Factor IX (F9) in vitro using a translatable mUNA molecule of this invention, as compared to expression of a native mRNA of Factor IX. FIG. 2 shows that the translation efficiency of this mUNA molecule was increased by 5-fold after 48 hours, as compared to the native mRNA of F9. The mUNA molecule of this embodiment was translated in mouse hepatocyte cell line Hepa1-6 to produce human F9.

FIG. 3 shows the results of expressing human Erythropoietin (EPO) in vitro using a translatable mUNA molecule of this invention, as compared to expression of a native mRNA of human EPO. FIG. 3 shows that the translation efficiency of this mUNA molecule was increased nearly 3-fold after 48 hours, as compared to the native mRNA of EPO. The mUNA molecule of this embodiment was translated in mouse hepatocyte cell line Hepa1-6 to produce human EPO.

FIG. 4 shows the results of expressing mouse Erythropoietin (EPO) in vitro using several translatable mUNA molecules of this invention, as compared to expression of a native mRNA of mouse EPO. FIG. 4 shows that the translation efficiencies of the mUNA molecules (#2, 3, 4, 5, 6, 7, 8, 9, 10 and 11) were increased by up to 10-fold after 72 hours, as compared to the native mRNA of EPO. The mUNA molecules of this embodiment were translated in mouse hepatocyte cell line Hepa1-6 to produce mouse EPO.

FIG. 5 shows the results of expressing human alpha-1-antitrypsin in vivo using a translatable mUNA molecule of this invention, as compared to expression of a native mRNA of human alpha-1-antitrypsin. FIG. 5 shows that the translation efficiency of this mUNA molecule at 72 hrs was increased more than 3-fold as compared to the native mRNA of human alpha-1-antitrypsin. The mUNA molecule of this embodiment was translated in C57BL/c mouse to produce human alpha-1-antitrypsin.

FIG. 6 shows the results of expressing human erythropoietin (EPO) in vivo using a translatable mUNA molecule of this invention, as compared to expression of a native mRNA of human EPO. FIG. 6 shows that the translation efficiency of this mUNA molecule at 72 hrs was increased more than 10-fold as compared to the native mRNA of human EPO. The mUNA molecule of this embodiment was translated in C57BL/c mouse to produce human EPO.

FIG. 7 shows the primary structure of a functional mRNA transcript in the cytoplasm. The mRNA includes a 5' methylguanosine cap, a protein coding sequence flanked by untranslated regions (UTRs), and a polyadenosine (polyA) tail bound by polyA binding proteins (PABPs).

FIG. 8 shows the 5' cap and PABPs cooperatively interacting with proteins involved in translation to facilitate the recruitment and recycling of ribosome complexes.

FIG. 9 shows the splint-mediated ligation scheme, in which an acceptor RNA with a 30-monomer stub polyA tail (A(30)) was ligated to a 30-monomer donor oligomer A(30). The splint-mediated ligation used a DNA oligomer splint which was complementary to the 3' UTR sequence upstream of the stub polyA tail, and included a 60-monomer oligo(dT) 5' heel (T(60)) to splint the ligation. The anchoring region of the splint was complementary to the UTR sequence to ensure that a 5' $dT_{30}$ overhang was presented upon hybridization to the acceptor. This brings the donor oligomer into juxtaposition with the 3' terminus of the stub tail, dramatically improving the kinetics of ligation.

FIG. 10 shows experimental results of splint-mediated ligation of a donor oligomer to an acceptor. FIG. 10 shows the results of ligation using 2 ug of a 120-monomer acceptor with an $A_{30}$ stub tail that was ligated to a 5'-phosphorylated $A_{30}$ RNA donor oligomer using T4 RNA Ligase 2. The reaction was incubated overnight at 37° C. The ligation and a mock reaction done without enzyme were purified, treated with DNAse I for 1 hour to degrade and detach the splint oligomers, and re-purified in a volume of 30 uL. The ligation efficiency was nearly 100%. The absence of a size shift in the mock-reaction prep shows that the acceptor and donor were truly ligated and not simply held together by undigested splint oligomers.

FIG. 11 shows the results of splint-mediated ligation using an acceptor RNA with a 30-monomer stub polyA tail (A(30)). The ligation reactions were performed with three different donor oligomer species: A(30), A(60), and A(120). Based on the gel shifts, the ligations have attained nearly 100% efficiency.

FIG. 12 shows the results of one-hour splint-mediated ligations that were performed on nGFP-$A_{30}$ transcripts. The resulting ligation products were compared to untreated transcripts and native nGFP-$A_{60}$ IVT products. The native nGFP-$A_{60}$ and the ligated products were up-shifted on the gel relative to the untreated nGFP-$A_{30}$ transcripts and mock-ligated material, showing that the ligation yield was nearly 100%.

FIG. 13 shows increased lifetime and translational activity for an nGFP-$A_{60}$ ligation product. In FIG. 13, nuclearized transcripts were transfected into fibroblasts, and a comparison of fluorescence signals was made for nGFP-$A_{30}$, mock-ligated nGFP-$A_{30}$, and an nGFP-$A_{60}$ ligation product (FIG. 13, left to right). The significantly higher fluorescence signal observed for the nGFP-$A_{60}$ ligation product shows that it has markedly increased translational activity.

FIG. 14 shows the results of a ligation performed with a 100-monomer acceptor RNA that was treated for 3 hours at room temperature with T4 RNA Ligase 2 (truncated KQ mutant) using a 10 uM concentration of a polyA tail 30-monomer donor oligomer. 15% PEG 8000 was included in the reaction as a volume excluder to promote efficient ligation. The ligation reaction showed that a high molecular weight product was formed, having a size in between the 100-monomer acceptor RNA and a 180-monomer RNA transcript included as a size standard. These results show that the ligation reaction produced a predominant product having high molecular weight with nearly 100% ligation of the donor to the acceptor. Additional experiments with concentrations of the polyA tail at 10 uM, 20 uM, and 40 uM showed that from about 50% to about 100% of the acceptor RNA was ligated.

DETAILED DESCRIPTION OF THE INVENTION

Figure 1:
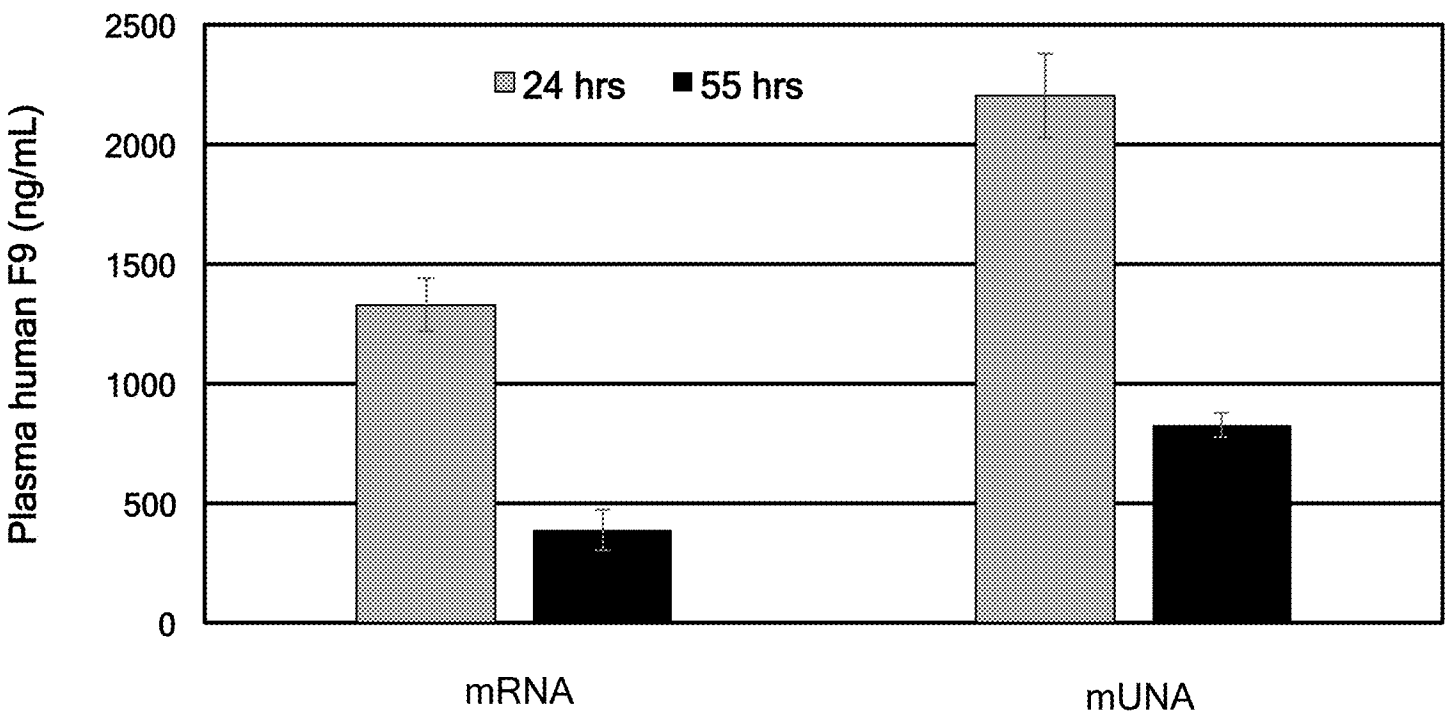
FIG. 1.

This invention provides a range of novel agents and compositions to be used for therapeutic applications. The molecules and compositions of this invention can be used for ameliorating, preventing or treating various diseases associated with genomic functionalities.

The molecules of this invention can be translatable messenger UNA molecules, which can have long half-life, particularly in the cytoplasm. The long duration mUNA molecules (mUNA molecules) can be used for ameliorating, preventing or treating various diseases associated with undesirable modulation of protein concentration, or activity of a protein.

The properties of the mUNA compounds of this invention arise according to their molecular structure, and the structure of the molecule in its entirety, as a whole, can provide significant benefits based on those properties. Embodiments of this invention can provide mUNA molecules having one or more properties that advantageously provide enhanced effectiveness in regulating protein expression or concentration, or modulating protein activity. The molecules and compositions of this invention can provide formulations for therapeutic agents for various diseases and conditions, which can provide clinical agents.

This invention provides a range of mUNA molecules that are surprisingly translatable to provide active peptide or protein, in vitro and in vivo.

The mUNA structures and compositions can have increased translational activity and cytoplasmic half-life. In these embodiments, the mUNA structures and compositions can provide increased functional half-life in the cytoplasm of mammalian cells over native mRNA molecules. The inventive mUNA molecules can have increased half-life of activity with respect to a corresponding native mRNA.

A wide range of novel mUNA molecules are provided herein, each of which can incorporate specialized linker groups. The linker groups can be attached in a chain in the mUNA molecule. Each linker group can also be attached to a nucleobase.

In some aspects, a linker group can be a monomer. Monomers can be attached to form a chain molecule. In a chain molecule of this invention, a linker group monomer can be attached at any point in the chain.

In certain aspects, linker group monomers can be attached in a chain molecule of this invention so that the linker group monomers reside near the ends of the chain, or at any position in the chain.

As used herein, a chain molecule can also be referred to as an oligomer.

In further aspects, the linker groups of a chain molecule can each be attached to a nucleobase. The presence of nucleobases in the chain molecule can provide a sequence of nucleobases in the chain molecule.

In certain embodiments, this invention provides oligomer mUNA molecules having chain structures that incorporate novel combinations of the linker group monomers, along with certain natural nucleotides, or non-natural nucleotides, or modified nucleotides, or chemically-modified nucleotides.

The oligomer mUNA molecules of this invention can display a sequence of nucleobases, and can be designed to express a polypeptide or protein, in vitro, ex vivo, or in vivo. The expressed polypeptide or protein can have activity in various forms, including activity corresponding to protein expressed from natural mRNA, or activity corresponding to a negative or dominant negative protein.

In some aspects, this invention can provide active mUNA oligomer molecules having a base sequence that corresponds to at least a fragment of a native nucleic acid molecule of a cell.

In some embodiments, the cell can be a eukaryotic cell, a mammalian cell, or a human cell.

This invention provides structures, methods and compositions for oligomeric mUNA agents that incorporate the linker group monomers. The oligomeric molecules of this invention can be used as active agents in formulations for therapeutics.

This invention provides a range of mUNA molecules that are useful for providing therapeutic effects because of their longevity of activity in providing an expressed peptide or protein.

In certain embodiments, an active mUNA molecule can be structured as an oligomer composed of monomers. The oligomeric structures of this invention may contain one or more linker group monomers, along with certain nucleotides.

An expressed peptide or protein can be modified or mutated as compared to a native variant, or can be a homolog or ortholog for enhanced expression in a eukaryotic cell. An active mUNA molecule can be human codon optimized. Methodologies for optimizing codons are known in the art.

In certain embodiments, a mUNA molecule may contain a sequence of nucleobases, and can be designed to express a peptide or protein of any isoform, in part by having sufficient homology with a native polynucleotide sequence.

In some embodiments, a mUNA molecule can be from about 200 to about 12,000 monomers in length, or more. In certain embodiments, a mUNA molecule can be from 200 to 12,000 monomers in length, or 200 to 10,000 monomers, or 200 to 8,000 monomers, or 200 to 6000 monomers, or 200 to 5000 monomers, or 200 to 4000 monomers, or 200 to 3600 monomers, or 200 to 3200 monomers, or 200 to 3000 monomers, or 200 to 2800 monomers, or 200 to 2600 monomers, or 200 to 2400 monomers, or 200 to 2200 monomers, or 600 to 3200 monomers, or 600 to 3000 monomers, or 600 to 2600 monomers.

In some embodiments, a mUNA molecule can contain from 1 to about 8,000 UNA monomers. In certain embodiments, a mUNA molecule can contain from 1 to 8,000 UNA monomers, or 1 to 6,000 UNA monomers, or 1 to 4,000 UNA monomers, or 1 to 3,000 UNA monomers, or 1 to 2,000 UNA monomers, or 1 to 1,000 UNA monomers, or 1 to 500 UNA monomers, or 1 to 300 UNA monomers, or 1 to 200 UNA monomers, or 1 to 100 UNA monomers, or 1 to 50 UNA monomers, or 1 to 40 UNA monomers, or 1 to 30 UNA monomers, or 1 to 20 UNA monomers, or 1 to 10 UNA monomers, or 1 to 6 UNA monomers.

In some embodiments, a mUNA molecule can be from about 200 to about 12,000 bases in length, or more. In certain embodiments, a mUNA molecule can be from 200 to 12,000 bases in length, or 200 to 10,000 bases, or 200 to 8,000 bases, or 200 to 6000 bases, or 200 to 5000 bases, or 200 to 4000 bases, or 200 to 3600 bases, or 200 to 3200 bases, or 200 to 3000 bases, or 200 to 2800 bases, or 200 to 2600 bases, or 200 to 2400 bases, or 200 to 2200 bases, or 600 to 3200 bases, or 600 to 3000 bases, or 600 to 2600 bases.

A mUNA molecule of this invention may comprise a 5' cap, a 5' untranslated region of monomers, a coding region of monomers, a 3' untranslated region of monomers, and a tail region of monomers. Any of these regions of monomers may comprise one or more UNA monomers.

A mUNA molecule of this invention may comprise a 5' untranslated region of monomers containing one or more UNA monomers.

A mUNA molecule of this invention may comprise a coding region of monomers containing one or more UNA monomers.

A mUNA molecule of this invention may comprise a 3' untranslated region of monomers containing one or more UNA monomers.

A mUNA molecule of this invention may comprise a tail region of monomers containing one or more UNA monomers.

A mUNA molecule of this invention may comprise a 5' cap containing one or more UNA monomers.

A mUNA molecule of this invention can be translatable, and may comprise regions of sequences or structures that are operable for translation in a cell, or which have the functionality of regions of an mRNA including, for example, a 5' cap, a 5' untranslated region, a coding region, a 3' untranslated region, and a polyA tail.

This invention further contemplates methods for delivering one or more vectors, or one or more mUNA molecules to a cell.

In some embodiments, one or more mUNA molecules can be delivered to a cell, in vitro, ex vivo, or in vivo. Viral and non-viral transfer methods as are known in the art can be used to introduce mUNA molecules in mammalian cells. mUNA molecules can be delivered with a pharmaceutically acceptable vehicle, or for example, encapsulated in a liposome.

A peptide or protein expressed by a mUNA molecule can be any peptide or protein, endogenous or exogenous in nature with respect to a eukaryotic cell, and may be a synthetic or non-natural peptide or protein with activity or effect in the cell.

In some embodiments, mUNA structures and compositions of this invention can reduce the number and frequency of transfections required for cell-fate manipulation in culture as compared to utilizing native compositions.

In additional aspects, this invention provides increased activity for mUNA-based drugs as compared to utilizing native compositions, and can reduce the dose levels required for efficacious therapy.

In further aspects, this invention provides increased activity for mUNA-based molecules, as compared to utilizing a native mRNA as active agent.

In some aspects, this invention can provide mUNA molecules that may reduce the cellular innate immune response, as compared to that induced by a natural nucleic acid, peptide or protein.

In further aspects, embodiments of this invention can provide increased efficacy for single-dose therapeutic modalities, including mUNA immunization and immunotherapies.

This invention can provide synthetic mUNA molecules that are refractory to deadenylation as compared to native molecules.

In certain embodiments, this invention can provide synthetic mUNA molecules with increased specific activity and longer functional half-life as compared to native molecules. The synthetic mUNA molecules of this invention can provide increased levels of ectopic protein expression. When using a mUNA molecule as a vector, cellular-delivery can be at increased levels, and cytotoxic innate immune responses can be restrained so that higher levels of ectopic protein expression can be achieved. The mUNA molecules of this invention can have increased specific activity and longer functional half-life than mRNAs.

In certain aspects, a mUNA molecule may have a number of mutations from a native mRNA, or from a disease associated mRNA.

In further embodiments, this invention can provide mUNA molecules having cleavable delivery and targeting moieties attached at the 3' end.

In general, the specific activity for a synthetic translatable molecule delivered by transfection can be viewed as the number of molecules of protein expressed per delivered transcript per unit time.

As used herein, translation efficiency refers to a measure of the production of a protein or polypeptide by translation of a messenger molecule in vitro or in vivo.

This invention provides a range of mUNA molecules, which can contain one or more UNA monomers, and a number of nucleic acid monomers, wherein the mUNA molecule can be translated to express a polypeptide or protein.

In some embodiments, this invention includes a range of mUNA molecules, which contain one or more UNA monomers in one or more untranslated regions, and a number of nucleic acid monomers, wherein the mUNA molecule can be translated to express a polypeptide or protein.

In some embodiments, this invention includes a range of mUNA molecules, which contain one or more UNA monomers in a tail region or monomers, and a number of nucleic acid monomers, wherein the mUNA molecule can be translated to express a polypeptide or protein.

In some embodiments, a mUNA molecule can contain a modified 5' cap.

In some embodiments, a mUNA molecule can contain one ore more UNA monomers in a 5' cap.

In further embodiments, a mUNA molecule can contain a translation enhancing 5' untranslated region of monomers.

In further embodiments, a mUNA molecule can contain one or more UNA monomers in a 5' untranslated region.

In additional embodiments, a mUNA molecule can contain a translation enhancing 3' untranslated region of monomers.

In additional embodiments, a mUNA molecule can contain one or more UNA monomers in a 3' untranslated region of monomers.

In additional embodiments, a mUNA molecule can contain one or more UNA monomers in a tail region of monomers.

In additional embodiments, a mUNA molecule can contain one or more UNA monomers in a polyA tail.

In another aspect, a mUNA molecule can exhibit at least 2-fold, 3-fold, 5-fold, or 10-fold increased translation efficiency in vivo as compared to a native mRNA that encodes the same translation product.

In another aspect, a mUNA molecule can produce at least 2-fold, 3-fold, 5-fold, or 10-fold increased polypeptide or protein in vivo as compared to a native mRNA that encodes the same polypeptide or protein.

In additional embodiments, this invention provides methods for treating a rare disease or condition in a subject by administering to the subject a composition containing a mUNA molecule.

In additional embodiments, this invention provides methods for treating a liver disease or condition in a subject by administering to the subject a composition containing a mUNA molecule.

Modalities for Peptides and Proteins

A mUNA molecule of this invention may be used for ameliorating, preventing or treating a disease through enzyme modulation or replacement. In these embodiments, a mUNA molecule of this invention can be administered to regulate, modulate, increase, or decrease the concentration or effectiveness of a natural enzyme in a subject.

In some aspects, the enzyme can be an unmodified, natural enzyme for which the patient has an abnormal quantity.

In some embodiments, a mUNA molecule can be delivered to cells or subjects, and translated to supply increased levels of the natural enzyme.

A mUNA molecule of this invention may be used for ameliorating, preventing or treating a disease through modulation or introduction of a peptide or protein. In these embodiments, a mUNA molecule of this invention can be administered to regulate, modulate, increase, or decrease the concentration or effectiveness of a peptide or protein in a subject, where the peptide or protein is non-natural or mutated, as compared to a native peptide or protein.

In some aspects, the peptide or protein can be a modified, non-natural, exogenous, or synthetic peptide or protein, which has a pharmacological effect in a subject.

In some embodiments, a mUNA molecule can be delivered to cells or subjects, and translated to supply a concentration of the peptide or protein.

Examples of diseases for enzyme modulation include lysosomal diseases, for example, Gaucher disease, Fabry disease, Mucopolysaccharidoses (MPS) and related diseases including MPS I, MPS II (Hunter syndrome), and MPS VI, as well as Glycogen storage disease type II.

Examples of diseases for enzyme modulation include hematologic diseases, for example, sickle-cell disease, thalassemia, methemoglobinemia, anemia due to deficiency of hemoglobin or $B_{12}$ intrinsic factor, spherocytosis, glucose-6-phosphate dehydrogenase deficiency, and pyruvate kinase deficiency.

Examples of diseases for enzyme modulation include hemophilia, Von Willebrand disease, Protein S deficiency, age-related macular degeneration, trinucleotide repeat disorders, muscular dystrophy, insertion mutation diseases, DNA repair-deficiency disorders, and deletion mutation diseases.

Rare Diseases

Examples of diseases and/or conditions for which the mUNA molecules of this invention can be translatable to provide an active agent include those in Table 1.

TABLE 1

Rare diseases

| RARE DISEASE | DEFICIENCY |
|---|---|
| Aminoacylase 1 deficiency | Aminoacylase 1 |
| Apo A-I deficiency | Apo A-I |
| Carbamoyl phosphate synthetase 1 deficiency | Carbamoyl phosphate synthetase 1 |
| Ornithine transcarbamylase deficiency | Ornithine transcarbamylase |
| Plasminogen activator inhibitor type 1 deficiency | Plasminogen activator inhibitor type 1 |
| Flaujeac factor deficiency | Flaujeac factor (High-molecular-weight kininogen) |
| High-molecular-weight kininogen deficiency congenital | High-molecular-weight kininogen (Flaujeac factor) |
| PEPCK 1 deficiency | PEPCK 1 |
| Pyruvate kinase deficiency liver type | Pyruvate kinase liver type |
| Alpha 1-antitrypsin deficiency | Alpha 1-antitrypsin |
| Anti-plasmin deficiency congenital | Anti-plasmin |
| Apolipoprotein C 2I deficiency | Apolipoprotein C 2I |

TABLE 1-continued

| Rare diseases | |
|---|---|
| RARE DISEASE | DEFICIENCY |
| Butyrylcholinesterase deficiency | Butyrylcholinesterase |
| Complement component 2 deficiency | Complement component 2 |
| Complement component 8 deficiency type 2 | Complement component 8 type 2 |
| Congenital antithrombin deficiency type 1 | Antithrombin |
| Congenital antithrombin deficiency type 2 | Antithrombin, type 2 |
| Congenital antithrombin deficiency type 3 | Antithrombin, type 3 |
| Cortisone reductase deficiency 1 | Cortisone reductase |
| Factor VII deficiency | Factor VII |
| Factor X deficiency | Factor X |
| Factor XI deficiency | Factor XI |
| Factor XII deficiency | Factor XII |
| Factor XIII deficiency | Factor XIII |
| Fibrinogen deficiency congenital | Fibrinogen |
| Fructose-1 6-bisphosphatase deficiency | Fructose-1 6-bisphosphatase |
| Gamma aminobutyric acid transaminase deficiency | Gamma aminobutyric acid transaminase |
| Gamma-cystathionase deficiency | Gamma-cystathionase |
| Glut2 deficiency | Glut2 |
| GTP cyclohydrolase I deficiency | GTP cyclohydrolase I |
| Isolated growth hormone deficiency type 1B | Isolated growth hormone type 1B |
| Molybdenum cofactor deficiency | Molybdenum cofactor |
| Prekallikrein deficiency congenital | Prekallikrein |
| Proconvertin deficiency congenital | Proconvertin |
| Protein S deficiency | Protein S |
| Pseudocholinesterase deficiency | Pseudocholinesterase |
| Stuart factor deficiency congenital | Stuart factor |
| Tetrahydrobiopterin deficiency | Tetrahydrobiopterin |
| Type 1 plasminogen deficiency | Plasminogen |
| Urocanase deficiency | Urocanase |
| Chondrodysplasia punctata with steroid sulfatase deficiency | Chondrodysplasia punctata with steroid sulfatase/X-linked chondrodysplasia punctata 1 |
| Homocystinuria due to CBS deficiency | CBS |
| Guanidinoacetate methyltransferase deficiency | Guanidinoacetate methyltransferase |
| Pulmonary surfactant protein B deficiency | Pulmonary surfactant protein B |
| Aminoacylase 1 deficiency | Aminoacylase 1 |
| Acid Sphingomyelinase Deficiency | Enzyme found in lysosomes, responsible for conversion of lipid sphingomyelin into lipid ceramide |
| Adenylosuccinate Lyase Deficiency | Neurological disorder, brain dysfunction (encephalopathy) and to delayed development of mental and movement abilities, autistic behaviors and seizures |
| Aggressive Angiomyxoma | Myxoid tumor involving the blood vessels, may be a non-metastasizing benign tumor |
| Albrights Hereditary Osteodystrophy | Inherited in an autosomal dominant pattern, lack of responsiveness to parathyroid hormone, low serum calcium, high serum phosphate |
| Carney Stratakis Syndrome | Very rare syndrome characterized by gastrointestinal stromal tumors and paragangliomas. |
| Carney Triad Syndrome | Characterized by the coexistence of 3 types of neoplasms, mainly in young women, including gastric gastrointestinal stromal tumor, pulmonary chondroma, and extra-adrenal paraganglioma |
| CDKL5 Mutation | Results in severe neurodevelopmental impairment and early onset, difficult to control seizures |
| CLOVES Syndrome | Complex vascular anomalies: Congenital, Lipomatous Overgrowth, Vascular malformations, Epidermal nevi and Scoliosis/Skeletal/Spinal anomalies |
| Cockayne Syndrome | Characterized by short stature and an appearance of premature aging, failure to gain weight, abnormally small head size, and impaired development of the nervous system |

TABLE 1-continued

| Rare diseases | |
|---|---|
| RARE DISEASE | DEFICIENCY |
| Congenital Disorder of Glycosylation type 1R | Rare inborn errors of metabolism involving deficient or defective glycosylation |
| Cowden Syndrome | Characterized by multiple noncancerous, tumor-like growths called hamartomas and an increased risk of developing certain cancers |
| DEND Syndrome | Generally severe form of neonatal diabetes mellitus characterized by a triad of developmental delay, epilepsy, and neonatal diabetes |
| Dercum's Disease | Characterized by multiple, and painful lipomas. These lipomas mainly occur on the trunk, the upper arms and upper legs |
| Febrile Infection-Related Epilepsy Syndrome | Explosive-onset, potentially fatal acute epileptic encephalopathy, develops in previously healthy children and adolescents following the onset of a non-specific febrile illness |
| Fibular Aplasia Tibial Campomelia Oligosyndactyly Syndrome | Unknown genetic basis and inheritance with variable expressivity and penetrance |
| Food Protein-Induced Enterocolitis Syndrome | A non-IgE mediated immune reaction in the gastrointestinal system to one or more specific foods, commonly characterized by profuse vomiting and diarrhea |
| Foreign Body Giant Cell Reactive Tissue Disease | Collection of fused macrophages which are generated in response to the presence of a large foreign body; particularly evident with implants that cause the body chronic inflammation and foreign body response |
| Galloway-Mowat | Physical features may include an unusually small head and additional abnormalities of the head and facial area; damage to clusters of capillaries in the kidneys resulting in abnormal kidney function; and, in many cases, protrusion of part of the stomach through an abnormal opening in the diaphragm |
| Gitelman syndrome | Autosomal recessive kidney disorder characterized by hypokalemic metabolic alkalosis with hypocalciuria, and hypomagnesemia. |
| Glycerol Kinase Deficiency | X-linked recessive enzyme defect that is heterozygous in nature, responsible gene in a region containing genes in which deletions can cause DMD and adrenal hypoplasia congenita |
| Glycogen Storage Disease type 9 | Caused by the inability to break down glycogen. The different forms of the condition can affect glycogen breakdown in liver cells, muscle cells or both |
| gm1 gangliosidosis | Autosomal recessive lysosomal storage disease characterized by accumulation of ganglioside substrates in lysosomes |
| Hereditary spherocytosis | Affects red blood cells, shortage of red blood cells, yellowing of the eyes and skin, and an enlarged spleen |
| Hidradenitis Suppurativa Stage III | Disorder of the terminal follicular epithelium in the apocrine gland-bearing skin, frequently causing keloids, contractures, and immobility. Stage III is defined as multiple lesions, with more extensive sinus tracts and scarring |
| Horizonatal Gaze Palsy with Progressive Scoliosis | Disorder that affects vision and also causes an abnormal curvature of the spine |
| IMAGe syndrome | The combination of intrauterine growth restriction, metaphyseal dysplasia, adrenal hypoplasia congenita, and genital anomalies (only about 20 cases reported in the medical literature) |
| Isodicentric 15 | Chromosome abnormality in which a child is born with extra genetic material from chromosome 15 |
| isolated hemihyperplasia | One side of the body grows more than other, causing asymmetry |
| Juvenile Xanthogranuloma | Usually benign and self-limiting. It occurs most often in the skin of the head, neck, and trunk but can also occur in the arms, legs, feet, and buttocks |
| Kasabach-Merritt Syndrome | A vascular tumor leads to decreased platelet counts and sometimes other bleeding problems |
| Kniest Dysplasia | Disorder of bone growth characterized by short stature (dwarfism) with other skeletal abnormalities and problems with vision and hearing |

TABLE 1-continued

| Rare diseases | |
|---|---|
| RARE DISEASE | DEFICIENCY |
| Koolen de-Vries Syndrome | Disorder characterized by developmental delay and mild to moderate intellectual disability.They usually have weak muscle tone in childhood. About half have recurrent seizures |
| Lennox-Gastaut syndrome | Type of epilepsy with multiple different types of seizures, particularly tonic (stiffening) and atonic (drop) seizures. Intellectual development is usually, but not always, impaired |
| Lymphangiomatosis | Congenital and can affect any of the body's systems except the central nervous system (including the brain) |
| Lymphangiomiomytosis | Can occur either sporadically or in association with the tuberous sclerosis complex (TSC) and is often considered a forme fruste of TSC |
| MASA Syndrome | X-linked recessive neurological disorder |
| Mast Cell Activation disorder | Condition with signs and symptoms involving the skin, gastrointestinal, cardiovascular, respiratory, and neurologic systems |
| Mecp2 Duplication Syndrome | Genetic neurodevelopmental disorder characterized by low muscle tone, potentially severe intellectual disability, developmental delays, recurrent respiratory infections, speech abnormalities, seizures, and progressive spasticity |
| Mucha Habermann | Skin disorder |
| Neonatal Hemochromatosis | Severe liver disease of fetal or perinatal onset, associated with deposition of stainable iron in extrahepatic sites, disordered iron handling due to injury to the perinatal liver, as a form of fulminant hepatic failure |
| N-glycanase deficiency | The encoded enzyme may play a role in the proteasome-mediated degradation of misfolded glycoproteins |
| Opsoclonus Myoclonus Syndrome | Neurological disorder of unknown causes which appears to be the result of an autoimmune process involving the nervous system |
| Persistent genital arousal disorder | Results in a spontaneous, persistent, and uncontrollable genital arousal, with or without orgasm or genital engorgement, unrelated to any feelings of sexual desire |
| Pompe Disease | Inherited disorder caused by the buildup of glycogen in the body's cells. The accumulation of glycogen in certain organs and tissues, especially muscles, impairs their ability to function normally |
| Progressive Familial Intrahepatic Cholestasis | Disorder that causes progressive liver disease, which typically leads to liver failure. In people with PFIC, liver cells are less able to secrete a digestive fluid called bile. The buildup of bile in liver cells causes liver disease in affected individuals |
| Pseudohypoparathyroidism type 1a | Characterized by renal resistance to parathyroid hormone, resulting in hypocalcemia, hyperphosphatemia, and elevated PTH; resistance to other hormones including thydroid stimulating hormone, gonadotropins and growth-hormone-releasing hormone |
| PTEN Hamartoma Tumor Syndrome | The gene was identified as a tumor suppressor that is mutated in a large number of cancers at high frequency |
| Schnitzler syndrome | Characterised by chronic hives and periodic fever, bone pain and joint pain (sometimes with joint inflammation), weight loss, malaise, fatigue, swollen lymph glands and enlarged spleen and liver |
| Scleroderma | Chronic hardening and tightening of the skin and connective tissues |
| Semi Lobar Holoprosencephany | Holoprosencephany: birth defect of the brain, which often can also affect facial features, including closely spaced eyes, small head size, and sometimes clefts of the lip and roof of the mouth. Semilobar holoprosencephaly is a subtype of holoprosencephaly characterised by an incomplete forebrain division |
| Sjogren's Syndrome | Immune system disorder characterized by dry eyes and dry mouth |
| Specific Antibody Deficiency Disease | Immune |
| SYNGAP 1 | A ras GTPase-activating protein that is critical for the development of cognition and proper synapse function |

TABLE 1-continued

| Rare diseases | |
|---|---|
| RARE DISEASE | DEFICIENCY |
| Trigeminal Trophic Syndrome | This is the wing of tissue at the end of the nose above the nostril. Trigeminal trophic syndrome is due to damage to the trigeminal nerve |
| Undiffentiated Connective Tissue Disease | Systemic autoimmune disease |
| X-linked hypophosphatemia | X-linked dominant form of rickets (or osteomalacia) that differs from most cases of rickets in that ingestion of vitamin D is relatively ineffective. It can cause bone deformity including short stature and genu varum |

Modalities for Immune Modulation

The mUNA molecules of this invention can be translatable to provide an active protein. In certain embodiments, a translatable mUNA molecule can provide an active mRNA immunization agent, or an mRNA vaccine component.

A mUNA vaccine of this disclosure can advantageously provide a safe and efficacious genetic vaccine by inducing an immune response having both cellular and humoral components. In general, protein can be expressed using a mUNA vaccine of this invention.

In some embodiments, a mUNA vaccine can advantageously provide protein synthesis in the cytoplasm. In certain embodiments, a mUNA vaccine of this invention can provide internalization, release and transport of an exogenous mRNA in the cytoplasm.

In certain aspects, a mUNA vaccine of this invention can encode for a protein antigen that can be translated by host cells.

In further aspects, some mUNA vaccines of this disclosure can encode for tumor antigens, viral antigens, or allergens.

Modalities for administering a mUNA vaccine of this invention can include intravenous, intranodal, intradermal, subcutaneous and intrasplenic.

Embodiments of this invention further provide mUNA vaccines having increased half-life of translation, which can be used to reduce the necessary dose and exposure to antigen, and reduce the risk of inducing tolerance.

A mUNA vaccine of this invention can provide an immunological effect without the risk of integration of a component into the genome, and may reduce the risk of mutagenesis as compared to other genetic vaccines.

Additional embodiments of this disclosure include mUNA molecules having translational activity, where the translational activity can be described by a cytoplasmic half-life in a mammalian cell. The half-life can be determined by the time required for 50% of the mUNA molecule to be degraded in the cell.

A translatable mUNA molecule of this invention can be a precursor of an active molecule, which can be used in the treatment of a condition or disease in a subject.

In some embodiments, a translatable mUNA molecule of this invention can be a pharmacologically active molecule having increased half-life in the cytoplasm of mammalian cells.

Examples of mUNA molecules of this invention include a mUNA molecule that provides an mRNA encoding HIV-1 gag antigen, a mUNA molecule that provides an mRNA encoding antigens overexpressed in lung cancers, a mUNA molecule that provides an mRNA encoding malarial *P. falciparum* reticulocyte-binding protein homologue 5 (PfRH5), and a mUNA molecule that provides an mRNA encoding malarial *Plasmodium falciparum* PfSEA-1, a 244 KD malaria antigen expressed in schizont-infected RBCs.

UNA Monomers and Oligomers

In some embodiments, linker group monomers can be unlocked nucleomonomers (UNA monomers), which are small organic molecules based on a propane-1,2,3-tri-yl-trisoxy structure as shown below:

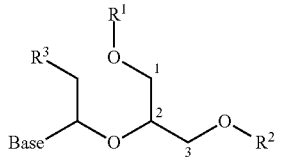

UNA MONOMER where $R^1$ and $R^2$ are H, and $R^1$ and $R^2$ can be phosphodiester linkages, Base can be a nucleobase, and $R^3$ is a functional group described below.

In another view, the UNA monomer main atoms can be drawn in IUPAC notation as follows:

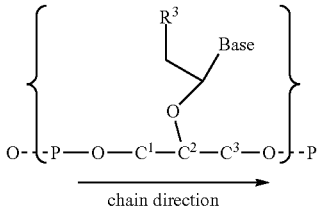

UNA monomer unit where the direction of progress of the oligomer chain is from the 1-end to the 3-end of the propane residue.

Examples of a nucleobase include uracil, thymine, cytosine, 5-methylcytosine, adenine, guanine, inosine, and natural and non-natural nucleobase analogues.

Examples of a nucleobase include pseudouracil, 1-methylpseudouracil, and 5-methoxyuracil.

In general, a UNA monomer, which is not a nucleotide, can be an internal linker monomer in an oligomer. An internal UNA monomer in an oligomer is flanked by other monomers on both sides.

A UNA monomer can participate in base pairing when the oligomer forms a complex or duplex, for example, and there are other monomers with nucleobases in the complex or duplex.

Examples of UNA monomer as internal monomers flanked at both the propane-1-yl position and the propane-3-yl position, where $R^3$ is —OH, are shown below.

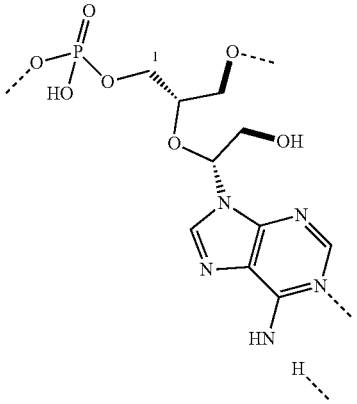

UNA-A

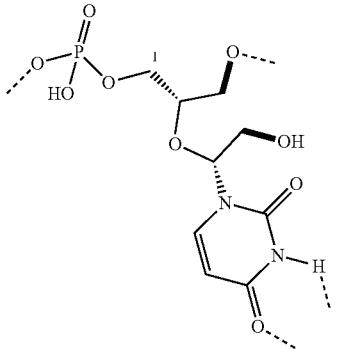

UNA-U

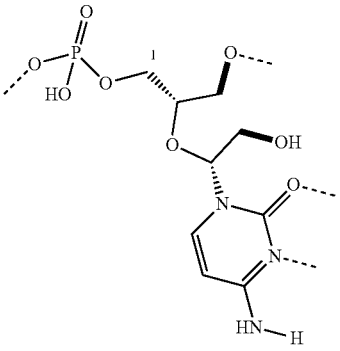

UNA-C

-continued

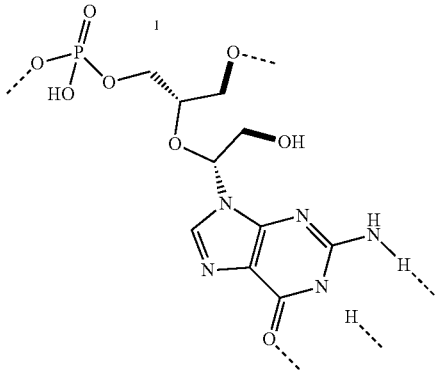

UNA-G

A UNA monomer can be a terminal monomer of an oligomer, where the UNA monomer is attached to only one monomer at either the propane-1-yl position or the propane-3-yl position. Because the UNA monomers are flexible organic structures, unlike nucleotides, the terminal UNA monomer can be a flexible terminator for the oligomer.

Examples of a UNA monomer as a terminal monomer attached at the propane-3-yl position are shown below.

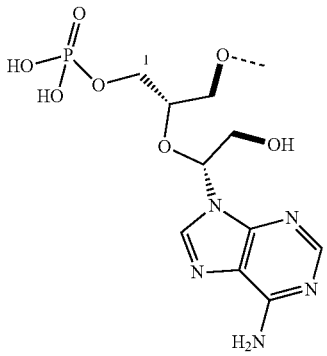

terminal UNA-A

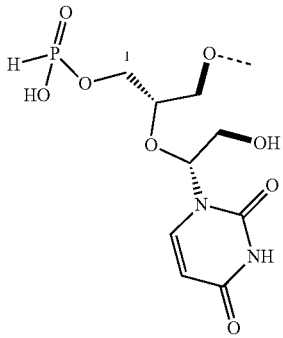

terminal UNA-U

-continued

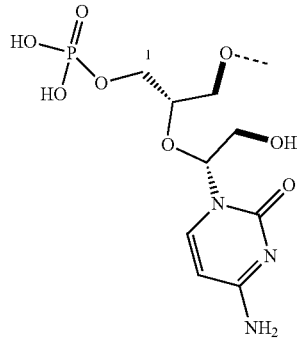

terminal UNA-C

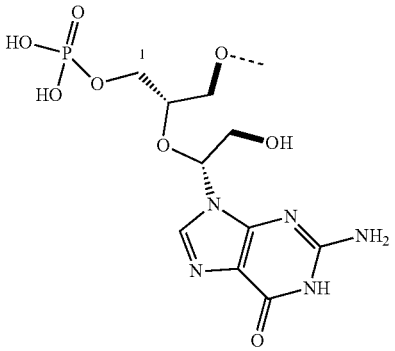

terminal UNA-G

Because a UNA monomer can be a flexible molecule, a UNA monomer as a terminal monomer can assume widely differing conformations. An example of an energy minimized UNA monomer conformation as a terminal monomer attached at the propane-3-yl position is shown below.

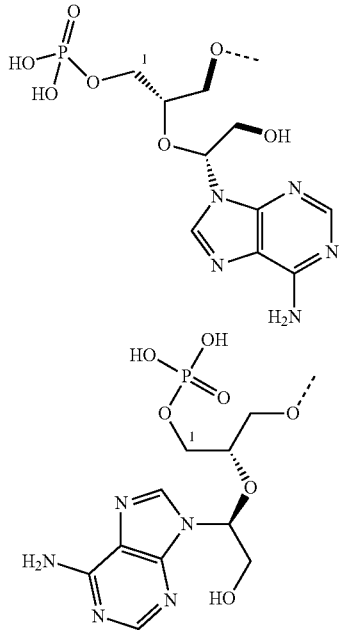

UNA-A terminal forms: the dashed bond shows the propane-3-yl attachment

Among other things, the structure of the UNA monomer allows it to be attached to naturally-occurring nucleotides.

A UNA oligomer can be a chain composed of UNA monomers, as well as various nucleotides that may be based on naturally-occurring nucleosides.

In some embodiments, the functional group $R^3$ of a UNA monomer can be —$OR^4$, —$SR^4$, —$NR^4{}_2$, —NH(C═O)$R^4$, morpholino, morpholin-1-yl, piperazin-1-yl, or 4-alkanoyl-piperazin-1-yl, where $R^4$ is the same or different for each occurrence, and can be H, alkyl, a cholesterol, a lipid molecule, a polyamine, an amino acid, or a polypeptide.

The UNA monomers are organic molecules. UNA monomers are not nucleic acid monomers or nucleotides, nor are they naturally-occurring nucleosides or modified naturally-occurring nucleosides.

A UNA oligomer of this invention is a synthetic chain molecule.

In some embodiments, as shown above, a UNA monomer can be UNA-A (designated Ã), UNA-U (designated Ũ), UNA-C (designated Č), and UNA-G (designated Ğ).

Designations that may be used herein include mA, mG, mC, and mU, which refer to the 2'-O-Methyl modified ribonucleotides.

Designations that may be used herein include dT, which refers to a 2'-deoxy T nucleotide.

Additional Monomers for Oligomers

As used herein, in the context of oligomer sequences, the symbol X represents a UNA monomer. When a mUNA oligomer is complexed or duplexed with a nucleic acid molecule, the UNA monomers of the mUNA oligomer can have any base attached that would be complementary to the monomer with which it is paired in the nucleic acid molecule.

As used herein, in the context of oligomer sequences, the symbol N can represent any natural nucleotide monomer, or any modified nucleotide monomer. When a mUNA oligomer is complexed or duplexed with a nucleic acid molecule, an N monomer of the mUNA oligomer can have any base attached that would be complementary to the monomer with which it is paired in the nucleic acid molecule.

As used herein, in the context of oligomer sequences, the symbol Q represents a non-natural, modified, or chemically-modified nucleotide monomer. When a mUNA oligomer is complexed or duplexed with a nucleic acid molecule, a Q monomer of the mUNA oligomer can have any base attached that would be complementary to the monomer with which it is paired in the nucleic acid molecule.

Examples of nucleic acid monomers include non-natural, modified, and chemically-modified nucleotides, including any such nucleotides known in the art.

Examples of non-natural, modified, and chemically-modified nucleotide monomers include any such nucleotides known in the art, for example, 2'-O-methyl ribonucleotides, 2'-O-methyl purine nucleotides, 2'-deoxy-2'-fluoro ribonucleotides, 2'-deoxy-2'-fluoro pyrimidine nucleotides, 2'-deoxy ribonucleotides, 2'-deoxy purine nucleotides, universal base nucleotides, 5-C-methyl-nucleotides, and inverted deoxyabasic monomer residues.

Examples of non-natural, modified, and chemically-modified nucleotide monomers include 3'-end stabilized nucleotides, 3'-glyceryl nucleotides, 3'-inverted abasic nucleotides, and 3'-inverted thymidine.

Examples of non-natural, modified, and chemically-modified nucleotide monomers include locked nucleic acid nucleotides (LNA), 2'-O,4'-C-methylene-(D-ribofuranosyl)

nucleotides, 2'-methoxyethoxy (MOE) nucleotides, 2'-methyl-thio-ethyl, 2'-deoxy-2'-fluoro nucleotides, and 2'-O-methyl nucleotides.

Examples of non-natural, modified, and chemically-modified nucleotide monomers include 2',4'-Constrained 2'-O-Methoxyethyl (cMOE) and 2'-O-Ethyl (cEt) Modified DNAs.

Examples of non-natural, modified, and chemically-modified nucleotide monomers include 2'-amino nucleotides, 2'-O-amino nucleotides, 2'-C-allyl nucleotides, and 2'-O-allyl nucleotides.

Examples of non-natural, modified, and chemically-modified nucleotide monomers include $N^6$-methyladenosine nucleotides.

Examples of non-natural, modified, and chemically-modified nucleotide monomers include nucleotide monomers with modified bases 5-(3-amino)propyluridine, 5-(2-mercapto)ethyluridine, 5-bromouridine; 8-bromoguanosine, or 7-deazaadenosine.

Examples of non-natural, modified, and chemically-modified nucleotide monomers include 2'-O-aminopropyl substituted nucleotides.

Examples of non-natural, modified, and chemically-modified nucleotide monomers include replacing the 2'-OH group of a nucleotide with a 2'-R, a 2'-OR, a 2'-halogen, a 2'-SR, or a 2'-amino, where R can be H, alkyl, alkenyl, or alkynyl.

Examples of nucleotide monomers include pseudouridine (psi-Uridine) and 1-methylpseudouridine.

Some examples of modified nucleotides are given in Saenger, Principles of Nucleic Acid Structure, Springer-Verlag, 1984.

mUNA Compounds

Aspects of this invention provide structures and compositions for mUNA molecules that are oligomeric compounds. The mUNA compounds can be active agents for pharmaceutical compositions.

An oligomeric mUNA agent of this invention may contain one or more UNA monomers. Oligomeric molecules of this invention can be used as active agents in formulations for supplying peptide and protein therapeutics.

In some embodiments, this invention provides oligomeric mUNA compounds having a structure that incorporates novel combinations of UNA monomers with certain natural nucleotides, non-natural nucleotides, modified nucleotides, or chemically-modified nucleotides.

Oligomeric mUNA compounds of this invention can have a length of from about 200 to about 12,000 bases in length. Oligomeric mUNA compounds of this invention can have a length of about 1800, or about 1900, or about 2000, or about 2100, or about 2200, or about 2300, or about 2400, or about 2500 bases.

In further aspects, the oligomeric mUNA compounds of this invention can be pharmacologically active molecules. A mUNA molecule can be used as an active pharmaceutical ingredient for generating a peptide or protein active agent in vitro, in vivo, or ex vivo.

A mUNA molecule of this invention can have the structure of Formula I

Formula I

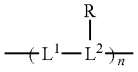

wherein $L^1$ is a linkage, n is from 200 to 12,000, and for each occurrence $L^2$ is a UNA linker group having the formula —$C^1$—$C^2$—$C^3$— where R is attached to $C^2$ and has the formula —$OCH(CH_2R^3)R^5$, where $R^3$ is —$OR^4$, —$SR^4$, —$NR^4{}_2$, —NH(C═O)$R^4$, morpholino, morpholin-1-yl, piperazin-1-yl, or 4-alkanoyl-piperazin-1-yl, where $R^4$ is the same or different for each occurrence and is H, alkyl, a cholesterol, a lipid molecule, a polyamine, an amino acid, or a polypeptide, and where $R^5$ is a nucleobase, or $L^2$(R) is a sugar such as a ribose and R is a nucleobase, or $L^2$ is a modified sugar such as a modified ribose and R is a nucleobase. In certain embodiments, a nucleobase can be a modified nucleobase. $L^1$ can be a phosphodiester linkage.

The base sequence of a mUNA molecule can be any sequence of nucleobases.

In some aspects, a mUNA molecule of this invention can have any number of phosphorothioate intermonomer linkages in any intermonomer location.

In some embodiments, any one or more of the intermonomer linkages of a mUNA molecule can be a phosphodiester, a phosphorothioate including dithioates, a chiral phosphorothioate, and other chemically modified forms.

When a mUNA molecule terminates in a UNA monomer, the terminal position has a 1-end, or the terminal position has a 3-end, according to the positional numbering shown above.

mUNA Molecules with Enhanced Translation

A mUNA molecule of this invention can incorporate a region that enhances the translational efficiency of the mUNA molecule.

In general, translational enhancer regions as known in the art can be incorporated into the structure of a mUNA molecule to increase peptide or protein yields.

A mUNA molecule containing a translation enhancer region can provide increased production of peptide or protein.

In some embodiments, a translation enhancer region can comprise, or be located in a 5' or 3' untranslated region of a mUNA molecule.

Examples of translation enhancer regions include naturally-occurring enhancer regions from TEV 5'UTR and Xenopus beta-globin 3'UTR.

mUNA Molecular Structure and Sequences

A mUNA molecule can be designed to express a target peptide or protein. In some embodiments, the target peptide or protein can be associated with a condition or disease in a subject.

In some aspects, the base sequence of a mUNA molecule can include a portion that is identical to at least an effective portion or domain of a base sequence of an mRNA, where an effective portion is sufficient to impart a therapeutic activity to a translation product of the mUNA molecule.

In some aspects, this invention provides active mUNA oligomer molecules having a base sequence identical to at least a fragment of a native nucleic acid molecule of a cell.

In certain embodiments, the base sequence of a mUNA molecule can include a portion that is identical to a base sequence of an mRNA, except for one or more base mutations. The number of mutations for the mUNA molecule should not exceed an amount that would produce a translation product of the mUNA molecule having substantially less activity than the mRNA.

The oligomer mUNA molecules of this invention can display a sequence of nucleobases, and can be designed to express a peptide or protein, in vitro, ex vivo, or in vivo. The expressed peptide or protein can have activity in various forms, including activity corresponding to protein expressed from a native or natural mRNA.

In some embodiments, a mUNA molecule of this invention may have a chain length of about 400 to 15,000 monomers, where any monomer that is not a UNA monomer can be a Q monomer.

mUNA Molecular Cap Structure

A mUNA molecule of this invention may have a 5'-end capped with various groups and their analogues as are known in the art. The 5' cap may be a m7GpppGm cap. The 5' cap may be an ARCA cap (3'-OMe-m7G(5')pppG). The 5' cap may be an mCAP (m7G(5')ppp(5')G, $N^7$-Methyl-Guanosine-5'-Triphosphate-5'-Guanosine). The 5' cap may be resistant to hydrolysis.

Some examples of 5' cap structures are given in WO2015/051169A2.

Genetic Basis for mUNA Molecules

In some embodiments, the mUNA molecules of this invention can be structured to provide peptides or proteins that are nominally expressed by any portion of a genome. Examples of genes for which a mUNA molecule can be used to express the corresponding peptide or protein are set forth below.

Examples of genes for which a mUNA molecule can be used to express the corresponding peptide or protein include: Neoplasia, PTEN; ATM; ATR; EGFR; ERBB2; ERBB3; ERBB4; Notch1; Notch2; Notch3; Notch4; AKT; AKT2; AKT3; HIF; HIF1a; HIF3a; Met; HRG; Bcl2; PPAR alpha; PPAR gamma; WT1 (Wilms Tumor); FGF Receptor Family members (5 members: 1, 2, 3, 4, 5); CDKN2a; APC; RB (retinoblastoma); MEN1; VHL; BRCA1; BRCA2; AR (Androgen Receptor); TSG101; IGF; IGF Receptor; Igf1 (4 variants); Igf2 (3 variants); Igf 1 Receptor; Igf 2 Receptor; Bax; Bcl2; caspases family (9 members: 1, 2, 3, 4, 6, 7, 8, 9, 12); Kras; Apc.

Examples of genes for which a mUNA molecule can be used to express the corresponding peptide or protein include: Age-related Macular Degeneration, Schizophrenia, Aber; Ccl2; Cc2; cp (ceruloplasmin); Timp3; cathepsinD; Vld1r; Ccr2 Neuregulin1 (Nrg1); Erb4 (receptor for Neuregulin); Complexin1 (Cplx1); Tph1 Tryptophan hydroxylase; Tph2 Tryptophan hydroxylase 2; Neurexin 1; GSK3; GSK3a; GSK3b.

Examples of genes for which a mUNA molecule can be used to express the corresponding peptide or protein include: 5-HTT (Slc6a4); COMT; DRD (Drd1a); SLC6A3; DAOA; DTNBP1; Dao (Dao1).

Examples of genes for which a mUNA molecule can be used to express the corresponding peptide or protein include: Trinucleotide Repeat Disorders, HTT (Huntington's Dx); SBMA/SMAX1/AR (Kennedy's Dx); FXN/X25 (Friedrich's Ataxia); ATX3 (Machado-Joseph's Dx); ATXN1 and ATXN2 (spinocerebellar ataxias); DMPK (myotonic dystrophy); Atrophin-1 and Atn 1 (DRPLA Dx); CBP (Creb-BP-global instability); VLDLR (Alzheimer's); Atxn7; Atxn10.

Examples of genes for which a mUNA molecule can be used to express the corresponding peptide or protein include: Fragile X Syndrome, FMR2; FXR1; FXR2; mGLUR5.

Examples of genes for which a mUNA molecule can be used to express the corresponding peptide or protein include: Secretase Related Disorders, APH-1 (alpha and beta); Presenilin (Psen1); nicastrin (Ncstn); PEN-2.

Examples of genes for which a mUNA molecule can be used to express the corresponding peptide or protein include: Nos1.

Examples of genes for which a mUNA molecule can be used to express the corresponding peptide or protein include: Parp1.

Examples of genes for which a mUNA molecule can be used to express the corresponding peptide or protein include: Nat1; Nat2.

Examples of genes for which a mUNA molecule can be used to express the corresponding peptide or protein include: Prion-related disorders, Prp.

Examples of genes for which a mUNA molecule can be used to express the corresponding peptide or protein include: ALS disease, SOD1; ALS2; STEX; FUS; TARDBP; VEGF (VEGF-a; VEGF-b; VEGF-c).

Examples of genes for which a mUNA molecule can be used to express the corresponding peptide or protein include: Drug addiction, Prkce (alcohol); Drd2; Drd4; ABAT (alcohol); GRIA2; Grm5; Grin1; Htr1b; Grin2a; Drd3; Pdyn; Gria1 (alcohol).

Examples of genes for which a mUNA molecule can be used to express the corresponding peptide or protein include: Autism, Mecp2; BZRAP1; MDGA2; Sema5A; Neurexin 1; Fragile X (FMR2 (AFF2); FXR1; FXR2; Mglur5).

Examples of genes for which a mUNA molecule can be used to express the corresponding peptide or protein include: Alzheimer's Disease, E1; CHIP; UCH; UBB; Tau; LRP; PICALM; Clusterin; PS1; SORL1; CR1; Vld1r; Uba1; Uba3; CHIP28 (Aqp1, Aquaporin 1); Uchl1; Uchl3; APP.

Examples of genes for which a mUNA molecule can be used to express the corresponding peptide or protein include: Inflammation, IL-10; IL-1 (IL-1a; IL-1b); IL-13; IL-17 (IL-17a (CTLA8); IL-17b; IL-17c; IL-17d; IL-17f); II-23; Cx3er1; ptpn22; TNFa; NOD2/CARD15 for IBD; IL-6; IL-12 (IL-12a; IL-12b); CTLA4; Cx3cl1.

Examples of genes for which a mUNA molecule can be used to express the corresponding peptide or protein include: Parkinson's Disease, x-Synuclein; DJ-1; LRRK2; Parkin; PINK1.

Examples of genes for which a mUNA molecule can be used to express the corresponding peptide or protein include: Blood and coagulation diseases and disorders, Anemia (CDAN1, CDA1, RPS19, DBA, PKLR, PK1, NT5C3, UMPH1, PSN1, RHAG, RH50A, NRAMP2, SPTB, ALAS2, ANH1, ASB, ABCB7, ABC7, ASAT); Bare lymphocyte syndrome (TAPBP, TPSN, TAP2, ABCB3, PSF2, RING11, MHC2TA, C2TA, RFX5, RFXAP, RFX5), Bleeding disorders (TBXA2R, P2RX1, P2X1); Factor H and factor H-like 1 (HF1, CFH, HUS); Factor V and factor VIII (MCFD2); Factor VII deficiency (F7); Factor X deficiency (F10); Factor XI deficiency (F11); Factor XII deficiency (F12, HAF); Factor XIIIA deficiency (F13A1, F13A); Factor XIIIB deficiency (F13B); Fanconi anemia (FANCA, FACA, FA1, FA, FAA, FAAP95, FAAP90, FLJ34064, FANCB, FANCC, FACC, BRCA2, FANCD1, FANCD2, FANCD, FACD, FAD, FANCE, FACE, FANCF, XRCC9, FANCG, BRIP1, BACH1, FANCJ, PHF9, FANCL, FANCM, KIAA1596); Hemophagocytic lymphohistiocytosis disorders (PRF1, HPLH2, UNC13D, MUNC13-4, HPLH3, HLH3, FHL3); Hemophilia A (F8, F8C, HEMA); Hemophilia B (F9 Factor IX, HEMB), Hemorrhagic disorders (PI, ATT, F5); Leukocyde deficiencies and disorders (ITGB2, CD18, LCAMB, LAD, EIF2B1, EIF2BA, EIF2B2, EIF2B3, EIF2B5, LVWM, CACH, CLE, EIF2B4); Sickle cell anemia (HBB); Thalassemia (HBA2, HBB, HBD, LCRB, HBA1).

Examples of genes for which a mUNA molecule can be used to express the corresponding peptide or protein include: Cell dysregulation and oncology diseases and disorders, B-cell non-Hodgkin lymphoma (BCL7A, BCL7); Leukemia (TAL1 TCL5, SCL, TAL2, FLT3, NBS1, NBS, ZNFN1A1, IK1, LYF1, HOXD4, HOX4B, BCR, CML, PHL, ALL, ARNT, KRAS2, RASK2, GMPS, AF10, ARHGEF12, LARG, KIAA0382, CALM, CLTH, CEBPA, CEBP, CHIC2, BTL, FLT3, KIT, PBT, LPP, NPM1, NUP214, D9S46E, CAN, CAIN, RUNX1, CBFA2, AML1, WHSCIL1, NSD3, FLT3, AF1Q, NPM1, NUMA1, ZNF145, PLZF, PML, MYL, STAT5B, AF10, CALM, CLTH, ARL11, ARLTS1, P2RX7, P2X7, BCR, CML, PHL, ALL, GRAF, NF1, VRNF, WSS, NFNS, PTPN11, PTP2C, SHP2, NS1, BCL2, CCND1, PRAD1, BCL1, TCRA, GATA1, GF1, ERYF1, NFE1, ABL1, NQO1, DIA4, NMOR1, NUP214, D9S46E, CAN, CAIN).

Examples of genes for which a mUNA molecule can be used to express the corresponding peptide or protein include: Inflammation and immune related diseases and disorders, AIDS (KIR3DL1, NKAT3, NKB1, AMB11, KIR3DS1, IFNG, CXCL12, SDF1); Autoimmune lymphoproliferative syndrome (TNFRSF6, APT1, FAS, CD95, ALPS1A); Combined immuno-deficiency, (IL2RG, SCIDX1, SCIDX, IMD4); HIV-1 (CCL5, SCYA5, D17S136E, TCP228), HIV susceptibility or infection (IL10, CSIF, CMKBR2, CCR2, CMKBR5, CCCKR5 (CCR5)); Immuno-deficiencies (CD3E, CD3G, AICDA, AID, HIGM2, TNFRSF5, CD40, UNG, DGU, HIGM4, TNFSF5, CD40LG, HIGM1, IGM, FOXP3, IPEX, AIID, XPID, PIDX, TNFRSF14B, TACI); Inflammation (IL-10, IL-1 (IL-1a, IL-1b), IL-13, IL-17 (IL-17a (CTLA8), IL-17b, IL-17c, IL-17d, IL-17f, 11-23, Cx3cr1, ptpn22, TNFa, NOD2/CARD15 for IBD, IL-6, IL-12 (IL-12a, IL-12b), CTLA4, Cx3cl1); Severe combined immunodeficiencies (SCIDs) (JAK3, JAKL, DCLRE1C, ARTEMIS, SCIDA, RAG1, RAG2, ADA, PTPRC, CD45, LCA, IL7R, CD3D, T3D, IL2RG, SCIDX1, SCIDX, IMD4).

Examples of genes for which a mUNA molecule can be used to express the corresponding peptide or protein include: Metabolic, liver, kidney and protein diseases and disorders, Amyloid neuropathy (TTR, PALB); Amyloidosis (APOA1, APP, AAA, CVAP, AD1, GSN, FGA, LYZ, TTR, PALB); Cirrhosis (KRT18, KRT8, CIRH1A, NAIC, TEX292, KIAA1988); Cystic fibrosis (CFTR, BG213071, ABCC7, CF, MRP7); Glycogen storage diseases (SLC2A2, GLUT2, G6PC, G6PT, G6PT1, GAA, LAMP2, LAMPB, AGL, GDE, GBE1, GYS2, PYGL, PFKM); Hepatic adenoma, 142330 (TCF1, HNF1A, MODY3), Hepatic failure, early onset, and neurologic disorder (SCOD1, SCO1), Hepatic lipase deficiency (LIPC), Hepato-blastoma, cancer and carcinomas (CTNNB1, PDGFRL, PDGRL, PRLTS, AXIN1, AXIN, CTNNB1, TP53, P53, LFS1, IGF2R, MPRI, MET, CASP8, MCH5; Medullary cystic kidney disease (UMOD, HNFJ, FJHN, MCKD2, ADMCKD2); Phenylketonuria (PAH, PKU1, QDPR, DHPR, PTS); Polycystic kidney and hepatic disease (FCYT, PKHD1, ARPKD, PKD1, PKD2, PKD4, PKDTS, PRKCSH, G19P1, PCLD, SEC63).

Examples of genes for which a mUNA molecule can be used to express the corresponding peptide or protein include: Lipoprotein lipase, APOA1, APOC3 and APOA4.

Examples of genes for which a mUNA molecule can be used to express the corresponding peptide or protein include: Muscular/skeletal diseases and disorders, Becker muscular dystrophy (DMD, BMD, MYF6), Duchenne Muscular Dystrophy (DMD, BMD); Emery-Dreifuss muscular dystrophy (LMNA, LMN1, EMD2, FPLD, CMD1A, HGPS, LGMD1B, LMNA, LMN1, EMD2, FPLD, CMD1A); Facio-scapulohumeral muscular dystrophy (FSHMD1A, FSHD1A); Muscular dystrophy (FKRP, MDC1C, LGMD2I, LAMA2, LAMM, LARGE, KIAA0609, MDC1D, FCMD, TTID, MYOT, CAPN3, CANP3, DYSF, LGMD2B, SGCG, LGMD2C, DMDA1, SCG3, SGCA, ADL, DAG2, LGMD2D, DMDA2, SGCB, LGMD2E, SGCD, SGD, LGMD2F, CMD1L, TCAP, LGMD2G, CMD1N, TRIM32, HT2A, LGMD2H, FKRP, MDC1C, LGMD2I, TTN, CMD1G, TMD, LGMD2J, POMT1, CAV3, LGMD1C, SEPN1, SELN, RSMD1, PLEC1, PLTN, EBS1); Osteopetrosis (LRP5, BMND1, LRP7, LR3, OPPG, VBCH2, CLCN7, CLC7, OPTA2, OSTM1, GL, TCIRG1, TIRC7, OC116, OPTB1); Muscular atrophy (VAPB, VAPC, ALS8, SMN1, SMA1, SMA2, SMA3, SMA4, BSCL2, SPG17, GARS, SMAD1, CMT2D, HEXB, IGHMBP2, SMUBP2, CATF1, SMARD1).

Examples of genes for which a mUNA molecule can be used to express the corresponding peptide or protein include: Neurological and neuronal diseases and disorders, ALS (SOD1, ALS2, STEX, FUS, TARDBP, VEGF (VEGF-a, VEGF-b, VEGF-c); Alzheimer's Disease (APP, AAA, CVAP, AD1, APOE, AD2, PSEN2, AD4, STM2, APBB2, FE65L1, NOS3, PLAU, URK, ACE, DCP1, ACE1, MPO, PACIP1, PAXIPIL, PTIP, A2M, BLMH, BMH, PSEN1, AD3); Autism (Mecp2, BZRAP1, MDGA2, Sema5A, Neurexin 1, GLO1, MECP2, RTT, PPMX, MRX16, MRX79, NLGN3, NLGN4, KIAA1260, AUTSX2); Fragile X Syndrome (FMR2, FXR1, FXR2, mGLUR5); Huntington's disease and disease like disorders (HD, IT15, PRNP, PRIP, JPH3, JP3, HDL2, TBP, SCA17); Parkinson disease (NR4A2, NURR1, NOT, TINUR, SNCAIP, TBP, SCA17, SNCA, NACP, PARK1, PARK4, DJ1, PARK7, LRRK2, PARK8, PINK1, PARK6, UCHL1, PARK5, SNCA, NACP, PARK1, PARK4, PRKN, PARK2, PDJ, DBH, NDUFV2); Rett syndrome (MECP2, RTT, PPMX, MRX16, MRX79, CDKL5, STK9, MECP2, RTT, PPMX, MRX16, MRX79, x-Synuclein, DJ-1); Schizo-phrenia (Neuregulin1 (Nrg1), Erb4 (receptor for Neuregulin), Complexin1 (Cplx1), Tph1 Trypto-phan hydroxylase, Tph2, Tryptophan hydroxylase 2, Neurexin 1, GSK3, GSK3a, GSK3b, 5-HTT (Slc6a4), COMT, DRD (Drd1a), SLC6A3, DAOA, DTNBP1, Dao (Dao1)); Secretase Related Dis-orders (APH-1 (alpha and beta), Presenilin (Psen1), nicastrin, (Ncstn), PEN-2, Nos1, Parp1, Nat1, Nat2); Trinucleotide Repeat Disorders (HTT (Huntington's Dx), SBMA/SMAX1/AR (Kennedy's Dx), FXN/X25 (Friedrich's Ataxia), ATX3 (Machado-Joseph's Dx), ATXN1 and ATXN2 (spinocerebellar ataxias), DMPK (myotonic dystrophy), Atrophin-1 and Atn1 (DRPLA Dx), CBP (Creb-BP-global instability), VLDLR (Alzheimer's), Atxn7, Atxn10).

Examples of genes for which a mUNA molecule can be used to express the corresponding peptide or protein include: Occular diseases and disorders, Age-related macular degeneration (Aber, Ccl2, Cc2, cp (ceruloplasmin), Timp3, cathepsinD, Vld1r, Ccr2); Cataract (CRYAA, CRYA1, CRYBB2, CRYB2, PITX3, BFSP2, CP49, CP47, CRYAA, CRYA1, PAX6, AN2, MGDA, CRYBA1, CRYB1, CRYGC, CRYG3, CCL, LIM2, MP19, CRYGD, CRYG4, BFSP2, CP49, CP47, HSF4, CTM, HSF4, CTM, MIP, AQP0, CRYAB, CRYA2, CTPP2, CRYBB1, CRYGD, CRYG4, CRYBB2, CRYB2, CRYGC, CRYG3, CCL, CRYAA, CRYA1, GJA8, CX50, CAE1, GJA3, CX46, CZP3, CAE3, CCM1, CAM, KRIT1); Corneal clouding and dystrophy (APOA1, TGFBI, CSD2, CDGG1, CSD, BIGH3, CDG2, TACSTD2, TROP2, M1S1, VSX1, RINX, PPCD, PPD, KTCN, COL8A2, FECD, PPCD2, PIP5K3, CFD); Cornea plana congenital (KERA, CNA2); Glaucoma (MYOC, TIGR, GLC1A, JOAG, GPOA, OPTN, GLC1E, FIP2, HYPL, NRP, CYP1B1, GLC3A, OPA1, NTG, NPG, CYP1B1, GLC3A); Leber congenital amaurosis (CRB1, RP12, CRX, CORD2, CRD, RPGRIP1, LCA6, CORD9, RPE65, RP20, AIPL1, LCA4, GUCY2D, GUC2D, LCA1, CORD6, RDH12, LCA3); Macular dystrophy (ELOVL4, ADMD, STGD2, STGD3, RDS, RP7, PRPH2, PRPH, AVMD, AOFMD, VMD2).

Examples of genes for which a mUNA molecule can be used to express the corresponding peptide or protein include: Epilepsy, myoclonic, EPM2A, MELF, EPM2 Lafora type, 254780 Epilepsy, myoclonic, NHLRC1, EPM2A, EPM2B Lafora type, 254780.

Examples of genes for which a mUNA molecule can be used to express the corresponding peptide or protein include: Duchenne muscular DMD, BMD dystrophy, 310200 (3) AIDS, delayed/rapid KIR3DL1, NKAT3, NKB1, AMB11, KIR3DS1 progression to (3).

Examples of genes for which a mUNA molecule can be used to express the corresponding peptide or protein include: AIDS, delayed/rapid KIR3DL1, NKAT3, NKB1, AMB11, KIR3DS1 progression to (3) AIDS, rapid IFNG progression to, 609423 (3) AIDS, resistance to CXCL12, SDF1 (3).

Examples of genes for which a mUNA molecule can be used to express the corresponding peptide or protein include: Alpha-1-Antitrypsin Deficiency, SERPINA1 [serpin peptidase inhibitor, clade A (alpha-1 antiproteinase, antitrypsin), member 1]; SERPINA2 [serpin peptidase inhibitor, clade A (alpha-1 antiproteinase, antitrypsin), member 2]; SERPINA3 [serpin peptidase inhibitor, clade A (alpha-1 antiproteinase, antitrypsin), member 3]; SERPINA5 [serpin peptidase inhibitor, clade A (alpha-1 antiproteinase, antitrypsin), member 5]; SERPINA6 [serpin peptidase inhibitor, clade A (alpha-1 antiproteinase, antitrypsin), member 6]; SERPINA7 [serpin peptidase inhibitor, clade A (alpha-1 antiproteinase, antitrypsin), member 7];" AND "SERPLNA6 (serpin peptidase inhibitor, clade A (alpha-1 antiproteinase, antitrypsin), member 6).

Examples of genes for which a mUNA molecule can be used to express the corresponding peptide or protein include: PI3K/AKT Signaling, PRKCE; ITGAM; ITGA5; IRAK1; PRKAA2; EIF2AK2; PTEN; EIF4E; PRKCZ; GRK6; MAPK1; TSC1; PLK1; AKT2; IKBKB; PIK3CA; CDK8; CDKN1B; NFKB2; BCL2; PIK3CB; PPP2R1A; MAPK8; BCL2L1; MAPK3; TSC2; ITGA1; KRAS; EIF4EBP1; RELA; PRKCD; NOS3; PRKAA1; MAPK9; CDK2; PPP2CA; PIM1; ITGB7; YWHAZ; ILK; TP53; RAF1; IKBKG; RELB; DYRK1A; CDKN1A; ITGB1; MAP2K2; JAK1; AKT1; JAK2; PIK3R1; CHUK; PDPK1; PPP2R5C; CTNNB1; MAP2K1; NFKB1; PAK3; ITGB3; CCND1; GSK3A; FRAP1; SFN; ITGA2; TTK; CSNK1A1; BRAF; GSK3B; AKT3; FOXO1; SGK; HSP90AA1; RPS6KB1.

Examples of genes for which a mUNA molecule can be used to express the corresponding peptide or protein include: ERK/MAPK Signaling, PRKCE; ITGAM; ITGA5; HSPB1; IRAK1; PRKAA2; EIF2AK2; RAC1; RAP1A; TLN1; EIF4E; ELK1; GRK6; MAPK1; RAC2; PLK1; AKT2; PIK3CA; CDK8; CREB1; PRKCI; PTK2; FOS; RPS6KA4; PIK3CB; PPP2R1A; PIK3C3; MAPK8; MAPK3; ITGA1; ETS1; KRAS; MYCN; EIF4EBP1; PPARG; PRKCD; PRKAA1; MAPK9; SRC; CDK2; PPP2CA; PIM1; PIK3C2A; ITGB7; YWHAZ; PPP1CC; KSR1; PXN; RAF1; FYN; DYRK1A; ITGB1; MAP2K2; PAK4; PIK3R1; STAT3; PPP2R5C; MAP2K1; PAK3; ITGB3; ESR1; ITGA2; MYC; TTK; CSNK1A1; CRKL; BRAF; ATF4; PRKCA; SRF; STAT1; SGK.

Examples of genes for which a mUNA molecule can be used to express the corresponding peptide or protein include: Serine/Threonine-Protein Kinase, CDK16; PCTK1; CDK5R1.

Examples of genes for which a mUNA molecule can be used to express the corresponding peptide or protein include: Glucocorticoid Receptor Signaling, RAC1; TAF4B; EP300; SMAD2; TRAF6; PCAF; ELK1; MAPK1; SMAD3; AKT2; IKBKB; NCOR2; UBE2I; PIK3CA; CREB1; FOS; HSPA5; NFKB2; BCL2; MAP3K14; STAT5B; PIK3CB; PIK3C3; MAPK8; BCL2L1; MAPK3; TSC22D3; MAPK10; NRIP1; KRAS; MAPK13; RELA; STAT5A; MAPK9; NOS2A; PBX1; NR3C1; PIK3C2A; CDKN1C; TRAF2; SERPINE1; NCOA3; MAPK14; TNF; RAF1; IKBKG; MAP3K7; CREBBP; CDKN1A; MAP2K2; JAK1; IL8; NCOA2; AKT1; JAK2; PIK3R1; CHUK; STAT3; MAP2K1; NFKB1; TGFBR1; ESR1; SMAD4; CEBPB; JUN; AR; AKT3; CCL2; MMP1; STAT1; IL6; HSP90AA1.

Examples of genes for which a mUNA molecule can be used to express the corresponding peptide or protein include: Axonal Guidance Signaling, PRKCE; ITGAM; ROCK1; ITGA5; CXCR4; ADAM12; IGF1; RAC1; RAP1A; E1F4E; PRKCZ; NRP1; NTRK2; ARHGEF7; SMO; ROCK2; MAPK1; PGF; RAC2; PTPN11; GNAS; AKT2; PIK3CA; ERBB2; PRKC1; PTK2; CFL1; GNAQ; PIK3CB; CXCL12; PIK3C3; WNT11; PRKD1; GNB2L1; ABL1; MAPK3; ITGA1; KRAS; RHOA; PRKCD; PIK3C2A; ITGB7; GLI2; PXN; VASP; RAF1; FYN; ITGB1; MAP2K2; PAK4; ADAM17; AKT1; PIK3R1; GLI1; WNT5A; ADAM10; MAP2K1; PAK3; ITGB3; CDC42; VEGFA; ITGA2; EPHA8; CRKL; RND1; GSK3B; AKT3; PRKCA.

Examples of genes for which a mUNA molecule can be used to express the corresponding peptide or protein include: Ephrin Receptor Signaling, PRKCE; ITGAM; ROCK1; ITGA5; CXCR4; IRAK1; PRKAA2; EIF2AK2; RAC1; RAP1A; GRK6; ROCK2; MAPK1; PGF; RAC2; PTPN11; GNAS; PLK1; AKT2; DOK1; CDK8; CREB1; PTK2; CFL1; GNAQ; MAP3K14; CXCL12; MAPK8; GNB2L1; ABL1; MAPK3; ITGA1; KRAS; RHOA; PRKCD; PRKAA1; MAPK9; SRC; CDK2; PIM1; ITGB7; PXN; RAF1; FYN; DYRK1A; ITGB1; MAP2K2; PAK4, AKT1; JAK2; STAT3; ADAM10; MAP2K1; PAK3; ITGB3; CDC42; VEGFA; ITGA2; EPHA8; TTK; CSNK1A1; CRKL; BRAF; PTPN13; ATF4; AKT3; SGK.

Examples of genes for which a mUNA molecule can be used to express the corresponding peptide or protein include: Actin Cytoskeleton Signaling, ACTN4; PRKCE; ITGAM; ROCK1; ITGA5; IRAK1; PRKAA2; EIF2AK2; RAC1; INS; ARHGEF7; GRK6; ROCK2; MAPK1; RAC2; PLK1; AKT2; PIK3CA; CDK8; PTK2; CFL1; PIK3CB; MYH9; DIAPH1; PIK3C3; MAPK8; F2R; MAPK3; SLC9A1; ITGA1; KRAS; RHOA; PRKCD; PRKAA1; MAPK9; CDK2; PIM1; PIK3C2A; ITGB7; PPP1CC; PXN; VIL2; RAF1; GSN; DYRK1A; ITGB1; MAP2K2; PAK4; PIP5K1A; PIK3R1; MAP2K1; PAK3; ITGB3; CDC42; APC; ITGA2; TTK; CSNK1A1; CRKL; BRAF; VAV3; SGK.

Examples of genes for which a mUNA molecule can be used to express the corresponding peptide or protein include: Huntington's Disease Signaling, PRKCE; IGF1; EP300; RCOR1; PRKCZ; HDAC4; TGM2; MAPK1; CAPNS1; AKT2; EGFR; NCOR2; SP1; CAPN2; PIK3CA; HDAC5; CREB1; PRKC1; HSPA5; REST; GNAQ; PIK3CB; PIK3C3; MAPK8; IGF1R; PRKD1; GNB2L1; BCL2L1; CAPN1; MAPK3; CASP8; HDAC2; HDAC7A; PRKCD; HDAC11; MAPK9; HDAC9; PIK3C2A; HDAC3; TP53; CASP9; CREBBP; AKT1; PIK3R1; PDPK1; CASP1; APAF1; FRAP1; CASP2; JUN; BAX; ATF4; AKT3; PRKCA; CLTC; SGK; HDAC6; CASP3.

Examples of genes for which a mUNA molecule can be used to express the corresponding peptide or protein include: Apoptosis Signaling, PRKCE; ROCK1; BID; IRAK1;

PRKAA2; EIF2AK2; BAK1; BIRC4; GRK6; MAPK1; CAPNS1; PLK1; AKT2; IKBKB; CAPN2; CDK8; FAS; NFKB2; BCL2; MAP3K14; MAPK8; BCL2L1; CAPN1; MAPK3; CASP8; KRAS; RELA; PRKCD; PRKAA1; MAPK9; CDK2; PIM1; TP53; TNF; RAF1; IKBKG; RELB; CASP9; DYRK1A; MAP2K2; CHUK; APAF1; MAP2K1; NFKB1; PAK3; LMNA; CASP2; BIRC2; TTK; CSNK1A1; BRAF; BAX; PRKCA; SGK; CASP3; BIRC3; PARP1.

Examples of genes for which a mUNA molecule can be used to express the corresponding peptide or protein include: B Cell Receptor Signaling, RAC1; PTEN; LYN; ELK1; MAPK1; RAC2; PTPN11; AKT2; IKBKB; PIK3CA; CREB1; SYK; NFKB2; CAMK2A; MAP3K14; PIK3CB; PIK3C3; MAPK8; BCL2L1; ABL1; MAPK3; ETS1; KRAS; MAPK13; RELA; PTPN6; MAPK9; EGR1; PIK3C2A; BTK; MAPK14; RAF1; IKBKG; RELB; MAP3K7; MAP2K2; AKT1; PIK3R1; CHUK; MAP2K1; NFKB1; CDC42; GSK3A; FRAP1; BCL6; BCL10; JUN; GSK3B; ATF4; AKT3; VAV3; RPS6KB1.

Examples of genes for which a mUNA molecule can be used to express the corresponding peptide or protein include: Leukocyte Extravasation Signaling, ACTN4; CD44; PRKCE; ITGAM; ROCK1; CXCR4; CYBA; RAC1; RAP1A; PRKCZ; ROCK2; RAC2; PTPN11; MMP14; PIK3CA; PRKCI; PTK2; PIK3CB; CXCL12; PIK3C3; MAPK8; PRKD1; ABL1; MAPK10; CYBB; MAPK13; RHOA; PRKCD; MAPK9; SRC; PIK3C2A; BTK; MAPK14; NOX1; PXN; VIL2; VASP; ITGB1; MAP2K2; CTNND1; PIK3R1; CTNNB1; CLDN1; CDC42; F11R; ITK; CRKL; VAV3; CTTN; PRKCA; MMP1; MMP9.

Examples of genes for which a mUNA molecule can be used to express the corresponding peptide or protein include: Integrin Signaling, ACTN4; ITGAM; ROCK1; ITGA5; RAC1; PTEN; RAP1A; TLN1; ARHGEF7; MAPK1; RAC2; CAPNS1; AKT2; CAPN2; P1K3CA; PTK2; PIK3CB; PIK3C3; MAPK8; CAV1; CAPN1; ABL1; MAPK3; ITGA1; KRAS; RHOA; SRC; PIK3C2A; ITGB7; PPP1CC; ILK; PXN; VASP; RAF1; FYN; ITGB1; MAP2K2; PAK4; AKT1; PIK3R1; TNK2; MAP2K1; PAK3; ITGB3; CDC42; RND3; ITGA2; CRKL; BRAF; GSK3B; AKT3.

Examples of genes for which a mUNA molecule can be used to express the corresponding peptide or protein include: Acute Phase Response Signaling, IRAK1; SOD2; MYD88; TRAF6; ELK1; MAPK1; PTPN11; AKT2; IKBKB; PIK3CA; FOS; NFKB2; MAP3K14; PIK3CB; MAPK8; RIPK1; MAPK3; IL6ST; KRAS; MAPK13; IL6R; RELA; SOCS1; MAPK9; FTL; NR3C1; TRAF2; SERPINE1; MAPK14; TNF; RAF1; PDK1; IKBKG; RELB; MAP3K7; MAP2K2; AKT1; JAK2; PIK3R1; CHUK; STAT3; MAP2K1; NFKB1; FRAP1; CEBPB; JUN; AKT3; IL1R1; IL6.

Examples of genes for which a mUNA molecule can be used to express the corresponding peptide or protein include: PTEN Signaling, ITGAM; ITGA5; RAC1; PTEN; PRKCZ; BCL2L11; MAPK1; RAC2; AKT2; EGFR; IKBKB; CBL; PIK3CA; CDKN1B; PTK2; NFKB2; BCL2; PIK3CB; BCL2L1; MAPK3; ITGA1; KRAS; ITGB7; ILK; PDGFRB; INSR; RAF1; IKBKG; CASP9; CDKN1A; ITGB1; MAP2K2; AKT1; PIK3R1; CHUK; PDGFRA; PDPK1; MAP2K1; NFKB1; ITGB3; CDC42; CCND1; GSK3A; ITGA2; GSK3B; AKT3; FOXO1; CASP3; RPS6KB1.

Examples of genes for which a mUNA molecule can be used to express the corresponding peptide or protein include: p53 Signaling, PTEN; EP300; BBC3; PCAF; FASN; BRCA1; GADD45A; BIRC5; AKT2; PIK3CA; CHEK1; TP53INP1; BCL2; PIK3CB; PIK3C3; MAPK8; THBS1; ATR; BCL2L1; E2F1; PMAIP1; CHEK2; TNFRSF10B; TP73; RB1; HDAC9; CDK2; PIK3C2A; MAPK14; TP53; LRDD; CDKN1A; HIPK2; AKT1; RIK3R1; RRM2B; APAF1; CTNNB1; SIRT1; CCND1; PRKDC; ATM; SFN; CDKN2A; JUN; SNAI2; GSK3B; BAX; AKT3.

Examples of genes for which a mUNA molecule can be used to express the corresponding peptide or protein include: Aryl Hydrocarbon Receptor Signaling, HSPB1; EP300; FASN; TGM2; RXRA; MAPK1; NQO1; NCOR2; SP1; ARNT; CDKN1B; FOS; CHEK1; SMARCA4; NFKB2; MAPK8; ALDH1A1; ATR; E2F1; MAPK3; NRIP1; CHEK2; RELA; TP73; GSTP1; RB1; SRC; CDK2; AHR; NFE2L2; NCOA3; TP53; TNF; CDKN1A; NCOA2; APAF1; NFKB1; CCND1; ATM; ESR1; CDKN2A; MYC; JUN; ESR2; BAX; IL6; CYP1B1; HSP90AA1.

Examples of genes for which a mUNA molecule can be used to express the corresponding peptide or protein include: Xenobiotic Metabolism Signaling, PRKCE; EP300; PRKCZ; RXRA; MAPK1; NQO1; NCOR2; PIK3CA; ARNT; PRKCI; NFKB2; CAMK2A; PIK3CB; PPP2R1A; PIK3C3; MAPK8; PRKD1; ALDH1A1; MAPK3; NRIP1; KRAS; MAPK13; PRKCD; GSTP1; MAPK9; NOS2A; ABCB1; AHR; PPP2CA; FTL; NFE2L2; PIK3C2A; PPARGC1A; MAPK14; TNF; RAF1; CREBBP; MAP2K2; PIK3R1; PPP2R5C; MAP2K1; NFKB1; KEAP1; PRKCA; EIF2AK3; IL6; CYP1B1; HSP90AA1.

Examples of genes for which a mUNA molecule can be used to express the corresponding peptide or protein include: SAPK/JNK Signaling, PRKCE; IRAK1; PRKAA2; EIF2AK2; RAC1; ELK1; GRK6; MAPK1; GADD45A; RAC2; PLK1; AKT2; PIK3CA; FADD; CDK8; PIK3CB; PIK3C3; MAPK8; RIPK1; GNB2L1; IRS1; MAPK3; MAPK10; DAXX; KRAS; PRKCD; PRKAA1; MAPK9; CDK2; PIM1; PIK3C2A; TRAF2; TP53; LCK; MAP3K7; DYRK1A; MAP2K2; PIK3R1; MAP2K1; PAK3; CDC42; JUN; TTK; CSNK1A1; CRKL; BRAF; SGK.

Examples of genes for which a mUNA molecule can be used to express the corresponding peptide or protein include: PPAr/RXR Signaling, PRKAA2; EP300; INS; SMAD2; TRAF6; PPARA; FASN; RXRA; MAPK1; SMAD3; GNAS; IKBKB; NCOR2; ABCA1; GNAQ; NFKB2; MAP3K14; STAT5B; MAPK8; IRS1; MAPK3; KRAS; RELA; PRKAA1; PPARGC1A; NCOA3; MAPK14; INSR; RAF1; IKBKG; RELB; MAP3K7; CREBBP; MAP2K2; JAK2; CHUK; MAP2K1; NFKB1; TGFBR1; SMAD4; JUN; IL1R1; PRKCA; IL6; HSP90AA1; ADIPOQ.

Examples of genes for which a mUNA molecule can be used to express the corresponding peptide or protein include: NF-KB Signaling, IRAK1; EIF2AK2; EP300; INS; MYD88; PRKCZ: TRAF6; TBK1; AKT2; EGFR; IKBKB; PIK3CA; BTRC; NFKB2; MAP3K14; PIK3CB; PIK3C3; MAPK8; RIPK1; HDAC2; KRAS; RELA; PIK3C2A; TRAF2; TLR4: PDGFRB; TNF; INSR; LCK; IKBKG; RELB; MAP3K7; CREBBP; AKT1; PIK3R1; CHUK; PDGFRA; NFKB1; TLR2; BCL10; GSK3B; AKT3; TNFAIP3; IL1R1.

Examples of genes for which a mUNA molecule can be used to express the corresponding peptide or protein include: Neuregulin Signaling, ERBB4; PRKCE; ITGAM; ITGA5: PTEN; PRKCZ; ELK1; MAPK1; PTPN11; AKT2; EGFR; ERBB2; PRKCI; CDKN1B; STAT5B; PRKD1; MAPK3; ITGA1; KRAS; PRKCD; STAT5A; SRC; ITGB7; RAF1; ITGB1; MAP2K2; ADAM17; AKT1; PIK3R1; PDPK1; MAP2K1; ITGB3; EREG; FRAP1; PSEN1; ITGA2; MYC; NRG1; CRKL; AKT3; PRKCA; HSP90AA1; RPS6KB1.

Examples of genes for which a mUNA molecule can be used to express the corresponding peptide or protein include: Wnt & Beta catenin Signaling, CD44; EP300; LRP6; DVL3; CSNK1E; GJA1; SMO; AKT2; PIN1; CDH1; BTRC; GNAQ; MARK2; PPP2R1A; WNT11; SRC; DKK1; PPP2CA; SOX6; SFRP2: ILK; LEF1; SOX9; TP53; MAP3K7; CREBBP; TCF7L2; AKT1; PPP2R5C; WNT5A; LRP5; CTNNB1; TGFBR1; CCND1; GSK3A; DVL1; APC; CDKN2A; MYC; CSNK1A1; GSK3B; AKT3; SOX2.

Examples of genes for which a mUNA molecule can be used to express the corresponding peptide or protein include: Insulin Receptor Signaling, PTEN; INS; EIF4E; PTPN1; PRKCZ; MAPK1; TSC1; PTPN11; AKT2; CBL; PIK3CA; PRKCI; PIK3CB; PIK3C3; MAPK8; IRS1; MAPK3; TSC2; KRAS; EIF4EBP1; SLC2A4; PIK3C2A; PPP1CC; INSR; RAF1; FYN; MAP2K2; JAK1; AKT1; JAK2; PIK3R1; PDPK1; MAP2K1; GSK3A; FRAP1; CRKL; GSK3B; AKT3; FOXO1; SGK; RPS6KB1.

Examples of genes for which a mUNA molecule can be used to express the corresponding peptide or protein include: IL-6 Signaling, HSPB1; TRAF6; MAPKAPK2; ELK1; MAPK1; PTPN11; IKBKB; FOS; NFKB2: MAP3K14; MAPK8; MAPK3; MAPK10; IL6ST; KRAS; MAPK13; IL6R; RELA; SOCS1; MAPK9; ABCB1; TRAF2; MAPK14; TNF; RAF1; IKBKG; RELB; MAP3K7; MAP2K2; IL8; JAK2; CHUK; STAT3; MAP2K1; NFKB1; CEBPB; JUN; IL1R1; SRF; IL6.

Examples of genes for which a mUNA molecule can be used to express the corresponding peptide or protein include: Hepatic Cholestasis, PRKCE; IRAK1; INS; MYD88; PRKCZ; TRAF6; PPARA; RXRA; IKBKB; PRKCI; NFKB2; MAP3K14; MAPK8; PRKD1; MAPK10; RELA; PRKCD; MAPK9; ABCB1; TRAF2; TLR4; TNF; INSR; IKBKG; RELB; MAP3K7; IL8; CHUK; NR1H2; TJP2; NFKB1; ESR1; SREBF1; FGFR4; JUN; IL1R1; PRKCA; IL6.

Examples of genes for which a mUNA molecule can be used to express the corresponding peptide or protein include: IGF-1 Signaling, IGF1; PRKCZ; ELK1; MAPK1; PTPN11; NEDD4; AKT2; PIK3CA; PRKC1; PTK2; FOS; PIK3CB; PIK3C3; MAPK8; 1GF1R; IRS1; MAPK3; IGFBP7; KRAS; PIK3C2A; YWHAZ; PXN; RAF1; CASP9; MAP2K2; AKT1; PIK3R1; PDPK1; MAP2K1; IGFBP2; SFN; JUN; CYR61; AKT3; FOXO1; SRF; CTGF; RPS6KB1.

Examples of genes for which a mUNA molecule can be used to express the corresponding peptide or protein include: NRF2-mediated Oxidative Stress Response, PRKCE; EP300; SOD2; PRKCZ; MAPK1; SQSTM1; NQO1; PIK3CA; PRKC1; FOS; PIK3CB; P1K3C3; MAPK8; PRKD1; MAPK3; KRAS; PRKCD; GSTP1; MAPK9; FTL; NFE2L2; PIK3C2A; MAPK14; RAF1; MAP3K7; CREBBP; MAP2K2; AKT1; PIK3R1; MAP2K1; PPIB; JUN; KEAP1; GSK3B; ATF4; PRKCA; EIF2AK3; HSP90AA1.

Examples of genes for which a mUNA molecule can be used to express the corresponding peptide or protein include: Hepatic, Fibrosis/Hepatic Stellate Cell Activation, EDN1; IGF1; KDR; FLT1; SMAD2; FGFR1; MET; PGF; SMAD3; EGFR; FAS; CSF1; NFKB2; BCL2; MYH9; IGF1R; IL6R; RELA; TLR4; PDGFRB; TNF; RELB; IL8; PDGFRA; NFKB1; TGFBR1; SMAD4; VEGFA; BAX; IL1R1; CCL2; HGF; MMP1; STAT1; IL6; CTGF; MMP9.

Examples of genes for which a mUNA molecule can be used to express the corresponding peptide or protein include: PPAR Signaling, EP300; INS; TRAF6; PPARA; RXRA; MAPK1; IKBKB; NCOR2; FOS; NFKB2; MAP3K14; STAT5B; MAPK3; NRIP1; KRAS; PPARG; RELA; STAT5A; TRAF2; PPARGC1A; PDGFRB; TNF; INSR; RAF1; IKBKG; RELB; MAP3K7; CREBBP; MAP2K2; CHUK; PDGFRA; MAP2K1; NFKB1; JUN; IL1R1; HSP90AA1.

Examples of genes for which a mUNA molecule can be used to express the corresponding peptide or protein include: Fc Epsilon RI Signaling, PRKCE; RAC1; PRKCZ; LYN; MAPK1; RAC2; PTPN11; AKT2; PIK3CA; SYK; PRKCI; PIK3CB; PIK3C3; MAPK8; PRKD1; MAPK3; MAPK10; KRAS; MAPK13; PRKCD; MAPK9; PIK3C2A; BTK; MAPK14; TNF; RAF1; FYN; MAP2K2; AKT1; PIK3R1; PDPK1; MAP2K1; AKT3; VAV3; PRKCA.

Examples of genes for which a mUNA molecule can be used to express the corresponding peptide or protein include: G-Protein Coupled Receptor Signaling, PRKCE; RAP1A; RGS16; MAPK1; GNAS; AKT2; IKBKB; PIK3CA; CREB1; GNAQ; NFKB2; CAMK2A; PIK3CB; PIK3C3; MAPK3; KRAS; RELA; SRC; PIK3C2A; RAF1; IKBKG; RELB; FYN; MAP2K2; AKT1; PIK3R1; CHUK; PDPK1; STAT3; MAP2K1; NFKB1; BRAF; ATF4; AKT3; PRKCA.

Examples of genes for which a mUNA molecule can be used to express the corresponding peptide or protein include: Inositol Phosphate Metabolism, PRKCE; IRAK1; PRKAA2; EIF2AK2; PTEN; GRK6; MAPK1; PLK1; AKT2; PIK3CA; CDK8; PIK3CB; PIK3C3; MAPK8; MAPK3; PRKCD; PRKAA1; MAPK9; CDK2; PIM1; PIK3C2A; DYRK1A; MAP2K2; PIP5K1A; PIK3R1; MAP2K1; PAK3; ATM; TTK; CSNK1A1; BRAF; SGK.

Examples of genes for which a mUNA molecule can be used to express the corresponding peptide or protein include: PDGF Signaling, EIF2AK2; ELK1; ABL2; MAPK1; PIK3CA; FOS; PIK3CB; PIK3C3; MAPK8; CAV1; ABL1; MAPK3; KRAS; SRC; PIK3C2A; PDGFRB; RAF1; MAP2K2; JAK1; JAK2; PIK3R1; PDGFRA; STAT3; SPHK1; MAP2K1; MYC; JUN; CRKL; PRKCA; SRF; STAT1; SPHK2.

Examples of genes for which a mUNA molecule can be used to express the corresponding peptide or protein include: VEGF Signaling, ACTN4; ROCK1; KDR; FLT1; ROCK2; MAPK1; PGF; AKT2; PIK3CA; ARNT; PTK2; BCL2; PIK3CB; PIK3C3; BCL2L1; MAPK3; KRAS; HIF1A; NOS3; PIK3C2A; PXN; RAF1; MAP2K2; ELAVL1; AKT1; PIK3R1; MAP2K1; SFN; VEGFA; AKT3; FOXO1; PRKCA.

Examples of genes for which a mUNA molecule can be used to express the corresponding peptide or protein include: Natural Killer Cell Signaling, PRKCE; RAC1; PRKCZ; MAPK1; RAC2; PTPN11; KIR2DL3; AKT2; PIK3CA; SYK; PRKCI; PIK3CB; PIK3C3; PRKD1; MAPK3; KRAS; PRKCD; PTPN6; PIK3C2A; LCK; RAF1; FYN; MAP2K2; PAK4; AKT1; PIK3R1; MAP2K1; PAK3; AKT3; VAV3; PRKCA.

Examples of genes for which a mUNA molecule can be used to express the corresponding peptide or protein include: Cell Cycle: G1/S Checkpoint Regulation, HDAC4; SMAD3; SUV39H1; HDAC5; CDKN1B; BTRC; ATR; ABL1; E2F1; HDAC2; HDAC7A; RB1; HDAC11; HDAC9; CDK2; E2F2; HDAC3; TP53; CDKN1A; CCND1; E2F4; ATM; RBL2; SMAD4; CDKN2A; MYC; NRG1; GSK3B; RBL1; HDAC6.

Examples of genes for which a mUNA molecule can be used to express the corresponding peptide or protein include: T Cell Receptor Signaling, RAC1; ELK1; MAPK1; IKBKB; CBL; PIK3CA; FOS; NFKB2; PIK3CB; PIK3C3; MAPK8; MAPK3; KRAS; RELA, PIK3C2A; BTK; LCK; RAF1;

IKBKG; RELB, FYN; MAP2K2; PIK3R1; CHUK; MAP2K1; NFKB1; ITK; BCL10; JUN; VAV3.

Examples of genes for which a mUNA molecule can be used to express the corresponding peptide or protein include: Death Receptor Signaling, CRADD; HSPB1; BID; BIRC4; TBK1; IKBKB; FADD; FAS; NFKB2; BCL2; MAP3K14; MAPK8; RIPK1; CASP8; DAXX; TNFRSF10B; RELA; TRAF2; TNF; IKBKG; RELB; CASP9; CHUK; APAF1; NFKB1; CASP2; BIRC2; CASP3; BIRC3.

Examples of genes for which a mUNA molecule can be used to express the corresponding peptide or protein include: FGF Signaling RAC1; FGFR1; MET; MAPKAPK2; MAPK1; PTPN11; AKT2; PIK3CA; CREB1; PIK3CB; PIK3C3; MAPK8; MAPK3; MAPK13; PTPN6; PIK3C2A; MAPK14; RAF1; AKT1; PIK3R1; STAT3; MAP2K1; FGFR4; CRKL; ATF4; AKT3; PRKCA; HGF.

Examples of genes for which a mUNA molecule can be used to express the corresponding peptide or protein include: GM-CSF Signaling, LYN; ELK1; MAPK1; PTPN11; AKT2; PIK3CA; CAMK2A; STAT5B; PIK3CB; PIK3C3; GNB2L1; BCL2L1; MAPK3; ETS1; KRAS; RUNX1; PIM1; PIK3C2A; RAF1; MAP2K2; AKT1; JAK2; PIK3R1; STAT3; MAP2K1; CCND1; AKT3; STAT1.

Examples of genes for which a mUNA molecule can be used to express the corresponding peptide or protein include: Amyotrophic Lateral Sclerosis Signaling, BID; IGF1; RAC1; BIRC4; PGF; CAPNS1; CAPN2; PIK3CA; BCL2; PIK3CB; PIK3C3; BCL2L1; CAPN1; PIK3C2A; TP53; CASP9; PIK3R1; RAB5A; CASP1; APAF1; VEGFA; BIRC2; BAX; AKT3; CASP3; BIRC3.

Examples of genes for which a mUNA molecule can be used to express the corresponding peptide or protein include: JAK/Stat Signaling, PTPN1; MAPK1; PTPN11; AKT2; PIK3CA; STAT5B; PIK3CB; PIK3C3; MAPK3; KRAS; SOCS1; STAT5A; PTPN6; PIK3C2A; RAF1; CDKN1A; MAP2K2; JAK1; AKT1; JAK2; PIK3R1; STAT3; MAP2K1; FRAP1; AKT3; STAT1.

Examples of genes for which a mUNA molecule can be used to express the corresponding peptide or protein include: Nicotinate and Nicotinamide Metabolism, PRKCE; IRAK1; PRKAA2; EIF2AK2; GRK6; MAPK1; PLK1; AKT2; CDK8; MAPK8; MAPK3; PRKCD; PRKAA1; PBEF1; MAPK9; CDK2; PIM1; DYRK1A; MAP2K2; MAP2K1; PAK3; NT5E; TTK; CSNK1A1; BRAF; SGK.

Examples of genes for which a mUNA molecule can be used to express the corresponding peptide or protein include: Chemokine Signaling, CXCR4; ROCK2; MAPK1; PTK2; FOS; CFL1; GNAQ; CAMK2A; CXCL12; MAPK8; MAPK3; KRAS; MAPK13; RHOA; CCR3; SRC; PPP1CC; MAPK14; NOX1; RAF1; MAP2K2; MAP2K1; JUN; CCL2; PRKCA.

Examples of genes for which a mUNA molecule can be used to express the corresponding peptide or protein include: IL-2 Signaling, ELK1; MAPK1; PTPN11; AKT2; PIK3CA; SYK; FOS; STAT5B; PIK3CB; PIK3C3; MAPK8; MAPK3; KRAS; SOCS1; STAT5A; PIK3C2A: LCK; RAF1; MAP2K2; JAK1; AKT1; PIK3R1; MAP2K1; JUN; AKT3.

Examples of genes for which a mUNA molecule can be used to express the corresponding peptide or protein include: Synaptic Long Term Depression, PRKCE; IGF1; PRKCZ; PRDX6; LYN; MAPK1; GNAS; PRKC1; GNAQ; PPP2R1A; IGF1R; PRKID1; MAPK3; KRAS; GRN; PRKCD; NOS3; NOS2A; PPP2CA; YWHAZ; RAF1; MAP2K2; PPP2R5C; MAP2K1; PRKCA.

Examples of genes for which a mUNA molecule can be used to express the corresponding peptide or protein include: Estrogen Receptor Signaling, TAF4B; EP300; CARM1; PCAF; MAPK1; NCOR2; SMARCA4; MAPK3; NRIP1; KRAS; SRC; NR3C1; HDAC3; PPARGC1A; RBM9; NCOA3; RAF1; CREBBP; MAP2K2; NCOA2; MAP2K1; PRKDC; ESR1; ESR2.

Examples of genes for which a mUNA molecule can be used to express the corresponding peptide or protein include: Protein Ubiquitination Pathway, TRAF6; SMURF1; BIRC4; BRCA1; UCHL1; NEDD4; CBL; UBE2I; BTRC; HSPA5; USP7; USP10; FBXW7; USP9X; STUB1; USP22; B2M; BIRC2; PARK2; USPS; USP1; VHL; HSP90AA1; BIRC3.

Examples of genes for which a mUNA molecule can be used to express the corresponding peptide or protein include: IL-10 Signaling, TRAF6; CCR1; ELK1; IKBKB; SP1; FOS; NFKB2; MAP3K14; MAPK8; MAPK13; RELA; MAPK14; TNF; IKBKG; RELB; MAP3K7; JAK1; CHUK; STAT3; NFKB1; JUN; IL1R1; IL6.

Examples of genes for which a mUNA molecule can be used to express the corresponding peptide or protein include: VDR/RXR Activation, PRKCE; EP300; PRKCZ; RXRA; GADD45A; HES1; NCOR2; SP1; PRKC1; CDKN1B; PRKD1; PRKCD; RUNX2; KLF4; YY1; NCOA3; CDKN1A; NCOA2; SPP1; LRP5; CEBPB; FOXO1; PRKCA.

Examples of genes for which a mUNA molecule can be used to express the corresponding peptide or protein include: TGF-beta Signaling, EP300; SMAD2; SMURF1; MAPK1; SMAD3; SMAD1; FOS; MAPK8; MAPK3; KRAS; MAPK9; RUNX2; SERPINE1; RAF1; MAP3K7; CREBBP; MAP2K2; MAP2K1; TGFBR1; SMAD4; JUN; SMAD5.

Examples of genes for which a mUNA molecule can be used to express the corresponding peptide or protein include: Toll-like Receptor Signaling, IRAK1; EIF2AK2; MYD88; TRAF6; PPARA; ELK1; IKBKB; FOS; NFKB2; MAP3K14; MAPK8; MAPK13; RELA; TLR4; MAPK14; IKBKG; RELB; MAP3K7; CHUK; NFKB1; TLR2; JUN.

Examples of genes for which a mUNA molecule can be used to express the corresponding peptide or protein include: p38 MAPK Signaling, HSPB1; IRAK1; TRAF6; MAPKAPK2; ELK1; FADD; FAS; CREB1; DDIT3; RPS6KA4; DAXX; MAPK13; TRAF2; MAPK14; TNF; MAP3K7; TGFBR1; MYC; ATF4; IL1R1; SRF; STAT1.

Examples of genes for which a mUNA molecule can be used to express the corresponding peptide or protein include: Neurotrophin/TRK Signaling, NTRK2; MAPK1; PTPN11; PIK3CA; CREB1; FOS; PIK3CB; PIK3C3; MAPK8; MAPK3; KRAS; PIK3C2A; RAF1; MAP2K2; AKT1; PIK3R1; PDPK1; MAP2K1; CDC42; JUN; ATF4.

Examples of genes for which a mUNA molecule can be used to express the corresponding peptide or protein include: FXR/RXR Activation, INS; PPARA; FASN; RXRA; AKT2; SDC1; MAPK8; APOB; MAPK10; PPARG; MTTP; MAPK9; PPARGC1A; TNF; CREBBP; AKT1; SREBF1; FGFR4; AKT3; FOXO1.

Examples of genes for which a mUNA molecule can be used to express the corresponding peptide or protein include: Synaptic Long Term Potentiation, PRKCE; RAP1A; EP300; PRKCZ; MAPK1; CREB1; PRKC1; GNAQ; CAMK2A; PRKD1; MAPK3; KRAS; PRKCD; PPP1CC; RAF1; CREBBP; MAP2K2; MAP2K1; ATF4; PRKCA.

Examples of genes for which a mUNA molecule can be used to express the corresponding peptide or protein include: Calcium Signaling, RAP1A; EP300; HDAC4; MAPK1; HDAC5; CREB1; CAMK2A; MYH9; MAPK3; HDAC2; HDAC7A; HDAC11; HDAC9; HDAC3; CREBBP; CALR; CAMKK2; ATF4; HDAC6.

Examples of genes for which a mUNA molecule can be used to express the corresponding peptide or protein include: EGF Signaling, ELK1; MAPK1; EGFR; PIK3CA; FOS; PIK3CB; PIK3C3; MAPK8; MAPK3; PIK3C2A; RAF1; JAK1; PIK3R1; STAT3; MAP2K1; JUN; PRKCA; SRF; STAT1.

Examples of genes for which a mUNA molecule can be used to express the corresponding peptide or protein include: Hypoxia Signaling in the Cardiovascular System, EDN1; PTEN; EP300; NQO1; UBE21; CREB1; ARNT; HIF1A; SLC2A4; NOS3; TP53; LDHA; AKT1; ATM; VEGFA; JUN; ATF4; VHL; HSP90AA1.

Examples of genes for which a mUNA molecule can be used to express the corresponding peptide or protein include: LPS/IL-1 Mediated Inhibition of RXR Function, IRAK1; MYD88; TRAF6; PPARA; RXRA; ABCA1, MAPK8; ALDH1A1; GSTP1; MAPK9; ABCB1; TRAF2; TLR4; TNF; MAP3K7; NR1H2; SREBF1; JUN; IL1R1.

Examples of genes for which a mUNA molecule can be used to express the corresponding peptide or protein include: LXR/RXR Activation, FASN; RXRA; NCOR2; ABCA1; NFKB2; IRF3; RELA; NOS2A; TLR4; TNF; RELB; LDLR; NR1H2; NFKB1; SREBF1; IL1R1; CCL2; IL6; MMP9.

Examples of genes for which a mUNA molecule can be used to express the corresponding peptide or protein include: Amyloid Processing, PRKCE; CSNK1E; MAPK1; CAPNS1; AKT2; CAPN2; CAPN1; MAPK3; MAPK13; MAPT; MAPK14; AKT1; PSEN1; CSNK1A1; GSK3B; AKT3; APP.

Examples of genes for which a mUNA molecule can be used to express the corresponding peptide or protein include: IL-4 Signaling, AKT2; PIK3CA; PIK3CB; PIK3C3; IRS1; KRAS; SOCS1; PTPN6; NR3C1; PIK3C2A; JAK1; AKT1; JAK2; PIK3R1; FRAP1; AKT3; RPS6KB1.

Examples of genes for which a mUNA molecule can be used to express the corresponding peptide or protein include: Cell Cycle: G2/M DNA Damage Checkpoint Regulation, EP300; PCAF; BRCA1; GADD45A; PLK1; BTRC; CHEK1; ATR; CHEK2; YWHAZ; TP53; CDKN1A; PRKDC; ATM; SFN; CDKN2A.

Examples of genes for which a mUNA molecule can be used to express the corresponding peptide or protein include: Nitric Oxide Signaling in the Cardiovascular System, KDR; FLT1; PGF; AKT2; PIK3CA; PIK3CB; PIK3C3; CAV1; PRKCD; NOS3; PIK3C2A; AKT1; PIK3R1; VEGFA; AKT3; HSP90AA1.

Examples of genes for which a mUNA molecule can be used to express the corresponding peptide or protein include: Purine Metabolism NME2; SMARCA4; MYH9; RRM2; ADAR; EIF2AK4; PKM2; ENTPD1; RAD51; RRM2B; TJP2; RAD51C; NT5E; POLD1; NME1.

Examples of genes for which a mUNA molecule can be used to express the corresponding peptide or protein include: cAMP-mediated Signaling, RAP1A; MAPK1; GNAS; CREB1; CAMK2A; MAPK3; SRC; RAF1; MAP2K2; STAT3; MAP2K1; BRAF; ATF4.

Examples of genes for which a mUNA molecule can be used to express the corresponding peptide or protein include: Mitochondrial Dysfunction Notch Signaling, SOD2; MAPK8; CASP8; MAPK10; MAPK9; CASP9; PARK7; PSEN1; PARK2; APP; CASP3 HES1; JAG1; NUMB; NOTCH4; ADAM17; NOTCH2; PSEN1; NOTCH3; NOTCH1; DLL4.

Examples of genes for which a mUNA molecule can be used to express the corresponding peptide or protein include: Endoplasmic Reticulum Stress Pathway, HSPA5; MAPK8; XBP1; TRAF2; ATF6; CASP9; ATF4; EIF2AK3; CASP3.

Examples of genes for which a mUNA molecule can be used to express the corresponding peptide or protein include: Pyrimidine Metabolism, NME2; AICDA; RRM2; EIF2AK4; ENTPD1; RRM2B; NT5E; POLD1; NME1.

Examples of genes for which a mUNA molecule can be used to express the corresponding peptide or protein include: Parkinson's Signaling, UCHL1; MAPK8; MAPK13; MAPK14; CASP9; PARK7; PARK2; CASP3.

Examples of genes for which a mUNA molecule can be used to express the corresponding peptide or protein include: Cardiac & Beta Adrenergic Signaling, GNAS; GNAQ; PPP2R1A; GNB2L1; PPP2CA; PPP1CC; PPP2R5C.

Examples of genes for which a mUNA molecule can be used to express the corresponding peptide or protein include: Glycolysis/Gluco-neogenesis, HK2; GCK; GPI; ALDH1A1; PKM2; LDHA; HK1.

Examples of genes for which a mUNA molecule can be used to express the corresponding peptide or protein include: Interferon Signaling, IRF1; SOCS1; JAK1; JAK2; IFITM1; STAT1; IFIT3.

Examples of genes for which a mUNA molecule can be used to express the corresponding peptide or protein include: Sonic Hedgehog Signaling, ARRB2; SMO; GLI2; DYRK1A; GLI1; GSK3B; DYRKIB.

Examples of genes for which a mUNA molecule can be used to express the corresponding peptide or protein include: Glycerophospholipid Metabolism, PLD1; GRN; GPAM; YWHAZ; SPHK1; SPHK2.

Examples of genes for which a mUNA molecule can be used to express the corresponding peptide or protein include: Phospholipid Degradation, PRDX6; PLD1; GRN; YWHAZ; SPHK1; SPHK2.

Examples of genes for which a mUNA molecule can be used to express the corresponding peptide or protein include: Tryptophan Metabolism, SIAH2; PRMT5; NEDD4; ALDH1A1; CYP1B1; STAHL Examples of genes for which a mUNA molecule can be used to express the corresponding peptide or protein include: Lysine Degradation, SUV39H1; EHMT2; NSD1; SETD7; PPP2R5C.

Examples of genes for which a mUNA molecule can be used to express the corresponding peptide or protein include: Nucleotide Excision, ERCC5; ERCC4; XPA; XPC; ERCC1.

Examples of genes for which a mUNA molecule can be used to express the corresponding peptide or protein include: Repair Pathway Starch and Sucrose Metabolism, UCHL1; HK2; GCK; GPI; HK1.

Examples of genes for which a mUNA molecule can be used to express the corresponding peptide or protein include: Aminosugars Metabolism, NQO1; HK2; GCK; HK1.

Examples of genes for which a mUNA molecule can be used to express the corresponding peptide or protein include: Arachidonic Acid Metabolism, PRDX6; GRN; YWHAZ; CYP1B1.

Examples of genes for which a mUNA molecule can be used to express the corresponding peptide or protein include: Circadian Rhythm Signaling, CSNK1E; CREB1; ATF4; NR1D1.

Examples of genes for which a mUNA molecule can be used to express the corresponding peptide or protein include: Coagulation System, BDKRB1; F2R; SERPINE1; F3.

Examples of genes for which a mUNA molecule can be used to express the corresponding peptide or protein include: Dopamine Receptor Signaling, PPP2R1A; PPP2CA; PPP1CC; PPP2R5C.

Examples of genes for which a mUNA molecule can be used to express the corresponding peptide or protein include: Glutathione Metabolism, IDH2; GSTP1; ANPEP; IDH1.

Examples of genes for which a mUNA molecule can be used to express the corresponding peptide or protein include: Glycerolipid Metabolism, ALDH1A1; GPAM; SPHK1; SPHK2.

Examples of genes for which a mUNA molecule can be used to express the corresponding peptide or protein include: Linoleic Acid Metabolism, PRDX6; GRN; YWHAZ; CYP1B1.

Examples of genes for which a mUNA molecule can be used to express the corresponding peptide or protein include: Methionine Metabolism, DNMT1; DNMT3B; AHCY; DNMT3A.

Examples of genes for which a mUNA molecule can be used to express the corresponding peptide or protein include: Pyruvate Metabolism, GLO1; ALDH1A1; PKM2; LDHA.

Examples of genes for which a mUNA molecule can be used to express the corresponding peptide or protein include: Arginine and Proline Metabolism, ALDH1A1; NOS3; NOS2A.

Examples of genes for which a mUNA molecule can be used to express the corresponding peptide or protein include: Eicosanoid Signaling, PRDX6; GRN; YWHAZ.

Examples of genes for which a mUNA molecule can be used to express the corresponding peptide or protein include: Fructose and Mannose Metabolism, HK2; GCK; HK1.

Examples of genes for which a mUNA molecule can be used to express the corresponding peptide or protein include: Galactose Metabolism, HK2; GCK; HK1.

Examples of genes for which a mUNA molecule can be used to express the corresponding peptide or protein include: Stilbene, Coumarine and Lignin Biosynthesis, PRDX6; PRDX1; TYR.

Examples of genes for which a mUNA molecule can be used to express the corresponding peptide or protein include: Antigen Presentation Pathway, CALR; B2M.

Examples of genes for which a mUNA molecule can be used to express the corresponding peptide or protein include: Biosynthesis of Steroids, NQO1; DHCR7.

Examples of genes for which a mUNA molecule can be used to express the corresponding peptide or protein include: Butanoate Metabolism, ALDH1A1; NLGN1.

Examples of genes for which a mUNA molecule can be used to express the corresponding peptide or protein include: Citrate Cycle, IDH2; IDH1.

Examples of genes for which a mUNA molecule can be used to express the corresponding peptide or protein include: Fatty Acid Metabolism, ALDH1A1; CYP1B1.

Examples of genes for which a mUNA molecule can be used to express the corresponding peptide or protein include: Glycerophospholipid Metabolism, PRDX6; CHKA.

Examples of genes for which a mUNA molecule can be used to express the corresponding peptide or protein include: Histidine Metabolism, PRMT5; ALDH1A1.

Examples of genes for which a mUNA molecule can be used to express the corresponding peptide or protein include: Inositol Metabolism, ERO1L; APEX1.

Examples of genes for which a mUNA molecule can be used to express the corresponding peptide or protein include: Metabolism of Xenobiotics by Cytochrome p450, GSTP1; CYP1B1.

Examples of genes for which a mUNA molecule can be used to express the corresponding peptide or protein include: Methane Metabolism, PRDX6; PRDX1.

Examples of genes for which a mUNA molecule can be used to express the corresponding peptide or protein include: Phenylalanine Metabolism, PRDX6; PRDX1.

Examples of genes for which a mUNA molecule can be used to express the corresponding peptide or protein include: Propanoate Metabolism, ALDH1A1; LDHA.

Examples of genes for which a mUNA molecule can be used to express the corresponding peptide or protein include: Selenoamino Acid Metabolism, PRMT5; AHCY.

Examples of genes for which a mUNA molecule can be used to express the corresponding peptide or protein include: Sphingolipid Metabolism, SPHK1; SPHK2.

Examples of genes for which a mUNA molecule can be used to express the corresponding peptide or protein include: Aminophosphonate Metabolism, PRMT5.

Examples of genes for which a mUNA molecule can be used to express the corresponding peptide or protein include: Androgen and Estrogen Metabolism, PRMT5.

Examples of genes for which a mUNA molecule can be used to express the corresponding peptide or protein include: Ascorbate and Aldarate Metabolism, ALDH1A1.

Examples of genes for which a mUNA molecule can be used to express the corresponding peptide or protein include: Bile Acid Biosynthesis, ALDH1A1.

Examples of genes for which a mUNA molecule can be used to express the corresponding peptide or protein include: Cysteine Metabolism, LDHA.

Examples of genes for which a mUNA molecule can be used to express the corresponding peptide or protein include: Fatty Acid Biosynthesis, FASN.

Examples of genes for which a mUNA molecule can be used to express the corresponding peptide or protein include: Glutamate Receptor Signaling, GNB2L1.

Examples of genes and/or polynucleotides that can be edited with the guide molecules of this invention include: NRF2-mediated Oxidative Stress Response, PRDX1.

Examples of genes for which a mUNA molecule can be used to express the corresponding peptide or protein include: Pentose Phosphate Pathway, GPI.

Examples of genes for which a mUNA molecule can be used to express the corresponding peptide or protein include: Pentose and Glucuronate Interconversions, UCHL1.

Examples of genes for which a mUNA molecule can be used to express the corresponding peptide or protein include: Retinol Metabolism, ALDH1A1.

Examples of genes for which a mUNA molecule can be used to express the corresponding peptide or protein include: Riboflavin Metabolism, TYR.

Examples of genes for which a mUNA molecule can be used to express the corresponding peptide or protein include: Tyrosine Metabolism, PRMT5, TYR.

Examples of genes for which a mUNA molecule can be used to express the corresponding peptide or protein include: Ubiquinone Biosynthesis, PRMT5.

Examples of genes for which a mUNA molecule can be used to express the corresponding peptide or protein include: Valine, Leucine and Isoleucine Degradation, ALDH1A1.

Examples of genes for which a mUNA molecule can be used to express the corresponding peptide or protein include: Glycine, Serine and Threonine Metabolism, CHKA.

Examples of genes for which a mUNA molecule can be used to express the corresponding peptide or protein include: Lysine Degradation, ALDH1A1.

Examples of genes for which a mUNA molecule can be used to express the corresponding peptide or protein include: Pain/Taste, TRPM5; TRPA1.

Examples of genes for which a mUNA molecule can be used to express the corresponding peptide or protein include: Pain, TRPM7; TRPC5; TRPC6; TRPC1; Cnr1; cnr2; Grk2; Trpa1; Pomc; Cgrp; Crf; Pka; Era; Nr2b; TRPM5; Prkaca; Prkacb; Prkar1a; Prkar2a.

Examples of genes for which a mUNA molecule can be used to express the corresponding peptide or protein include: Mitochondrial Function, AIF; CytC; SMAC (Diablo); Aifm-1; Aifm-2.

Examples of genes for which a mUNA molecule can be used to express the corresponding peptide or protein include: Developmental Neurology, BMP-4; Chordin (Chrd); Noggin (Nog); WNT (Wnt2; Wnt2b; Wnt3a; Wnt4; Wnt5a; Wnt6; Wnt7b; Wnt8b; Wnt9a; Wnt9b; Wnt10a; Wnt10b; Wnt16); beta-catenin; Dkk-1; Frizzled related proteins; Otx-2; Gbx2; FGF-8; Reelin; Dab1; unc-86 (Pou4fl or Brn3a); Numb; Reln.

mUNA Methods

In various aspects, this invention provides methods for synthesis of mUNA messenger UNA oligomer molecules.

mUNA oligomer molecules of this invention can be synthesized and isolated using methods disclosed herein, as well as any pertinent techniques known in the art.

Some methods for preparing nucleic acids are given in, for example, Merino, Chemical Synthesis of Nucleoside Analogues, (2013); Gait, Oligonucleotide synthesis: a practical approach (1984); Herdewijn, Oligonucleotide Synthesis, Methods in Molecular Biology, Vol. 288 (2005).

In some embodiments, a ligase can be used to link a synthetic oligomer to the 3' end of an RNA molecule or an RNA transcript to form a mUNA molecule. The synthetic oligomer that is ligated to the 3' end can provide the functionality of a polyA tail, and advantageously provide resistance to its removal by 3'-exoribonucleases. The ligated product mUNA molecule can have increased specific activity and provide increased levels of ectopic protein expression.

In certain embodiments, ligated product mUNA molecules of this invention can be made with an RNA transcript that has native specificity. The ligated product can be a synthetic molecule that retains the structure of the RNA transcript at the 5' end to ensure compatibility with the native specificity.

In further embodiments, ligated product mUNA molecules of this invention can be made with an exogenous RNA transcript or non-natural RNA. The ligated product can be a synthetic molecule that retains the structure of the RNA.

In general, the canonical mRNA degradation pathway in cells includes the steps: (i) the polyA tail is gradually cut back to a stub by 3' exonucleases, shutting down the looping interaction required for efficient translation and leaving the cap open to attack; (ii) decapping complexes remove the 5' cap; (iii) the unprotected and translationally incompetent residuum of the transcript is degraded by 5' and 3' exonuclease activity.

Embodiments of this invention involve new mUNA structures which can have increased translational activity over a native transcript. The mUNA molecules can prevent exonucleases from trimming back the polyA tail in the process of de-adenylation.

Embodiments of this invention provide structures, compositions and methods for translatable mUNA molecules. Embodiments of this invention can provide translatable mUNA molecules containing one or more UNA monomers and having increased functional half-life.

It has been found that ligation of a synthetic oligomer to the 3' end of an mRNA transcript can surprisingly be accomplished with high conversion of the mRNA transcript to the ligation product. The ligase can catalyze the joining of the 3'-hydroxyl terminus of the RNA transcript to a synthetic oligomer bearing a 5' monophosphate group. The 3' end of the synthetic oligomer can be blocked to prevent circularization and concatemerization, while the presence of a triphosphate or cap moiety at the 5' terminus of the mRNA transcript can prevent its entry into undesired side reactions.

In some embodiments, the yield of conversion of the mRNA transcript to the ligation product mUNA molecule can be from 70% to 100%. In some embodiments, the yield of conversion of the mRNA transcript to the ligation product can be 70%, 80%, 90%, 95%, 99%, or 100%.

As used herein, the terms polyA tail and polyA oligomer refer to an oligomer of monomers, wherein the monomers can include nucleotides based on adenine, UNA monomers, naturally-occurring nucleotides, modified nucleotides, or nucleotide analogues.

A modified nucleotide can be base-modified, sugar-modified, or linkage modified.

Splint Ligation Methods

Embodiments of this invention can employ splint ligation to synthesize mUNA molecules.

In some aspects, ligation of a tail oligomer to the 3' end of an RNA molecule can surprisingly be accomplished with high conversion of the RNA molecule to the ligation product by using a DNA splint oligomer. Splint ligation of specific RNA molecules can be done with a DNA ligase and a bridging DNA splint oligomer that is complementary to the RNAs.

As used herein, a molecule to which a tail oligomer is added can be referred to as an acceptor oligomer, and a tail oligomer to be ligated to an acceptor oligomer can be referred to as a donor oligomer.

A donor oligomer of this invention may contain one or more UNA monomers. In some embodiments, a donor oligomer may be composed of UNA monomers and adenylate nucleotides.

A donor oligomer of this invention may include any number of UNA monomers within its total length.

An acceptor oligomer of this invention can be a RNA of any length, an mRNA, or a mammalian gene transcript.

In some aspects, ligation of a donor oligomer of any length to the 3' end of an acceptor RNA molecule can surprisingly be accomplished with high conversion to the ligation product mUNA molecule by using a DNA splint oligomer.

In certain embodiments, a DNA splint oligomer can hybridize to the end of an mRNA having a short polyA tail, anchored in a specific position based on a region complementary to the end of the mRNA's 3' UTR. The polyA tail can be about 30 monomers or less in length. The DNA splint oligomer can incorporate a poly(dT) tail that overhangs beyond the native polyA tail of the mRNA transcript. The poly(dT) tail can bring a polyA oligomer into position for efficient ligation to the synthetic mRNA.

Embodiments of this invention can employ splint ligation to introduce UNA monomers, modified nucleotides, or nucleotide analogues into RNA molecules.

In certain embodiments, in splint ligation the DNA ligase can be used to join RNA molecules in an RNA:DNA hybrid.

In some embodiments, the donor can be from 2 to 120 monomers in length, or from 3 to 120 monomers, or from 4 to 120 monomers, or from 5 to 120 monomers, or from 6 to 120 monomers, or longer.

The splint oligomer can be removed from the ligation product using a DNAse treatment, which can be required post-IVT to remove the DNA template for transcription.

Cohesive End Ligation

In some embodiments, a wild-type T4 RNA ligase can be used to join the 3' hydroxyl terminus of an RNA transcript to a tail oligomer bearing a 5' monophosphate group.

In further embodiments, a KQ mutant variant of T4 RNA Ligase 2, which requires a pre-adenylated donor, was used to join the 3' hydroxyl terminus of an RNA transcript to a pre-adenylated tail oligomer.

In these embodiments, a preponderance of the tail can advantageously be incorporated co-transcriptionally in the IVT synthetic RNA transcript, and the donor oligomer can be correspondingly shortened.

Post-Ligation Treatment

In some aspects, a 3'-exonuclease treatment can be used to remove the unligated fraction of the product of the ligation reaction. Examples of a 3'-exonuclease include Exonuclease T, Ribonuclease R, and analogs thereof.

In certain embodiments, Ribonuclease R can be used with high processivity, and the ligation can be insensitive to sequence content and variations, as well as secondary structure.

Tail Oligomers

In some embodiments, the 100% bulk ligation of a tail oligomer to the 3' end of an RNA has been achieved.

Donor oligomers of this invention for ligation to the 3' end of an mRNA may be from 2 to 120 monomers in length, or from 3 to 120 monomers in length, or from 4 to 120 monomers in length, or from 5 to 120 monomers in length, or longer.

In further embodiments, a donor oligomer may have a 3'-terminal modification to block circularization or oligimerization of the synthetic oligomer in ligation reactions. Examples of a 3'-terminal modification include a 3'-terminal C3 spacer.

A donor oligomer of this invention may contain one or more UNA monomers.

A donor oligomer can include one or more nucleic acid monomers that are naturally-occurring nucleotides, modified naturally-occurring nucleotides, or non-naturally-occurring nucleotides.

A donor oligomer can include a nucleic acid monomer that is base-modified, sugar-modified, or linkage modified.

Pharmaceutical Compositions

In some aspects, this invention provides pharmaceutical compositions containing a mUNA oligomeric compound and a pharmaceutically acceptable carrier.

A pharmaceutical composition can be capable of local or systemic administration. In some aspects, a pharmaceutical composition can be capable of any modality of administration. In certain aspects, the administration can be intravenous, subcutaneous, pulmonary, intramuscular, intraperitoneal, dermal, oral, or nasal administration.

Embodiments of this invention include pharmaceutical compositions containing an oligomeric compound in a lipid formulation.

In some embodiments, a pharmaceutical composition may comprise one or more lipids selected from cationic lipids, anionic lipids, sterols, pegylated lipids, and any combination of the foregoing.

In certain embodiments, a pharmaceutical composition can be substantially free of liposomes.

In further embodiments, a pharmaceutical composition can include liposomes or nanoparticles.

Some examples of lipids and lipid compositions for delivery of an active molecule of this invention are given in WO/2015/074085, which is hereby incorporated by reference in its entirety.

In additional embodiments, a pharmaceutical composition can contain an oligomeric compound within a viral or bacterial vector.

A pharmaceutical composition of this disclosure may include carriers, diluents or excipients as are known in the art. Examples of pharmaceutical compositions and methods are described, for example, in Remington's Pharmaceutical Sciences, Mack Publishing Co. (A. R. Gennaro ed. 1985), and Remington, The Science and Practice of Pharmacy, 21st Edition (2005).

Examples of excipients for a pharmaceutical composition include antioxidants, suspending agents, dispersing agents, preservatives, buffering agents, tonicity agents, and surfactants.

An effective dose of an agent or pharmaceutical formulation of this invention can be an amount that is sufficient to cause translation of a mUNA molecule in a cell.

A therapeutically effective dose can be an amount of an agent or formulation that is sufficient to cause a therapeutic effect. A therapeutically effective dose can be administered in one or more separate administrations, and by different routes.

A therapeutically effective dose, upon administration, can result in serum levels of an active agent of 1-1000 pg/ml, or 1-1000 ng/ml, or 1-1000 μg/ml, or more.

A therapeutically effective dose of an active agent in vivo can be a dose of 0.001-0.01 mg/kg body weight, or 0.01-0.1 mg/kg, or 0.1-1 mg/kg, or 1-10 mg/kg, or 10-100 mg/kg.

A therapeutically effective dose of an active agent in vivo can be a dose of 0.001 mg/kg body weight, or 0.01 mg/kg, or 0.1 mg/kg, or 1 mg/kg, or 2 mg/kg, or 3 mg/kg, or 4 mg/kg, or 5 mg/kg, or more.

A subject can be an animal, or a human subject or patient.

Base sequences show herein are from left to right, 5' to 3', unless stated otherwise.

For the examples below, the mUNA transfection protocol in vitro was as follows:

1 Plate mouse hepatocyte Hepa1-6 cells 5000 cells per well in 96 well plate at least 8 hours before transfection.
2 Replace 90 uL DMEM medium containing 10% FBS and Non-essential amino acid) adding 90 uL into each well of 96 well plate immediately before beginning the transfection experiment.
3 Prepare Messenger Max transfection reagent (Life Technologies) mUNA complex according to manufacturer's instruction.
4 Transfer 10 uL of the complex into a well containing the cells in the 96-well plate.
5 Collect the medium after desired time points and add 100 uL fresh medium into each well. Medium will be kept at −80° C. until ELISA assay is performed using the standard manufacturer protocol.

For the examples below, the mUNA transfection protocol in vivo was as follows:

1 The mUNA is formulated with Lipid nanoparticle (LNP).
2 Inject the LNP-formulated mUNA (1 mg/kg mUNA) into BL57BL/c mice (4-6 week-old) via standard i.v. injection in the lateral tail vein.
3 Collect approximately 50 uL of blood in a Heparin-coated microcentrifuge tube.
4 Centrifuge at 3,000×g for 10 minutes at 4° C.

5 Transfer the supernatant (plasma) into a fresh microcentrifuge tube. Plasma will be kept at −80° C. until ELISA assay is performed using the standard manufacturer protocol.

EXAMPLES

All of the comparative mUNA and mRNA molecules in the examples below were synthesized with the 5' cap being a m7GpppGm cap. Unless otherwise specified, the mUNA molecules in the examples below contained a 5'-UTR of TEV, and a 3' UTR of xenopus beta-globin.

Example 1: mUNA Oligomer Producing Human Factor IX In Vivo

In this example, a translatable mUNA molecule was made and used for expressing human Factor IX (F9) in vivo with advantageously increased efficiency of translation, as compared to the mRNA of Factor IX. The translatable mUNA molecule expressing human Factor IX in vivo exhibited activity suitable for use in methods for ameliorating or treating hemophilia B. In this embodiment, the translatable mUNA molecule comprised a 5' cap (m7GpppGm), a 5' UTR of TEV, a F9 CDS, a 3'UTR of xenopus beta-globin, and a tail region.

The translation efficiency of this mUNA molecule is shown in FIG. 1, as compared to the mRNA of F9.

The mUNA molecule of this embodiment was translated in C57BL/c mouse to produce human F9.

FIG. 1 shows that the translation efficiency of this mUNA molecule was advantageously and surprisingly increased as compared to the mRNA of F9. In particular, after 55 hours, the translation efficiency of this mUNA molecule was increased by more than 2-fold (827/388) as compared to the mRNA of F9.

Details of the base structure of this translatable mUNA molecule are as follows:

(SEQ ID NO: 1)

(m7GpppGm)GGGAAACAUAAGUCAACACAACAUAUACAAAACAAACGAA

UCUCAAGCAAUCAAGCAUUCUACUUCUAUUGCAGCAAUUUAAAUCAUUUC

UUUUAAAGCAAAAGCAAUUUUCUGAAAAUUUUCACCAUUUACGAACGAUA

GCCAUGGCCCAGCGCGUGAACAUGAUCAUGGCAGAAUCACCAGGCCUCAU

CACCAUCUGCCUUUUAGGAUAUCUACUCAGUGCUGAAUGUACAGUUUUUC

UUGAUCAUGAAAACGCCAACAAAAUUCUGAAUCGGCCAAAGAGGUAUAAU

UCAGGUAAAUUGGAAGAGUUUGUUCAAGGGAACCUUGAGAGAGAAUGUAU

GGAAGAAAAGUGUAGUUUUGAAGAAGCACGAGAAGUUUUUGAAAACACUG

AAAGAACAACUGAAUUUUGGAAGCAGUAUGUUGAUGGAGAUCAGUGUGAG

UCCAAUCCAUGUUUAAAUGGCGGCAGUUGCAAGGAUGACAUUAAUUCCUA

UGAAUGUUGGUGUCCCUUUGGAUUUGAAGGAAAGAACUGUGAAUUAGAUG

UAACAUGUAACAUUAAGAAUGGCAGAUGCGAGCAGUUUUGUAAAAAUAGU

GCUGAUAACAAGGUGGUUUGCUCCUGUACUGAGGGAUAUCGACUUGCAGA

AAACCAGAAGUCCUGUGAACCAGCAGUGCCAUUUCCAUGUGGAAGAGUUU

CUGUUUCACAAACUUCUAAGCUCACCCGUGCUGAGACUGUUUUUCCUGAU

GUGGACUAUGUAAAUUCUACUGAAGCUGAAACCAUUUUGGAUAACAUCAC

-continued

UCAAAGCACCCAAUCAUUUAAUGACUUCACUCGGGUUGUUGGUGGAGAAG

AUGCCAAACCAGGUCAAUUCCCUUGGCAGGUUGUUUUGAAUGGUAAAGUU

GAUGCAUUCUGUGGAGGCUCUAUCGUUAAUGAAAAAUGGAUUGUAACUGC

UGCCCACUGUGUUGAAACUGGUGUUAAAAUUACAGUUGUCGCAGGUGAAC

AUAAUAUUGAGGAGACAGAACAUACAGAGCAAAAGCGAAAUGUGAUUCGA

AUUAUUCCUCACCACAACUACAAUGCAGCUAUUAAUAAGUACAACCAUGA

CAUUGCCCUUCUGGAACUGGACGAACCCUUAGUGCUAAACAGCUACGUUA

CACCUAUUUGCAUUGCUGACAAGGAAUACACGAACAUCUUCCUCAAAUUU

GGAUCUGGCUAUGUAAGUGGCUGGGGAAGAGUCUUCCACAAAGGGAGAUC

AGCUUUAGUUCUUCAGUACCUUAGAGUUCCACUUGUUGACCGAGCCACAU

GUCUUCGAUCUACAAAGUUCACCAUCUAUAACAACAUGUUCUGUGCUGGC

UUCCAUGAAGGAGGUAGAGAUUCAUGUCAAGGAGAUAGUGGGGGACCCCA

UGUUACUGAAGUGGAAGGGACCAGUUUCUUAACUGGAAUUAUUAGCUGGG

GUGAAGAGUGUGCAAUGAAAGGCAAAUAUGGAAUAUAUACCAAGGUAUCC

CGGUAUGUCAACUGGAUUAAGGAAAAAACAAAGCUCACUUGACUAGUGAC

UGACUAGGAUCUGGUUACCACUAAACCAGCCUCAAGAACACCCGAAUGGA

GUCUCUAAGCUACAUAAUACCAACUUACACUUACAAAAUGUUGUCCCCCA

AAAUGUAGCCAUUCGUAUCUGCUCCUAAUAAAAAGAAAGUUUCUUCACAU

AAAAAAAAAAAAAAAAAAAAAAAAAAAAAAAAAAAAAAAAAAAAAAAAAA

AAAAAAÃÃAA

Example 2: mUNA Oligomer Producing Human Factor IX In Vitro

In this example, the translatable mUNA molecule of Example 1 (SEQ ID NO:1) was made and used for expressing human Factor IX (F9) in vitro with advantageously increased efficiency of translation, as compared to the mRNA of Factor IX. The translatable mUNA molecule expressing human Factor IX exhibited activity suitable for use in methods for ameliorating or treating hemophilia B.

Figure 2:
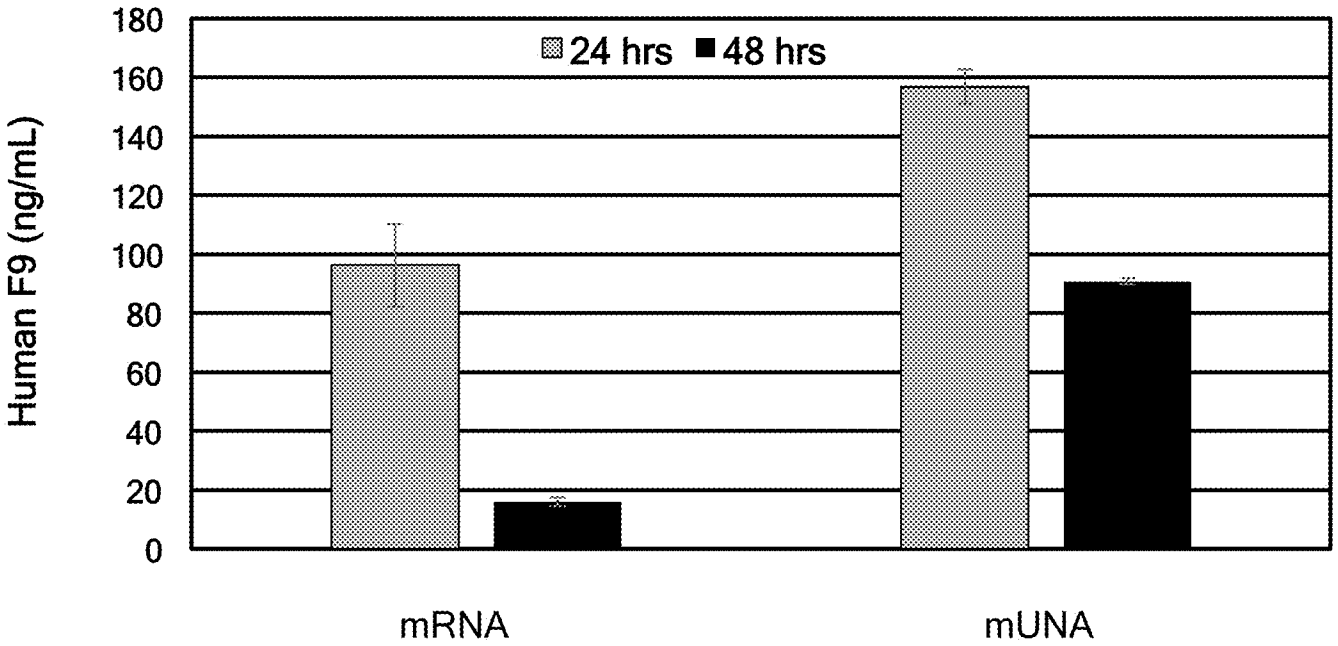
FIG. 2.

The translation efficiency of this mUNA molecule (SEQ ID NO:1) is shown in FIG. 2, as compared to the mRNA of F9.

The mUNA molecule of this embodiment was translated in mouse hepatocyte cell line Hepa1-6 to produce human F9.

FIG. 2 shows that the translation efficiency of this mUNA molecule was advantageously and surprisingly increased as compared to the mRNA of F9. In particular, after 48 hours, the translation efficiency of this mUNA molecule was increased by 5-fold (91/16) as compared to the mRNA of F9.

Example 3: mUNA Oligomer Producing Human Erythropoietin In Vitro

In this example, a translatable mUNA molecule was made and used for expressing human Erythropoietin (EPO) in vitro with advantageously increased efficiency of translation, as compared to the mRNA of EPO. The translatable mUNA molecule expressing human EPO exhibited activity suitable for use in methods for ameliorating or treating certain anemias, inflammatory bowel disease, and/or certain myelodysplasias. In this embodiment, the translatable mUNA molecule comprised a 5' cap (m7 GpppGm), a 5' UTR of TEV, a human EPO CDS, a 3'UTR of xenopus beta-globin, and a tail region.

Figure 3:
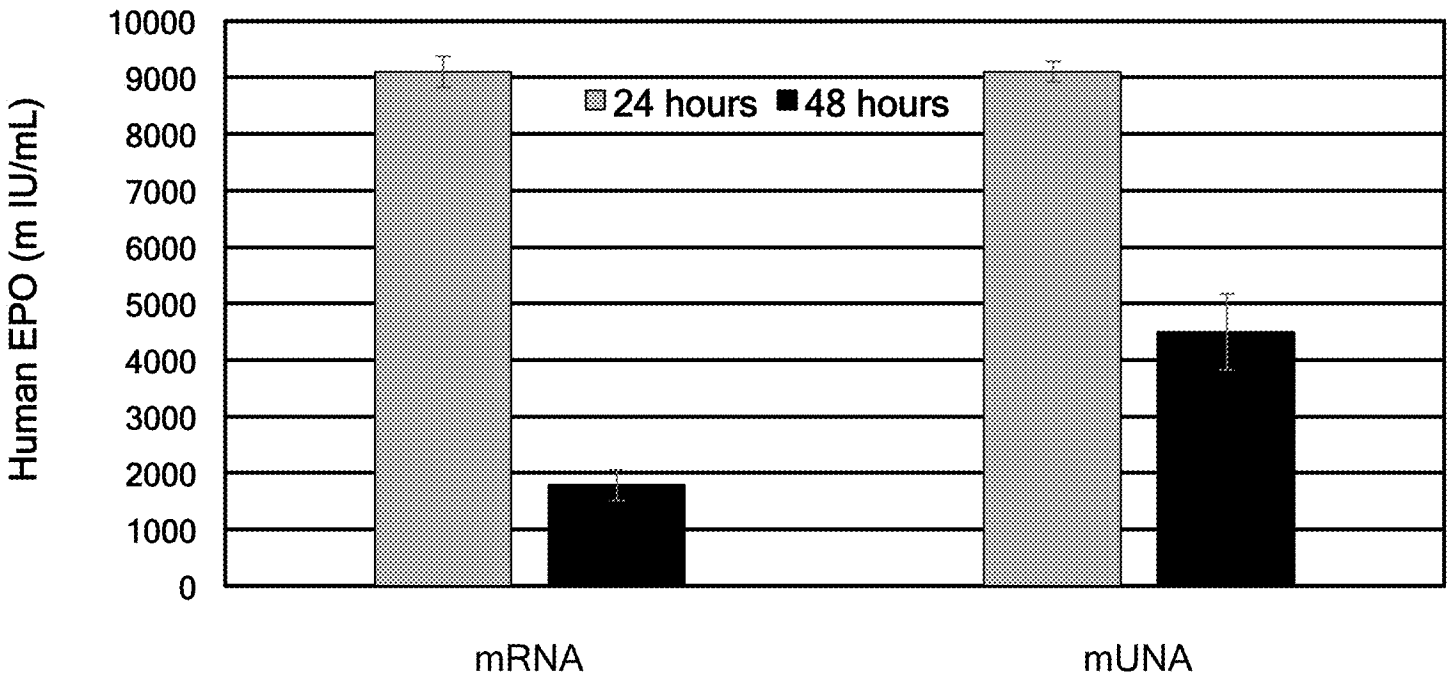
FIG. 3.

The translation efficiency of this mUNA molecule is shown in FIG. 3, as compared to the mRNA of EPO.

The mUNA molecule of this embodiment was translated in mouse hepatocyte cell line Hepa1-6 to produce human EPO.

FIG. 3 shows that the translation efficiency of this mUNA molecule was advantageously and surprisingly increased as compared to the mRNA of F9. In particular, after 48 hours, the translation efficiency of this mUNA molecule was more than doubled (4500/1784) as compared to the mRNA of EPO.

Details of the base structure of this translatable mUNA molecule are as follows:

(SEQ ID NO: 2)
(m7GpppGm)GGGAAACAUAAGUCAACACAACAUAUACAAAACAAACGAA
UCUCAAGCAAUCAAGCAUUCUACUUCUAUUGCAGCAAUUUAAAUCAUUUC
UUUUAAAGCAAAAGCAAUUUUCUGAAAAUUUUCACCAUUUACGAACGAUA
GCCAUGGGGGUGCACGAAUGUCCUGCCUGGCUGUGGCUUCUCCUGUCCCU
GCUGUCGCUCCCUCUGGGCCUCCCAGUCCUGGGCGCCCCACCACGCCUCA
UCUGUGACAGCCGAGUCCUGGAGAGGUACCUCUUGGAGGCCAAGGAGGCC
GAGAAUAUCACGACGGGCUGUGCUGAACACUGCAGCUUGAAUGAGAAUAU
CACUGUCCCAGACACCAAAGUUAAUUUCUAUGCCUGGAAGAGGAUGGAGG
UCGGGCAGCAGGCCGUAGAAGUCUGGCAGGGCCUGGCCCUGCUGUCGGAA
GCUGUCCUGCGGGGCCAGGCCCUGUUGGUCAACUCUUCCCAGCCGUGGGA
GCCCCUGCAGCUGCAUGUGGAUAAAGCCGUCAGUGGCCUUCGCAGCCUCA
CCACUCUGCUUCGGGCUCUGGGAGCCCAGAAGGAAGCCAUCUCCCCUCCA
GAUGCGGCCUCAGCUGCUCCACUCCGAACAAUCACUGCUGACACUUUCCG
CAAACUCUUCCGAGUCUACUCCAAUUUCCUCCGGGGAAAGCUGAAGCUGU
ACACAGGGGAGGCCUGCAGGACAGGGGACAGAUGACUAGUGACUGACUAG
GAUCUGGUUACCACUAAACCAGCCUCAAGAACACCCGAAUGGAGUCUCUA
AGCUACAUAAUACCAACUUACACUUACAAAAUGUUGUCCCCCAAAAUGUA
GCCAUUCGUAUCUGCUCCUAAUAAAAAGAAAGUUUCUUCACAUAAAAAAA
AAAAAAAAAAAAAAAAAAAAAAAAAAAAAAAAAAAAAAAAAAAAAAAAÃ
ÃAA

Example 4: mUNA Oligomers Producing Mouse Erythropoietin In Vitro

In this example, several translatable mUNA molecules were made and used for expressing mouse Erythropoietin (EPO) in vitro with advantageously increased efficiency of translation, as compared to the mRNA of EPO. In this embodiment, the translatable mUNA molecules each comprised a 5' cap (m7GpppGm), a 5' UTR of TEV, a mouse EPO CDS, a 3'UTR of xenopus beta-globin, and a tail region.

Figure 4:
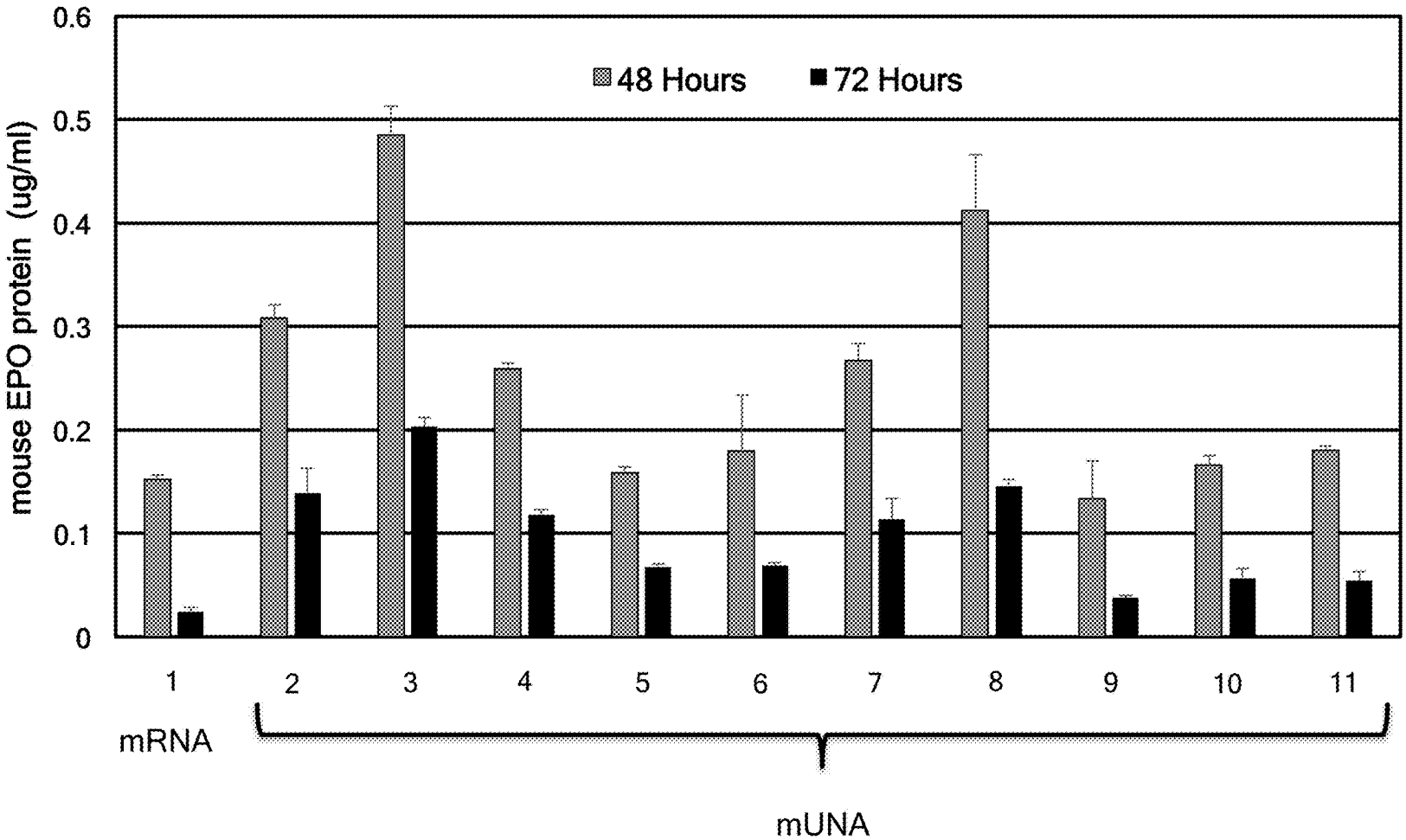
FIG. 4.

The translation efficiency of these mUNA molecules (#2, 3, 4, 5, 6, 7, 8, 9, 10 and 11) are shown in FIG. 4, as compared to the mRNA of EPO (#1).

The mUNA molecules of this embodiment were translated in mouse hepatocyte cell line Hepa1-6 to produce mouse EPO.

FIG. 4 shows that the translation efficiency of the mUNA molecules (#2, 3, 4, 5, 6, 7, 8, 9, 10 and 11) was advantageously and surprisingly increased as compared to the mRNA of EPO (#1). In particular, after 72 hours, the translation efficiency of the mUNA molecules was increased by up to 8-fold (0.203/0.025) as compared to the mRNA of EPO, and the translation efficiency of every mUNA molecule (#2, 3, 4, 5, 6, 7, 8, 9, 10 and 11) was increased as compared to the mRNA of EPO (#1).

Details of the base structure of the translatable mUNA molecule #2 are as follows:

(SEQ ID NO: 3)
(m7GpppGm)GGGAAACAUAAGUCAACACAACAUAUACAAAACAAACGAA
UCUCAAGCAAUCAAGCAUUCUACUUCUAUUGCAGCAAUUUAAAUCAUUUC
UUUUAAAGCAAAAGCAAUUUUCUGAAAAUUUUCACCAUUUACGAACGAUA
GCCAUGGGGGUGCCCGAACGUCCCACCCUGCUGCUUUUACUCUCCUUGCU
ACUGAUUCCUCUGGGCCUCCCAGUCCUCUGUGCUCCCCCACGCCUCAUCU
GCGACAGUCGAGUUCUGGAGAGGUACAUCUUAGAGGCCAAGGAGGCAGAA
AAUGUCACGAUGGGUUGUGCAGAAGGUCCCAGACUGAGUGAAAAUAUUAC
AGUCCCAGAUACCAAAGUCAACUUCUAUGCUUGGAAAAGAAUGGAGGUGG
AAGAACAGGCCAUAGAAGUUUGGCAAGGCCUGUCCCUGCUCUCAGAAGCC
AUCCUGCAGGCCCAGGCCCUGCUAGCCAAUUCCUCCCAGCCACCAGAGAC
CCUUCAGCUUCAUAUAGACAAAGCCAUCAGUGGUCUACGUAGCCUCACUU
CACUGCUUCGGGUACUGGGAGCUCAGAAGGAAUUGAUGUCGCCUCCAGAU
ACCACCCCACCUGCUCCACUCCGAACACUCACAGUGGAUACUUUCUGCAA
GCUCUUCCGGGUCUACGCCAACUUCCUCCGGGGGAAACUGAAGCUGUACA
CGGGAGAGGUCUGCAGGAGAGGGGACAGGTGACUAGUGACUGACUAGGAU
CUGGUUACCACUAAACCAGCCUCAAGAACACCCGAAUGGAGUCUCUAAGC
UACAUAAUACCAACUUACACUUACAAAAUGUUGUCCCCCAAAAUGUAGCC
AUUCGUAUCUGCUCCUAAUAAAAAGAAAGUUUCUUCACAUAAAAAAAAAA
AAAAAAAAAAAAAAAAAAAAAAAAAAAAAAAAAAAAAAAAAAAAAAÃÃ

Details of the base structure of the translatable mUNA molecules #3 through #11 that were made are the same as molecule #2, except that the 3' terminal tail regions, the last 40 monomers are as follows:

mUNA molecule #3
(SEQ ID NO: 4)
AAAAAAAAAAAAAAAAAAAAAAAAAAAAAAAA
AAAAAAAAAAAAAAAAAAAAAAAAAAAAÃÃAA mUNA molecule #4
(SEQ ID NO: 5)
AAAAAAAAAAAAAAAAAAAAAAAAAAAAAAAA
AAAAAAAAAAAAAAAAAAAAAAAAAAÃÃAAAA mUNA molecule #5
(SEQ ID NO: 6)
AAAAAAAAAAAAAAAAAAAAAAAAAAAAAAAA
AAAAAAAAAAAAAAAAAAAAAAAAÃÃAAAAAA -continued mUNA molecule #6

(SEQ ID NO: 7)

AAAAAAAAAAAAAAAAAAAAAAAAAAAAAA

AAAAAAAAAAAAAAAAAAAAÃÃAAAAAAAA mUNA molecule #7

(SEQ ID NO: 8)

AAAAAAAAAAAAAAAAAAAAAAAAAAAAAA

AAAAAAAAAAAAAAAAAAÃÃAAAAAAAAAA mUNA molecule #8

(SEQ ID NO: 9)

AAAAAAAAAAAAAAAAAAAAAAAAAAAAAA

AAAAAAAAAAAAAAAÃÃAAAAAAAAAAAA mUNA molecule #9

(SEQ ID NO: 10)

AAAAAAAAAAAAAAAAAAAAAAAAAAAAAA

AAAAAAAAAAAAAAÃÃAAAAAAAAAAAAAA mUNA molecule #10

(SEQ ID NO: 11)

AAAAAAAAAAAAAAAAAAAAAAAAAAAAAA

AAAAAAAAAAAAÃÃAAAAAAAAAAAAAAAA mUNA molecule #11

(SEQ ID NO: 12)

AAAAAAAAAAAAAAAAAAAAAAAAAAAAAA

AAAAAAAAAAÃÃAAAAAAAAAAAAAAAAAA

Example 5: mUNA Oligomer Producing Human Alpha-1-Antitrypsin In Vivo

In this example, a translatable mUNA molecule was made and used for expressing human alpha-1-Antitrypsin in vivo with advantageously increased efficiency of translation, as compared to the mRNA of human alpha-1-Antitrypsin. The translatable mUNA molecule expressing human alpha-1-Antitrypsin exhibited activity suitable for use in methods for ameliorating or treating alpha-1-Antitrypsin deficiency. In this embodiment, the translatable mUNA molecule comprised a 5' cap (m7GpppGm), a 5' UTR of TEV, a human alpha-1-Antitrypsin CDS, a 3'UTR of xenopus beta-globin, and a tail region.

Figure 5:
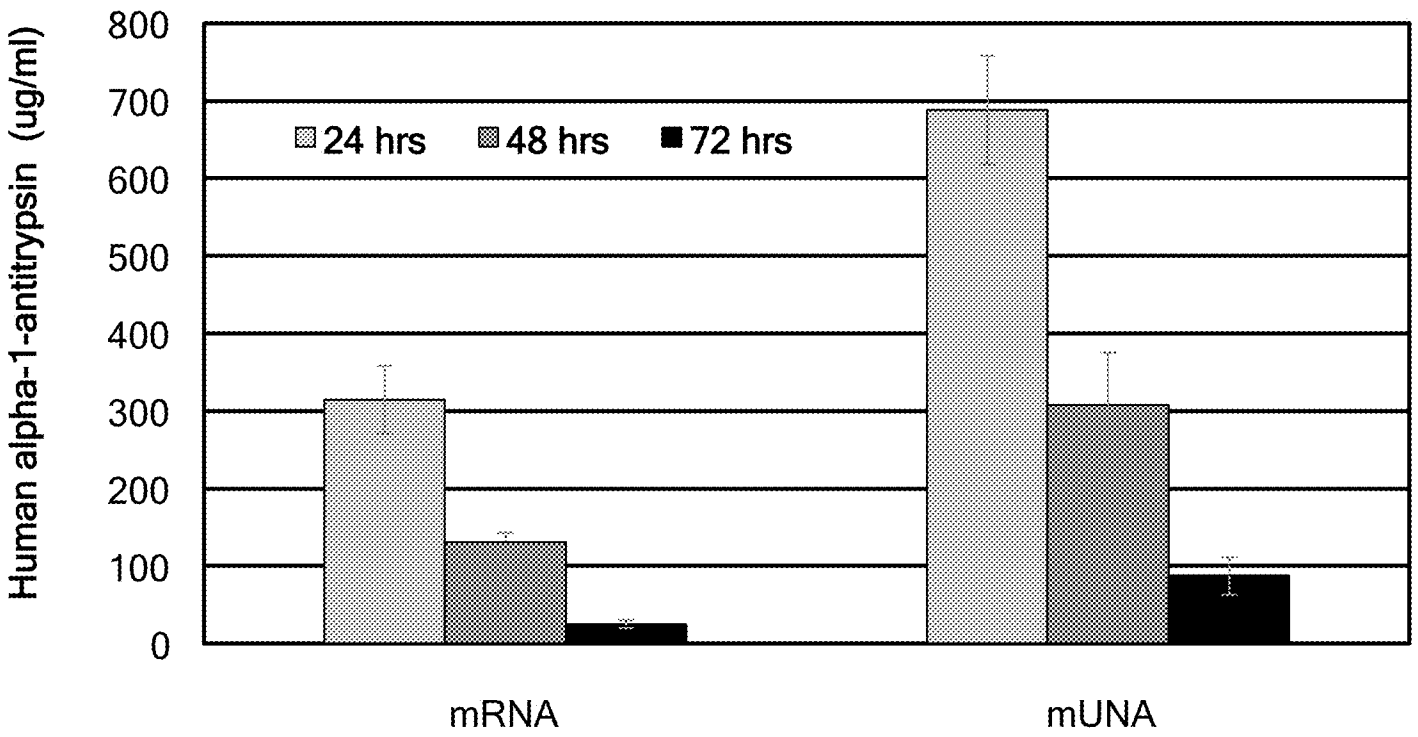
FIG. 5.

The translation efficiency of this mUNA molecule is shown in FIG. 5, as compared to the mRNA of human alpha-1-Antitrypsin.

The mUNA molecule of this embodiment was translated in C57BL/c mouse to produce human alpha-1-Antitrypsin.

FIG. 5 shows that the translation efficiency of this mUNA molecule was advantageously and surprisingly increased as compared to the mRNA of human alpha-1-Antitrypsin. In particular, after 72 hours, the translation efficiency of this mUNA molecule was increased by more than 3-fold (87.8/25.4) as compared to the mRNA of human alpha-1-Antitrypsin.

Details of the base structure of this translatable mUNA molecule were as follows:

(SEQ ID NO: 13)

(m7GpppGm) GGGAAACAUAAGUCAACACAACAUAUACAAAACAAACGAA

UCUCAAGCAAUCAAGCAUUCUACUUCUAUUGCAGCAAUUUAAAUCAUUUC

UUUUAAAGCAAAAGCAAUUUUCUGAAAAUUUUCACCAUUUACGAACGAUA

GCCAUGCCGUCUUCUGUCUCGUGGGGCAUCCUCCUGCUGGCAGGCCUGUG

CUGCCUGGUCCCUGUCUCCCUGGCUGAGGAUCCCCAGGGAGAUGCUGCCC

AGAAGACAGAUACAUCCCACCAUGAUCAGGAUCACCCAACCUUCAACAAG

AUCACCCCCAACCUGGCUGAGUUCGCCUUCAGCCUAUACCGCCAGCUGGC

ACACCAGUCCAACAGCACCAAUAUCUUCUUCUCCCCAGUGAGCAUCGCUA

CAGCCUUUGCAAUGCUCUCCCUGGGGACCAAGGCUGACACUCACGAUGAA

AUCCUGGAGGGCCUGAAUUUCAACCUCACGGAGAUUCCGGAGGCUCAGAU

CCAUGAAGGCUUCCAGGAACUCCUCCGUACCCUCAACCAGCCAGACAGCC

AGCUCCAGCUGACCACCGGCAAUGGCCUGUUCCUCAGCGAGGGCCUGAAG

CUAGUGGAUAAGUUUUUGGAGGAUGUUAAAAAGUUGUACCACUCAGAAGC

CUUCACUGUCAACUUCGGGGACACCGAAGAGGCCAAGAAACAGAUCAACG

AUUACGUGGAGAAGGGUACUCAAGGGAAAAUUGUGGAUUUGGUCAAGGAG

CUUGACAGAGACACAGUUUUUGCUCUGGUGAAUUACAUCUUCUUUAAAGG

CAAAUGGGAGAGACCCUUUGAAGUCAAGGACACCGAGGAAGAGGACUUCC

ACGUGGACCAGGUGACCACCGUGAAGGUGCCUAUGAUGAAGCGUUUAGGC

AUGUUUAACAUCCAGCACUGUAAGAAGCUGUCCAGCUGGGUGCUGCUGAU

GAAAUACCUGGGCAAUGCCACCGCCAUCUUCUUCCUGCCUGAUGAGGGGA

AACUACAGCACCUGGAAAAUGAACUCACCCACGAUAUCAUCACCAAGUUC

CUGGAAAAUGAAGACAGAAGGUCUGCCAGCUUACAUUUACCCAAACUGUC

CAUUACUGGAACCUAUGAUCUGAAGAGCGUCCUGGGUCAACUGGGCAUCA

CUAAGGUCUUCAGCAAUGGGGCUGACCUCUCCGGGGUCACAGAGGAGGCA

CCCCUGAAGCUCUCCAAGGCCGUGCAUAAGGCUGUGCUGACCAUCGACGA

GAAAGGGACUGAAGCUGCUGGGGCCAUGUUUUUAGAGGCCAUACCCAUGU

CUAUCCCCCCCGAGGUCAAGUUCAACAAACCCUUUGUCUUCUUAAUGAUU

GAACAAAAUACCAAGUCUCCCCUCUUCAUGGGAAAAGUGGUGAAUCCCAC

CCAAAAAUAACUAGUGACUGACUAGGAUCUGGUUACCACUAAACCAGCCU

CAAGAACACCCGAAUGGAGUCUCUAAGCUACAUAAUACCAACUUACACUU

ACAAAAUGUUGUCCCCCAAAAUGUAGCCAUUCGUAUCUGCUCCUAAUAAA

AAGAAAGUUUCUUCACAUAAAAAAAAAAAAAAAAAAAAAAAAAAAAAAA

AAAAAAAAAAAAAAAAAAAAAAÃÃAAAA

Example 6: mUNA Oligomer Producing Human Erythropoietin In Vivo

In this example, a translatable mUNA molecule was made and used for expressing human Erythropoietin (EPO) in vivo with advantageously increased efficiency of translation, as compared to the mRNA of EPO. The translatable mUNA molecule expressing human EPO exhibited activity suitable for use in methods for ameliorating or treating certain anemias, inflammatory bowel disease, and/or certain myelodysplasias. In this embodiment, the translatable mUNA molecule comprised a 5' cap (m7GpppGm), a 5' UTR of TEV, a human EPO CDS, a 3'UTR of xenopus beta-globin, and a tail region.

Figure 6:
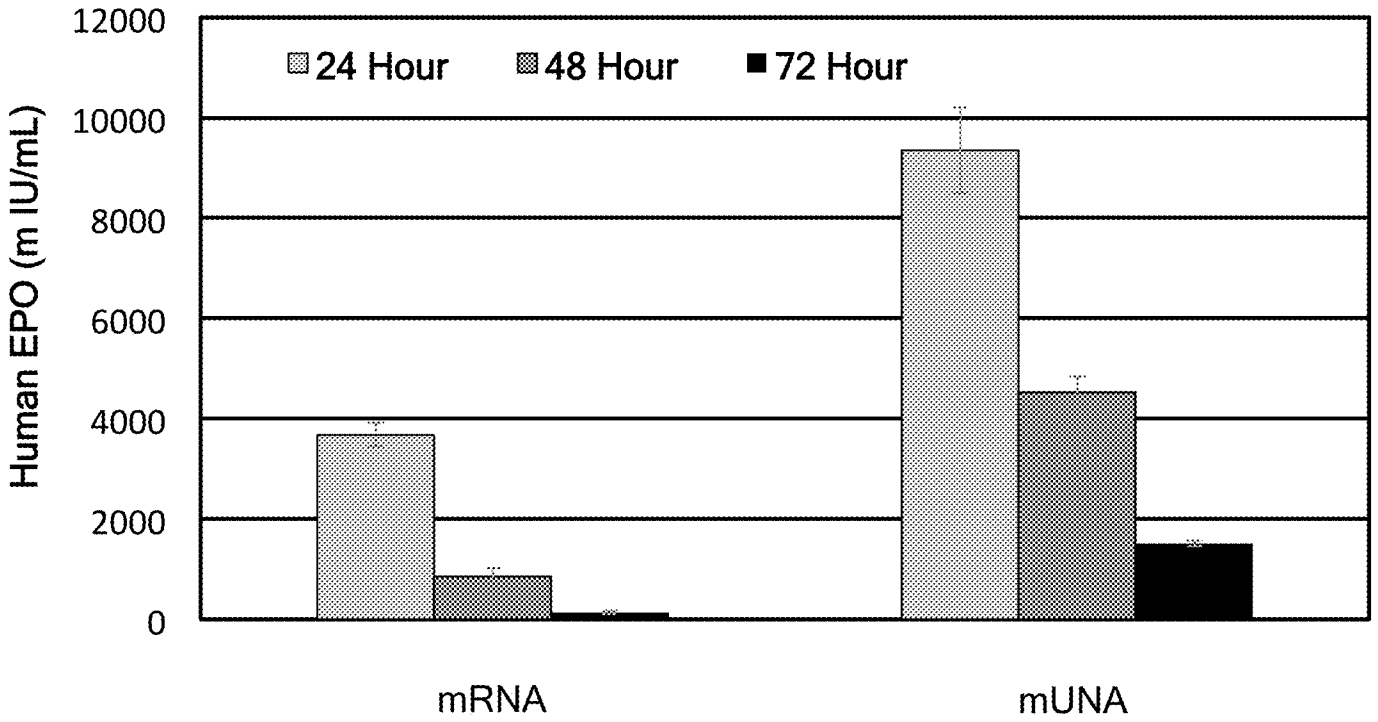
FIG. 6.
Figure 7:
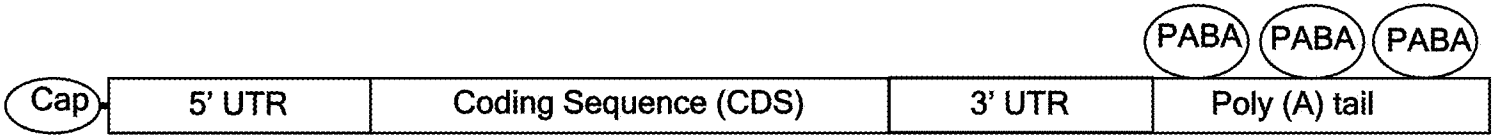
FIG. 7.
Figure 8:
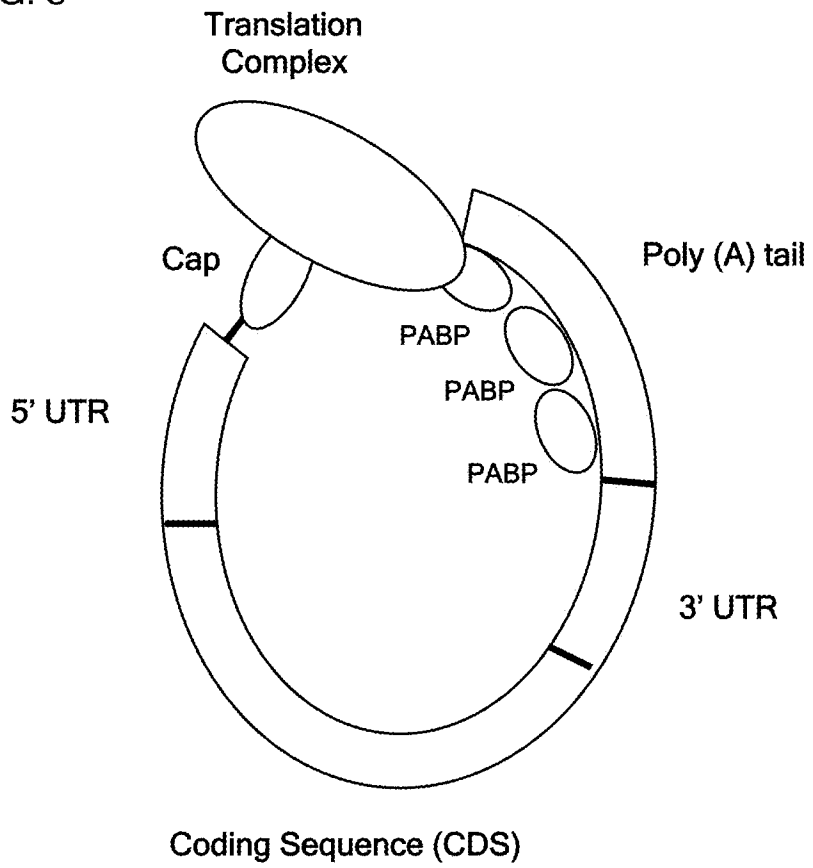
FIG. 8.
Figure 9:
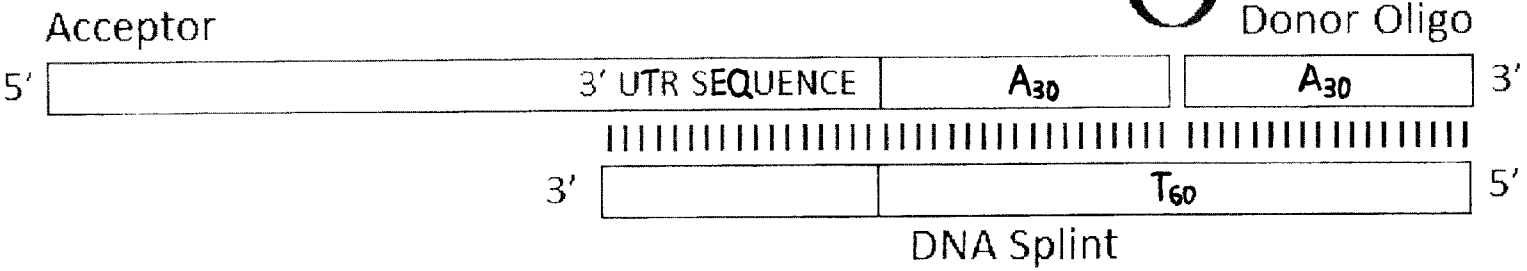
FIG. 9.
Figure 10:
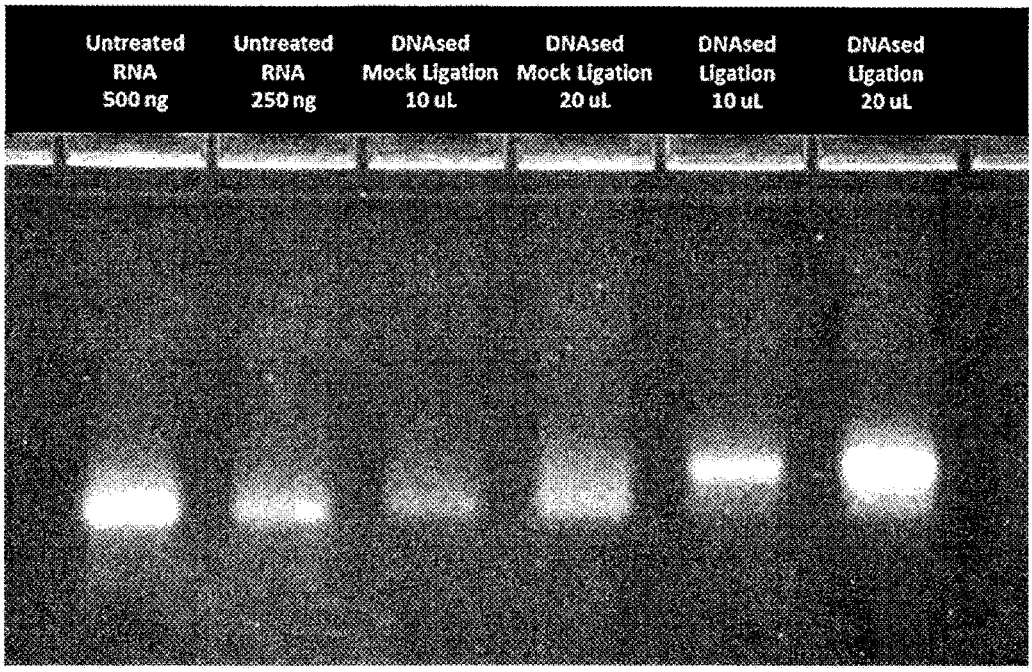
FIG. 10.
Figure 11:
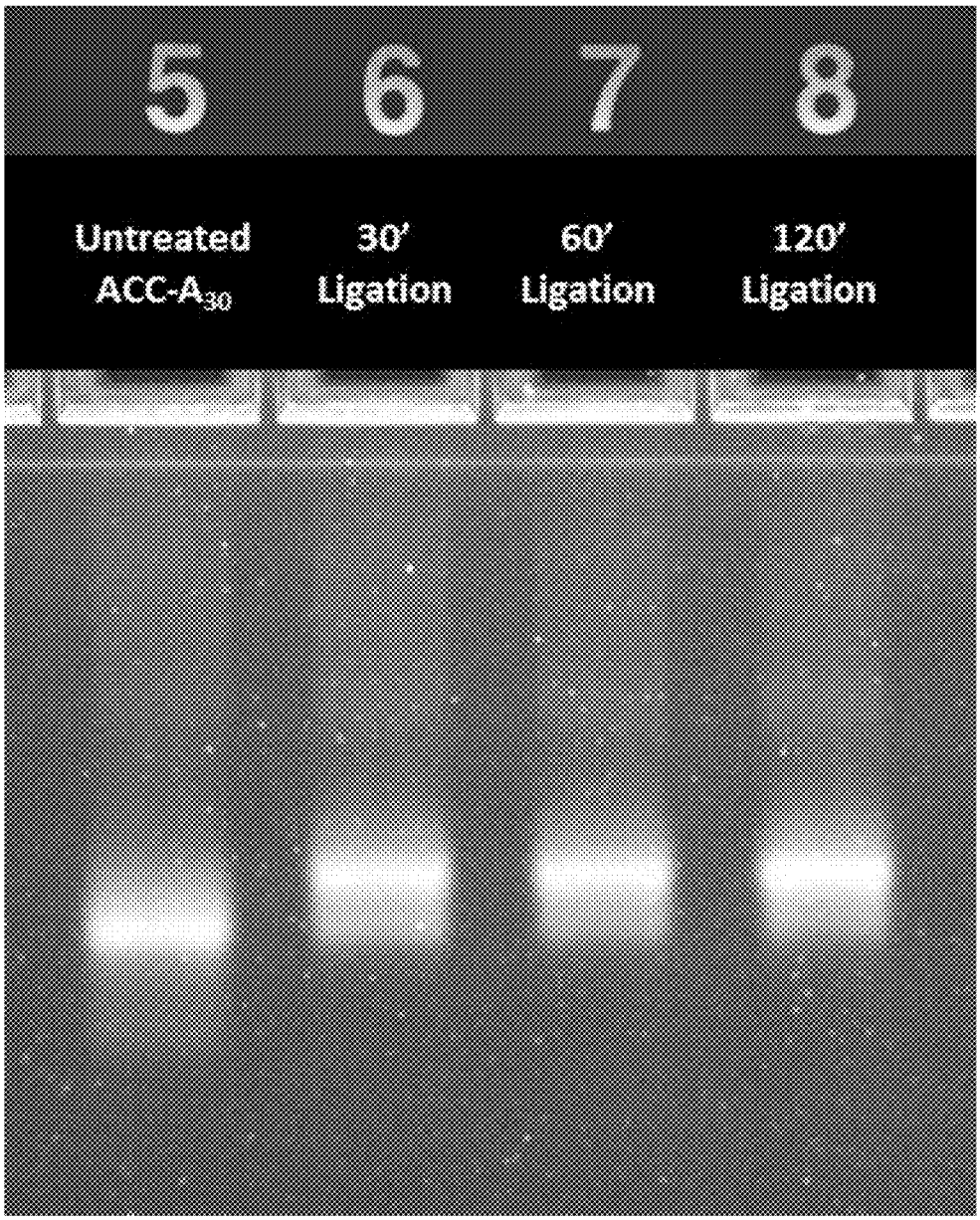
FIG. 11.

The translation efficiency of this mUNA molecule is shown in FIG. 6, as compared to the mRNA of EPO.

The mUNA molecule of this embodiment was translated in C57BL/c mouse to produce human EPO.

FIG. 6 shows that the translation efficiency of this mUNA molecule was advantageously and surprisingly increased as compared to the mRNA of EPO. In particular, after 72 hours, the translation efficiency of this mUNA molecule was increased by more than 10-fold (1517/143) as compared to the mRNA of EPO.

Details of the base structure of this translatable mUNA molecule were as follows:

(SEQ ID NO: 14)

(m7GpppGm)GGGAAACAUAAGUCAACACAACAUAUACAAAACAAACGAA

UCUCAAGCAAUCAAGCAUUCUACUUCUAUUGCAGCAAUUUAAAUCAUUUC

UUUUAAAGCAAAAGCAAUUUUCUGAAAAUUUUCACCAUUUACGAACGAUA

GCCAUGGGGGUGCACGAAUGUCCUGCCUGGCUGUGGCUUCUCCUGUCCCU

GCUGUCGCUCCCUCUGGGCCUCCCAGUCCUGGGCGCCCCACCACGCCUCA

UCUGUGACAGCCGAGUCCUGGAGAGGUACCUCUUGGAGGCCAAGGAGGCC

GAGAAUAUCACGACGGGCUGUGCUGAACACUGCAGCUUGAAUGAGAAUAU

CACUGUCCCAGACACCAAAGUUAAUUUCUAUGCCUGGAAGAGGAUGGAGG

UCGGGCAGCAGGCCGUAGAAGUCUGGCAGGGCCUGGCCCUGCUGUCGGAA

GCUGUCCUGCGGGGCCAGGCCCUGUUGGUCAACUCUUCCCAGCCGUGGGA

GCCCCUGCAGCUGCAUGUGGAUAAAGCCGUCAGUGGCCUUCGCAGCCUCA

CCACUCUGCUUCGGGCUCUGGGAGCCCAGAAGGAAGCCAUCUCCCCUCCA

GAUGCGGCCUCAGCUGCUCCACUCCGAACAAUCACUGCUGACACUUUCCG

CAAACUCUUCCGAGUCUACUCCAAUUUCCUCCGGGGAAAGCUGAAGCUGU

ACACAGGGGAGGCCUGCAGGACAGGGGACAGAUGACUAGUGACUGACUAG

GAUCUGGUUACCACUAAACCAGCCUCAAGAACACCCGAAUGGAGUCUCUA

AGCUACAUAAUACCAACUUACACUUACAAAAUGUUGUCCCCCAAAAUGUA

GCCAUUCGUAUCUGCUCCUAAUAAAAAGAAAGUUUCUUCACAUAAAAAAA

AAAAAAAAAAAAAAAAAAAAAAAAAAAAAAAAAAAAAAAAAAAAAAAÃÃA

AAA

Example 7: mUNA Oligomer Producing Human CFTR

In this example, a translatable mUNA molecule is made for use in expressing human CFTR in vivo. The translatable mUNA molecule expressing human CFTR in vivo is suitable for use in methods for ameliorating or treating cystic fibrosis. In this embodiment, the translatable mUNA molecule comprises a 5' cap (m7GpppGm), a 5' UTR of TEV, a CFTR CDS, a 3'UTR of xenopus beta-globin, and a tail region shown in Example 4.

Human CFTR is accession NM_000492.3.

Example 8: mUNA Oligomer Producing Human ASL

In this example, a translatable mUNA molecule is made for use in expressing human argininosuccinate lyase (ASL) in vivo. The translatable mUNA molecule expressing human ASL in vivo is suitable for use in methods for ameliorating or treating ASL deficiency. In this embodiment, the translatable mUNA molecule comprises a 5' cap (m7GpppGm), a 5' UTR of TEV, a ASL CDS, a 3'UTR of xenopus beta-globin, and a tail region shown in Example 4.

Human ASL is accession NM_001024943.1.

Example 9: mUNA Oligomer Producing Human PAH

In this example, a translatable mUNA molecule is made for use in expressing human Phenylalanine-4-hydroxylase (PAH) in vivo. The translatable mUNA molecule expressing human PAH in vivo is suitable for use in methods for ameliorating or treating Phenylketonuria (PKU). In this embodiment, the translatable mUNA molecule comprises a 5' cap (m7GpppGm), a 5' UTR of TEV, a PAH CDS, a 3'UTR of xenopus beta-globin, and a tail region shown in Example 4.

Human PAH is accession NM_000277.1.

Example 10: mUNA Oligomer Producing Human NIS

In this example, a translatable mUNA molecule is made for use in expressing human Sodium/iodide cotransporter (NIS) in vivo. The translatable mUNA molecule expressing human NIS in vivo is suitable for use in methods for ameliorating or treating thyroid disease. In this embodiment, the translatable mUNA molecule comprises a 5' cap (m7GpppGm), a 5' UTR of TEV, a NIS CDS, a 3'UTR of xenopus beta-globin, and a tail region shown in Example 4.

Human NIS is accession BC105047.

Example 11: mUNA Oligomer Producing Human NIS

In this example, a translatable mUNA molecule is made for use in expressing human Sodium/iodide cotransporter (NIS) in vivo. The translatable mUNA molecule expressing human NIS in vivo is suitable for use in methods for ameliorating or treating thyroid disease. In this embodiment, the translatable mUNA molecule comprises a 5' cap (m7GpppGm), a 5' UTR of TEV, a NIS CDS, a 3'UTR of xenopus beta-globin, and a tail region shown in Example 4.

Human NIS is accession BC105047.

Example 12: mUNA Oligomer Producing Human Hepcidin

In this example, a translatable mUNA molecule is made for use in expressing human Hepcidin in vivo. The translatable mUNA molecule expressing human Hepcidin in vivo is suitable for use in methods for ameliorating or treating iron deficiency disease. In this embodiment, the translatable mUNA molecule comprises a 5' cap (m7GpppGm), a 5' UTR of TEV, a Hepcidin CDS, a 3'UTR of xenopus beta-globin, and a tail region shown in Example 4.

Human Hepcidin is accession NM_021175.3.

Example 13: mUNA Oligomer Expressing Factor IX

In this example, the structures of mUNA molecules for use in expressing Factor IX are shown.

Factor IX (F9) is associated with hemophilia B.

The base sequences shown below are the portion of the mUNA molecule that may correspond in functionality to the open reading frame of the native mRNA of human Factor IX. The complete mUNA molecule comprises a 5' cap (m7GpppGm), and a 5'-UTR upstream of the sequence below, and a 3' UTR and polyA tail (SEQ ID Nos:4 to 12) downstream of the sequence below, each of which corresponds to the structure of the native mRNA of human Factor IX.

Human Factor IX is accession NM_000133.3.

(SEQ ID NO: 15)

AUĜCAGCGCGUGAACAUGAUCAUGGCAGAAUCÃCCAGGCCUCAUCACCAUCUGCCUUUU

AGGÃUAUCUACUCAGUGCUGAAUGUACAGUUUÜCUUGAUCAUGAAAACGCCAACAAAA

UUCUĜAAUCGGCCAAAGAGGUAUAAUUCAGGUAAÃUUGGAAGAGUUUGUUCAAGGGAAC

CUUGAĜAGAGAAUGUAUGGAAGAAAAGUGUAGUUÜGAAGAAGCACGAGAAGUUUUUGA

AAACACÜGAAAGAACAACUGAAUUUUGGAAGCAGUAÜGUUGAUGGAGAUCAGUGUGAGU

CCAAUCCÃUGUUUAAAUGGCGGCAGUUGCAAGGAUGACAUUAAUUCCUAUGAAUGUUGG

UGUCCCUÜGGAUUUGAAGGAAAGAACUGUGAAUUAGAÜGUAACAUGUAACAUUAAGAA

UGGCAGAUGCGAGCAGUUUUGUAAAAAUAGUGCUGAUAACAAGGUGGUUUGCUCCUGUA

CUGAGGGAUAÜCGACUUGCAGAAAACCAGAAGUCCUGUGAÃCCAGCAGUGCCAUUUCCA

UGUGGAAGAGUÜUCUGUUUCACAAACUUCUAAGCUCACCCGÜGCUGAGACUGUUUUUCC

UGAUGUGGACUAÜGUAAAUUCUACUGAAGCUGAAACCAUUUUĜGAUAACAUCACUCAAA

GCACCCAAUCAUÜAAUGACUUCACUCGGGUUGUUGGUGGAGAÃGAUGCCAAACCAGGU

CAAUUCCCUUGGCAĜGUUGUUUUGAAUGGUAAAGUUGAUGCAUUĈUGUGGAGGCUCUAU

CGUUAAUGAAAAAUGĜAUUGUAACUGCUGCCCACUGUGUUGAAACÜGGUGUUAAAAUUA

CAGUUGUCGCAGGUGAÃCAUAAUAUUGAGGAGACAGAACAUACAGAĜCAAAAGCGAAAU

GUGAUUCGAAUUAUUCCÜCACCACAACUACAAUGCAGCUAUUAAUAAĜUACAACCAUGA

CAUUGCCCUUCUGGAACUĜGACGAACCCUUAGUGCUAAACAGCUACGÜÜACACCUAUUU

GCAUUGCUGACAAGGAAUAĈACGAACAUCUUCCUCAAAUUUGGAUCUGGĈUAUGUAAGU

GGCUGGGGAAGAGUCUUCCAĈAAAGGGAGAUCAGCUUUAGUUCUUCAGUAĈCUUAGAGU

UCCACUUGUUGACCGAGCCACÃUGUCUUCGAUCUACAAAGUUCACCAUCUAÜAACAACA

UGUUCUGUGCUGGCUUCCAUGAÃGGAGGUAGAGAUUCAUGUCAAGGAGAUAGÜGGGGGA

CCCCAUGUUACUGAAGUGGAAGGĜACCAGUUUCUUAACUGGAAUUAUUAGCUGĜGGUGA

AGAGUGUGCAAUGAAAGGCAAAUAÜGGAAUAUAUACCAAGGUAUCCCGGUAUGUĈAACU

GGAUUAAGGAAAAAACAAAGCUCACÜUAA (SEQ ID NO: 16)

AÜĜĈAGCGCGUGAACAUGAUCAUGGCAGAAUCACCAGGCCUCAUCACCAUCUGCCUUUU

AGGAUAUCUACUCAGUGCUGAAUGUACAGUUUUUCUUGAUCAUGAAAACGCCAACAAAA

UUCUGAAUCGGCCAAAGAGGUAUAAUUCAGGUAAAUUGGAAGAGUUUGUUCAAGGGAAC

CUUGAGAGAGAAUGUAUGGAAGAAAAGUGUAGUUUUGAAGAAGCACGAGAAGUUUUUGA

AAACACUGAAAGAACAACUGAAUUUUGGAAGCAGUAUGUUGAUGGAGAUCAGUGUGAGU

CCAAUCCAUGUUUAAAUGGCGGCAGUUGCAAGGAUGACAUUAAUUCCUAUGAAUGUUGG

UGUCCCUUUGGAUUUGAAGGAAAGAACUGUGAAUUAGAUGUAACAUGUAACAUUAAGAA

UGGCAGAUGCGAGCAGUUUUGUAAAAAUAGUGCUGAUAACAAGGUGGUUUGCUCCUGUA

CUGAGGGAUAUCGACUUGCAGAAAACCAGAAGUCCUGUGAACCAGCAGUGCCAUUUCCA

UGUGGAAGAGUUUCUGUUUCACAAACUUCUAAGCUCACCCGUGCUGAGACUGUUUUUCC

UGAUGUGGACUAUGUAAAUUCUACUGAAGCUGAAACCAUUUUGGAUAACAUCACUCAAA

GCACCCAAUCAUUUAAUGACUUCACUCGGGUUGUUGGUGGAGAAGAUGCCAAACCAGGU

CAAUUCCCUUGGCAGGUUGUUUUGAAUGGUAAAGUUGAUGCAUUCUGUGGAGGCUCUAU

CGUUAAUGAAAAAUGGAUUGUAACUGCUGCCCACUGUGUUGAAACUGGUGUUAAAAUUA

-continued

CAGUUGUCGCAGGUGAACAUAAUAUUGAGGAGACAGAACAUACAGAGCAAAAGCGAAAU

GUGAUUCGAAUUAUUCCUCACCACAACUACAAUGCAGCUAUUAAUAAGUACAACCAUGA

CAUUGCCCUUCUGGAACUGGACGAACCCUUAGUGCUAAACAGCUACGUUACACCUAUUU

GCAUUGCUGACAAGGAAUACACGAACAUCUUCCUCAAAUUUGGAUCUGGCUAUGUAAGU

GGCUGGGGAAGAGUCUUCCACAAAGGGAGAUCAGCUUUAGUUCUUCAGUACCUUAGAGU

UCCACUUGUUGACCGAGCCACAUGUCUUCGAUCUACAAAGUUCACCAUCUAUAACAACA

UGUUCUGUGCUGGCUUCCAUGAAGGAGGUAGAGAUUCAUGUCAAGGAGAUAGUGGGGGA

CCCCAUGUUACUGAAGUGGAAGGGACCAGUUUCUUAACUGGAAUUAUUAGCUGGGGUGA

AGAGUGUGCAAUGAAAGGCAAAUAUGGAAUAUAUACCAAGGUAUCCCGGUAUGUCAACU

GGAUUAAGGAAAAAACAAAGCUCACUUUAA (SEQ ID NO: 17)

AÜGCAGCGCGÜGAACAÜGAÜCAÜGGCAGAAÜCACCAGGCCÜCAÜCACCAÜCÜGCCÜÜÜG

AGGAÜAÜCÜACÜCAGÜGCÜGAAÜGÜACAGÜÜÜÜÜÜCÜÜGAÜCAÜGAAAACGCCAACAAAA

ÜÜCÜGAAÜCGGCCAAAGAGGÜAÜAAÜÜCAGGÜAAAÜÜGGAAGAGÜÜÜÜGÜÜCAAGGGAAC

CÜÜGAGAGAGAAÜGÜAÜGGAAGAAAAGÜGÜAGÜÜÜÜÜGAAGAAGCACGAGAAGÜÜÜÜÜÜGA

AAACACÜGAAAGAACAACÜGAAÜÜÜÜÜGGAAGCAGÜAÜGÜÜGAÜGGAGAÜCAGÜGÜGAGÜ

CCAAÜCCAÜGÜÜÜÜAAAÜGGCGGCAGÜÜGCAAGGAÜGACAÜÜAAÜÜCCÜAÜGAAÜGÜÜGG

ÜGÜCCCÜÜÜÜGGAÜÜÜÜGAAGGAAAGAACÜGÜGAAÜÜAGAÜGÜAACAÜGÜAACAÜÜAAGAA

ÜGGCAGAÜGCGAGCAGÜÜÜÜÜÜGÜAAAAAÜAGÜGCÜGAÜAACAAGGÜGGÜÜÜÜGCÜCCÜGÜA

CÜGAGGGAÜAÜCGACÜÜGCAGAAAACCAGAAGÜCCÜGÜGAACCAGCAGÜGCCAÜÜÜÜCCA

ÜGÜGGAAGAGÜÜÜÜCÜGÜÜÜÜCACAAACÜÜCUAAGCÜCACCCGÜGCÜGAGACÜGÜÜÜÜÜÜCC

ÜGAÜGÜGGACÜAÜGÜAAAÜÜCÜACÜGAAGCÜGAAACCAÜÜÜÜÜGGAÜAACAÜCACÜCAAA

GCACCCAAÜCAÜÜÜÜAAÜGACÜÜCACÜCGGGÜÜGÜÜGGÜGGAGAAGAÜGCCAAACCAGGÜ

CAAÜÜCCCÜÜGGCAGGÜÜGÜÜÜÜÜGAAÜGGÜAAAGÜÜGAÜGCAÜÜCÜGÜGGAGGCÜCÜAÜ

CGÜÜAAÜGAAAAAÜGGAÜÜGÜAACÜGCÜGCCCACÜGÜGÜÜGAAACÜGGÜGÜÜAAAAÜÜA

CAGÜÜGÜCGCAGGÜGAACAÜAAÜAÜÜGAGGAGACAGAACAÜACAGAGCAAAAGCGAAAÜ

GÜGAÜÜCGAAÜÜAÜÜCCÜCACCACAACÜACAAÜGCAGCÜAÜÜAAÜAAGÜACAACCAÜGA

CAÜÜGCCCÜÜCÜGGAACÜGGACGAACCCÜÜAGÜGCÜAAACAGCÜACGÜÜACACCÜAÜÜG

GCAÜÜGCÜGACAAGGAAÜACACGAACAÜCÜÜCCÜCAAAÜÜÜGGAÜCÜGGCÜAÜGÜAAGÜ

GGCÜGGGGAAGAGÜCÜÜCCACAAAGGGAGAÜCAGCÜÜÜÜAGÜÜCÜÜCAGÜACCÜÜAGAGÜ

ÜCCACÜÜGÜÜGACCGAGCCACAÜGÜCÜÜCGAÜCÜACAAAGÜÜCACCAÜCÜAÜAACAACA

ÜGÜÜCÜGÜGCÜGGCÜÜCCAÜGAAGGAGGÜAGAGAÜÜCAÜGÜCAAGGAGAÜAGÜGGGGGA

CCCCAÜGÜÜACÜGAAGÜGGAAGGGACCAGÜÜÜÜCÜÜAACÜGGAAÜÜAÜÜAGCÜGGGGÜGA

AGAGÜGÜGCAAÜGAAAGGCAAAÜAÜGGAAÜAÜAÜACCAAGGÜAÜCCCGÜAÜGÜCAACÜ

GGAÜÜAAGGAAAAAACAAAGCÜCACÜÜAA

Example 14: mUNA Oligomer Expressing Alpha-1-Antitrypsin

In this example, the structures of mUNA molecules for use in expressing alpha-1-Antitrypsin are shown.

Alpha-1-Antitrypsin is associated with alpha-1-Antitrypsin deficiency disease, cystic fibrosis, interstitial lung disease, and pulmonary arterial hypertension.

The base sequences shown below are the portion of the mUNA molecule that may correspond in functionality to the open reading frame of the native mRNA of alpha-1-Antitrypsin. The complete mUNA molecule comprises a 5' cap (m7GpppGm), and a 5'-UTR upstream of the sequence below, and a 3' UTR and polyA tail (SEQ ID Nos:4 to 12) downstream of the sequence below, each of which corresponds to the structure of the native mRNA of alpha-1-Antitrypsin.

Human alpha-1-antitrypsin mRNA is accession NM_000295.4.

(SEQ ID NO: 18)

AUĜCCGUCUUCUGUCUCGUGGGGCAUCCUCCUĜCUGGCAGGCCUGUGCUGCCUGGUCCC

UGUĈUCCCUGGCUGAGGAUCCCCAGGGAGAUGCŬGCCCAGAAGACAGAUACAUCCCACC

AUGAŬCAGGAUCACCCAACCUUCAACAAGAUCACĈCCCAACCUGGCUGAGUUCGCCUUC

AGCCUÃUACCGCCAGCUGGCACACCAGUCCAACAGĈACCAAUAUCUUCUUCUCCCCAGU

GAGCAUĈGCUACAGCCUUUGCAAUGCUCUCCCUGGĜACCAAGGCUGACACUCACGAUG

AAAUCCUĜGAGGGCCUGAAUUUCAACCUCACGGAGAUŬCCGGAGGCUCAGAUCCAUGAA

GGCUUCCAĜGAACUCCUCCGUACCCUCAACCAGCCAGAĈAGCCAGCUCCAGCUGACCAC

CGGCAAUGGĈCUGUUCCUCAGCGAGGGCCUGAAGCUAGUĜGAUAAGUUUUUGGAGGAUG

UUAAAAAGUUĜUACCACUCAGAAGCCUUCACUGUCAACUUĈGGGGACACCGAAGAGGCC

AAGAAACAGAUĈAACGAUUACGUGGAGAAGGGUACUCAAGGĜAAAAUUGUGGAUUUGGU

CAAGGAGCUUGAĈAGAGACACAGUUUUUGCUCUGGUGAAUUAĈAUCUUCUUUAAAGGCA

AAUGGGAGAGACCĈUUUGAAGUCAAGGACACCGAGGAAGAGGAĈUUCCACGUGGACCAG

GUGACCACCGUGAAĜGUGCCUAUGAUGAAGCGUUUAGGCAUGUUŬAACAUCCAGCACUG

UAAGAAGCUGUCCAGĈUGGGUGCUGCUGAUGAAAUACCUGGGCAAŬGCCACCGCCAUCU

UCUUCCUGCCUGAUGAĜGGGAAACUACAGCACCUGGAAAAUGAACUĈACCCACGAUAUC

AUCACCAAGUUCCUGGAÃAAUGAAGACAGAAGGUCUGCCAGCUUACAŬUUACCCAAACU

GUCCAUUACUGGAACCUAŬGAUCUGAAGAGCGUCCUGGGUCAACUGGĜCAUCACUAAGG

UCUUCAGCAAUGGGGCUGAĈCUCUCCGGGGUCACAGAGGAGGCACCCCUĜAAGCUCUCC

AAGGCCGUGCAUAAGGCUGUĜCUGACCAUCGACGAGAAAGGGACUGAAGCŬGCUGGGGC

CAUGUUUUUAGAGGCCAUACCĈAUGUCUAUCCCCCCCGAGGUCAAGUUCAAĈAAACCCU

UUGUCUUCUUAAUGAUUGAACAÃAAUACCAAGUCUCCCCUCUUCAUGGGAAAÃGUGGUG

AAUCCCACCCAAAAAUÃA (SEQ ID NO: 19)

AŬĜĈCGUCUUCUGUCUCGUGGGGCAUCCUCCUGCUGGCAGGCCUGUGCUGCCUGGUCCC

UGUCUCCCUGGCUGAGGAUCCCCAGGGAGAUGCUGCCCAGAAGACAGAUACAUCCCACC

AUGAUCAGGAUCACCCAACCUUCAACAAGAUCACCCCCAACCUGGCUGAGUUCGCCUUC

AGCCUAUACCGCCAGCUGGCACACCAGUCCAACAGCACCAAUAUCUUCUUCUCCCCAGU

GAGCAUCGCUACAGCCUUUGCAAUGCUCUCCCUGGGGACCAAGGCUGACACUCACGAUG

AAAUCCUGGAGGGCCUGAAUUUCAACCUCACGGAGAUUCCGGAGGCUCAGAUCCAUGAA

GGCUUCCAGGAACUCCUCCGUACCCUCAACCAGCCAGACAGCCAGCUCCAGCUGACCAC

CGGCAAUGGCCUGUUCCUCAGCGAGGGCCUGAAGCUAGUGGAUAAGUUUUUGGAGGAUG

UUAAAAAGUUGUACCACUCAGAAGCCUUCACUGUCAACUUCGGGGACACCGAAGAGGCC

AAGAAACAGAUCAACGAUUACGUGGAGAAGGGUACUCAAGGGAAAAUUGUGGAUUUGGU

-continued

CAAGGAGCUUGACAGAGACACAGUUUUUGCUCUGGUGAAUUACAUCUUCUUUAAAGGCA

AAUGGGAGAGACCCUUUGAAGUCAAGGACACCGAGGAAGAGGACUUCCACGUGGACCAG

GUGACCACCGUGAAGGUGCCUAUGAUGAAGCGUUUAGGCAUGUUUAACAUCCAGCACUG

UAAGAAGCUGUCCAGCUGGGUGCUGCUGAUGAAAUACCUGGGCAAUGCCACCGCCAUCU

UCUUCCUGCCUGAUGAGGGGAAACUACAGCACCUGGAAAAUGAACUCACCCACGAUAUC

AUCACCAAGUUCCUGGAAAAUGAAGACAGAAGGUCUGCCAGCUUACAUUUACCCAAACU

GUCCAUUACUGGAACCUAUGAUCUGAAGAGCGUCCUGGGUCAACUGGGCAUCACUAAGG

UCUUCAGCAAUGGGGCUGACCUCUCCGGGGUCACAGAGGAGGCACCCCUGAAGCUCUCC

AAGGCCGUGCAUAAGGCUGUGCUGACCAUCGACGAGAAAGGGACUGAAGCUGCUGGGGC

CAUGUUUUUAGAGGCCAUACCCAUGUCUAUCCCCCCCGAGGUCAAGUUCAACAAACCCU

UUGUCUUCUUAAUGAUUGAACAAAAUACCAAGUCUCCCCUCUUCAUGGGAAAAGUGGUG

AAUCCCACCCAAAAAUAA (SEQ ID NO: 20)

AÜGCCGÜCÜÜCÜGÜCÜCGÜGGGGCAÜCCÜCCÜGCÜGGCAGGCCÜGÜGCÜGCCÜGGÜCCC

ÜGÜCÜCCCÜGGCÜGAGGAÜCCCCAGGGAGAÜGCÜGCCCAGAAGACAGAÜACAÜCCCACC

AÜGAÜCAGGAÜCACCCAACCÜÜÜCAACAAGAÜCACCCCCAACCÜGGCÜGAGÜÜÜCGCCÜÜÜC

AGCCÜAÜACCGCCAGCÜGGCACACCAGÜCCAACAGCACCAAÜAÜCÜÜÜCÜÜÜCÜCCCCAGÜ

GAGCAÜCGCÜACAGCCÜÜÜÜGCAAÜGCÜCÜCCCÜGGGGACCAAGGCÜGACACÜCACGAÜG

AAAÜCCÜGGAGGGCCÜGAAÜÜÜÜCAACCÜCACGGAGAÜÜÜCCGGAGGCÜCAGAÜCCAÜGAA

GGCÜÜÜCCAGGAACÜCCÜCCGÜACCCÜCAACCAGCCAGACAGCCAGCÜCCAGCÜGACCAC

CGGCAAÜGGCCÜGÜÜCCÜCAGCGAGGGCCÜGAAGCÜAGÜGGAÜAAGÜÜÜÜÜÜGGAGGAÜG

ÜÜÜAAAAAGÜÜÜGÜACCACÜCAGAAGCCÜÜÜCACÜGÜCAACÜÜÜCGGGGACACCGAAGAGGCC

AAGAAACAGAÜCAACGAÜÜÜACGÜGGAGAAGGGÜACÜCAAGGGAAAAÜÜÜGÜGGAÜÜÜÜGGÜ

CAAGGAGCÜÜÜGACAGAGACACAGÜÜÜÜÜÜGCÜCÜGGÜGAAÜÜÜACAÜCÜÜÜCÜÜÜÜAAAGGCA

AAÜGGGAGAGACCÜÜÜÜGAAGÜCAAGGACACCGAGGAAGAGGACÜÜÜCCACGÜGGACCAG

GÜGACCACCGÜGAAGGÜGCCÜAÜGAÜGAAGCGÜÜÜÜAGGCAÜGÜÜÜÜAACAÜCCAGCACÜG

ÜAAGAAGCÜGÜCCAGCÜGGGÜGCÜGCÜGAÜGAAAÜACCÜGGGCAAÜGCCACCGCCAÜCÜ

ÜCÜÜÜCCÜGCCÜGAÜGAGGGGAAACÜACAGCACCÜGGAAAAÜGAACÜCACCCACGAÜAÜC

AÜCACCAAGÜÜÜCCÜGGAAAAÜGAAGACAGAAGGÜCÜGCCAGCÜÜÜACAÜÜÜÜACCCAAACÜ

GÜCCAÜÜÜACÜGGAACCÜAÜGAÜCÜGAAGAGCGÜCCÜGGGÜCAACÜGGGCAÜCACÜAAGG

ÜCÜÜÜCAGCAAÜGGGGCÜGACCÜCÜCCGGGGÜCACAGAGGAGGCACCCCÜGAAGCÜCÜCC

AAGGCCGÜGCAÜAAGGCÜGÜGCÜGACCAÜCGACGAGAAAGGGACÜGAAGCÜGCÜGGGGC

CAÜGÜÜÜÜÜÜAGAGGCCAÜACCCAÜGÜCÜAÜCCCCCCCGAGGÜCAAGÜÜÜCAACAAACCCÜ

ÜÜÜGÜCÜÜÜCÜÜÜAAÜGAÜÜÜGAACAAAAÜACCAAGÜCÜCCCCÜCÜÜÜCAÜGGGAAAAGÜGGÜG

AAÜCCCACCCAAAAAÜAA

Example 15: mUNA Oligomer Expressing Alpha-1-Antitrypsin

In this example, the structures of mUNA molecules for use in expressing alpha-1-Antitrypsin are shown.

Alpha-1-Antitrypsin is associated with alpha-1-Antitrypsin deficiency disease, cystic fibrosis, interstitial lung disease, and pulmonary arterial hypertension.

The base sequences shown below are the portion of the mUNA molecule that may correspond in functionality to the 5'-UTR of the native mRNA of alpha-1-Antitrypsin. The complete mUNA molecule comprises a 5' cap (m7GpppGm) upstream of the sequence below, and coding region (CDS) for human alpha-1-Antitrypsin, a 3' UTR and polyA tail (SEQ ID Nos:4 to 12) downstream of the sequence below, each of which corresponds to the structure of the native mRNA of alpha-1-Antitrypsin.

Human alpha-1-antitrypsin mRNA is accession NM_000295.4.

(SEQ ID NO: 21)
GGCACCACCACUGACCUGGGACAGUGAAUCGACAGCCGACC (SEQ ID NO: 22)
GGCACCACCACUGACCUGGGACAGUGAAUCGACAGCCGACC (SEQ ID NO: 23)
GGCACCACCACUGACCUGGGACAGUGAAUCGACAGCCGACC (SEQ ID NO: 24)
GGCACCACCACUGACCUGGGACAGUGAAUCGACAGCCGACC (SEQ ID NO: 25)
GGCACCACCACUGACCUGGGACAGUGAAUCGACAGCCGACC (SEQ ID NO: 26)
GGCACCACCACUGACCUGGGACAGUGAAUCGACAGCCGACC (SEQ ID NO: 27)
GGCACCACCACUGACCUGGGACAGUGAAUCGACAGCCGACC (SEQ ID NO: 28)
GGCACCACCACUGACCUGGGACAGUGAAUCGACAGCCGACC (SEQ ID NO: 29)
GGCACCACCACUGACCUGGGACAGUGAAUCGACAGCCGACC (SEQ ID NO: 30)
GGCACCACCACUGACCUGGGACAGUGAAUCGACAGCCGACC (SEQ ID NO: 31)
GGCACCACCACUGACCUGGGACAGUGAAUCGACAGCCGACC (SEQ ID NO: 32)
GGCACCACCACUGACCUGGGACAGUGAAUCGACAGCCGACC (SEQ ID NO: 33)
GGCACCACCACUGACCUGGGACAGUGAAUCGACAGCCGACC (SEQ ID NO: 34)
GGCACCACCACUGACCUGGGACAGUGAAUCGACAGCCGACC (SEQ ID NO: 35)
GGCACCACCACUGACCUGGGACAGUGAAUCGACAGCCGACC (SEQ ID NO: 36)
GGCACCACCACUGACCUGGGACAGUGAAUCGACAGCCGACC (SEQ ID NO: 37)
GGCACCACCACUGACCUGGGACAGUGAAUCGACAGCCGACC (SEQ ID NO: 38)
GGCACCACCACUGACCUGGGACAGUGAAUCGACAGCCGACC

-continued (SEQ ID NO: 39)
GGCACCACCACUGACCUGGGACAGUGAAUCGACAGCCGACC (SEQ ID NO: 40)
GGCACCACCACUGACCUGGGACAGUGAAUCGACAGCCGACC (SEQ ID NO: 41)
GGCACCACCACUGACCUGGGACAGUGAAUCGACAGCCGACC (SEQ ID NO: 42)
GGCACCACCACUGACCUGGGACAGUGAAUCGACAGCCGACC (SEQ ID NO: 43)
GGCACCACCACUGACCUGGGACAGUGAAUCGACAGCCGACC (SEQ ID NO: 44)
GGCACCACCACUGACCUGGGACAGUGAAUCGACAGCCGACC (SEQ ID NO: 45)
GGCACCACCACUGACCUGGGACAGUGAAUCGACAGCCGACC (SEQ ID NO: 46)
GGCACCACCACUGACCUGGGACAGUGAAUCGACAGCCGACC (SEQ ID NO: 47)
GGCACCACCACUGACCUGGGACAGUGAAUCGACAGCCGACC (SEQ ID NO: 48)
GGCACCACCACUGACCUGGGACAGUGAAUCGACAGCCGACC (SEQ ID NO: 49)
GGCACCACCACUGACCUGGGACAGUGAAUCGACAGCCGACC (SEQ ID NO: 50)
GGCACCACCACUGACCUGGGACAGUGAAUCGACAGCCGACC (SEQ ID NO: 51)
GGCACCACCACUGACCUGGGACAGUGAAUCGACAGCCGACC (SEQ ID NO: 52)
GGCACCACCACUGACCUGGGACAGUGAAUCGACAGCCGACC (SEQ ID NO: 53)
GGCACCACCACUGACCUGGGACAGUGAAUCGACAGCCGACC (SEQ ID NO: 54)
GGCACCACCACUGACCUGGGACAGUGAAUCGACAGCCGACC (SEQ ID NO: 55)
GGCACCACCACUGACCUGGGACAGUGAAUCGACAGCCGACC (SEQ ID NO: 56)
GGCACCACCACUGACCUGGGACAGUGAAUCGACAGCCGACC (SEQ ID NO: 57)
GGCACCACCACUGACCUGGGACAGUGAAUCGACAGCCGACC (SEQ ID NO: 58)
GGCACCACCACUGACCUGGGACAGUGAAUCGACAGCCGACC (SEQ ID NO: 59)
GGCACCACCACUGACCUGGGACAGUGAAUCGACAGCCGACC (SEQ ID NO: 60)
GGCACCACCACUGACCUGGGACAGUGAAUCGACAGCCGACC (SEQ ID NO: 61)
GGCACCACCACUGACCUGGGACAGUGAAUCGACAGCCGACC (SEQ ID NO: 62)
GGCACCACCACUGACCUGGGACAGUGAAUCGACAGCCGACC (SEQ ID NO: 63)
GGCACCACCACUGACCUGGGACAGUGAAUCGACAGCCGACC (SEQ ID NO: 64)
GGCACCACCACUGACCUGGGACAGUGAAUCGACAGCCGACC -continued (SEQ ID NO: 65)
GGCACCACCACUGACĈUGGGACAGUGAAUCGACAGCCGACĈ

(SEQ ID NO: 66)
GGCACCACCACUGAĈCUGGGACAGUGAAUCGACAGCCGACĈ

(SEQ ID NO: 67)
GGCACCACCACUGÃCCUGGGACAGUGAAUCGACAGCCGACĈ

(SEQ ID NO: 68)
GGCACCACCACUĜACCUGGGACAGUGAAUCGACAGCCGACĈ

(SEQ ID NO: 69)
GGCACCACCACÜGACCUGGGACAGUGAAUCGACAGCCGACĈ

(SEQ ID NO: 70)
GGCACCACCÂCUGACCUGGGACAGUGAAUCGACAGCCGACĈ

(SEQ ID NO: 71)
GGCACCACCÃCUGACCUGGGACAGUGAAUCGACAGCCGACĈ

(SEQ ID NO: 72)
GGCACCACĈACUGACCUGGGACAGUGAAUCGACAGCCGACĈ

(SEQ ID NO: 73)
GGCACCAĈCACUGACCUGGGACAGUGAAUCGACAGCCGACĈ

(SEQ ID NO: 74)
GGCACCÃCCACUGACCUGGGACAGUGAAUCGACAGCCGACĈ

(SEQ ID NO: 75)
GGCACĈACCACUGACCUGGGACAGUGAAUCGACAGCCGACĈ

(SEQ ID NO: 76)
GGCÂĈCACCACUGACCUGGGACAGUGAAUCGACAGCCGACĈ

(SEQ ID NO: 77)
GGCÃCCACCACUGACCUGGGACAGUGAAUCGACAGCCGACĈ

(SEQ ID NO: 78)
GGĈACCACCACUGACCUGGGACAGUGAAUCGACAGCCGACĈ

(SEQ ID NO: 79)
GĜCACCACCACUGACCUGGGACAGUGAAUCGACAGCCGACĈ

(SEQ ID NO: 80)
GGCACCACCACUGACCUGGGACAGUGAAUCGACAGCCGÃĈĈ

(SEQ ID NO: 81)
GGCACCACCACUGACCUGGGACAGUGAAUCGACAGĈĈGACC (SEQ ID NO: 82)
GGCACCACCACUGACCUGGGACAGUGAAUCGAĈÃĜCCGACC (SEQ ID NO: 83)
GGCACCACCACUGACCUGGGACAGUGAAUĈĜÃCAGCCGACC (SEQ ID NO: 84)
GGCACCACCACUGACCUGGGACAGUGÃÃÜCGACAGCCGACC (SEQ ID NO: 85)
GGCACCACCACUGACCUGGGACAĜÜĜAAUCGACAGCCGACC (SEQ ID NO: 86)
GGCACCACCACUGACCUGGGÃĈÃAGUGAAUCGACAGCCGACC (SEQ ID NO: 87)
GGCACCACCACUGACCUĜĜĜACAGUGAAUCGACAGCCGACC (SEQ ID NO: 88)
GGCACCACCACUGAĈĈÜGGGACAGUGAAUCGACAGCCGACC (SEQ ID NO: 89)
GGCACCACCACÜĜÃCCUGGGACAGUGAAUCGACAGCCGACC

-continued (SEQ ID NO: 90)
GGCACCACĈÃĈUGACCUGGGACAGUGAAUCGACAGCCGACC (SEQ ID NO: 91)
GGCACĈÃĈCACUGACCUGGGACAGUGAAUCGACAGCCGACC (SEQ ID NO: 92)
GGĈÃĈCACCACUGACCUGGGACAGUGAAUCGACAGCCGACC (SEQ ID NO: 93)
GĜCACCACCACUGACCUGGGACAGUGAAUCGACAGCCGÃCĈ

(SEQ ID NO: 94)
GĜCACCACCACUGACCUGGGACAGUGAAUCGACAGCCĜACĈ

(SEQ ID NO: 95)
GĜCACCACCACUGACCUGGGACAGUGAAUCGACAGCĈGACĈ

(SEQ ID NO: 96)
GĜCACCACCACUGACCUGGGACAGUGAAUCGACAGĈCGACĈ

(SEQ ID NO: 97)
GĜCACCACCACUGACCUGGGACAGUGAAUCGACAĜCCGACĈ

(SEQ ID NO: 98)
GĜCACCACCACUGACCUGGGACAGUGAAUCGACÃGCCGACĈ

(SEQ ID NO: 99)
GĜCACCACCACUGACCUGGGACAGUGAAUCGAĈAGCCGACĈ

(SEQ ID NO: 100)
GĜCACCACCACUGACCUGGGACAGUGAAUCGÃCAGCCGACĈ

(SEQ ID NO: 101)
GĜCACCACCACUGACCUGGGACAGUGAAUCĜACAGCCGACĈ

(SEQ ID NO: 102)
GĜCACCACCACUGACCUGGGACAGUGAAUĈGACAGCCGACĈ

(SEQ ID NO: 103)
GĜCACCACCACUGACCUGGGACAGUGAÃÜCGACAGCCGACĈ

(SEQ ID NO: 104)
GĜCACCACCACUGACCUGGGACAGUGÃAUCGACAGCCGACĈ

(SEQ ID NO: 105)
GĜCACCACCACUGACCUGGGACAGUGÃAUCGACAGCCGACĈ

(SEQ ID NO: 106)
GĜCACCACCACUGACCUGGGACAGUĜAAUCGACAGCCGACĈ

(SEQ ID NO: 107)
GĜCACCACCACUGACCUGGGACAGÜGAAUCGACAGCCGACĈ

(SEQ ID NO: 108)
GĜCACCACCACUGACCUGGGACAĜUGAAUCGACAGCCGACĈ

(SEQ ID NO: 109)
GĜCACCACCACUGACCUGGGACÃGUGAAUCGACAGCCGACĈ

(SEQ ID NO: 110)
GĜCACCACCACUGACCUGGGAĈAGUGAAUCGACAGCCGACĈ

(SEQ ID NO: 111)
GĜCACCACCACUGACCUGGGÃCAGUGAAUCGACAGCCGACĈ

(SEQ ID NO: 112)
GĜCACCACCACUGACCUGGĜACAGUGAAUCGACAGCCGACĈ

(SEQ ID NO: 113)
GĜCACCACCACUGACCUGĜGACAGUGAAUCGACAGCCGACĈ

(SEQ ID NO: 114)
GĜCACCACCACUGACCUĜGGACAGUGAAUCGACAGCCGACĈ

(SEQ ID NO: 115)
GĜCACCACCACUGACCÜGGGACAGUGAAUCGACAGCCGACĈ

-continued (SEQ ID NO: 116)

GĜCACCACCACUGACĈUGGGACAGUGAAUCGACAGCCGACĈ

(SEQ ID NO: 117)

GĜCACCACCACUGAĈCUGGGACAGUGAAUCGACAGCCGACĈ

(SEQ ID NO: 118)

GĜCACCACCACUGĂCCUGGGACAGUGAAUCGACAGCCGACĈ

(SEQ ID NO: 119)

GĜCACCACCACUĜACCUGGGACAGUGAAUCGACAGCCGACĈ

(SEQ ID NO: 120)

GĜCACCACCACŬGACCUGGGACAGUGAAUCGACAGCCGACĈ

(SEQ ID NO: 121)

GĜCACCACCAĈUGACCUGGGACAGUGAAUCGACAGCCGACĈ

(SEQ ID NO: 122)

GĜCACCACCĂCUGACCUGGGACAGUGAAUCGACAGCCGACĈ

(SEQ ID NO: 123)

GĜCACCACĈACUGACCUGGGACAGUGAAUCGACAGCCGACĈ

(SEQ ID NO: 124)

GĜCACCAĈCACUGACCUGGGACAGUGAAUCGACAGCCGACĈ

(SEQ ID NO: 125)

GĜCACCĂCCACUGACCUGGGACAGUGAAUCGACAGCCGACĈ

(SEQ ID NO: 126)

GĜCACĈACCACUGACCUGGGACAGUGAAUCGACAGCCGACĈ

-continued (SEQ ID NO: 127)

GĜCAĈCACCACUGACCUGGGACAGUGAAUCGACAGCCGACĈ

(SEQ ID NO: 128)

GĜCĂCCACCACUGACCUGGGACAGUGAAUCGACAGCCGACĈ

(SEQ ID NO: 129)

GĜĈACCACCACUGACCUGGGACAGUGAAUCGACAGCCGACĈ

(SEQ ID NO: 130)

ĜĜCACCACCACUGACCUGGGACAGUGAAUCGACAGCCGACĈ

Example 16: mUNA Oligomer Expressing Erythropoietin (EPO)

In this example, the structures of mUNA molecules for use in expressing human Erythropoietin (EPO) are shown.

Erythropoietin is available as a commercial drug and is indicated for anemia resulting from chronic kidney disease, inflammatory bowel disease including Crohn's disease and ulcer colitis, and myelodysplasia from the treatment of cancer with chemotherapy or radiation.

The base sequences shown below are the portion of the mUNA molecule that may correspond in functionality to the open reading frame of the native mRNA of human Erythropoietin. The complete mUNA molecule comprises a 5' cap (m7GpppGm), and a 5'-UTR upstream of the sequence below, and a 3' UTR and polyA tail (SEQ ID Nos:4 to 12) downstream of the sequence below, each of which corresponds to the structure of the native mRNA of human Erythropoietin.

Human Erythropoietin is accession NM_000799.2.

(SEQ ID NO: 131)

AŬĜĜGGGUGCACGAAUGUCCUGCCUGGCUGUGGCUUCUCCUGUCCCUGCUGUCGCUCCC

UCUGGGCCUCCCAGUCCUGGGCGCCCCACCACGCCUCAUCUGUGACAGCCGAGUCCUGG

AGAGGUACCUCUUGGAGGCCAAGGAGGCCGAGAAUAUCACGACGGGCUGUGCUGAACAC

UGCAGCUUGAAUGAGAAUAUCACUGUCCCAGACACCAAAGUUAAUUUCUAUGCCUGGAA

GAGGAUGGAGGUCGGGCAGCAGGCCGUAGAAGUCUGGCAGGGCCUGGCCCUGCUGUCGG

AAGCUGUCCUGCGGGGCCAGGCCCUGUUGGUCAACUCUUCCCAGCCGUGGGAGCCCCUG

CAGCUGCAUGUGGAUAAAGCCGUCAGUGGCCUUCGCAGCCUCACCACUCUGCUUCGGGC

UCUGGGAGCCCAGAAGGAAGCCAUCUCCCCUCCAGAUGCGGCCUCAGCUGCUCCACUCC

GAACAAUCACUGCUGACACUUUCCGCAAACUCUUCCGAGUCUACUCCAAUUUCCUCCGG

GGAAAGCUGAAGCUGUACACAGGGGAGGCCUGCAGGACAGGGGACAGĂŬĜA (SEQ ID NO: 132)

AUĜGGGGUGCACGAĂUGUCCUGCCUGĜCUGUGGCUUCUĈCUGUCCCUGCUĜUCGCUCCC

UCUĜGGCCUCCCAGUĈCUGGGCGCCCCĂCCACGCCUCAUĈUGUGACAGCCGĂGUCCUGG

AGAGĜUACCUCUUGGAĜGCCAAGGAGGCĈGAGAAUAUCACĜACGGGCUGUGCŬGAACAC

UGCAGĈUUGAAUGAGAAŬAUCACUGUCCCĂGACACCAAAGUŬAAUUUCUAUGCĈUGGAA

GAGGAUĜGAGGUCGGGCAĜCAGGCCGUAGAĂGUCUGGCAGGGĈCUGGCCCUGCUĜUCGG

AAGCUGUĈCUGCGGGGCCAĜGCCCUGUUGGUĈAACUCUUCCCAĜCCGUGGGAGCCĈCUG

CAGCUGCAŬGUGGAUAAAGCĈGUCAGUGGCCUŬCGCAGCCUCACĈACUCUGCUUCGĜGC

UCUGGGAGCĈCAGAAGGAAGCĈAUCUCCCCUCCĂGAUGCGGCCUCĂGCUGCUCCACUĈC

GAACAAUCACŬGCUGACACUUUĈCGCAAACUCUUĈCGAGUCUACUCĈAAUUUCCUCCGĜ

-continued

GGAAAGCUGAAGCUGUACACAGGGGAGGCCUGCAGGACAGGGGACAGAUGA (SEQ ID NO: 133)

AUGGGGGUGCACGAAUGUCCUGCCUGGCUGUGGCUUCUCCUGUCCCUGCUGUCGCUCCC

UCUGGGCCUCCCAGUCCUGGGCGCCCCACCACGCCUCAUCUGUGACAGCCGAGUCCUGG

AGAGGUACCUCUUGGAGGCCAAGGAGGCCGAGAAUAUCACGACGGGCUGUGCUGAACAC

UGCAGCUUGAAUGAGAAUAUCACUGUCCCAGACACCAAAGUUAAUUUCUAUGCCUGGAA

GAGGAUGGAGGUCGGGCAGCAGGCCGUAGAAGUCUGGCAGGGCCUGGCCCUGCUGUCGG

AAGCUGUCCUGCGGGGCCAGGCCCUGUUGGUCAACUCUUCCCAGCCGUGGGAGCCCCUG

CAGCUGCAUGUGGAUAAAGCCGUCAGUGGCCUUCGCAGCCUCACCACUCUGCUUCGGGC

UCUGGGAGCCCAGAAGGAAGCCAUCUCCCCUCCAGAUGCGGCCUCAGCUGCUCCACUCC

GAACAAUCACUGCUGACACUUUCCGCAAACUCUUCCGAGUCUACUCCAAUUUCCUCCGG

GGAAAGCUGAAGCUGUACACAGGGGAGGCCUGCAGGACAGGGGACAGAUGA (SEQ ID NO: 134)

AUGCUGUUUAAUCUGAGGAUCCUGUUUAAACAAUGCAGCUUUUAGAAAUGGUCACAACU

UCAUGGUUCGAAAUUUCGGUGUGGACAACCACUACAAAAUAAAGUGCAGCUGAAGGGC

CGUGACCUUCUCACUCUAAAAAACUUUACCGGAGAAGAAAUUAAAUAUAUGCUAUGGCU

AUCAGCAGAUCUGAAAUUUAGGAUAAAACAGAAAGGAGAGUAUUUGCCUUUAUUGCAAG

GGAAGUCCUUAGGCAUGAUUUUUGAGAAAAGAAGUACUCGAACAAGAUUGUCUACAGAA

ACAGGCUUUGCACUUCUGGGAGGACAUCCUUGUUUUCUUACCACACAAGAUAUUCAUUU

GGGUGUGAAUGAAAGUCUCACGGACACGGCCCGUGUAUUGUCUAGCAUGGCAGAUGCAG

UAUUGGCUCGAGUGUAUAAACAAUCAGAUUUGGACACCCUGGCUAAAGAAGCAUCCAUC

CCAAUUAUCAAUGGGCUGUCAGAUUUGUACCAUCCUAUCCAGAUCCUGGCUGAUUACCU

CACGCUCCAGGAACACUAUAGCUCUCUGAAAGGUCUUACCCUCAGCUGGAUCGGGGAUG

GGAACAAUAUCCUGCACUCCAUCAUGAUGAGCGCAGCGAAAUUCGGAAUGCACCUUCAG

GCAGCUACUCCAAAGGGUUAUGAGCCGGAUGCUAGUGUAACCAAGUUGGCAGAGCAGUA

UGCCAAAGAGAAUGGUACCAAGCUGUUGCUGACAAAUGAUCCAUUGGAAGCAGCGCAUG

GAGGCAAUGUAUUAAUUACAGACACUUGGAUAAGCAUGGGACAAGAAGAGGAGAAGAAA

AAGCGGCUCCAGGCUUUCCAAGGUUACCAGGUUACAAUGAAGACUGCUAAAGUUGCUGC

CUCUGACUGGACAUUUUUACACUGCUUGCCCAGAAAGCCAGAAGAAGUGGAUGAUGAAG

UCUUUUAUUCUCCUCGAUCACUAGUGUUCCCAGAGGCAGAAAACAGAAAGUGGACAAUC

AUGGCUGUCAUGGUGUCCCUGCUGACAGAUUACUCACCUCAGCUCCAGAAGCCUAAAUU

UUGA

Example 17: mUNA Oligomer Expressing Ornithine Transcarbamylase

In this example, the structures of mUNA molecules for use in expressing human Ornithine transcarbamylase are shown.

Ornithine transcarbamylase is associated with Ornithine transcarbamylase deficiency.

The base sequences shown below are the portion of the mUNA molecule that may correspond in functionality to the open reading frame of the native mRNA of human Ornithine transcarbamylase. The complete mUNA molecule comprises a 5' cap (m7GpppGm), and a 5'-UTR upstream of the sequence below, and a 3' UTR and polyA tail (SEQ ID Nos:4 to 12) downstream of the sequence below, each of which corresponds to the structure of the native mRNA of human Ornithine transcarbamylase.

Human Ornithine transcarbamylase is accession NM_000531.5.

-continued (SEQ ID NO: 135)

AÛÛÛCUGUUUAAUCUGAGGAUCCUGUUAAACAAUGCAGCUUUUAGAAAUGGUCACAACUU

CAUGGUUCGAAAUUUUCGGUGUGGACAACCACUACAAAAUAAAGUGCAGCUGAAGGGCC

GUGACCUUCUCACUCUAAAAAACUUUACCGGAGAAGAAAUUAAAUAUAUGCUAUGGCUA

UCAGCAGAUCUGAAAUUUAGGAUAAAACAGAAAGGAGAGUAUUUGCCUUUAUUGCAAGG

GAAGUCCUUAGGCAUGAUUUUUGAGAAAAGAAGUACUCGAACAAGAUUGUCUACAGAAA

CAGGCUUUGCACUUCUGGGAGGACAUCCUUGUUUUCUUACCACACAAGAUAUUCAUUUG

GGUGUGAAUGAAAGUCUCACGGACACGGCCCGUGUAUUGUCUAGCAUGGCAGAUGCAGU

AUUGGCUCGAGUGUAUAAACAAUCAGAUUUGGACACCCUGGCUAAAGAAGCAUCCAUCC

CAAUUAUCAAUGGGCUGUCAGAUUUGUACCAUCCUAUCCAGAUCCUGGCUGAUUACCUC

ACGCUCCAGGAACACUAUAGCUCUCUGAAAGGUCUUACCCUCAGCUGGAUCGGGGAUGG

GAACAAUAUCCUGCACUCCAUCAUGAUGAGCGCAGCGAAAUUCGGAAUGCACCUUCAGG

CAGCUACUCCAAAGGGUUAUGAGCCGGAUGCUAGUGUAACCAAGUUGGCAGAGCAGUAU

GCCAAAGAGAAUGGUACCAAGCUGUUGCUGACAAAUGAUCCAUUGGAAGCAGCGCAUGG

AGGCAAUGUAUUAAUUACAGACACUUGGAUAAGCAUGGGACAAGAAGAGGAGAAGAAAA

AGCGGCUCCAGGCUUUCCAAGGUUACCAGGUUACAAUGAAGACUGCUAAAGUUGCUGCC

UCUGACUGGACAUUUUUACACUGCUUGCCCAGAAAGCCAGAAGAAGUGGAUGAUGAAGU

CUUUUAUUCUCCUCGAUCACUAGUGUUCCCAGAGGCAGAAAACAGAAAGUGGACAAUCA

UGGCUGUCAUGGUGUCCCUGCUGACAGAUUACUCACCUCAGCUCCAGAAGCCUAAAUUÛ

ÛÛGA (SEQ ID NO: 136)

AÛGCÛGÛÛÛAAÛCÛGAGGAÛCCÛGÛÛAAACAAÛGCAGCÛÛÛÛAGAAAÛGGÛCACAACÛÛ

CAÛGGÛÛCGAAAÛÛÛÛCGGÛGÛGGACAACCACÛACAAAAÛAAAGÛGCAGCÛGAAGGGCC

GÛGACCÛÛCÛCACÛCÛAAAAAACÛÛÛACCGGAGAAGAAAÛÛAAAÛAÛAÛGCÛAÛGGCÛA

ÛCAGCAGAÛCÛGAAAÛÛÛAGGAÛAAAACAGAAAGGAGAGÛAÛÛÛGCCÛÛÛAÛÛGCAAGG

GAAGÛCCÛÛAGGCAÛGAÛÛÛÛÛGAGAAAAGAAGÛACÛCGAACAAGAÛÛGÛCÛACAGAAA

CAGGCÛÛÛGCACÛÛCÛGGGAGGACAÛCCÛÛGÛÛÛÛCÛÛACCACACAAGAÛAÛÛCAÛÛÛG

GGÛGÛGAAÛGAAAGÛCÛCACGGACACGGCCCGÛGÛAÛÛGÛCÛAGCAÛGGCAGAÛGCAGÛ

AÛÛGGCÛCGAGÛGÛAÛAAACAAÛCAGAÛÛÛGGACACCCÛGGCÛAAAGAAGCAÛCCAÛCC

CAAÛÛAÛCAAÛGGGCÛGÛCAGAÛÛÛGÛACCAÛCCÛAÛCCAGAÛCCÛGGCÛGAÛÛACCÛC

ACGCÛCCAGGAACACÛAÛAGCÛCÛCÛGAAAGGÛCÛÛACCCÛCAGCÛGGAÛCGGGGAÛGG

GAACAAÛAÛCCÛGCACÛCCAÛCAÛGAÛGAGCGCAGCGAAAÛÛCGGAAÛGCACCÛÛCAGG

CAGCÛACÛCCAAAGGGÛÛAÛGAGCCGGAÛGCÛAGÛGÛAACCAAGÛÛGGCAGAGCAGÛAÛ

GCCAAAGAGAAÛGGÛACCAAGCÛGÛÛGCÛGACAAAÛGAÛCCAÛÛGGAAGCAGCGCAÛGG

AGGCAAÛGÛAÛÛAAÛÛACAGACACÛÛGGAÛAAGCAÛGGGACAAGAAGAGGAGAAGAAAA

AGCGGCÛCCAGGCÛÛÛCCAAGGÛÛACCAGGÛÛACAAÛGAAGACÛGCÛAAAGÛÛGCÛGCC

ÛCÛGACÛGGACAÛÛÛÛÛACACÛGCÛÛGCCCAGAAAGCCAGAAGAAGÛGGAÛGAÛGAAGÛ

CÛÛÛÛAÛÛCÛCCÛCGAÛCACÛAGÛGÛÛCCCAGAGGCAGAAAACAGAAAGÛGGACAAÛCA

ÛGGCÛGÛCAÛGGÛGÛCCCÛGCÛGACAGAÛÛACÛCACCÛCAGCÛCCAGAAGCCÛAAAÛÛÛ

ÛGA

Example 18: mUNA Oligomer Expressing Beta-Globin

In this example, the structures of mUNA molecules for use in expressing human beta-globin are shown.

Beta-globin may be associated with sickle-cell disease, beta thalassemia, and genetic resistance to malaria.

The base sequences shown below are the portion of the mUNA molecule that may correspond in functionality to the 3'-UTR of the native mRNA of human beta-globin. The complete mUNA molecule comprises a 5' cap (m7GpppGm), 5'-UTR, and coding region (CDS) for human beta-globin upstream of the sequence below, and a polyA tail (SEQ ID Nos:4 to 12) downstream of the sequence below, each of which corresponds to the structure of the native mRNA of human beta-globin.

Human beta-globin is accession NM_000518.4.

(SEQ ID NO: 137)

GĈUCGCUUUCUUGCUGUCCAAUUUCUAUUAAAGGUUCCUUUGUUCCCUAAGUCCAACUA

CUAAACUGGGGGAUAUUAUGAAGGGCCUUGAGCAUCUGGAUUCUGCCUAAUAAAAAACA

UUUAUUUUCAUUGCÃA (SEQ ID NO: 138)

GĈÜĈGCUUUCUUGCUGUCCAAUUUCUAUUAAAGGUUCCUUUGUUCCCUAAGUCCAACUA

CUAAACUGGGGGAUAUUAUGAAGGGCCUUGAGCAUCUGGAUUCUGCCUAAUAAAAAACA

UUUAUUUUCAUUĜĈÃA (SEQ ID NO: 139)

GĈUCGCUÜUCUUGĈUGUCCÃAUUUCÜAUUAÃAGGUUCĈUUUGUÜCCCUAÃGUCCAÃCUA

CUÃAACUGĜGGGAUÃUUAUGÃAGGGCĈUUGAGĈAUCUGĜAUUCUĜCCUAAÜAAAAAÃCA

UUUÃUUUUCÃUUGCÃA (SEQ ID NO: 140)

GĈÜCGCUÜÜCUUGĈÜGUCCÃÃUUUCÜÃUUAÃÃĜGUUCĈÜUUGUÜĈCCUAÃĜUCCAÃĈUA

CUÃÃACUGĜĜGGAUÃÜUAUGÃÃAGGGCĈÜUGAGĈÃUCUGĜÃUUCUĜĈCUAAÜÃAAAAÃĈA

UUUÃÜUUUCÃÜUGCÃA (SEQ ID NO: 141)

ĜĈÜĈĜĈÜÜÜĜÜÜĜĈÜĜÜĈĜÃÜÜÜĈÜÃÜÜÃÃĜĜÜÜĈĈÜÜÜĜÜÜĈĈĈÜÃĜÜĈĈÃĈÜÃ

ĈÜÃÃĈÜĜĜĜĜÃÜÃÜÜÃÜĜÃĜĜĜĈĈÜÜĜÃĜĈÃÜĈÜĜĜÃÜÜĈÜĜĈĈÜÃÃÜÃÃÃÃÃĈÃ

ÜÜÜÃÜÜÜÜĜÃÜÜĜĈÃÃ

Example 19: mUNA Oligomer Translation Enhancer Based on Xenopus Beta-Globin 3'UTR In this example, the structures of mUNA molecules for use in enhancing translational efficiency are shown.

The base sequences shown below are the portion of the mUNA molecule that may correspond in functionality to the 3'-UTR of Xenopus beta-globin. The complete mUNA molecule comprises a 5' cap (m7GpppGm), 5'-UTR, and coding region (CDS) upstream of the sequence below, and a polyA tail (SEQ ID Nos:4 to 12) downstream of the sequence below, each of which corresponds to the structure of a native human mRNA. Thus, a UNA oligomer incorporating the oligomer fragment below can have enhanced translational efficiency.

Xenopus beta-globin is accession NM_001096347.1.

(SEQ ID NO: 142)

CÜAGUGACUGACUAGGAUCUGGUUACCACUAAACCAGCCUCAAGAACACC

CGAAUGGAGUCUCUAAGCUACAUAAUACCAACUUACACUUACAAAAUGUU

GUCCCCCAAAAUGUAGCCAUUCGUAUCUGCUCCUAAUAAAAAGAAAGUUU

CUUCACÃU

-continued (SEQ ID NO: 143)

CÛÃĜUGACUGACUAGGAUCUGGUUACCACUAAACCAGCCUCAAGAACACC

CGAAUGGAGUCUCUAAGCUACAUAAUACCAACUUACACUUACAAAAUGUU

GUCCCCCAAAAUGUAGCCAUUCGUAUCUGCUCCUAAUAAAAAGAAAGUUU

CUUCÃĈÃU (SEQ ID NO: 144)

CÛAGUGAĈUGACUÃGGAUCÛGGUUAĈCACUAÃACCAGĈCUCAAĜAACACC

CGAAUĜGAGUCÛCUAAGĈUACAUÃAUACCÃACUUAĈACUUAĈAAAAUĜUU

GUCĈCCCAAÃAUGUAĜCCAUUĈGUAUCÛGCUCCÛAAUAAÃAAGAAÃGUUU

CÛUCACÃU (SEQ ID NO: 145)

CÛÃGUGAĈÛGACUÃĜGAUCÛĜGUUAĈĈACUAÃÃCCAGĈĈUCAAĜÃACACĈ

ĈGAAUĜĜAGUCÛĈUAAGĈÛACAUÃÃUACCÃÃCUUAĈÃCUUAĈÃAAAUĜÛU

GUCĈĈCCAAÃÃUGUAĜĈCAUUĈĜUAUCÛĜCUCCÛÃAUAAÃÃAGAAÃĜUUU

CÛÛCACÃU (SEQ ID NO: 146)

ĈUÃĜUĜAĈUĜAĈUÃĜĜAÛUĈÛĜĜUUAĈĈACUAÃÃĈĈAĜĈUĈAAĜAÃĈAĈĈĈĜAÃÛĜĜAĜ

ÛĈÛĈÛÃAĜĈÛÃĈÃÛÃÃÛÃĈĈAĈÛÛÃĈACÛÛÃĈAĈÛÛÃĈAÃÃÃÃÛĜÛÛĜÛĈĈĈĈĈÃÃÃÛĜÛÃĜĈĈ

ÃÛÛĈĜÛÃÛĈÛĜÛĈĈÛÃÃÛÃÃÃÃĜĈÃÃĜÛÛÛĈÛÛĈÃĈÃÛ

Example 20: mUNA Oligomer Expressing Thrombopoietin

In this example, the structures of mUNA molecules for use in expressing human Thrombopoietin are shown.

Thrombopoietin is associated with liver and kidney disease.

The base sequences shown below are the portion of the mUNA molecule that may correspond in functionality to the open reading frame of the native mRNA of human Thrombopoietin. The complete mUNA molecule comprises a 5' cap (m7GpppGm), and a 5'-UTR upstream of the sequence below, and a 3' UTR and polyA tail (SEQ ID Nos:4 to 12) downstream of the sequence below, each of which corresponds to the structure of the native mRNA of human Thrombopoietin.

Human Thrombopoietin is accession NM_000460.3.

(SEQ ID NO: 147)

AÛĜGAGCUGACUGAAUUGCUĈCUCGUGGUCAUGCUUCÛĈCUAACUGCAAG

GCUAACĜCUGUCCAGCCCGGCUCCÛCCUGCUUGUGACCUCCGÃGUCCUCA

GUAAACUGCÛÛCGUGACUCCCAUGUCCÛĈCACAGCAGACUGAGCCAĜUGC

CCAGAGGUUCACCÛUUGCCUACACCUGUCCÛĜCUGCCUGCUGUGGACUU

ÛAGCUUGGGAGAAUGGAÃAACCCAGAUGGAGGAGAĈCAAGGCACAGGACA

UUCÛGGGAGCAGUGACCCUUCÛGCUGGAGGGAGUGAUGGĈAGCACGGGGA

CAACUGGĜACCCACUUGCCUCUCAUĈCUCCUGGGGCAGCUUUCÛGGACA

GGUCCGUCUCCUĈCUUGGGGCCCUGCAGAGĈCUCCUUGGAACCCAGCUÛC

CUCCACAGGGCAGGACĈACAGCUCACAAGGAUCCĈAAUGCCAUCUUCCUG

-continued

AGĈUUCCAACACCUGCUCCGÃGGAAAGGUGCGUUUCCUGÃUGCUUGUAGG

AGGGUCCÃCCCUCUGCGUCAGGCGGĜGCCCCACCCACCACAGCUĜUCCCC

AGCAGAACCUCUĈUAGUCCUCACACUGAACĜAGCUCCCAAACAGGACUÛC

UGGAUUGUUGGAGACAÃACUUCACUGCCUCAGCCÃGAACUACUGGCUCUG

GGĈUUCUGAAGUGGCAGCAGĜGAUUCAGAGCCAAGAUUĈCUGGUCUGCUG

AACCAAÃCCUCCAGGUCCCUGGACĈAAAUCCCCGGAUACCUGÃACAGGAU

ACACGAACUCÛUGAAUGGAACUCGUGGAĈUCUUUCCUGGACCCUCAĈGCA

GGACCCUAGGAGCCĈCGGACAUUUCCUCAGGAÃCAUCAGACACAGGCUCC

ĈUGCCACCCAACCUCCAGĈCUGGAUAUUCUCCUUCCĈCAACCCAUCCUCC

UACUĜGACAGUAUACGCUCUUCĈCUCUUCCACCCACCUUGĈCCACCCCUG

UGGUCCAGĈUCCACCCCCUGCUUCCUĜACCCUUCUGCUCCAACGĈCCACC

CCUACCAGCCCUĈUUCUAAACACAUCCUACÃCCCACUCCCAGAAUCUGÛC

UCAGGAAGGGUÃA (SEQ ID NO: 148)

AÛĜGAGCUGACUGAAUUGCUCCUCGUGGUCAUGCUUCUCCUAACUGCAAG

GCUAACGCUGUCCAGCCCGGCUCCUCCUGCUUGUGACCUCCGAGUCCUCA

GUAAACUGCUUCGUGACUCCCAUGUCCUUCACAGCAGACUGAGCCAGUGC

CCAGAGGUUCACCCUUUGCCUACACCUGUCCUGCUGCCUGCUGUGGACUU

UAGCUUGGGAGAAUGGAAAACCCAGAUGGAGGAGACCAAGGCACAGGACA

UUCUGGGAGCAGUGACCCUUCUGCUGGAGGGAGUGAUGGCAGCACGGGGA

CAACUGGGACCCACUUGCCUCUCAUCCCUCCUGGGGCAGCUUUCUGGACA

-continued

GGUCCGUCUCCUCCUUGGGGCCCUGCAGAGCCUCCUUGGAACCCAGCUUC

CUCCACAGGGCAGGACCACAGCUCACAAGGAUCCCAAUGCCAUCUUCCUG

AGCUUCCAACACCUGCUCCGAGGAAAGGUGCGUUUCCUGAUGCUUGUAGG

AGGGUCCACCCUCUGCGUCAGGCGGGCCCCACCCACCACAGCUGUCCCCA

GCAGAACCUCUCUAGUCCUCACACUGAACGAGCUCCCAAACAGGACUUCU

GGAUUGUUGGAGACAAACUUCACUGCCUCAGCCAGAACUACUGGCUCUGG

GCUUCUGAAGUGGCAGCAGGGAUUCAGAGCCAAGAUUCCUGGUCUGCUGA

ACCAAACCUCCAGGUCCCUGGACCAAAUCCCCGGAUACCUGAACAGGAUA

CACGAACUCUUGAAUGGAACUCGUGGACUCUUUCCUGGACCCUCACGCAG

GACCCUAGGAGCCCCGGACAUUUCCUCAGGAACAUCAGACACAGGCUCCC

UGCCACCCAACCUCCAGCCUGGAUAUUCUCCUUCCCCAACCCAUCCUCCU

ACUGGACAGUAUACGCUCUUCCCUCUUCCACCCACCUUGCCCACCCCUGU

GGUCCAGCUCCACCCCCUGCUUCCUGACCCUUCUGCUCCAACGCCCACCC

CUACCAGCCCUCUUCUAAACACAUCCUACACCCACUCCCAGAAUCUGUCU

CAGGAAGGGUAA (SEQ ID NO: 149)

AÜGGAGCÜGACÜGAAÜÜGCÜCCÜCGÜGGÜCAÜGCÜÜCÜCCÜAACÜGCAAG

GCÜAACGCÜGÜCCAGCCCGGCÜCCÜCCÜGCÜÜGÜGACCÜCCGAGÜCCÜCA

GÜAAACÜGCÜÜCGÜGACÜCCCAÜGÜCCÜÜCACAGCAGACÜGAGCCAGÜGC

CCAGAGGÜÜCACCCÜÜÜGCCÜACACCÜGÜCCÜGCÜGCCÜGCÜGÜGGACÜU

ÜAGCÜÜGGGAGAAÜGGAAAACCCAGAÜGGAGGAGACCAAGGCACAGGACA

ÜÜCÜGGGAGCAGÜGACCCÜÜCÜGCÜGGAGGGAGÜGAÜGGCAGCACGGGGA

CAACÜGGGACCCACÜÜGCCÜCÜCAÜCCCÜCCÜGGGGCAGCÜÜÜCÜGGACA

GGÜCCGÜCÜCCÜCCÜÜGGGGCCCÜGCAGAGCCÜCCÜÜGGAACCCAGCÜÜC

CÜCCACAGGGCAGGACCACAGCÜCACAAGGAÜCCCAAÜGCCAÜCÜÜCCÜG

AGCÜÜCCAACACCÜGCÜCCGAGGAAAGGÜGCGÜÜÜCCÜGAÜGCÜÜGÜAGG

AGGGÜCCACCCÜCÜGCGÜCAGGCGGGCCCCACCCACCACAGCÜGÜCCCCA

GCAGAACCÜCÜCÜAGÜCCÜCACACÜGAACGAGCÜCCCAAACAGGACÜÜCU

GGAÜÜGÜÜGGAGACAAACÜÜCACÜGCCÜCAGCCAGAACÜACÜGGCÜCÜGG

GCÜÜCÜGAAGÜGGCAGCAGGGAÜÜCAGAGCCAAGAÜÜCCÜGGÜCÜGCÜGA

ACCAAACCÜCCAGGÜCCCÜGGACCAAAÜCCCCGGAÜACCÜGAACAGGAÜA

CACGAACÜCÜÜGAAÜGGAACÜCGÜGGACÜCÜÜÜCCÜGGACCCÜCACGCAG

GACCCÜAGGAGCCCCGGACAÜÜÜCCÜCAGGAACAÜCAGACACAGGCÜCCC

ÜGCCACCCAACCÜCCAGCCÜGGAÜAÜÜCÜCCÜÜCCCCAACCCAÜCCÜCCU

ACÜGGACAGÜAÜACGCÜCÜÜCCCÜCÜÜCCACCCACCÜÜGCCCACCCCÜGU

GGÜCCAGCÜCCACCCCCÜGCÜÜCCÜGACCCÜÜCÜGCÜCCAACGCCCACCC

CÜACCAGCCCÜCÜÜCÜAAACACAÜCCÜACACCCACÜCCCAGAAÜCÜGÜCU

CAGGAAGGGÜAA

Example 21: mUNA Oligomer Expressing Human Amylo-Alpha-1, 6-Glucosidase, 4-Alpha-Glucanotransferase (AGL)

In this example, the structures of mUNA molecules for use in expressing human amylo-alpha-1, 6-glucosidase, 4-alpha-glucanotransferase (AGL) are shown.

AGL is associated with glycogen storage disease.

The base sequences shown below are the portion of the mUNA molecule that may correspond in functionality to the open reading frame of the native mRNA of human AGL. The complete mUNA molecule comprises a 5' cap (m7GpppGm), and a 5'-UTR upstream of the sequence below, and a 3' UTR and polyA tail (SEQ ID Nos:4 to 12) downstream of the sequence below, each of which corresponds to the structure of the native mRNA of human AGL.

Human AGL is accession NM_000642.2.

(SEQ ID NO: 150)

AÜÜGGACACAGUAAACAGAUUCGAAUUUUACUUCUGAACGAAAUGGAGAA

ACUGGAAAAGACCCUCUUCAGACUUGAACAAGGGUAUGAGCUACAGUUCC

GAUUAGGCCCAACUUUACAGGGAAAAGCAGUUACCGUGUAUACAAAUUAC

CCAUUUCCUGGAGAAACAUUUAAUAGAGAAAAAUUCCGUUCUCUGGAUUG

GGAAAAUCCAACAGAAAGAGAAGAUGAUUCUGAUAAAUACUGUAAACUUA

AUCUGCAACAAUCUGGUUCAUUUCAGUAUUAUUUCCUUCAAGGAAAUGAG

AAAAGUGGUGGAGGUUACAUAGUUGUGGACCCCAUUUUACGUGUUGGUGC

UGAUAAUCAUGUGCUACCCUUGGACUGUGUUACUCUUCAGACAUUUUUAG

CUAAGUGUUUGGGACCUUUUGAUGAAUGGGAAAGCAGACUUAGGGUUGCA

AAAGAAUCAGGCUACAACAUGAUUCAUUUUACCCCAUUGCAGACUCUUGG

ACUAUCUAGGUCAUGCUACUCCCUUGCCAAUCAGUUAGAAUUAAAUCCUG

ACUUUUCAAGACCUAAUAGAAAGUAUACCUGGAAUGAUGUUGGACAGCUA

GUGGAAAAAUUAAAAAAGGAAUGGAAUGUUAUUUGUAUUACUGAUGUUGU

CUACAAUCAUACUGCUGCUAAUAGUAAAUGGAUCCAGGAACAUCCAGAAU

GUGCCUAUAAUCUUGUGAAUUCUCCACACUUAAAACCUGCCUGGGUCUUA

GACAGAGCACUUUGGCGUUUCUCCUGUGAUGUUGCAGAAGGGAAAUACAA

AGAAAAGGGAAUACCUGCUUUGAUUGAAAAUGAUCACCAUAUGAAUUCCA

UCCGAAAAAUAAUUUGGGAGGAUAUUUUUCCAAAGCUUAAACUCUGGGAA

UUUUUCCAAGUAGAUGUCAACAAAGCGGUUGAGCAAUUUAGAAGACUUCU

UACACAAGAAAAUAGGCGAGUAACCAAGUCUGAUCCAAACCAACACCUUA

CGAUUAUUCAAGAUCCUGAAUACAGACGGUUUGGCUGUACUGUAGAUAUG

AACAUUGCACUAACGACUUUCAUACCACAUGACAAGGGGCCAGCAGCAAU

UGAAGAAUGCUGUAAUUGGUUUCAUAAAAGAAUGGAGGAAUUAAAUUCAG

AGAAGCAUCGACUCAUUAACUAUCAUCAGGAACAGGCAGUUAAUUGCCUU

UUGGGAAAUGUGUUUUAUGAACGACUGGCUGGCCAUGGUCCAAAACUAGG

ACCUGUCACUAGAAAGCAUCCUUUAGUUACCAGGUAUUUUACUUUCCCAU

UUGAAGAGAUAGACUUCUCCAUGGAAGAAUCUAUGAUUCAUCUGCCAAAU

AAAGCUUGUUUUCUGAUGGCACACAAUGGAUGGGUAAUGGGAGAUGAUCC

UCUUCGAAACUUUGCUGAACCGGGUUCAGAAGUUUACCUAAGGAGAGAAC

-continued

UUAUUUGCUGGGGAGACAGUGUUAAAUUACGCUAUGGGAAUAAACCAGAG

GACUGUCCUUAUCUCUGGGCACACAUGAAAAAAUACACUGAAAUAACUGC

AACUUAUUUCCAGGGAGUACGUCUUGAUAACUGCCACUCAACACCUCUUC

ACGUAGCUGAGUACAUGUUGGAUGCUGCUAGGAAUUUGCAACCCAAUUUA

UAUGUAGUAGCUGAACUGUUCACAGGAAGUGAAGAUCUGGACAAUGUCUU

UGUUACUAGACUGGGCAUUAGUUCCUUAAUAAGAGAGGCAAUGAGUGCAU

AUAAUAGUCAUGAAGAGGGCAGAUUAGUUUACCGAUAUGGAGGAGAACCU

GUUGGAUCCUUUGUUCAGCCCUGUUUGAGGCCUUUAAUGCCAGCUAUUGC

ACAUGCCCUGUUUAUGGAUAUUACGCAUGAUAAUGAGUGUCCUAUUGUGC

AUAGAUCAGCGUAUGAUGCUCUUCCAAGUACUACAAUUGUUUCUAUGGCA

UGUUGUGCUAGUGGAAGUACAAGAGGCUAUGAUGAAUUAGUGCCUCAUCA

GAUUUCAGUGGUUUCUGAAGAACGGUUUUACACUAAGUGGAAUCCUGAAG

CAUUGCCUUCAAACACAGGUGAAGUUAAUUUCCAAAGCGGCAUUAUUGCA

GCCAGGUGUGCUAUCAGUAAACUUCAUCAGGAGCUUGGAGCCAAGGGUUU

UAUUCAGGUGUAUGUGGAUCAAGUUGAUGAAGACAUAGUGGCAGUAACAA

GACACUCACCUAGCAUCCAUCAGUCUGUUGUGGCUGUAUCUAGAACUGCU

UUCAGGAAUCCCAAGACUUCAUUUUACAGCAAGGAAGUGCCUCAAAUGUG

CAUCCCUGGCAAAAUUGAAGAAGUAGUUCUUGAAGCUAGAACUAUUGAGA

GAAACACGAAACCUUAUAGGAAGGAUGAGAAUUCAAUCAAUGGAACACCA

GAUAUCACAGUAGAAAUUAGAGAACAUAUUCAGCUUAAUGAAAGUAAAAU

UGUUAAACAAGCUGGAGUUGCCACAAAAGGGCCCAAUGAAUAUAUUCAAG

AAAUAGAAUUUGAAAACUUGUCUCCAGGAAGUGUUAUUAUAUUCAGAGUU

AGUCUUGAUCCACAUGCACAAGUCGCUGUUGGAAUUCUUCGAAAUCAUCU

GACACAAUUCAGUCCUCACUUUAAAUCUGGCAGCCUAGCUGUUGACAAUG

CAGAUCCUAUAUUAAAAAUUCCUUUUGCUUCUCUUGCCUCCAGAUUAACU

UUGGCUGAGCUAAAUCAGAUCCUUUACCGAUGUGAAUCAGAAGAAAAGGA

AGAUGGUGGAGGGUGCUAUGACAUACCAAACUGGUCAGCCCUUAAAUAUG

CAGGUCUUCAAGGUUUAAUGUCUGUAUUGGCAGAAAUAAGACCAAAGAAU

GACUUGGGGCAUCCUUUUUGUAAUAAUUUGAGAUCUGGAGAUUGGAUGAU

UGACUAUGUCAGUAACCGGCUUAUUUCACGAUCAGGAACUAUUGCUGAAG

UUGGUAAAUGGUUGCAGGCUAUGUUCUUCUACCUGAAGCAGAUCCCACGU

UACCUUAUCCCAUGUUACUUUGAUGCUAUAUUAAUUGGUGCAUAUACCAC

UCUUCUGGAUACAGCAUGGAAGCAGAUGUCAAGCUUUGUUCAGAAUGGUU

CAACCUUUGUGAAACACCUUUCAUUGGGUUCAGUUCAACUGUGUGGAGUA

GGAAAAUUCCCUUCCCUGCCAAUUCUUUCACCUGCCCUAAUGGAUGUACC

UUAUAGGUUAAAUGAGAUCACAAAAGAAAAGGAGCAAUGUUGUGUUUCUC

UAGCUGCAGGCUUACCUCAUUUUUCUUCUGGUAUUUUCCGCUGCUGGGGA

AGGGAUACUUUUAUUGCACUUAGAGGUAUACUGCUGAUUACUGGACGCUA

UGUAGAAGCCAGGAAUAUUAUUUUAGCAUUUGCGGGUACCCUGAGGCAUG

GUCUCAUUCCUAAUCUACUGGGUGAAGGAAUUUAUGCCAGAUACAAUUGU

-continued

CGGGAUGCUGUGUGGUGGUGGCUGCAGUGUAUCCAGGAUUACUGUAAAAU

GGUUCCAAAUGGUCUAGACAUUCUCAAGUGCCCAGUUUCCAGAAUGUAUC

CUACAGAUGAUUCUGCUCCUUUGCCUGCUGGCACACUGGAUCAGCCAUUG

UUUGAAGUCAUACAGGAAGCAAUGCAAAAACACAUGCAGGGCAUACAGUU

CCGAGAAAGGAAUGCUGGUCCCCAGAUAGAUCGAAACAUGAAGGACGAAG

GUUUUAAUAUAACUGCAGGAGUUGAUGAAGAAACAGGAUUUGUUUAUGGA

GGAAAUCGUUUCAAUUGUGGCACAUGGAUGGAUAAAAUGGGAGAAAGUGA

CAGAGCUAGAAACAGAGGAAUCCCAGCCACACCAAGAGAUGGGUCUGCUG

UGGAAAUUGUGGGCCUGAGUAAAUCUGCUGUUCGCUGGUUGCUGGAAUUA

UCCAAAAAAAAUAUUUUCCCUUAUCAUGAAGUCACAGUAAAAAGACAUGG

AAAGGCUAUAAAGGUCUCAUAUGAUGAGUGGAACAGAAAAAUACAAGACA

ACUUUGAAAAGCUAUUUCAUGUUUCCGAAGACCCUUCAGAUUUAAAUGAA

AAGCAUCCAAAUCUGGUUCACAAACGUGGCAUAUACAAAGAUAGUUAUGG

AGCUUCAAGUCCUUGGUGUGACUAUCAGCUCAGGCCUAAUUUUACCAUAG

CAAUGGUUGUGGCCCCUGAGCUCUUUACUACAGAAAAAGCAUGGAAAGCU

UUGGAGAUUGCAGAAAAAAAAUUGCUUGGUCCCCUUGGCAUGAAAACUUU

AGAUCCAGAUGAUAUGGUUUACUGUGGAAUUUAUGACAAUGCAUUAGACA

AUGACAACUACAAUCUUGCUAAAGGUUUCAAUUAUCACCAAGGACCUGAG

UGGCUGUGGCCUAUUGGGUAUUUUCUUCGUGCAAAAUUAUAUUUUUCCAG

AUUGAUGGGCCCGGAGACUACUGCAAAGACUAUAGUUUUGGUUAAAAAUG

UUCUUUCCCGACAUUAUGUUCAUCUUGAGAGAUCCCCUUGGAAAGGACUU

CCAGAACUGACCAAUGAGAAUGCCCAGUACUGUCCUUUCAGCUGUGAAAC

ACAAGCCUGGUCAAUUGCUACUAUUCUUGAGACACUUUAUGAUUUAUAG (SEQ ID NO: 151)

AUGGGACACAGUAAACAGAUUCGAAUUUUACUUCUGAACGAAAUGGAGAA

ACUGGAAAAGACCCUCUUCAGACUUGAACAAGGGUAUGAGCUACAGUUCC

GAUUAGGCCCAACUUUACAGGGAAAAGCAGUUACCGUGUAUACAAAUUAC

CCAUUUCCUGGAGAAACAUUUAAUAGAGAAAAAUUCCGUUCUCUGGAUUG

GGAAAAUCCAACAGAAAGAGAAGAUGAUUCUGAUAAAUACUGUAAACUUA

AUCUGCAACAAUCUGGUUCAUUUCAGUAUUAUUUCCUUCAAGGAAAUGAG

AAAAGUGGUGGAGGUUACAUAGUUGUGGACCCCAUUUUACGUGUUGGUGC

UGAUAAUCAUGUGCUACCCUUGGACUGUGUUACUCUUCAGACAUUUUUAG

CUAAGUGUUUGGGACCUUUUGAUGAAUGGGAAAGCAGACUUAGGGUUGCA

AAAGAAUCAGGCUACAACAUGAUUCAUUUUACCCCAUUGCAGACUCUUGG

ACUAUCUAGGUCAUGCUACUCCCUUGCCAAUCAGUUAGAAUUAAAUCCUG

ACUUUUCAAGACCUAAUAGAAAGUAUACCUGGAAUGAUGUUGGACAGCUA

GUGGAAAAAUUAAAAAAGGAAUGGAAUGUUAUUUGUAUUACUGAUGUUGU

CUACAAUCAUACUGCUGCUAAUAGUAAAUGGAUCCAGGAACAUCCAGAAU

GUGCCUAUAAUCUUGUGAAUUCUCCACACUUAAAACCUGCCUGGGUCUUA

GACAGAGCACUUUGGCGUUUCUCCUGUGAUGUUGCAGAAGGGAAAUACAA

AGAAAAGGGAAUACCUGCUUUGAUUGAAAAUGAUCACCAUAUGAAUUCCA

-continued

UCCGAAAAAUAAUUUGGGAGGAUAUUUUUCCAAAGCUUAAACUCUGGGAA

UUUUUCCAAGUAGAUGUCAACAAAGCGGUUGAGCAAUUUAGAAGACUUCU

UACACAAGAAAAUAGGCGAGUAACCAAGUCUGAUCCAAACCAACACCUUA

CGAUUAUUCAAGAUCCUGAAUACAGACGGUUUGGCUGUACUGUAGAUAUG

AACAUUGCACUAACGACUUUCAUACCACAUGACAAGGGGCCAGCAGCAAU

UGAAGAAUGCUGUAAUUGGUUUCAUAAAAGAAUGGAGGAAUUAAAUUCAG

AGAAGCAUCGACUCAUUAACUAUCAUCAGGAACAGGCAGUUAAUUGCCUU

UUGGGAAAUGUGUUUUAUGAACGACUGGCUGGCCAUGGUCCAAAACUAGG

ACCUGUCACUAGAAAGCAUCCUUUAGUUACCAGGUAUUUUACUUUCCCAU

UUGAAGAGAUAGACUUCUCCAUGGAAGAAUCUAUGAUUCAUCUGCCAAAU

AAAGCUUGUUUUCUGAUGGCACACAAUGGAUGGGUAAUGGGAGAUGAUCC

UCUUCGAAACUUUGCUGAACCGGGUUCAGAAGUUUACCUAAGGAGAGAAC

UUAUUUGCUGGGGAGACAGUGUUAAAUUACGCUAUGGGAAUAAACCAGAG

GACUGUCCUUAUCUCUGGGCACACAUGAAAAAAUACACUGAAAUAACUGC

AACUUAUUUCCAGGGAGUACGUCUUGAUAACUGCCACUCAACACCUCUUC

ACGUAGCUGAGUACAUGUUGGAUGCUGCUAGGAAUUUGCAACCCAAUUUA

UAUGUAGUAGCUGAACUGUUCACAGGAAGUGAAGAUCUGGACAAUGUCUU

UGUUACUAGACUGGGCAUUAGUUCCUUAAUAAGAGAGGCAAUGAGUGCAU

AUAAUAGUCAUGAAGAGGGCAGAUUAGUUUACCGAUAUGGAGGAGAACCU

GUUGGAUCCUUUGUUCAGCCCUGUUUGAGGCCUUUAAUGCCAGCUAUUGC

ACAUGCCCUGUUUAUGGAUAUUACGCAUGAUAAUGAGUGUCCUAUUGUGC

AUAGAUCAGCGUAUGAUGCUCUUCCAAGUACUACAAUUGUUUCUAUGGCA

UGUUGUGCUAGUGGAAGUACAAGAGGCUAUGAUGAAUUAGUGCCUCAUCA

GAUUUCAGUGGUUUCUGAAGAACGGUUUUACACUAAGUGGAAUCCUGAAG

CAUUGCCUUCAAACACAGGUGAAGUUAAUUUCCAAAGCGGCAUUAUUGCA

GCCAGGUGUGCUAUCAGUAAACUUCAUCAGGAGCUUGGAGCCAAGGGUUU

UAUUCAGGUGUAUGUGGAUCAAGUUGAUGAAGACAUAGUGGCAGUAACAA

GACACUCACCUAGCAUCCAUCAGUCUGUUGUGGCUGUAUCUAGAACUGCU

UUCAGGAAUCCCAAGACUUCAUUUUACAGCAAGGAAGUGCCUCAAAUGUG

CAUCCCUGGCAAAAUUGAAGAAGUAGUUCUUGAAGCUAGAACUAUUGAGA

GAAACACGAAACCUUAUAGGAAGGAUGAGAAUUCAAUCAAUGGAACACCA

GAUAUCACAGUAGAAAUUAGAGAACAUAUUCAGCUUAAUGAAAGUAAAAU

UGUUAAACAAGCUGGAGUUGCCACAAAAGGGCCCAAUGAAUAUAUUCAAG

AAAUAGAAUUUGAAAACUUGUCUCCAGGAAGUGUUAUUAUAUUCAGAGUU

AGUCUUGAUCCACAUGCACAAGUCGCUGUUGGAAUUCUUCGAAAUCAUCU

GACACAAUUCAGUCCUCACUUUAAAUCUGGCAGCCUAGCUGUUGACAAUG

CAGAUCCUAUAUUAAAAAUUCCUUUUGCUUCUCUUGCCUCCAGAUUAACU

UUGGCUGAGCUAAAUCAGAUCCUUUACCGAUGUGAAUCAGAAGAAAAGGA

AGAUGGUGGAGGGUGCUAUGACAUACCAAACUGGUCAGCCCUUAAAUAUG

CAGGUCUUCAAGGUUUAAUGUCUGUAUUGGCAGAAAUAAGACCAAAGAAU

GACUUGGGGCAUCCUUUUUGUAAUAAUUUGAGAUCUGGAGAUUGGAUGAU

-continued

UGACUAUGUCAGUAACCGGCUUAUUUCACGAUCAGGAACUAUUGCUGAAG

UUGGUAAAUGGUUGCAGGCUAUGUUCUUCUACCUGAAGCAGAUCCCACGU

UACCUUAUCCCAUGUUACUUUGAUGCUAUAUUAAUUGGUGCAUAUACCAC

UCUUCUGGAUACAGCAUGGAAGCAGAUGUCAAGCUUUGUUCAGAAUGGUU

CAACCUUUGUGAAACACCUUUCAUUGGGUUCAGUUCAACUGUGUGGAGUA

GGAAAAUUCCCUUCCCUGCCAAUUCUUUCACCUGCCCUAAUGGAUGUACC

UUAUAGGUUAAAUGAGAUCACAAAAGAAAAGGAGCAAUGUUGUGUUUCUC

UAGCUGCAGGCUUACCUCAUUUUUCUUCUGGUAUUUUCCGCUGCUGGGGA

AGGGAUACUUUUAUUGCACUUAGAGGUAUACUGCUGAUUACUGGACGCUA

UGUAGAAGCCAGGAAUAUUAUUUUAGCAUUUGCGGGUACCCUGAGGCAUG

GUCUCAUUCCUAAUCUACUGGGUGAAGGAAUUUAUGCCAGAUACAAUUGU

CGGGAUGCUGUGUGGUGGUGGCUGCAGUGUAUCCAGGAUUACUGUAAAAU

GGUUCCAAAUGGUCUAGACAUUCUCAAGUGCCCAGUUUCCAGAAUGUAUC

CUACAGAUGAUUCUGCUCCUUUGCCUGCUGGCACACUGGAUCAGCCAUUG

UUUGAAGUCAUACAGGAAGCAAUGCAAAAACACAUGCAGGGCAUACAGUU

CCGAGAAAGGAAUGCUGGUCCCCAGAUAGAUCGAAACAUGAAGGACGAAG

GUUUUAAUAUAACUGCAGGAGUUGAUGAAGAAACAGGAUUUGUUUAUGGA

GGAAAUCGUUUCAAUUGUGGCACAUGGAUGGAUAAAAUGGGAGAAAGUGA

CAGAGCUAGAAACAGAGGAAUCCCAGCCACACCAAGAGAUGGGUCUGCUG

UGGAAAUUGUGGGCCUGAGUAAAUCUGCUGUUCGCUGGUUGCUGGAAUUA

UCCAAAAAAAAAUAUUUUCCCUUAUCAUGAAGUCACAGUAAAAAGACAUGG

AAAGGCUAUAAAGGUCUCAUAUGAUGAGUGGAACAGAAAAAUACAAGACA

ACUUUGAAAAGCUAUUUCAUGUUUCCGAAGACCCUUCAGAUUUAAAUGAA

AAGCAUCCAAAUCUGGUUCACAAACGUGGCAUAUACAAAGAUAGUUAUGG

AGCUUCAAGUCCUUGGUGUGACUAUCAGCUCAGGCCUAAUUUUACCAUAG

CAAUGGUUGUGGCCCCUGAGCUCUUUACUACAGAAAAAGCAUGGAAAGCU

UUGGAGAUUGCAGAAAAAAAAUUGCUUGGUCCCCUUGGCAUGAAAACUUU

AGAUCCAGAUGAUAUGGUUUACUGUGGAAUUUAUGACAAUGCAUUAGACA

AUGACAACUACAAUCUUGCUAAAGGUUUCAAUUAUCACCAAGGACCUGAG

UGGCUGUGGCCUAUUGGGUAUUUUCUUCGUGCAAAAUUAUAUUUUUCCAG

AUUGAUGGGCCCGGAGACUACUGCAAAGACUAUAGUUUUGGUUAAAAAUG

UUCUUUCCCGACAUUAUGUUCAUCUUGAGAGAUCCCCUUGGAAAGGACUU

CCAGAACUGACCAAUGAGAAUGCCCAGUACUGUCCUUUCAGCUGUGAAAC

ACAAGCCUGGUCAAUUGCUACUAUUCUUGAGACACUUUAUGAUUUAUAG

Example 22: mUNA Oligomer Expressing Human Protein S (Alpha) (PROS1)

In this example, the structures of mUNA molecules for use in expressing human protein S (alpha) (PROS1) are shown.

Human protein S (alpha) is associated with Protein S deficiency, thrombosis, and arterial occlusive disease.

The base sequences shown below are the portion of the mUNA molecule that may correspond in functionality to the open reading frame of the native mRNA of human protein S (alpha). The complete mUNA molecule comprises a 5' cap (m7GpppGm), and a 5'-UTR upstream of the sequence below, and a 3' UTR and polyA tail (SEQ ID Nos:4 to 12) downstream of the sequence below, each of which corresponds to the structure of the native mRNA of human protein S (alpha).

Human protein S (alpha) is accession NM_001314077.1.

(SEQ ID NO: 152)

AÜĜÃGGGUCCUGGGUGGGCGCUGCGGGGCGCUGCUGGCGUGUCUCCUCCU

AGUGCUUCCCGUCUCAGAGGCAAACUUUUGUUUAUAUUUUAGAAAUGAUU

UUAUAUACAACCGUGCAUGCAUUUCUGUAUUGGUCGGCUUAUCUGGAUGC

AAUUUUUUCUAUUCUAUAUGCUUUUUGUCAAAGCAACAGGCUUCACAAGU

CCUGGUUAGGAAGCGUCGUGCAAAUUCUUUACUUGAAGAAACCAAACAGG

GUAAUCUUGAAAGAGAAUGCAUCGAAGAACUGUGCAAUAAAGAAGAAGCC

AGGGAGGUCUUUGAAAAUGACCCGGAAACGGAUUAUUUUUAUCCAAAAUA

CUUAGUUUGUCUUCGCUCUUUUCAAACUGGGUUAUUCACUGCUGCACGUC

AGUCAACUAAUGCUUAUCCUGACCUAAGAAGCUGUGUCAAUGCCAUUCCA

GACCAGUGUAGUCCUCUGCCAUGCAAUGAAGAUGGAUAUAUGAGCUGCAA

AGAUGGAAAAGCUUCUUUUACUUGCACUUGUAAACCAGGUUGGCAAGGAG

AAAAGUGUGAAUUUGACAUAAAUGAAUGCAAAGAUCCCUCAAAUAUAAAU

GGAGGUUGCAGUCAAAUUUGUGAUAAUACACCUGGAAGUUACCACUGUUC

CUGUAAAAAUGGUUUUGUUAUGCUUUCAAAUAAGAAAGAUUGUAAAGAUG

UGGAUGAAUGCUCUUUGAAGCCAAGCAUUUGUGGCACAGCUGUGUGCAAG

AACAUCCCAGGAGAUUUUGAAUGUGAAUGCCCCGAAGGCUACAGAUAUAA

UCUCAAAUCAAAGUCUUGUGAAGAUAUAGAUGAAUGCUCUGAGAACAUGU

GUGCUCAGCUUUGUGUCAAUUACCCUGGAGGUUACACUUGCUAUUGUGAU

GGGAAGAAAGGAUUCAAACUUGCCCAAGAUCAGAAGAGUUGUGAGGUUGU

UUCAGUGUGCCUUCCCUUGAACCUUGACACAAAGUAUGAAUUACUUUACU

UGGCGGAGCAGUUUGCAGGGGUUGUUUUAUAUUUAAAAUUUCGUUUGCCA

GAAAUCAGCAGAUUUUCAGCAGAAUUUGAUUUCCGGACAUAUGAUUCAGA

AGGCGUGAUACUGUACGCAGAAUCUAUCGAUCACUCAGCGUGGCUCCUGA

UUGCACUUCGUGGUGGAAAGAUUGAAGUUCAGCUUAAGAAUGAACAUACA

UCCAAAAUCACAACUGGAGGUGAUGUUAUUAAUAAUGGUCUAUGGAAUAU

GGUGUCUGUGGAAGAAUUAGAACAUAGUAUUAGCAUUAAAAUAGCUAAAG

AAGCUGUGAUGGAUAUAAAUAAACCUGGACCCCUUUUUAAGCCGGAAAAU

GGAUUGCUGGAAACCAAAGUAUACUUUGCAGGAUUCCCUCGGAAAGUGGA

AAGUGAACUCAUUAAACCGAUUAACCCUCGUCUAGAUGGAUGUAUACGAA

GCUGGAAUUUGAUGAAGCAAGGAGCUUCUGGAAUAAAGGAAAUUAUUCAA

GAAAAACAAAAUAAGCAUUGCCUGGUUACUGUGGAGAAGGGCUCCUACUA

UCCUGGUUCUGGAAUUGCUCAAUUUCACAUAGAUUAUAAUAAUGUAUCCA

GUGCUGAGGGUUGGCAUGUAAAUGUGACCUUGAAUAUUCGUCCAUCCACG

GGCACUGGUGUUAUGCUUGCCUUGGUUUCUGGUAACAACACAGUGCCCUU

UGCUGUGUCCUUGGUGGACUCCACCUCUGAAAAAUCACAGGAUAUUCUGU

-continued

UAUCUGUUGAAAAUACUGUAAUAUAUCGGAUACAGGCCCUAAGUCUAUGU

UCCGAUCAACAAUCUCAUCUGGAAUUUAGAGUCAACAGAAACAAUCUGGA

GUUGUCGACACCACUUAAAAUAGAAACCAUCUCCCAUGAAGACCUUCAAA

GACAACUUGCCGUCUUGGACAAAGCAAUGAAAGCAAAAGUGGCCACAUAC

CUGGGUGGCCUUCCAGAUGUUCCAUUCAGUGCCACACCAGUGAAUGCCUU

UUAUAAUGGCUGCAUGGAAGUGAAUAUUAAUGGUGUACAGUUGGAUCUGG

AUGAAGCCAUUUCUAAACAUAAUGAUAUUAGAGCUCACUCAUGUCCAUCA

GUUUGGAAAAAGACAAAGAAUUCUÜÜÃA (SEQ ID NO: 153)

AUGAGGGUCCUGGGUGGGCGCUGCGGGGCGCUGCUGGCGUGUCUCCUCCU

AGUGCUUCCCGUCUCAGAGGCAAACUUUUGUUUAUAUUUUAGAAAUGAUU

UUAUAUACAACCGUGCAUGCAUUUCUGUAUUGGUCGGCUUAUCUGGAUGC

AAUUUUUUCUAUUCUAUAUGCUUUUUGUCAAAGCAACAGGCUUCACAAGU

CCUGGUUAGGAAGCGUCGUGCAAAUUCUUUACUUGAAGAAACCAAACAGG

GUAAUCUUGAAAGAGAAUGCAUCGAAGAACUGUGCAAUAAAGAAGAAGCC

AGGGAGGUCUUUGAAAAUGACCCGGAAACGGAUUAUUUUUAUCCAAAAUA

CUUAGUUUGUCUUCGCUCUUUUCAAACUGGGUUAUUCACUGCUGCACGUC

AGUCAACUAAUGCUUAUCCUGACCUAAGAAGCUGUGUCAAUGCCAUUCCA

GACCAGUGUAGUCCUCUGCCAUGCAAUGAAGAUGGAUAUAUGAGCUGCAA

AGAUGGAAAAGCUUCUUUUACUUGCACUUGUAAACCAGGUUGGCAAGGAG

AAAAGUGUGAAUUUGACAUAAAUGAAUGCAAAGAUCCCUCAAAUAUAAAU

GGAGGUUGCAGUCAAAUUUGUGAUAAUACACCUGGAAGUUACCACUGUUC

CUGUAAAAAUGGUUUUGUUAUGCUUUCAAAUAAGAAAGAUUGUAAAGAUG

UGGAUGAAUGCUCUUUGAAGCCAAGCAUUUGUGGCACAGCUGUGUGCAAG

AACAUCCCAGGAGAUUUUGAAUGUGAAUGCCCCGAAGGCUACAGAUAUAA

UCUCAAAUCAAAGUCUUGUGAAGAUAUAGAUGAAUGCUCUGAGAACAUGU

GUGCUCAGCUUUGUGUCAAUUACCCUGGAGGUUACACUUGCUAUUGUGAU

GGGAAGAAAGGAUUCAAACUUGCCCAAGAUCAGAAGAGUUGUGAGGUUGU

UUCAGUGUGCCUUCCCUUGAACCUUGACACAAAGUAUGAAUUACUUUACU

UGGCGGAGCAGUUUGCAGGGGUUGUUUUAUAUUUAAAAUUUCGUUUGCCA

GAAAUCAGCAGAUUUUCAGCAGAAUUUGAUUUCCGGACAUAUGAUUCAGA

AGGCGUGAUACUGUACGCAGAAUCUAUCGAUCACUCAGCGUGGCUCCUGA

UUGCACUUCGUGGUGGAAAGAUUGAAGUUCAGCUUAAGAAUGAACAUACA

UCCAAAAUCACAACUGGAGGUGAUGUUAUUAAUAAUGGUCUAUGGAAUAU

GGUGUCUGUGGAAGAAUUAGAACAUAGUAUUAGCAUUAAAAUAGCUAAAG

AAGCUGUGAUGGAUAUAAAUAAACCUGGACCCCUUUUUAAGCCGGAAAAU

GGAUUGCUGGAAACCAAAGUAUACUUUGCAGGAUUCCCUCGGAAAGUGGA

AAGUGAACUCAUUAAACCGAUUAACCCUCGUCUAGAUGGAUGUAUACGAA

GCUGGAAUUUGAUGAAGCAAGGAGCUUCUGGAAUAAAGGAAAUUAUUCAA

GAAAAACAAAAUAAGCAUUGCCUGGUUACUGUGGAGAAGGGCUCCUACUA

UCCUGGUUCUGGAAUUGCUCAAUUUCACAUAGAUUAUAAUAAUGUAUCCA

-continued

GUGCUGAGGGUUGGCAUGUAAAUGUGACCUUGAAUAUUCGUCCAUCCACG

GGCACUGGUGUUAUGCUUGCCUUGGUUUCUGGUAACAACACAGUGCCCUU

UGCUGUGUCCUUGGUGGACUCCACCUCUGAAAAAUCACAGGAUAUUCUGU

UAUCUGUUGAAAAUACUGUAAUAUAUCGGAUACAGGCCCUAAGUCUAUGU

UCCGAUCAACAAUCUCAUCUGGAAUUUAGAGUCAACAGAAACAAUCUGGA

GUUGUCGACACCACUUAAAAUAGAAACCAUCUCCCAUGAAGACCUUCAAA

GACAACUUGCCGUCUUGGACAAAGCAAUGAAAGCAAAAGUGGCCACAUAC

CUGGGUGGCCUUCCAGAUGUUCCAUUCAGUGCCACACCAGUGAAUGCCUU

UUAUAAUGGCUGCAUGGAAGUGAAUAUUAAUGGUGUACAGUUGGAUCUGG

AUGAAGCCAUUUCUAAACAUAAUGAUAUUAGAGCUCACUCAUGUCCAUCA

GUUUGGAAAAAGACAAAGAAUUCUUAA

Example 23: mUNA Oligomer Expressing Human Pyruvate Kinase, Liver and RBC (PKLR)

In this example, the structures of mUNA molecules for use in expressing human pyruvate kinase, liver and RBC (PKLR) are shown.

Human pyruvate kinase, liver and RBC (PKLR) is associated with chronic hereditary nonspherocytic hemolytic anemia.

The base sequences shown below are the portion of the mUNA molecule that may correspond in functionality to the open reading frame of the native mRNA of human pyruvate kinase, liver and RBC (PKLR). The complete mUNA molecule comprises a 5' cap (m7GpppGm), and a 5'-UTR upstream of the sequence below, and a 3' UTR and polyA tail (SEQ ID Nos:4 to 12) downstream of the sequence below, each of which corresponds to the structure of the native mRNA of human pyruvate kinase, liver and RBC (PKLR).

Human pyruvate kinase, liver and RBC (PKLR) is accession NM_000298.5.

(SEQ ID NO: 154)

AÛÛÛCGAUCCAGGAGAACAUAUCAUCCCUGCAGCUUCGGUCAUGGGUCUC

UAAGUCCCAAAGAGACUUAGCAAAGUCCAUCCUGAUUGGGGCUCCAGGAG

GGCCAGCGGGGUAUCUGCGGCGGGCCAGUGUGGCCCAACUGACCCAGGAG

CUGGGCACUGCCUUCUUCCAGCAGCAGCAGCUGCCAGCUGCUAUGGCAGA

CACCUUCCUGGAACACCUCUGCCUACUGGACAUUGACUCCGAGCCCGUGG

CUGCUCGCAGUACCAGCAUCAUUGCCACCAUCGGGCCAGCAUCUCGCUCC

GUGGAGCGCCUCAAGGAGAUGAUCAAGGCCGGGAUGAACAUUGCGCGACU

CAACUUCUCCCACGGCUCCCACGAGUACCAUGCUGAGUCCAUCGCCAACG

UCCGGGAGGCGGUGGAGAGCUUUGCAGGUUCCCCACUCAGCUACCGGCCC

GUGGCCAUCGCCCUGGACACCAAGGGACCGGAGAUCCGCACUGGGAUCCU

GCAGGGGGGUCCAGAGUCGGAAGUGGAGCUGGUGAAGGGCUCCCAGGUGC

UGGUGACUGUGGACCCCGCGUUCCGGACGCGGGGGAACGCGAACACCGUG

UGGGUGGACUACCCCAAUAUUGUCCGGGUCGUGCCGGUGGGGGGCCGCAU

CUACAUUGACGACGGGCUCAUCUCCCUAGUGGUCCAGAAAAUCGGCCCAG

-continued

AGGGACUGGUGACCCAAGUGGAGAACGGCGGCGUCCUGGGCAGCCGGAAG

GGCGUGAACUUGCCAGGGGCCCAGGUGGACUUGCCCGGGCUGUCCGAGCA

GGACGUCCGAGACCUGCGCUUCGGGGUGGAGCAUGGGGUGGACAUCGUCU

UUGCCUCCUUUGUGCGGAAAGCCAGCGACGUGGCUGCCGUCAGGGCUGCU

CUGGGUCCGGAAGGACACGGCAUCAAGAUCAUCAGCAAAAUUGAGAACCA

CGAAGGCGUGAAGAGGUUUGAUGAAAUCCUGGAGGUGAGCGACGGCAUCA

UGGUGGCACGGGGGGACCUAGGCAUCGAGAUCCCAGCAGAGAAGGUUUUC

CUGGCUCAGAAGAUGAUGAUUGGGCGCUGCAACUUGGCGGGCAAGCCUGU

UGUCUGUGCCACACAGAUGCUGGAGAGCAUGAUUACCAAGCCCCGGCCAA

CGAGGGCAGAGACAAGCGAUGUCGCCAAUGCUGUGCUGGAUGGGGCUGAC

UGCAUCAUGCUGUCAGGGGAGACUGCCAAGGGCAACUUCCCUGUGGAAGC

GGUGAAGAUGCAGCAUGCGAUUGCCCGGGAGGCAGAGGCCGCAGUGUACC

ACCGGCAGCUGUUUGAGGAGCUACGUCGGGCAGCGCCACUAAGCCGUGAU

CCCACUGAGGUCACCGCCAUUGGUGCUGUGGAGGCUGCCUUCAAGUGCUG

UGCUGCUGCCAUCAUUGUGCUGACCACAACUGGCCGCUCAGCCCAGCUUC

UGUCUCGGUACCGACCUCGGGCAGCAGUCAUUGCUGUCACCCGCUCUGCC

CAGGCUGCCCGCCAGGUCCACUUAUGCCGAGGAGUCUUCCCCUUGCUUUA

CCGUGAACCUCCAGAAGCCAUCUGGGCAGAUGAUGUAGAUCGCCGGGUGC

AAUUUGGCAUUGAAAGUGGAAAGCUCCGUGGCUUCCUCCGUGUUGGAGAC

CUGGUGAUUGUGGUGACAGGCUGGCGACCUGGCUCCGGCUACACCAACAU

CAUGCGGGUGCUAAGCAUAUCÛÛÛGA (SEQ ID NO: 155)

AUGUCGAUCCAGGAGAACAUAUCAUCCCUGCAGCUUCGGUCAUGGGUCUC

UAAGUCCCAAAGAGACUUAGCAAAGUCCAUCCUGAUUGGGGCUCCAGGAG

GGCCAGCGGGGUAUCUGCGGCGGGCCAGUGUGGCCCAACUGACCCAGGAG

CUGGGCACUGCCUUCUUCCAGCAGCAGCAGCUGCCAGCUGCUAUGGCAGA

CACCUUCCUGGAACACCUCUGCCUACUGGACAUUGACUCCGAGCCCGUGG

CUGCUCGCAGUACCAGCAUCAUUGCCACCAUCGGGCCAGCAUCUCGCUCC

GUGGAGCGCCUCAAGGAGAUGAUCAAGGCCGGGAUGAACAUUGCGCGACU

CAACUUCUCCCACGGCUCCCACGAGUACCAUGCUGAGUCCAUCGCCAACG

UCCGGGAGGCGGUGGAGAGCUUUGCAGGUUCCCCACUCAGCUACCGGCCC

GUGGCCAUCGCCCUGGACACCAAGGGACCGGAGAUCCGCACUGGGAUCCU

GCAGGGGGGUCCAGAGUCGGAAGUGGAGCUGGUGAAGGGCUCCCAGGUGC

UGGUGACUGUGGACCCCGCGUUCCGGACGCGGGGGAACGCGAACACCGUG

UGGGUGGACUACCCCAAUAUUGUCCGGGUCGUGCCGGUGGGGGGCCGCAU

CUACAUUGACGACGGGCUCAUCUCCCUAGUGGUCCAGAAAAUCGGCCCAG

AGGGACUGGUGACCCAAGUGGAGAACGGCGGCGUCCUGGGCAGCCGGAAG

GGCGUGAACUUGCCAGGGGCCCAGGUGGACUUGCCCGGGCUGUCCGAGCA

GGACGUCCGAGACCUGCGCUUCGGGGUGGAGCAUGGGGUGGACAUCGUCU

UUGCCUCCUUUGUGCGGAAAGCCAGCGACGUGGCUGCCGUCAGGGCUGCU

CUGGGUCCGGAAGGACACGGCAUCAAGAUCAUCAGCAAAAUUGAGAACCA

-continued

CGAAGGCGUGAAGAGGUUUGAUGAAAUCCUGGAGGUGAGCGACGGCAUCA

UGGUGGCACGGGGGGACCUAGGCAUCGAGAUCCCAGCAGAGAAGGUUUUC

CUGGCUCAGAAGAUGAUGAUUGGGCGCUGCAACUUGGCGGGCAAGCCUGU

UGUCUGUGCCACACAGAUGCUGGAGAGCAUGAUUACCAAGCCCCGGCCAA

CGAGGGCAGAGACAAGCGAUGUCGCCAAUGCUGUGCUGGAUGGGGCUGAC

UGCAUCAUGCUGUCAGGGGAGACUGCCAAGGGCAACUUCCCUGUGGAAGC

GGUGAAGAUGCAGCAUGCGAUUGCCCGGGAGGCAGAGGCCGCAGUGUACC

ACCGGCAGCUGUUUGAGGAGCUACGUCGGGCAGCGCCACUAAGCCGUGAU

CCCACUGAGGUCACCGCCAUUGGUGCUGUGGAGGCUGCCUUCAAGUGCUG

UGCUGCUGCCAUCAUUGUGCUGACCACAACUGGCCGCUCAGCCCAGCUUC

UGUCUCGGUACCGACCUCGGGCAGCAGUCAUUGCUGUCACCCGCUCUGCC

CAGGCUGCCCGCCAGGUCCACUUAUGCCGAGGAGUCUUCCCCUUGCUUUA

CCGUGAACCUCCAGAAGCCAUCUGGGCAGAUGAUGUAGAUCGCCGGGUGC

AAUUUGGCAUUGAAAGUGGAAAGCUCCGUGGCUUCCUCCGUGUUGGAGAC

CUGGUGAUUGUGGUGACAGGCUGGCGACCUGGCUCCGGCUACACCAACAU

CAUGCGGGUGCUAAGCAUAUCCUGA

Example 24: mUNA Oligomer Expressing Human Phenylalanine Hydroxylase

In this example, the structures of mUNA molecules for use in expressing human phenylalanine hydroxylase are shown.

Human phenylalanine hydroxylase is associated with phenylketonuria.

The base sequences shown below are the portion of the mUNA molecule that may correspond in functionality to the open reading frame of the native mRNA of human phenylalanine hydroxylase. The complete mUNA molecule comprises a 5' cap (m7GpppGm), and a 5'-UTR upstream of the sequence below, and a 3' UTR and polyA tail (SEQ ID NOs:4 to 12) downstream of the sequence below, each of which corresponds to the structure of the native mRNA of human phenylalanine hydroxylase.

Human phenylalanine hydroxylase is accession NM_000277.1.

(SEQ ID NO: 156)

AÜĜÜCCACUGCGGUCCUGGAAAACCCAGGCUUGGGCAGGAAACUCUCUGA

CUUUGGACAGGAAACAAGCUAUAUUGAAGACAACUGCAAUCAAAAUGGUG

CCAUAUCACUGAUCUUCUCACUCAAAGAAGAAGUUGGUGCAUUGGCCAAA

GUAUUGCGCUUAUUUGAGGAGAAUGAUGUAAACCUGACCCACAUUGAAUC

UAGACCUUCUCGUUUAAAGAAAGAUGAGUAUGAAUUUUUCACCCAUUUGG

AUAAACGUAGCCUGCCUGCUCUGACAAACAUCAUCAAGAUCUUGAGGCAU

GACAUUGGUGCCACUGUCCAUGAGCUUUCACGAGAUAAGAAGAAAGACAC

AGUGCCCUGGUUCCCAAGAACCAUUCAAGAGCUGGACAGAUUUGCCAAUC

AGAUUCUCAGCUAUGGAGCGGAACUGGAUGCUGACCACCCUGGUUUUAAA

GAUCCUGUGUACCGUGCAAGACGGAAGCAGUUUGCUGACAUUGCCUACAA

CUACCGCCAUGGGCAGCCCAUCCCUCGAGUGGAAUACAUGGAGGAAGAAA

AGAAAACAUGGGGCACAGUGUUCAAGACUCUGAAGUCCUUGUAUAAAACC

CAUGCUUGCUAUGAGUACAAUCACAUUUUUCCACUUCUUGAAAAGUACUG

UGGCUUCCAUGAAGAUAACAUUCCCCAGCUGGAAGACGUUUCUCAAUUCC

UGCAGACUUGCACUGGUUUCCGCCUCCGACCUGUGGCUGGCCUGCUUUCC

UCUCGGGAUUUCUUGGGUGGCCUGGCCUUCCGAGUCUUCCACUGCACACA

GUACAUCAGACAUGGAUCCAAGCCCAUGUAUACCCCCGAACCUGACAUCU

GCCAUGAGCUGUUGGGACAUGUGCCCUUGUUUUCAGAUCGCAGCUUUGCC

CAGUUUUCCCAGGAAAUUGGCCUUGCCUCUCUGGGUGCACCUGAUGAAUA

CAUUGAAAAGCUCGCCACAAUUUACUGGUUUACUGUGGAGUUUGGGCUCU

GCAAACAAGGAGACUCCAUAAAGGCAUAUGGUGCUGGGCUCCUGUCAUCC

UUUGGUGAAUUACAGUACUGCUUAUCAGAGAAGCCAAAGCUUCUCCCCCU

GGAGCUGGAGAAGACAGCCAUCCAAAAUUACACUGUCACGGAGUUCCAGC

CCCUGUAUUACGUGGCAGAGAGUUUUAAUGAUGCCAAGGAGAAAGUAAGG

AACUUUGCUGCCACAAUACCUCGGCCCUUCUCAGUUCGCUACGACCCAUA

CACCCAAAGGAUUGAGGUCUUGGACAAUACCCAGCAGCUUAAGAUUUUGG

CUGAUUCCAUUAACAGUGAAAUUGGAAUCCUUUGCAGUGCCCUCCAGAAA

AUAAAĜÜÃA (SEQ ID NO: 157)

AUĜUCCACUGCGGUCCUGGAÃAACCCAGGCUUGGGCAGĜAAACUCUCUGA

CUUUGGÃCAGGAAACAAGCUAUAÜĜAAGACAACUGCAAUCAÃAAUGGUG

CCAUAUCACUĜAUCUUCUCACUCAAAGAÃGAAGUUGGUGCAUUGGCĈAAA

GUAUUGCGCUUAUÜĜAGGAGAAUGAUGUAAÂCCUGACCCACAUUGAAUC

ÜAGACCUUCUCGUUUAAAĜAAAGAUGAGUAUGAAUÜÜUCACCCAUUUGG

AUAAÃCGUAGCCUGCCUGCUCÜĜACAAACAUCAUCAAGAUĈUUGAGGCAU

GACAUUGGÜGCCACUGUCCAUGAGCUÜUCACGAGAUAAGAAGAÃGACAC

AGUGCCCUGGUÜĈCCAAGAACCAUUCAAGAĜCUGGACAGAUUUGCCAÃÜC

AGAUUCUCAGCUAUGGÃGCGGAACUGGAUGCUGAĈCACCCUGGUUUUAAA

GAÜCCUGUGUACCGUGCAAGÃCGGAAGCAGUUUGCUGAĈAUUGCCUACAA

CUACCGĈCAUGGGCAGCCCAUCCCÜCGAGUGGAAUACAUGGAĜGAAGAAA

AGAAAACAUĜGGCACAGUGUUCAAGACÜCUGAAGUCCUUGUAUAAÃACC

CAUGCUUGCUAUGAĜUACAAUCACAUUUUUCCÃCUUCUUGAAAAGUACUG

ÜGGCUUCCAUGAAGAUAAĈAUUCCCCAGCUGGAAGAĈGUUUCUCAAUUCC

UGCAĜACUUGCACUGGUUUCCGĈCUCCGACCUGUGGCUGĜCUGCUUUCC

UCUCGGGAÜUUCUUGGGUGGCCUGGCĈUUCCGAGUCUUCCACUGĈACACA

GUACAUCAGACAÜGGAUCCAAGCCCAUGUAÜACCCCCGAACCUGACAUĈU

GCCAUGAGCUGUUGGGÃCAUGUGCCCUUGUUUUCÃGAUCGCAGCUUUGCC

CAĜUUUUCCCAGGAAAUUGGĈCUUGCCUCUCUGGGUGCÃCCUGAUGAAUA

CAUUGAÃAAGCUCGCCACAAUUUAĈUGGUUUACUGUGGAGUÜĜGGGCUCU

GCAAACAAGGÃGACUCCAUAAAGGCAUAÜGGUGCUGGGCUCCUGUCÃUCC

-continued

UUUGGUGAAUUACAĜUACUGCUUAUCAGAGAAĜCCAAAGCUUCUCCCCCU

ĜGAGCUGGAGAAGACAGCĈAUCCAAAAUUACACUGUĈACGGAGUUCCAGC

CCCUĜUAUUACGUGGCAGAGAGŬUUUAAUGAUGCCAAGGAĜGAAAGUAAG

GAACUUUĜCUGCCACAAUACCUCGGCĈCUUCUCAGUUCGCUACGĂCCCAU

ACACCCAAAGGAŬUGAGGUCUUGGACAAUAĈCCAGCAGCUUAAGAUUŬG

GCUGAUUCCAUUAACAĜUGAAAUUGGAAUCCUUUĜCAGUGCCCUCCAGAA

AAŬAAAGUĂA (SEQ ID NO: 158)

AUGUCCACUGCGGUCCUGGAAAACCCAGGCUUGGGCAGGAAACUCUCUGA

CUUUGGACAGGAAACAAGCUAUAUUGAAGACAACUGCAAUCAAAAUGGUG

CCAUAUCACUGAUCUUCUCACUCAAAGAAGAAGUUGGUGCAUUGGCCAAA

GUAUUGCGCUUAUUUGAGGAGAAUGAUGUAAACCUGACCCACAUUGAAUC

UAGACCUUCUCGUUUAAAGAAAGAUGAGUAUGAAUUUUUCACCCAUUUGG

AUAAACGUAGCCUGCCUGCUCUGACAAACAUCAUCAAGAUCUUGAGGCAU

GACAUUGGUGCCACUGUCCAUGAGCUUUCACGAGAUAAGAAGAAAGACAC

AGUGCCCUGGUUCCCAAGAACCAUUCAAGAGCUGGACAGAUUUGCCAAUC

AGAUUCUCAGCUAUGGAGCGGAACUGGAUGCUGACCACCCUGGUUUUAAA

GAUCCUGUGUACCGUGCAAGACGGAAGCAGUUUGCUGACAUUGCCUACAA

CUACCGCCAUGGGCAGCCCAUCCCUCGAGUGGAAUACAUGGAGGAAGAAA

AGAAAACAUGGGGCACAGUGUUCAAGACUCUGAAGUCCUUGUAUAAAACC

CAUGCUUGCUAUGAGUACAAUCACAUUUUUCCACUUCUUGAAAAGUACUG

UGGCUUCCAUGAAGAUAACAUUCCCCAGCUGGAAGACGUUUCUCAAUUCC

UGCAGACUUGCACUGGUUUCCGCCUCCGACCUGUGGCUGGCCUGCUUUCC

UCUCGGGAUUUCUUGGGUGGCCUGGCCUUCCGAGUCUUCCACUGCACACA

GUACAUCAGACAUGGAUCCAAGCCCAUGUAUACCCCCGAACCUGACAUCU

GCCAUGAGCUGUUGGGACAUGUGCCCUUGUUUUCAGAUCGCAGCUUUGCC

CAGUUUUCCCAGGAAAUUGGCCUUGCCUCUCUGGGUGCACCUGAUGAAUA

CAUUGAAAAGCUCGCCACAAUUUACUGGUUUACUGUGGAGUUUGGGCUCU

GCAAACAAGGAGACUCCAUAAAGGCAUAUGGUGCUGGGCUCCUGUCAUCC

-continued

UUUGGUGAAUUACAGUACUGCUUAUCAGAGAAGCCAAAGCUUCUCCCCCU

GGAGCUGGAGAAGACAGCCAUCCAAAAUUACACUGUCACGGAGUUCCAGC

CCCUGUAUUACGUGGCAGAGAGUUUUAAUGAUGCCAAGGAGAAAGUAAGG

AACUUUGCUGCCACAAUACCUCGGCCCUUCUCAGUUCGCUACGACCCAUA

CACCCAAAGGAUUGAGGUCUUGGACAAUACCCAGCAGCUUAAGAUUUUGG

CUGAUUCCAUUAACAGUGAAAUUGGAAUCCUUUGCAGUGCCCUCCAGAAA

AUAAAGUAA

Example 25: mUNA Oligomer Translation Enhancer Based on TEV 5'UTR

In this example, the structures of mUNA molecules for enhancing translational efficiency are shown.

The 5'-UTR of tobacco etch virus (TEV) is as follows:

(SEQ ID NO: 159)

UCAACACAACAUAUACAAAAACAAACGAAUCUCAAGCAAUCAAGCAUUCU

ACUUCUAUUCAGCAAUUUAAAUCAUUUCUUUUAAAGCAAAAGCAAUUUUC

UGAAAAUUUUCACCAUUUACGAACGAUAGCC

The base sequences shown below are the portion of the mUNA molecule that may correspond in functionality to the 5'-UTR of tobacco etch virus (TEV). The complete mUNA molecule comprises a 5' cap upstream of the sequence below (m7GpppGm), and a coding region (CDS) of a protein of interest, a 3'-UTR, and a polyA tail (SEQ ID Nos:4 to 12) downstream of the sequence below, each of which corresponds to the structure of any native human mRNA. Thus, a UNA oligomer incorporating the oligomer fragment below can have enhanced translational efficiency.

The translation enhancer is placed upstream of the AUG translation start site, and the enhancer region is not translated into the therapeutic protein.

(SEQ ID NO: 160)

UĈAACĂCAAĈAUAŬACAĂAACĂAACĜAAUĈUCAĂGCAĂUCAĂGCAŬUCU

ĂCUUĈUAŬĜCAĜCAAŬUUAĂAUCĂUUUĈUUUŬAAAĜCAAĂAGCĂAUŬU

CUĜAAAĂUUUŬCACĈAUŬACGĂACGĂUAGĈC (SEQ ID NO: 161)

UĈAACACAACAUAUACAAAACAAACGAAUCUĈAAGCAAUCAAGCAUUCUA

CUUCUAUUGCAĜCAAUUUAAAUCAUUUCUUUUAAAGCAAAAĜCAAUUUUC

UGAAAAUUUUCACCAUUUACGAACGAUAGCĈC (SEQ ID NO: 162)

UĈĂĂCACAACAUAUACAAAACAAACGAAUCUCAAGCAAUCAAGCAUUCUA

CUUCUAUUGCAGCAAUUUAAAUCAUUUCUUUUAAAGCAAAAGCAAUUUUC

-continued

UGAAAAUUUUCACCAUUUACGAACGAUÃÂÛC (SEQ ID NO: 163)

ÛCAACACAACAÛÃÛACAAAACAAACGAÃÛCÛCAAGCAÃÛCAAGCAÃÛÛCÛA

CÛÛCÛÃÛÛGCAGCAÃÛÛÛAAÃÛCÃÛÛÛCÛÛÛÛAAAGCAAAAGCAÃÛÛÛÛC

ÛGAAAÃÛÛÛÛCACCÃÛÛÛACGAACGÃÛAGCC (SEQ ID NO: 164)

ÛÂÃÂÂÂÂÃÂÂÂÂÃÂÂÂ reactions were performed with three different donor oligomer species: A(30), A(60), and A(120). Based on the gel shifts, the ligations attained nearly 100% efficiency.

Example 32: Splint-Mediated Ligation

A protocol used for a 100 ul splint-mediated ligation reaction included the following materials, reagents, and steps.

100 pmol UNA-PolyA UNA Oligomer donor.

100 pmol TAIL-60 splint oligomer.

50 pmol purified RNA acceptor.

10 uL T4 RNA Ligase 2 10× Buffer.

2 uL T4 RNA Ligase 2.

Nuclease-free Water to 100 uL.

Mix and incubate for 1-2 hours at 37 degrees, then purify the RNA in a total of ~90 uL RNAse-free water.

Add 10 uL 10× DNase buffer to eluent and 2 ul DNase I, mix and incubate for 1 hour at 37 degrees to digest splint DNA.

Repurify the RNA using RNeasy spin columns, eluting in water or TE pH 7.0.

Reagents.

NEB M0239 T4 RNA Ligase 2.

NEB M0303 DNase I (RNase-free).

Qiagen 74104RNeasy Mini Kit.

TAIL-60 splint oligomer sequence:

(SEQ ID NO: 165)
CTTCCTACTCAGGCTTTATTCAAAGACCA.

Notes:

(a) The splint oligomer sequence includes an anchor that is specific to the 3' UTR used for making mRNA.

(b) This protocol requires an mRNA transcript with a pre-incorporated 30-nt polyA tail.

Example 33: Splint-Mediated Ligation

Figure 12:
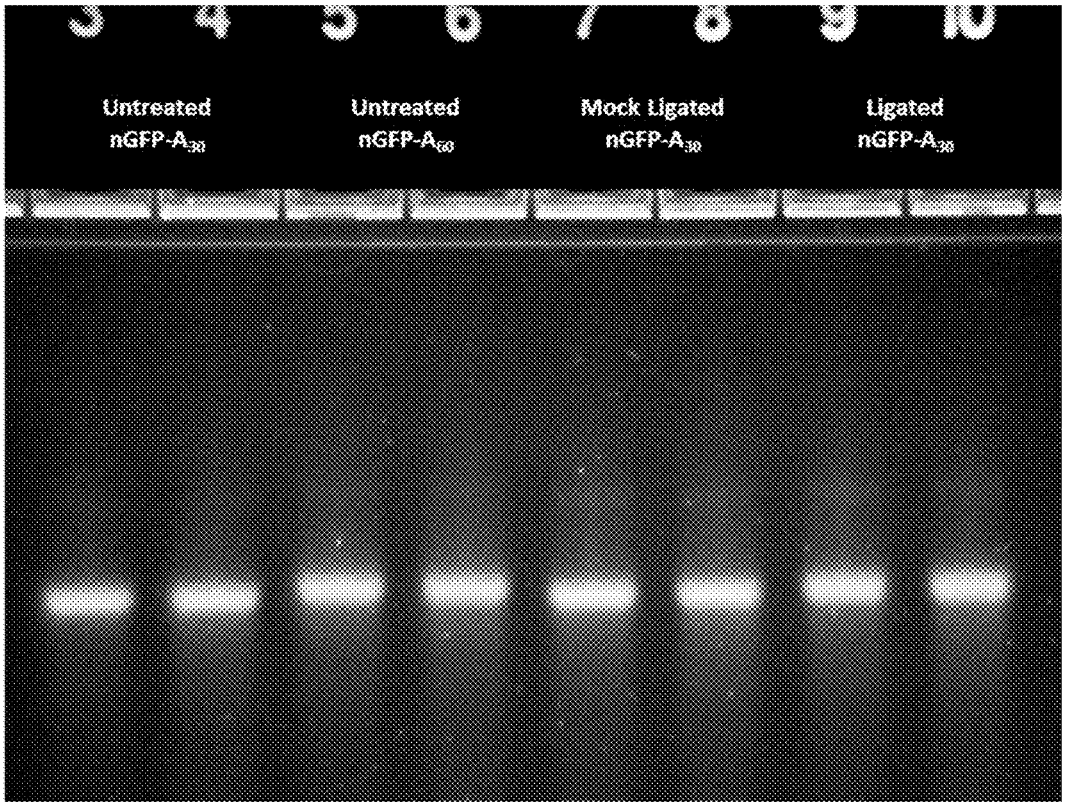
FIG. 12.

A full-length synthetic mRNA acceptor and a 5'-monophosphate-bearing polyA donor were ligated in the presence of a DNA splint oligomer. On ligating a 30-monomer length tail to a ~1 Kb nGFP transcript, a size shift was apparent on a 2% agarose gel, providing a direct indication that bulk ligation was achieved. FIG. 12 shows the results of one-hour splint-mediated ligations that were performed on nGFP-$A_{30}$ transcripts. The resulting ligation products were compared to untreated transcripts and native nGFP-$A_{60}$ IVT products. The native nGFP-$A_{60}$ and the ligated products were upshifted on the gel relative to the untreated nGFP-$A_{30}$ transcripts and mock-ligated material.

Example 34: Splint-Mediated Ligation

A UNA-PolyA UNA Oligomer donor was made having the following structure:

(SEQ ID NO: 166)
5'-(rAp)-AAAAAAAAAAAAAAAAAAAAAAAAAAAAAA-(3' C3 Spacer), wherein 5'-(rAp) is 5' Phosphorylation and A is UNA-A.

Example 35: Translatable RNA Molecules

An nGFP transcript with a polyA tail of 30-monomers in length (untreated $A_{30}$ mRNA) was ligated to a donor polyA tail of 30-monomers in length to give an mRNA product having a polyA tail of 60-monomers in length ($A_{60}$-bearing ligation product) by splint-mediated ligation.

Figure 13:
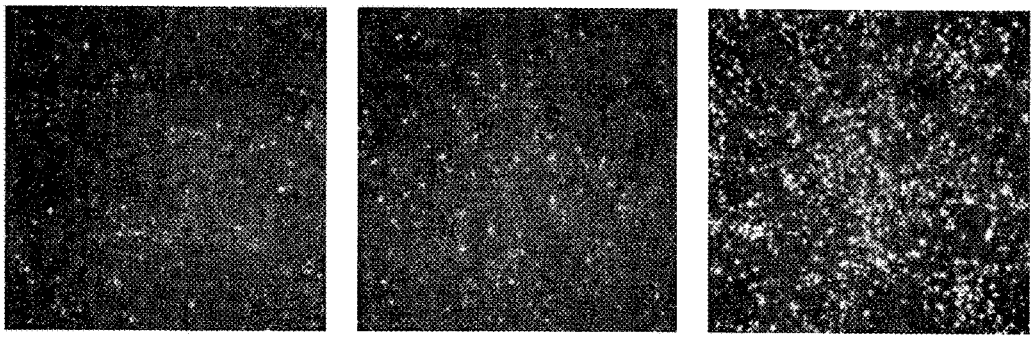
FIG. 13.

FIG. 13 shows increased lifetime and translational activity for the nGFP-$A_{60}$ ligation product. As shown in FIG. 13, nuclearized transcripts were transfected into fibroblasts for comparison of nGFP-$A_{30}$, mock-ligated nGFP-$A_{30}$, and an nGFP-$A_{60}$ ligation product (FIG. 13, left to right). The significantly higher fluorescence signal observed for the nGFP-$A_{60}$ ligation product shows that it has markedly increased translational activity.

Example 36: Cohesive End Ligation

A wild-type T4 RNA ligase was used to ligate a donor 5' phosphorylated oligomer to a short IVT transcript. Short synthetic RNAs were generated by IVT, and the outcome of ligation reactions was evaluated on high-resolution 4% agarose gels. The increase in transcript size from ligation of a synthetic oligomer 30 monomers in length to a full-sized mRNA of 1-2 Kb is too small to clearly visualize on a gel. Thus, short synthetic RNAs of 100-180 monomers were generated by IVT. The 3' terminal sequence of these short synthetic RNAs was identical to that in the 3' UTRs of synthetic mRNAs.

Example 37: Cohesive End Ligation with Pre-Adenylated Donor

A synthetic oligomer having an adenylated 5' end was prepared. The adenylated 5' end, normally formed as a catalytic intermediate by the ligase, pre-activated the synthetic oligomer for ligation. Use of the pre-adenylated synthetic oligomer obviated the need for ATP in the reactions, and allowed the use of a mutant ligase that was active exclusively on adenylated substrates. Pre-adenylation of the synthetic oligomer increased ligation efficiency and minimized side-product formation.

A KQ mutant variant of T4 RNA Ligase 2 was used to ligate a pre-adenylated donor oligomer to a short IVT transcript.

Figure 14:
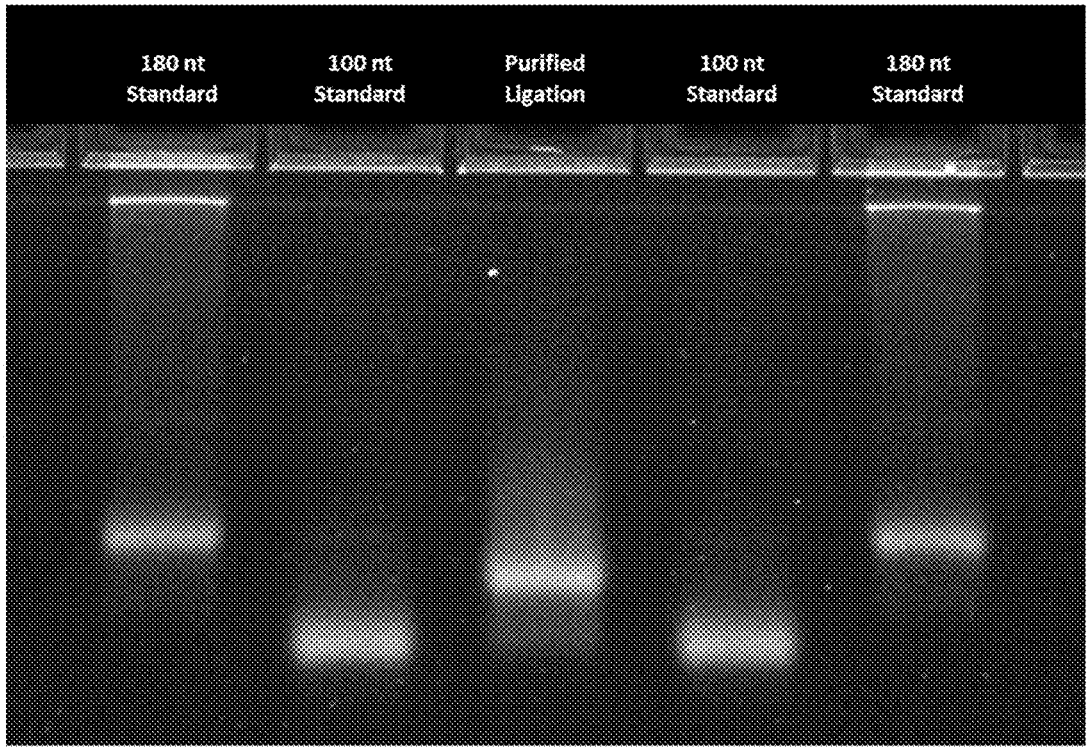
FIG. 14.

FIG. 14 shows the results of a ligation performed with a 100-monomer acceptor RNA that was treated for 3 hours at room temperature with T4 RNA Ligase 2 (truncated KQ mutant) using a 10 uM concentration of a polyA tail 30-monomer donor oligomer. 15% PEG 8000 was included in the reaction as a volume excluder to promote efficient ligation. The ligation reaction showed that a high molecular weight product was formed, having a size in between the 100-monomer acceptor RNA and a 180-monomer RNA transcript included as a size standard. These results show that the ligation reaction produced a predominant product having high molecular weight with nearly 100% ligation of the donor to the acceptor. Additional experiments performed with concentrations of the polyA tail at 10 uM, 20 uM, and 40 uM showed that at least half of the acceptor RNA was ligated in all cases.

All publications, patents and literature specifically mentioned herein are incorporated by reference for all purposes.

It is understood that this invention is not limited to the particular methodology, protocols, materials, and reagents described, as these may vary. It is also to be understood that the terminology used herein is for the purpose of describing particular embodiments only, and is not intended to limit the scope of the present invention, which will be encompassed by the appended claims.

It must be noted that as used herein and in the appended claims, the singular forms "a", "an", and "the" include plural reference unless the context clearly dictates otherwise. As well, the terms "a" (or "an"), "one or more" and "at least one" can be used interchangeably herein. It is also to be noted that the terms "comprises," "comprising", "containing," "including", and "having" can be used interchangeably.

Without further elaboration, it is believed that one skilled in the art can, based on the above description, utilize the present invention to its fullest extent. The following specific embodiments are, therefore, to be construed as merely illustrative, and not limitative of the remainder of the disclosure in any way whatsoever.

All of the features disclosed in this specification may be combined in any combination. Each feature disclosed in this specification may be replaced by an alternative feature serving the same, equivalent, or similar purpose.

SEQUENCE LISTING

```
<160> NUMBER OF SEQ ID NOS: 166

<210> SEQ ID NO 1
<211> LENGTH: 1750
<212> TYPE: RNA
<213> ORGANISM: Artificial Sequence
<220> FEATURE:
<223> OTHER INFORMATION: Description of Artificial Sequence: Synthetic
      polynucleotide
<220> FEATURE:
<223> OTHER INFORMATION: 5' cap (m7GpppGm)
<220> FEATURE:
<221> NAME/KEY: modified_base
<222> LOCATION: (1747)..(1748)
<223> OTHER INFORMATION: UNA monomer

<400> SEQUENCE: 1

gggaaacaua agucaacaca acauauacaa aacaaacgaa ucucaagcaa ucaagcauuc     60

uacuucuauu gcagcaauuu aaaucauuuc uuuuaaagca aaagcaauuu ucugaaaauu    120

uucaccauuu acgaacgaua gccauggccc agcgcgugaa caugaucaug gcagaaucac    180

caggccucau caccaucugc cuuuuaggau aucuacucag ugcugaaugu acaguuuuuc    240

uugaucauga aaacgccaac aaaauucuga aucggccaaa gagguauaau ucagguaaau    300

uggaagaguu uguucaaggg aaccuugaga gagaauguau ggaagaaaag uguaguuuug    360

aagaagcacg agaaguuuuu gaaaacacug aaagaacaac ugaauuuugg aagcaguaug    420

uugauggaga ucagugugag uccaauccau guuuaaaugg cggcaguugc aaggaugaca    480

uuaauuccua ugaauguugg uguccccuuug gauuugaagg aaagaacugu gaauuagaug    540

uaacauguaa cauuaagaau ggcagaugcg agcaguuuug uaaaaauagu gcugauaaca    600

agguggguuug cuccuguacu gagggauauc gacuugcaga aaaccagaag uccugugaac    660

cagcagugcc auuuccaugu ggaagaguuu cuguuucaca aacuucuaag cucacccgug    720

cugagacugu uuuuccugau guggacuaug uaaauucuac ugaagcugaa accauuuugg    780

auaacaucac ucaaagcacc caaucauuua augacuucac ucggguuguu gguggagaag    840

augccaaacc aggucaauuc ccuuggcagg uuguuuugaa ugguaaaguu gaugcauucu    900

guggaggcuc uaucguuaau gaaaaaugga uuguaacugc ugcccacugu guugaaacug    960

guguuaaaau uacaguuguc gcaggugaac auaauauuga ggagacagaa cauacagagc   1020

aaaagcgaaa ugugauucga auuauuccuc accacaacua caaugcagcu auuaauaagu   1080

acaaccauga cauugcccuu cuggaacugg acgaacccuu agugcuaaac agcuacguua   1140

caccuauuug cauugcugac aaggaauaca cgaacaucuu ccucaaauuu ggaucuggcu   1200

auguaagugg cuggggaaga gucuuccaca aagggagauc agcuuuaguu cuucaguacc   1260

uuagaguucc acuuguugac cgagccacau gucuucgauc uacaaaguuc accaucuaua   1320

acaacauguu cugugcuggc uuccaugaag gagguagaga uucaugucaa ggagauagug   1380

ggggacccca uguuacugaa guggaaggga ccaguuucuu aacuggaauu auuagcuggg   1440
```

```
gugaagagug ugcaaugaaa ggcaaauaug gaauauauac caagguaucc cgguauguca   1500

acuggauuaa ggaaaaaaca aagcucacuu gacuagugac ugacuaggau cugguuacca   1560

cuaaaccagc cucaagaaca cccgaaugga gucucuaagc uacauaauac caacuuacac   1620

uuacaaaaug uugucccccca aaauguagcc auucguaucu gcuccuaaua aaaagaaagu   1680

uucuucacau aaaaaaaaaa aaaaaaaaaa aaaaaaaaaa aaaaaaaaaa aaaaaaaaaa   1740

aaaaaaaaaa                                                          1750
```

<210> SEQ ID NO 2
<211> LENGTH: 943
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<223> OTHER INFORMATION: 5' cap (m7GpppGm)
<220> FEATURE:
<221> NAME/KEY: modified_base
<222> LOCATION: (940)..(941)
<223> OTHER INFORMATION: UNA monomer

<400> SEQUENCE: 2

```
gggaaacaua agucaacaca acauauacaa aacaaacgaa ucucaagcaa ucaagcauuc     60

uacuucuauu gcagcaauuu aaaucauuuc uuuuaaagca aaagcaauuu ucugaaaauu    120

uucaccauuu acgaacgaua gccaugggggg ugcacgaaug uccugccugg cuguggcuuc    180

uccugucccu gcugucgcuc ccucugggcc ucccaguccu gggcgcccca ccacgccuca    240

ucugugacag ccgaguccug gagagguacc ucuuggaggc caaggaggcc gagaauauca    300

cgacgggcug ugcugaacac ugcagcuuga augagaauau cacuguccca gacaccaaag    360

uuaauuucua ugccuggaag aggauggagg ucgggcagca ggccguagaa gucuggcagg    420

gccuggcccu gcugucggaa gcuguccugc ggggccaggc ccuguugguc aacucuuccc    480

agccguggga gccccugcag cugcaugugg auaaagccgu caguggccuu cgcagccuca    540

ccacucugcu ucgggcucug ggagcccaga aggaagccau cuccccucca gaugcggccu    600

cagcugcucc acuccgaaca aucacugcug acacuuuccg caaacucuuc cgagucuacu    660

ccaauuuccu ccggggaaag cugaagcugu acacagggga ggccugcagg acaggggaca    720

gaugacuagu gacugacuag gaucugguua ccacuaaacc agccucaaga acacccgaau    780

ggagucucua agcuacauaa uaccaacuua cacuuacaaa auguuguccc ccaaaaugua    840

gccauucgua ucugcuccua auaaaaagaa aguuucuuca cauaaaaaaa aaaaaaaaaa    900

aaaaaaaaaa aaaaaaaaaa aaaaaaaaaa aaaaaaaaaa aaa                      943
```

<210> SEQ ID NO 3
<211> LENGTH: 940
<212> TYPE: DNA
<213> ORGANISM: Artificial Sequence
<220> FEATURE:
<223> OTHER INFORMATION: Description of Artificial Sequence: Synthetic
oligonucleotide
<220> FEATURE:
<223> OTHER INFORMATION: Description of Combined DNA/RNA Molecule:
Synthetic oligonucleotide
<220> FEATURE:
<223> OTHER INFORMATION: 5' cap (m7GpppGm)
<220> FEATURE:
<221> NAME/KEY: modified_base
<222> LOCATION: (939)..(940)
<223> OTHER INFORMATION: a, c, t, g, unknown or other

<400> SEQUENCE: 3 gggaaacaua agucaacaca acauauacaa aacaaacgaa ucucaagcaa ucaagcauuc 60 uacuucuauu gcagcaauuu aaaucauuuc uuuuaaagca aaagcaauuu ucugaaaauu 120 uucaccauuu acgaacgaua gccaugggggg ugcccgaacg ucccacccug cugcuuuuac 180 ucuccuugcu acugauuccu cugggccucc caguccucug ugcucccccca cgccucaucu 240 gcgacagucg aguucuggag agguacaucu uagaggccaa ggaggcagaa aaugucacga 300 uggguugugc agaaggcccc agacugagug aaaauauuac aguccccagau accaaaguca 360 acuucuaugc uuggaaaaga auggaggugg aagaacaggc cauagaaguu uggcaaggcc 420 uguccccugcu cucagaagcc auccugcagg cccaggcccu gcuagccaau uccucccagc 480 caccagagac ccuucagcuu cauauagaca aagccaucag uggucuacgu agccucacuu 540 cacugcuucg gguacuggga gcucagaagg aauugauguc gccuccagau accaccccac 600 cugcuccacu ccgaacacuc acaguggaua cuuucugcaa gcucuuccgg gucuacgcca 660 acuuccuccg ggggaaacug aagcuguaca cgggagaggu cugcaggaga ggggacaggt 720 gacuagugac ugacuaggau cugguuacca cuaaaccagc cucaagaaca cccgaaugga 780 gucucuaagc uacauaauac caacuuacac uuacaaaaug uuguccccca aaauguagcc 840 auucguaucu gcuccuaaua aaaagaaagu uucuucacau aaaaaaaaaa aaaaaaaaaa 900 aaaaaaaaaa aaaaaaaaaa aaaaaaaaaa aaaaaaaaaa 940

<210> SEQ ID NO 4
<211> LENGTH: 60
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (57)..(58)
<223> OTHER INFORMATION: UNA monomer

<400> SEQUENCE: 4 aaaaaaaaaa aaaaaaaaaa aaaaaaaaaa aaaaaaaaaa aaaaaaaaaa aaaaaaaaaa 60

<210> SEQ ID NO 5
<211> LENGTH: 60
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (55)..(56)
<223> OTHER INFORMATION: UNA monomer

<400> SEQUENCE: 5 aaaaaaaaaa aaaaaaaaaa aaaaaaaaaa aaaaaaaaaa aaaaaaaaaa aaaaaaaaaa 60

<210> SEQ ID NO 6
<211> LENGTH: 60
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base <222> LOCATION: (53)..(54)
<223> OTHER INFORMATION: UNA monomer

<400> SEQUENCE: 6 aaaaaaaaaa aaaaaaaaaa aaaaaaaaaa aaaaaaaaaa aaaaaaaaaa aaaaaaaaaa 60

<210> SEQ ID NO 7
<211> LENGTH: 60
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (51)..(52)
<223> OTHER INFORMATION: UNA monomer

<400> SEQUENCE: 7 aaaaaaaaaa aaaaaaaaaa aaaaaaaaaa aaaaaaaaaa aaaaaaaaaa aaaaaaaaaa 60

<210> SEQ ID NO 8
<211> LENGTH: 60
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (49)..(50)
<223> OTHER INFORMATION: UNA monomer

<400> SEQUENCE: 8 aaaaaaaaaa aaaaaaaaaa aaaaaaaaaa aaaaaaaaaa aaaaaaaaaa aaaaaaaaaa 60

<210> SEQ ID NO 9
<211> LENGTH: 60
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (47)..(48)
<223> OTHER INFORMATION: UNA monomer

<400> SEQUENCE: 9 aaaaaaaaaa aaaaaaaaaa aaaaaaaaaa aaaaaaaaaa aaaaaaaaaa aaaaaaaaaa 60

<210> SEQ ID NO 10
<211> LENGTH: 60
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (45)..(46)
<223> OTHER INFORMATION: UNA monomer

<400> SEQUENCE: 10 aaaaaaaaaa aaaaaaaaaa aaaaaaaaaa aaaaaaaaaa aaaaaaaaaa aaaaaaaaaa 60

<210> SEQ ID NO 11
<211> LENGTH: 60
<212> TYPE: RNA

<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (43)..(44)
<223> OTHER INFORMATION: UNA monomer

<400> SEQUENCE: 11 aaaaaaaaaa aaaaaaaaaa aaaaaaaaaa aaaaaaaaaa aaaaaaaaaa aaaaaaaaaa 60

<210> SEQ ID NO 12
<211> LENGTH: 60
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (41)..(42)
<223> OTHER INFORMATION: UNA monomer

<400> SEQUENCE: 12 aaaaaaaaaa aaaaaaaaaa aaaaaaaaaa aaaaaaaaaa aaaaaaaaaa aaaaaaaaaa 60

<210> SEQ ID NO 13
<211> LENGTH: 1618
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<223> OTHER INFORMATION: 5' cap (m7GpppGm)
<220> FEATURE:
<221> NAME/KEY: modified_base
<222> LOCATION: (1613)..(1614)
<223> OTHER INFORMATION: UNA monomer

<400> SEQUENCE: 13 gggaaacaua agucaacaca acauauacaa aacaaacgaa ucucaagcaa ucaagcauuc 60 uacuucuauu gcagcaauuu aaaucauuuc uuuuaaagca aaagcaauuu ucugaaaauu 120 uucaccauuu acgaacgaua gccaugccgu cuucugucuc gugggcauc cuccugcugg 180 caggccugug cugccugguc ccugucuccc uggcugagga uccccaggga gaugcugccc 240 agaagacaga uacaucccac caugaucagg aucacccaac cuucaacaag aucaccccca 300 accuggcuga guucgccuuc agccuauacc gccagcuggc acaccagucc aacagcacca 360 auaucuucuu cuccccagug agcaucgcua cagccuuugc aaugcucucc cuggggacca 420 aggcugacac ucacgaugaa auccuggagg gccugaauuu caaccucacg gagauuccgg 480 aggcucagau ccaugaaggc uuccaggaac uccuccguac ccucaaccag ccagacagcc 540 agcuccagcu gaccaccggc aauggccugu uccucagcga gggccugaag cuaguggaua 600 aguuuuugga ggauguuaaa aaguuguacc acucagaagc cuucacuguc aacuucgggg 660 acaccgaaga ggccaagaaa cagaucaacg auuacgugga gaaggguacu caagggaaaa 720 uuguggauuu ggucaaggag cuugacagag acacaguuuu ugcucuggug aauuacaucu 780 ucuuuaaagg caaaugggag agacccuuug aagucaagga caccgaggaa gaggacuucc 840 acguggacca ggugaccacc gugaaggugc cuaugaugaa gcguuuaggc auguuuaaca 900 uccagcacug uaagaagcug uccagcuggg ugcugcugau gaaauaccug ggcaaugcca 960

```
ccgccaucuu cuuccugccu gaugagggga aacuacagca ccuggaaaau gaacucaccc   1020

acgauaucau caccaaguuc cuggaaaaug aagacagaag gucugccagc uuacauuuac   1080

ccaaacuguc cauuacugga accuaugauc ugaagagcgu ccugggucaa cugggcauca   1140

cuaaggucuu cagcaauggg gcugaccucu ccggggucac agaggaggca ccccugaagc   1200

ucuccaaggc cgugcauaag gcugugcuga ccaucgacga gaaagggacu gaagcugcug   1260

gggccauguu uuuagaggcc auacccaugu cuauccccc cgaggucaag uucaacaaac   1320

ccuuugucuu cuuaaugauu gaacaaaaua ccaagucucc ccucuucaug ggaaaagugg   1380

ugaaucccac ccaaaaauaa cuagugacug acuaggaucu gguuaccacu aaaccagccu   1440

caagaacacc cgaauggagu cucuaagcua cauaauacca acuuacacuu acaaaauguu   1500

gucccccaaa auguagccau ucguaucugc uccuaauaaa aagaaaguuu cuucacauaa   1560

aaaaaaaaaa aaaaaaaaaa aaaaaaaaaa aaaaaaaaaa aaaaaaaaaa aaaaaaaa     1618
```

<210> SEQ ID NO 14
<211> LENGTH: 943
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<223> OTHER INFORMATION: 5' cap (m7GpppGm)
<220> FEATURE:
<221> NAME/KEY: modified_base
<222> LOCATION: (938)..(939)
<223> OTHER INFORMATION: UNA monomer

<400> SEQUENCE: 14

```
gggaaacaua agucaacaca acauauacaa aacaaacgaa ucucaagcaa ucaagcauuc     60

uacuucuauu gcagcaauuu aaaucauuuc uuuuaaagca aaagcaauuu ucugaaaauu    120

uucaccauuu acgaacgaua gccaugggg ugcacgaaug uccugccugg cuguggcuuc    180

uccuguccu gcugucgcuc ccucugggcc ucccaguccu gggcgcccca ccacgccuca    240

ucugugacag ccgaguccug gagagguacc ucuuggaggc caaggaggcc gagaauauca    300

cgacgggcug ugcugaacac ugcagcuuga augagaauau cacuguccca gacaccaaag    360

uuaauuucua ugccuggaag aggauggagg ucgggcagca ggccguagaa gucuggcagg    420

gccuggcccu gcugucggaa gcuguccugc ggggccaggc ccuguugguc aacucuuccc    480

agccguggga gccccugcag cugcaugugg auaaagccgu caguggccuu cgcagccuca    540

ccacucugcu ucgggcucug ggagcccaga aggaagccau cuccccucca gaugcggccu    600

cagcugcucc acuccgaaca aucacugcug acacuuuccg caaacucuuc cgagucuacu    660

ccaauuuccu ccggggaaag cugaagcugu acacagggga ggccugcagg acaggggaca    720

gaugacuagu gacugacuag gaucugguua ccacuaaacc agccucaaga acacccgaau    780

ggagucucua agcuacauaa uaccaacuua cacuuacaaa auguuguccc ccaaaaugua    840

gccauucgua ucugcuccua auaaaaagaa aguuucuuca cauaaaaaaa aaaaaaaaaa    900

aaaaaaaaaa aaaaaaaaaa aaaaaaaaaa aaaaaaaaaa aaa                      943
```

<210> SEQ ID NO 15
<211> LENGTH: 1386
<212> TYPE: RNA
<213> ORGANISM: Artificial Sequence
<220> FEATURE:
<223> OTHER INFORMATION: Description of Artificial Sequence: Synthetic
polynucleotide <220> FEATURE:
<221> NAME/KEY: modified_base
<222> LOCATION: (3)..(3)
<223> OTHER INFORMATION: UNA monomer
<220> FEATURE:
<221> NAME/KEY: modified_base
<222> LOCATION: (33)..(33)
<223> OTHER INFORMATION: UNA monomer
<220> FEATURE:
<221> NAME/KEY: modified_base
<222> LOCATION: (63)..(63)
<223> OTHER INFORMATION: UNA monomer
<220> FEATURE:
<221> NAME/KEY: modified_base
<222> LOCATION: (93)..(93)
<223> OTHER INFORMATION: UNA monomer
<220> FEATURE:
<221> NAME/KEY: modified_base
<222> LOCATION: (123)..(123)
<223> OTHER INFORMATION: UNA monomer
<220> FEATURE:
<221> NAME/KEY: modified_base
<222> LOCATION: (153)..(153)
<223> OTHER INFORMATION: UNA monomer
<220> FEATURE:
<221> NAME/KEY: modified_base
<222> LOCATION: (183)..(183)
<223> OTHER INFORMATION: UNA monomer
<220> FEATURE:
<221> NAME/KEY: modified_base
<222> LOCATION: (213)..(213)
<223> OTHER INFORMATION: UNA monomer
<220> FEATURE:
<221> NAME/KEY: modified_base
<222> LOCATION: (243)..(243)
<223> OTHER INFORMATION: UNA monomer
<220> FEATURE:
<221> NAME/KEY: modified_base
<222> LOCATION: (273)..(273)
<223> OTHER INFORMATION: UNA monomer
<220> FEATURE:
<221> NAME/KEY: modified_base
<222> LOCATION: (303)..(303)
<223> OTHER INFORMATION: UNA monomer
<220> FEATURE:
<221> NAME/KEY: modified_base
<222> LOCATION: (333)..(333)
<223> OTHER INFORMATION: UNA monomer
<220> FEATURE:
<221> NAME/KEY: modified_base
<222> LOCATION: (363)..(363)
<223> OTHER INFORMATION: UNA monomer
<220> FEATURE:
<221> NAME/KEY: modified_base
<222> LOCATION: (393)..(393)
<223> OTHER INFORMATION: UNA monomer
<220> FEATURE:
<221> NAME/KEY: modified_base
<222> LOCATION: (423)..(423)
<223> OTHER INFORMATION: UNA monomer
<220> FEATURE:
<221> NAME/KEY: modified_base
<222> LOCATION: (453)..(453)
<223> OTHER INFORMATION: UNA monomer
<220> FEATURE:
<221> NAME/KEY: modified_base
<222> LOCATION: (483)..(483)
<223> OTHER INFORMATION: UNA monomer
<220> FEATURE:
<221> NAME/KEY: modified_base
<222> LOCATION: (513)..(513)
<223> OTHER INFORMATION: UNA monomer
<220> FEATURE:
<221> NAME/KEY: modified_base
<222> LOCATION: (543)..(543)
<223> OTHER INFORMATION: UNA monomer
<220> FEATURE:
<221> NAME/KEY: modified_base
<222> LOCATION: (573)..(573)

<223> OTHER INFORMATION: UNA monomer
<220> FEATURE:
<221> NAME/KEY: modified_base
<222> LOCATION: (603)..(603)
<223> OTHER INFORMATION: UNA monomer
<220> FEATURE:
<221> NAME/KEY: modified_base
<222> LOCATION: (633)..(633)
<223> OTHER INFORMATION: UNA monomer
<220> FEATURE:
<221> NAME/KEY: modified_base
<222> LOCATION: (663)..(663)
<223> OTHER INFORMATION: UNA monomer
<220> FEATURE:
<221> NAME/KEY: modified_base
<222> LOCATION: (693)..(693)
<223> OTHER INFORMATION: UNA monomer
<220> FEATURE:
<221> NAME/KEY: modified_base
<222> LOCATION: (723)..(723)
<223> OTHER INFORMATION: UNA monomer
<220> FEATURE:
<221> NAME/KEY: modified_base
<222> LOCATION: (753)..(753)
<223> OTHER INFORMATION: UNA monomer
<220> FEATURE:
<221> NAME/KEY: modified_base
<222> LOCATION: (783)..(783)
<223> OTHER INFORMATION: UNA monomer
<220> FEATURE:
<221> NAME/KEY: modified_base
<222> LOCATION: (813)..(813)
<223> OTHER INFORMATION: UNA monomer
<220> FEATURE:
<221> NAME/KEY: modified_base
<222> LOCATION: (843)..(843)
<223> OTHER INFORMATION: UNA monomer
<220> FEATURE:
<221> NAME/KEY: modified_base
<222> LOCATION: (873)..(873)
<223> OTHER INFORMATION: UNA monomer
<220> FEATURE:
<221> NAME/KEY: modified_base
<222> LOCATION: (903)..(903)
<223> OTHER INFORMATION: UNA monomer
<220> FEATURE:
<221> NAME/KEY: modified_base
<222> LOCATION: (933)..(933)
<223> OTHER INFORMATION: UNA monomer
<220> FEATURE:
<221> NAME/KEY: modified_base
<222> LOCATION: (963)..(963)
<223> OTHER INFORMATION: UNA monomer
<220> FEATURE:
<221> NAME/KEY: modified_base
<222> LOCATION: (993)..(993)
<223> OTHER INFORMATION: UNA monomer
<220> FEATURE:
<221> NAME/KEY: modified_base
<222> LOCATION: (1023)..(1023)
<223> OTHER INFORMATION: UNA monomer
<220> FEATURE:
<221> NAME/KEY: modified_base
<222> LOCATION: (1053)..(1053)
<223> OTHER INFORMATION: UNA monomer
<220> FEATURE:
<221> NAME/KEY: modified_base
<222> LOCATION: (1083)..(1083)
<223> OTHER INFORMATION: UNA monomer
<220> FEATURE:
<221> NAME/KEY: modified_base
<222> LOCATION: (1113)..(1113)
<223> OTHER INFORMATION: UNA monomer
<220> FEATURE:
<221> NAME/KEY: modified_base
<222> LOCATION: (1143)..(1143)
<223> OTHER INFORMATION: UNA monomer
<220> FEATURE:
<221> NAME/KEY: modified_base <222> LOCATION: (1173)..(1173)
<223> OTHER INFORMATION: UNA monomer
<220> FEATURE:
<221> NAME/KEY: modified_base
<222> LOCATION: (1203)..(1203)
<223> OTHER INFORMATION: UNA monomer
<220> FEATURE:
<221> NAME/KEY: modified_base
<222> LOCATION: (1233)..(1233)
<223> OTHER INFORMATION: UNA monomer
<220> FEATURE:
<221> NAME/KEY: modified_base
<222> LOCATION: (1263)..(1263)
<223> OTHER INFORMATION: UNA monomer
<220> FEATURE:
<221> NAME/KEY: modified_base
<222> LOCATION: (1293)..(1293)
<223> OTHER INFORMATION: UNA monomer
<220> FEATURE:
<221> NAME/KEY: modified_base
<222> LOCATION: (1323)..(1323)
<223> OTHER INFORMATION: UNA monomer
<220> FEATURE:
<221> NAME/KEY: modified_base
<222> LOCATION: (1353)..(1353)
<223> OTHER INFORMATION: UNA monomer
<220> FEATURE:
<221> NAME/KEY: modified_base
<222> LOCATION: (1383)..(1383)
<223> OTHER INFORMATION: UNA monomer

<400> SEQUENCE: 15 augcagcgcg ugaacaugau cauggcagaa ucaccaggcc ucaucaccau cugccuuuua 60 ggauaucuac ucagugcuga auguacaguu uuucuugauc augaaaacgc caacaaaauu 120 cugaaucggc caaagaggua uaauucaggu aaauuggaag aguuuguuca agggaaccuu 180 gagagagaau guauggaaga aaaguguagu uuugaagaag cacgagaagu uuuugaaaac 240 acugaaagaa caacugaauu uuggaagcag uauguugaug gagaucagug ugaguccaau 300 ccauguuuaa auggcggcag uugcaaggau gacauuaauu ccuaugaaug uuggugucccc 360 uuuggauuug aaggaaagaa cugugaauua gauguaacau guaacauuaa gaauggcaga 420 ugcgagcagu uuuguaaaaa uagugcugau aacaaggugg uuugcuccug uacugaggga 480 uaucgacuug cagaaaacca gaaguccugu gaaccagcag ugccauuucc auguggaaga 540 guuucuguuu cacaaacuuc uaagcucacc cgugcugaga cuguuuuucc ugauguggac 600 uauguaaauu cuacugaagc ugaaaccauu uuggauaaca ucacucaaag cacccaauca 660 uuuaaugacu ucacucgggu uguuggugga gaagaugcca aaccagguca auucccuugg 720 cagguuguuu ugaaugguaa aguugaugca uucuguggag gcucuaucgu uaaugaaaaa 780 uggauuguaa cugcugccca cuguguugaa acuggguuua aaauuacagu ugucgcaggu 840 gaacauaaua uugaggagac agaacauaca gagcaaaagc gaaaugugau ucgaauuauu 900 ccucaccaca acuacaaugc agcuauuaau aaguacaacc augacauugc ccuucuggaa 960 cuggacgaac ccuuagugcu aaacagcuac guuacaccua uuugcauugc ugacaaggaa 1020 uacacgaaca ucuuccucaa auuuggaucu ggcuauguaa guggcugggg aagagucuuc 1080 cacaaaggga gaucagcuuu aguucuucag uaccuuagag uuccacuugu ugaccgagcc 1140 acaugucuuc gaucuacaaa guucaccauc uauaacaaca uguucugugc uggcuuccau 1200 gaaggaggua gagauucaug ucaaggagau aguggggac cccauguuac ugaaguggaa 1260 gggaccaguu ucuuaacugg aauuauuagc uggggugaag agugugcaau gaaaggcaaa 1320 uauggaauau auaccaaggu aucccgguau gucaacugga uuaaggaaaa aacaaagcuc 1380 acuuaa 1386

<210> SEQ ID NO 16
<211> LENGTH: 1386
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (1383)..(1385)
<223> OTHER INFORMATION: UNA monomer

<400> SEQUENCE: 16 augcagcgcg ugaacaugau cauggcagaa ucaccaggcc ucaucaccau cugccuuuua 60 ggauaucuac ucagugcuga auguacaguu uuucuugauc augaaaacgc caacaaaauu 120 cugaaucggc caaagaggua uaauucaggu aaauuggaag aguuuguuca agggaaccuu 180 gagagagaau guauggaaga aaaguguagu uuugaagaag cacgagaagu uuuugaaaac 240 acugaaagaa caacugaauu uuggaagcag uauguugaug gagaucagug ugaguccaau 300 ccauguuuaa auggcggcag uugcaaggau gacauuaauu ccuaugaaug uuggugucccc 360 uuuggauuug aaggaaagaa cugugaauua gauguaacau guaacauuaa gaauggcaga 420 ugcgagcagu uuuguaaaaa uagugcugau aacaaggugg uuugcuccug uacugaggga 480 uaucgacuug cagaaaacca gaaguccugu gaaccagcag ugccauuucc auguggaaga 540 guuucuguuu cacaaacuuc uaagcucacc cgugcugaga cuguuuuucc ugauguggac 600 uauguaaauu cuacugaagc ugaaaccauu uuggauaaca ucacucaaag cacccaauca 660 uuuaaugacu ucacucgggu uguuggugga gaagaugcca aaccagguca auucccuugg 720 cagguuguuu ugaaugguaa aguugaugca uucuguggag gcucuaucgu uaaugaaaaa 780 uggauuguaa cugcugccca cuguguugaa acuggguuua aaauuacagu ugucgcaggu 840 gaacauaaua uugaggagac agaacauaca gagcaaaagc gaaaugugau ucgaauuauu 900 ccucaccaca acuacaaugc agcuauuaau aaguacaacc augacauugc ccuucuggaa 960 cuggacgaac ccuuagugcu aaacagcuac guuacaccua uuugcauugc ugacaaggaa 1020 uacacgaaca ucuuccucaa auuuggaucu ggcuauguaa guggcugggg aagagucuuc 1080 cacaaaggga gaucagcuuu aguucuucag uaccuuagag uuccacuugu ugaccgagcc 1140 acaugucuuc gaucuacaaa guucaccauc uauaacaaca uguucugugc uggcuuccau 1200 gaaggaggua gagauucaug ucaaggagau aguggggac cccauguuac ugaaguggaa 1260 gggaccaguu ucuuaacugg aauuauuagc uggggugaag agugugcaau gaaaggcaaa 1320 uauggaauau auaccaaggu aucccgguau gucaacugga uuaaggaaaa aacaaagcuc 1380 acuuaa 1386

<210> SEQ ID NO 17
<211> LENGTH: 1386
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base <222> LOCATION: (2)..(2)
<223> OTHER INFORMATION: UNA monomer
<220> FEATURE:
<221> NAME/KEY: modified_base
<222> LOCATION: (11)..(11)
<223> OTHER INFORMATION: UNA monomer
<220> FEATURE:
<221> NAME/KEY: modified_base
<222> LOCATION: (17)..(17)
<223> OTHER INFORMATION: UNA monomer
<220> FEATURE:
<221> NAME/KEY: modified_base
<222> LOCATION: (20)..(20)
<223> OTHER INFORMATION: UNA monomer
<220> FEATURE:
<221> NAME/KEY: modified_base
<222> LOCATION: (23)..(23)
<223> OTHER INFORMATION: UNA monomer
<220> FEATURE:
<221> NAME/KEY: modified_base
<222> LOCATION: (31)..(31)
<223> OTHER INFORMATION: UNA monomer
<220> FEATURE:
<221> NAME/KEY: modified_base
<222> LOCATION: (41)..(41)
<223> OTHER INFORMATION: UNA monomer
<220> FEATURE:
<221> NAME/KEY: modified_base
<222> LOCATION: (44)..(44)
<223> OTHER INFORMATION: UNA monomer
<220> FEATURE:
<221> NAME/KEY: modified_base
<222> LOCATION: (50)..(50)
<223> OTHER INFORMATION: UNA monomer
<220> FEATURE:
<221> NAME/KEY: modified_base
<222> LOCATION: (52)..(52)
<223> OTHER INFORMATION: UNA monomer
<220> FEATURE:
<221> NAME/KEY: modified_base
<222> LOCATION: (56)..(59)
<223> OTHER INFORMATION: UNA monomer
<220> FEATURE:
<221> NAME/KEY: modified_base
<222> LOCATION: (64)..(64)
<223> OTHER INFORMATION: UNA monomer
<220> FEATURE:
<221> NAME/KEY: modified_base
<222> LOCATION: (66)..(66)
<223> OTHER INFORMATION: UNA monomer
<220> FEATURE:
<221> NAME/KEY: modified_base
<222> LOCATION: (68)..(68)
<223> OTHER INFORMATION: UNA monomer
<220> FEATURE:
<221> NAME/KEY: modified_base
<222> LOCATION: (71)..(71)
<223> OTHER INFORMATION: UNA monomer
<220> FEATURE:
<221> NAME/KEY: modified_base
<222> LOCATION: (75)..(75)
<223> OTHER INFORMATION: UNA monomer
<220> FEATURE:
<221> NAME/KEY: modified_base
<222> LOCATION: (78)..(78)
<223> OTHER INFORMATION: UNA monomer
<220> FEATURE:
<221> NAME/KEY: modified_base
<222> LOCATION: (82)..(82)
<223> OTHER INFORMATION: UNA monomer
<220> FEATURE:
<221> NAME/KEY: modified_base
<222> LOCATION: (84)..(84)
<223> OTHER INFORMATION: UNA monomer
<220> FEATURE:
<221> NAME/KEY: modified_base
<222> LOCATION: (89)..(93)
<223> OTHER INFORMATION: UNA monomer
<220> FEATURE:

<221> NAME/KEY: modified_base
<222> LOCATION: (95)..(96)
<223> OTHER INFORMATION: UNA monomer
<220> FEATURE:
<221> NAME/KEY: modified_base
<222> LOCATION: (99)..(99)
<223> OTHER INFORMATION: UNA monomer
<220> FEATURE:
<221> NAME/KEY: modified_base
<222> LOCATION: (102)..(102)
<223> OTHER INFORMATION: UNA monomer
<220> FEATURE:
<221> NAME/KEY: modified_base
<222> LOCATION: (119)..(120)
<223> OTHER INFORMATION: UNA monomer
<220> FEATURE:
<221> NAME/KEY: modified_base
<222> LOCATION: (122)..(122)
<223> OTHER INFORMATION: UNA monomer
<220> FEATURE:
<221> NAME/KEY: modified_base
<222> LOCATION: (126)..(126)
<223> OTHER INFORMATION: UNA monomer
<220> FEATURE:
<221> NAME/KEY: modified_base
<222> LOCATION: (139)..(139)
<223> OTHER INFORMATION: UNA monomer
<220> FEATURE:
<221> NAME/KEY: modified_base
<222> LOCATION: (141)..(141)
<223> OTHER INFORMATION: UNA monomer
<220> FEATURE:
<221> NAME/KEY: modified_base
<222> LOCATION: (144)..(145)
<223> OTHER INFORMATION: UNA monomer
<220> FEATURE:
<221> NAME/KEY: modified_base
<222> LOCATION: (150)..(150)
<223> OTHER INFORMATION: UNA monomer
<220> FEATURE:
<221> NAME/KEY: modified_base
<222> LOCATION: (154)..(155)
<223> OTHER INFORMATION: UNA monomer
<220> FEATURE:
<221> NAME/KEY: modified_base
<222> LOCATION: (163)..(165)
<223> OTHER INFORMATION: UNA monomer
<220> FEATURE:
<221> NAME/KEY: modified_base
<222> LOCATION: (167)..(168)
<223> OTHER INFORMATION: UNA monomer
<220> FEATURE:
<221> NAME/KEY: modified_base
<222> LOCATION: (179)..(180)
<223> OTHER INFORMATION: UNA monomer
<220> FEATURE:
<221> NAME/KEY: modified_base
<222> LOCATION: (190)..(190)
<223> OTHER INFORMATION: UNA monomer
<220> FEATURE:
<221> NAME/KEY: modified_base
<222> LOCATION: (192)..(192)
<223> OTHER INFORMATION: UNA monomer
<220> FEATURE:
<221> NAME/KEY: modified_base
<222> LOCATION: (194)..(194)
<223> OTHER INFORMATION: UNA monomer
<220> FEATURE:
<221> NAME/KEY: modified_base
<222> LOCATION: (205)..(205)
<223> OTHER INFORMATION: UNA monomer
<220> FEATURE:
<221> NAME/KEY: modified_base
<222> LOCATION: (207)..(207)
<223> OTHER INFORMATION: UNA monomer
<220> FEATURE:
<221> NAME/KEY: modified_base
<222> LOCATION: (210)..(213)
<223> OTHER INFORMATION: UNA monomer <220> FEATURE:
<221> NAME/KEY: modified_base
<222> LOCATION: (230)..(234)
<223> OTHER INFORMATION: UNA monomer
<220> FEATURE:
<221> NAME/KEY: modified_base
<222> LOCATION: (243)..(243)
<223> OTHER INFORMATION: UNA monomer
<220> FEATURE:
<221> NAME/KEY: modified_base
<222> LOCATION: (255)..(255)
<223> OTHER INFORMATION: UNA monomer
<220> FEATURE:
<221> NAME/KEY: modified_base
<222> LOCATION: (259)..(262)
<223> OTHER INFORMATION: UNA monomer
<220> FEATURE:
<221> NAME/KEY: modified_base
<222> LOCATION: (271)..(271)
<223> OTHER INFORMATION: UNA monomer
<220> FEATURE:
<221> NAME/KEY: modified_base
<222> LOCATION: (273)..(273)
<223> OTHER INFORMATION: UNA monomer
<220> FEATURE:
<221> NAME/KEY: modified_base
<222> LOCATION: (275)..(276)
<223> OTHER INFORMATION: UNA monomer
<220> FEATURE:
<221> NAME/KEY: modified_base
<222> LOCATION: (279)..(279)
<223> OTHER INFORMATION: UNA monomer
<220> FEATURE:
<221> NAME/KEY: modified_base
<222> LOCATION: (285)..(285)
<223> OTHER INFORMATION: UNA monomer
<220> FEATURE:
<221> NAME/KEY: modified_base
<222> LOCATION: (289)..(289)
<223> OTHER INFORMATION: UNA monomer
<220> FEATURE:
<221> NAME/KEY: modified_base
<222> LOCATION: (291)..(291)
<223> OTHER INFORMATION: UNA monomer
<220> FEATURE:
<221> NAME/KEY: modified_base
<222> LOCATION: (295)..(295)
<223> OTHER INFORMATION: UNA monomer
<220> FEATURE:
<221> NAME/KEY: modified_base
<222> LOCATION: (300)..(300)
<223> OTHER INFORMATION: UNA monomer
<220> FEATURE:
<221> NAME/KEY: modified_base
<222> LOCATION: (304)..(304)
<223> OTHER INFORMATION: UNA monomer
<220> FEATURE:
<221> NAME/KEY: modified_base
<222> LOCATION: (306)..(308)
<223> OTHER INFORMATION: UNA monomer
<220> FEATURE:
<221> NAME/KEY: modified_base
<222> LOCATION: (312)..(312)
<223> OTHER INFORMATION: UNA monomer
<220> FEATURE:
<221> NAME/KEY: modified_base
<222> LOCATION: (321)..(322)
<223> OTHER INFORMATION: UNA monomer
<220> FEATURE:
<221> NAME/KEY: modified_base
<222> LOCATION: (330)..(330)
<223> OTHER INFORMATION: UNA monomer
<220> FEATURE:
<221> NAME/KEY: modified_base
<222> LOCATION: (335)..(336)
<223> OTHER INFORMATION: UNA monomer
<220> FEATURE:
<221> NAME/KEY: modified_base
<222> LOCATION: (339)..(340)

<223> OTHER INFORMATION: UNA monomer
<220> FEATURE:
<221> NAME/KEY: modified_base
<222> LOCATION: (343)..(343)
<223> OTHER INFORMATION: UNA monomer
<220> FEATURE:
<221> NAME/KEY: modified_base
<222> LOCATION: (345)..(345)
<223> OTHER INFORMATION: UNA monomer
<220> FEATURE:
<221> NAME/KEY: modified_base
<222> LOCATION: (349)..(349)
<223> OTHER INFORMATION: UNA monomer
<220> FEATURE:
<221> NAME/KEY: modified_base
<222> LOCATION: (351)..(352)
<223> OTHER INFORMATION: UNA monomer
<220> FEATURE:
<221> NAME/KEY: modified_base
<222> LOCATION: (355)..(355)
<223> OTHER INFORMATION: UNA monomer
<220> FEATURE:
<221> NAME/KEY: modified_base
<222> LOCATION: (357)..(357)
<223> OTHER INFORMATION: UNA monomer
<220> FEATURE:
<221> NAME/KEY: modified_base
<222> LOCATION: (361)..(363)
<223> OTHER INFORMATION: UNA monomer
<220> FEATURE:
<221> NAME/KEY: modified_base
<222> LOCATION: (367)..(369)
<223> OTHER INFORMATION: UNA monomer
<220> FEATURE:
<221> NAME/KEY: modified_base
<222> LOCATION: (382)..(382)
<223> OTHER INFORMATION: UNA monomer
<220> FEATURE:
<221> NAME/KEY: modified_base
<222> LOCATION: (384)..(384)
<223> OTHER INFORMATION: UNA monomer
<220> FEATURE:
<221> NAME/KEY: modified_base
<222> LOCATION: (388)..(389)
<223> OTHER INFORMATION: UNA monomer
<220> FEATURE:
<221> NAME/KEY: modified_base
<222> LOCATION: (393)..(393)
<223> OTHER INFORMATION: UNA monomer
<220> FEATURE:
<221> NAME/KEY: modified_base
<222> LOCATION: (395)..(395)
<223> OTHER INFORMATION: UNA monomer
<220> FEATURE:
<221> NAME/KEY: modified_base
<222> LOCATION: (400)..(400)
<223> OTHER INFORMATION: UNA monomer
<220> FEATURE:
<221> NAME/KEY: modified_base
<222> LOCATION: (402)..(402)
<223> OTHER INFORMATION: UNA monomer
<220> FEATURE:
<221> NAME/KEY: modified_base
<222> LOCATION: (407)..(408)
<223> OTHER INFORMATION: UNA monomer
<220> FEATURE:
<221> NAME/KEY: modified_base
<222> LOCATION: (414)..(414)
<223> OTHER INFORMATION: UNA monomer
<220> FEATURE:
<221> NAME/KEY: modified_base
<222> LOCATION: (421)..(421)
<223> OTHER INFORMATION: UNA monomer
<220> FEATURE:
<221> NAME/KEY: modified_base
<222> LOCATION: (430)..(433)
<223> OTHER INFORMATION: UNA monomer
<220> FEATURE:
<221> NAME/KEY: modified_base <222> LOCATION: (435)..(435)
<223> OTHER INFORMATION: UNA monomer
<220> FEATURE:
<221> NAME/KEY: modified_base
<222> LOCATION: (441)..(441)
<223> OTHER INFORMATION: UNA monomer
<220> FEATURE:
<221> NAME/KEY: modified_base
<222> LOCATION: (444)..(444)
<223> OTHER INFORMATION: UNA monomer
<220> FEATURE:
<221> NAME/KEY: modified_base
<222> LOCATION: (447)..(447)
<223> OTHER INFORMATION: UNA monomer
<220> FEATURE:
<221> NAME/KEY: modified_base
<222> LOCATION: (450)..(450)
<223> OTHER INFORMATION: UNA monomer
<220> FEATURE:
<221> NAME/KEY: modified_base
<222> LOCATION: (458)..(458)
<223> OTHER INFORMATION: UNA monomer
<220> FEATURE:
<221> NAME/KEY: modified_base
<222> LOCATION: (461)..(463)
<223> OTHER INFORMATION: UNA monomer
<220> FEATURE:
<221> NAME/KEY: modified_base
<222> LOCATION: (466)..(466)
<223> OTHER INFORMATION: UNA monomer
<220> FEATURE:
<221> NAME/KEY: modified_base
<222> LOCATION: (469)..(469)
<223> OTHER INFORMATION: UNA monomer
<220> FEATURE:
<221> NAME/KEY: modified_base
<222> LOCATION: (471)..(471)
<223> OTHER INFORMATION: UNA monomer
<220> FEATURE:
<221> NAME/KEY: modified_base
<222> LOCATION: (474)..(474)
<223> OTHER INFORMATION: UNA monomer
<220> FEATURE:
<221> NAME/KEY: modified_base
<222> LOCATION: (481)..(481)
<223> OTHER INFORMATION: UNA monomer
<220> FEATURE:
<221> NAME/KEY: modified_base
<222> LOCATION: (483)..(483)
<223> OTHER INFORMATION: UNA monomer
<220> FEATURE:
<221> NAME/KEY: modified_base
<222> LOCATION: (488)..(489)
<223> OTHER INFORMATION: UNA monomer
<220> FEATURE:
<221> NAME/KEY: modified_base
<222> LOCATION: (505)..(505)
<223> OTHER INFORMATION: UNA monomer
<220> FEATURE:
<221> NAME/KEY: modified_base
<222> LOCATION: (508)..(508)
<223> OTHER INFORMATION: UNA monomer
<220> FEATURE:
<221> NAME/KEY: modified_base
<222> LOCATION: (510)..(510)
<223> OTHER INFORMATION: UNA monomer
<220> FEATURE:
<221> NAME/KEY: modified_base
<222> LOCATION: (521)..(521)
<223> OTHER INFORMATION: UNA monomer
<220> FEATURE:
<221> NAME/KEY: modified_base
<222> LOCATION: (526)..(528)
<223> OTHER INFORMATION: UNA monomer
<220> FEATURE:
<221> NAME/KEY: modified_base
<222> LOCATION: (532)..(532)
<223> OTHER INFORMATION: UNA monomer
<220> FEATURE:

<221> NAME/KEY: modified_base
<222> LOCATION: (534)..(534)
<223> OTHER INFORMATION: UNA monomer
<220> FEATURE:
<221> NAME/KEY: modified_base
<222> LOCATION: (542)..(544)
<223> OTHER INFORMATION: UNA monomer
<220> FEATURE:
<221> NAME/KEY: modified_base
<222> LOCATION: (546)..(546)
<223> OTHER INFORMATION: UNA monomer
<220> FEATURE:
<221> NAME/KEY: modified_base
<222> LOCATION: (548)..(550)
<223> OTHER INFORMATION: UNA monomer
<220> FEATURE:
<221> NAME/KEY: modified_base
<222> LOCATION: (558)..(559)
<223> OTHER INFORMATION: UNA monomer
<220> FEATURE:
<221> NAME/KEY: modified_base
<222> LOCATION: (561)..(561)
<223> OTHER INFORMATION: UNA monomer
<220> FEATURE:
<221> NAME/KEY: modified_base
<222> LOCATION: (566)..(566)
<223> OTHER INFORMATION: UNA monomer
<220> FEATURE:
<221> NAME/KEY: modified_base
<222> LOCATION: (573)..(573)
<223> OTHER INFORMATION: UNA monomer
<220> FEATURE:
<221> NAME/KEY: modified_base
<222> LOCATION: (576)..(576)
<223> OTHER INFORMATION: UNA monomer
<220> FEATURE:
<221> NAME/KEY: modified_base
<222> LOCATION: (582)..(582)
<223> OTHER INFORMATION: UNA monomer
<220> FEATURE:
<221> NAME/KEY: modified_base
<222> LOCATION: (584)..(588)
<223> OTHER INFORMATION: UNA monomer
<220> FEATURE:
<221> NAME/KEY: modified_base
<222> LOCATION: (591)..(591)
<223> OTHER INFORMATION: UNA monomer
<220> FEATURE:
<221> NAME/KEY: modified_base
<222> LOCATION: (594)..(594)
<223> OTHER INFORMATION: UNA monomer
<220> FEATURE:
<221> NAME/KEY: modified_base
<222> LOCATION: (596)..(596)
<223> OTHER INFORMATION: UNA monomer
<220> FEATURE:
<221> NAME/KEY: modified_base
<222> LOCATION: (601)..(601)
<223> OTHER INFORMATION: UNA monomer
<220> FEATURE:
<221> NAME/KEY: modified_base
<222> LOCATION: (603)..(603)
<223> OTHER INFORMATION: UNA monomer
<220> FEATURE:
<221> NAME/KEY: modified_base
<222> LOCATION: (605)..(605)
<223> OTHER INFORMATION: UNA monomer
<220> FEATURE:
<221> NAME/KEY: modified_base
<222> LOCATION: (609)..(610)
<223> OTHER INFORMATION: UNA monomer
<220> FEATURE:
<221> NAME/KEY: modified_base
<222> LOCATION: (612)..(612)
<223> OTHER INFORMATION: UNA monomer
<220> FEATURE:
<221> NAME/KEY: modified_base
<222> LOCATION: (615)..(615)
<223> OTHER INFORMATION: UNA monomer <220> FEATURE:
<221> NAME/KEY: modified_base
<222> LOCATION: (621)..(621)
<223> OTHER INFORMATION: UNA monomer
<220> FEATURE:
<221> NAME/KEY: modified_base
<222> LOCATION: (629)..(632)
<223> OTHER INFORMATION: UNA monomer
<220> FEATURE:
<221> NAME/KEY: modified_base
<222> LOCATION: (636)..(636)
<223> OTHER INFORMATION: UNA monomer
<220> FEATURE:
<221> NAME/KEY: modified_base
<222> LOCATION: (641)..(641)
<223> OTHER INFORMATION: UNA monomer
<220> FEATURE:
<221> NAME/KEY: modified_base
<222> LOCATION: (645)..(645)
<223> OTHER INFORMATION: UNA monomer
<220> FEATURE:
<221> NAME/KEY: modified_base
<222> LOCATION: (658)..(658)
<223> OTHER INFORMATION: UNA monomer
<220> FEATURE:
<221> NAME/KEY: modified_base
<222> LOCATION: (661)..(663)
<223> OTHER INFORMATION: UNA monomer
<220> FEATURE:
<221> NAME/KEY: modified_base
<222> LOCATION: (666)..(666)
<223> OTHER INFORMATION: UNA monomer
<220> FEATURE:
<221> NAME/KEY: modified_base
<222> LOCATION: (670)..(671)
<223> OTHER INFORMATION: UNA monomer
<220> FEATURE:
<221> NAME/KEY: modified_base
<222> LOCATION: (675)..(675)
<223> OTHER INFORMATION: UNA monomer
<220> FEATURE:
<221> NAME/KEY: modified_base
<222> LOCATION: (680)..(681)
<223> OTHER INFORMATION: UNA monomer
<220> FEATURE:
<221> NAME/KEY: modified_base
<222> LOCATION: (683)..(684)
<223> OTHER INFORMATION: UNA monomer
<220> FEATURE:
<221> NAME/KEY: modified_base
<222> LOCATION: (687)..(687)
<223> OTHER INFORMATION: UNA monomer
<220> FEATURE:
<221> NAME/KEY: modified_base
<222> LOCATION: (696)..(696)
<223> OTHER INFORMATION: UNA monomer
<220> FEATURE:
<221> NAME/KEY: modified_base
<222> LOCATION: (708)..(708)
<223> OTHER INFORMATION: UNA monomer
<220> FEATURE:
<221> NAME/KEY: modified_base
<222> LOCATION: (712)..(713)
<223> OTHER INFORMATION: UNA monomer
<220> FEATURE:
<221> NAME/KEY: modified_base
<222> LOCATION: (717)..(718)
<223> OTHER INFORMATION: UNA monomer
<220> FEATURE:
<221> NAME/KEY: modified_base
<222> LOCATION: (725)..(726)
<223> OTHER INFORMATION: UNA monomer
<220> FEATURE:
<221> NAME/KEY: modified_base
<222> LOCATION: (728)..(731)
<223> OTHER INFORMATION: UNA monomer
<220> FEATURE:
<221> NAME/KEY: modified_base
<222> LOCATION: (735)..(735)

<223> OTHER INFORMATION: UNA monomer
<220> FEATURE:
<221> NAME/KEY: modified_base
<222> LOCATION: (738)..(738)
<223> OTHER INFORMATION: UNA monomer
<220> FEATURE:
<221> NAME/KEY: modified_base
<222> LOCATION: (743)..(744)
<223> OTHER INFORMATION: UNA monomer
<220> FEATURE:
<221> NAME/KEY: modified_base
<222> LOCATION: (747)..(747)
<223> OTHER INFORMATION: UNA monomer
<220> FEATURE:
<221> NAME/KEY: modified_base
<222> LOCATION: (751)..(752)
<223> OTHER INFORMATION: UNA monomer
<220> FEATURE:
<221> NAME/KEY: modified_base
<222> LOCATION: (754)..(754)
<223> OTHER INFORMATION: UNA monomer
<220> FEATURE:
<221> NAME/KEY: modified_base
<222> LOCATION: (756)..(756)
<223> OTHER INFORMATION: UNA monomer
<220> FEATURE:
<221> NAME/KEY: modified_base
<222> LOCATION: (763)..(763)
<223> OTHER INFORMATION: UNA monomer
<220> FEATURE:
<221> NAME/KEY: modified_base
<222> LOCATION: (765)..(765)
<223> OTHER INFORMATION: UNA monomer
<220> FEATURE:
<221> NAME/KEY: modified_base
<222> LOCATION: (767)..(767)
<223> OTHER INFORMATION: UNA monomer
<220> FEATURE:
<221> NAME/KEY: modified_base
<222> LOCATION: (770)..(771)
<223> OTHER INFORMATION: UNA monomer
<220> FEATURE:
<221> NAME/KEY: modified_base
<222> LOCATION: (774)..(774)
<223> OTHER INFORMATION: UNA monomer
<220> FEATURE:
<221> NAME/KEY: modified_base
<222> LOCATION: (781)..(781)
<223> OTHER INFORMATION: UNA monomer
<220> FEATURE:
<221> NAME/KEY: modified_base
<222> LOCATION: (785)..(786)
<223> OTHER INFORMATION: UNA monomer
<220> FEATURE:
<221> NAME/KEY: modified_base
<222> LOCATION: (788)..(788)
<223> OTHER INFORMATION: UNA monomer
<220> FEATURE:
<221> NAME/KEY: modified_base
<222> LOCATION: (792)..(792)
<223> OTHER INFORMATION: UNA monomer
<220> FEATURE:
<221> NAME/KEY: modified_base
<222> LOCATION: (795)..(795)
<223> OTHER INFORMATION: UNA monomer
<220> FEATURE:
<221> NAME/KEY: modified_base
<222> LOCATION: (802)..(802)
<223> OTHER INFORMATION: UNA monomer
<220> FEATURE:
<221> NAME/KEY: modified_base
<222> LOCATION: (804)..(804)
<223> OTHER INFORMATION: UNA monomer
<220> FEATURE:
<221> NAME/KEY: modified_base
<222> LOCATION: (806)..(807)
<223> OTHER INFORMATION: UNA monomer
<220> FEATURE:
<221> NAME/KEY: modified_base <222> LOCATION: (813)..(813)
<223> OTHER INFORMATION: UNA monomer
<220> FEATURE:
<221> NAME/KEY: modified_base
<222> LOCATION: (816)..(816)
<223> OTHER INFORMATION: UNA monomer
<220> FEATURE:
<221> NAME/KEY: modified_base
<222> LOCATION: (818)..(819)
<223> OTHER INFORMATION: UNA monomer
<220> FEATURE:
<221> NAME/KEY: modified_base
<222> LOCATION: (824)..(825)
<223> OTHER INFORMATION: UNA monomer
<220> FEATURE:
<221> NAME/KEY: modified_base
<222> LOCATION: (830)..(831)
<223> OTHER INFORMATION: UNA monomer
<220> FEATURE:
<221> NAME/KEY: modified_base
<222> LOCATION: (833)..(833)
<223> OTHER INFORMATION: UNA monomer
<220> FEATURE:
<221> NAME/KEY: modified_base
<222> LOCATION: (840)..(840)
<223> OTHER INFORMATION: UNA monomer
<220> FEATURE:
<221> NAME/KEY: modified_base
<222> LOCATION: (846)..(846)
<223> OTHER INFORMATION: UNA monomer
<220> FEATURE:
<221> NAME/KEY: modified_base
<222> LOCATION: (849)..(849)
<223> OTHER INFORMATION: UNA monomer
<220> FEATURE:
<221> NAME/KEY: modified_base
<222> LOCATION: (851)..(852)
<223> OTHER INFORMATION: UNA monomer
<220> FEATURE:
<221> NAME/KEY: modified_base
<222> LOCATION: (867)..(867)
<223> OTHER INFORMATION: UNA monomer
<220> FEATURE:
<221> NAME/KEY: modified_base
<222> LOCATION: (885)..(885)
<223> OTHER INFORMATION: UNA monomer
<220> FEATURE:
<221> NAME/KEY: modified_base
<222> LOCATION: (887)..(887)
<223> OTHER INFORMATION: UNA monomer
<220> FEATURE:
<221> NAME/KEY: modified_base
<222> LOCATION: (890)..(891)
<223> OTHER INFORMATION: UNA monomer
<220> FEATURE:
<221> NAME/KEY: modified_base
<222> LOCATION: (896)..(897)
<223> OTHER INFORMATION: UNA monomer
<220> FEATURE:
<221> NAME/KEY: modified_base
<222> LOCATION: (899)..(900)
<223> OTHER INFORMATION: UNA monomer
<220> FEATURE:
<221> NAME/KEY: modified_base
<222> LOCATION: (903)..(903)
<223> OTHER INFORMATION: UNA monomer
<220> FEATURE:
<221> NAME/KEY: modified_base
<222> LOCATION: (913)..(913)
<223> OTHER INFORMATION: UNA monomer
<220> FEATURE:
<221> NAME/KEY: modified_base
<222> LOCATION: (918)..(918)
<223> OTHER INFORMATION: UNA monomer
<220> FEATURE:
<221> NAME/KEY: modified_base
<222> LOCATION: (924)..(924)
<223> OTHER INFORMATION: UNA monomer
<220> FEATURE:

<221> NAME/KEY: modified_base
<222> LOCATION: (926)..(927)
<223> OTHER INFORMATION: UNA monomer
<220> FEATURE:
<221> NAME/KEY: modified_base
<222> LOCATION: (930)..(930)
<223> OTHER INFORMATION: UNA monomer
<220> FEATURE:
<221> NAME/KEY: modified_base
<222> LOCATION: (934)..(934)
<223> OTHER INFORMATION: UNA monomer
<220> FEATURE:
<221> NAME/KEY: modified_base
<222> LOCATION: (942)..(942)
<223> OTHER INFORMATION: UNA monomer
<220> FEATURE:
<221> NAME/KEY: modified_base
<222> LOCATION: (947)..(948)
<223> OTHER INFORMATION: UNA monomer
<220> FEATURE:
<221> NAME/KEY: modified_base
<222> LOCATION: (953)..(954)
<223> OTHER INFORMATION: UNA monomer
<220> FEATURE:
<221> NAME/KEY: modified_base
<222> LOCATION: (956)..(956)
<223> OTHER INFORMATION: UNA monomer
<220> FEATURE:
<221> NAME/KEY: modified_base
<222> LOCATION: (962)..(962)
<223> OTHER INFORMATION: UNA monomer
<220> FEATURE:
<221> NAME/KEY: modified_base
<222> LOCATION: (973)..(974)
<223> OTHER INFORMATION: UNA monomer
<220> FEATURE:
<221> NAME/KEY: modified_base
<222> LOCATION: (977)..(977)
<223> OTHER INFORMATION: UNA monomer
<220> FEATURE:
<221> NAME/KEY: modified_base
<222> LOCATION: (980)..(980)
<223> OTHER INFORMATION: UNA monomer
<220> FEATURE:
<221> NAME/KEY: modified_base
<222> LOCATION: (988)..(988)
<223> OTHER INFORMATION: UNA monomer
<220> FEATURE:
<221> NAME/KEY: modified_base
<222> LOCATION: (992)..(993)
<223> OTHER INFORMATION: UNA monomer
<220> FEATURE:
<221> NAME/KEY: modified_base
<222> LOCATION: (999)..(999)
<223> OTHER INFORMATION: UNA monomer
<220> FEATURE:
<221> NAME/KEY: modified_base
<222> LOCATION: (1001)..(1003)
<223> OTHER INFORMATION: UNA monomer
<220> FEATURE:
<221> NAME/KEY: modified_base
<222> LOCATION: (1007)..(1008)
<223> OTHER INFORMATION: UNA monomer
<220> FEATURE:
<221> NAME/KEY: modified_base
<222> LOCATION: (1011)..(1011)
<223> OTHER INFORMATION: UNA monomer
<220> FEATURE:
<221> NAME/KEY: modified_base
<222> LOCATION: (1021)..(1021)
<223> OTHER INFORMATION: UNA monomer
<220> FEATURE:
<221> NAME/KEY: modified_base
<222> LOCATION: (1031)..(1031)
<223> OTHER INFORMATION: UNA monomer
<220> FEATURE:
<221> NAME/KEY: modified_base
<222> LOCATION: (1033)..(1034)
<223> OTHER INFORMATION: UNA monomer <220> FEATURE:
<221> NAME/KEY: modified_base
<222> LOCATION: (1037)..(1037)
<223> OTHER INFORMATION: UNA monomer
<220> FEATURE:
<221> NAME/KEY: modified_base
<222> LOCATION: (1042)..(1044)
<223> OTHER INFORMATION: UNA monomer
<220> FEATURE:
<221> NAME/KEY: modified_base
<222> LOCATION: (1048)..(1048)
<223> OTHER INFORMATION: UNA monomer
<220> FEATURE:
<221> NAME/KEY: modified_base
<222> LOCATION: (1050)..(1050)
<223> OTHER INFORMATION: UNA monomer
<220> FEATURE:
<221> NAME/KEY: modified_base
<222> LOCATION: (1054)..(1054)
<223> OTHER INFORMATION: UNA monomer
<220> FEATURE:
<221> NAME/KEY: modified_base
<222> LOCATION: (1056)..(1056)
<223> OTHER INFORMATION: UNA monomer
<220> FEATURE:
<221> NAME/KEY: modified_base
<222> LOCATION: (1058)..(1058)
<223> OTHER INFORMATION: UNA monomer
<220> FEATURE:
<221> NAME/KEY: modified_base
<222> LOCATION: (1062)..(1062)
<223> OTHER INFORMATION: UNA monomer
<220> FEATURE:
<221> NAME/KEY: modified_base
<222> LOCATION: (1066)..(1066)
<223> OTHER INFORMATION: UNA monomer
<220> FEATURE:
<221> NAME/KEY: modified_base
<222> LOCATION: (1076)..(1076)
<223> OTHER INFORMATION: UNA monomer
<220> FEATURE:
<221> NAME/KEY: modified_base
<222> LOCATION: (1078)..(1079)
<223> OTHER INFORMATION: UNA monomer
<220> FEATURE:
<221> NAME/KEY: modified_base
<222> LOCATION: (1093)..(1093)
<223> OTHER INFORMATION: UNA monomer
<220> FEATURE:
<221> NAME/KEY: modified_base
<222> LOCATION: (1098)..(1100)
<223> OTHER INFORMATION: UNA monomer
<220> FEATURE:
<221> NAME/KEY: modified_base
<222> LOCATION: (1103)..(1104)
<223> OTHER INFORMATION: UNA monomer
<220> FEATURE:
<221> NAME/KEY: modified_base
<222> LOCATION: (1106)..(1107)
<223> OTHER INFORMATION: UNA monomer
<220> FEATURE:
<221> NAME/KEY: modified_base
<222> LOCATION: (1111)..(1111)
<223> OTHER INFORMATION: UNA monomer
<220> FEATURE:
<221> NAME/KEY: modified_base
<222> LOCATION: (1115)..(1116)
<223> OTHER INFORMATION: UNA monomer
<220> FEATURE:
<221> NAME/KEY: modified_base
<222> LOCATION: (1121)..(1122)
<223> OTHER INFORMATION: UNA monomer
<220> FEATURE:
<221> NAME/KEY: modified_base
<222> LOCATION: (1127)..(1128)
<223> OTHER INFORMATION: UNA monomer
<220> FEATURE:
<221> NAME/KEY: modified_base
<222> LOCATION: (1130)..(1131)

<223> OTHER INFORMATION: UNA monomer
<220> FEATURE:
<221> NAME/KEY: modified_base
<222> LOCATION: (1144)..(1144)
<223> OTHER INFORMATION: UNA monomer
<220> FEATURE:
<221> NAME/KEY: modified_base
<222> LOCATION: (1146)..(1146)
<223> OTHER INFORMATION: UNA monomer
<220> FEATURE:
<221> NAME/KEY: modified_base
<222> LOCATION: (1148)..(1149)
<223> OTHER INFORMATION: UNA monomer
<220> FEATURE:
<221> NAME/KEY: modified_base
<222> LOCATION: (1153)..(1153)
<223> OTHER INFORMATION: UNA monomer
<220> FEATURE:
<221> NAME/KEY: modified_base
<222> LOCATION: (1155)..(1155)
<223> OTHER INFORMATION: UNA monomer
<220> FEATURE:
<221> NAME/KEY: modified_base
<222> LOCATION: (1162)..(1163)
<223> OTHER INFORMATION: UNA monomer
<220> FEATURE:
<221> NAME/KEY: modified_base
<222> LOCATION: (1169)..(1169)
<223> OTHER INFORMATION: UNA monomer
<220> FEATURE:
<221> NAME/KEY: modified_base
<222> LOCATION: (1171)..(1171)
<223> OTHER INFORMATION: UNA monomer
<220> FEATURE:
<221> NAME/KEY: modified_base
<222> LOCATION: (1173)..(1173)
<223> OTHER INFORMATION: UNA monomer
<220> FEATURE:
<221> NAME/KEY: modified_base
<222> LOCATION: (1181)..(1181)
<223> OTHER INFORMATION: UNA monomer
<220> FEATURE:
<221> NAME/KEY: modified_base
<222> LOCATION: (1183)..(1184)
<223> OTHER INFORMATION: UNA monomer
<220> FEATURE:
<221> NAME/KEY: modified_base
<222> LOCATION: (1186)..(1186)
<223> OTHER INFORMATION: UNA monomer
<220> FEATURE:
<221> NAME/KEY: modified_base
<222> LOCATION: (1188)..(1188)
<223> OTHER INFORMATION: UNA monomer
<220> FEATURE:
<221> NAME/KEY: modified_base
<222> LOCATION: (1191)..(1191)
<223> OTHER INFORMATION: UNA monomer
<220> FEATURE:
<221> NAME/KEY: modified_base
<222> LOCATION: (1195)..(1196)
<223> OTHER INFORMATION: UNA monomer
<220> FEATURE:
<221> NAME/KEY: modified_base
<222> LOCATION: (1200)..(1200)
<223> OTHER INFORMATION: UNA monomer
<220> FEATURE:
<221> NAME/KEY: modified_base
<222> LOCATION: (1209)..(1209)
<223> OTHER INFORMATION: UNA monomer
<220> FEATURE:
<221> NAME/KEY: modified_base
<222> LOCATION: (1215)..(1216)
<223> OTHER INFORMATION: UNA monomer
<220> FEATURE:
<221> NAME/KEY: modified_base
<222> LOCATION: (1219)..(1219)
<223> OTHER INFORMATION: UNA monomer
<220> FEATURE:
<221> NAME/KEY: modified_base <222> LOCATION: (1221)..(1221)
<223> OTHER INFORMATION: UNA monomer
<220> FEATURE:
<221> NAME/KEY: modified_base
<222> LOCATION: (1230)..(1230)
<223> OTHER INFORMATION: UNA monomer
<220> FEATURE:
<221> NAME/KEY: modified_base
<222> LOCATION: (1233)..(1233)
<223> OTHER INFORMATION: UNA monomer
<220> FEATURE:
<221> NAME/KEY: modified_base
<222> LOCATION: (1245)..(1245)
<223> OTHER INFORMATION: UNA monomer
<220> FEATURE:
<221> NAME/KEY: modified_base
<222> LOCATION: (1247)..(1248)
<223> OTHER INFORMATION: UNA monomer
<220> FEATURE:
<221> NAME/KEY: modified_base
<222> LOCATION: (1251)..(1251)
<223> OTHER INFORMATION: UNA monomer
<220> FEATURE:
<221> NAME/KEY: modified_base
<222> LOCATION: (1256)..(1256)
<223> OTHER INFORMATION: UNA monomer
<220> FEATURE:
<221> NAME/KEY: modified_base
<222> LOCATION: (1269)..(1271)
<223> OTHER INFORMATION: UNA monomer
<220> FEATURE:
<221> NAME/KEY: modified_base
<222> LOCATION: (1273)..(1274)
<223> OTHER INFORMATION: UNA monomer
<220> FEATURE:
<221> NAME/KEY: modified_base
<222> LOCATION: (1278)..(1278)
<223> OTHER INFORMATION: UNA monomer
<220> FEATURE:
<221> NAME/KEY: modified_base
<222> LOCATION: (1283)..(1284)
<223> OTHER INFORMATION: UNA monomer
<220> FEATURE:
<221> NAME/KEY: modified_base
<222> LOCATION: (1286)..(1287)
<223> OTHER INFORMATION: UNA monomer
<220> FEATURE:
<221> NAME/KEY: modified_base
<222> LOCATION: (1291)..(1291)
<223> OTHER INFORMATION: UNA monomer
<220> FEATURE:
<221> NAME/KEY: modified_base
<222> LOCATION: (1296)..(1296)
<223> OTHER INFORMATION: UNA monomer
<220> FEATURE:
<221> NAME/KEY: modified_base
<222> LOCATION: (1303)..(1303)
<223> OTHER INFORMATION: UNA monomer
<220> FEATURE:
<221> NAME/KEY: modified_base
<222> LOCATION: (1305)..(1305)
<223> OTHER INFORMATION: UNA monomer
<220> FEATURE:
<221> NAME/KEY: modified_base
<222> LOCATION: (1310)..(1310)
<223> OTHER INFORMATION: UNA monomer
<220> FEATURE:
<221> NAME/KEY: modified_base
<222> LOCATION: (1321)..(1321)
<223> OTHER INFORMATION: UNA monomer
<220> FEATURE:
<221> NAME/KEY: modified_base
<222> LOCATION: (1323)..(1323)
<223> OTHER INFORMATION: UNA monomer
<220> FEATURE:
<221> NAME/KEY: modified_base
<222> LOCATION: (1328)..(1328)
<223> OTHER INFORMATION: UNA monomer
<220> FEATURE:

<221> NAME/KEY: modified_base
<222> LOCATION: (1330)..(1330)
<223> OTHER INFORMATION: UNA monomer
<220> FEATURE:
<221> NAME/KEY: modified_base
<222> LOCATION: (1332)..(1332)
<223> OTHER INFORMATION: UNA monomer
<220> FEATURE:
<221> NAME/KEY: modified_base
<222> LOCATION: (1340)..(1340)
<223> OTHER INFORMATION: UNA monomer
<220> FEATURE:
<221> NAME/KEY: modified_base
<222> LOCATION: (1342)..(1342)
<223> OTHER INFORMATION: UNA monomer
<220> FEATURE:
<221> NAME/KEY: modified_base
<222> LOCATION: (1348)..(1348)
<223> OTHER INFORMATION: UNA monomer
<220> FEATURE:
<221> NAME/KEY: modified_base
<222> LOCATION: (1350)..(1350)
<223> OTHER INFORMATION: UNA monomer
<220> FEATURE:
<221> NAME/KEY: modified_base
<222> LOCATION: (1352)..(1352)
<223> OTHER INFORMATION: UNA monomer
<220> FEATURE:
<221> NAME/KEY: modified_base
<222> LOCATION: (1357)..(1357)
<223> OTHER INFORMATION: UNA monomer
<220> FEATURE:
<221> NAME/KEY: modified_base
<222> LOCATION: (1361)..(1362)
<223> OTHER INFORMATION: UNA monomer
<220> FEATURE:
<221> NAME/KEY: modified_base
<222> LOCATION: (1379)..(1379)
<223> OTHER INFORMATION: UNA monomer
<220> FEATURE:
<221> NAME/KEY: modified_base
<222> LOCATION: (1383)..(1384)
<223> OTHER INFORMATION: UNA monomer

<400> SEQUENCE: 17 augcagcgcg ugaacaugau cauggcagaa ucaccaggcc ucaucaccau cugccuuuua 60 ggauaucuac ucagugcuga auguacaguu uuucuugauc augaaaacgc caacaaaauu 120 cugaaucggc caaagaggua uaauucaggu aaauuggaag aguuuguuca agggaaccuu 180 gagagagaau guauggaaga aaaguguagu uuugaagaag cacgagaagu uuuugaaaac 240 acugaaagaa caacugaauu uuggaagcag uauguugaug gagaucagug ugaguccaau 300 ccauguuuaa auggcggcag uugcaaggau gacauuaauu ccuaugaaug uuggugucccc 360 uuuggauuug aaggaaagaa cugugaauua gauguaacau guaacauuaa gaauggcaga 420 ugcgagcagu uuuguaaaaa uagugcugau aacaaggugg uuugcuccug uacugaggga 480 uaucgacuug cagaaaacca gaaguccugu gaaccagcag ugccauuucc auguggaaga 540 guuucuguuu cacaaacuuc uaagcucacc cgugcugaga cuguuuuucc ugauguggac 600 uauguaaauu cuacugaagc ugaaaccauu uuggauaaca ucacucaaag cacccaauca 660 uuuaaugacu ucacucgggu uguuggugga gaagaugcca aaccagguca auucccuugg 720 cagguuguuu ugaaugguaa aguugaugca uucuguggag gcucuaucgu uaaugaaaaa 780 uggauuguaa cugcugccca cuguguugaa acuggguuua aaauuacagu ugucgcaggu 840 gaacauaaua uugaggagac agaacauaca gagcaaaagc gaaaugugau ucgaauuauu 900 ccucaccaca acuacaaugc agcuauuaau aaguacaacc augacauugc ccuucuggaa 960 cuggacgaac ccuuagugcu aaacagcuac guuacaccua uuugcauugc ugacaaggaa 1020 uacacgaaca ucuuccucaa auuuggaucu ggcuauguaa guggcugggg aagagucuuc 1080 cacaaaggga gaucagcuuu aguucuucag uaccuuagag uuccacuugu ugaccgagcc 1140 acaugucuuc gaucuacaaa guucaccauc uauaacaaca uguucugugc uggcuuccau 1200 gaaggaggua gagauucaug ucaaggagau agugggggac cccauguuac ugaaguggaa 1260 gggaccaguu ucuuaacugg aauuauuagc uggggugaag agugugcaau gaaaggcaaa 1320 uauggaauau auaccaaggu aucccgguau gucaacugga uuaaggaaaa aacaaagcuc 1380 acuuaa 1386

<210> SEQ ID NO 18
<211> LENGTH: 1257
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (3)..(3)
<223> OTHER INFORMATION: UNA monomer
<220> FEATURE:
<221> NAME/KEY: modified_base
<222> LOCATION: (33)..(33)
<223> OTHER INFORMATION: UNA monomer
<220> FEATURE:
<221> NAME/KEY: modified_base
<222> LOCATION: (63)..(63)
<223> OTHER INFORMATION: UNA monomer
<220> FEATURE:
<221> NAME/KEY: modified_base
<222> LOCATION: (93)..(93)
<223> OTHER INFORMATION: UNA monomer
<220> FEATURE:
<221> NAME/KEY: modified_base
<222> LOCATION: (123)..(123)
<223> OTHER INFORMATION: UNA monomer
<220> FEATURE:
<221> NAME/KEY: modified_base
<222> LOCATION: (153)..(153)
<223> OTHER INFORMATION: UNA monomer
<220> FEATURE:
<221> NAME/KEY: modified_base
<222> LOCATION: (183)..(183)
<223> OTHER INFORMATION: UNA monomer
<220> FEATURE:
<221> NAME/KEY: modified_base
<222> LOCATION: (213)..(213)
<223> OTHER INFORMATION: UNA monomer
<220> FEATURE:
<221> NAME/KEY: modified_base
<222> LOCATION: (243)..(243)
<223> OTHER INFORMATION: UNA monomer
<220> FEATURE:
<221> NAME/KEY: modified_base
<222> LOCATION: (273)..(273)
<223> OTHER INFORMATION: UNA monomer
<220> FEATURE:
<221> NAME/KEY: modified_base
<222> LOCATION: (303)..(303)
<223> OTHER INFORMATION: UNA monomer
<220> FEATURE:
<221> NAME/KEY: modified_base
<222> LOCATION: (333)..(333)
<223> OTHER INFORMATION: UNA monomer
<220> FEATURE:
<221> NAME/KEY: modified_base
<222> LOCATION: (363)..(363)
<223> OTHER INFORMATION: UNA monomer
<220> FEATURE:
<221> NAME/KEY: modified_base
<222> LOCATION: (393)..(393)
<223> OTHER INFORMATION: UNA monomer <220> FEATURE:
<221> NAME/KEY: modified_base
<222> LOCATION: (423)..(423)
<223> OTHER INFORMATION: UNA monomer
<220> FEATURE:
<221> NAME/KEY: modified_base
<222> LOCATION: (453)..(453)
<223> OTHER INFORMATION: UNA monomer
<220> FEATURE:
<221> NAME/KEY: modified_base
<222> LOCATION: (483)..(483)
<223> OTHER INFORMATION: UNA monomer
<220> FEATURE:
<221> NAME/KEY: modified_base
<222> LOCATION: (513)..(513)
<223> OTHER INFORMATION: UNA monomer
<220> FEATURE:
<221> NAME/KEY: modified_base
<222> LOCATION: (543)..(543)
<223> OTHER INFORMATION: UNA monomer
<220> FEATURE:
<221> NAME/KEY: modified_base
<222> LOCATION: (573)..(573)
<223> OTHER INFORMATION: UNA monomer
<220> FEATURE:
<221> NAME/KEY: modified_base
<222> LOCATION: (603)..(603)
<223> OTHER INFORMATION: UNA monomer
<220> FEATURE:
<221> NAME/KEY: modified_base
<222> LOCATION: (633)..(633)
<223> OTHER INFORMATION: UNA monomer
<220> FEATURE:
<221> NAME/KEY: modified_base
<222> LOCATION: (663)..(663)
<223> OTHER INFORMATION: UNA monomer
<220> FEATURE:
<221> NAME/KEY: modified_base
<222> LOCATION: (693)..(693)
<223> OTHER INFORMATION: UNA monomer
<220> FEATURE:
<221> NAME/KEY: modified_base
<222> LOCATION: (723)..(723)
<223> OTHER INFORMATION: UNA monomer
<220> FEATURE:
<221> NAME/KEY: modified_base
<222> LOCATION: (753)..(753)
<223> OTHER INFORMATION: UNA monomer
<220> FEATURE:
<221> NAME/KEY: modified_base
<222> LOCATION: (783)..(783)
<223> OTHER INFORMATION: UNA monomer
<220> FEATURE:
<221> NAME/KEY: modified_base
<222> LOCATION: (813)..(813)
<223> OTHER INFORMATION: UNA monomer
<220> FEATURE:
<221> NAME/KEY: modified_base
<222> LOCATION: (843)..(843)
<223> OTHER INFORMATION: UNA monomer
<220> FEATURE:
<221> NAME/KEY: modified_base
<222> LOCATION: (873)..(873)
<223> OTHER INFORMATION: UNA monomer
<220> FEATURE:
<221> NAME/KEY: modified_base
<222> LOCATION: (903)..(903)
<223> OTHER INFORMATION: UNA monomer
<220> FEATURE:
<221> NAME/KEY: modified_base
<222> LOCATION: (933)..(933)
<223> OTHER INFORMATION: UNA monomer
<220> FEATURE:
<221> NAME/KEY: modified_base
<222> LOCATION: (963)..(963)
<223> OTHER INFORMATION: UNA monomer
<220> FEATURE:
<221> NAME/KEY: modified_base
<222> LOCATION: (993)..(993)

<223> OTHER INFORMATION: UNA monomer
<220> FEATURE:
<221> NAME/KEY: modified_base
<222> LOCATION: (1023)..(1023)
<223> OTHER INFORMATION: UNA monomer
<220> FEATURE:
<221> NAME/KEY: modified_base
<222> LOCATION: (1053)..(1053)
<223> OTHER INFORMATION: UNA monomer
<220> FEATURE:
<221> NAME/KEY: modified_base
<222> LOCATION: (1083)..(1083)
<223> OTHER INFORMATION: UNA monomer
<220> FEATURE:
<221> NAME/KEY: modified_base
<222> LOCATION: (1113)..(1113)
<223> OTHER INFORMATION: UNA monomer
<220> FEATURE:
<221> NAME/KEY: modified_base
<222> LOCATION: (1143)..(1143)
<223> OTHER INFORMATION: UNA monomer
<220> FEATURE:
<221> NAME/KEY: modified_base
<222> LOCATION: (1173)..(1173)
<223> OTHER INFORMATION: UNA monomer
<220> FEATURE:
<221> NAME/KEY: modified_base
<222> LOCATION: (1203)..(1203)
<223> OTHER INFORMATION: UNA monomer
<220> FEATURE:
<221> NAME/KEY: modified_base
<222> LOCATION: (1233)..(1233)
<223> OTHER INFORMATION: UNA monomer
<220> FEATURE:
<221> NAME/KEY: modified_base
<222> LOCATION: (1256)..(1256)
<223> OTHER INFORMATION: UNA monomer

<400> SEQUENCE: 18 augccgucuu cugucucgug gggcauccuc cugcuggcag gccugugcug ccuggucccu 60 gucucccugg cugaggaucc ccagggagau gcugcccaga agacagauac aucccaccau 120 gaucaggauc acccaaccuu caacaagauc acccccaacc uggcugaguu cgccuucagc 180 cuauaccgcc agcuggcaca ccaguccaac agcaccaaua ucuucuucuc cccagugagc 240 aucgcuacag ccuuugcaau gcucucccug gggaccaagg cugacacuca cgaugaaauc 300 cuggagggcc ugaauuucaa ccucacggag auuccggagg cucagaucca ugaaggcuuc 360 caggaacucc uccguacccu caaccagcca gacagccagc uccagcugac caccggcaau 420 ggccuguucc ucagcgaggg ccugaagcua guggauaagu uuuuggagga uguuaaaaag 480 uuguaccacu cagaagccuu cacugucaac uucggggaca ccgaagaggc caagaaacag 540 aucaacgauu acguggagaa ggguacucaa gggaaaauug uggauuuggu caaggagcuu 600 gacagagaca caguuuuugc ucuggugaau uacaucuucu uuaaaggcaa augggagaga 660 cccuuugaag ucaaggacac cgaggaagag gacuuccacg uggaccaggu gaccaccgug 720 aaggugccua ugaugaagcg uuuaggcaug uuuaacaucc agcacuguaa gaagcugucc 780 agcugggugc ugcugaugaa auaccugggc aaugccaccg ccaucuucuu ccugccugau 840 gaggggaaac uacagcaccu ggaaaaugaa cucacccacg auaucaucac caaguuccug 900 gaaaaugaag acagaagguc ugccagcuua cauuuaccca aacuguccau uacuggaacc 960 uaugaucuga agagcguccu gggucaacug ggcaucacua aggucuucag caaugggcu 1020 gaccucuccg gggucacaga ggaggcaccc cugaagcucu ccaaggccgu gcauaaggcu 1080 gugcugacca ucgacgagaa agggacugaa gcugcugggg ccauguuuuu agaggccaua 1140 cccaugucua uccccccga ggucaaguuc aacaaacccu uugucuucuu aaugauugaa 1200 caaaauacca agucuccccu cuucauggga aaagugguga aucccaccca aaaauaa 1257

<210> SEQ ID NO 19
<211> LENGTH: 1257
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (1254)..(1256)
<223> OTHER INFORMATION: UNA monomer

<400> SEQUENCE: 19 augccgucuu cugucucgug gggcauccuc cugcuggcag gccugugcug ccuggucccu 60 gucucccugg cugaggaucc ccagggagau gcugcccaga agacagauac aucccaccau 120 gaucaggauc acccaaccuu caacaagauc acccccaacc uggcugaguu cgccuucagc 180 cuauaccgcc agcuggcaca ccaguccaac agcaccaaua ucuucuucuc cccagugagc 240 aucgcuacag ccuuugcaau gcucucccug gggaccaagg cugacacuca cgaugaaauc 300 cuggagggcc ugaauuucaa ccucacggag auuccggagg cucagaucca ugaaggcuuc 360 caggaacucc uccguacccu caaccagcca gacagccagc uccagcugac caccggcaau 420 ggccuguucc ucagcgaggg ccugaagcua guggauaagu uuuuggagga uguuaaaaag 480 uuguaccacu cagaagccuu cacugucaac uucggggaca ccgaagaggc caagaaacag 540 aucaacgauu acguggagaa ggguacucaa gggaaaauug uggauuuggu caaggagcuu 600 gacagagaca caguuuuugc ucuggugaau uacaucuucu uuaaaggcaa augggagaga 660 cccuuugaag ucaaggacac cgaggaagag gacuuccacg uggaccaggu gaccaccgug 720 aaggugccua ugaugaagcg uuuaggcaug uuuaacaucc agcacuguaa gaagcugucc 780 agcugggugc ugcugaugaa auaccugggc aaugccaccg ccaucuucuu ccugccugau 840 gaggggaaac uacagcaccu ggaaaaugaa cucacccacg auaucaucac caaguuccug 900 gaaaaugaag acagaagguc ugccagcuua cauuuaccca aacuguccau uacuggaacc 960 uaugaucuga agagcguccu gggucaacug ggcaucacua aggucuucag caaugggcu 1020 gaccucuccg gggucacaga ggaggcaccc cugaagcucu ccaaggccgu gcauaaggcu 1080 gugcugacca ucgacgagaa agggacugaa gcugcugggg ccauguuuuu agaggccaua 1140 cccaugucua ucccccccga ggucaaguuc aacaaacccu uugucuucuu aaugauugaa 1200 caaaauacca agucuccccu cuucauggga aaagugguga aucccaccca aaaauaa 1257

<210> SEQ ID NO 20
<211> LENGTH: 1257
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (7)..(7)

<223> OTHER INFORMATION: UNA monomer
<220> FEATURE:
<221> NAME/KEY: modified_base
<222> LOCATION: (9)..(10)
<223> OTHER INFORMATION: UNA monomer
<220> FEATURE:
<221> NAME/KEY: modified_base
<222> LOCATION: (12)..(12)
<223> OTHER INFORMATION: UNA monomer
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (16)..(16)
<223> OTHER INFORMATION: UNA monomer
<220> FEATURE:
<221> NAME/KEY: modified_base
<222> LOCATION: (19)..(19)
<223> OTHER INFORMATION: UNA monomer
<220> FEATURE:
<221> NAME/KEY: modified_base
<222> LOCATION: (26)..(26)
<223> OTHER INFORMATION: UNA monomer
<220> FEATURE:
<221> NAME/KEY: modified_base
<222> LOCATION: (29)..(29)
<223> OTHER INFORMATION: UNA monomer
<220> FEATURE:
<221> NAME/KEY: modified_base
<222> LOCATION: (32)..(32)
<223> OTHER INFORMATION: UNA monomer
<220> FEATURE:
<221> NAME/KEY: modified_base
<222> LOCATION: (35)..(35)
<223> OTHER INFORMATION: UNA monomer
<220> FEATURE:
<221> NAME/KEY: modified_base
<222> LOCATION: (44)..(44)
<223> OTHER INFORMATION: UNA monomer
<220> FEATURE:
<221> NAME/KEY: modified_base
<222> LOCATION: (46)..(46)
<223> OTHER INFORMATION: UNA monomer
<220> FEATURE:
<221> NAME/KEY: modified_base
<222> LOCATION: (49)..(49)
<223> OTHER INFORMATION: UNA monomer
<220> FEATURE:
<221> NAME/KEY: modified_base
<222> LOCATION: (53)..(53)
<223> OTHER INFORMATION: UNA monomer
<220> FEATURE:
<221> NAME/KEY: modified_base
<222> LOCATION: (56)..(56)
<223> OTHER INFORMATION: UNA monomer
<220> FEATURE:
<221> NAME/KEY: modified_base
<222> LOCATION: (60)..(60)
<223> OTHER INFORMATION: UNA monomer
<220> FEATURE:
<221> NAME/KEY: modified_base
<222> LOCATION: (62)..(62)
<223> OTHER INFORMATION: UNA monomer
<220> FEATURE:
<221> NAME/KEY: modified_base
<222> LOCATION: (64)..(64)
<223> OTHER INFORMATION: UNA monomer
<220> FEATURE:
<221> NAME/KEY: modified_base
<222> LOCATION: (68)..(68)
<223> OTHER INFORMATION: UNA monomer
<220> FEATURE:
<221> NAME/KEY: modified_base
<222> LOCATION: (72)..(72)
<223> OTHER INFORMATION: UNA monomer
<220> FEATURE:
<221> NAME/KEY: modified_base <222> LOCATION: (78)..(78)
<223> OTHER INFORMATION: UNA monomer
<220> FEATURE:
<221> NAME/KEY: modified_base
<222> LOCATION: (90)..(90)
<223> OTHER INFORMATION: UNA monomer
<220> FEATURE:
<221> NAME/KEY: modified_base
<222> LOCATION: (93)..(93)
<223> OTHER INFORMATION: UNA monomer
<220> FEATURE:
<221> NAME/KEY: modified_base
<222> LOCATION: (108)..(108)
<223> OTHER INFORMATION: UNA monomer
<220> FEATURE:
<221> NAME/KEY: modified_base
<222> LOCATION: (112)..(112)
<223> OTHER INFORMATION: UNA monomer
<220> FEATURE:
<221> NAME/KEY: modified_base
<222> LOCATION: (120)..(120)
<223> OTHER INFORMATION: UNA monomer
<220> FEATURE:
<221> NAME/KEY: modified_base
<222> LOCATION: (123)..(123)
<223> OTHER INFORMATION: UNA monomer
<220> FEATURE:
<221> NAME/KEY: modified_base
<222> LOCATION: (129)..(129)
<223> OTHER INFORMATION: UNA monomer
<220> FEATURE:
<221> NAME/KEY: modified_base
<222> LOCATION: (139)..(140)
<223> OTHER INFORMATION: UNA monomer
<220> FEATURE:
<221> NAME/KEY: modified_base
<222> LOCATION: (149)..(149)
<223> OTHER INFORMATION: UNA monomer
<220> FEATURE:
<221> NAME/KEY: modified_base
<222> LOCATION: (161)..(161)
<223> OTHER INFORMATION: UNA monomer
<220> FEATURE:
<221> NAME/KEY: modified_base
<222> LOCATION: (165)..(165)
<223> OTHER INFORMATION: UNA monomer
<220> FEATURE:
<221> NAME/KEY: modified_base
<222> LOCATION: (169)..(170)
<223> OTHER INFORMATION: UNA monomer
<220> FEATURE:
<221> NAME/KEY: modified_base
<222> LOCATION: (175)..(176)
<223> OTHER INFORMATION: UNA monomer
<220> FEATURE:
<221> NAME/KEY: modified_base
<222> LOCATION: (182)..(182)
<223> OTHER INFORMATION: UNA monomer
<220> FEATURE:
<221> NAME/KEY: modified_base
<222> LOCATION: (184)..(184)
<223> OTHER INFORMATION: UNA monomer
<220> FEATURE:
<221> NAME/KEY: modified_base
<222> LOCATION: (194)..(194)
<223> OTHER INFORMATION: UNA monomer
<220> FEATURE:
<221> NAME/KEY: modified_base
<222> LOCATION: (205)..(205)
<223> OTHER INFORMATION: UNA monomer
<220> FEATURE:
<221> NAME/KEY: modified_base
<222> LOCATION: (219)..(219)
<223> OTHER INFORMATION: UNA monomer
<220> FEATURE:
<221> NAME/KEY: modified_base
<222> LOCATION: (221)..(221)
<223> OTHER INFORMATION: UNA monomer
<220> FEATURE:

<221> NAME/KEY: modified_base
<222> LOCATION: (223)..(224)
<223> OTHER INFORMATION: UNA monomer
<220> FEATURE:
<221> NAME/KEY: modified_base
<222> LOCATION: (226)..(227)
<223> OTHER INFORMATION: UNA monomer
<220> FEATURE:
<221> NAME/KEY: modified_base
<222> LOCATION: (229)..(229)
<223> OTHER INFORMATION: UNA monomer
<220> FEATURE:
<221> NAME/KEY: modified_base
<222> LOCATION: (236)..(236)
<223> OTHER INFORMATION: UNA monomer
<220> FEATURE:
<221> NAME/KEY: modified_base
<222> LOCATION: (242)..(242)
<223> OTHER INFORMATION: UNA monomer
<220> FEATURE:
<221> NAME/KEY: modified_base
<222> LOCATION: (246)..(246)
<223> OTHER INFORMATION: UNA monomer
<220> FEATURE:
<221> NAME/KEY: modified_base
<222> LOCATION: (253)..(255)
<223> OTHER INFORMATION: UNA monomer
<220> FEATURE:
<221> NAME/KEY: modified_base
<222> LOCATION: (260)..(260)
<223> OTHER INFORMATION: UNA monomer
<220> FEATURE:
<221> NAME/KEY: modified_base
<222> LOCATION: (263)..(263)
<223> OTHER INFORMATION: UNA monomer
<220> FEATURE:
<221> NAME/KEY: modified_base
<222> LOCATION: (265)..(265)
<223> OTHER INFORMATION: UNA monomer
<220> FEATURE:
<221> NAME/KEY: modified_base
<222> LOCATION: (269)..(269)
<223> OTHER INFORMATION: UNA monomer
<220> FEATURE:
<221> NAME/KEY: modified_base
<222> LOCATION: (282)..(282)
<223> OTHER INFORMATION: UNA monomer
<220> FEATURE:
<221> NAME/KEY: modified_base
<222> LOCATION: (288)..(288)
<223> OTHER INFORMATION: UNA monomer
<220> FEATURE:
<221> NAME/KEY: modified_base
<222> LOCATION: (294)..(294)
<223> OTHER INFORMATION: UNA monomer
<220> FEATURE:
<221> NAME/KEY: modified_base
<222> LOCATION: (299)..(299)
<223> OTHER INFORMATION: UNA monomer
<220> FEATURE:
<221> NAME/KEY: modified_base
<222> LOCATION: (302)..(302)
<223> OTHER INFORMATION: UNA monomer
<220> FEATURE:
<221> NAME/KEY: modified_base
<222> LOCATION: (311)..(311)
<223> OTHER INFORMATION: UNA monomer
<220> FEATURE:
<221> NAME/KEY: modified_base
<222> LOCATION: (315)..(317)
<223> OTHER INFORMATION: UNA monomer
<220> FEATURE:
<221> NAME/KEY: modified_base
<222> LOCATION: (323)..(323)
<223> OTHER INFORMATION: UNA monomer
<220> FEATURE:
<221> NAME/KEY: modified_base
<222> LOCATION: (332)..(333)
<223> OTHER INFORMATION: UNA monomer <220> FEATURE:
<221> NAME/KEY: modified_base
<222> LOCATION: (342)..(342)
<223> OTHER INFORMATION: UNA monomer
<220> FEATURE:
<221> NAME/KEY: modified_base
<222> LOCATION: (347)..(347)
<223> OTHER INFORMATION: UNA monomer
<220> FEATURE:
<221> NAME/KEY: modified_base
<222> LOCATION: (351)..(351)
<223> OTHER INFORMATION: UNA monomer
<220> FEATURE:
<221> NAME/KEY: modified_base
<222> LOCATION: (358)..(359)
<223> OTHER INFORMATION: UNA monomer
<220> FEATURE:
<221> NAME/KEY: modified_base
<222> LOCATION: (368)..(368)
<223> OTHER INFORMATION: UNA monomer
<220> FEATURE:
<221> NAME/KEY: modified_base
<222> LOCATION: (371)..(371)
<223> OTHER INFORMATION: UNA monomer
<220> FEATURE:
<221> NAME/KEY: modified_base
<222> LOCATION: (375)..(375)
<223> OTHER INFORMATION: UNA monomer
<220> FEATURE:
<221> NAME/KEY: modified_base
<222> LOCATION: (380)..(380)
<223> OTHER INFORMATION: UNA monomer
<220> FEATURE:
<221> NAME/KEY: modified_base
<222> LOCATION: (401)..(401)
<223> OTHER INFORMATION: UNA monomer
<220> FEATURE:
<221> NAME/KEY: modified_base
<222> LOCATION: (407)..(407)
<223> OTHER INFORMATION: UNA monomer
<220> FEATURE:
<221> NAME/KEY: modified_base
<222> LOCATION: (420)..(420)
<223> OTHER INFORMATION: UNA monomer
<220> FEATURE:
<221> NAME/KEY: modified_base
<222> LOCATION: (425)..(425)
<223> OTHER INFORMATION: UNA monomer
<220> FEATURE:
<221> NAME/KEY: modified_base
<222> LOCATION: (427)..(428)
<223> OTHER INFORMATION: UNA monomer
<220> FEATURE:
<221> NAME/KEY: modified_base
<222> LOCATION: (431)..(431)
<223> OTHER INFORMATION: UNA monomer
<220> FEATURE:
<221> NAME/KEY: modified_base
<222> LOCATION: (443)..(443)
<223> OTHER INFORMATION: UNA monomer
<220> FEATURE:
<221> NAME/KEY: modified_base
<222> LOCATION: (449)..(449)
<223> OTHER INFORMATION: UNA monomer
<220> FEATURE:
<221> NAME/KEY: modified_base
<222> LOCATION: (452)..(452)
<223> OTHER INFORMATION: UNA monomer
<220> FEATURE:
<221> NAME/KEY: modified_base
<222> LOCATION: (456)..(456)
<223> OTHER INFORMATION: UNA monomer
<220> FEATURE:
<221> NAME/KEY: modified_base
<222> LOCATION: (460)..(464)
<223> OTHER INFORMATION: UNA monomer
<220> FEATURE:
<221> NAME/KEY: modified_base
<222> LOCATION: (471)..(471)

<223> OTHER INFORMATION: UNA monomer
<220> FEATURE:
<221> NAME/KEY: modified_base
<222> LOCATION: (473)..(474)
<223> OTHER INFORMATION: UNA monomer
<220> FEATURE:
<221> NAME/KEY: modified_base
<222> LOCATION: (481)..(482)
<223> OTHER INFORMATION: UNA monomer
<220> FEATURE:
<221> NAME/KEY: modified_base
<222> LOCATION: (484)..(484)
<223> OTHER INFORMATION: UNA monomer
<220> FEATURE:
<221> NAME/KEY: modified_base
<222> LOCATION: (490)..(490)
<223> OTHER INFORMATION: UNA monomer
<220> FEATURE:
<221> NAME/KEY: modified_base
<222> LOCATION: (499)..(500)
<223> OTHER INFORMATION: UNA monomer
<220> FEATURE:
<221> NAME/KEY: modified_base
<222> LOCATION: (504)..(504)
<223> OTHER INFORMATION: UNA monomer
<220> FEATURE:
<221> NAME/KEY: modified_base
<222> LOCATION: (506)..(506)
<223> OTHER INFORMATION: UNA monomer
<220> FEATURE:
<221> NAME/KEY: modified_base
<222> LOCATION: (511)..(512)
<223> OTHER INFORMATION: UNA monomer
<220> FEATURE:
<221> NAME/KEY: modified_base
<222> LOCATION: (542)..(542)
<223> OTHER INFORMATION: UNA monomer
<220> FEATURE:
<221> NAME/KEY: modified_base
<222> LOCATION: (549)..(550)
<223> OTHER INFORMATION: UNA monomer
<220> FEATURE:
<221> NAME/KEY: modified_base
<222> LOCATION: (554)..(554)
<223> OTHER INFORMATION: UNA monomer
<220> FEATURE:
<221> NAME/KEY: modified_base
<222> LOCATION: (564)..(564)
<223> OTHER INFORMATION: UNA monomer
<220> FEATURE:
<221> NAME/KEY: modified_base
<222> LOCATION: (567)..(567)
<223> OTHER INFORMATION: UNA monomer
<220> FEATURE:
<221> NAME/KEY: modified_base
<222> LOCATION: (578)..(579)
<223> OTHER INFORMATION: UNA monomer
<220> FEATURE:
<221> NAME/KEY: modified_base
<222> LOCATION: (581)..(581)
<223> OTHER INFORMATION: UNA monomer
<220> FEATURE:
<221> NAME/KEY: modified_base
<222> LOCATION: (585)..(587)
<223> OTHER INFORMATION: UNA monomer
<220> FEATURE:
<221> NAME/KEY: modified_base
<222> LOCATION: (590)..(590)
<223> OTHER INFORMATION: UNA monomer
<220> FEATURE:
<221> NAME/KEY: modified_base
<222> LOCATION: (599)..(600)
<223> OTHER INFORMATION: UNA monomer
<220> FEATURE:
<221> NAME/KEY: modified_base
<222> LOCATION: (614)..(618)
<223> OTHER INFORMATION: UNA monomer
<220> FEATURE:
<221> NAME/KEY: modified_base <222> LOCATION: (621)..(621)
<223> OTHER INFORMATION: UNA monomer
<220> FEATURE:
<221> NAME/KEY: modified_base
<222> LOCATION: (623)..(623)
<223> OTHER INFORMATION: UNA monomer
<220> FEATURE:
<221> NAME/KEY: modified_base
<222> LOCATION: (626)..(626)
<223> OTHER INFORMATION: UNA monomer
<220> FEATURE:
<221> NAME/KEY: modified_base
<222> LOCATION: (630)..(631)
<223> OTHER INFORMATION: UNA monomer
<220> FEATURE:
<221> NAME/KEY: modified_base
<222> LOCATION: (635)..(635)
<223> OTHER INFORMATION: UNA monomer
<220> FEATURE:
<221> NAME/KEY: modified_base
<222> LOCATION: (637)..(638)
<223> OTHER INFORMATION: UNA monomer
<220> FEATURE:
<221> NAME/KEY: modified_base
<222> LOCATION: (640)..(642)
<223> OTHER INFORMATION: UNA monomer
<220> FEATURE:
<221> NAME/KEY: modified_base
<222> LOCATION: (652)..(652)
<223> OTHER INFORMATION: UNA monomer
<220> FEATURE:
<221> NAME/KEY: modified_base
<222> LOCATION: (664)..(666)
<223> OTHER INFORMATION: UNA monomer
<220> FEATURE:
<221> NAME/KEY: modified_base
<222> LOCATION: (671)..(671)
<223> OTHER INFORMATION: UNA monomer
<220> FEATURE:
<221> NAME/KEY: modified_base
<222> LOCATION: (694)..(695)
<223> OTHER INFORMATION: UNA monomer
<220> FEATURE:
<221> NAME/KEY: modified_base
<222> LOCATION: (701)..(701)
<223> OTHER INFORMATION: UNA monomer
<220> FEATURE:
<221> NAME/KEY: modified_base
<222> LOCATION: (710)..(710)
<223> OTHER INFORMATION: UNA monomer
<220> FEATURE:
<221> NAME/KEY: modified_base
<222> LOCATION: (719)..(719)
<223> OTHER INFORMATION: UNA monomer
<220> FEATURE:
<221> NAME/KEY: modified_base
<222> LOCATION: (725)..(725)
<223> OTHER INFORMATION: UNA monomer
<220> FEATURE:
<221> NAME/KEY: modified_base
<222> LOCATION: (729)..(729)
<223> OTHER INFORMATION: UNA monomer
<220> FEATURE:
<221> NAME/KEY: modified_base
<222> LOCATION: (731)..(731)
<223> OTHER INFORMATION: UNA monomer
<220> FEATURE:
<221> NAME/KEY: modified_base
<222> LOCATION: (734)..(734)
<223> OTHER INFORMATION: UNA monomer
<220> FEATURE:
<221> NAME/KEY: modified_base
<222> LOCATION: (741)..(743)
<223> OTHER INFORMATION: UNA monomer
<220> FEATURE:
<221> NAME/KEY: modified_base
<222> LOCATION: (749)..(749)
<223> OTHER INFORMATION: UNA monomer
<220> FEATURE:

<221> NAME/KEY: modified_base
<222> LOCATION: (751)..(753)
<223> OTHER INFORMATION: UNA monomer
<220> FEATURE:
<221> NAME/KEY: modified_base
<222> LOCATION: (758)..(758)
<223> OTHER INFORMATION: UNA monomer
<220> FEATURE:
<221> NAME/KEY: modified_base
<222> LOCATION: (766)..(766)
<223> OTHER INFORMATION: UNA monomer
<220> FEATURE:
<221> NAME/KEY: modified_base
<222> LOCATION: (768)..(768)
<223> OTHER INFORMATION: UNA monomer
<220> FEATURE:
<221> NAME/KEY: modified_base
<222> LOCATION: (776)..(776)
<223> OTHER INFORMATION: UNA monomer
<220> FEATURE:
<221> NAME/KEY: modified_base
<222> LOCATION: (778)..(778)
<223> OTHER INFORMATION: UNA monomer
<220> FEATURE:
<221> NAME/KEY: modified_base
<222> LOCATION: (784)..(784)
<223> OTHER INFORMATION: UNA monomer
<220> FEATURE:
<221> NAME/KEY: modified_base
<222> LOCATION: (788)..(788)
<223> OTHER INFORMATION: UNA monomer
<220> FEATURE:
<221> NAME/KEY: modified_base
<222> LOCATION: (791)..(791)
<223> OTHER INFORMATION: UNA monomer
<220> FEATURE:
<221> NAME/KEY: modified_base
<222> LOCATION: (794)..(794)
<223> OTHER INFORMATION: UNA monomer
<220> FEATURE:
<221> NAME/KEY: modified_base
<222> LOCATION: (797)..(797)
<223> OTHER INFORMATION: UNA monomer
<220> FEATURE:
<221> NAME/KEY: modified_base
<222> LOCATION: (802)..(802)
<223> OTHER INFORMATION: UNA monomer
<220> FEATURE:
<221> NAME/KEY: modified_base
<222> LOCATION: (806)..(806)
<223> OTHER INFORMATION: UNA monomer
<220> FEATURE:
<221> NAME/KEY: modified_base
<222> LOCATION: (813)..(813)
<223> OTHER INFORMATION: UNA monomer
<220> FEATURE:
<221> NAME/KEY: modified_base
<222> LOCATION: (824)..(824)
<223> OTHER INFORMATION: UNA monomer
<220> FEATURE:
<221> NAME/KEY: modified_base
<222> LOCATION: (826)..(827)
<223> OTHER INFORMATION: UNA monomer
<220> FEATURE:
<221> NAME/KEY: modified_base
<222> LOCATION: (829)..(830)
<223> OTHER INFORMATION: UNA monomer
<220> FEATURE:
<221> NAME/KEY: modified_base
<222> LOCATION: (833)..(833)
<223> OTHER INFORMATION: UNA monomer
<220> FEATURE:
<221> NAME/KEY: modified_base
<222> LOCATION: (837)..(837)
<223> OTHER INFORMATION: UNA monomer
<220> FEATURE:
<221> NAME/KEY: modified_base
<222> LOCATION: (840)..(840)
<223> OTHER INFORMATION: UNA monomer <220> FEATURE:
<221> NAME/KEY: modified_base
<222> LOCATION: (851)..(851)
<223> OTHER INFORMATION: UNA monomer
<220> FEATURE:
<221> NAME/KEY: modified_base
<222> LOCATION: (860)..(860)
<223> OTHER INFORMATION: UNA monomer
<220> FEATURE:
<221> NAME/KEY: modified_base
<222> LOCATION: (867)..(867)
<223> OTHER INFORMATION: UNA monomer
<220> FEATURE:
<221> NAME/KEY: modified_base
<222> LOCATION: (872)..(872)
<223> OTHER INFORMATION: UNA monomer
<220> FEATURE:
<221> NAME/KEY: modified_base
<222> LOCATION: (882)..(882)
<223> OTHER INFORMATION: UNA monomer
<220> FEATURE:
<221> NAME/KEY: modified_base
<222> LOCATION: (884)..(884)
<223> OTHER INFORMATION: UNA monomer
<220> FEATURE:
<221> NAME/KEY: modified_base
<222> LOCATION: (887)..(887)
<223> OTHER INFORMATION: UNA monomer
<220> FEATURE:
<221> NAME/KEY: modified_base
<222> LOCATION: (895)..(896)
<223> OTHER INFORMATION: UNA monomer
<220> FEATURE:
<221> NAME/KEY: modified_base
<222> LOCATION: (899)..(899)
<223> OTHER INFORMATION: UNA monomer
<220> FEATURE:
<221> NAME/KEY: modified_base
<222> LOCATION: (906)..(906)
<223> OTHER INFORMATION: UNA monomer
<220> FEATURE:
<221> NAME/KEY: modified_base
<222> LOCATION: (919)..(919)
<223> OTHER INFORMATION: UNA monomer
<220> FEATURE:
<221> NAME/KEY: modified_base
<222> LOCATION: (921)..(921)
<223> OTHER INFORMATION: UNA monomer
<220> FEATURE:
<221> NAME/KEY: modified_base
<222> LOCATION: (928)..(929)
<223> OTHER INFORMATION: UNA monomer
<220> FEATURE:
<221> NAME/KEY: modified_base
<222> LOCATION: (933)..(935)
<223> OTHER INFORMATION: UNA monomer
<220> FEATURE:
<221> NAME/KEY: modified_base
<222> LOCATION: (944)..(944)
<223> OTHER INFORMATION: UNA monomer
<220> FEATURE:
<221> NAME/KEY: modified_base
<222> LOCATION: (946)..(946)
<223> OTHER INFORMATION: UNA monomer
<220> FEATURE:
<221> NAME/KEY: modified_base
<222> LOCATION: (950)..(951)
<223> OTHER INFORMATION: UNA monomer
<220> FEATURE:
<221> NAME/KEY: modified_base
<222> LOCATION: (954)..(954)
<223> OTHER INFORMATION: UNA monomer
<220> FEATURE:
<221> NAME/KEY: modified_base
<222> LOCATION: (961)..(961)
<223> OTHER INFORMATION: UNA monomer
<220> FEATURE:
<221> NAME/KEY: modified_base
<222> LOCATION: (963)..(963)

<223> OTHER INFORMATION: UNA monomer
<220> FEATURE:
<221> NAME/KEY: modified_base
<222> LOCATION: (966)..(966)
<223> OTHER INFORMATION: UNA monomer
<220> FEATURE:
<221> NAME/KEY: modified_base
<222> LOCATION: (968)..(968)
<223> OTHER INFORMATION: UNA monomer
<220> FEATURE:
<221> NAME/KEY: modified_base
<222> LOCATION: (977)..(977)
<223> OTHER INFORMATION: UNA monomer
<220> FEATURE:
<221> NAME/KEY: modified_base
<222> LOCATION: (980)..(980)
<223> OTHER INFORMATION: UNA monomer
<220> FEATURE:
<221> NAME/KEY: modified_base
<222> LOCATION: (984)..(984)
<223> OTHER INFORMATION: UNA monomer
<220> FEATURE:
<221> NAME/KEY: modified_base
<222> LOCATION: (989)..(989)
<223> OTHER INFORMATION: UNA monomer
<220> FEATURE:
<221> NAME/KEY: modified_base
<222> LOCATION: (995)..(995)
<223> OTHER INFORMATION: UNA monomer
<220> FEATURE:
<221> NAME/KEY: modified_base
<222> LOCATION: (999)..(999)
<223> OTHER INFORMATION: UNA monomer
<220> FEATURE:
<221> NAME/KEY: modified_base
<222> LOCATION: (1004)..(1004)
<223> OTHER INFORMATION: UNA monomer
<220> FEATURE:
<221> NAME/KEY: modified_base
<222> LOCATION: (1006)..(1007)
<223> OTHER INFORMATION: UNA monomer
<220> FEATURE:
<221> NAME/KEY: modified_base
<222> LOCATION: (1014)..(1014)
<223> OTHER INFORMATION: UNA monomer
<220> FEATURE:
<221> NAME/KEY: modified_base
<222> LOCATION: (1020)..(1020)
<223> OTHER INFORMATION: UNA monomer
<220> FEATURE:
<221> NAME/KEY: modified_base
<222> LOCATION: (1025)..(1025)
<223> OTHER INFORMATION: UNA monomer
<220> FEATURE:
<221> NAME/KEY: modified_base
<222> LOCATION: (1027)..(1027)
<223> OTHER INFORMATION: UNA monomer
<220> FEATURE:
<221> NAME/KEY: modified_base
<222> LOCATION: (1034)..(1034)
<223> OTHER INFORMATION: UNA monomer
<220> FEATURE:
<221> NAME/KEY: modified_base
<222> LOCATION: (1052)..(1052)
<223> OTHER INFORMATION: UNA monomer
<220> FEATURE:
<221> NAME/KEY: modified_base
<222> LOCATION: (1058)..(1058)
<223> OTHER INFORMATION: UNA monomer
<220> FEATURE:
<221> NAME/KEY: modified_base
<222> LOCATION: (1060)..(1060)
<223> OTHER INFORMATION: UNA monomer
<220> FEATURE:
<221> NAME/KEY: modified_base
<222> LOCATION: (1070)..(1070)
<223> OTHER INFORMATION: UNA monomer
<220> FEATURE:
<221> NAME/KEY: modified_base <222> LOCATION: (1074)..(1074)
<223> OTHER INFORMATION: UNA monomer
<220> FEATURE:
<221> NAME/KEY: modified_base
<222> LOCATION: (1080)..(1080)
<223> OTHER INFORMATION: UNA monomer
<220> FEATURE:
<221> NAME/KEY: modified_base
<222> LOCATION: (1082)..(1082)
<223> OTHER INFORMATION: UNA monomer
<220> FEATURE:
<221> NAME/KEY: modified_base
<222> LOCATION: (1085)..(1085)
<223> OTHER INFORMATION: UNA monomer
<220> FEATURE:
<221> NAME/KEY: modified_base
<222> LOCATION: (1091)..(1091)
<223> OTHER INFORMATION: UNA monomer
<220> FEATURE:
<221> NAME/KEY: modified_base
<222> LOCATION: (1107)..(1107)
<223> OTHER INFORMATION: UNA monomer
<220> FEATURE:
<221> NAME/KEY: modified_base
<222> LOCATION: (1113)..(1113)
<223> OTHER INFORMATION: UNA monomer
<220> FEATURE:
<221> NAME/KEY: modified_base
<222> LOCATION: (1116)..(1116)
<223> OTHER INFORMATION: UNA monomer
<220> FEATURE:
<221> NAME/KEY: modified_base
<222> LOCATION: (1124)..(1124)
<223> OTHER INFORMATION: UNA monomer
<220> FEATURE:
<221> NAME/KEY: modified_base
<222> LOCATION: (1126)..(1130)
<223> OTHER INFORMATION: UNA monomer
<220> FEATURE:
<221> NAME/KEY: modified_base
<222> LOCATION: (1139)..(1139)
<223> OTHER INFORMATION: UNA monomer
<220> FEATURE:
<221> NAME/KEY: modified_base
<222> LOCATION: (1145)..(1145)
<223> OTHER INFORMATION: UNA monomer
<220> FEATURE:
<221> NAME/KEY: modified_base
<222> LOCATION: (1147)..(1147)
<223> OTHER INFORMATION: UNA monomer
<220> FEATURE:
<221> NAME/KEY: modified_base
<222> LOCATION: (1149)..(1149)
<223> OTHER INFORMATION: UNA monomer
<220> FEATURE:
<221> NAME/KEY: modified_base
<222> LOCATION: (1151)..(1151)
<223> OTHER INFORMATION: UNA monomer
<220> FEATURE:
<221> NAME/KEY: modified_base
<222> LOCATION: (1163)..(1163)
<223> OTHER INFORMATION: UNA monomer
<220> FEATURE:
<221> NAME/KEY: modified_base
<222> LOCATION: (1168)..(1169)
<223> OTHER INFORMATION: UNA monomer
<220> FEATURE:
<221> NAME/KEY: modified_base
<222> LOCATION: (1180)..(1182)
<223> OTHER INFORMATION: UNA monomer
<220> FEATURE:
<221> NAME/KEY: modified_base
<222> LOCATION: (1184)..(1184)
<223> OTHER INFORMATION: UNA monomer
<220> FEATURE:
<221> NAME/KEY: modified_base
<222> LOCATION: (1186)..(1187)
<223> OTHER INFORMATION: UNA monomer
<220> FEATURE:

<221> NAME/KEY: modified_base
<222> LOCATION: (1189)..(1190)
<223> OTHER INFORMATION: UNA monomer
<220> FEATURE:
<221> NAME/KEY: modified_base
<222> LOCATION: (1193)..(1193)
<223> OTHER INFORMATION: UNA monomer
<220> FEATURE:
<221> NAME/KEY: modified_base
<222> LOCATION: (1196)..(1197)
<223> OTHER INFORMATION: UNA monomer
<220> FEATURE:
<221> NAME/KEY: modified_base
<222> LOCATION: (1206)..(1206)
<223> OTHER INFORMATION: UNA monomer
<220> FEATURE:
<221> NAME/KEY: modified_base
<222> LOCATION: (1213)..(1213)
<223> OTHER INFORMATION: UNA monomer
<220> FEATURE:
<221> NAME/KEY: modified_base
<222> LOCATION: (1215)..(1215)
<223> OTHER INFORMATION: UNA monomer
<220> FEATURE:
<221> NAME/KEY: modified_base
<222> LOCATION: (1220)..(1220)
<223> OTHER INFORMATION: UNA monomer
<220> FEATURE:
<221> NAME/KEY: modified_base
<222> LOCATION: (1222)..(1223)
<223> OTHER INFORMATION: UNA monomer
<220> FEATURE:
<221> NAME/KEY: modified_base
<222> LOCATION: (1226)..(1226)
<223> OTHER INFORMATION: UNA monomer
<220> FEATURE:
<221> NAME/KEY: modified_base
<222> LOCATION: (1235)..(1235)
<223> OTHER INFORMATION: UNA monomer
<220> FEATURE:
<221> NAME/KEY: modified_base
<222> LOCATION: (1238)..(1238)
<223> OTHER INFORMATION: UNA monomer
<220> FEATURE:
<221> NAME/KEY: modified_base
<222> LOCATION: (1242)..(1242)
<223> OTHER INFORMATION: UNA monomer
<220> FEATURE:
<221> NAME/KEY: modified_base
<222> LOCATION: (1255)..(1255)
<223> OTHER INFORMATION: UNA monomer

<400> SEQUENCE: 20 augccgucuu cugucucgug gggcauccuc cugcuggcag gccugugcug ccuggucccu 60 gucucccugg cugaggaucc ccagggagau gcugcccaga agacagauac aucccaccau 120 gaucaggauc acccaaccuu caacaagauc acccccaacc uggcugaguu cgccuucagc 180 cuauaccgcc agcuggcaca ccaguccaac agcaccaaua ucuucuucuc cccagugagc 240 aucgcuacag ccuuugcaau gcucucccug gggaccaagg cugacacuca cgaugaaauc 300 cuggagggcc ugaauuucaa ccucacggag auuccggagg cucagaucca ugaaggcuuc 360 caggaacucc uccguacccu caaccagcca gacagccagc uccagcugac caccggcaau 420 ggccuguucc ucagcgaggg ccugaagcua guggauaagu uuuuggagga uguuaaaaag 480 uuguaccacu cagaagccuu cacugucaac uucggggaca ccgaagaggc caagaaacag 540 aucaacgauu acguggagaa ggguacucaa gggaaaauug uggauuuggu caaggagcuu 600 gacagagaca caguuuuugc ucuggugaau uacaucuucu uuaaaggcaa augggagaga 660 cccuuugaag ucaaggacac cgaggaagag gacuuccacg uggaccaggu gaccaccgug 720 aaggugccua ugaugaagcg uuuaggcaug uuuaacaucc agcacuguaa gaagcugucc 780 agcugggugc ugcugaugaa auaccugggc aaugccaccg ccaucuucuu ccugccugau 840 gaggggaaac uacagcaccu ggaaaaugaa cucacccacg auaucaucac caaguuccug 900 gaaaaugaag acagaagguc ugccagcuua cauuuaccca aacuguccau uacuggaacc 960 uaugaucuga agagcguccu gggucaacug ggcaucacua aggucuucag caaugggcu 1020 gaccucuccg gggucacaga ggaggcaccc cugaagcucu ccaaggccgu gcauaaggcu 1080 gugcugacca ucgacgagaa agggacugaa gcugcugggg ccauguuuuu agaggccaua 1140 cccaugucua ucccccccga ggucaaguuc aacaaacccu uugucuucuu aaugauugaa 1200 caaaauacca agucuccccu cuucauggga aaagugguga aucccaccca aaaauaa 1257

<210> SEQ ID NO 21
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide

<400> SEQUENCE: 21 ggcaccacca cugaccuggg acagugaauc gacagccgac c 41

<210> SEQ ID NO 22
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (40)..(41)
<223> OTHER INFORMATION: UNA monomer

<400> SEQUENCE: 22 ggcaccacca cugaccuggg acagugaauc gacagccgac c 41

<210> SEQ ID NO 23
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (38)..(39)
<223> OTHER INFORMATION: UNA monomer

<400> SEQUENCE: 23 ggcaccacca cugaccuggg acagugaauc gacagccgac c 41

<210> SEQ ID NO 24
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (36)..(37)
<223> OTHER INFORMATION: UNA monomer

<400> SEQUENCE: 24 ggcaccacca cugaccuggg acagugaauc gacagccgac c 41

<210> SEQ ID NO 25
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (34)..(35)
<223> OTHER INFORMATION: UNA monomer

<400> SEQUENCE: 25 ggcaccacca cugaccuggg acagugaauc gacagccgac c 41

<210> SEQ ID NO 26
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (32)..(33)
<223> OTHER INFORMATION: UNA monomer

<400> SEQUENCE: 26 ggcaccacca cugaccuggg acagugaauc gacagccgac c 41

<210> SEQ ID NO 27
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (30)..(31)
<223> OTHER INFORMATION: UNA monomer

<400> SEQUENCE: 27 ggcaccacca cugaccuggg acagugaauc gacagccgac c 41

<210> SEQ ID NO 28
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (28)..(29)
<223> OTHER INFORMATION: UNA monomer

<400> SEQUENCE: 28 ggcaccacca cugaccuggg acagugaauc gacagccgac c 41

<210> SEQ ID NO 29
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:

<221> NAME/KEY: modified_base
<222> LOCATION: (26)..(27)
<223> OTHER INFORMATION: UNA monomer

<400> SEQUENCE: 29 ggcaccacca cugaccuggg acagugaauc gacagccgac c 41

<210> SEQ ID NO 30
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (24)..(25)
<223> OTHER INFORMATION: UNA monomer

<400> SEQUENCE: 30 ggcaccacca cugaccuggg acagugaauc gacagccgac c 41

<210> SEQ ID NO 31
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (22)..(23)
<223> OTHER INFORMATION: UNA monomer

<400> SEQUENCE: 31 ggcaccacca cugaccuggg acagugaauc gacagccgac c 41

<210> SEQ ID NO 32
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (20)..(21)
<223> OTHER INFORMATION: UNA monomer

<400> SEQUENCE: 32 ggcaccacca cugaccuggg acagugaauc gacagccgac c 41

<210> SEQ ID NO 33
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (18)..(19)
<223> OTHER INFORMATION: UNA monomer

<400> SEQUENCE: 33 ggcaccacca cugaccuggg acagugaauc gacagccgac c 41

<210> SEQ ID NO 34
<211> LENGTH: 41

<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (16)..(17)
<223> OTHER INFORMATION: UNA monomer

<400> SEQUENCE: 34 ggcaccacca cugaccuggg acagugaauc gacagccgac c 41

<210> SEQ ID NO 35
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (14)..(15)
<223> OTHER INFORMATION: UNA monomer

<400> SEQUENCE: 35 ggcaccacca cugaccuggg acagugaauc gacagccgac c 41

<210> SEQ ID NO 36
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (12)..(13)
<223> OTHER INFORMATION: UNA monomer

<400> SEQUENCE: 36 ggcaccacca cugaccuggg acagugaauc gacagccgac c 41

<210> SEQ ID NO 37
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (10)..(11)
<223> OTHER INFORMATION: UNA monomer

<400> SEQUENCE: 37 ggcaccacca cugaccuggg acagugaauc gacagccgac c 41

<210> SEQ ID NO 38
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (8)..(9)
<223> OTHER INFORMATION: UNA monomer

<400> SEQUENCE: 38 ggcaccacca cugaccuggg acagugaauc gacagccgac c 41

<210> SEQ ID NO 39
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (6)..(7)
<223> OTHER INFORMATION: UNA monomer

<400> SEQUENCE: 39 ggcaccacca cugaccuggg acagugaauc gacagccgac c 41

<210> SEQ ID NO 40
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (4)..(5)
<223> OTHER INFORMATION: UNA monomer

<400> SEQUENCE: 40 ggcaccacca cugaccuggg acagugaauc gacagccgac c 41

<210> SEQ ID NO 41
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(3)
<223> OTHER INFORMATION: UNA monomer

<400> SEQUENCE: 41 ggcaccacca cugaccuggg acagugaauc gacagccgac c 41

<210> SEQ ID NO 42
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (39)..(39)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 42 ggcaccacca cugaccuggg acagugaauc gacagccgac c 41

<210> SEQ ID NO 43
<211> LENGTH: 41
<212> TYPE: RNA

<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (38)..(38)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 43 ggcaccacca cugaccuggg acagugaauc gacagccgac c 41

<210> SEQ ID NO 44
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (37)..(37)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 44 ggcaccacca cugaccuggg acagugaauc gacagccgac c 41

<210> SEQ ID NO 45
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (36)..(36)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 45 ggcaccacca cugaccuggg acagugaauc gacagccgac c 41

<210> SEQ ID NO 46
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (35)..(35)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 46 ggcaccacca cugaccuggg acagugaauc gacagccgac c 41

<210> SEQ ID NO 47
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (34)..(34)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 47 ggcaccacca cugaccuggg acagugaauc gacagccgac c 41

<210> SEQ ID NO 48
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (33)..(33)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 48 ggcaccacca cugaccuggg acagugaauc gacagccgac c 41

<210> SEQ ID NO 49
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (32)..(32)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 49 ggcaccacca cugaccuggg acagugaauc gacagccgac c 41

<210> SEQ ID NO 50
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (31)..(31)
<223> OTHER INFORMATION: UNA monomer
<220> FEATURE:
<221> NAME/KEY: modified_base
<222> LOCATION: (41)..(41)

<223> OTHER INFORMATION: UNA monomer

<400> SEQUENCE: 50 ggcaccacca cugaccuggg acagugaauc gacagccgac c 41

<210> SEQ ID NO 51
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (30)..(30)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 51 ggcaccacca cugaccuggg acagugaauc gacagccgac c 41

<210> SEQ ID NO 52
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (29)..(29)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 52 ggcaccacca cugaccuggg acagugaauc gacagccgac c 41

<210> SEQ ID NO 53
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (28)..(28)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 53 ggcaccacca cugaccuggg acagugaauc gacagccgac c 41

<210> SEQ ID NO 54
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base <222> LOCATION: (27)..(27)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 54 ggcaccacca cugaccuggg acagugaauc gacagccgac c 41

<210> SEQ ID NO 55
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (26)..(26)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 55 ggcaccacca cugaccuggg acagugaauc gacagccgac c 41

<210> SEQ ID NO 56
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (25)..(25)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 56 ggcaccacca cugaccuggg acagugaauc gacagccgac c 41

<210> SEQ ID NO 57
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (24)..(24)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 57 ggcaccacca cugaccuggg acagugaauc gacagccgac c 41

<210> SEQ ID NO 58
<211> LENGTH: 41
<212> TYPE: RNA
<213> ORGANISM: Artificial Sequence <220> FEATURE:
<223> OTHER INFORMATION: Description of Artificial Sequence: Synthetic
oligonucleotide
<220> FEATURE:
<221> NAME/KEY: modified_base
<222> LOCATION: (23)..(23)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 58 ggcaccacca cugaccuggg acagugaauc gacagccgac c 41

<210> SEQ ID NO 59
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (22)..(22)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 59 ggcaccacca cugaccuggg acagugaauc gacagccgac c 41

<210> SEQ ID NO 60
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (21)..(21)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 60 ggcaccacca cugaccuggg acagugaauc gacagccgac c 41

<210> SEQ ID NO 61
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (20)..(20)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 61 ggcaccacca cugaccuggg acagugaauc gacagccgac c 41

<210> SEQ ID NO 62
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (19)..(19)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 62 ggcaccacca cugaccuggg acagugaauc gacagccgac c 41

<210> SEQ ID NO 63
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (18)..(18)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 63 ggcaccacca cugaccuggg acagugaauc gacagccgac c 41

<210> SEQ ID NO 64
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (17)..(17)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 64 ggcaccacca cugaccuggg acagugaauc gacagccgac c 41

<210> SEQ ID NO 65
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (16)..(16)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 65 ggcaccacca cugaccuggg acagugaauc gacagccgac c 41

<210> SEQ ID NO 66
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (15)..(15)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 66 ggcaccacca cugaccuggg acagugaauc gacagccgac c 41

<210> SEQ ID NO 67
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 67 ggcaccacca cugaccuggg acagugaauc gacagccgac c 41

<210> SEQ ID NO 68
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (13)..(13)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 68 ggcaccacca cugaccuggg acagugaauc gacagccgac c 41

<210> SEQ ID NO 69
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (12)..(12)

<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 69 ggcaccacca cugaccuggg acagugaauc gacagccgac c 41

<210> SEQ ID NO 70
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (11)..(11)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 70 ggcaccacca cugaccuggg acagugaauc gacagccgac c 41

<210> SEQ ID NO 71
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (10)..(10)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 71 ggcaccacca cugaccuggg acagugaauc gacagccgac c 41

<210> SEQ ID NO 72
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (9)..(9)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 72 ggcaccacca cugaccuggg acagugaauc gacagccgac c 41

<210> SEQ ID NO 73
<211> LENGTH: 41
<212> TYPE: RNA
<213> ORGANISM: Artificial Sequence
<220> FEATURE:

<223> OTHER INFORMATION: Description of Artificial Sequence: Synthetic
oligonucleotide
<220> FEATURE:
<221> NAME/KEY: modified_base
<222> LOCATION: (8)..(8)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 73 ggcaccacca cugaccuggg acagugaauc gacagccgac c 41

<210> SEQ ID NO 74
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (7)..(7)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 74 ggcaccacca cugaccuggg acagugaauc gacagccgac c 41

<210> SEQ ID NO 75
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (6)..(6)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 75 ggcaccacca cugaccuggg acagugaauc gacagccgac c 41

<210> SEQ ID NO 76
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (5)..(5)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 76 ggcaccacca cugaccuggg acagugaauc gacagccgac c 41

<210> SEQ ID NO 77
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (4)..(4)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 77 ggcaccacca cugaccuggg acagugaauc gacagccgac c 41

<210> SEQ ID NO 78
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (3)..(3)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 78 ggcaccacca cugaccuggg acagugaauc gacagccgac c 41

<210> SEQ ID NO 79
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 79 ggcaccacca cugaccuggg acagugaauc gacagccgac c 41

<210> SEQ ID NO 80
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (39)..(41)
<223> OTHER INFORMATION: UNA monomer

<400> SEQUENCE: 80 ggcaccacca cugaccuggg acagugaauc gacagccgac c 41

<210> SEQ ID NO 81
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (36)..(38)
<223> OTHER INFORMATION: UNA monomer

<400> SEQUENCE: 81 ggcaccacca cugaccuggg acagugaauc gacagccgac c 41

<210> SEQ ID NO 82
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (33)..(35)
<223> OTHER INFORMATION: UNA monomer

<400> SEQUENCE: 82 ggcaccacca cugaccuggg acagugaauc gacagccgac c 41

<210> SEQ ID NO 83
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (30)..(32)
<223> OTHER INFORMATION: UNA monomer

<400> SEQUENCE: 83 ggcaccacca cugaccuggg acagugaauc gacagccgac c 41

<210> SEQ ID NO 84
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (27)..(29)
<223> OTHER INFORMATION: UNA monomer

<400> SEQUENCE: 84 ggcaccacca cugaccuggg acagugaauc gacagccgac c 41

<210> SEQ ID NO 85
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (24)..(26)

<223> OTHER INFORMATION: UNA monomer

<400> SEQUENCE: 85 ggcaccacca cugaccuggg acagugaauc gacagccgac c 41

<210> SEQ ID NO 86
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (21)..(23)
<223> OTHER INFORMATION: UNA monomer

<400> SEQUENCE: 86 ggcaccacca cugaccuggg acagugaauc gacagccgac c 41

<210> SEQ ID NO 87
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (18)..(20)
<223> OTHER INFORMATION: UNA monomer

<400> SEQUENCE: 87 ggcaccacca cugaccuggg acagugaauc gacagccgac c 41

<210> SEQ ID NO 88
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (15)..(17)
<223> OTHER INFORMATION: UNA monomer

<400> SEQUENCE: 88 ggcaccacca cugaccuggg acagugaauc gacagccgac c 41

<210> SEQ ID NO 89
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (12)..(14)
<223> OTHER INFORMATION: UNA monomer

<400> SEQUENCE: 89 ggcaccacca cugaccuggg acagugaauc gacagccgac c 41

<210> SEQ ID NO 90
<211> LENGTH: 41
<212> TYPE: RNA
<213> ORGANISM: Artificial Sequence <220> FEATURE:
<223> OTHER INFORMATION: Description of Artificial Sequence: Synthetic
oligonucleotide
<220> FEATURE:
<221> NAME/KEY: modified_base
<222> LOCATION: (9)..(11)
<223> OTHER INFORMATION: UNA monomer

<400> SEQUENCE: 90 ggcaccacca cugaccuggg acagugaauc gacagccgac c 41

<210> SEQ ID NO 91
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (6)..(8)
<223> OTHER INFORMATION: UNA monomer

<400> SEQUENCE: 91 ggcaccacca cugaccuggg acagugaauc gacagccgac c 41

<210> SEQ ID NO 92
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (3)..(5)
<223> OTHER INFORMATION: UNA monomer

<400> SEQUENCE: 92 ggcaccacca cugaccuggg acagugaauc gacagccgac c 41

<210> SEQ ID NO 93
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (39)..(39)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 93 ggcaccacca cugaccuggg acagugaauc gacagccgac c 41

<210> SEQ ID NO 94
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide <220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (38)..(38)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 94 ggcaccacca cugaccuggg acagugaauc gacagccgac c 41

<210> SEQ ID NO 95
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (37)..(37)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 95 ggcaccacca cugaccuggg acagugaauc gacagccgac c 41

<210> SEQ ID NO 96
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (36)..(36)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 96 ggcaccacca cugaccuggg acagugaauc gacagccgac c 41

<210> SEQ ID NO 97
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer <220> FEATURE:
<221> NAME/KEY: modified_base
<222> LOCATION: (35)..(35)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 97 ggcaccacca cugaccuggg acagugaauc gacagccgac c 41

<210> SEQ ID NO 98
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (34)..(34)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 98 ggcaccacca cugaccuggg acagugaauc gacagccgac c 41

<210> SEQ ID NO 99
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (33)..(33)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 99 ggcaccacca cugaccuggg acagugaauc gacagccgac c 41

<210> SEQ ID NO 100
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (32)..(32)
<223> OTHER INFORMATION: UNA monomer <220> FEATURE:
<221> NAME/KEY: modified_base
<222> LOCATION: (41)..(41)
<223> OTHER INFORMATION: UNA monomer

<400> SEQUENCE: 100 ggcaccacca cugaccuggg acagugaauc gacagccgac c 41

<210> SEQ ID NO 101
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (31)..(31)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 101 ggcaccacca cugaccuggg acagugaauc gacagccgac c 41

<210> SEQ ID NO 102
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (30)..(30)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 102 ggcaccacca cugaccuggg acagugaauc gacagccgac c 41

<210> SEQ ID NO 103
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (29)..(29)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 103 ggcaccacca cugaccuggg acagugaauc gacagccgac c 41

<210> SEQ ID NO 104
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (28)..(28)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 104 ggcaccacca cugaccuggg acagugaauc gacagccgac c 41

<210> SEQ ID NO 105
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (27)..(27)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 105 ggcaccacca cugaccuggg acagugaauc gacagccgac c 41

<210> SEQ ID NO 106
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (26)..(26)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 106 ggcaccacca cugaccuggg acagugaauc gacagccgac c 41

<210> SEQ ID NO 107
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (25)..(25)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 107 ggcaccacca cugaccuggg acagugaauc gacagccgac c 41

<210> SEQ ID NO 108
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (24)..(24)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 108 ggcaccacca cugaccuggg acagugaauc gacagccgac c 41

<210> SEQ ID NO 109
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (23)..(23)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 109 ggcaccacca cugaccuggg acagugaauc gacagccgac c 41

<210> SEQ ID NO 110
<211> LENGTH: 41

<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (22)..(22)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 110 ggcaccacca cugaccuggg acagugaauc gacagccgac c 41

<210> SEQ ID NO 111
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (21)..(21)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 111 ggcaccacca cugaccuggg acagugaauc gacagccgac c 41

<210> SEQ ID NO 112
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (20)..(20)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 112 ggcaccacca cugaccuggg acagugaauc gacagccgac c 41

<210> SEQ ID NO 113
<211> LENGTH: 41
<212> TYPE: RNA
<213> ORGANISM: Artificial Sequence
<220> FEATURE:
<223> OTHER INFORMATION: Description of Artificial Sequence: Synthetic oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (19)..(19)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 113 ggcaccacca cugaccuggg acagugaauc gacagccgac c 41

<210> SEQ ID NO 114
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (18)..(18)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 114 ggcaccacca cugaccuggg acagugaauc gacagccgac c 41

<210> SEQ ID NO 115
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (17)..(17)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 115 ggcaccacca cugaccuggg acagugaauc gacagccgac c 41

<210> SEQ ID NO 116
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)

<223> OTHER INFORMATION: UNA monomer
<220> FEATURE:
<221> NAME/KEY: modified_base
<222> LOCATION: (16)..(16)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 116 ggcaccacca cugaccuggg acagugaauc gacagccgac c 41

<210> SEQ ID NO 117
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (15)..(15)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 117 ggcaccacca cugaccuggg acagugaauc gacagccgac c 41

<210> SEQ ID NO 118
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 118 ggcaccacca cugaccuggg acagugaauc gacagccgac c 41

<210> SEQ ID NO 119
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (13)..(13)

<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 119 ggcaccacca cugaccuggg acagugaauc gacagccgac c 41

<210> SEQ ID NO 120
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (12)..(12)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 120 ggcaccacca cugaccuggg acagugaauc gacagccgac c 41

<210> SEQ ID NO 121
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (11)..(11)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 121 ggcaccacca cugaccuggg acagugaauc gacagccgac c 41

<210> SEQ ID NO 122
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (10)..(10)
<223> OTHER INFORMATION: UNA monomer
<220> FEATURE:
<221> NAME/KEY: modified_base
<222> LOCATION: (41)..(41)

<223> OTHER INFORMATION: UNA monomer

<400> SEQUENCE: 122 ggcaccacca cugaccuggg acagugaauc gacagccgac c 41

<210> SEQ ID NO 123
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (9)..(9)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 123 ggcaccacca cugaccuggg acagugaauc gacagccgac c 41

<210> SEQ ID NO 124
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (8)..(8)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 124 ggcaccacca cugaccuggg acagugaauc gacagccgac c 41

<210> SEQ ID NO 125
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (7)..(7)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 125 ggcaccacca cugaccuggg acagugaauc gacagccgac c 41

<210> SEQ ID NO 126
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (6)..(6)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 126 ggcaccacca cugaccuggg acagugaauc gacagccgac c 41

<210> SEQ ID NO 127
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (5)..(5)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 127 ggcaccacca cugaccuggg acagugaauc gacagccgac c 41

<210> SEQ ID NO 128
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (4)..(4)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 128 ggcaccacca cugaccuggg acagugaauc gacagccgac c 41

<210> SEQ ID NO 129

<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (2)..(3)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 129 ggcaccacca cugaccuggg acagugaauc gacagccgac c 41

<210> SEQ ID NO 130
<211> LENGTH: 41
<212> TYPE: RNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (1)..(2)
<223> OTHER INFORMATION: UNA monomer
<220> FEATURE:
<221> NAME/KEY: modified_base
<222> LOCATION: (41)..(41)
<223> OTHER INFORMATION: UNA monomer

<400> SEQUENCE: 130 ggcaccacca cugaccuggg acagugaauc gacagccgac c 41

<210> SEQ ID NO 131
<211> LENGTH: 582
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (579)..(581)
<223> OTHER INFORMATION: UNA monomer

<400> SEQUENCE: 131 augggggugc acgaaugucc ugccuggcug uggcuucucc ugucccugcu gucgcucccu 60 cugggccucc caguccuggg cgccccacca cgccucaucu gugacagccg aguccuggag 120 agguaccucu uggaggccaa ggaggccgag aauaucacga cgggcugugc ugaacacugc 180 agcuugaaug agaauaucac uguccccagac accaaaguua auuucuaugc cuggaagagg 240 auggaggucg ggcagcaggc cguagaaguc uggcagggcc uggcccugcu gucggaagcu 300 guccugcggg gccaggcccu guuggucaac ucuucccagc cgugggagcc ccugcagcug 360 cauguggaua aagccgucag uggccuucgc agccucacca cucugcuucg ggcucuggga 420 gcccagaagg aagccaucuc cccuccagau gcggccucag cugcuccacu ccgaacaauc 480 acugcugaca cuuuccgcaa acucuuccga gucuacucca auuuccuccg gggaaagcug 540 aagcuguaca caggggaggc cugcaggaca ggggacagau ga 582

<210> SEQ ID NO 132
<211> LENGTH: 582
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (3)..(3)
<223> OTHER INFORMATION: UNA monomer
<220> FEATURE:
<221> NAME/KEY: modified_base
<222> LOCATION: (15)..(15)
<223> OTHER INFORMATION: UNA monomer
<220> FEATURE:
<221> NAME/KEY: modified_base
<222> LOCATION: (27)..(27)
<223> OTHER INFORMATION: UNA monomer
<220> FEATURE:
<221> NAME/KEY: modified_base
<222> LOCATION: (39)..(39)
<223> OTHER INFORMATION: UNA monomer
<220> FEATURE:
<221> NAME/KEY: modified_base
<222> LOCATION: (51)..(51)
<223> OTHER INFORMATION: UNA monomer
<220> FEATURE:
<221> NAME/KEY: modified_base
<222> LOCATION: (63)..(63)
<223> OTHER INFORMATION: UNA monomer
<220> FEATURE:
<221> NAME/KEY: modified_base
<222> LOCATION: (75)..(75)
<223> OTHER INFORMATION: UNA monomer
<220> FEATURE:
<221> NAME/KEY: modified_base
<222> LOCATION: (87)..(87)
<223> OTHER INFORMATION: UNA monomer
<220> FEATURE:
<221> NAME/KEY: modified_base
<222> LOCATION: (99)..(99)
<223> OTHER INFORMATION: UNA monomer
<220> FEATURE:
<221> NAME/KEY: modified_base
<222> LOCATION: (111)..(111)
<223> OTHER INFORMATION: UNA monomer
<220> FEATURE:
<221> NAME/KEY: modified_base
<222> LOCATION: (123)..(123)
<223> OTHER INFORMATION: UNA monomer
<220> FEATURE:
<221> NAME/KEY: modified_base
<222> LOCATION: (135)..(135)
<223> OTHER INFORMATION: UNA monomer
<220> FEATURE:
<221> NAME/KEY: modified_base
<222> LOCATION: (147)..(147)
<223> OTHER INFORMATION: UNA monomer
<220> FEATURE:
<221> NAME/KEY: modified_base
<222> LOCATION: (159)..(159)
<223> OTHER INFORMATION: UNA monomer
<220> FEATURE:
<221> NAME/KEY: modified_base
<222> LOCATION: (171)..(171)
<223> OTHER INFORMATION: UNA monomer
<220> FEATURE:
<221> NAME/KEY: modified_base
<222> LOCATION: (183)..(183)
<223> OTHER INFORMATION: UNA monomer
<220> FEATURE:
<221> NAME/KEY: modified_base
<222> LOCATION: (195)..(195)
<223> OTHER INFORMATION: UNA monomer
<220> FEATURE:
<221> NAME/KEY: modified_base
<222> LOCATION: (207)..(207)

<223> OTHER INFORMATION: UNA monomer
<220> FEATURE:
<221> NAME/KEY: modified_base
<222> LOCATION: (219)..(219)
<223> OTHER INFORMATION: UNA monomer
<220> FEATURE:
<221> NAME/KEY: modified_base
<222> LOCATION: (231)..(231)
<223> OTHER INFORMATION: UNA monomer
<220> FEATURE:
<221> NAME/KEY: modified_base
<222> LOCATION: (243)..(243)
<223> OTHER INFORMATION: UNA monomer
<220> FEATURE:
<221> NAME/KEY: modified_base
<222> LOCATION: (255)..(255)
<223> OTHER INFORMATION: UNA monomer
<220> FEATURE:
<221> NAME/KEY: modified_base
<222> LOCATION: (267)..(267)
<223> OTHER INFORMATION: UNA monomer
<220> FEATURE:
<221> NAME/KEY: modified_base
<222> LOCATION: (279)..(279)
<223> OTHER INFORMATION: UNA monomer
<220> FEATURE:
<221> NAME/KEY: modified_base
<222> LOCATION: (291)..(291)
<223> OTHER INFORMATION: UNA monomer
<220> FEATURE:
<221> NAME/KEY: modified_base
<222> LOCATION: (303)..(303)
<223> OTHER INFORMATION: UNA monomer
<220> FEATURE:
<221> NAME/KEY: modified_base
<222> LOCATION: (315)..(315)
<223> OTHER INFORMATION: UNA monomer
<220> FEATURE:
<221> NAME/KEY: modified_base
<222> LOCATION: (327)..(327)
<223> OTHER INFORMATION: UNA monomer
<220> FEATURE:
<221> NAME/KEY: modified_base
<222> LOCATION: (339)..(339)
<223> OTHER INFORMATION: UNA monomer
<220> FEATURE:
<221> NAME/KEY: modified_base
<222> LOCATION: (351)..(351)
<223> OTHER INFORMATION: UNA monomer
<220> FEATURE:
<221> NAME/KEY: modified_base
<222> LOCATION: (363)..(363)
<223> OTHER INFORMATION: UNA monomer
<220> FEATURE:
<221> NAME/KEY: modified_base
<222> LOCATION: (375)..(375)
<223> OTHER INFORMATION: UNA monomer
<220> FEATURE:
<221> NAME/KEY: modified_base
<222> LOCATION: (387)..(387)
<223> OTHER INFORMATION: UNA monomer
<220> FEATURE:
<221> NAME/KEY: modified_base
<222> LOCATION: (399)..(399)
<223> OTHER INFORMATION: UNA monomer
<220> FEATURE:
<221> NAME/KEY: modified_base
<222> LOCATION: (411)..(411)
<223> OTHER INFORMATION: UNA monomer
<220> FEATURE:
<221> NAME/KEY: modified_base
<222> LOCATION: (423)..(423)
<223> OTHER INFORMATION: UNA monomer
<220> FEATURE:
<221> NAME/KEY: modified_base
<222> LOCATION: (435)..(435)
<223> OTHER INFORMATION: UNA monomer
<220> FEATURE:
<221> NAME/KEY: modified_base <222> LOCATION: (447)..(447)
<223> OTHER INFORMATION: UNA monomer
<220> FEATURE:
<221> NAME/KEY: modified_base
<222> LOCATION: (459)..(459)
<223> OTHER INFORMATION: UNA monomer
<220> FEATURE:
<221> NAME/KEY: modified_base
<222> LOCATION: (471)..(471)
<223> OTHER INFORMATION: UNA monomer
<220> FEATURE:
<221> NAME/KEY: modified_base
<222> LOCATION: (483)..(483)
<223> OTHER INFORMATION: UNA monomer
<220> FEATURE:
<221> NAME/KEY: modified_base
<222> LOCATION: (495)..(495)
<223> OTHER INFORMATION: UNA monomer
<220> FEATURE:
<221> NAME/KEY: modified_base
<222> LOCATION: (507)..(507)
<223> OTHER INFORMATION: UNA monomer
<220> FEATURE:
<221> NAME/KEY: modified_base
<222> LOCATION: (519)..(519)
<223> OTHER INFORMATION: UNA monomer
<220> FEATURE:
<221> NAME/KEY: modified_base
<222> LOCATION: (531)..(531)
<223> OTHER INFORMATION: UNA monomer
<220> FEATURE:
<221> NAME/KEY: modified_base
<222> LOCATION: (543)..(543)
<223> OTHER INFORMATION: UNA monomer
<220> FEATURE:
<221> NAME/KEY: modified_base
<222> LOCATION: (555)..(555)
<223> OTHER INFORMATION: UNA monomer
<220> FEATURE:
<221> NAME/KEY: modified_base
<222> LOCATION: (567)..(567)
<223> OTHER INFORMATION: UNA monomer
<220> FEATURE:
<221> NAME/KEY: modified_base
<222> LOCATION: (579)..(579)
<223> OTHER INFORMATION: UNA monomer

<400> SEQUENCE: 132 augggggugc acgaaugucc ugccuggcug uggcuucucc ugucccugcu gucgcucccu 60 cugggccucc caguccuggg cgccccacca cgccucaucu gugacagccg aguccuggag 120 agguaccucu uggaggccaa ggaggccgag aauaucacga cgggcugugc ugaacacugc 180 agcuugaaug agaauaucac uguccccagac accaaaguua auuucuaugc cuggaagagg 240 auggaggucg ggcagcaggc cguagaaguc uggcagggcc uggcccugcu gucggaagcu 300 guccugcggg gccaggcccu guuggucaac ucuucccagc cgugggagcc ccugcagcug 360 cauguggaua aagccgucag uggccuucgc agccucacca cucugcuucg ggcucuggga 420 gcccagaagg aagccaucuc cccuccagau gcggccucag cugcuccacu ccgaacaauc 480 acugcugaca cuuuccgcaa acucuuccga gucuacucca auuuccuccg gggaaagcug 540 aagcuguaca caggggaggc cugcaggaca ggggacagau ga 582

<210> SEQ ID NO 133
<211> LENGTH: 582
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base <222> LOCATION: (2)..(2)
<223> OTHER INFORMATION: UNA monomer
<220> FEATURE:
<221> NAME/KEY: modified_base
<222> LOCATION: (8)..(8)
<223> OTHER INFORMATION: UNA monomer
<220> FEATURE:
<221> NAME/KEY: modified_base
<222> LOCATION: (16)..(16)
<223> OTHER INFORMATION: UNA monomer
<220> FEATURE:
<221> NAME/KEY: modified_base
<222> LOCATION: (18)..(18)
<223> OTHER INFORMATION: UNA monomer
<220> FEATURE:
<221> NAME/KEY: modified_base
<222> LOCATION: (21)..(21)
<223> OTHER INFORMATION: UNA monomer
<220> FEATURE:
<221> NAME/KEY: modified_base
<222> LOCATION: (25)..(25)
<223> OTHER INFORMATION: UNA monomer
<220> FEATURE:
<221> NAME/KEY: modified_base
<222> LOCATION: (29)..(29)
<223> OTHER INFORMATION: UNA monomer
<220> FEATURE:
<221> NAME/KEY: modified_base
<222> LOCATION: (31)..(31)
<223> OTHER INFORMATION: UNA monomer
<220> FEATURE:
<221> NAME/KEY: modified_base
<222> LOCATION: (35)..(36)
<223> OTHER INFORMATION: UNA monomer
<220> FEATURE:
<221> NAME/KEY: modified_base
<222> LOCATION: (38)..(38)
<223> OTHER INFORMATION: UNA monomer
<220> FEATURE:
<221> NAME/KEY: modified_base
<222> LOCATION: (41)..(41)
<223> OTHER INFORMATION: UNA monomer
<220> FEATURE:
<221> NAME/KEY: modified_base
<222> LOCATION: (43)..(43)
<223> OTHER INFORMATION: UNA monomer
<220> FEATURE:
<221> NAME/KEY: modified_base
<222> LOCATION: (47)..(47)
<223> OTHER INFORMATION: UNA monomer
<220> FEATURE:
<221> NAME/KEY: modified_base
<222> LOCATION: (50)..(50)
<223> OTHER INFORMATION: UNA monomer
<220> FEATURE:
<221> NAME/KEY: modified_base
<222> LOCATION: (52)..(52)
<223> OTHER INFORMATION: UNA monomer
<220> FEATURE:
<221> NAME/KEY: modified_base
<222> LOCATION: (56)..(56)
<223> OTHER INFORMATION: UNA monomer
<220> FEATURE:
<221> NAME/KEY: modified_base
<222> LOCATION: (60)..(60)
<223> OTHER INFORMATION: UNA monomer
<220> FEATURE:
<221> NAME/KEY: modified_base
<222> LOCATION: (62)..(62)
<223> OTHER INFORMATION: UNA monomer
<220> FEATURE:
<221> NAME/KEY: modified_base
<222> LOCATION: (68)..(68)
<223> OTHER INFORMATION: UNA monomer
<220> FEATURE:
<221> NAME/KEY: modified_base
<222> LOCATION: (74)..(74)
<223> OTHER INFORMATION: UNA monomer
<220> FEATURE:

<221> NAME/KEY: modified_base
<222> LOCATION: (77)..(77)
<223> OTHER INFORMATION: UNA monomer
<220> FEATURE:
<221> NAME/KEY: modified_base
<222> LOCATION: (95)..(95)
<223> OTHER INFORMATION: UNA monomer
<220> FEATURE:
<221> NAME/KEY: modified_base
<222> LOCATION: (98)..(98)
<223> OTHER INFORMATION: UNA monomer
<220> FEATURE:
<221> NAME/KEY: modified_base
<222> LOCATION: (100)..(100)
<223> OTHER INFORMATION: UNA monomer
<220> FEATURE:
<221> NAME/KEY: modified_base
<222> LOCATION: (102)..(102)
<223> OTHER INFORMATION: UNA monomer
<220> FEATURE:
<221> NAME/KEY: modified_base
<222> LOCATION: (113)..(113)
<223> OTHER INFORMATION: UNA monomer
<220> FEATURE:
<221> NAME/KEY: modified_base
<222> LOCATION: (116)..(116)
<223> OTHER INFORMATION: UNA monomer
<220> FEATURE:
<221> NAME/KEY: modified_base
<222> LOCATION: (124)..(124)
<223> OTHER INFORMATION: UNA monomer
<220> FEATURE:
<221> NAME/KEY: modified_base
<222> LOCATION: (128)..(128)
<223> OTHER INFORMATION: UNA monomer
<220> FEATURE:
<221> NAME/KEY: modified_base
<222> LOCATION: (130)..(131)
<223> OTHER INFORMATION: UNA monomer
<220> FEATURE:
<221> NAME/KEY: modified_base
<222> LOCATION: (153)..(153)
<223> OTHER INFORMATION: UNA monomer
<220> FEATURE:
<221> NAME/KEY: modified_base
<222> LOCATION: (155)..(155)
<223> OTHER INFORMATION: UNA monomer
<220> FEATURE:
<221> NAME/KEY: modified_base
<222> LOCATION: (166)..(166)
<223> OTHER INFORMATION: UNA monomer
<220> FEATURE:
<221> NAME/KEY: modified_base
<222> LOCATION: (168)..(168)
<223> OTHER INFORMATION: UNA monomer
<220> FEATURE:
<221> NAME/KEY: modified_base
<222> LOCATION: (171)..(171)
<223> OTHER INFORMATION: UNA monomer
<220> FEATURE:
<221> NAME/KEY: modified_base
<222> LOCATION: (178)..(178)
<223> OTHER INFORMATION: UNA monomer
<220> FEATURE:
<221> NAME/KEY: modified_base
<222> LOCATION: (184)..(185)
<223> OTHER INFORMATION: UNA monomer
<220> FEATURE:
<221> NAME/KEY: modified_base
<222> LOCATION: (189)..(189)
<223> OTHER INFORMATION: UNA monomer
<220> FEATURE:
<221> NAME/KEY: modified_base
<222> LOCATION: (195)..(195)
<223> OTHER INFORMATION: UNA monomer
<220> FEATURE:
<221> NAME/KEY: modified_base
<222> LOCATION: (197)..(197)
<223> OTHER INFORMATION: UNA monomer <220> FEATURE:
<221> NAME/KEY: modified_base
<222> LOCATION: (201)..(201)
<223> OTHER INFORMATION: UNA monomer
<220> FEATURE:
<221> NAME/KEY: modified_base
<222> LOCATION: (203)..(203)
<223> OTHER INFORMATION: UNA monomer
<220> FEATURE:
<221> NAME/KEY: modified_base
<222> LOCATION: (218)..(219)
<223> OTHER INFORMATION: UNA monomer
<220> FEATURE:
<221> NAME/KEY: modified_base
<222> LOCATION: (222)..(224)
<223> OTHER INFORMATION: UNA monomer
<220> FEATURE:
<221> NAME/KEY: modified_base
<222> LOCATION: (226)..(226)
<223> OTHER INFORMATION: UNA monomer
<220> FEATURE:
<221> NAME/KEY: modified_base
<222> LOCATION: (228)..(228)
<223> OTHER INFORMATION: UNA monomer
<220> FEATURE:
<221> NAME/KEY: modified_base
<222> LOCATION: (232)..(232)
<223> OTHER INFORMATION: UNA monomer
<220> FEATURE:
<221> NAME/KEY: modified_base
<222> LOCATION: (242)..(242)
<223> OTHER INFORMATION: UNA monomer
<220> FEATURE:
<221> NAME/KEY: modified_base
<222> LOCATION: (248)..(248)
<223> OTHER INFORMATION: UNA monomer
<220> FEATURE:
<221> NAME/KEY: modified_base
<222> LOCATION: (263)..(263)
<223> OTHER INFORMATION: UNA monomer
<220> FEATURE:
<221> NAME/KEY: modified_base
<222> LOCATION: (269)..(269)
<223> OTHER INFORMATION: UNA monomer
<220> FEATURE:
<221> NAME/KEY: modified_base
<222> LOCATION: (271)..(271)
<223> OTHER INFORMATION: UNA monomer
<220> FEATURE:
<221> NAME/KEY: modified_base
<222> LOCATION: (281)..(281)
<223> OTHER INFORMATION: UNA monomer
<220> FEATURE:
<221> NAME/KEY: modified_base
<222> LOCATION: (287)..(287)
<223> OTHER INFORMATION: UNA monomer
<220> FEATURE:
<221> NAME/KEY: modified_base
<222> LOCATION: (290)..(290)
<223> OTHER INFORMATION: UNA monomer
<220> FEATURE:
<221> NAME/KEY: modified_base
<222> LOCATION: (292)..(292)
<223> OTHER INFORMATION: UNA monomer
<220> FEATURE:
<221> NAME/KEY: modified_base
<222> LOCATION: (300)..(300)
<223> OTHER INFORMATION: UNA monomer
<220> FEATURE:
<221> NAME/KEY: modified_base
<222> LOCATION: (302)..(302)
<223> OTHER INFORMATION: UNA monomer
<220> FEATURE:
<221> NAME/KEY: modified_base
<222> LOCATION: (305)..(305)
<223> OTHER INFORMATION: UNA monomer
<220> FEATURE:
<221> NAME/KEY: modified_base
<222> LOCATION: (320)..(320)

<223> OTHER INFORMATION: UNA monomer
<220> FEATURE:
<221> NAME/KEY: modified_base
<222> LOCATION: (322)..(323)
<223> OTHER INFORMATION: UNA monomer
<220> FEATURE:
<221> NAME/KEY: modified_base
<222> LOCATION: (326)..(326)
<223> OTHER INFORMATION: UNA monomer
<220> FEATURE:
<221> NAME/KEY: modified_base
<222> LOCATION: (331)..(331)
<223> OTHER INFORMATION: UNA monomer
<220> FEATURE:
<221> NAME/KEY: modified_base
<222> LOCATION: (333)..(334)
<223> OTHER INFORMATION: UNA monomer
<220> FEATURE:
<221> NAME/KEY: modified_base
<222> LOCATION: (343)..(343)
<223> OTHER INFORMATION: UNA monomer
<220> FEATURE:
<221> NAME/KEY: modified_base
<222> LOCATION: (353)..(353)
<223> OTHER INFORMATION: UNA monomer
<220> FEATURE:
<221> NAME/KEY: modified_base
<222> LOCATION: (359)..(359)
<223> OTHER INFORMATION: UNA monomer
<220> FEATURE:
<221> NAME/KEY: modified_base
<222> LOCATION: (363)..(363)
<223> OTHER INFORMATION: UNA monomer
<220> FEATURE:
<221> NAME/KEY: modified_base
<222> LOCATION: (365)..(365)
<223> OTHER INFORMATION: UNA monomer
<220> FEATURE:
<221> NAME/KEY: modified_base
<222> LOCATION: (369)..(369)
<223> OTHER INFORMATION: UNA monomer
<220> FEATURE:
<221> NAME/KEY: modified_base
<222> LOCATION: (377)..(377)
<223> OTHER INFORMATION: UNA monomer
<220> FEATURE:
<221> NAME/KEY: modified_base
<222> LOCATION: (381)..(381)
<223> OTHER INFORMATION: UNA monomer
<220> FEATURE:
<221> NAME/KEY: modified_base
<222> LOCATION: (386)..(387)
<223> OTHER INFORMATION: UNA monomer
<220> FEATURE:
<221> NAME/KEY: modified_base
<222> LOCATION: (395)..(395)
<223> OTHER INFORMATION: UNA monomer
<220> FEATURE:
<221> NAME/KEY: modified_base
<222> LOCATION: (402)..(402)
<223> OTHER INFORMATION: UNA monomer
<220> FEATURE:
<221> NAME/KEY: modified_base
<222> LOCATION: (404)..(404)
<223> OTHER INFORMATION: UNA monomer
<220> FEATURE:
<221> NAME/KEY: modified_base
<222> LOCATION: (407)..(408)
<223> OTHER INFORMATION: UNA monomer
<220> FEATURE:
<221> NAME/KEY: modified_base
<222> LOCATION: (414)..(414)
<223> OTHER INFORMATION: UNA monomer
<220> FEATURE:
<221> NAME/KEY: modified_base
<222> LOCATION: (416)..(416)
<223> OTHER INFORMATION: UNA monomer
<220> FEATURE:
<221> NAME/KEY: modified_base <222> LOCATION: (437)..(437)
<223> OTHER INFORMATION: UNA monomer
<220> FEATURE:
<221> NAME/KEY: modified_base
<222> LOCATION: (439)..(439)
<223> OTHER INFORMATION: UNA monomer
<220> FEATURE:
<221> NAME/KEY: modified_base
<222> LOCATION: (444)..(444)
<223> OTHER INFORMATION: UNA monomer
<220> FEATURE:
<221> NAME/KEY: modified_base
<222> LOCATION: (450)..(450)
<223> OTHER INFORMATION: UNA monomer
<220> FEATURE:
<221> NAME/KEY: modified_base
<222> LOCATION: (457)..(457)
<223> OTHER INFORMATION: UNA monomer
<220> FEATURE:
<221> NAME/KEY: modified_base
<222> LOCATION: (462)..(462)
<223> OTHER INFORMATION: UNA monomer
<220> FEATURE:
<221> NAME/KEY: modified_base
<222> LOCATION: (465)..(465)
<223> OTHER INFORMATION: UNA monomer
<220> FEATURE:
<221> NAME/KEY: modified_base
<222> LOCATION: (470)..(470)
<223> OTHER INFORMATION: UNA monomer
<220> FEATURE:
<221> NAME/KEY: modified_base
<222> LOCATION: (479)..(479)
<223> OTHER INFORMATION: UNA monomer
<220> FEATURE:
<221> NAME/KEY: modified_base
<222> LOCATION: (483)..(483)
<223> OTHER INFORMATION: UNA monomer
<220> FEATURE:
<221> NAME/KEY: modified_base
<222> LOCATION: (486)..(486)
<223> OTHER INFORMATION: UNA monomer
<220> FEATURE:
<221> NAME/KEY: modified_base
<222> LOCATION: (492)..(494)
<223> OTHER INFORMATION: UNA monomer
<220> FEATURE:
<221> NAME/KEY: modified_base
<222> LOCATION: (503)..(503)
<223> OTHER INFORMATION: UNA monomer
<220> FEATURE:
<221> NAME/KEY: modified_base
<222> LOCATION: (505)..(506)
<223> OTHER INFORMATION: UNA monomer
<220> FEATURE:
<221> NAME/KEY: modified_base
<222> LOCATION: (512)..(512)
<223> OTHER INFORMATION: UNA monomer
<220> FEATURE:
<221> NAME/KEY: modified_base
<222> LOCATION: (514)..(514)
<223> OTHER INFORMATION: UNA monomer
<220> FEATURE:
<221> NAME/KEY: modified_base
<222> LOCATION: (517)..(517)
<223> OTHER INFORMATION: UNA monomer
<220> FEATURE:
<221> NAME/KEY: modified_base
<222> LOCATION: (522)..(524)
<223> OTHER INFORMATION: UNA monomer
<220> FEATURE:
<221> NAME/KEY: modified_base
<222> LOCATION: (527)..(527)
<223> OTHER INFORMATION: UNA monomer
<220> FEATURE:
<221> NAME/KEY: modified_base
<222> LOCATION: (539)..(539)
<223> OTHER INFORMATION: UNA monomer
<220> FEATURE:

<221> NAME/KEY: modified_base
<222> LOCATION: (545)..(545)
<223> OTHER INFORMATION: UNA monomer
<220> FEATURE:
<221> NAME/KEY: modified_base
<222> LOCATION: (547)..(547)
<223> OTHER INFORMATION: UNA monomer
<220> FEATURE:
<221> NAME/KEY: modified_base
<222> LOCATION: (562)..(562)
<223> OTHER INFORMATION: UNA monomer
<220> FEATURE:
<221> NAME/KEY: modified_base
<222> LOCATION: (580)..(580)
<223> OTHER INFORMATION: UNA monomer

<400> SEQUENCE: 133 augggggugc acgaaugucc ugccuggcug uggcuucucc uguccccugcu gucgcucccu 60 cugggccucc caguccuggg cgccccacca cgccucaucu gugacagccg aguccuggag 120 agguaccucu uggaggccaa ggaggccgag aauaucacga cgggcugugc ugaacacugc 180 agcuugaaug agaauaucac uguccccagac accaaaguua auuucuaugc cuggaagagg 240 auggaggucg ggcagcaggc cguagaaguc uggcagggcc uggcccugcu gucggaagcu 300 guccugcggg gccaggcccu guuggucaac ucuucccagc cgugggagcc ccugcagcug 360 cauguggaua aagccgucag uggccuucgc agccucacca cucugcuucg ggcucuggga 420 gcccagaagg aagccaucuc cccuccagau gcggccucag cugcuccacu ccgaacaauc 480 acugcugaca cuuuccgcaa acucuuccga gucuacucca auuuccuccg gggaaagcug 540 aagcuguaca caggggaggc cugcaggaca ggggacagau ga 582

<210> SEQ ID NO 134
<211> LENGTH: 1066
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (3)..(3)
<223> OTHER INFORMATION: UNA monomer
<220> FEATURE:
<221> NAME/KEY: modified_base
<222> LOCATION: (15)..(15)
<223> OTHER INFORMATION: UNA monomer
<220> FEATURE:
<221> NAME/KEY: modified_base
<222> LOCATION: (27)..(27)
<223> OTHER INFORMATION: UNA monomer
<220> FEATURE:
<221> NAME/KEY: modified_base
<222> LOCATION: (39)..(39)
<223> OTHER INFORMATION: UNA monomer
<220> FEATURE:
<221> NAME/KEY: modified_base
<222> LOCATION: (51)..(51)
<223> OTHER INFORMATION: UNA monomer
<220> FEATURE:
<221> NAME/KEY: modified_base
<222> LOCATION: (63)..(63)
<223> OTHER INFORMATION: UNA monomer
<220> FEATURE:
<221> NAME/KEY: modified_base
<222> LOCATION: (75)..(75)
<223> OTHER INFORMATION: UNA monomer
<220> FEATURE:
<221> NAME/KEY: modified_base
<222> LOCATION: (87)..(87)
<223> OTHER INFORMATION: UNA monomer
<220> FEATURE:

<221> NAME/KEY: modified_base
<222> LOCATION: (99)..(99)
<223> OTHER INFORMATION: UNA monomer
<220> FEATURE:
<221> NAME/KEY: modified_base
<222> LOCATION: (111)..(111)
<223> OTHER INFORMATION: UNA monomer
<220> FEATURE:
<221> NAME/KEY: modified_base
<222> LOCATION: (123)..(123)
<223> OTHER INFORMATION: UNA monomer
<220> FEATURE:
<221> NAME/KEY: modified_base
<222> LOCATION: (135)..(135)
<223> OTHER INFORMATION: UNA monomer
<220> FEATURE:
<221> NAME/KEY: modified_base
<222> LOCATION: (147)..(147)
<223> OTHER INFORMATION: UNA monomer
<220> FEATURE:
<221> NAME/KEY: modified_base
<222> LOCATION: (159)..(159)
<223> OTHER INFORMATION: UNA monomer
<220> FEATURE:
<221> NAME/KEY: modified_base
<222> LOCATION: (171)..(171)
<223> OTHER INFORMATION: UNA monomer
<220> FEATURE:
<221> NAME/KEY: modified_base
<222> LOCATION: (183)..(183)
<223> OTHER INFORMATION: UNA monomer
<220> FEATURE:
<221> NAME/KEY: modified_base
<222> LOCATION: (195)..(195)
<223> OTHER INFORMATION: UNA monomer
<220> FEATURE:
<221> NAME/KEY: modified_base
<222> LOCATION: (207)..(207)
<223> OTHER INFORMATION: UNA monomer
<220> FEATURE:
<221> NAME/KEY: modified_base
<222> LOCATION: (219)..(219)
<223> OTHER INFORMATION: UNA monomer
<220> FEATURE:
<221> NAME/KEY: modified_base
<222> LOCATION: (231)..(231)
<223> OTHER INFORMATION: UNA monomer
<220> FEATURE:
<221> NAME/KEY: modified_base
<222> LOCATION: (243)..(243)
<223> OTHER INFORMATION: UNA monomer
<220> FEATURE:
<221> NAME/KEY: modified_base
<222> LOCATION: (255)..(255)
<223> OTHER INFORMATION: UNA monomer
<220> FEATURE:
<221> NAME/KEY: modified_base
<222> LOCATION: (267)..(267)
<223> OTHER INFORMATION: UNA monomer
<220> FEATURE:
<221> NAME/KEY: modified_base
<222> LOCATION: (279)..(279)
<223> OTHER INFORMATION: UNA monomer
<220> FEATURE:
<221> NAME/KEY: modified_base
<222> LOCATION: (291)..(291)
<223> OTHER INFORMATION: UNA monomer
<220> FEATURE:
<221> NAME/KEY: modified_base
<222> LOCATION: (303)..(303)
<223> OTHER INFORMATION: UNA monomer
<220> FEATURE:
<221> NAME/KEY: modified_base
<222> LOCATION: (315)..(315)
<223> OTHER INFORMATION: UNA monomer
<220> FEATURE:
<221> NAME/KEY: modified_base
<222> LOCATION: (327)..(327)
<223> OTHER INFORMATION: UNA monomer <220> FEATURE:
<221> NAME/KEY: modified_base
<222> LOCATION: (339)..(339)
<223> OTHER INFORMATION: UNA monomer
<220> FEATURE:
<221> NAME/KEY: modified_base
<222> LOCATION: (351)..(351)
<223> OTHER INFORMATION: UNA monomer
<220> FEATURE:
<221> NAME/KEY: modified_base
<222> LOCATION: (363)..(363)
<223> OTHER INFORMATION: UNA monomer
<220> FEATURE:
<221> NAME/KEY: modified_base
<222> LOCATION: (375)..(375)
<223> OTHER INFORMATION: UNA monomer
<220> FEATURE:
<221> NAME/KEY: modified_base
<222> LOCATION: (387)..(387)
<223> OTHER INFORMATION: UNA monomer
<220> FEATURE:
<221> NAME/KEY: modified_base
<222> LOCATION: (399)..(399)
<223> OTHER INFORMATION: UNA monomer
<220> FEATURE:
<221> NAME/KEY: modified_base
<222> LOCATION: (411)..(411)
<223> OTHER INFORMATION: UNA monomer
<220> FEATURE:
<221> NAME/KEY: modified_base
<222> LOCATION: (423)..(423)
<223> OTHER INFORMATION: UNA monomer
<220> FEATURE:
<221> NAME/KEY: modified_base
<222> LOCATION: (435)..(435)
<223> OTHER INFORMATION: UNA monomer
<220> FEATURE:
<221> NAME/KEY: modified_base
<222> LOCATION: (447)..(447)
<223> OTHER INFORMATION: UNA monomer
<220> FEATURE:
<221> NAME/KEY: modified_base
<222> LOCATION: (459)..(459)
<223> OTHER INFORMATION: UNA monomer
<220> FEATURE:
<221> NAME/KEY: modified_base
<222> LOCATION: (471)..(471)
<223> OTHER INFORMATION: UNA monomer
<220> FEATURE:
<221> NAME/KEY: modified_base
<222> LOCATION: (483)..(483)
<223> OTHER INFORMATION: UNA monomer
<220> FEATURE:
<221> NAME/KEY: modified_base
<222> LOCATION: (495)..(495)
<223> OTHER INFORMATION: UNA monomer
<220> FEATURE:
<221> NAME/KEY: modified_base
<222> LOCATION: (507)..(507)
<223> OTHER INFORMATION: UNA monomer
<220> FEATURE:
<221> NAME/KEY: modified_base
<222> LOCATION: (519)..(519)
<223> OTHER INFORMATION: UNA monomer
<220> FEATURE:
<221> NAME/KEY: modified_base
<222> LOCATION: (531)..(531)
<223> OTHER INFORMATION: UNA monomer
<220> FEATURE:
<221> NAME/KEY: modified_base
<222> LOCATION: (543)..(543)
<223> OTHER INFORMATION: UNA monomer
<220> FEATURE:
<221> NAME/KEY: modified_base
<222> LOCATION: (555)..(555)
<223> OTHER INFORMATION: UNA monomer
<220> FEATURE:
<221> NAME/KEY: modified_base
<222> LOCATION: (567)..(567)

<223> OTHER INFORMATION: UNA monomer
<220> FEATURE:
<221> NAME/KEY: modified_base
<222> LOCATION: (579)..(579)
<223> OTHER INFORMATION: UNA monomer
<220> FEATURE:
<221> NAME/KEY: modified_base
<222> LOCATION: (591)..(591)
<223> OTHER INFORMATION: UNA monomer
<220> FEATURE:
<221> NAME/KEY: modified_base
<222> LOCATION: (603)..(603)
<223> OTHER INFORMATION: UNA monomer
<220> FEATURE:
<221> NAME/KEY: modified_base
<222> LOCATION: (615)..(615)
<223> OTHER INFORMATION: UNA monomer
<220> FEATURE:
<221> NAME/KEY: modified_base
<222> LOCATION: (627)..(627)
<223> OTHER INFORMATION: UNA monomer
<220> FEATURE:
<221> NAME/KEY: modified_base
<222> LOCATION: (639)..(639)
<223> OTHER INFORMATION: UNA monomer
<220> FEATURE:
<221> NAME/KEY: modified_base
<222> LOCATION: (651)..(651)
<223> OTHER INFORMATION: UNA monomer
<220> FEATURE:
<221> NAME/KEY: modified_base
<222> LOCATION: (663)..(663)
<223> OTHER INFORMATION: UNA monomer
<220> FEATURE:
<221> NAME/KEY: modified_base
<222> LOCATION: (675)..(675)
<223> OTHER INFORMATION: UNA monomer
<220> FEATURE:
<221> NAME/KEY: modified_base
<222> LOCATION: (687)..(687)
<223> OTHER INFORMATION: UNA monomer
<220> FEATURE:
<221> NAME/KEY: modified_base
<222> LOCATION: (699)..(699)
<223> OTHER INFORMATION: UNA monomer
<220> FEATURE:
<221> NAME/KEY: modified_base
<222> LOCATION: (711)..(711)
<223> OTHER INFORMATION: UNA monomer
<220> FEATURE:
<221> NAME/KEY: modified_base
<222> LOCATION: (723)..(723)
<223> OTHER INFORMATION: UNA monomer
<220> FEATURE:
<221> NAME/KEY: modified_base
<222> LOCATION: (735)..(735)
<223> OTHER INFORMATION: UNA monomer
<220> FEATURE:
<221> NAME/KEY: modified_base
<222> LOCATION: (747)..(747)
<223> OTHER INFORMATION: UNA monomer
<220> FEATURE:
<221> NAME/KEY: modified_base
<222> LOCATION: (759)..(759)
<223> OTHER INFORMATION: UNA monomer
<220> FEATURE:
<221> NAME/KEY: modified_base
<222> LOCATION: (771)..(771)
<223> OTHER INFORMATION: UNA monomer
<220> FEATURE:
<221> NAME/KEY: modified_base
<222> LOCATION: (783)..(783)
<223> OTHER INFORMATION: UNA monomer
<220> FEATURE:
<221> NAME/KEY: modified_base
<222> LOCATION: (795)..(795)
<223> OTHER INFORMATION: UNA monomer
<220> FEATURE:
<221> NAME/KEY: modified_base <222> LOCATION: (807)..(807)
<223> OTHER INFORMATION: UNA monomer
<220> FEATURE:
<221> NAME/KEY: modified_base
<222> LOCATION: (819)..(819)
<223> OTHER INFORMATION: UNA monomer
<220> FEATURE:
<221> NAME/KEY: modified_base
<222> LOCATION: (831)..(831)
<223> OTHER INFORMATION: UNA monomer
<220> FEATURE:
<221> NAME/KEY: modified_base
<222> LOCATION: (843)..(843)
<223> OTHER INFORMATION: UNA monomer
<220> FEATURE:
<221> NAME/KEY: modified_base
<222> LOCATION: (855)..(855)
<223> OTHER INFORMATION: UNA monomer
<220> FEATURE:
<221> NAME/KEY: modified_base
<222> LOCATION: (867)..(867)
<223> OTHER INFORMATION: UNA monomer
<220> FEATURE:
<221> NAME/KEY: modified_base
<222> LOCATION: (879)..(879)
<223> OTHER INFORMATION: UNA monomer
<220> FEATURE:
<221> NAME/KEY: modified_base
<222> LOCATION: (891)..(891)
<223> OTHER INFORMATION: UNA monomer
<220> FEATURE:
<221> NAME/KEY: modified_base
<222> LOCATION: (903)..(903)
<223> OTHER INFORMATION: UNA monomer
<220> FEATURE:
<221> NAME/KEY: modified_base
<222> LOCATION: (915)..(915)
<223> OTHER INFORMATION: UNA monomer
<220> FEATURE:
<221> NAME/KEY: modified_base
<222> LOCATION: (927)..(927)
<223> OTHER INFORMATION: UNA monomer
<220> FEATURE:
<221> NAME/KEY: modified_base
<222> LOCATION: (939)..(939)
<223> OTHER INFORMATION: UNA monomer
<220> FEATURE:
<221> NAME/KEY: modified_base
<222> LOCATION: (951)..(951)
<223> OTHER INFORMATION: UNA monomer
<220> FEATURE:
<221> NAME/KEY: modified_base
<222> LOCATION: (963)..(963)
<223> OTHER INFORMATION: UNA monomer
<220> FEATURE:
<221> NAME/KEY: modified_base
<222> LOCATION: (975)..(975)
<223> OTHER INFORMATION: UNA monomer
<220> FEATURE:
<221> NAME/KEY: modified_base
<222> LOCATION: (987)..(987)
<223> OTHER INFORMATION: UNA monomer
<220> FEATURE:
<221> NAME/KEY: modified_base
<222> LOCATION: (999)..(999)
<223> OTHER INFORMATION: UNA monomer
<220> FEATURE:
<221> NAME/KEY: modified_base
<222> LOCATION: (1011)..(1011)
<223> OTHER INFORMATION: UNA monomer
<220> FEATURE:
<221> NAME/KEY: modified_base
<222> LOCATION: (1023)..(1023)
<223> OTHER INFORMATION: UNA monomer
<220> FEATURE:
<221> NAME/KEY: modified_base
<222> LOCATION: (1035)..(1035)
<223> OTHER INFORMATION: UNA monomer
<220> FEATURE:

<221> NAME/KEY: modified_base
<222> LOCATION: (1047)..(1047)
<223> OTHER INFORMATION: UNA monomer
<220> FEATURE:
<221> NAME/KEY: modified_base
<222> LOCATION: (1059)..(1059)
<223> OTHER INFORMATION: UNA monomer
<220> FEATURE:
<221> NAME/KEY: modified_base
<222> LOCATION: (1065)..(1065)
<223> OTHER INFORMATION: UNA monomer

<400> SEQUENCE: 134 augcuguuua aucugaggau ccuguuuaaa caaugcagcu uuuagaaaug gucacaacuu 60 caugguucga aauuuucggu guggacaacc acuacaaaau aaagugcagc ugaagggccg 120 ugaccuucuc acucuaaaaa acuuuaccgg agaagaaauu aaauauaugc uauggcuauc 180 agcagaucug aaauuuagga uaaaacagaa aggagaguau uugccuuuau ugcaagggaa 240 guccuuaggc augauuuuug agaaaagaag uacucgaaca agauugucua cagaaacagg 300 cuuugcacuu cugggaggac auccuuguuu ucuuaccaca caagauauuc auuugggugu 360 gaaugaaagu cucacggaca cggcccgugu auugucuagc auggcagaug caguauuggc 420 ucgaguguau aaacaaucag auuuggacac ccuggcuaaa gaagcaucca ucccaauuau 480 caaugggcug ucagauuugu accauccuau ccagauccug gcugauuacc ucacgcucca 540 ggaacacuau agcucucuga aaggucuuac ccucagcugg aucggggaug ggaacaauau 600 ccugcacucc aucaugauga gcgcagcgaa auucggaaug caccuucagg cagcuacucc 660 aaaggguuau gagccggaug cuaguguaac caaguuggca gagcaguaug ccaaagagaa 720 ugguaccaag cuguugcuga caaaugaucc auuggaagca gcgcauggag gcaauguauu 780 aauuacagac acuuggauaa gcaugggaca agaagaggag aagaaaaagc ggcuccaggc 840 uuuccaaggu uaccagguua caaugaagac ugcuaaaguu gcugccucug acuggacauu 900 uuuacacugc uugcccagaa agccagaaga aguggaugau gaagucuuuu auucuccucg 960 aucacuagug uucccagagg cagaaaacag aaaguggaca aucauggcug ucaugguguc 1020 ccugcugaca gauuacucac cucagcucca gaagccuaaa uuuuga 1066

<210> SEQ ID NO 135
<211> LENGTH: 1065
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (1062)..(1064)
<223> OTHER INFORMATION: UNA monomer

<400> SEQUENCE: 135 augcuguuua aucugaggau ccuguuaaac aaugcagcuu uuagaaaugg ucacaacuuc 60 augguucgaa auuuucggug uggacaacca cuacaaaaua aagugcagcu gaagggccgu 120 gaccuucuca cucuaaaaaa cuuuaccgga gaagaaauua aauauaugcu auggcuauca 180 gcagaucuga aauuuaggau aaaacagaaa ggagaguauu ugccuuuauu gcaagggaag 240 uccuuaggca ugauuuuuga gaaaagaagu acucgaacaa gauugucuac agaaacaggc 300

```
uuugcacuuc ugggaggaca uccuuguuuu cuuaccacac aagauauuca uuugggugug    360

aaugaaaguc ucacggacac ggcccgugua uugucuagca uggcagaugc aguauuggcu    420

cgaguguaua aacaaucaga uuuggacacc cuggcuaaag aagcauccau cccaauuauc    480

aaugggcugu cagauuugua ccauccuauc cagauccugg cugauuaccu cacgcuccag    540

gaacacuaua gcucucugaa aggucuuacc cucagcugga ucggggaugg gaacaauauc    600

cugcacucca ucaugaugag cgcagcgaaa uucggaaugc accuucaggc agcuacucca    660

aaggguuaug agccggaugc uaguguaacc aaguuggcag agcaguaugc caaagagaau    720

gguaccaagc uguugcugac aaaugaucca uuggaagcag cgcauggagg caauguauua    780

auuacagaca cuuggauaag caugggacaa gaagaggaga agaaaaagcg gcuccaggcu    840

uuccaagguu accagguuac aaugaagacu gcuaaaguug cugccucuga cuggacauuu    900

uuacacugcu ugcccagaaa gccagaagaa guggaugaug aagucuuuua uucuccucga    960

ucacuagugu ucccagaggc agaaaacaga aaguggacaa ucauggcugu caugguguccc   1020

cugcugacag auuacucacc ucagcuccag aagccuaaau uuuga                   1065
```

<210> SEQ ID NO 136
<211> LENGTH: 1065
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (5)..(5)
<223> OTHER INFORMATION: UNA monomer
<220> FEATURE:
<221> NAME/KEY: modified_base
<222> LOCATION: (7)..(9)
<223> OTHER INFORMATION: UNA monomer
<220> FEATURE:
<221> NAME/KEY: modified_base
<222> LOCATION: (12)..(12)
<223> OTHER INFORMATION: UNA monomer
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (20)..(20)
<223> OTHER INFORMATION: UNA monomer
<220> FEATURE:
<221> NAME/KEY: modified_base
<222> LOCATION: (23)..(23)
<223> OTHER INFORMATION: UNA monomer
<220> FEATURE:
<221> NAME/KEY: modified_base
<222> LOCATION: (25)..(26)
<223> OTHER INFORMATION: UNA monomer
<220> FEATURE:
<221> NAME/KEY: modified_base
<222> LOCATION: (33)..(33)
<223> OTHER INFORMATION: UNA monomer
<220> FEATURE:
<221> NAME/KEY: modified_base
<222> LOCATION: (39)..(42)
<223> OTHER INFORMATION: UNA monomer
<220> FEATURE:
<221> NAME/KEY: modified_base
<222> LOCATION: (48)..(48)
<223> OTHER INFORMATION: UNA monomer
<220> FEATURE:

<221> NAME/KEY: modified_base
<222> LOCATION: (51)..(51)
<223> OTHER INFORMATION: UNA monomer
<220> FEATURE:
<221> NAME/KEY: modified_base
<222> LOCATION: (58)..(59)
<223> OTHER INFORMATION: UNA monomer
<220> FEATURE:
<221> NAME/KEY: modified_base
<222> LOCATION: (62)..(62)
<223> OTHER INFORMATION: UNA monomer
<220> FEATURE:
<221> NAME/KEY: modified_base
<222> LOCATION: (65)..(66)
<223> OTHER INFORMATION: UNA monomer
<220> FEATURE:
<221> NAME/KEY: modified_base
<222> LOCATION: (72)..(75)
<223> OTHER INFORMATION: UNA monomer
<220> FEATURE:
<221> NAME/KEY: modified_base
<222> LOCATION: (79)..(79)
<223> OTHER INFORMATION: UNA monomer
<220> FEATURE:
<221> NAME/KEY: modified_base
<222> LOCATION: (81)..(81)
<223> OTHER INFORMATION: UNA monomer
<220> FEATURE:
<221> NAME/KEY: modified_base
<222> LOCATION: (92)..(92)
<223> OTHER INFORMATION: UNA monomer
<220> FEATURE:
<221> NAME/KEY: modified_base
<222> LOCATION: (99)..(99)
<223> OTHER INFORMATION: UNA monomer
<220> FEATURE:
<221> NAME/KEY: modified_base
<222> LOCATION: (104)..(104)
<223> OTHER INFORMATION: UNA monomer
<220> FEATURE:
<221> NAME/KEY: modified_base
<222> LOCATION: (110)..(110)
<223> OTHER INFORMATION: UNA monomer
<220> FEATURE:
<221> NAME/KEY: modified_base
<222> LOCATION: (120)..(120)
<223> OTHER INFORMATION: UNA monomer
<220> FEATURE:
<221> NAME/KEY: modified_base
<222> LOCATION: (125)..(126)
<223> OTHER INFORMATION: UNA monomer
<220> FEATURE:
<221> NAME/KEY: modified_base
<222> LOCATION: (128)..(128)
<223> OTHER INFORMATION: UNA monomer
<220> FEATURE:
<221> NAME/KEY: modified_base
<222> LOCATION: (132)..(132)
<223> OTHER INFORMATION: UNA monomer
<220> FEATURE:
<221> NAME/KEY: modified_base
<222> LOCATION: (134)..(134)
<223> OTHER INFORMATION: UNA monomer
<220> FEATURE:
<221> NAME/KEY: modified_base
<222> LOCATION: (142)..(144)
<223> OTHER INFORMATION: UNA monomer
<220> FEATURE:
<221> NAME/KEY: modified_base
<222> LOCATION: (158)..(159)
<223> OTHER INFORMATION: UNA monomer
<220> FEATURE:
<221> NAME/KEY: modified_base
<222> LOCATION: (163)..(163)
<223> OTHER INFORMATION: UNA monomer
<220> FEATURE:
<221> NAME/KEY: modified_base
<222> LOCATION: (165)..(165)
<223> OTHER INFORMATION: UNA monomer <220> FEATURE:
<221> NAME/KEY: modified_base
<222> LOCATION: (167)..(167)
<223> OTHER INFORMATION: UNA monomer
<220> FEATURE:
<221> NAME/KEY: modified_base
<222> LOCATION: (170)..(170)
<223> OTHER INFORMATION: UNA monomer
<220> FEATURE:
<221> NAME/KEY: modified_base
<222> LOCATION: (172)..(172)
<223> OTHER INFORMATION: UNA monomer
<220> FEATURE:
<221> NAME/KEY: modified_base
<222> LOCATION: (176)..(176)
<223> OTHER INFORMATION: UNA monomer
<220> FEATURE:
<221> NAME/KEY: modified_base
<222> LOCATION: (178)..(178)
<223> OTHER INFORMATION: UNA monomer
<220> FEATURE:
<221> NAME/KEY: modified_base
<222> LOCATION: (186)..(186)
<223> OTHER INFORMATION: UNA monomer
<220> FEATURE:
<221> NAME/KEY: modified_base
<222> LOCATION: (188)..(188)
<223> OTHER INFORMATION: UNA monomer
<220> FEATURE:
<221> NAME/KEY: modified_base
<222> LOCATION: (193)..(195)
<223> OTHER INFORMATION: UNA monomer
<220> FEATURE:
<221> NAME/KEY: modified_base
<222> LOCATION: (200)..(200)
<223> OTHER INFORMATION: UNA monomer
<220> FEATURE:
<221> NAME/KEY: modified_base
<222> LOCATION: (217)..(217)
<223> OTHER INFORMATION: UNA monomer
<220> FEATURE:
<221> NAME/KEY: modified_base
<222> LOCATION: (219)..(221)
<223> OTHER INFORMATION: UNA monomer
<220> FEATURE:
<221> NAME/KEY: modified_base
<222> LOCATION: (225)..(227)
<223> OTHER INFORMATION: UNA monomer
<220> FEATURE:
<221> NAME/KEY: modified_base
<222> LOCATION: (229)..(230)
<223> OTHER INFORMATION: UNA monomer
<220> FEATURE:
<221> NAME/KEY: modified_base
<222> LOCATION: (241)..(241)
<223> OTHER INFORMATION: UNA monomer
<220> FEATURE:
<221> NAME/KEY: modified_base
<222> LOCATION: (244)..(245)
<223> OTHER INFORMATION: UNA monomer
<220> FEATURE:
<221> NAME/KEY: modified_base
<222> LOCATION: (251)..(251)
<223> OTHER INFORMATION: UNA monomer
<220> FEATURE:
<221> NAME/KEY: modified_base
<222> LOCATION: (254)..(258)
<223> OTHER INFORMATION: UNA monomer
<220> FEATURE:
<221> NAME/KEY: modified_base
<222> LOCATION: (270)..(270)
<223> OTHER INFORMATION: UNA monomer
<220> FEATURE:
<221> NAME/KEY: modified_base
<222> LOCATION: (273)..(273)
<223> OTHER INFORMATION: UNA monomer
<220> FEATURE:
<221> NAME/KEY: modified_base
<222> LOCATION: (283)..(284)

<223> OTHER INFORMATION: UNA monomer
<220> FEATURE:
<221> NAME/KEY: modified_base
<222> LOCATION: (286)..(286)
<223> OTHER INFORMATION: UNA monomer
<220> FEATURE:
<221> NAME/KEY: modified_base
<222> LOCATION: (288)..(288)
<223> OTHER INFORMATION: UNA monomer
<220> FEATURE:
<221> NAME/KEY: modified_base
<222> LOCATION: (301)..(303)
<223> OTHER INFORMATION: UNA monomer
<220> FEATURE:
<221> NAME/KEY: modified_base
<222> LOCATION: (308)..(309)
<223> OTHER INFORMATION: UNA monomer
<220> FEATURE:
<221> NAME/KEY: modified_base
<222> LOCATION: (311)..(311)
<223> OTHER INFORMATION: UNA monomer
<220> FEATURE:
<221> NAME/KEY: modified_base
<222> LOCATION: (321)..(321)
<223> OTHER INFORMATION: UNA monomer
<220> FEATURE:
<221> NAME/KEY: modified_base
<222> LOCATION: (324)..(325)
<223> OTHER INFORMATION: UNA monomer
<220> FEATURE:
<221> NAME/KEY: modified_base
<222> LOCATION: (327)..(330)
<223> OTHER INFORMATION: UNA monomer
<220> FEATURE:
<221> NAME/KEY: modified_base
<222> LOCATION: (332)..(333)
<223> OTHER INFORMATION: UNA monomer
<220> FEATURE:
<221> NAME/KEY: modified_base
<222> LOCATION: (345)..(345)
<223> OTHER INFORMATION: UNA monomer
<220> FEATURE:
<221> NAME/KEY: modified_base
<222> LOCATION: (347)..(348)
<223> OTHER INFORMATION: UNA monomer
<220> FEATURE:
<221> NAME/KEY: modified_base
<222> LOCATION: (351)..(353)
<223> OTHER INFORMATION: UNA monomer
<220> FEATURE:
<221> NAME/KEY: modified_base
<222> LOCATION: (357)..(357)
<223> OTHER INFORMATION: UNA monomer
<220> FEATURE:
<221> NAME/KEY: modified_base
<222> LOCATION: (359)..(359)
<223> OTHER INFORMATION: UNA monomer
<220> FEATURE:
<221> NAME/KEY: modified_base
<222> LOCATION: (363)..(363)
<223> OTHER INFORMATION: UNA monomer
<220> FEATURE:
<221> NAME/KEY: modified_base
<222> LOCATION: (369)..(369)
<223> OTHER INFORMATION: UNA monomer
<220> FEATURE:
<221> NAME/KEY: modified_base
<222> LOCATION: (371)..(371)
<223> OTHER INFORMATION: UNA monomer
<220> FEATURE:
<221> NAME/KEY: modified_base
<222> LOCATION: (387)..(387)
<223> OTHER INFORMATION: UNA monomer
<220> FEATURE:
<221> NAME/KEY: modified_base
<222> LOCATION: (389)..(389)
<223> OTHER INFORMATION: UNA monomer
<220> FEATURE:
<221> NAME/KEY: modified_base <222> LOCATION: (391)..(392)
<223> OTHER INFORMATION: UNA monomer
<220> FEATURE:
<221> NAME/KEY: modified_base
<222> LOCATION: (394)..(394)
<223> OTHER INFORMATION: UNA monomer
<220> FEATURE:
<221> NAME/KEY: modified_base
<222> LOCATION: (396)..(396)
<223> OTHER INFORMATION: UNA monomer
<220> FEATURE:
<221> NAME/KEY: modified_base
<222> LOCATION: (401)..(401)
<223> OTHER INFORMATION: UNA monomer
<220> FEATURE:
<221> NAME/KEY: modified_base
<222> LOCATION: (408)..(408)
<223> OTHER INFORMATION: UNA monomer
<220> FEATURE:
<221> NAME/KEY: modified_base
<222> LOCATION: (413)..(413)
<223> OTHER INFORMATION: UNA monomer
<220> FEATURE:
<221> NAME/KEY: modified_base
<222> LOCATION: (415)..(416)
<223> OTHER INFORMATION: UNA monomer
<220> FEATURE:
<221> NAME/KEY: modified_base
<222> LOCATION: (420)..(420)
<223> OTHER INFORMATION: UNA monomer
<220> FEATURE:
<221> NAME/KEY: modified_base
<222> LOCATION: (425)..(425)
<223> OTHER INFORMATION: UNA monomer
<220> FEATURE:
<221> NAME/KEY: modified_base
<222> LOCATION: (427)..(427)
<223> OTHER INFORMATION: UNA monomer
<220> FEATURE:
<221> NAME/KEY: modified_base
<222> LOCATION: (429)..(429)
<223> OTHER INFORMATION: UNA monomer
<220> FEATURE:
<221> NAME/KEY: modified_base
<222> LOCATION: (436)..(436)
<223> OTHER INFORMATION: UNA monomer
<220> FEATURE:
<221> NAME/KEY: modified_base
<222> LOCATION: (441)..(443)
<223> OTHER INFORMATION: UNA monomer
<220> FEATURE:
<221> NAME/KEY: modified_base
<222> LOCATION: (452)..(452)
<223> OTHER INFORMATION: UNA monomer
<220> FEATURE:
<221> NAME/KEY: modified_base
<222> LOCATION: (456)..(456)
<223> OTHER INFORMATION: UNA monomer
<220> FEATURE:
<221> NAME/KEY: modified_base
<222> LOCATION: (466)..(466)
<223> OTHER INFORMATION: UNA monomer
<220> FEATURE:
<221> NAME/KEY: modified_base
<222> LOCATION: (470)..(470)
<223> OTHER INFORMATION: UNA monomer
<220> FEATURE:
<221> NAME/KEY: modified_base
<222> LOCATION: (476)..(477)
<223> OTHER INFORMATION: UNA monomer
<220> FEATURE:
<221> NAME/KEY: modified_base
<222> LOCATION: (479)..(479)
<223> OTHER INFORMATION: UNA monomer
<220> FEATURE:
<221> NAME/KEY: modified_base
<222> LOCATION: (483)..(483)
<223> OTHER INFORMATION: UNA monomer
<220> FEATURE:

<221> NAME/KEY: modified_base
<222> LOCATION: (488)..(488)
<223> OTHER INFORMATION: UNA monomer
<220> FEATURE:
<221> NAME/KEY: modified_base
<222> LOCATION: (490)..(490)
<223> OTHER INFORMATION: UNA monomer
<220> FEATURE:
<221> NAME/KEY: modified_base
<222> LOCATION: (495)..(497)
<223> OTHER INFORMATION: UNA monomer
<220> FEATURE:
<221> NAME/KEY: modified_base
<222> LOCATION: (499)..(499)
<223> OTHER INFORMATION: UNA monomer
<220> FEATURE:
<221> NAME/KEY: modified_base
<222> LOCATION: (504)..(504)
<223> OTHER INFORMATION: UNA monomer
<220> FEATURE:
<221> NAME/KEY: modified_base
<222> LOCATION: (507)..(507)
<223> OTHER INFORMATION: UNA monomer
<220> FEATURE:
<221> NAME/KEY: modified_base
<222> LOCATION: (509)..(509)
<223> OTHER INFORMATION: UNA monomer
<220> FEATURE:
<221> NAME/KEY: modified_base
<222> LOCATION: (515)..(515)
<223> OTHER INFORMATION: UNA monomer
<220> FEATURE:
<221> NAME/KEY: modified_base
<222> LOCATION: (518)..(518)
<223> OTHER INFORMATION: UNA monomer
<220> FEATURE:
<221> NAME/KEY: modified_base
<222> LOCATION: (522)..(522)
<223> OTHER INFORMATION: UNA monomer
<220> FEATURE:
<221> NAME/KEY: modified_base
<222> LOCATION: (525)..(526)
<223> OTHER INFORMATION: UNA monomer
<220> FEATURE:
<221> NAME/KEY: modified_base
<222> LOCATION: (530)..(530)
<223> OTHER INFORMATION: UNA monomer
<220> FEATURE:
<221> NAME/KEY: modified_base
<222> LOCATION: (536)..(536)
<223> OTHER INFORMATION: UNA monomer
<220> FEATURE:
<221> NAME/KEY: modified_base
<222> LOCATION: (547)..(547)
<223> OTHER INFORMATION: UNA monomer
<220> FEATURE:
<221> NAME/KEY: modified_base
<222> LOCATION: (549)..(549)
<223> OTHER INFORMATION: UNA monomer
<220> FEATURE:
<221> NAME/KEY: modified_base
<222> LOCATION: (553)..(553)
<223> OTHER INFORMATION: UNA monomer
<220> FEATURE:
<221> NAME/KEY: modified_base
<222> LOCATION: (555)..(555)
<223> OTHER INFORMATION: UNA monomer
<220> FEATURE:
<221> NAME/KEY: modified_base
<222> LOCATION: (557)..(557)
<223> OTHER INFORMATION: UNA monomer
<220> FEATURE:
<221> NAME/KEY: modified_base
<222> LOCATION: (564)..(564)
<223> OTHER INFORMATION: UNA monomer
<220> FEATURE:
<221> NAME/KEY: modified_base
<222> LOCATION: (566)..(567)
<223> OTHER INFORMATION: UNA monomer <220> FEATURE:
<221> NAME/KEY: modified_base
<222> LOCATION: (572)..(572)
<223> OTHER INFORMATION: UNA monomer
<220> FEATURE:
<221> NAME/KEY: modified_base
<222> LOCATION: (577)..(577)
<223> OTHER INFORMATION: UNA monomer
<220> FEATURE:
<221> NAME/KEY: modified_base
<222> LOCATION: (581)..(581)
<223> OTHER INFORMATION: UNA monomer
<220> FEATURE:
<221> NAME/KEY: modified_base
<222> LOCATION: (588)..(588)
<223> OTHER INFORMATION: UNA monomer
<220> FEATURE:
<221> NAME/KEY: modified_base
<222> LOCATION: (597)..(597)
<223> OTHER INFORMATION: UNA monomer
<220> FEATURE:
<221> NAME/KEY: modified_base
<222> LOCATION: (599)..(599)
<223> OTHER INFORMATION: UNA monomer
<220> FEATURE:
<221> NAME/KEY: modified_base
<222> LOCATION: (602)..(602)
<223> OTHER INFORMATION: UNA monomer
<220> FEATURE:
<221> NAME/KEY: modified_base
<222> LOCATION: (607)..(607)
<223> OTHER INFORMATION: UNA monomer
<220> FEATURE:
<221> NAME/KEY: modified_base
<222> LOCATION: (611)..(611)
<223> OTHER INFORMATION: UNA monomer
<220> FEATURE:
<221> NAME/KEY: modified_base
<222> LOCATION: (614)..(614)
<223> OTHER INFORMATION: UNA monomer
<220> FEATURE:
<221> NAME/KEY: modified_base
<222> LOCATION: (617)..(617)
<223> OTHER INFORMATION: UNA monomer
<220> FEATURE:
<221> NAME/KEY: modified_base
<222> LOCATION: (631)..(632)
<223> OTHER INFORMATION: UNA monomer
<220> FEATURE:
<221> NAME/KEY: modified_base
<222> LOCATION: (638)..(638)
<223> OTHER INFORMATION: UNA monomer
<220> FEATURE:
<221> NAME/KEY: modified_base
<222> LOCATION: (644)..(645)
<223> OTHER INFORMATION: UNA monomer
<220> FEATURE:
<221> NAME/KEY: modified_base
<222> LOCATION: (654)..(654)
<223> OTHER INFORMATION: UNA monomer
<220> FEATURE:
<221> NAME/KEY: modified_base
<222> LOCATION: (657)..(657)
<223> OTHER INFORMATION: UNA monomer
<220> FEATURE:
<221> NAME/KEY: modified_base
<222> LOCATION: (666)..(667)
<223> OTHER INFORMATION: UNA monomer
<220> FEATURE:
<221> NAME/KEY: modified_base
<222> LOCATION: (669)..(669)
<223> OTHER INFORMATION: UNA monomer
<220> FEATURE:
<221> NAME/KEY: modified_base
<222> LOCATION: (678)..(678)
<223> OTHER INFORMATION: UNA monomer
<220> FEATURE:
<221> NAME/KEY: modified_base
<222> LOCATION: (681)..(681)

<223> OTHER INFORMATION: UNA monomer
<220> FEATURE:
<221> NAME/KEY: modified_base
<222> LOCATION: (684)..(684)
<223> OTHER INFORMATION: UNA monomer
<220> FEATURE:
<221> NAME/KEY: modified_base
<222> LOCATION: (686)..(686)
<223> OTHER INFORMATION: UNA monomer
<220> FEATURE:
<221> NAME/KEY: modified_base
<222> LOCATION: (694)..(695)
<223> OTHER INFORMATION: UNA monomer
<220> FEATURE:
<221> NAME/KEY: modified_base
<222> LOCATION: (706)..(706)
<223> OTHER INFORMATION: UNA monomer
<220> FEATURE:
<221> NAME/KEY: modified_base
<222> LOCATION: (708)..(708)
<223> OTHER INFORMATION: UNA monomer
<220> FEATURE:
<221> NAME/KEY: modified_base
<222> LOCATION: (720)..(720)
<223> OTHER INFORMATION: UNA monomer
<220> FEATURE:
<221> NAME/KEY: modified_base
<222> LOCATION: (723)..(723)
<223> OTHER INFORMATION: UNA monomer
<220> FEATURE:
<221> NAME/KEY: modified_base
<222> LOCATION: (731)..(731)
<223> OTHER INFORMATION: UNA monomer
<220> FEATURE:
<221> NAME/KEY: modified_base
<222> LOCATION: (733)..(734)
<223> OTHER INFORMATION: UNA monomer
<220> FEATURE:
<221> NAME/KEY: modified_base
<222> LOCATION: (737)..(737)
<223> OTHER INFORMATION: UNA monomer
<220> FEATURE:
<221> NAME/KEY: modified_base
<222> LOCATION: (744)..(744)
<223> OTHER INFORMATION: UNA monomer
<220> FEATURE:
<221> NAME/KEY: modified_base
<222> LOCATION: (747)..(747)
<223> OTHER INFORMATION: UNA monomer
<220> FEATURE:
<221> NAME/KEY: modified_base
<222> LOCATION: (751)..(752)
<223> OTHER INFORMATION: UNA monomer
<220> FEATURE:
<221> NAME/KEY: modified_base
<222> LOCATION: (765)..(765)
<223> OTHER INFORMATION: UNA monomer
<220> FEATURE:
<221> NAME/KEY: modified_base
<222> LOCATION: (774)..(774)
<223> OTHER INFORMATION: UNA monomer
<220> FEATURE:
<221> NAME/KEY: modified_base
<222> LOCATION: (776)..(776)
<223> OTHER INFORMATION: UNA monomer
<220> FEATURE:
<221> NAME/KEY: modified_base
<222> LOCATION: (778)..(779)
<223> OTHER INFORMATION: UNA monomer
<220> FEATURE:
<221> NAME/KEY: modified_base
<222> LOCATION: (782)..(783)
<223> OTHER INFORMATION: UNA monomer
<220> FEATURE:
<221> NAME/KEY: modified_base
<222> LOCATION: (792)..(793)
<223> OTHER INFORMATION: UNA monomer
<220> FEATURE:
<221> NAME/KEY: modified_base <222> LOCATION: (797)..(797)
<223> OTHER INFORMATION: UNA monomer
<220> FEATURE:
<221> NAME/KEY: modified_base
<222> LOCATION: (803)..(803)
<223> OTHER INFORMATION: UNA monomer
<220> FEATURE:
<221> NAME/KEY: modified_base
<222> LOCATION: (833)..(833)
<223> OTHER INFORMATION: UNA monomer
<220> FEATURE:
<221> NAME/KEY: modified_base
<222> LOCATION: (840)..(842)
<223> OTHER INFORMATION: UNA monomer
<220> FEATURE:
<221> NAME/KEY: modified_base
<222> LOCATION: (849)..(850)
<223> OTHER INFORMATION: UNA monomer
<220> FEATURE:
<221> NAME/KEY: modified_base
<222> LOCATION: (857)..(858)
<223> OTHER INFORMATION: UNA monomer
<220> FEATURE:
<221> NAME/KEY: modified_base
<222> LOCATION: (863)..(863)
<223> OTHER INFORMATION: UNA monomer
<220> FEATURE:
<221> NAME/KEY: modified_base
<222> LOCATION: (870)..(870)
<223> OTHER INFORMATION: UNA monomer
<220> FEATURE:
<221> NAME/KEY: modified_base
<222> LOCATION: (873)..(873)
<223> OTHER INFORMATION: UNA monomer
<220> FEATURE:
<221> NAME/KEY: modified_base
<222> LOCATION: (878)..(879)
<223> OTHER INFORMATION: UNA monomer
<220> FEATURE:
<221> NAME/KEY: modified_base
<222> LOCATION: (882)..(882)
<223> OTHER INFORMATION: UNA monomer
<220> FEATURE:
<221> NAME/KEY: modified_base
<222> LOCATION: (886)..(886)
<223> OTHER INFORMATION: UNA monomer
<220> FEATURE:
<221> NAME/KEY: modified_base
<222> LOCATION: (888)..(888)
<223> OTHER INFORMATION: UNA monomer
<220> FEATURE:
<221> NAME/KEY: modified_base
<222> LOCATION: (892)..(892)
<223> OTHER INFORMATION: UNA monomer
<220> FEATURE:
<221> NAME/KEY: modified_base
<222> LOCATION: (898)..(902)
<223> OTHER INFORMATION: UNA monomer
<220> FEATURE:
<221> NAME/KEY: modified_base
<222> LOCATION: (907)..(907)
<223> OTHER INFORMATION: UNA monomer
<220> FEATURE:
<221> NAME/KEY: modified_base
<222> LOCATION: (910)..(911)
<223> OTHER INFORMATION: UNA monomer
<220> FEATURE:
<221> NAME/KEY: modified_base
<222> LOCATION: (932)..(932)
<223> OTHER INFORMATION: UNA monomer
<220> FEATURE:
<221> NAME/KEY: modified_base
<222> LOCATION: (936)..(936)
<223> OTHER INFORMATION: UNA monomer
<220> FEATURE:
<221> NAME/KEY: modified_base
<222> LOCATION: (939)..(939)
<223> OTHER INFORMATION: UNA monomer
<220> FEATURE:

<221> NAME/KEY: modified_base
<222> LOCATION: (944)..(944)
<223> OTHER INFORMATION: UNA monomer
<220> FEATURE:
<221> NAME/KEY: modified_base
<222> LOCATION: (946)..(949)
<223> OTHER INFORMATION: UNA monomer
<220> FEATURE:
<221> NAME/KEY: modified_base
<222> LOCATION: (951)..(952)
<223> OTHER INFORMATION: UNA monomer
<220> FEATURE:
<221> NAME/KEY: modified_base
<222> LOCATION: (954)..(954)
<223> OTHER INFORMATION: UNA monomer
<220> FEATURE:
<221> NAME/KEY: modified_base
<222> LOCATION: (957)..(957)
<223> OTHER INFORMATION: UNA monomer
<220> FEATURE:
<221> NAME/KEY: modified_base
<222> LOCATION: (961)..(961)
<223> OTHER INFORMATION: UNA monomer
<220> FEATURE:
<221> NAME/KEY: modified_base
<222> LOCATION: (965)..(965)
<223> OTHER INFORMATION: UNA monomer
<220> FEATURE:
<221> NAME/KEY: modified_base
<222> LOCATION: (968)..(968)
<223> OTHER INFORMATION: UNA monomer
<220> FEATURE:
<221> NAME/KEY: modified_base
<222> LOCATION: (970)..(971)
<223> OTHER INFORMATION: UNA monomer
<220> FEATURE:
<221> NAME/KEY: modified_base
<222> LOCATION: (994)..(994)
<223> OTHER INFORMATION: UNA monomer
<220> FEATURE:
<221> NAME/KEY: modified_base
<222> LOCATION: (1001)..(1001)
<223> OTHER INFORMATION: UNA monomer
<220> FEATURE:
<221> NAME/KEY: modified_base
<222> LOCATION: (1004)..(1004)
<223> OTHER INFORMATION: UNA monomer
<220> FEATURE:
<221> NAME/KEY: modified_base
<222> LOCATION: (1008)..(1008)
<223> OTHER INFORMATION: UNA monomer
<220> FEATURE:
<221> NAME/KEY: modified_base
<222> LOCATION: (1010)..(1010)
<223> OTHER INFORMATION: UNA monomer
<220> FEATURE:
<221> NAME/KEY: modified_base
<222> LOCATION: (1013)..(1013)
<223> OTHER INFORMATION: UNA monomer
<220> FEATURE:
<221> NAME/KEY: modified_base
<222> LOCATION: (1016)..(1016)
<223> OTHER INFORMATION: UNA monomer
<220> FEATURE:
<221> NAME/KEY: modified_base
<222> LOCATION: (1018)..(1018)
<223> OTHER INFORMATION: UNA monomer
<220> FEATURE:
<221> NAME/KEY: modified_base
<222> LOCATION: (1022)..(1022)
<223> OTHER INFORMATION: UNA monomer
<220> FEATURE:
<221> NAME/KEY: modified_base
<222> LOCATION: (1025)..(1025)
<223> OTHER INFORMATION: UNA monomer
<220> FEATURE:
<221> NAME/KEY: modified_base
<222> LOCATION: (1032)..(1033)
<223> OTHER INFORMATION: UNA monomer <220> FEATURE:
<221> NAME/KEY: modified_base
<222> LOCATION: (1036)..(1036)
<223> OTHER INFORMATION: UNA monomer
<220> FEATURE:
<221> NAME/KEY: modified_base
<222> LOCATION: (1041)..(1041)
<223> OTHER INFORMATION: UNA monomer
<220> FEATURE:
<221> NAME/KEY: modified_base
<222> LOCATION: (1046)..(1046)
<223> OTHER INFORMATION: UNA monomer
<220> FEATURE:
<221> NAME/KEY: modified_base
<222> LOCATION: (1056)..(1056)
<223> OTHER INFORMATION: UNA monomer
<220> FEATURE:
<221> NAME/KEY: modified_base
<222> LOCATION: (1060)..(1063)
<223> OTHER INFORMATION: UNA monomer

<400> SEQUENCE: 136 augcuguuua aucugaggau ccuguuaaac aaugcagcuu uuagaaaugg ucacaacuuc 60 augguucgaa auuuucggug uggacaacca cuacaaaaua aagugcagcu gaagggccgu 120 gaccuucuca cucuaaaaaa cuuuaccgga gaagaaauua aauauaugcu auggcuauca 180 gcagaucuga aauuuaggau aaaacagaaa ggagaguauu ugccuuuauu gcaagggaag 240 uccuuaggca ugauuuuuga gaaaagaagu acucgaacaa gauugucuac agaaacaggc 300 uuugcacuuc ugggaggaca uccuuguuuu cuuaccacac aagauauuca uuugggugug 360 aaugaaaguc ucacggacac ggcccgugua uugucuagca uggcagaugc aguauuggcu 420 cgaguguaua aacaaucaga uuuggacacc cuggcuaaag aagcauccau cccaauuauc 480 aaugggcugu cagauuugua ccauccuauc cagauccugg cugauuaccu cacgcuccag 540 gaacacuaua gcucucugaa aggucuuacc cucagcugga ucggggaugg gaacaauauc 600 cugcacucca ucaugaugag cgcagcgaaa uucggaaugc accuucaggc agcuacucca 660 aaggguuaug agccggaugc uaguguaacc aaguuggcag agcaguaugc caaagagaau 720 gguaccaagc uguugcugac aaaugaucca uuggaagcag cgcauggagg caauguauua 780 auuacagaca cuuggauaag caugggacaa gaagaggaga agaaaaagcg gcuccaggcu 840 uuccaagguu accagguuac aaugaagacu gcuaaaguug cugccucuga cuggacauuu 900 uuacacugcu ugcccagaaa gccagaagaa guggaugaug aagucuuuua uucuccucga 960 ucacuagugu ucccagaggc agaaaacaga aaguggacaa ucauggcugu caugguguccc 1020 cugcugacag auuacucacc ucagcuccag aagccuaaau uuuga 1065

<210> SEQ ID NO 137
<211> LENGTH: 134
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (133)..(133)
<223> OTHER INFORMATION: UNA monomer

<400> SEQUENCE: 137 gcucgcuuuc uugcugucca auuucuauua aagguuccuu uguucccuaa guccaacuac 60 uaaacugggg gauauuauga agggccuuga gcaucuggau ucugccuaau aaaaaacauu 120 uauuuucauu gcaa 134

<210> SEQ ID NO 138
<211> LENGTH: 134
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (131)..(133)
<223> OTHER INFORMATION: UNA monomer

<400> SEQUENCE: 138 gcucgcuuuc uugcugucca auuucuauua aagguuccuu uguucccuaa guccaacuac 60 uaaacugggg gauauuauga agggccuuga gcaucuggau ucugccuaau aaaaaacauu 120 uauuuucauu gcaa 134

<210> SEQ ID NO 139
<211> LENGTH: 134
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (8)..(8)
<223> OTHER INFORMATION: UNA monomer
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (20)..(20)
<223> OTHER INFORMATION: UNA monomer
<220> FEATURE:
<221> NAME/KEY: modified_base
<222> LOCATION: (26)..(26)
<223> OTHER INFORMATION: UNA monomer
<220> FEATURE:
<221> NAME/KEY: modified_base
<222> LOCATION: (32)..(32)
<223> OTHER INFORMATION: UNA monomer
<220> FEATURE:
<221> NAME/KEY: modified_base
<222> LOCATION: (38)..(38)
<223> OTHER INFORMATION: UNA monomer
<220> FEATURE:
<221> NAME/KEY: modified_base
<222> LOCATION: (44)..(44)
<223> OTHER INFORMATION: UNA monomer
<220> FEATURE:
<221> NAME/KEY: modified_base
<222> LOCATION: (50)..(50)
<223> OTHER INFORMATION: UNA monomer
<220> FEATURE:
<221> NAME/KEY: modified_base
<222> LOCATION: (56)..(56)
<223> OTHER INFORMATION: UNA monomer
<220> FEATURE:

<221> NAME/KEY: modified_base
<222> LOCATION: (62)..(62)
<223> OTHER INFORMATION: UNA monomer
<220> FEATURE:
<221> NAME/KEY: modified_base
<222> LOCATION: (68)..(68)
<223> OTHER INFORMATION: UNA monomer
<220> FEATURE:
<221> NAME/KEY: modified_base
<222> LOCATION: (74)..(74)
<223> OTHER INFORMATION: UNA monomer
<220> FEATURE:
<221> NAME/KEY: modified_base
<222> LOCATION: (80)..(80)
<223> OTHER INFORMATION: UNA monomer
<220> FEATURE:
<221> NAME/KEY: modified_base
<222> LOCATION: (86)..(86)
<223> OTHER INFORMATION: UNA monomer
<220> FEATURE:
<221> NAME/KEY: modified_base
<222> LOCATION: (92)..(92)
<223> OTHER INFORMATION: UNA monomer
<220> FEATURE:
<221> NAME/KEY: modified_base
<222> LOCATION: (98)..(98)
<223> OTHER INFORMATION: UNA monomer
<220> FEATURE:
<221> NAME/KEY: modified_base
<222> LOCATION: (104)..(104)
<223> OTHER INFORMATION: UNA monomer
<220> FEATURE:
<221> NAME/KEY: modified_base
<222> LOCATION: (110)..(110)
<223> OTHER INFORMATION: UNA monomer
<220> FEATURE:
<221> NAME/KEY: modified_base
<222> LOCATION: (116)..(116)
<223> OTHER INFORMATION: UNA monomer
<220> FEATURE:
<221> NAME/KEY: modified_base
<222> LOCATION: (122)..(122)
<223> OTHER INFORMATION: UNA monomer
<220> FEATURE:
<221> NAME/KEY: modified_base
<222> LOCATION: (128)..(128)
<223> OTHER INFORMATION: UNA monomer
<220> FEATURE:
<221> NAME/KEY: modified_base
<222> LOCATION: (133)..(133)
<223> OTHER INFORMATION: UNA monomer

<400> SEQUENCE: 139 gcucgcuuuc uugcugucca auuucuauua aagguuccuu uguucccuaa guccaacuac 60 uaaacugggg gauauuauga agggccuuga gcaucuggau ucugccuaau aaaaaacauu 120 uauuuucauu gcaa 134

<210> SEQ ID NO 140
<211> LENGTH: 134
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(3)
<223> OTHER INFORMATION: UNA monomer
<220> FEATURE:
<221> NAME/KEY: modified_base
<222> LOCATION: (8)..(9)
<223> OTHER INFORMATION: UNA monomer
<220> FEATURE:
<221> NAME/KEY: modified_base
<222> LOCATION: (14)..(15)

<223> OTHER INFORMATION: UNA monomer
<220> FEATURE:
<221> NAME/KEY: modified_base
<222> LOCATION: (20)..(21)
<223> OTHER INFORMATION: UNA monomer
<220> FEATURE:
<221> NAME/KEY: modified_base
<222> LOCATION: (26)..(27)
<223> OTHER INFORMATION: UNA monomer
<220> FEATURE:
<221> NAME/KEY: modified_base
<222> LOCATION: (32)..(33)
<223> OTHER INFORMATION: UNA monomer
<220> FEATURE:
<221> NAME/KEY: modified_base
<222> LOCATION: (38)..(39)
<223> OTHER INFORMATION: UNA monomer
<220> FEATURE:
<221> NAME/KEY: modified_base
<222> LOCATION: (44)..(45)
<223> OTHER INFORMATION: UNA monomer
<220> FEATURE:
<221> NAME/KEY: modified_base
<222> LOCATION: (50)..(51)
<223> OTHER INFORMATION: UNA monomer
<220> FEATURE:
<221> NAME/KEY: modified_base
<222> LOCATION: (56)..(57)
<223> OTHER INFORMATION: UNA monomer
<220> FEATURE:
<221> NAME/KEY: modified_base
<222> LOCATION: (62)..(63)
<223> OTHER INFORMATION: UNA monomer
<220> FEATURE:
<221> NAME/KEY: modified_base
<222> LOCATION: (68)..(69)
<223> OTHER INFORMATION: UNA monomer
<220> FEATURE:
<221> NAME/KEY: modified_base
<222> LOCATION: (74)..(75)
<223> OTHER INFORMATION: UNA monomer
<220> FEATURE:
<221> NAME/KEY: modified_base
<222> LOCATION: (80)..(81)
<223> OTHER INFORMATION: UNA monomer
<220> FEATURE:
<221> NAME/KEY: modified_base
<222> LOCATION: (86)..(87)
<223> OTHER INFORMATION: UNA monomer
<220> FEATURE:
<221> NAME/KEY: modified_base
<222> LOCATION: (92)..(93)
<223> OTHER INFORMATION: UNA monomer
<220> FEATURE:
<221> NAME/KEY: modified_base
<222> LOCATION: (98)..(99)
<223> OTHER INFORMATION: UNA monomer
<220> FEATURE:
<221> NAME/KEY: modified_base
<222> LOCATION: (104)..(105)
<223> OTHER INFORMATION: UNA monomer
<220> FEATURE:
<221> NAME/KEY: modified_base
<222> LOCATION: (110)..(111)
<223> OTHER INFORMATION: UNA monomer
<220> FEATURE:
<221> NAME/KEY: modified_base
<222> LOCATION: (116)..(117)
<223> OTHER INFORMATION: UNA monomer
<220> FEATURE:
<221> NAME/KEY: modified_base
<222> LOCATION: (122)..(123)
<223> OTHER INFORMATION: UNA monomer
<220> FEATURE:
<221> NAME/KEY: modified_base
<222> LOCATION: (128)..(129)
<223> OTHER INFORMATION: UNA monomer
<220> FEATURE:
<221> NAME/KEY: modified_base <222> LOCATION: (133)..(133)
<223> OTHER INFORMATION: UNA monomer

<400> SEQUENCE: 140 gcucgcuuuc uugcugucca auuucuauua aagguuccuu uguucccuaa guccaacuac 60 uaaacugggg gauauuauga agggccuuga gcaucuggau ucugccuaau aaaaaacauu 120 uauuuucauu gcaa 134

<210> SEQ ID NO 141
<211> LENGTH: 134
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (1)..(134)
<223> OTHER INFORMATION: UNA monomer

<400> SEQUENCE: 141 gcucgcuuuc uugcugucca auuucuauua aagguuccuu uguucccuaa guccaacuac 60 uaaacugggg gauauuauga agggccuuga gcaucuggau ucugccuaau aaaaaacauu 120 uauuuucauu gcaa 134

<210> SEQ ID NO 142
<211> LENGTH: 158
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (157)..(157)
<223> OTHER INFORMATION: UNA monomer

<400> SEQUENCE: 142 cuagugacug acuaggaucu gguuaccacu aaaccagccu caagaacacc cgaauggagu 60 cucuaagcua cauaauacca acuuacacuu acaaaauguu gucccccaaa auguagccau 120 ucguaucugc uccuaauaaa aagaaaguuu cuucacau 158

<210> SEQ ID NO 143
<211> LENGTH: 158
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (155)..(157)
<223> OTHER INFORMATION: UNA monomer

<400> SEQUENCE: 143 cuagugacug acuaggaucu gguuaccacu aaaccagccu caagaacacc cgaauggagu 60 cucuaagcua cauaauacca acuuacacuu acaaaauguu gucccccaaa auguagccau 120 ucguaucugc uccuaauaaa aagaaaguuu cuucacau 158

<210> SEQ ID NO 144
<211> LENGTH: 158
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (8)..(8)
<223> OTHER INFORMATION: UNA monomer
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (20)..(20)
<223> OTHER INFORMATION: UNA monomer
<220> FEATURE:
<221> NAME/KEY: modified_base
<222> LOCATION: (26)..(26)
<223> OTHER INFORMATION: UNA monomer
<220> FEATURE:
<221> NAME/KEY: modified_base
<222> LOCATION: (32)..(32)
<223> OTHER INFORMATION: UNA monomer
<220> FEATURE:
<221> NAME/KEY: modified_base
<222> LOCATION: (38)..(38)
<223> OTHER INFORMATION: UNA monomer
<220> FEATURE:
<221> NAME/KEY: modified_base
<222> LOCATION: (44)..(44)
<223> OTHER INFORMATION: UNA monomer
<220> FEATURE:
<221> NAME/KEY: modified_base
<222> LOCATION: (50)..(50)
<223> OTHER INFORMATION: UNA monomer
<220> FEATURE:
<221> NAME/KEY: modified_base
<222> LOCATION: (56)..(56)
<223> OTHER INFORMATION: UNA monomer
<220> FEATURE:
<221> NAME/KEY: modified_base
<222> LOCATION: (62)..(62)
<223> OTHER INFORMATION: UNA monomer
<220> FEATURE:
<221> NAME/KEY: modified_base
<222> LOCATION: (68)..(68)
<223> OTHER INFORMATION: UNA monomer
<220> FEATURE:
<221> NAME/KEY: modified_base
<222> LOCATION: (74)..(74)
<223> OTHER INFORMATION: UNA monomer
<220> FEATURE:
<221> NAME/KEY: modified_base
<222> LOCATION: (80)..(80)
<223> OTHER INFORMATION: UNA monomer
<220> FEATURE:
<221> NAME/KEY: modified_base
<222> LOCATION: (86)..(86)
<223> OTHER INFORMATION: UNA monomer
<220> FEATURE:
<221> NAME/KEY: modified_base
<222> LOCATION: (92)..(92)
<223> OTHER INFORMATION: UNA monomer
<220> FEATURE:
<221> NAME/KEY: modified_base
<222> LOCATION: (98)..(98)
<223> OTHER INFORMATION: UNA monomer <220> FEATURE:
<221> NAME/KEY: modified_base
<222> LOCATION: (104)..(104)
<223> OTHER INFORMATION: UNA monomer
<220> FEATURE:
<221> NAME/KEY: modified_base
<222> LOCATION: (110)..(110)
<223> OTHER INFORMATION: UNA monomer
<220> FEATURE:
<221> NAME/KEY: modified_base
<222> LOCATION: (116)..(116)
<223> OTHER INFORMATION: UNA monomer
<220> FEATURE:
<221> NAME/KEY: modified_base
<222> LOCATION: (122)..(122)
<223> OTHER INFORMATION: UNA monomer
<220> FEATURE:
<221> NAME/KEY: modified_base
<222> LOCATION: (128)..(128)
<223> OTHER INFORMATION: UNA monomer
<220> FEATURE:
<221> NAME/KEY: modified_base
<222> LOCATION: (134)..(134)
<223> OTHER INFORMATION: UNA monomer
<220> FEATURE:
<221> NAME/KEY: modified_base
<222> LOCATION: (140)..(140)
<223> OTHER INFORMATION: UNA monomer
<220> FEATURE:
<221> NAME/KEY: modified_base
<222> LOCATION: (146)..(146)
<223> OTHER INFORMATION: UNA monomer
<220> FEATURE:
<221> NAME/KEY: modified_base
<222> LOCATION: (152)..(152)
<223> OTHER INFORMATION: UNA monomer
<220> FEATURE:
<221> NAME/KEY: modified_base
<222> LOCATION: (157)..(157)
<223> OTHER INFORMATION: UNA monomer

<400> SEQUENCE: 144 cuagugacug acuaggaucu gguuaccacu aaaccagccu caagaacacc cgaauggagu 60 cucuaagcua cauaauacca acuuacacuu acaaaauguu gucccccaaa auguagccau 120 ucguaucugc uccuaauaaa aagaaaguuu cuucacau 158

<210> SEQ ID NO 145
<211> LENGTH: 158
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(3)
<223> OTHER INFORMATION: UNA monomer
<220> FEATURE:
<221> NAME/KEY: modified_base
<222> LOCATION: (8)..(9)
<223> OTHER INFORMATION: UNA monomer
<220> FEATURE:
<221> NAME/KEY: modified_base
<222> LOCATION: (14)..(15)
<223> OTHER INFORMATION: UNA monomer
<220> FEATURE:
<221> NAME/KEY: modified_base
<222> LOCATION: (20)..(21)
<223> OTHER INFORMATION: UNA monomer
<220> FEATURE:
<221> NAME/KEY: modified_base
<222> LOCATION: (26)..(27)
<223> OTHER INFORMATION: UNA monomer
<220> FEATURE:
<221> NAME/KEY: modified_base <222> LOCATION: (32)..(33)
<223> OTHER INFORMATION: UNA monomer
<220> FEATURE:
<221> NAME/KEY: modified_base
<222> LOCATION: (38)..(39)
<223> OTHER INFORMATION: UNA monomer
<220> FEATURE:
<221> NAME/KEY: modified_base
<222> LOCATION: (44)..(45)
<223> OTHER INFORMATION: UNA monomer
<220> FEATURE:
<221> NAME/KEY: modified_base
<222> LOCATION: (50)..(51)
<223> OTHER INFORMATION: UNA monomer
<220> FEATURE:
<221> NAME/KEY: modified_base
<222> LOCATION: (56)..(57)
<223> OTHER INFORMATION: UNA monomer
<220> FEATURE:
<221> NAME/KEY: modified_base
<222> LOCATION: (62)..(63)
<223> OTHER INFORMATION: UNA monomer
<220> FEATURE:
<221> NAME/KEY: modified_base
<222> LOCATION: (68)..(69)
<223> OTHER INFORMATION: UNA monomer
<220> FEATURE:
<221> NAME/KEY: modified_base
<222> LOCATION: (74)..(75)
<223> OTHER INFORMATION: UNA monomer
<220> FEATURE:
<221> NAME/KEY: modified_base
<222> LOCATION: (80)..(81)
<223> OTHER INFORMATION: UNA monomer
<220> FEATURE:
<221> NAME/KEY: modified_base
<222> LOCATION: (86)..(87)
<223> OTHER INFORMATION: UNA monomer
<220> FEATURE:
<221> NAME/KEY: modified_base
<222> LOCATION: (92)..(93)
<223> OTHER INFORMATION: UNA monomer
<220> FEATURE:
<221> NAME/KEY: modified_base
<222> LOCATION: (98)..(99)
<223> OTHER INFORMATION: UNA monomer
<220> FEATURE:
<221> NAME/KEY: modified_base
<222> LOCATION: (104)..(105)
<223> OTHER INFORMATION: UNA monomer
<220> FEATURE:
<221> NAME/KEY: modified_base
<222> LOCATION: (110)..(111)
<223> OTHER INFORMATION: UNA monomer
<220> FEATURE:
<221> NAME/KEY: modified_base
<222> LOCATION: (116)..(117)
<223> OTHER INFORMATION: UNA monomer
<220> FEATURE:
<221> NAME/KEY: modified_base
<222> LOCATION: (122)..(123)
<223> OTHER INFORMATION: UNA monomer
<220> FEATURE:
<221> NAME/KEY: modified_base
<222> LOCATION: (128)..(129)
<223> OTHER INFORMATION: UNA monomer
<220> FEATURE:
<221> NAME/KEY: modified_base
<222> LOCATION: (134)..(135)
<223> OTHER INFORMATION: UNA monomer
<220> FEATURE:
<221> NAME/KEY: modified_base
<222> LOCATION: (140)..(141)
<223> OTHER INFORMATION: UNA monomer
<220> FEATURE:
<221> NAME/KEY: modified_base
<222> LOCATION: (146)..(147)
<223> OTHER INFORMATION: UNA monomer
<220> FEATURE:

<221> NAME/KEY: modified_base
<222> LOCATION: (152)..(153)
<223> OTHER INFORMATION: UNA monomer
<220> FEATURE:
<221> NAME/KEY: modified_base
<222> LOCATION: (157)..(157)
<223> OTHER INFORMATION: UNA monomer

<400> SEQUENCE: 145 cuagugacug acuaggaucu gguuaccacu aaaccagccu caagaacacc cgaauggagu 60 cucuaagcua cauaauacca acuuacacuu acaaaauguu gucccccaaa auguagccau 120 ucguaucugc uccuaauaaa aagaaaguuu cuucacau 158

<210> SEQ ID NO 146
<211> LENGTH: 158
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (1)..(158)
<223> OTHER INFORMATION: UNA monomer

<400> SEQUENCE: 146 cuagugacug acuaggaucu gguuaccacu aaaccagccu caagaacacc cgaauggagu 60 cucuaagcua cauaauacca acuuacacuu acaaaauguu gucccccaaa auguagccau 120 ucguaucugc uccuaauaaa aagaaaguuu cuucacau 158

<210> SEQ ID NO 147
<211> LENGTH: 1063
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (3)..(3)
<223> OTHER INFORMATION: UNA monomer
<220> FEATURE:
<221> NAME/KEY: modified_base
<222> LOCATION: (21)..(21)
<223> OTHER INFORMATION: UNA monomer
<220> FEATURE:
<221> NAME/KEY: modified_base
<222> LOCATION: (39)..(39)
<223> OTHER INFORMATION: UNA monomer
<220> FEATURE:
<221> NAME/KEY: modified_base
<222> LOCATION: (57)..(57)
<223> OTHER INFORMATION: UNA monomer
<220> FEATURE:
<221> NAME/KEY: modified_base
<222> LOCATION: (75)..(75)
<223> OTHER INFORMATION: UNA monomer
<220> FEATURE:
<221> NAME/KEY: modified_base
<222> LOCATION: (93)..(93)
<223> OTHER INFORMATION: UNA monomer
<220> FEATURE:
<221> NAME/KEY: modified_base
<222> LOCATION: (111)..(111)
<223> OTHER INFORMATION: UNA monomer
<220> FEATURE:
<221> NAME/KEY: modified_base
<222> LOCATION: (129)..(129)
<223> OTHER INFORMATION: UNA monomer
<220> FEATURE:
<221> NAME/KEY: modified_base <222> LOCATION: (147)..(147)
<223> OTHER INFORMATION: UNA monomer
<220> FEATURE:
<221> NAME/KEY: modified_base
<222> LOCATION: (165)..(165)
<223> OTHER INFORMATION: UNA monomer
<220> FEATURE:
<221> NAME/KEY: modified_base
<222> LOCATION: (183)..(183)
<223> OTHER INFORMATION: UNA monomer
<220> FEATURE:
<221> NAME/KEY: modified_base
<222> LOCATION: (201)..(201)
<223> OTHER INFORMATION: UNA monomer
<220> FEATURE:
<221> NAME/KEY: modified_base
<222> LOCATION: (218)..(218)
<223> OTHER INFORMATION: UNA monomer
<220> FEATURE:
<221> NAME/KEY: modified_base
<222> LOCATION: (236)..(236)
<223> OTHER INFORMATION: UNA monomer
<220> FEATURE:
<221> NAME/KEY: modified_base
<222> LOCATION: (254)..(254)
<223> OTHER INFORMATION: UNA monomer
<220> FEATURE:
<221> NAME/KEY: modified_base
<222> LOCATION: (272)..(272)
<223> OTHER INFORMATION: UNA monomer
<220> FEATURE:
<221> NAME/KEY: modified_base
<222> LOCATION: (290)..(290)
<223> OTHER INFORMATION: UNA monomer
<220> FEATURE:
<221> NAME/KEY: modified_base
<222> LOCATION: (308)..(308)
<223> OTHER INFORMATION: UNA monomer
<220> FEATURE:
<221> NAME/KEY: modified_base
<222> LOCATION: (327)..(327)
<223> OTHER INFORMATION: UNA monomer
<220> FEATURE:
<221> NAME/KEY: modified_base
<222> LOCATION: (345)..(345)
<223> OTHER INFORMATION: UNA monomer
<220> FEATURE:
<221> NAME/KEY: modified_base
<222> LOCATION: (363)..(363)
<223> OTHER INFORMATION: UNA monomer
<220> FEATURE:
<221> NAME/KEY: modified_base
<222> LOCATION: (381)..(381)
<223> OTHER INFORMATION: UNA monomer
<220> FEATURE:
<221> NAME/KEY: modified_base
<222> LOCATION: (399)..(399)
<223> OTHER INFORMATION: UNA monomer
<220> FEATURE:
<221> NAME/KEY: modified_base
<222> LOCATION: (417)..(417)
<223> OTHER INFORMATION: UNA monomer
<220> FEATURE:
<221> NAME/KEY: modified_base
<222> LOCATION: (453)..(453)
<223> OTHER INFORMATION: UNA monomer
<220> FEATURE:
<221> NAME/KEY: modified_base
<222> LOCATION: (471)..(471)
<223> OTHER INFORMATION: UNA monomer
<220> FEATURE:
<221> NAME/KEY: modified_base
<222> LOCATION: (490)..(490)
<223> OTHER INFORMATION: UNA monomer
<220> FEATURE:
<221> NAME/KEY: modified_base
<222> LOCATION: (508)..(508)
<223> OTHER INFORMATION: UNA monomer
<220> FEATURE:

<221> NAME/KEY: modified_base
<222> LOCATION: (527)..(527)
<223> OTHER INFORMATION: UNA monomer
<220> FEATURE:
<221> NAME/KEY: modified_base
<222> LOCATION: (545)..(545)
<223> OTHER INFORMATION: UNA monomer
<220> FEATURE:
<221> NAME/KEY: modified_base
<222> LOCATION: (563)..(563)
<223> OTHER INFORMATION: UNA monomer
<220> FEATURE:
<221> NAME/KEY: modified_base
<222> LOCATION: (581)..(581)
<223> OTHER INFORMATION: UNA monomer
<220> FEATURE:
<221> NAME/KEY: modified_base
<222> LOCATION: (599)..(599)
<223> OTHER INFORMATION: UNA monomer
<220> FEATURE:
<221> NAME/KEY: modified_base
<222> LOCATION: (617)..(617)
<223> OTHER INFORMATION: UNA monomer
<220> FEATURE:
<221> NAME/KEY: modified_base
<222> LOCATION: (635)..(635)
<223> OTHER INFORMATION: UNA monomer
<220> FEATURE:
<221> NAME/KEY: modified_base
<222> LOCATION: (653)..(653)
<223> OTHER INFORMATION: UNA monomer
<220> FEATURE:
<221> NAME/KEY: modified_base
<222> LOCATION: (671)..(671)
<223> OTHER INFORMATION: UNA monomer
<220> FEATURE:
<221> NAME/KEY: modified_base
<222> LOCATION: (689)..(689)
<223> OTHER INFORMATION: UNA monomer
<220> FEATURE:
<221> NAME/KEY: modified_base
<222> LOCATION: (707)..(707)
<223> OTHER INFORMATION: UNA monomer
<220> FEATURE:
<221> NAME/KEY: modified_base
<222> LOCATION: (725)..(725)
<223> OTHER INFORMATION: UNA monomer
<220> FEATURE:
<221> NAME/KEY: modified_base
<222> LOCATION: (743)..(743)
<223> OTHER INFORMATION: UNA monomer
<220> FEATURE:
<221> NAME/KEY: modified_base
<222> LOCATION: (761)..(761)
<223> OTHER INFORMATION: UNA monomer
<220> FEATURE:
<221> NAME/KEY: modified_base
<222> LOCATION: (779)..(779)
<223> OTHER INFORMATION: UNA monomer
<220> FEATURE:
<221> NAME/KEY: modified_base
<222> LOCATION: (797)..(797)
<223> OTHER INFORMATION: UNA monomer
<220> FEATURE:
<221> NAME/KEY: modified_base
<222> LOCATION: (815)..(815)
<223> OTHER INFORMATION: UNA monomer
<220> FEATURE:
<221> NAME/KEY: modified_base
<222> LOCATION: (833)..(833)
<223> OTHER INFORMATION: UNA monomer
<220> FEATURE:
<221> NAME/KEY: modified_base
<222> LOCATION: (851)..(851)
<223> OTHER INFORMATION: UNA monomer
<220> FEATURE:
<221> NAME/KEY: modified_base
<222> LOCATION: (869)..(869)
<223> OTHER INFORMATION: UNA monomer <220> FEATURE:
<221> NAME/KEY: modified_base
<222> LOCATION: (887)..(887)
<223> OTHER INFORMATION: UNA monomer
<220> FEATURE:
<221> NAME/KEY: modified_base
<222> LOCATION: (905)..(905)
<223> OTHER INFORMATION: UNA monomer
<220> FEATURE:
<221> NAME/KEY: modified_base
<222> LOCATION: (923)..(923)
<223> OTHER INFORMATION: UNA monomer
<220> FEATURE:
<221> NAME/KEY: modified_base
<222> LOCATION: (941)..(941)
<223> OTHER INFORMATION: UNA monomer
<220> FEATURE:
<221> NAME/KEY: modified_base
<222> LOCATION: (959)..(959)
<223> OTHER INFORMATION: UNA monomer
<220> FEATURE:
<221> NAME/KEY: modified_base
<222> LOCATION: (977)..(977)
<223> OTHER INFORMATION: UNA monomer
<220> FEATURE:
<221> NAME/KEY: modified_base
<222> LOCATION: (995)..(995)
<223> OTHER INFORMATION: UNA monomer
<220> FEATURE:
<221> NAME/KEY: modified_base
<222> LOCATION: (1013)..(1013)
<223> OTHER INFORMATION: UNA monomer
<220> FEATURE:
<221> NAME/KEY: modified_base
<222> LOCATION: (1031)..(1031)
<223> OTHER INFORMATION: UNA monomer
<220> FEATURE:
<221> NAME/KEY: modified_base
<222> LOCATION: (1049)..(1049)
<223> OTHER INFORMATION: UNA monomer
<220> FEATURE:
<221> NAME/KEY: modified_base
<222> LOCATION: (1062)..(1062)
<223> OTHER INFORMATION: UNA monomer

<400> SEQUENCE: 147 auggagcuga cugaauugcu ccucgugguc augcuucucc uaacugcaag gcuaacgcug 60 uccagcccgg cuccuccugc uugugaccuc cgaguccuca guaaacugcu ucgugacucc 120 cauguccuuc acagcagacu gagccagugc ccagagguuc acccuuugcc uacaccuguc 180 cugcugccug cuguggacuu uagcuuggga gaauggaaaa cccagaugga ggagaccaag 240 gcacaggaca uucugggagc agugacccuu cugcuggagg gagugauggc agcacgggga 300 caacugggac ccacuugccu cucaucccuc cuggggcagc uuucuggaca gguccgucuc 360 cuccuugggg cccugcagag ccuccuugga acccagcuuc cuccacaggg caggaccaca 420 gcucacaagg aucccaaugc caucuuccug agcuuccaac accugcuccg aggaaaggug 480 cguuuccuga ugcuuguagg aggguccacc cucugcguca ggcggggccc cacccaccac 540 agcuguccccc agcagaaccu cucuaguccu cacacugaac gagcucccaa acaggacuuc 600 uggauuguug gagacaaacu ucacugccuc agccagaacu acuggcucug ggcuucugaa 660 guggcagcag ggauucagag ccaagauucc uggucugcug aaccaaaccu ccagguccccu 720 ggaccaaauc cccggauacc ugaacaggau acacgaacuc uugaauggaa cucguggacu 780 cuuuccugga cccucacgca ggacccuagg agccccggac auuuccucag gaacaucaga 840 cacaggcucc cugccaccca accuccagcc uggauauucu ccuuccccaa cccauccucc 900 uacuggacag uauacgcucu ucccucuucc acccaccuug cccaccccug ugguccagcu 960 ccacccccug cuuccugacc cuucugcucc aacgcccacc ccuaccagcc cucuucuaaa 1020 cacauccuac acccacuccc agaaucuguc ucaggaaggg uaa 1063

<210> SEQ ID NO 148
<211> LENGTH: 1062
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (1059)..(1061)
<223> OTHER INFORMATION: UNA monomer

<400> SEQUENCE: 148 auggagcuga cugaauugcu ccucgugguc augcuucucc uaacugcaag gcuaacgcug 60 uccagcccgg cuccuccugc uugugaccuc cgaguccuca guaaacugcu ucgugacucc 120 cauguccuuc acagcagacu gagccagugc ccagagguuc acccuuugcc uacaccuguc 180 cugcugccug cuguggacuu uagcuuggga gaauggaaaa cccagaugga ggagaccaag 240 gcacaggaca uucugggagc agugacccuu cugcuggagg gagugauggc agcacgggga 300 caacugggac ccacuugccu cucaucccuc cuggggcagc uuucuggaca gguccgucuc 360 cuccuugggg cccugcagag ccuccuugga acccagcuuc cuccacaggg caggaccaca 420 gcucacaagg aucccaaugc caucuuccug agcuuccaac accugcuccg aggaaaggug 480 cguuuccuga ugcuuguagg aggguccacc cucugcguca ggcgggcccc acccaccaca 540 gcugucccca gcagaaccuc ucuaguccuc acacugaacg agcucccaaa caggacuucu 600 ggauuguugg agacaaacuu cacugccuca gccagaacua cuggcucugg gcuucugaag 660 uggcagcagg gauucagagc caagauuccu ggucugcuga accaaaccuc cagguccccug 720 gaccaaaucc ccggauaccu gaacaggaua cacgaacucu ugaauggaac ucguggacuc 780 uuuccuggac ccucacgcag gacccuagga gccccggaca uuuccucagg aacaucagac 840 acaggcuccc ugccacccaa ccuccagccu ggauauucuc cuuccccaac ccauccuccu 900 acuggacagu auacgcucuu cccucuucca cccaccuugc ccaccccugu gguccagcuc 960 cacccccugc uuccugaccc uucugcucca acgcccaccc cuaccagccc ucuucuaaac 1020 acauccuaca cccacuccca gaaucugucu caggaagggu aa 1062

<210> SEQ ID NO 149
<211> LENGTH: 1062
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (8)..(8)
<223> OTHER INFORMATION: UNA monomer
<220> FEATURE:
<221> NAME/KEY: modified_base
<222> LOCATION: (12)..(12)
<223> OTHER INFORMATION: UNA monomer <220> FEATURE:
<221> NAME/KEY: modified_base
<222> LOCATION: (16)..(17)
<223> OTHER INFORMATION: UNA monomer
<220> FEATURE:
<221> NAME/KEY: modified_base
<222> LOCATION: (20)..(20)
<223> OTHER INFORMATION: UNA monomer
<220> FEATURE:
<221> NAME/KEY: modified_base
<222> LOCATION: (23)..(23)
<223> OTHER INFORMATION: UNA monomer
<220> FEATURE:
<221> NAME/KEY: modified_base
<222> LOCATION: (26)..(26)
<223> OTHER INFORMATION: UNA monomer
<220> FEATURE:
<221> NAME/KEY: modified_base
<222> LOCATION: (29)..(29)
<223> OTHER INFORMATION: UNA monomer
<220> FEATURE:
<221> NAME/KEY: modified_base
<222> LOCATION: (32)..(32)
<223> OTHER INFORMATION: UNA monomer
<220> FEATURE:
<221> NAME/KEY: modified_base
<222> LOCATION: (35)..(36)
<223> OTHER INFORMATION: UNA monomer
<220> FEATURE:
<221> NAME/KEY: modified_base
<222> LOCATION: (38)..(38)
<223> OTHER INFORMATION: UNA monomer
<220> FEATURE:
<221> NAME/KEY: modified_base
<222> LOCATION: (41)..(41)
<223> OTHER INFORMATION: UNA monomer
<220> FEATURE:
<221> NAME/KEY: modified_base
<222> LOCATION: (45)..(45)
<223> OTHER INFORMATION: UNA monomer
<220> FEATURE:
<221> NAME/KEY: modified_base
<222> LOCATION: (53)..(53)
<223> OTHER INFORMATION: UNA monomer
<220> FEATURE:
<221> NAME/KEY: modified_base
<222> LOCATION: (59)..(59)
<223> OTHER INFORMATION: UNA monomer
<220> FEATURE:
<221> NAME/KEY: modified_base
<222> LOCATION: (61)..(61)
<223> OTHER INFORMATION: UNA monomer
<220> FEATURE:
<221> NAME/KEY: modified_base
<222> LOCATION: (72)..(72)
<223> OTHER INFORMATION: UNA monomer
<220> FEATURE:
<221> NAME/KEY: modified_base
<222> LOCATION: (75)..(75)
<223> OTHER INFORMATION: UNA monomer
<220> FEATURE:
<221> NAME/KEY: modified_base
<222> LOCATION: (78)..(78)
<223> OTHER INFORMATION: UNA monomer
<220> FEATURE:
<221> NAME/KEY: modified_base
<222> LOCATION: (81)..(82)
<223> OTHER INFORMATION: UNA monomer
<220> FEATURE:
<221> NAME/KEY: modified_base
<222> LOCATION: (84)..(84)
<223> OTHER INFORMATION: UNA monomer
<220> FEATURE:
<221> NAME/KEY: modified_base
<222> LOCATION: (89)..(89)
<223> OTHER INFORMATION: UNA monomer
<220> FEATURE:
<221> NAME/KEY: modified_base
<222> LOCATION: (95)..(95)

<223> OTHER INFORMATION: UNA monomer
<220> FEATURE:
<221> NAME/KEY: modified_base
<222> LOCATION: (98)..(98)
<223> OTHER INFORMATION: UNA monomer
<220> FEATURE:
<221> NAME/KEY: modified_base
<222> LOCATION: (102)..(102)
<223> OTHER INFORMATION: UNA monomer
<220> FEATURE:
<221> NAME/KEY: modified_base
<222> LOCATION: (107)..(107)
<223> OTHER INFORMATION: UNA monomer
<220> FEATURE:
<221> NAME/KEY: modified_base
<222> LOCATION: (110)..(111)
<223> OTHER INFORMATION: UNA monomer
<220> FEATURE:
<221> NAME/KEY: modified_base
<222> LOCATION: (114)..(114)
<223> OTHER INFORMATION: UNA monomer
<220> FEATURE:
<221> NAME/KEY: modified_base
<222> LOCATION: (118)..(118)
<223> OTHER INFORMATION: UNA monomer
<220> FEATURE:
<221> NAME/KEY: modified_base
<222> LOCATION: (123)..(123)
<223> OTHER INFORMATION: UNA monomer
<220> FEATURE:
<221> NAME/KEY: modified_base
<222> LOCATION: (125)..(125)
<223> OTHER INFORMATION: UNA monomer
<220> FEATURE:
<221> NAME/KEY: modified_base
<222> LOCATION: (128)..(129)
<223> OTHER INFORMATION: UNA monomer
<220> FEATURE:
<221> NAME/KEY: modified_base
<222> LOCATION: (140)..(140)
<223> OTHER INFORMATION: UNA monomer
<220> FEATURE:
<221> NAME/KEY: modified_base
<222> LOCATION: (148)..(148)
<223> OTHER INFORMATION: UNA monomer
<220> FEATURE:
<221> NAME/KEY: modified_base
<222> LOCATION: (158)..(159)
<223> OTHER INFORMATION: UNA monomer
<220> FEATURE:
<221> NAME/KEY: modified_base
<222> LOCATION: (165)..(167)
<223> OTHER INFORMATION: UNA monomer
<220> FEATURE:
<221> NAME/KEY: modified_base
<222> LOCATION: (171)..(171)
<223> OTHER INFORMATION: UNA monomer
<220> FEATURE:
<221> NAME/KEY: modified_base
<222> LOCATION: (177)..(177)
<223> OTHER INFORMATION: UNA monomer
<220> FEATURE:
<221> NAME/KEY: modified_base
<222> LOCATION: (179)..(179)
<223> OTHER INFORMATION: UNA monomer
<220> FEATURE:
<221> NAME/KEY: modified_base
<222> LOCATION: (182)..(182)
<223> OTHER INFORMATION: UNA monomer
<220> FEATURE:
<221> NAME/KEY: modified_base
<222> LOCATION: (185)..(185)
<223> OTHER INFORMATION: UNA monomer
<220> FEATURE:
<221> NAME/KEY: modified_base
<222> LOCATION: (189)..(189)
<223> OTHER INFORMATION: UNA monomer
<220> FEATURE:
<221> NAME/KEY: modified_base <222> LOCATION: (192)..(192)
<223> OTHER INFORMATION: UNA monomer
<220> FEATURE:
<221> NAME/KEY: modified_base
<222> LOCATION: (194)..(194)
<223> OTHER INFORMATION: UNA monomer
<220> FEATURE:
<221> NAME/KEY: modified_base
<222> LOCATION: (199)..(201)
<223> OTHER INFORMATION: UNA monomer
<220> FEATURE:
<221> NAME/KEY: modified_base
<222> LOCATION: (205)..(206)
<223> OTHER INFORMATION: UNA monomer
<220> FEATURE:
<221> NAME/KEY: modified_base
<222> LOCATION: (214)..(214)
<223> OTHER INFORMATION: UNA monomer
<220> FEATURE:
<221> NAME/KEY: modified_base
<222> LOCATION: (227)..(227)
<223> OTHER INFORMATION: UNA monomer
<220> FEATURE:
<221> NAME/KEY: modified_base
<222> LOCATION: (251)..(252)
<223> OTHER INFORMATION: UNA monomer
<220> FEATURE:
<221> NAME/KEY: modified_base
<222> LOCATION: (254)..(254)
<223> OTHER INFORMATION: UNA monomer
<220> FEATURE:
<221> NAME/KEY: modified_base
<222> LOCATION: (263)..(263)
<223> OTHER INFORMATION: UNA monomer
<220> FEATURE:
<221> NAME/KEY: modified_base
<222> LOCATION: (269)..(270)
<223> OTHER INFORMATION: UNA monomer
<220> FEATURE:
<221> NAME/KEY: modified_base
<222> LOCATION: (272)..(272)
<223> OTHER INFORMATION: UNA monomer
<220> FEATURE:
<221> NAME/KEY: modified_base
<222> LOCATION: (275)..(275)
<223> OTHER INFORMATION: UNA monomer
<220> FEATURE:
<221> NAME/KEY: modified_base
<222> LOCATION: (284)..(284)
<223> OTHER INFORMATION: UNA monomer
<220> FEATURE:
<221> NAME/KEY: modified_base
<222> LOCATION: (287)..(287)
<223> OTHER INFORMATION: UNA monomer
<220> FEATURE:
<221> NAME/KEY: modified_base
<222> LOCATION: (305)..(305)
<223> OTHER INFORMATION: UNA monomer
<220> FEATURE:
<221> NAME/KEY: modified_base
<222> LOCATION: (315)..(316)
<223> OTHER INFORMATION: UNA monomer
<220> FEATURE:
<221> NAME/KEY: modified_base
<222> LOCATION: (320)..(320)
<223> OTHER INFORMATION: UNA monomer
<220> FEATURE:
<221> NAME/KEY: modified_base
<222> LOCATION: (322)..(322)
<223> OTHER INFORMATION: UNA monomer
<220> FEATURE:
<221> NAME/KEY: modified_base
<222> LOCATION: (325)..(325)
<223> OTHER INFORMATION: UNA monomer
<220> FEATURE:
<221> NAME/KEY: modified_base
<222> LOCATION: (329)..(329)
<223> OTHER INFORMATION: UNA monomer
<220> FEATURE:

<221> NAME/KEY: modified_base
<222> LOCATION: (332)..(332)
<223> OTHER INFORMATION: UNA monomer
<220> FEATURE:
<221> NAME/KEY: modified_base
<222> LOCATION: (341)..(343)
<223> OTHER INFORMATION: UNA monomer
<220> FEATURE:
<221> NAME/KEY: modified_base
<222> LOCATION: (345)..(345)
<223> OTHER INFORMATION: UNA monomer
<220> FEATURE:
<221> NAME/KEY: modified_base
<222> LOCATION: (353)..(353)
<223> OTHER INFORMATION: UNA monomer
<220> FEATURE:
<221> NAME/KEY: modified_base
<222> LOCATION: (357)..(357)
<223> OTHER INFORMATION: UNA monomer
<220> FEATURE:
<221> NAME/KEY: modified_base
<222> LOCATION: (359)..(359)
<223> OTHER INFORMATION: UNA monomer
<220> FEATURE:
<221> NAME/KEY: modified_base
<222> LOCATION: (362)..(362)
<223> OTHER INFORMATION: UNA monomer
<220> FEATURE:
<221> NAME/KEY: modified_base
<222> LOCATION: (365)..(366)
<223> OTHER INFORMATION: UNA monomer
<220> FEATURE:
<221> NAME/KEY: modified_base
<222> LOCATION: (374)..(374)
<223> OTHER INFORMATION: UNA monomer
<220> FEATURE:
<221> NAME/KEY: modified_base
<222> LOCATION: (383)..(383)
<223> OTHER INFORMATION: UNA monomer
<220> FEATURE:
<221> NAME/KEY: modified_base
<222> LOCATION: (386)..(387)
<223> OTHER INFORMATION: UNA monomer
<220> FEATURE:
<221> NAME/KEY: modified_base
<222> LOCATION: (398)..(399)
<223> OTHER INFORMATION: UNA monomer
<220> FEATURE:
<221> NAME/KEY: modified_base
<222> LOCATION: (402)..(402)
<223> OTHER INFORMATION: UNA monomer
<220> FEATURE:
<221> NAME/KEY: modified_base
<222> LOCATION: (423)..(423)
<223> OTHER INFORMATION: UNA monomer
<220> FEATURE:
<221> NAME/KEY: modified_base
<222> LOCATION: (432)..(432)
<223> OTHER INFORMATION: UNA monomer
<220> FEATURE:
<221> NAME/KEY: modified_base
<222> LOCATION: (438)..(438)
<223> OTHER INFORMATION: UNA monomer
<220> FEATURE:
<221> NAME/KEY: modified_base
<222> LOCATION: (443)..(443)
<223> OTHER INFORMATION: UNA monomer
<220> FEATURE:
<221> NAME/KEY: modified_base
<222> LOCATION: (445)..(446)
<223> OTHER INFORMATION: UNA monomer
<220> FEATURE:
<221> NAME/KEY: modified_base
<222> LOCATION: (449)..(449)
<223> OTHER INFORMATION: UNA monomer
<220> FEATURE:
<221> NAME/KEY: modified_base
<222> LOCATION: (454)..(455)
<223> OTHER INFORMATION: UNA monomer <220> FEATURE:
<221> NAME/KEY: modified_base
<222> LOCATION: (464)..(464)
<223> OTHER INFORMATION: UNA monomer
<220> FEATURE:
<221> NAME/KEY: modified_base
<222> LOCATION: (467)..(467)
<223> OTHER INFORMATION: UNA monomer
<220> FEATURE:
<221> NAME/KEY: modified_base
<222> LOCATION: (479)..(479)
<223> OTHER INFORMATION: UNA monomer
<220> FEATURE:
<221> NAME/KEY: modified_base
<222> LOCATION: (483)..(485)
<223> OTHER INFORMATION: UNA monomer
<220> FEATURE:
<221> NAME/KEY: modified_base
<222> LOCATION: (488)..(488)
<223> OTHER INFORMATION: UNA monomer
<220> FEATURE:
<221> NAME/KEY: modified_base
<222> LOCATION: (491)..(491)
<223> OTHER INFORMATION: UNA monomer
<220> FEATURE:
<221> NAME/KEY: modified_base
<222> LOCATION: (494)..(495)
<223> OTHER INFORMATION: UNA monomer
<220> FEATURE:
<221> NAME/KEY: modified_base
<222> LOCATION: (497)..(497)
<223> OTHER INFORMATION: UNA monomer
<220> FEATURE:
<221> NAME/KEY: modified_base
<222> LOCATION: (505)..(505)
<223> OTHER INFORMATION: UNA monomer
<220> FEATURE:
<221> NAME/KEY: modified_base
<222> LOCATION: (512)..(512)
<223> OTHER INFORMATION: UNA monomer
<220> FEATURE:
<221> NAME/KEY: modified_base
<222> LOCATION: (514)..(514)
<223> OTHER INFORMATION: UNA monomer
<220> FEATURE:
<221> NAME/KEY: modified_base
<222> LOCATION: (518)..(518)
<223> OTHER INFORMATION: UNA monomer
<220> FEATURE:
<221> NAME/KEY: modified_base
<222> LOCATION: (543)..(543)
<223> OTHER INFORMATION: UNA monomer
<220> FEATURE:
<221> NAME/KEY: modified_base
<222> LOCATION: (545)..(545)
<223> OTHER INFORMATION: UNA monomer
<220> FEATURE:
<221> NAME/KEY: modified_base
<222> LOCATION: (559)..(559)
<223> OTHER INFORMATION: UNA monomer
<220> FEATURE:
<221> NAME/KEY: modified_base
<222> LOCATION: (561)..(561)
<223> OTHER INFORMATION: UNA monomer
<220> FEATURE:
<221> NAME/KEY: modified_base
<222> LOCATION: (563)..(563)
<223> OTHER INFORMATION: UNA monomer
<220> FEATURE:
<221> NAME/KEY: modified_base
<222> LOCATION: (566)..(566)
<223> OTHER INFORMATION: UNA monomer
<220> FEATURE:
<221> NAME/KEY: modified_base
<222> LOCATION: (569)..(569)
<223> OTHER INFORMATION: UNA monomer
<220> FEATURE:
<221> NAME/KEY: modified_base
<222> LOCATION: (575)..(575)

<223> OTHER INFORMATION: UNA monomer
<220> FEATURE:
<221> NAME/KEY: modified_base
<222> LOCATION: (584)..(584)
<223> OTHER INFORMATION: UNA monomer
<220> FEATURE:
<221> NAME/KEY: modified_base
<222> LOCATION: (597)..(598)
<223> OTHER INFORMATION: UNA monomer
<220> FEATURE:
<221> NAME/KEY: modified_base
<222> LOCATION: (600)..(600)
<223> OTHER INFORMATION: UNA monomer
<220> FEATURE:
<221> NAME/KEY: modified_base
<222> LOCATION: (604)..(605)
<223> OTHER INFORMATION: UNA monomer
<220> FEATURE:
<221> NAME/KEY: modified_base
<222> LOCATION: (607)..(608)
<223> OTHER INFORMATION: UNA monomer
<220> FEATURE:
<221> NAME/KEY: modified_base
<222> LOCATION: (619)..(620)
<223> OTHER INFORMATION: UNA monomer
<220> FEATURE:
<221> NAME/KEY: modified_base
<222> LOCATION: (624)..(624)
<223> OTHER INFORMATION: UNA monomer
<220> FEATURE:
<221> NAME/KEY: modified_base
<222> LOCATION: (628)..(628)
<223> OTHER INFORMATION: UNA monomer
<220> FEATURE:
<221> NAME/KEY: modified_base
<222> LOCATION: (639)..(639)
<223> OTHER INFORMATION: UNA monomer
<220> FEATURE:
<221> NAME/KEY: modified_base
<222> LOCATION: (642)..(642)
<223> OTHER INFORMATION: UNA monomer
<220> FEATURE:
<221> NAME/KEY: modified_base
<222> LOCATION: (646)..(646)
<223> OTHER INFORMATION: UNA monomer
<220> FEATURE:
<221> NAME/KEY: modified_base
<222> LOCATION: (648)..(648)
<223> OTHER INFORMATION: UNA monomer
<220> FEATURE:
<221> NAME/KEY: modified_base
<222> LOCATION: (653)..(654)
<223> OTHER INFORMATION: UNA monomer
<220> FEATURE:
<221> NAME/KEY: modified_base
<222> LOCATION: (656)..(656)
<223> OTHER INFORMATION: UNA monomer
<220> FEATURE:
<221> NAME/KEY: modified_base
<222> LOCATION: (661)..(661)
<223> OTHER INFORMATION: UNA monomer
<220> FEATURE:
<221> NAME/KEY: modified_base
<222> LOCATION: (673)..(674)
<223> OTHER INFORMATION: UNA monomer
<220> FEATURE:
<221> NAME/KEY: modified_base
<222> LOCATION: (686)..(687)
<223> OTHER INFORMATION: UNA monomer
<220> FEATURE:
<221> NAME/KEY: modified_base
<222> LOCATION: (690)..(690)
<223> OTHER INFORMATION: UNA monomer
<220> FEATURE:
<221> NAME/KEY: modified_base
<222> LOCATION: (693)..(693)
<223> OTHER INFORMATION: UNA monomer
<220> FEATURE:
<221> NAME/KEY: modified_base <222> LOCATION: (695)..(695)
<223> OTHER INFORMATION: UNA monomer
<220> FEATURE:
<221> NAME/KEY: modified_base
<222> LOCATION: (698)..(698)
<223> OTHER INFORMATION: UNA monomer
<220> FEATURE:
<221> NAME/KEY: modified_base
<222> LOCATION: (709)..(709)
<223> OTHER INFORMATION: UNA monomer
<220> FEATURE:
<221> NAME/KEY: modified_base
<222> LOCATION: (715)..(715)
<223> OTHER INFORMATION: UNA monomer
<220> FEATURE:
<221> NAME/KEY: modified_base
<222> LOCATION: (719)..(719)
<223> OTHER INFORMATION: UNA monomer
<220> FEATURE:
<221> NAME/KEY: modified_base
<222> LOCATION: (728)..(728)
<223> OTHER INFORMATION: UNA monomer
<220> FEATURE:
<221> NAME/KEY: modified_base
<222> LOCATION: (736)..(736)
<223> OTHER INFORMATION: UNA monomer
<220> FEATURE:
<221> NAME/KEY: modified_base
<222> LOCATION: (740)..(740)
<223> OTHER INFORMATION: UNA monomer
<220> FEATURE:
<221> NAME/KEY: modified_base
<222> LOCATION: (749)..(749)
<223> OTHER INFORMATION: UNA monomer
<220> FEATURE:
<221> NAME/KEY: modified_base
<222> LOCATION: (758)..(758)
<223> OTHER INFORMATION: UNA monomer
<220> FEATURE:
<221> NAME/KEY: modified_base
<222> LOCATION: (760)..(761)
<223> OTHER INFORMATION: UNA monomer
<220> FEATURE:
<221> NAME/KEY: modified_base
<222> LOCATION: (765)..(765)
<223> OTHER INFORMATION: UNA monomer
<220> FEATURE:
<221> NAME/KEY: modified_base
<222> LOCATION: (771)..(771)
<223> OTHER INFORMATION: UNA monomer
<220> FEATURE:
<221> NAME/KEY: modified_base
<222> LOCATION: (774)..(774)
<223> OTHER INFORMATION: UNA monomer
<220> FEATURE:
<221> NAME/KEY: modified_base
<222> LOCATION: (779)..(779)
<223> OTHER INFORMATION: UNA monomer
<220> FEATURE:
<221> NAME/KEY: modified_base
<222> LOCATION: (781)..(783)
<223> OTHER INFORMATION: UNA monomer
<220> FEATURE:
<221> NAME/KEY: modified_base
<222> LOCATION: (786)..(786)
<223> OTHER INFORMATION: UNA monomer
<220> FEATURE:
<221> NAME/KEY: modified_base
<222> LOCATION: (793)..(793)
<223> OTHER INFORMATION: UNA monomer
<220> FEATURE:
<221> NAME/KEY: modified_base
<222> LOCATION: (806)..(806)
<223> OTHER INFORMATION: UNA monomer
<220> FEATURE:
<221> NAME/KEY: modified_base
<222> LOCATION: (821)..(823)
<223> OTHER INFORMATION: UNA monomer
<220> FEATURE:

<221> NAME/KEY: modified_base
<222> LOCATION: (826)..(826)
<223> OTHER INFORMATION: UNA monomer
<220> FEATURE:
<221> NAME/KEY: modified_base
<222> LOCATION: (835)..(835)
<223> OTHER INFORMATION: UNA monomer
<220> FEATURE:
<221> NAME/KEY: modified_base
<222> LOCATION: (847)..(847)
<223> OTHER INFORMATION: UNA monomer
<220> FEATURE:
<221> NAME/KEY: modified_base
<222> LOCATION: (851)..(851)
<223> OTHER INFORMATION: UNA monomer
<220> FEATURE:
<221> NAME/KEY: modified_base
<222> LOCATION: (863)..(863)
<223> OTHER INFORMATION: UNA monomer
<220> FEATURE:
<221> NAME/KEY: modified_base
<222> LOCATION: (870)..(870)
<223> OTHER INFORMATION: UNA monomer
<220> FEATURE:
<221> NAME/KEY: modified_base
<222> LOCATION: (874)..(874)
<223> OTHER INFORMATION: UNA monomer
<220> FEATURE:
<221> NAME/KEY: modified_base
<222> LOCATION: (876)..(877)
<223> OTHER INFORMATION: UNA monomer
<220> FEATURE:
<221> NAME/KEY: modified_base
<222> LOCATION: (879)..(879)
<223> OTHER INFORMATION: UNA monomer
<220> FEATURE:
<221> NAME/KEY: modified_base
<222> LOCATION: (882)..(883)
<223> OTHER INFORMATION: UNA monomer
<220> FEATURE:
<221> NAME/KEY: modified_base
<222> LOCATION: (894)..(894)
<223> OTHER INFORMATION: UNA monomer
<220> FEATURE:
<221> NAME/KEY: modified_base
<222> LOCATION: (897)..(897)
<223> OTHER INFORMATION: UNA monomer
<220> FEATURE:
<221> NAME/KEY: modified_base
<222> LOCATION: (900)..(900)
<223> OTHER INFORMATION: UNA monomer
<220> FEATURE:
<221> NAME/KEY: modified_base
<222> LOCATION: (903)..(903)
<223> OTHER INFORMATION: UNA monomer
<220> FEATURE:
<221> NAME/KEY: modified_base
<222> LOCATION: (910)..(910)
<223> OTHER INFORMATION: UNA monomer
<220> FEATURE:
<221> NAME/KEY: modified_base
<222> LOCATION: (912)..(912)
<223> OTHER INFORMATION: UNA monomer
<220> FEATURE:
<221> NAME/KEY: modified_base
<222> LOCATION: (917)..(917)
<223> OTHER INFORMATION: UNA monomer
<220> FEATURE:
<221> NAME/KEY: modified_base
<222> LOCATION: (919)..(920)
<223> OTHER INFORMATION: UNA monomer
<220> FEATURE:
<221> NAME/KEY: modified_base
<222> LOCATION: (924)..(924)
<223> OTHER INFORMATION: UNA monomer
<220> FEATURE:
<221> NAME/KEY: modified_base
<222> LOCATION: (926)..(927)
<223> OTHER INFORMATION: UNA monomer <220> FEATURE:
<221> NAME/KEY: modified_base
<222> LOCATION: (937)..(938)
<223> OTHER INFORMATION: UNA monomer
<220> FEATURE:
<221> NAME/KEY: modified_base
<222> LOCATION: (948)..(948)
<223> OTHER INFORMATION: UNA monomer
<220> FEATURE:
<221> NAME/KEY: modified_base
<222> LOCATION: (950)..(950)
<223> OTHER INFORMATION: UNA monomer
<220> FEATURE:
<221> NAME/KEY: modified_base
<222> LOCATION: (953)..(953)
<223> OTHER INFORMATION: UNA monomer
<220> FEATURE:
<221> NAME/KEY: modified_base
<222> LOCATION: (959)..(959)
<223> OTHER INFORMATION: UNA monomer
<220> FEATURE:
<221> NAME/KEY: modified_base
<222> LOCATION: (968)..(968)
<223> OTHER INFORMATION: UNA monomer
<220> FEATURE:
<221> NAME/KEY: modified_base
<222> LOCATION: (971)..(972)
<223> OTHER INFORMATION: UNA monomer
<220> FEATURE:
<221> NAME/KEY: modified_base
<222> LOCATION: (975)..(975)
<223> OTHER INFORMATION: UNA monomer
<220> FEATURE:
<221> NAME/KEY: modified_base
<222> LOCATION: (981)..(982)
<223> OTHER INFORMATION: UNA monomer
<220> FEATURE:
<221> NAME/KEY: modified_base
<222> LOCATION: (984)..(984)
<223> OTHER INFORMATION: UNA monomer
<220> FEATURE:
<221> NAME/KEY: modified_base
<222> LOCATION: (987)..(987)
<223> OTHER INFORMATION: UNA monomer
<220> FEATURE:
<221> NAME/KEY: modified_base
<222> LOCATION: (1002)..(1002)
<223> OTHER INFORMATION: UNA monomer
<220> FEATURE:
<221> NAME/KEY: modified_base
<222> LOCATION: (1011)..(1011)
<223> OTHER INFORMATION: UNA monomer
<220> FEATURE:
<221> NAME/KEY: modified_base
<222> LOCATION: (1013)..(1014)
<223> OTHER INFORMATION: UNA monomer
<220> FEATURE:
<221> NAME/KEY: modified_base
<222> LOCATION: (1016)..(1016)
<223> OTHER INFORMATION: UNA monomer
<220> FEATURE:
<221> NAME/KEY: modified_base
<222> LOCATION: (1024)..(1024)
<223> OTHER INFORMATION: UNA monomer
<220> FEATURE:
<221> NAME/KEY: modified_base
<222> LOCATION: (1027)..(1027)
<223> OTHER INFORMATION: UNA monomer
<220> FEATURE:
<221> NAME/KEY: modified_base
<222> LOCATION: (1036)..(1036)
<223> OTHER INFORMATION: UNA monomer
<220> FEATURE:
<221> NAME/KEY: modified_base
<222> LOCATION: (1044)..(1044)
<223> OTHER INFORMATION: UNA monomer
<220> FEATURE:
<221> NAME/KEY: modified_base
<222> LOCATION: (1046)..(1046)

<223> OTHER INFORMATION: UNA monomer
<220> FEATURE:
<221> NAME/KEY: modified_base
<222> LOCATION: (1048)..(1048)
<223> OTHER INFORMATION: UNA monomer
<220> FEATURE:
<221> NAME/KEY: modified_base
<222> LOCATION: (1050)..(1050)
<223> OTHER INFORMATION: UNA monomer
<220> FEATURE:
<221> NAME/KEY: modified_base
<222> LOCATION: (1060)..(1060)
<223> OTHER INFORMATION: UNA monomer

<400> SEQUENCE: 149 auggagcuga cugaauugcu ccucgugguc augcuucucc uaacugcaag gcuaacgcug 60 uccagcccgg cuccuccugc uugugaccuc cgaguccuca guaaacugcu ucgugacucc 120 cauguccuuc acagcagacu gagccagugc ccagagguuc acccuuugcc uacaccuguc 180 cugcugccug cuguggacuu uagcuuggga gaauggaaaa cccagaugga ggagaccaag 240 gcacaggaca uucugggagc agugacccuu cugcuggagg gagugauggc agcacgggga 300 caacugggac ccacuugccu cucauccccuc cuggggcagc uuucuggaca gguccgucuc 360 cuccuugggg cccugcagag ccuccuugga acccagcuuc cuccacaggg caggaccaca 420 gcucacaagg aucccaaugc caucuuccug agcuuccaac accugcuccg aggaaaggug 480 cguuuccuga ugcuuguagg aggguccacc cucugcguca ggcgggcccc acccaccaca 540 gcuguccccca gcagaaccuc ucuaguccuc acacugaacg agcucccaaa caggacuucu 600 ggauuguugg agacaaacuu cacugccuca gccagaacua cuggcucugg gcuucugaag 660 uggcagcagg gauucagagc caagauuccu ggucugcuga accaaaccuc cagguccccug 720 gaccaaaucc ccggauaccu gaacaggaua cacgaacucu ugaauggaac ucguggacuc 780 uuuccuggac ccucacgcag gacccuagga gccccggaca uuuccucagg aacaucagac 840 acaggcuccc ugccacccaa ccuccagccu ggauauucuc cuuccccaac ccauccuccu 900 acuggacagu auacgcucuu cccucuucca cccaccuugc ccaccccugu gguccagcuc 960 cacccccugc uuccugaccc uucugcucca acgcccaccc cuaccagccc ucuucuaaac 1020 acauccuaca cccacuccca gaaucugucu caggaagggu aa 1062

<210> SEQ ID NO 150
<211> LENGTH: 4599
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (4596)..(4598)
<223> OTHER INFORMATION: UNA monomer

<400> SEQUENCE: 150 augggacaca guaaacagau ucgaauuuua cuucugaacg aaauggagaa acuggaaaag 60 acccucuuca gacuugaaca aggguaugag cuacaguucc gauuaggccc aacuuuacag 120 ggaaaagcag uuaccgugua uacaaauuac ccauuuccug gagaaacauu uaauagagaa 180 aaauuccguu cucuggauug ggaaaaucca acagaaagag aagaugauuc ugauaaauac 240

-continued

```
uguaaacuua aucugcaaca aucugguuca uuucaguauu auuuccuuca aggaaaugag    300
aaaaguggug gagguuacau aguuguggac cccauuuuac guguuggugc ugauaaucau    360
gugcuacccu uggacugugu uacucuucag acauuuuuag cuaaguguuu gggaccuuuu    420
gaugaauggg aaagcagacu uaggguugca aaagaaucag gcuacaacau gauucauuuu    480
accccauugc agacucuugg acuaucuagg ucaugcuacu cccuugccaa ucaguuagaa    540
uuaaauccug acuuuucaag accuaauaga aaguauaccu ggaaugaugu uggacagcua    600
guggaaaaau uaaaaaagga auggaauguu auuuguauua cugauguugu cuacaaucau    660
acugcugcua auaguaaaug gauccaggaa cauccagaau gugccuauaa ucuugugaau    720
ucuccacacu uaaaaccugc cugggucuua gacagagcac uuuggcguuu cuccugugau    780
guugcagaag ggaaauacaa agaaaaggga auaccugcuu ugauugaaaa ugaucaccau    840
augaauucca uccgaaaaau aauuugggag gauauuuuuc caaagcuuaa acucugggaa    900
uuuuuccaag uagaugucaa caaagcgguu gagcaauuua gaagacuucu uacacaagaa    960
aauaggcgag uaaccaaguc ugauccaaac caacaccuua cgauuauuca agauccugaa   1020
uacagacggu uuggcuguac uguagauaug aacauugcac uaacgacuuu cauaccacau   1080
gacaaggggc cagcagcaau ugaagaaugc uguaauuggu uucauaaaag aauggaggaa   1140
uuaaauucag agaagcaucg acucauuaac uaucaucagg aacaggcagu uaauugccuu   1200
uugggaaaug uguuuuauga acgacuggcu ggccaugguc caaaacuagg accugucacu   1260
agaaagcauc cuuuaguuac cagguauuuu acuuucccau uugaagagau agacuucucc   1320
auggaagaau cuaugauuca ucugccaaau aaagcuuguu uucugauggc acacaaugga   1380
uggguaaugg gagaugaucc ucuucgaaac uuugcugaac cggguucaga aguuuaccua   1440
aggagagaac uuauuugcug gggagacagu guuaaauuac gcuaugggaa uaaaccagag   1500
gacuguccuu aucucugggc acacaugaaa aaauacacug aaauaacugc aacuuauuuc   1560
cagggaguac gucuugauaa cugccacuca acaccucuuc acguagcuga guacauguug   1620
gaugcugcua ggaauuugca acccaauuua uauguaguag cugaacuguu cacaggaagu   1680
gaagaucugg acaaugucuu uguuacuaga cugggcauua guuccuuaau aagagaggca   1740
augagugcau auaauaguca ugaagagggc agauuaguuu accgauaugg aggagaaccu   1800
guuggauccu uuguucagcc cuguuugagg ccuuuaaugc cagcuauugc acaugcccug   1860
uuuauggaua uuacgcauga uaaugagugu ccuauugugc auagaucagc guaugaugcu   1920
cuuccaagua cuacaauugu uucuauggca uguugugcua guggaaguac aagaggcuau   1980
gaugaauuag ugccucauca gauuucagug guuucugaag aacgguuuua cacuaagugg   2040
aauccugaag cauugccuuc aaacacaggu gaaguuaauu uccaaagcgg cauuauugca   2100
gccaggugug cuaucaguaa acuucaucag gagcuuggag ccaaggguuu uauucaggug   2160
uauguggauc aaguugauga agacauagug gcaguaacaa gacacucacc uagcauccau   2220
cagucuguug uggcuguauc uagaacugcu uucaggaauc ccaagacuuc auuuuacagc   2280
aaggaagugc cucaaaugug caucccuggc aaaauugaag aaguaguucu ugaagcuaga   2340
acuauugaga gaaacacgaa accuuauagg aaggaugaga auucaaucaa uggaacacca   2400
gauaucacag uagaaauuag agaacauauu cagcuuaaug aaaguaaaau uguuaaacaa   2460
gcuggaguug ccacaaaagg gcccaaugaa uauauucaag aaauagaauu ugaaaacuug   2520
ucuccaggaa guguuauuau auucagaguu agucuugauc cacaugcaca agucgcuguu   2580
ggaauucuuc gaaaucaucu gacacaauuc aguccucacu uuaaaucugg cagccuagcu   2640
```

```
guugacaaug cagauccuau auuaaaaauu ccuuuugcuu cucuugccuc cagauuaacu   2700
uuggcugagc uaaaucagau ccuuuaccga ugugaaucag aagaaaagga agauggugga   2760
gggugcuaug acauaccaaa cuggucagcc cuuaaauaug caggucuuca agguuuaaug   2820
ucuguauugg cagaaauaag accaaagaau gacuuggggc auccuuuuug uaauaauuug   2880
agaucuggag auuggaugau ugacuauguc aguaaccggc uuauuucacg aucaggaacu   2940
auugcugaag uugguaaaug guugcaggcu auguucuucu accugaagca gaucccacgu   3000
uaccuuaucc cauguuacuu ugaugcuaua uuaauuggug cauauaccac ucuucuggau   3060
acagcaugga agcagauguc aagcuuuguu cagaaugguu caaccuuugu gaaacaccuu   3120
ucauuggguu caguucaacu guguggagua ggaaaauucc cuucccugcc aauucuuuca   3180
ccugcccuaa uggauguacc uuauagguua aaugagauca caaaagaaaa ggagcaaugu   3240
uguguuucuc uagcugcagg cuuaccucau uuuucuucug guauuuuccg cugcugggga   3300
agggauacuu uuauugcacu uagagguaua cugcugauua cuggacgcua uguagaagcc   3360
aggaauauua uuuuagcauu ugcggguacc cugaggcaug gucucauucc uaaucuacug   3420
ggugaaggaa uuuaugccag auacaauugu cgggaugcug uguggugguug gcugcagugu   3480
auccaggauu acuguaaaau gguuccaaau ggucuagaca uucucaagug cccaguuucc   3540
agaauguauc cuacagauga uucugcuccu uugccugcug gcacacugga ucagccauug   3600
uuugaaguca uacaggaagc aaugcaaaaa cacaugcagg gcauacaguu ccgagaaagg   3660
aaugcugguc cccagauaga ucgaaacaug aaggacgaag guuuuaauau aacugcagga   3720
guugaugaag aaacaggauu uguuuaugga ggaaaucguu ucaauugugg cacauggaug   3780
gauaaaaugg gagaaaguga cagagcuaga aacagaggaa ucccagccac accaagagau   3840
gggucugcug uggaaauugu gggccugagu aaaucugcug uucgcugguu gcuggaauua   3900
uccaaaaaaa auauuuuccc uuaucaugaa gucacaguaa aaagacaugg aaaggcuaua   3960
aaggucucau augaugagug gaacagaaaa auacaagaca acuuugaaaa gcuauuucau   4020
guuuccgaag acccuucaga uuuaaaugaa aagcauccaa aucugguuca caaacguggc   4080
auauacaaag auaguuaugg agcuucaagu ccuuggugug acuaucagcu caggccuaau   4140
uuuaccauag caaugguugu ggccccugag cucuuuacua cagaaaaagc auggaaagcu   4200
uuggagauug cagaaaaaaa auugcuuggu ccccuuggca ugaaaacuuu agauccagau   4260
gauaugguuu acuguggaau uuaugacaau gcauuagaca augacaacua caaucuugcu   4320
aaagguuuca auuaucacca aggaccugag uggcuguggc cuauugggua uuuucuucgu   4380
gcaaaauuau auuuuuccag auugaugggc ccggagacua cugcaaagac uauaguuuug   4440
guuaaaaaug uucuuucccg acauuauguu caucuugaga gaucccccuug gaaaggacuu   4500
ccagaacuga ccaaugagaa ugcccaguac uguccuuuca gcugugaaac acaagccugg   4560
ucaauugcua cuauucuuga gacacuuuau gauuuauag                          4599
```

```
<210> SEQ ID NO 151
<211> LENGTH: 4599
<212> TYPE: RNA
<213> ORGANISM: Artificial Sequence
<220> FEATURE:
<223> OTHER INFORMATION: Description of Artificial Sequence: Synthetic
      polynucleotide
<220> FEATURE:
<221> NAME/KEY: modified_base
<222> LOCATION: (2)..(2)
<223> OTHER INFORMATION: UNA monomer
```

<220> FEATURE:
<221> NAME/KEY: modified_base
<222> LOCATION: (12)..(12)
<223> OTHER INFORMATION: UNA monomer
<220> FEATURE:
<221> NAME/KEY: modified_base
<222> LOCATION: (20)..(21)
<223> OTHER INFORMATION: UNA monomer
<220> FEATURE:
<221> NAME/KEY: modified_base
<222> LOCATION: (26)..(29)
<223> OTHER INFORMATION: UNA monomer
<220> FEATURE:
<221> NAME/KEY: modified_base
<222> LOCATION: (32)..(33)
<223> OTHER INFORMATION: UNA monomer
<220> FEATURE:
<221> NAME/KEY: modified_base
<222> LOCATION: (35)..(35)
<223> OTHER INFORMATION: UNA monomer
<220> FEATURE:
<221> NAME/KEY: modified_base
<222> LOCATION: (44)..(44)
<223> OTHER INFORMATION: UNA monomer
<220> FEATURE:
<221> NAME/KEY: modified_base
<222> LOCATION: (53)..(53)
<223> OTHER INFORMATION: UNA monomer
<220> FEATURE:
<221> NAME/KEY: modified_base
<222> LOCATION: (65)..(65)
<223> OTHER INFORMATION: UNA monomer
<220> FEATURE:
<221> NAME/KEY: modified_base
<222> LOCATION: (67)..(68)
<223> OTHER INFORMATION: UNA monomer
<220> FEATURE:
<221> NAME/KEY: modified_base
<222> LOCATION: (74)..(75)
<223> OTHER INFORMATION: UNA monomer
<220> FEATURE:
<221> NAME/KEY: modified_base
<222> LOCATION: (85)..(85)
<223> OTHER INFORMATION: UNA monomer
<220> FEATURE:
<221> NAME/KEY: modified_base
<222> LOCATION: (87)..(87)
<223> OTHER INFORMATION: UNA monomer
<220> FEATURE:
<221> NAME/KEY: modified_base
<222> LOCATION: (92)..(92)
<223> OTHER INFORMATION: UNA monomer
<220> FEATURE:
<221> NAME/KEY: modified_base
<222> LOCATION: (97)..(98)
<223> OTHER INFORMATION: UNA monomer
<220> FEATURE:
<221> NAME/KEY: modified_base
<222> LOCATION: (103)..(104)
<223> OTHER INFORMATION: UNA monomer
<220> FEATURE:
<221> NAME/KEY: modified_base
<222> LOCATION: (114)..(116)
<223> OTHER INFORMATION: UNA monomer
<220> FEATURE:
<221> NAME/KEY: modified_base
<222> LOCATION: (131)..(132)
<223> OTHER INFORMATION: UNA monomer
<220> FEATURE:
<221> NAME/KEY: modified_base
<222> LOCATION: (137)..(137)
<223> OTHER INFORMATION: UNA monomer
<220> FEATURE:
<221> NAME/KEY: modified_base
<222> LOCATION: (139)..(139)
<223> OTHER INFORMATION: UNA monomer
<220> FEATURE:
<221> NAME/KEY: modified_base
<222> LOCATION: (141)..(141)

<223> OTHER INFORMATION: UNA monomer
<220> FEATURE:
<221> NAME/KEY: modified_base
<222> LOCATION: (147)..(148)
<223> OTHER INFORMATION: UNA monomer
<220> FEATURE:
<221> NAME/KEY: modified_base
<222> LOCATION: (154)..(156)
<223> OTHER INFORMATION: UNA monomer
<220> FEATURE:
<221> NAME/KEY: modified_base
<222> LOCATION: (159)..(159)
<223> OTHER INFORMATION: UNA monomer
<220> FEATURE:
<221> NAME/KEY: modified_base
<222> LOCATION: (169)..(171)
<223> OTHER INFORMATION: UNA monomer
<220> FEATURE:
<221> NAME/KEY: modified_base
<222> LOCATION: (174)..(174)
<223> OTHER INFORMATION: UNA monomer
<220> FEATURE:
<221> NAME/KEY: modified_base
<222> LOCATION: (184)..(185)
<223> OTHER INFORMATION: UNA monomer
<220> FEATURE:
<221> NAME/KEY: modified_base
<222> LOCATION: (189)..(190)
<223> OTHER INFORMATION: UNA monomer
<220> FEATURE:
<221> NAME/KEY: modified_base
<222> LOCATION: (192)..(192)
<223> OTHER INFORMATION: UNA monomer
<220> FEATURE:
<221> NAME/KEY: modified_base
<222> LOCATION: (194)..(194)
<223> OTHER INFORMATION: UNA monomer
<220> FEATURE:
<221> NAME/KEY: modified_base
<222> LOCATION: (198)..(199)
<223> OTHER INFORMATION: UNA monomer
<220> FEATURE:
<221> NAME/KEY: modified_base
<222> LOCATION: (207)..(207)
<223> OTHER INFORMATION: UNA monomer
<220> FEATURE:
<221> NAME/KEY: modified_base
<222> LOCATION: (225)..(225)
<223> OTHER INFORMATION: UNA monomer
<220> FEATURE:
<221> NAME/KEY: modified_base
<222> LOCATION: (228)..(229)
<223> OTHER INFORMATION: UNA monomer
<220> FEATURE:
<221> NAME/KEY: modified_base
<222> LOCATION: (231)..(231)
<223> OTHER INFORMATION: UNA monomer
<220> FEATURE:
<221> NAME/KEY: modified_base
<222> LOCATION: (234)..(234)
<223> OTHER INFORMATION: UNA monomer
<220> FEATURE:
<221> NAME/KEY: modified_base
<222> LOCATION: (238)..(238)
<223> OTHER INFORMATION: UNA monomer
<220> FEATURE:
<221> NAME/KEY: modified_base
<222> LOCATION: (241)..(241)
<223> OTHER INFORMATION: UNA monomer
<220> FEATURE:
<221> NAME/KEY: modified_base
<222> LOCATION: (243)..(243)
<223> OTHER INFORMATION: UNA monomer
<220> FEATURE:
<221> NAME/KEY: modified_base
<222> LOCATION: (248)..(249)
<223> OTHER INFORMATION: UNA monomer
<220> FEATURE:
<221> NAME/KEY: modified_base <222> LOCATION: (252)..(252)
<223> OTHER INFORMATION: UNA monomer
<220> FEATURE:
<221> NAME/KEY: modified_base
<222> LOCATION: (254)..(254)
<223> OTHER INFORMATION: UNA monomer
<220> FEATURE:
<221> NAME/KEY: modified_base
<222> LOCATION: (262)..(262)
<223> OTHER INFORMATION: UNA monomer
<220> FEATURE:
<221> NAME/KEY: modified_base
<222> LOCATION: (264)..(264)
<223> OTHER INFORMATION: UNA monomer
<220> FEATURE:
<221> NAME/KEY: modified_base
<222> LOCATION: (267)..(268)
<223> OTHER INFORMATION: UNA monomer
<220> FEATURE:
<221> NAME/KEY: modified_base
<222> LOCATION: (271)..(273)
<223> OTHER INFORMATION: UNA monomer
<220> FEATURE:
<221> NAME/KEY: modified_base
<222> LOCATION: (277)..(277)
<223> OTHER INFORMATION: UNA monomer
<220> FEATURE:
<221> NAME/KEY: modified_base
<222> LOCATION: (279)..(280)
<223> OTHER INFORMATION: UNA monomer
<220> FEATURE:
<221> NAME/KEY: modified_base
<222> LOCATION: (282)..(284)
<223> OTHER INFORMATION: UNA monomer
<220> FEATURE:
<221> NAME/KEY: modified_base
<222> LOCATION: (287)..(288)
<223> OTHER INFORMATION: UNA monomer
<220> FEATURE:
<221> NAME/KEY: modified_base
<222> LOCATION: (297)..(297)
<223> OTHER INFORMATION: UNA monomer
<220> FEATURE:
<221> NAME/KEY: modified_base
<222> LOCATION: (306)..(306)
<223> OTHER INFORMATION: UNA monomer
<220> FEATURE:
<221> NAME/KEY: modified_base
<222> LOCATION: (309)..(309)
<223> OTHER INFORMATION: UNA monomer
<220> FEATURE:
<221> NAME/KEY: modified_base
<222> LOCATION: (315)..(316)
<223> OTHER INFORMATION: UNA monomer
<220> FEATURE:
<221> NAME/KEY: modified_base
<222> LOCATION: (320)..(320)
<223> OTHER INFORMATION: UNA monomer
<220> FEATURE:
<221> NAME/KEY: modified_base
<222> LOCATION: (323)..(324)
<223> OTHER INFORMATION: UNA monomer
<220> FEATURE:
<221> NAME/KEY: modified_base
<222> LOCATION: (326)..(326)
<223> OTHER INFORMATION: UNA monomer
<220> FEATURE:
<221> NAME/KEY: modified_base
<222> LOCATION: (335)..(338)
<223> OTHER INFORMATION: UNA monomer
<220> FEATURE:
<221> NAME/KEY: modified_base
<222> LOCATION: (342)..(342)
<223> OTHER INFORMATION: UNA monomer
<220> FEATURE:
<221> NAME/KEY: modified_base
<222> LOCATION: (344)..(345)
<223> OTHER INFORMATION: UNA monomer
<220> FEATURE:

<221> NAME/KEY: modified_base
<222> LOCATION: (348)..(348)
<223> OTHER INFORMATION: UNA monomer
<220> FEATURE:
<221> NAME/KEY: modified_base
<222> LOCATION: (351)..(351)
<223> OTHER INFORMATION: UNA monomer
<220> FEATURE:
<221> NAME/KEY: modified_base
<222> LOCATION: (354)..(354)
<223> OTHER INFORMATION: UNA monomer
<220> FEATURE:
<221> NAME/KEY: modified_base
<222> LOCATION: (357)..(357)
<223> OTHER INFORMATION: UNA monomer
<220> FEATURE:
<221> NAME/KEY: modified_base
<222> LOCATION: (360)..(360)
<223> OTHER INFORMATION: UNA monomer
<220> FEATURE:
<221> NAME/KEY: modified_base
<222> LOCATION: (362)..(362)
<223> OTHER INFORMATION: UNA monomer
<220> FEATURE:
<221> NAME/KEY: modified_base
<222> LOCATION: (365)..(365)
<223> OTHER INFORMATION: UNA monomer
<220> FEATURE:
<221> NAME/KEY: modified_base
<222> LOCATION: (370)..(371)
<223> OTHER INFORMATION: UNA monomer
<220> FEATURE:
<221> NAME/KEY: modified_base
<222> LOCATION: (376)..(376)
<223> OTHER INFORMATION: UNA monomer
<220> FEATURE:
<221> NAME/KEY: modified_base
<222> LOCATION: (378)..(378)
<223> OTHER INFORMATION: UNA monomer
<220> FEATURE:
<221> NAME/KEY: modified_base
<222> LOCATION: (380)..(381)
<223> OTHER INFORMATION: UNA monomer
<220> FEATURE:
<221> NAME/KEY: modified_base
<222> LOCATION: (384)..(384)
<223> OTHER INFORMATION: UNA monomer
<220> FEATURE:
<221> NAME/KEY: modified_base
<222> LOCATION: (386)..(387)
<223> OTHER INFORMATION: UNA monomer
<220> FEATURE:
<221> NAME/KEY: modified_base
<222> LOCATION: (394)..(398)
<223> OTHER INFORMATION: UNA monomer
<220> FEATURE:
<221> NAME/KEY: modified_base
<222> LOCATION: (402)..(402)
<223> OTHER INFORMATION: UNA monomer
<220> FEATURE:
<221> NAME/KEY: modified_base
<222> LOCATION: (406)..(406)
<223> OTHER INFORMATION: UNA monomer
<220> FEATURE:
<221> NAME/KEY: modified_base
<222> LOCATION: (408)..(410)
<223> OTHER INFORMATION: UNA monomer
<220> FEATURE:
<221> NAME/KEY: modified_base
<222> LOCATION: (417)..(420)
<223> OTHER INFORMATION: UNA monomer
<220> FEATURE:
<221> NAME/KEY: modified_base
<222> LOCATION: (423)..(423)
<223> OTHER INFORMATION: UNA monomer
<220> FEATURE:
<221> NAME/KEY: modified_base
<222> LOCATION: (427)..(427)
<223> OTHER INFORMATION: UNA monomer <220> FEATURE:
<221> NAME/KEY: modified_base
<222> LOCATION: (440)..(441)
<223> OTHER INFORMATION: UNA monomer
<220> FEATURE:
<221> NAME/KEY: modified_base
<222> LOCATION: (446)..(447)
<223> OTHER INFORMATION: UNA monomer
<220> FEATURE:
<221> NAME/KEY: modified_base
<222> LOCATION: (457)..(457)
<223> OTHER INFORMATION: UNA monomer
<220> FEATURE:
<221> NAME/KEY: modified_base
<222> LOCATION: (463)..(463)
<223> OTHER INFORMATION: UNA monomer
<220> FEATURE:
<221> NAME/KEY: modified_base
<222> LOCATION: (470)..(470)
<223> OTHER INFORMATION: UNA monomer
<220> FEATURE:
<221> NAME/KEY: modified_base
<222> LOCATION: (473)..(474)
<223> OTHER INFORMATION: UNA monomer
<220> FEATURE:
<221> NAME/KEY: modified_base
<222> LOCATION: (477)..(480)
<223> OTHER INFORMATION: UNA monomer
<220> FEATURE:
<221> NAME/KEY: modified_base
<222> LOCATION: (487)..(488)
<223> OTHER INFORMATION: UNA monomer
<220> FEATURE:
<221> NAME/KEY: modified_base
<222> LOCATION: (495)..(495)
<223> OTHER INFORMATION: UNA monomer
<220> FEATURE:
<221> NAME/KEY: modified_base
<222> LOCATION: (497)..(498)
<223> OTHER INFORMATION: UNA monomer
<220> FEATURE:
<221> NAME/KEY: modified_base
<222> LOCATION: (503)..(503)
<223> OTHER INFORMATION: UNA monomer
<220> FEATURE:
<221> NAME/KEY: modified_base
<222> LOCATION: (505)..(505)
<223> OTHER INFORMATION: UNA monomer
<220> FEATURE:
<221> NAME/KEY: modified_base
<222> LOCATION: (507)..(507)
<223> OTHER INFORMATION: UNA monomer
<220> FEATURE:
<221> NAME/KEY: modified_base
<222> LOCATION: (511)..(511)
<223> OTHER INFORMATION: UNA monomer
<220> FEATURE:
<221> NAME/KEY: modified_base
<222> LOCATION: (514)..(514)
<223> OTHER INFORMATION: UNA monomer
<220> FEATURE:
<221> NAME/KEY: modified_base
<222> LOCATION: (517)..(517)
<223> OTHER INFORMATION: UNA monomer
<220> FEATURE:
<221> NAME/KEY: modified_base
<222> LOCATION: (520)..(520)
<223> OTHER INFORMATION: UNA monomer
<220> FEATURE:
<221> NAME/KEY: modified_base
<222> LOCATION: (524)..(525)
<223> OTHER INFORMATION: UNA monomer
<220> FEATURE:
<221> NAME/KEY: modified_base
<222> LOCATION: (531)..(531)
<223> OTHER INFORMATION: UNA monomer
<220> FEATURE:
<221> NAME/KEY: modified_base
<222> LOCATION: (535)..(536)

<223> OTHER INFORMATION: UNA monomer
<220> FEATURE:
<221> NAME/KEY: modified_base
<222> LOCATION: (541)..(542)
<223> OTHER INFORMATION: UNA monomer
<220> FEATURE:
<221> NAME/KEY: modified_base
<222> LOCATION: (546)..(546)
<223> OTHER INFORMATION: UNA monomer
<220> FEATURE:
<221> NAME/KEY: modified_base
<222> LOCATION: (549)..(549)
<223> OTHER INFORMATION: UNA monomer
<220> FEATURE:
<221> NAME/KEY: modified_base
<222> LOCATION: (553)..(556)
<223> OTHER INFORMATION: UNA monomer
<220> FEATURE:
<221> NAME/KEY: modified_base
<222> LOCATION: (564)..(564)
<223> OTHER INFORMATION: UNA monomer
<220> FEATURE:
<221> NAME/KEY: modified_base
<222> LOCATION: (567)..(567)
<223> OTHER INFORMATION: UNA monomer
<220> FEATURE:
<221> NAME/KEY: modified_base
<222> LOCATION: (574)..(574)
<223> OTHER INFORMATION: UNA monomer
<220> FEATURE:
<221> NAME/KEY: modified_base
<222> LOCATION: (576)..(576)
<223> OTHER INFORMATION: UNA monomer
<220> FEATURE:
<221> NAME/KEY: modified_base
<222> LOCATION: (580)..(580)
<223> OTHER INFORMATION: UNA monomer
<220> FEATURE:
<221> NAME/KEY: modified_base
<222> LOCATION: (585)..(585)
<223> OTHER INFORMATION: UNA monomer
<220> FEATURE:
<221> NAME/KEY: modified_base
<222> LOCATION: (588)..(588)
<223> OTHER INFORMATION: UNA monomer
<220> FEATURE:
<221> NAME/KEY: modified_base
<222> LOCATION: (590)..(591)
<223> OTHER INFORMATION: UNA monomer
<220> FEATURE:
<221> NAME/KEY: modified_base
<222> LOCATION: (599)..(599)
<223> OTHER INFORMATION: UNA monomer
<220> FEATURE:
<221> NAME/KEY: modified_base
<222> LOCATION: (602)..(602)
<223> OTHER INFORMATION: UNA monomer
<220> FEATURE:
<221> NAME/KEY: modified_base
<222> LOCATION: (610)..(611)
<223> OTHER INFORMATION: UNA monomer
<220> FEATURE:
<221> NAME/KEY: modified_base
<222> LOCATION: (622)..(622)
<223> OTHER INFORMATION: UNA monomer
<220> FEATURE:
<221> NAME/KEY: modified_base
<222> LOCATION: (627)..(627)
<223> OTHER INFORMATION: UNA monomer
<220> FEATURE:
<221> NAME/KEY: modified_base
<222> LOCATION: (629)..(630)
<223> OTHER INFORMATION: UNA monomer
<220> FEATURE:
<221> NAME/KEY: modified_base
<222> LOCATION: (632)..(634)
<223> OTHER INFORMATION: UNA monomer
<220> FEATURE:
<221> NAME/KEY: modified_base <222> LOCATION: (636)..(636)
<223> OTHER INFORMATION: UNA monomer
<220> FEATURE:
<221> NAME/KEY: modified_base
<222> LOCATION: (638)..(639)
<223> OTHER INFORMATION: UNA monomer
<220> FEATURE:
<221> NAME/KEY: modified_base
<222> LOCATION: (642)..(642)
<223> OTHER INFORMATION: UNA monomer
<220> FEATURE:
<221> NAME/KEY: modified_base
<222> LOCATION: (645)..(645)
<223> OTHER INFORMATION: UNA monomer
<220> FEATURE:
<221> NAME/KEY: modified_base
<222> LOCATION: (647)..(648)
<223> OTHER INFORMATION: UNA monomer
<220> FEATURE:
<221> NAME/KEY: modified_base
<222> LOCATION: (650)..(650)
<223> OTHER INFORMATION: UNA monomer
<220> FEATURE:
<221> NAME/KEY: modified_base
<222> LOCATION: (652)..(652)
<223> OTHER INFORMATION: UNA monomer
<220> FEATURE:
<221> NAME/KEY: modified_base
<222> LOCATION: (657)..(657)
<223> OTHER INFORMATION: UNA monomer
<220> FEATURE:
<221> NAME/KEY: modified_base
<222> LOCATION: (660)..(660)
<223> OTHER INFORMATION: UNA monomer
<220> FEATURE:
<221> NAME/KEY: modified_base
<222> LOCATION: (663)..(663)
<223> OTHER INFORMATION: UNA monomer
<220> FEATURE:
<221> NAME/KEY: modified_base
<222> LOCATION: (666)..(666)
<223> OTHER INFORMATION: UNA monomer
<220> FEATURE:
<221> NAME/KEY: modified_base
<222> LOCATION: (669)..(669)
<223> OTHER INFORMATION: UNA monomer
<220> FEATURE:
<221> NAME/KEY: modified_base
<222> LOCATION: (672)..(672)
<223> OTHER INFORMATION: UNA monomer
<220> FEATURE:
<221> NAME/KEY: modified_base
<222> LOCATION: (675)..(675)
<223> OTHER INFORMATION: UNA monomer
<220> FEATURE:
<221> NAME/KEY: modified_base
<222> LOCATION: (679)..(679)
<223> OTHER INFORMATION: UNA monomer
<220> FEATURE:
<221> NAME/KEY: modified_base
<222> LOCATION: (683)..(683)
<223> OTHER INFORMATION: UNA monomer
<220> FEATURE:
<221> NAME/KEY: modified_base
<222> LOCATION: (693)..(693)
<223> OTHER INFORMATION: UNA monomer
<220> FEATURE:
<221> NAME/KEY: modified_base
<222> LOCATION: (700)..(700)
<223> OTHER INFORMATION: UNA monomer
<220> FEATURE:
<221> NAME/KEY: modified_base
<222> LOCATION: (702)..(702)
<223> OTHER INFORMATION: UNA monomer
<220> FEATURE:
<221> NAME/KEY: modified_base
<222> LOCATION: (706)..(706)
<223> OTHER INFORMATION: UNA monomer
<220> FEATURE:

<221> NAME/KEY: modified_base
<222> LOCATION: (708)..(708)
<223> OTHER INFORMATION: UNA monomer
<220> FEATURE:
<221> NAME/KEY: modified_base
<222> LOCATION: (711)..(711)
<223> OTHER INFORMATION: UNA monomer
<220> FEATURE:
<221> NAME/KEY: modified_base
<222> LOCATION: (713)..(714)
<223> OTHER INFORMATION: UNA monomer
<220> FEATURE:
<221> NAME/KEY: modified_base
<222> LOCATION: (716)..(716)
<223> OTHER INFORMATION: UNA monomer
<220> FEATURE:
<221> NAME/KEY: modified_base
<222> LOCATION: (720)..(721)
<223> OTHER INFORMATION: UNA monomer
<220> FEATURE:
<221> NAME/KEY: modified_base
<222> LOCATION: (723)..(723)
<223> OTHER INFORMATION: UNA monomer
<220> FEATURE:
<221> NAME/KEY: modified_base
<222> LOCATION: (730)..(731)
<223> OTHER INFORMATION: UNA monomer
<220> FEATURE:
<221> NAME/KEY: modified_base
<222> LOCATION: (738)..(738)
<223> OTHER INFORMATION: UNA monomer
<220> FEATURE:
<221> NAME/KEY: modified_base
<222> LOCATION: (742)..(742)
<223> OTHER INFORMATION: UNA monomer
<220> FEATURE:
<221> NAME/KEY: modified_base
<222> LOCATION: (746)..(746)
<223> OTHER INFORMATION: UNA monomer
<220> FEATURE:
<221> NAME/KEY: modified_base
<222> LOCATION: (748)..(749)
<223> OTHER INFORMATION: UNA monomer
<220> FEATURE:
<221> NAME/KEY: modified_base
<222> LOCATION: (761)..(763)
<223> OTHER INFORMATION: UNA monomer
<220> FEATURE:
<221> NAME/KEY: modified_base
<222> LOCATION: (768)..(770)
<223> OTHER INFORMATION: UNA monomer
<220> FEATURE:
<221> NAME/KEY: modified_base
<222> LOCATION: (772)..(772)
<223> OTHER INFORMATION: UNA monomer
<220> FEATURE:
<221> NAME/KEY: modified_base
<222> LOCATION: (775)..(775)
<223> OTHER INFORMATION: UNA monomer
<220> FEATURE:
<221> NAME/KEY: modified_base
<222> LOCATION: (777)..(777)
<223> OTHER INFORMATION: UNA monomer
<220> FEATURE:
<221> NAME/KEY: modified_base
<222> LOCATION: (780)..(780)
<223> OTHER INFORMATION: UNA monomer
<220> FEATURE:
<221> NAME/KEY: modified_base
<222> LOCATION: (782)..(783)
<223> OTHER INFORMATION: UNA monomer
<220> FEATURE:
<221> NAME/KEY: modified_base
<222> LOCATION: (796)..(796)
<223> OTHER INFORMATION: UNA monomer
<220> FEATURE:
<221> NAME/KEY: modified_base
<222> LOCATION: (812)..(812)
<223> OTHER INFORMATION: UNA monomer <220> FEATURE:
<221> NAME/KEY: modified_base
<222> LOCATION: (816)..(816)
<223> OTHER INFORMATION: UNA monomer
<220> FEATURE:
<221> NAME/KEY: modified_base
<222> LOCATION: (819)..(821)
<223> OTHER INFORMATION: UNA monomer
<220> FEATURE:
<221> NAME/KEY: modified_base
<222> LOCATION: (824)..(825)
<223> OTHER INFORMATION: UNA monomer
<220> FEATURE:
<221> NAME/KEY: modified_base
<222> LOCATION: (831)..(831)
<223> OTHER INFORMATION: UNA monomer
<220> FEATURE:
<221> NAME/KEY: modified_base
<222> LOCATION: (834)..(834)
<223> OTHER INFORMATION: UNA monomer
<220> FEATURE:
<221> NAME/KEY: modified_base
<222> LOCATION: (840)..(840)
<223> OTHER INFORMATION: UNA monomer
<220> FEATURE:
<221> NAME/KEY: modified_base
<222> LOCATION: (842)..(842)
<223> OTHER INFORMATION: UNA monomer
<220> FEATURE:
<221> NAME/KEY: modified_base
<222> LOCATION: (846)..(847)
<223> OTHER INFORMATION: UNA monomer
<220> FEATURE:
<221> NAME/KEY: modified_base
<222> LOCATION: (851)..(851)
<223> OTHER INFORMATION: UNA monomer
<220> FEATURE:
<221> NAME/KEY: modified_base
<222> LOCATION: (860)..(860)
<223> OTHER INFORMATION: UNA monomer
<220> FEATURE:
<221> NAME/KEY: modified_base
<222> LOCATION: (863)..(865)
<223> OTHER INFORMATION: UNA monomer
<220> FEATURE:
<221> NAME/KEY: modified_base
<222> LOCATION: (873)..(873)
<223> OTHER INFORMATION: UNA monomer
<220> FEATURE:
<221> NAME/KEY: modified_base
<222> LOCATION: (875)..(879)
<223> OTHER INFORMATION: UNA monomer
<220> FEATURE:
<221> NAME/KEY: modified_base
<222> LOCATION: (887)..(888)
<223> OTHER INFORMATION: UNA monomer
<220> FEATURE:
<221> NAME/KEY: modified_base
<222> LOCATION: (893)..(893)
<223> OTHER INFORMATION: UNA monomer
<220> FEATURE:
<221> NAME/KEY: modified_base
<222> LOCATION: (895)..(895)
<223> OTHER INFORMATION: UNA monomer
<220> FEATURE:
<221> NAME/KEY: modified_base
<222> LOCATION: (901)..(905)
<223> OTHER INFORMATION: UNA monomer
<220> FEATURE:
<221> NAME/KEY: modified_base
<222> LOCATION: (911)..(911)
<223> OTHER INFORMATION: UNA monomer
<220> FEATURE:
<221> NAME/KEY: modified_base
<222> LOCATION: (915)..(915)
<223> OTHER INFORMATION: UNA monomer
<220> FEATURE:
<221> NAME/KEY: modified_base
<222> LOCATION: (917)..(917)

<223> OTHER INFORMATION: UNA monomer
<220> FEATURE:
<221> NAME/KEY: modified_base
<222> LOCATION: (929)..(930)
<223> OTHER INFORMATION: UNA monomer
<220> FEATURE:
<221> NAME/KEY: modified_base
<222> LOCATION: (937)..(939)
<223> OTHER INFORMATION: UNA monomer
<220> FEATURE:
<221> NAME/KEY: modified_base
<222> LOCATION: (947)..(948)
<223> OTHER INFORMATION: UNA monomer
<220> FEATURE:
<221> NAME/KEY: modified_base
<222> LOCATION: (950)..(951)
<223> OTHER INFORMATION: UNA monomer
<220> FEATURE:
<221> NAME/KEY: modified_base
<222> LOCATION: (963)..(963)
<223> OTHER INFORMATION: UNA monomer
<220> FEATURE:
<221> NAME/KEY: modified_base
<222> LOCATION: (971)..(971)
<223> OTHER INFORMATION: UNA monomer
<220> FEATURE:
<221> NAME/KEY: modified_base
<222> LOCATION: (979)..(979)
<223> OTHER INFORMATION: UNA monomer
<220> FEATURE:
<221> NAME/KEY: modified_base
<222> LOCATION: (981)..(981)
<223> OTHER INFORMATION: UNA monomer
<220> FEATURE:
<221> NAME/KEY: modified_base
<222> LOCATION: (984)..(984)
<223> OTHER INFORMATION: UNA monomer
<220> FEATURE:
<221> NAME/KEY: modified_base
<222> LOCATION: (998)..(999)
<223> OTHER INFORMATION: UNA monomer
<220> FEATURE:
<221> NAME/KEY: modified_base
<222> LOCATION: (1004)..(1005)
<223> OTHER INFORMATION: UNA monomer
<220> FEATURE:
<221> NAME/KEY: modified_base
<222> LOCATION: (1007)..(1008)
<223> OTHER INFORMATION: UNA monomer
<220> FEATURE:
<221> NAME/KEY: modified_base
<222> LOCATION: (1014)..(1014)
<223> OTHER INFORMATION: UNA monomer
<220> FEATURE:
<221> NAME/KEY: modified_base
<222> LOCATION: (1017)..(1017)
<223> OTHER INFORMATION: UNA monomer
<220> FEATURE:
<221> NAME/KEY: modified_base
<222> LOCATION: (1021)..(1021)
<223> OTHER INFORMATION: UNA monomer
<220> FEATURE:
<221> NAME/KEY: modified_base
<222> LOCATION: (1030)..(1032)
<223> OTHER INFORMATION: UNA monomer
<220> FEATURE:
<221> NAME/KEY: modified_base
<222> LOCATION: (1036)..(1036)
<223> OTHER INFORMATION: UNA monomer
<220> FEATURE:
<221> NAME/KEY: modified_base
<222> LOCATION: (1038)..(1038)
<223> OTHER INFORMATION: UNA monomer
<220> FEATURE:
<221> NAME/KEY: modified_base
<222> LOCATION: (1041)..(1041)
<223> OTHER INFORMATION: UNA monomer
<220> FEATURE:
<221> NAME/KEY: modified_base <222> LOCATION: (1043)..(1043)
<223> OTHER INFORMATION: UNA monomer
<220> FEATURE:
<221> NAME/KEY: modified_base
<222> LOCATION: (1047)..(1047)
<223> OTHER INFORMATION: UNA monomer
<220> FEATURE:
<221> NAME/KEY: modified_base
<222> LOCATION: (1049)..(1049)
<223> OTHER INFORMATION: UNA monomer
<220> FEATURE:
<221> NAME/KEY: modified_base
<222> LOCATION: (1055)..(1056)
<223> OTHER INFORMATION: UNA monomer
<220> FEATURE:
<221> NAME/KEY: modified_base
<222> LOCATION: (1061)..(1061)
<223> OTHER INFORMATION: UNA monomer
<220> FEATURE:
<221> NAME/KEY: modified_base
<222> LOCATION: (1068)..(1070)
<223> OTHER INFORMATION: UNA monomer
<220> FEATURE:
<221> NAME/KEY: modified_base
<222> LOCATION: (1073)..(1073)
<223> OTHER INFORMATION: UNA monomer
<220> FEATURE:
<221> NAME/KEY: modified_base
<222> LOCATION: (1080)..(1080)
<223> OTHER INFORMATION: UNA monomer
<220> FEATURE:
<221> NAME/KEY: modified_base
<222> LOCATION: (1100)..(1101)
<223> OTHER INFORMATION: UNA monomer
<220> FEATURE:
<221> NAME/KEY: modified_base
<222> LOCATION: (1108)..(1108)
<223> OTHER INFORMATION: UNA monomer
<220> FEATURE:
<221> NAME/KEY: modified_base
<222> LOCATION: (1111)..(1111)
<223> OTHER INFORMATION: UNA monomer
<220> FEATURE:
<221> NAME/KEY: modified_base
<222> LOCATION: (1113)..(1113)
<223> OTHER INFORMATION: UNA monomer
<220> FEATURE:
<221> NAME/KEY: modified_base
<222> LOCATION: (1116)..(1117)
<223> OTHER INFORMATION: UNA monomer
<220> FEATURE:
<221> NAME/KEY: modified_base
<222> LOCATION: (1120)..(1122)
<223> OTHER INFORMATION: UNA monomer
<220> FEATURE:
<221> NAME/KEY: modified_base
<222> LOCATION: (1125)..(1125)
<223> OTHER INFORMATION: UNA monomer
<220> FEATURE:
<221> NAME/KEY: modified_base
<222> LOCATION: (1133)..(1133)
<223> OTHER INFORMATION: UNA monomer
<220> FEATURE:
<221> NAME/KEY: modified_base
<222> LOCATION: (1141)..(1142)
<223> OTHER INFORMATION: UNA monomer
<220> FEATURE:
<221> NAME/KEY: modified_base
<222> LOCATION: (1146)..(1147)
<223> OTHER INFORMATION: UNA monomer
<220> FEATURE:
<221> NAME/KEY: modified_base
<222> LOCATION: (1158)..(1158)
<223> OTHER INFORMATION: UNA monomer
<220> FEATURE:
<221> NAME/KEY: modified_base
<222> LOCATION: (1163)..(1163)
<223> OTHER INFORMATION: UNA monomer
<220> FEATURE:

<221> NAME/KEY: modified_base
<222> LOCATION: (1166)..(1167)
<223> OTHER INFORMATION: UNA monomer
<220> FEATURE:
<221> NAME/KEY: modified_base
<222> LOCATION: (1171)..(1171)
<223> OTHER INFORMATION: UNA monomer
<220> FEATURE:
<221> NAME/KEY: modified_base
<222> LOCATION: (1173)..(1173)
<223> OTHER INFORMATION: UNA monomer
<220> FEATURE:
<221> NAME/KEY: modified_base
<222> LOCATION: (1176)..(1176)
<223> OTHER INFORMATION: UNA monomer
<220> FEATURE:
<221> NAME/KEY: modified_base
<222> LOCATION: (1190)..(1191)
<223> OTHER INFORMATION: UNA monomer
<220> FEATURE:
<221> NAME/KEY: modified_base
<222> LOCATION: (1194)..(1195)
<223> OTHER INFORMATION: UNA monomer
<220> FEATURE:
<221> NAME/KEY: modified_base
<222> LOCATION: (1199)..(1202)
<223> OTHER INFORMATION: UNA monomer
<220> FEATURE:
<221> NAME/KEY: modified_base
<222> LOCATION: (1209)..(1209)
<223> OTHER INFORMATION: UNA monomer
<220> FEATURE:
<221> NAME/KEY: modified_base
<222> LOCATION: (1211)..(1211)
<223> OTHER INFORMATION: UNA monomer
<220> FEATURE:
<221> NAME/KEY: modified_base
<222> LOCATION: (1213)..(1216)
<223> OTHER INFORMATION: UNA monomer
<220> FEATURE:
<221> NAME/KEY: modified_base
<222> LOCATION: (1218)..(1218)
<223> OTHER INFORMATION: UNA monomer
<220> FEATURE:
<221> NAME/KEY: modified_base
<222> LOCATION: (1226)..(1226)
<223> OTHER INFORMATION: UNA monomer
<220> FEATURE:
<221> NAME/KEY: modified_base
<222> LOCATION: (1230)..(1230)
<223> OTHER INFORMATION: UNA monomer
<220> FEATURE:
<221> NAME/KEY: modified_base
<222> LOCATION: (1236)..(1236)
<223> OTHER INFORMATION: UNA monomer
<220> FEATURE:
<221> NAME/KEY: modified_base
<222> LOCATION: (1239)..(1239)
<223> OTHER INFORMATION: UNA monomer
<220> FEATURE:
<221> NAME/KEY: modified_base
<222> LOCATION: (1247)..(1247)
<223> OTHER INFORMATION: UNA monomer
<220> FEATURE:
<221> NAME/KEY: modified_base
<222> LOCATION: (1254)..(1254)
<223> OTHER INFORMATION: UNA monomer
<220> FEATURE:
<221> NAME/KEY: modified_base
<222> LOCATION: (1256)..(1256)
<223> OTHER INFORMATION: UNA monomer
<220> FEATURE:
<221> NAME/KEY: modified_base
<222> LOCATION: (1260)..(1260)
<223> OTHER INFORMATION: UNA monomer
<220> FEATURE:
<221> NAME/KEY: modified_base
<222> LOCATION: (1269)..(1269)
<223> OTHER INFORMATION: UNA monomer <220> FEATURE:
<221> NAME/KEY: modified_base
<222> LOCATION: (1272)..(1274)
<223> OTHER INFORMATION: UNA monomer
<220> FEATURE:
<221> NAME/KEY: modified_base
<222> LOCATION: (1277)..(1278)
<223> OTHER INFORMATION: UNA monomer
<220> FEATURE:
<221> NAME/KEY: modified_base
<222> LOCATION: (1285)..(1285)
<223> OTHER INFORMATION: UNA monomer
<220> FEATURE:
<221> NAME/KEY: modified_base
<222> LOCATION: (1287)..(1290)
<223> OTHER INFORMATION: UNA monomer
<220> FEATURE:
<221> NAME/KEY: modified_base
<222> LOCATION: (1293)..(1295)
<223> OTHER INFORMATION: UNA monomer
<220> FEATURE:
<221> NAME/KEY: modified_base
<222> LOCATION: (1300)..(1302)
<223> OTHER INFORMATION: UNA monomer
<220> FEATURE:
<221> NAME/KEY: modified_base
<222> LOCATION: (1310)..(1310)
<223> OTHER INFORMATION: UNA monomer
<220> FEATURE:
<221> NAME/KEY: modified_base
<222> LOCATION: (1315)..(1316)
<223> OTHER INFORMATION: UNA monomer
<220> FEATURE:
<221> NAME/KEY: modified_base
<222> LOCATION: (1318)..(1318)
<223> OTHER INFORMATION: UNA monomer
<220> FEATURE:
<221> NAME/KEY: modified_base
<222> LOCATION: (1322)..(1322)
<223> OTHER INFORMATION: UNA monomer
<220> FEATURE:
<221> NAME/KEY: modified_base
<222> LOCATION: (1330)..(1330)
<223> OTHER INFORMATION: UNA monomer
<220> FEATURE:
<221> NAME/KEY: modified_base
<222> LOCATION: (1332)..(1332)
<223> OTHER INFORMATION: UNA monomer
<220> FEATURE:
<221> NAME/KEY: modified_base
<222> LOCATION: (1334)..(1334)
<223> OTHER INFORMATION: UNA monomer
<220> FEATURE:
<221> NAME/KEY: modified_base
<222> LOCATION: (1337)..(1338)
<223> OTHER INFORMATION: UNA monomer
<220> FEATURE:
<221> NAME/KEY: modified_base
<222> LOCATION: (1341)..(1341)
<223> OTHER INFORMATION: UNA monomer
<220> FEATURE:
<221> NAME/KEY: modified_base
<222> LOCATION: (1343)..(1343)
<223> OTHER INFORMATION: UNA monomer
<220> FEATURE:
<221> NAME/KEY: modified_base
<222> LOCATION: (1350)..(1350)
<223> OTHER INFORMATION: UNA monomer
<220> FEATURE:
<221> NAME/KEY: modified_base
<222> LOCATION: (1356)..(1357)
<223> OTHER INFORMATION: UNA monomer
<220> FEATURE:
<221> NAME/KEY: modified_base
<222> LOCATION: (1359)..(1362)
<223> OTHER INFORMATION: UNA monomer
<220> FEATURE:
<221> NAME/KEY: modified_base
<222> LOCATION: (1364)..(1364)

<223> OTHER INFORMATION: UNA monomer
<220> FEATURE:
<221> NAME/KEY: modified_base
<222> LOCATION: (1367)..(1367)
<223> OTHER INFORMATION: UNA monomer
<220> FEATURE:
<221> NAME/KEY: modified_base
<222> LOCATION: (1377)..(1377)
<223> OTHER INFORMATION: UNA monomer
<220> FEATURE:
<221> NAME/KEY: modified_base
<222> LOCATION: (1381)..(1381)
<223> OTHER INFORMATION: UNA monomer
<220> FEATURE:
<221> NAME/KEY: modified_base
<222> LOCATION: (1385)..(1385)
<223> OTHER INFORMATION: UNA monomer
<220> FEATURE:
<221> NAME/KEY: modified_base
<222> LOCATION: (1388)..(1388)
<223> OTHER INFORMATION: UNA monomer
<220> FEATURE:
<221> NAME/KEY: modified_base
<222> LOCATION: (1395)..(1395)
<223> OTHER INFORMATION: UNA monomer
<220> FEATURE:
<221> NAME/KEY: modified_base
<222> LOCATION: (1398)..(1398)
<223> OTHER INFORMATION: UNA monomer
<220> FEATURE:
<221> NAME/KEY: modified_base
<222> LOCATION: (1401)..(1401)
<223> OTHER INFORMATION: UNA monomer
<220> FEATURE:
<221> NAME/KEY: modified_base
<222> LOCATION: (1403)..(1404)
<223> OTHER INFORMATION: UNA monomer
<220> FEATURE:
<221> NAME/KEY: modified_base
<222> LOCATION: (1411)..(1413)
<223> OTHER INFORMATION: UNA monomer
<220> FEATURE:
<221> NAME/KEY: modified_base
<222> LOCATION: (1416)..(1416)
<223> OTHER INFORMATION: UNA monomer
<220> FEATURE:
<221> NAME/KEY: modified_base
<222> LOCATION: (1425)..(1426)
<223> OTHER INFORMATION: UNA monomer
<220> FEATURE:
<221> NAME/KEY: modified_base
<222> LOCATION: (1433)..(1435)
<223> OTHER INFORMATION: UNA monomer
<220> FEATURE:
<221> NAME/KEY: modified_base
<222> LOCATION: (1439)..(1439)
<223> OTHER INFORMATION: UNA monomer
<220> FEATURE:
<221> NAME/KEY: modified_base
<222> LOCATION: (1451)..(1452)
<223> OTHER INFORMATION: UNA monomer
<220> FEATURE:
<221> NAME/KEY: modified_base
<222> LOCATION: (1454)..(1456)
<223> OTHER INFORMATION: UNA monomer
<220> FEATURE:
<221> NAME/KEY: modified_base
<222> LOCATION: (1459)..(1459)
<223> OTHER INFORMATION: UNA monomer
<220> FEATURE:
<221> NAME/KEY: modified_base
<222> LOCATION: (1470)..(1470)
<223> OTHER INFORMATION: UNA monomer
<220> FEATURE:
<221> NAME/KEY: modified_base
<222> LOCATION: (1472)..(1473)
<223> OTHER INFORMATION: UNA monomer
<220> FEATURE:
<221> NAME/KEY: modified_base <222> LOCATION: (1477)..(1478)
<223> OTHER INFORMATION: UNA monomer
<220> FEATURE:
<221> NAME/KEY: modified_base
<222> LOCATION: (1483)..(1483)
<223> OTHER INFORMATION: UNA monomer
<220> FEATURE:
<221> NAME/KEY: modified_base
<222> LOCATION: (1485)..(1485)
<223> OTHER INFORMATION: UNA monomer
<220> FEATURE:
<221> NAME/KEY: modified_base
<222> LOCATION: (1491)..(1491)
<223> OTHER INFORMATION: UNA monomer
<220> FEATURE:
<221> NAME/KEY: modified_base
<222> LOCATION: (1504)..(1504)
<223> OTHER INFORMATION: UNA monomer
<220> FEATURE:
<221> NAME/KEY: modified_base
<222> LOCATION: (1506)..(1506)
<223> OTHER INFORMATION: UNA monomer
<220> FEATURE:
<221> NAME/KEY: modified_base
<222> LOCATION: (1509)..(1510)
<223> OTHER INFORMATION: UNA monomer
<220> FEATURE:
<221> NAME/KEY: modified_base
<222> LOCATION: (1512)..(1512)
<223> OTHER INFORMATION: UNA monomer
<220> FEATURE:
<221> NAME/KEY: modified_base
<222> LOCATION: (1514)..(1514)
<223> OTHER INFORMATION: UNA monomer
<220> FEATURE:
<221> NAME/KEY: modified_base
<222> LOCATION: (1516)..(1516)
<223> OTHER INFORMATION: UNA monomer
<220> FEATURE:
<221> NAME/KEY: modified_base
<222> LOCATION: (1526)..(1526)
<223> OTHER INFORMATION: UNA monomer
<220> FEATURE:
<221> NAME/KEY: modified_base
<222> LOCATION: (1534)..(1534)
<223> OTHER INFORMATION: UNA monomer
<220> FEATURE:
<221> NAME/KEY: modified_base
<222> LOCATION: (1539)..(1539)
<223> OTHER INFORMATION: UNA monomer
<220> FEATURE:
<221> NAME/KEY: modified_base
<222> LOCATION: (1544)..(1544)
<223> OTHER INFORMATION: UNA monomer
<220> FEATURE:
<221> NAME/KEY: modified_base
<222> LOCATION: (1548)..(1548)
<223> OTHER INFORMATION: UNA monomer
<220> FEATURE:
<221> NAME/KEY: modified_base
<222> LOCATION: (1554)..(1555)
<223> OTHER INFORMATION: UNA monomer
<220> FEATURE:
<221> NAME/KEY: modified_base
<222> LOCATION: (1557)..(1559)
<223> OTHER INFORMATION: UNA monomer
<220> FEATURE:
<221> NAME/KEY: modified_base
<222> LOCATION: (1568)..(1568)
<223> OTHER INFORMATION: UNA monomer
<220> FEATURE:
<221> NAME/KEY: modified_base
<222> LOCATION: (1572)..(1572)
<223> OTHER INFORMATION: UNA monomer
<220> FEATURE:
<221> NAME/KEY: modified_base
<222> LOCATION: (1574)..(1575)
<223> OTHER INFORMATION: UNA monomer
<220> FEATURE:

<221> NAME/KEY: modified_base
<222> LOCATION: (1578)..(1578)
<223> OTHER INFORMATION: UNA monomer
<220> FEATURE:
<221> NAME/KEY: modified_base
<222> LOCATION: (1582)..(1582)
<223> OTHER INFORMATION: UNA monomer
<220> FEATURE:
<221> NAME/KEY: modified_base
<222> LOCATION: (1588)..(1588)
<223> OTHER INFORMATION: UNA monomer
<220> FEATURE:
<221> NAME/KEY: modified_base
<222> LOCATION: (1596)..(1596)
<223> OTHER INFORMATION: UNA monomer
<220> FEATURE:
<221> NAME/KEY: modified_base
<222> LOCATION: (1598)..(1599)
<223> OTHER INFORMATION: UNA monomer
<220> FEATURE:
<221> NAME/KEY: modified_base
<222> LOCATION: (1604)..(1604)
<223> OTHER INFORMATION: UNA monomer
<220> FEATURE:
<221> NAME/KEY: modified_base
<222> LOCATION: (1608)..(1608)
<223> OTHER INFORMATION: UNA monomer
<220> FEATURE:
<221> NAME/KEY: modified_base
<222> LOCATION: (1612)..(1612)
<223> OTHER INFORMATION: UNA monomer
<220> FEATURE:
<221> NAME/KEY: modified_base
<222> LOCATION: (1616)..(1616)
<223> OTHER INFORMATION: UNA monomer
<220> FEATURE:
<221> NAME/KEY: modified_base
<222> LOCATION: (1618)..(1619)
<223> OTHER INFORMATION: UNA monomer
<220> FEATURE:
<221> NAME/KEY: modified_base
<222> LOCATION: (1623)..(1623)
<223> OTHER INFORMATION: UNA monomer
<220> FEATURE:
<221> NAME/KEY: modified_base
<222> LOCATION: (1626)..(1626)
<223> OTHER INFORMATION: UNA monomer
<220> FEATURE:
<221> NAME/KEY: modified_base
<222> LOCATION: (1629)..(1629)
<223> OTHER INFORMATION: UNA monomer
<220> FEATURE:
<221> NAME/KEY: modified_base
<222> LOCATION: (1635)..(1637)
<223> OTHER INFORMATION: UNA monomer
<220> FEATURE:
<221> NAME/KEY: modified_base
<222> LOCATION: (1647)..(1649)
<223> OTHER INFORMATION: UNA monomer
<220> FEATURE:
<221> NAME/KEY: modified_base
<222> LOCATION: (1651)..(1651)
<223> OTHER INFORMATION: UNA monomer
<220> FEATURE:
<221> NAME/KEY: modified_base
<222> LOCATION: (1653)..(1653)
<223> OTHER INFORMATION: UNA monomer
<220> FEATURE:
<221> NAME/KEY: modified_base
<222> LOCATION: (1655)..(1655)
<223> OTHER INFORMATION: UNA monomer
<220> FEATURE:
<221> NAME/KEY: modified_base
<222> LOCATION: (1658)..(1658)
<223> OTHER INFORMATION: UNA monomer
<220> FEATURE:
<221> NAME/KEY: modified_base
<222> LOCATION: (1662)..(1662)
<223> OTHER INFORMATION: UNA monomer <220> FEATURE:
<221> NAME/KEY: modified_base
<222> LOCATION: (1667)..(1667)
<223> OTHER INFORMATION: UNA monomer
<220> FEATURE:
<221> NAME/KEY: modified_base
<222> LOCATION: (1669)..(1670)
<223> OTHER INFORMATION: UNA monomer
<220> FEATURE:
<221> NAME/KEY: modified_base
<222> LOCATION: (1680)..(1680)
<223> OTHER INFORMATION: UNA monomer
<220> FEATURE:
<221> NAME/KEY: modified_base
<222> LOCATION: (1686)..(1686)
<223> OTHER INFORMATION: UNA monomer
<220> FEATURE:
<221> NAME/KEY: modified_base
<222> LOCATION: (1688)..(1688)
<223> OTHER INFORMATION: UNA monomer
<220> FEATURE:
<221> NAME/KEY: modified_base
<222> LOCATION: (1695)..(1695)
<223> OTHER INFORMATION: UNA monomer
<220> FEATURE:
<221> NAME/KEY: modified_base
<222> LOCATION: (1697)..(1697)
<223> OTHER INFORMATION: UNA monomer
<220> FEATURE:
<221> NAME/KEY: modified_base
<222> LOCATION: (1699)..(1701)
<223> OTHER INFORMATION: UNA monomer
<220> FEATURE:
<221> NAME/KEY: modified_base
<222> LOCATION: (1703)..(1704)
<223> OTHER INFORMATION: UNA monomer
<220> FEATURE:
<221> NAME/KEY: modified_base
<222> LOCATION: (1707)..(1707)
<223> OTHER INFORMATION: UNA monomer
<220> FEATURE:
<221> NAME/KEY: modified_base
<222> LOCATION: (1712)..(1712)
<223> OTHER INFORMATION: UNA monomer
<220> FEATURE:
<221> NAME/KEY: modified_base
<222> LOCATION: (1718)..(1719)
<223> OTHER INFORMATION: UNA monomer
<220> FEATURE:
<221> NAME/KEY: modified_base
<222> LOCATION: (1722)..(1723)
<223> OTHER INFORMATION: UNA monomer
<220> FEATURE:
<221> NAME/KEY: modified_base
<222> LOCATION: (1726)..(1727)
<223> OTHER INFORMATION: UNA monomer
<220> FEATURE:
<221> NAME/KEY: modified_base
<222> LOCATION: (1730)..(1730)
<223> OTHER INFORMATION: UNA monomer
<220> FEATURE:
<221> NAME/KEY: modified_base
<222> LOCATION: (1742)..(1742)
<223> OTHER INFORMATION: UNA monomer
<220> FEATURE:
<221> NAME/KEY: modified_base
<222> LOCATION: (1746)..(1746)
<223> OTHER INFORMATION: UNA monomer
<220> FEATURE:
<221> NAME/KEY: modified_base
<222> LOCATION: (1750)..(1750)
<223> OTHER INFORMATION: UNA monomer
<220> FEATURE:
<221> NAME/KEY: modified_base
<222> LOCATION: (1752)..(1752)
<223> OTHER INFORMATION: UNA monomer
<220> FEATURE:
<221> NAME/KEY: modified_base
<222> LOCATION: (1755)..(1755)

<223> OTHER INFORMATION: UNA monomer
<220> FEATURE:
<221> NAME/KEY: modified_base
<222> LOCATION: (1758)..(1758)
<223> OTHER INFORMATION: UNA monomer
<220> FEATURE:
<221> NAME/KEY: modified_base
<222> LOCATION: (1761)..(1761)
<223> OTHER INFORMATION: UNA monomer
<220> FEATURE:
<221> NAME/KEY: modified_base
<222> LOCATION: (1774)..(1775)
<223> OTHER INFORMATION: UNA monomer
<220> FEATURE:
<221> NAME/KEY: modified_base
<222> LOCATION: (1778)..(1780)
<223> OTHER INFORMATION: UNA monomer
<220> FEATURE:
<221> NAME/KEY: modified_base
<222> LOCATION: (1786)..(1786)
<223> OTHER INFORMATION: UNA monomer
<220> FEATURE:
<221> NAME/KEY: modified_base
<222> LOCATION: (1788)..(1788)
<223> OTHER INFORMATION: UNA monomer
<220> FEATURE:
<221> NAME/KEY: modified_base
<222> LOCATION: (1800)..(1800)
<223> OTHER INFORMATION: UNA monomer
<220> FEATURE:
<221> NAME/KEY: modified_base
<222> LOCATION: (1802)..(1803)
<223> OTHER INFORMATION: UNA monomer
<220> FEATURE:
<221> NAME/KEY: modified_base
<222> LOCATION: (1807)..(1807)
<223> OTHER INFORMATION: UNA monomer
<220> FEATURE:
<221> NAME/KEY: modified_base
<222> LOCATION: (1810)..(1812)
<223> OTHER INFORMATION: UNA monomer
<220> FEATURE:
<221> NAME/KEY: modified_base
<222> LOCATION: (1814)..(1815)
<223> OTHER INFORMATION: UNA monomer
<220> FEATURE:
<221> NAME/KEY: modified_base
<222> LOCATION: (1822)..(1822)
<223> OTHER INFORMATION: UNA monomer
<220> FEATURE:
<221> NAME/KEY: modified_base
<222> LOCATION: (1824)..(1826)
<223> OTHER INFORMATION: UNA monomer
<220> FEATURE:
<221> NAME/KEY: modified_base
<222> LOCATION: (1833)..(1835)
<223> OTHER INFORMATION: UNA monomer
<220> FEATURE:
<221> NAME/KEY: modified_base
<222> LOCATION: (1838)..(1838)
<223> OTHER INFORMATION: UNA monomer
<220> FEATURE:
<221> NAME/KEY: modified_base
<222> LOCATION: (1845)..(1845)
<223> OTHER INFORMATION: UNA monomer
<220> FEATURE:
<221> NAME/KEY: modified_base
<222> LOCATION: (1847)..(1848)
<223> OTHER INFORMATION: UNA monomer
<220> FEATURE:
<221> NAME/KEY: modified_base
<222> LOCATION: (1854)..(1854)
<223> OTHER INFORMATION: UNA monomer
<220> FEATURE:
<221> NAME/KEY: modified_base
<222> LOCATION: (1859)..(1859)
<223> OTHER INFORMATION: UNA monomer
<220> FEATURE:
<221> NAME/KEY: modified_base <222> LOCATION: (1861)..(1863)
<223> OTHER INFORMATION: UNA monomer
<220> FEATURE:
<221> NAME/KEY: modified_base
<222> LOCATION: (1865)..(1865)
<223> OTHER INFORMATION: UNA monomer
<220> FEATURE:
<221> NAME/KEY: modified_base
<222> LOCATION: (1869)..(1869)
<223> OTHER INFORMATION: UNA monomer
<220> FEATURE:
<221> NAME/KEY: modified_base
<222> LOCATION: (1871)..(1872)
<223> OTHER INFORMATION: UNA monomer
<220> FEATURE:
<221> NAME/KEY: modified_base
<222> LOCATION: (1878)..(1878)
<223> OTHER INFORMATION: UNA monomer
<220> FEATURE:
<221> NAME/KEY: modified_base
<222> LOCATION: (1881)..(1881)
<223> OTHER INFORMATION: UNA monomer
<220> FEATURE:
<221> NAME/KEY: modified_base
<222> LOCATION: (1884)..(1884)
<223> OTHER INFORMATION: UNA monomer
<220> FEATURE:
<221> NAME/KEY: modified_base
<222> LOCATION: (1888)..(1888)
<223> OTHER INFORMATION: UNA monomer
<220> FEATURE:
<221> NAME/KEY: modified_base
<222> LOCATION: (1890)..(1890)
<223> OTHER INFORMATION: UNA monomer
<220> FEATURE:
<221> NAME/KEY: modified_base
<222> LOCATION: (1893)..(1893)
<223> OTHER INFORMATION: UNA monomer
<220> FEATURE:
<221> NAME/KEY: modified_base
<222> LOCATION: (1895)..(1896)
<223> OTHER INFORMATION: UNA monomer
<220> FEATURE:
<221> NAME/KEY: modified_base
<222> LOCATION: (1898)..(1898)
<223> OTHER INFORMATION: UNA monomer
<220> FEATURE:
<221> NAME/KEY: modified_base
<222> LOCATION: (1902)..(1902)
<223> OTHER INFORMATION: UNA monomer
<220> FEATURE:
<221> NAME/KEY: modified_base
<222> LOCATION: (1906)..(1906)
<223> OTHER INFORMATION: UNA monomer
<220> FEATURE:
<221> NAME/KEY: modified_base
<222> LOCATION: (1912)..(1912)
<223> OTHER INFORMATION: UNA monomer
<220> FEATURE:
<221> NAME/KEY: modified_base
<222> LOCATION: (1914)..(1914)
<223> OTHER INFORMATION: UNA monomer
<220> FEATURE:
<221> NAME/KEY: modified_base
<222> LOCATION: (1917)..(1917)
<223> OTHER INFORMATION: UNA monomer
<220> FEATURE:
<221> NAME/KEY: modified_base
<222> LOCATION: (1920)..(1920)
<223> OTHER INFORMATION: UNA monomer
<220> FEATURE:
<221> NAME/KEY: modified_base
<222> LOCATION: (1922)..(1923)
<223> OTHER INFORMATION: UNA monomer
<220> FEATURE:
<221> NAME/KEY: modified_base
<222> LOCATION: (1929)..(1929)
<223> OTHER INFORMATION: UNA monomer
<220> FEATURE:

<221> NAME/KEY: modified_base
<222> LOCATION: (1932)..(1932)
<223> OTHER INFORMATION: UNA monomer
<220> FEATURE:
<221> NAME/KEY: modified_base
<222> LOCATION: (1937)..(1938)
<223> OTHER INFORMATION: UNA monomer
<220> FEATURE:
<221> NAME/KEY: modified_base
<222> LOCATION: (1940)..(1942)
<223> OTHER INFORMATION: UNA monomer
<220> FEATURE:
<221> NAME/KEY: modified_base
<222> LOCATION: (1944)..(1944)
<223> OTHER INFORMATION: UNA monomer
<220> FEATURE:
<221> NAME/KEY: modified_base
<222> LOCATION: (1946)..(1946)
<223> OTHER INFORMATION: UNA monomer
<220> FEATURE:
<221> NAME/KEY: modified_base
<222> LOCATION: (1951)..(1951)
<223> OTHER INFORMATION: UNA monomer
<220> FEATURE:
<221> NAME/KEY: modified_base
<222> LOCATION: (1953)..(1954)
<223> OTHER INFORMATION: UNA monomer
<220> FEATURE:
<221> NAME/KEY: modified_base
<222> LOCATION: (1956)..(1956)
<223> OTHER INFORMATION: UNA monomer
<220> FEATURE:
<221> NAME/KEY: modified_base
<222> LOCATION: (1959)..(1959)
<223> OTHER INFORMATION: UNA monomer
<220> FEATURE:
<221> NAME/KEY: modified_base
<222> LOCATION: (1962)..(1962)
<223> OTHER INFORMATION: UNA monomer
<220> FEATURE:
<221> NAME/KEY: modified_base
<222> LOCATION: (1968)..(1968)
<223> OTHER INFORMATION: UNA monomer
<220> FEATURE:
<221> NAME/KEY: modified_base
<222> LOCATION: (1978)..(1978)
<223> OTHER INFORMATION: UNA monomer
<220> FEATURE:
<221> NAME/KEY: modified_base
<222> LOCATION: (1980)..(1980)
<223> OTHER INFORMATION: UNA monomer
<220> FEATURE:
<221> NAME/KEY: modified_base
<222> LOCATION: (1983)..(1983)
<223> OTHER INFORMATION: UNA monomer
<220> FEATURE:
<221> NAME/KEY: modified_base
<222> LOCATION: (1987)..(1988)
<223> OTHER INFORMATION: UNA monomer
<220> FEATURE:
<221> NAME/KEY: modified_base
<222> LOCATION: (1991)..(1991)
<223> OTHER INFORMATION: UNA monomer
<220> FEATURE:
<221> NAME/KEY: modified_base
<222> LOCATION: (1995)..(1995)
<223> OTHER INFORMATION: UNA monomer
<220> FEATURE:
<221> NAME/KEY: modified_base
<222> LOCATION: (1998)..(1998)
<223> OTHER INFORMATION: UNA monomer
<220> FEATURE:
<221> NAME/KEY: modified_base
<222> LOCATION: (2003)..(2005)
<223> OTHER INFORMATION: UNA monomer
<220> FEATURE:
<221> NAME/KEY: modified_base
<222> LOCATION: (2009)..(2009)
<223> OTHER INFORMATION: UNA monomer <220> FEATURE:
<221> NAME/KEY: modified_base
<222> LOCATION: (2012)..(2014)
<223> OTHER INFORMATION: UNA monomer
<220> FEATURE:
<221> NAME/KEY: modified_base
<222> LOCATION: (2016)..(2016)
<223> OTHER INFORMATION: UNA monomer
<220> FEATURE:
<221> NAME/KEY: modified_base
<222> LOCATION: (2026)..(2029)
<223> OTHER INFORMATION: UNA monomer
<220> FEATURE:
<221> NAME/KEY: modified_base
<222> LOCATION: (2034)..(2034)
<223> OTHER INFORMATION: UNA monomer
<220> FEATURE:
<221> NAME/KEY: modified_base
<222> LOCATION: (2038)..(2038)
<223> OTHER INFORMATION: UNA monomer
<220> FEATURE:
<221> NAME/KEY: modified_base
<222> LOCATION: (2043)..(2043)
<223> OTHER INFORMATION: UNA monomer
<220> FEATURE:
<221> NAME/KEY: modified_base
<222> LOCATION: (2046)..(2046)
<223> OTHER INFORMATION: UNA monomer
<220> FEATURE:
<221> NAME/KEY: modified_base
<222> LOCATION: (2053)..(2054)
<223> OTHER INFORMATION: UNA monomer
<220> FEATURE:
<221> NAME/KEY: modified_base
<222> LOCATION: (2058)..(2059)
<223> OTHER INFORMATION: UNA monomer
<220> FEATURE:
<221> NAME/KEY: modified_base
<222> LOCATION: (2070)..(2070)
<223> OTHER INFORMATION: UNA monomer
<220> FEATURE:
<221> NAME/KEY: modified_base
<222> LOCATION: (2075)..(2076)
<223> OTHER INFORMATION: UNA monomer
<220> FEATURE:
<221> NAME/KEY: modified_base
<222> LOCATION: (2079)..(2081)
<223> OTHER INFORMATION: UNA monomer
<220> FEATURE:
<221> NAME/KEY: modified_base
<222> LOCATION: (2093)..(2094)
<223> OTHER INFORMATION: UNA monomer
<220> FEATURE:
<221> NAME/KEY: modified_base
<222> LOCATION: (2096)..(2097)
<223> OTHER INFORMATION: UNA monomer
<220> FEATURE:
<221> NAME/KEY: modified_base
<222> LOCATION: (2107)..(2107)
<223> OTHER INFORMATION: UNA monomer
<220> FEATURE:
<221> NAME/KEY: modified_base
<222> LOCATION: (2109)..(2109)
<223> OTHER INFORMATION: UNA monomer
<220> FEATURE:
<221> NAME/KEY: modified_base
<222> LOCATION: (2112)..(2112)
<223> OTHER INFORMATION: UNA monomer
<220> FEATURE:
<221> NAME/KEY: modified_base
<222> LOCATION: (2114)..(2114)
<223> OTHER INFORMATION: UNA monomer
<220> FEATURE:
<221> NAME/KEY: modified_base
<222> LOCATION: (2118)..(2118)
<223> OTHER INFORMATION: UNA monomer
<220> FEATURE:
<221> NAME/KEY: modified_base
<222> LOCATION: (2123)..(2124)

<223> OTHER INFORMATION: UNA monomer
<220> FEATURE:
<221> NAME/KEY: modified_base
<222> LOCATION: (2127)..(2127)
<223> OTHER INFORMATION: UNA monomer
<220> FEATURE:
<221> NAME/KEY: modified_base
<222> LOCATION: (2135)..(2136)
<223> OTHER INFORMATION: UNA monomer
<220> FEATURE:
<221> NAME/KEY: modified_base
<222> LOCATION: (2148)..(2151)
<223> OTHER INFORMATION: UNA monomer
<220> FEATURE:
<221> NAME/KEY: modified_base
<222> LOCATION: (2153)..(2154)
<223> OTHER INFORMATION: UNA monomer
<220> FEATURE:
<221> NAME/KEY: modified_base
<222> LOCATION: (2159)..(2159)
<223> OTHER INFORMATION: UNA monomer
<220> FEATURE:
<221> NAME/KEY: modified_base
<222> LOCATION: (2161)..(2161)
<223> OTHER INFORMATION: UNA monomer
<220> FEATURE:
<221> NAME/KEY: modified_base
<222> LOCATION: (2163)..(2163)
<223> OTHER INFORMATION: UNA monomer
<220> FEATURE:
<221> NAME/KEY: modified_base
<222> LOCATION: (2165)..(2165)
<223> OTHER INFORMATION: UNA monomer
<220> FEATURE:
<221> NAME/KEY: modified_base
<222> LOCATION: (2169)..(2169)
<223> OTHER INFORMATION: UNA monomer
<220> FEATURE:
<221> NAME/KEY: modified_base
<222> LOCATION: (2174)..(2175)
<223> OTHER INFORMATION: UNA monomer
<220> FEATURE:
<221> NAME/KEY: modified_base
<222> LOCATION: (2178)..(2178)
<223> OTHER INFORMATION: UNA monomer
<220> FEATURE:
<221> NAME/KEY: modified_base
<222> LOCATION: (2186)..(2186)
<223> OTHER INFORMATION: UNA monomer
<220> FEATURE:
<221> NAME/KEY: modified_base
<222> LOCATION: (2189)..(2189)
<223> OTHER INFORMATION: UNA monomer
<220> FEATURE:
<221> NAME/KEY: modified_base
<222> LOCATION: (2195)..(2195)
<223> OTHER INFORMATION: UNA monomer
<220> FEATURE:
<221> NAME/KEY: modified_base
<222> LOCATION: (2206)..(2206)
<223> OTHER INFORMATION: UNA monomer
<220> FEATURE:
<221> NAME/KEY: modified_base
<222> LOCATION: (2211)..(2211)
<223> OTHER INFORMATION: UNA monomer
<220> FEATURE:
<221> NAME/KEY: modified_base
<222> LOCATION: (2216)..(2216)
<223> OTHER INFORMATION: UNA monomer
<220> FEATURE:
<221> NAME/KEY: modified_base
<222> LOCATION: (2220)..(2220)
<223> OTHER INFORMATION: UNA monomer
<220> FEATURE:
<221> NAME/KEY: modified_base
<222> LOCATION: (2224)..(2224)
<223> OTHER INFORMATION: UNA monomer
<220> FEATURE:
<221> NAME/KEY: modified_base <222> LOCATION: (2226)..(2226)
<223> OTHER INFORMATION: UNA monomer
<220> FEATURE:
<221> NAME/KEY: modified_base
<222> LOCATION: (2228)..(2229)
<223> OTHER INFORMATION: UNA monomer
<220> FEATURE:
<221> NAME/KEY: modified_base
<222> LOCATION: (2231)..(2231)
<223> OTHER INFORMATION: UNA monomer
<220> FEATURE:
<221> NAME/KEY: modified_base
<222> LOCATION: (2235)..(2235)
<223> OTHER INFORMATION: UNA monomer
<220> FEATURE:
<221> NAME/KEY: modified_base
<222> LOCATION: (2237)..(2237)
<223> OTHER INFORMATION: UNA monomer
<220> FEATURE:
<221> NAME/KEY: modified_base
<222> LOCATION: (2239)..(2239)
<223> OTHER INFORMATION: UNA monomer
<220> FEATURE:
<221> NAME/KEY: modified_base
<222> LOCATION: (2241)..(2241)
<223> OTHER INFORMATION: UNA monomer
<220> FEATURE:
<221> NAME/KEY: modified_base
<222> LOCATION: (2247)..(2247)
<223> OTHER INFORMATION: UNA monomer
<220> FEATURE:
<221> NAME/KEY: modified_base
<222> LOCATION: (2250)..(2252)
<223> OTHER INFORMATION: UNA monomer
<220> FEATURE:
<221> NAME/KEY: modified_base
<222> LOCATION: (2259)..(2259)
<223> OTHER INFORMATION: UNA monomer
<220> FEATURE:
<221> NAME/KEY: modified_base
<222> LOCATION: (2268)..(2269)
<223> OTHER INFORMATION: UNA monomer
<220> FEATURE:
<221> NAME/KEY: modified_base
<222> LOCATION: (2272)..(2275)
<223> OTHER INFORMATION: UNA monomer
<220> FEATURE:
<221> NAME/KEY: modified_base
<222> LOCATION: (2288)..(2288)
<223> OTHER INFORMATION: UNA monomer
<220> FEATURE:
<221> NAME/KEY: modified_base
<222> LOCATION: (2292)..(2292)
<223> OTHER INFORMATION: UNA monomer
<220> FEATURE:
<221> NAME/KEY: modified_base
<222> LOCATION: (2297)..(2297)
<223> OTHER INFORMATION: UNA monomer
<220> FEATURE:
<221> NAME/KEY: modified_base
<222> LOCATION: (2299)..(2299)
<223> OTHER INFORMATION: UNA monomer
<220> FEATURE:
<221> NAME/KEY: modified_base
<222> LOCATION: (2303)..(2303)
<223> OTHER INFORMATION: UNA monomer
<220> FEATURE:
<221> NAME/KEY: modified_base
<222> LOCATION: (2307)..(2307)
<223> OTHER INFORMATION: UNA monomer
<220> FEATURE:
<221> NAME/KEY: modified_base
<222> LOCATION: (2315)..(2316)
<223> OTHER INFORMATION: UNA monomer
<220> FEATURE:
<221> NAME/KEY: modified_base
<222> LOCATION: (2324)..(2324)
<223> OTHER INFORMATION: UNA monomer
<220> FEATURE:

<221> NAME/KEY: modified_base
<222> LOCATION: (2327)..(2328)
<223> OTHER INFORMATION: UNA monomer
<220> FEATURE:
<221> NAME/KEY: modified_base
<222> LOCATION: (2330)..(2331)
<223> OTHER INFORMATION: UNA monomer
<220> FEATURE:
<221> NAME/KEY: modified_base
<222> LOCATION: (2337)..(2337)
<223> OTHER INFORMATION: UNA monomer
<220> FEATURE:
<221> NAME/KEY: modified_base
<222> LOCATION: (2343)..(2343)
<223> OTHER INFORMATION: UNA monomer
<220> FEATURE:
<221> NAME/KEY: modified_base
<222> LOCATION: (2345)..(2346)
<223> OTHER INFORMATION: UNA monomer
<220> FEATURE:
<221> NAME/KEY: modified_base
<222> LOCATION: (2364)..(2365)
<223> OTHER INFORMATION: UNA monomer
<220> FEATURE:
<221> NAME/KEY: modified_base
<222> LOCATION: (2367)..(2367)
<223> OTHER INFORMATION: UNA monomer
<220> FEATURE:
<221> NAME/KEY: modified_base
<222> LOCATION: (2376)..(2376)
<223> OTHER INFORMATION: UNA monomer
<220> FEATURE:
<221> NAME/KEY: modified_base
<222> LOCATION: (2382)..(2383)
<223> OTHER INFORMATION: UNA monomer
<220> FEATURE:
<221> NAME/KEY: modified_base
<222> LOCATION: (2387)..(2387)
<223> OTHER INFORMATION: UNA monomer
<220> FEATURE:
<221> NAME/KEY: modified_base
<222> LOCATION: (2391)..(2391)
<223> OTHER INFORMATION: UNA monomer
<220> FEATURE:
<221> NAME/KEY: modified_base
<222> LOCATION: (2403)..(2403)
<223> OTHER INFORMATION: UNA monomer
<220> FEATURE:
<221> NAME/KEY: modified_base
<222> LOCATION: (2405)..(2405)
<223> OTHER INFORMATION: UNA monomer
<220> FEATURE:
<221> NAME/KEY: modified_base
<222> LOCATION: (2411)..(2411)
<223> OTHER INFORMATION: UNA monomer
<220> FEATURE:
<221> NAME/KEY: modified_base
<222> LOCATION: (2417)..(2418)
<223> OTHER INFORMATION: UNA monomer
<220> FEATURE:
<221> NAME/KEY: modified_base
<222> LOCATION: (2427)..(2427)
<223> OTHER INFORMATION: UNA monomer
<220> FEATURE:
<221> NAME/KEY: modified_base
<222> LOCATION: (2429)..(2430)
<223> OTHER INFORMATION: UNA monomer
<220> FEATURE:
<221> NAME/KEY: modified_base
<222> LOCATION: (2435)..(2436)
<223> OTHER INFORMATION: UNA monomer
<220> FEATURE:
<221> NAME/KEY: modified_base
<222> LOCATION: (2439)..(2439)
<223> OTHER INFORMATION: UNA monomer
<220> FEATURE:
<221> NAME/KEY: modified_base
<222> LOCATION: (2445)..(2445)
<223> OTHER INFORMATION: UNA monomer <220> FEATURE:
<221> NAME/KEY: modified_base
<222> LOCATION: (2450)..(2451)
<223> OTHER INFORMATION: UNA monomer
<220> FEATURE:
<221> NAME/KEY: modified_base
<222> LOCATION: (2453)..(2454)
<223> OTHER INFORMATION: UNA monomer
<220> FEATURE:
<221> NAME/KEY: modified_base
<222> LOCATION: (2463)..(2463)
<223> OTHER INFORMATION: UNA monomer
<220> FEATURE:
<221> NAME/KEY: modified_base
<222> LOCATION: (2468)..(2469)
<223> OTHER INFORMATION: UNA monomer
<220> FEATURE:
<221> NAME/KEY: modified_base
<222> LOCATION: (2487)..(2487)
<223> OTHER INFORMATION: UNA monomer
<220> FEATURE:
<221> NAME/KEY: modified_base
<222> LOCATION: (2491)..(2491)
<223> OTHER INFORMATION: UNA monomer
<220> FEATURE:
<221> NAME/KEY: modified_base
<222> LOCATION: (2493)..(2493)
<223> OTHER INFORMATION: UNA monomer
<220> FEATURE:
<221> NAME/KEY: modified_base
<222> LOCATION: (2495)..(2496)
<223> OTHER INFORMATION: UNA monomer
<220> FEATURE:
<221> NAME/KEY: modified_base
<222> LOCATION: (2504)..(2504)
<223> OTHER INFORMATION: UNA monomer
<220> FEATURE:
<221> NAME/KEY: modified_base
<222> LOCATION: (2509)..(2511)
<223> OTHER INFORMATION: UNA monomer
<220> FEATURE:
<221> NAME/KEY: modified_base
<222> LOCATION: (2518)..(2519)
<223> OTHER INFORMATION: UNA monomer
<220> FEATURE:
<221> NAME/KEY: modified_base
<222> LOCATION: (2521)..(2521)
<223> OTHER INFORMATION: UNA monomer
<220> FEATURE:
<221> NAME/KEY: modified_base
<222> LOCATION: (2523)..(2523)
<223> OTHER INFORMATION: UNA monomer
<220> FEATURE:
<221> NAME/KEY: modified_base
<222> LOCATION: (2532)..(2532)
<223> OTHER INFORMATION: UNA monomer
<220> FEATURE:
<221> NAME/KEY: modified_base
<222> LOCATION: (2534)..(2535)
<223> OTHER INFORMATION: UNA monomer
<220> FEATURE:
<221> NAME/KEY: modified_base
<222> LOCATION: (2537)..(2538)
<223> OTHER INFORMATION: UNA monomer
<220> FEATURE:
<221> NAME/KEY: modified_base
<222> LOCATION: (2540)..(2540)
<223> OTHER INFORMATION: UNA monomer
<220> FEATURE:
<221> NAME/KEY: modified_base
<222> LOCATION: (2542)..(2543)
<223> OTHER INFORMATION: UNA monomer
<220> FEATURE:
<221> NAME/KEY: modified_base
<222> LOCATION: (2549)..(2550)
<223> OTHER INFORMATION: UNA monomer
<220> FEATURE:
<221> NAME/KEY: modified_base
<222> LOCATION: (2553)..(2553)

<223> OTHER INFORMATION: UNA monomer
<220> FEATURE:
<221> NAME/KEY: modified_base
<222> LOCATION: (2555)..(2556)
<223> OTHER INFORMATION: UNA monomer
<220> FEATURE:
<221> NAME/KEY: modified_base
<222> LOCATION: (2559)..(2559)
<223> OTHER INFORMATION: UNA monomer
<220> FEATURE:
<221> NAME/KEY: modified_base
<222> LOCATION: (2565)..(2565)
<223> OTHER INFORMATION: UNA monomer
<220> FEATURE:
<221> NAME/KEY: modified_base
<222> LOCATION: (2573)..(2573)
<223> OTHER INFORMATION: UNA monomer
<220> FEATURE:
<221> NAME/KEY: modified_base
<222> LOCATION: (2577)..(2577)
<223> OTHER INFORMATION: UNA monomer
<220> FEATURE:
<221> NAME/KEY: modified_base
<222> LOCATION: (2579)..(2580)
<223> OTHER INFORMATION: UNA monomer
<220> FEATURE:
<221> NAME/KEY: modified_base
<222> LOCATION: (2585)..(2586)
<223> OTHER INFORMATION: UNA monomer
<220> FEATURE:
<221> NAME/KEY: modified_base
<222> LOCATION: (2588)..(2589)
<223> OTHER INFORMATION: UNA monomer
<220> FEATURE:
<221> NAME/KEY: modified_base
<222> LOCATION: (2595)..(2595)
<223> OTHER INFORMATION: UNA monomer
<220> FEATURE:
<221> NAME/KEY: modified_base
<222> LOCATION: (2598)..(2598)
<223> OTHER INFORMATION: UNA monomer
<220> FEATURE:
<221> NAME/KEY: modified_base
<222> LOCATION: (2600)..(2600)
<223> OTHER INFORMATION: UNA monomer
<220> FEATURE:
<221> NAME/KEY: modified_base
<222> LOCATION: (2608)..(2609)
<223> OTHER INFORMATION: UNA monomer
<220> FEATURE:
<221> NAME/KEY: modified_base
<222> LOCATION: (2613)..(2613)
<223> OTHER INFORMATION: UNA monomer
<220> FEATURE:
<221> NAME/KEY: modified_base
<222> LOCATION: (2616)..(2616)
<223> OTHER INFORMATION: UNA monomer
<220> FEATURE:
<221> NAME/KEY: modified_base
<222> LOCATION: (2620)..(2622)
<223> OTHER INFORMATION: UNA monomer
<220> FEATURE:
<221> NAME/KEY: modified_base
<222> LOCATION: (2626)..(2626)
<223> OTHER INFORMATION: UNA monomer
<220> FEATURE:
<221> NAME/KEY: modified_base
<222> LOCATION: (2628)..(2628)
<223> OTHER INFORMATION: UNA monomer
<220> FEATURE:
<221> NAME/KEY: modified_base
<222> LOCATION: (2636)..(2636)
<223> OTHER INFORMATION: UNA monomer
<220> FEATURE:
<221> NAME/KEY: modified_base
<222> LOCATION: (2640)..(2640)
<223> OTHER INFORMATION: UNA monomer
<220> FEATURE:
<221> NAME/KEY: modified_base <222> LOCATION: (2642)..(2643)
<223> OTHER INFORMATION: UNA monomer
<220> FEATURE:
<221> NAME/KEY: modified_base
<222> LOCATION: (2649)..(2649)
<223> OTHER INFORMATION: UNA monomer
<220> FEATURE:
<221> NAME/KEY: modified_base
<222> LOCATION: (2655)..(2655)
<223> OTHER INFORMATION: UNA monomer
<220> FEATURE:
<221> NAME/KEY: modified_base
<222> LOCATION: (2658)..(2658)
<223> OTHER INFORMATION: UNA monomer
<220> FEATURE:
<221> NAME/KEY: modified_base
<222> LOCATION: (2660)..(2660)
<223> OTHER INFORMATION: UNA monomer
<220> FEATURE:
<221> NAME/KEY: modified_base
<222> LOCATION: (2662)..(2663)
<223> OTHER INFORMATION: UNA monomer
<220> FEATURE:
<221> NAME/KEY: modified_base
<222> LOCATION: (2669)..(2670)
<223> OTHER INFORMATION: UNA monomer
<220> FEATURE:
<221> NAME/KEY: modified_base
<222> LOCATION: (2673)..(2676)
<223> OTHER INFORMATION: UNA monomer
<220> FEATURE:
<221> NAME/KEY: modified_base
<222> LOCATION: (2679)..(2680)
<223> OTHER INFORMATION: UNA monomer
<220> FEATURE:
<221> NAME/KEY: modified_base
<222> LOCATION: (2682)..(2682)
<223> OTHER INFORMATION: UNA monomer
<220> FEATURE:
<221> NAME/KEY: modified_base
<222> LOCATION: (2684)..(2685)
<223> OTHER INFORMATION: UNA monomer
<220> FEATURE:
<221> NAME/KEY: modified_base
<222> LOCATION: (2689)..(2689)
<223> OTHER INFORMATION: UNA monomer
<220> FEATURE:
<221> NAME/KEY: modified_base
<222> LOCATION: (2695)..(2696)
<223> OTHER INFORMATION: UNA monomer
<220> FEATURE:
<221> NAME/KEY: modified_base
<222> LOCATION: (2700)..(2702)
<223> OTHER INFORMATION: UNA monomer
<220> FEATURE:
<221> NAME/KEY: modified_base
<222> LOCATION: (2706)..(2706)
<223> OTHER INFORMATION: UNA monomer
<220> FEATURE:
<221> NAME/KEY: modified_base
<222> LOCATION: (2711)..(2711)
<223> OTHER INFORMATION: UNA monomer
<220> FEATURE:
<221> NAME/KEY: modified_base
<222> LOCATION: (2715)..(2715)
<223> OTHER INFORMATION: UNA monomer
<220> FEATURE:
<221> NAME/KEY: modified_base
<222> LOCATION: (2720)..(2720)
<223> OTHER INFORMATION: UNA monomer
<220> FEATURE:
<221> NAME/KEY: modified_base
<222> LOCATION: (2723)..(2725)
<223> OTHER INFORMATION: UNA monomer
<220> FEATURE:
<221> NAME/KEY: modified_base
<222> LOCATION: (2731)..(2731)
<223> OTHER INFORMATION: UNA monomer
<220> FEATURE:

<221> NAME/KEY: modified_base
<222> LOCATION: (2733)..(2733)
<223> OTHER INFORMATION: UNA monomer
<220> FEATURE:
<221> NAME/KEY: modified_base
<222> LOCATION: (2737)..(2737)
<223> OTHER INFORMATION: UNA monomer
<220> FEATURE:
<221> NAME/KEY: modified_base
<222> LOCATION: (2754)..(2754)
<223> OTHER INFORMATION: UNA monomer
<220> FEATURE:
<221> NAME/KEY: modified_base
<222> LOCATION: (2757)..(2757)
<223> OTHER INFORMATION: UNA monomer
<220> FEATURE:
<221> NAME/KEY: modified_base
<222> LOCATION: (2764)..(2764)
<223> OTHER INFORMATION: UNA monomer
<220> FEATURE:
<221> NAME/KEY: modified_base
<222> LOCATION: (2767)..(2767)
<223> OTHER INFORMATION: UNA monomer
<220> FEATURE:
<221> NAME/KEY: modified_base
<222> LOCATION: (2769)..(2769)
<223> OTHER INFORMATION: UNA monomer
<220> FEATURE:
<221> NAME/KEY: modified_base
<222> LOCATION: (2774)..(2774)
<223> OTHER INFORMATION: UNA monomer
<220> FEATURE:
<221> NAME/KEY: modified_base
<222> LOCATION: (2782)..(2782)
<223> OTHER INFORMATION: UNA monomer
<220> FEATURE:
<221> NAME/KEY: modified_base
<222> LOCATION: (2785)..(2785)
<223> OTHER INFORMATION: UNA monomer
<220> FEATURE:
<221> NAME/KEY: modified_base
<222> LOCATION: (2792)..(2793)
<223> OTHER INFORMATION: UNA monomer
<220> FEATURE:
<221> NAME/KEY: modified_base
<222> LOCATION: (2797)..(2797)
<223> OTHER INFORMATION: UNA monomer
<220> FEATURE:
<221> NAME/KEY: modified_base
<222> LOCATION: (2799)..(2799)
<223> OTHER INFORMATION: UNA monomer
<220> FEATURE:
<221> NAME/KEY: modified_base
<222> LOCATION: (2805)..(2805)
<223> OTHER INFORMATION: UNA monomer
<220> FEATURE:
<221> NAME/KEY: modified_base
<222> LOCATION: (2807)..(2808)
<223> OTHER INFORMATION: UNA monomer
<220> FEATURE:
<221> NAME/KEY: modified_base
<222> LOCATION: (2814)..(2816)
<223> OTHER INFORMATION: UNA monomer
<220> FEATURE:
<221> NAME/KEY: modified_base
<222> LOCATION: (2819)..(2819)
<223> OTHER INFORMATION: UNA monomer
<220> FEATURE:
<221> NAME/KEY: modified_base
<222> LOCATION: (2821)..(2821)
<223> OTHER INFORMATION: UNA monomer
<220> FEATURE:
<221> NAME/KEY: modified_base
<222> LOCATION: (2823)..(2823)
<223> OTHER INFORMATION: UNA monomer
<220> FEATURE:
<221> NAME/KEY: modified_base
<222> LOCATION: (2825)..(2825)
<223> OTHER INFORMATION: UNA monomer <220> FEATURE:
<221> NAME/KEY: modified_base
<222> LOCATION: (2827)..(2828)
<223> OTHER INFORMATION: UNA monomer
<220> FEATURE:
<221> NAME/KEY: modified_base
<222> LOCATION: (2837)..(2837)
<223> OTHER INFORMATION: UNA monomer
<220> FEATURE:
<221> NAME/KEY: modified_base
<222> LOCATION: (2850)..(2850)
<223> OTHER INFORMATION: UNA monomer
<220> FEATURE:
<221> NAME/KEY: modified_base
<222> LOCATION: (2854)..(2855)
<223> OTHER INFORMATION: UNA monomer
<220> FEATURE:
<221> NAME/KEY: modified_base
<222> LOCATION: (2862)..(2862)
<223> OTHER INFORMATION: UNA monomer
<220> FEATURE:
<221> NAME/KEY: modified_base
<222> LOCATION: (2865)..(2869)
<223> OTHER INFORMATION: UNA monomer
<220> FEATURE:
<221> NAME/KEY: modified_base
<222> LOCATION: (2871)..(2871)
<223> OTHER INFORMATION: UNA monomer
<220> FEATURE:
<221> NAME/KEY: modified_base
<222> LOCATION: (2874)..(2874)
<223> OTHER INFORMATION: UNA monomer
<220> FEATURE:
<221> NAME/KEY: modified_base
<222> LOCATION: (2877)..(2879)
<223> OTHER INFORMATION: UNA monomer
<220> FEATURE:
<221> NAME/KEY: modified_base
<222> LOCATION: (2884)..(2884)
<223> OTHER INFORMATION: UNA monomer
<220> FEATURE:
<221> NAME/KEY: modified_base
<222> LOCATION: (2886)..(2886)
<223> OTHER INFORMATION: UNA monomer
<220> FEATURE:
<221> NAME/KEY: modified_base
<222> LOCATION: (2892)..(2893)
<223> OTHER INFORMATION: UNA monomer
<220> FEATURE:
<221> NAME/KEY: modified_base
<222> LOCATION: (2897)..(2897)
<223> OTHER INFORMATION: UNA monomer
<220> FEATURE:
<221> NAME/KEY: modified_base
<222> LOCATION: (2900)..(2901)
<223> OTHER INFORMATION: UNA monomer
<220> FEATURE:
<221> NAME/KEY: modified_base
<222> LOCATION: (2905)..(2905)
<223> OTHER INFORMATION: UNA monomer
<220> FEATURE:
<221> NAME/KEY: modified_base
<222> LOCATION: (2907)..(2907)
<223> OTHER INFORMATION: UNA monomer
<220> FEATURE:
<221> NAME/KEY: modified_base
<222> LOCATION: (2909)..(2909)
<223> OTHER INFORMATION: UNA monomer
<220> FEATURE:
<221> NAME/KEY: modified_base
<222> LOCATION: (2913)..(2913)
<223> OTHER INFORMATION: UNA monomer
<220> FEATURE:
<221> NAME/KEY: modified_base
<222> LOCATION: (2921)..(2922)
<223> OTHER INFORMATION: UNA monomer
<220> FEATURE:
<221> NAME/KEY: modified_base
<222> LOCATION: (2924)..(2926)

<223> OTHER INFORMATION: UNA monomer
<220> FEATURE:
<221> NAME/KEY: modified_base
<222> LOCATION: (2932)..(2932)
<223> OTHER INFORMATION: UNA monomer
<220> FEATURE:
<221> NAME/KEY: modified_base
<222> LOCATION: (2940)..(2940)
<223> OTHER INFORMATION: UNA monomer
<220> FEATURE:
<221> NAME/KEY: modified_base
<222> LOCATION: (2942)..(2943)
<223> OTHER INFORMATION: UNA monomer
<220> FEATURE:
<221> NAME/KEY: modified_base
<222> LOCATION: (2946)..(2946)
<223> OTHER INFORMATION: UNA monomer
<220> FEATURE:
<221> NAME/KEY: modified_base
<222> LOCATION: (2951)..(2952)
<223> OTHER INFORMATION: UNA monomer
<220> FEATURE:
<221> NAME/KEY: modified_base
<222> LOCATION: (2955)..(2955)
<223> OTHER INFORMATION: UNA monomer
<220> FEATURE:
<221> NAME/KEY: modified_base
<222> LOCATION: (2959)..(2959)
<223> OTHER INFORMATION: UNA monomer
<220> FEATURE:
<221> NAME/KEY: modified_base
<222> LOCATION: (2962)..(2963)
<223> OTHER INFORMATION: UNA monomer
<220> FEATURE:
<221> NAME/KEY: modified_base
<222> LOCATION: (2970)..(2970)
<223> OTHER INFORMATION: UNA monomer
<220> FEATURE:
<221> NAME/KEY: modified_base
<222> LOCATION: (2972)..(2972)
<223> OTHER INFORMATION: UNA monomer
<220> FEATURE:
<221> NAME/KEY: modified_base
<222> LOCATION: (2974)..(2975)
<223> OTHER INFORMATION: UNA monomer
<220> FEATURE:
<221> NAME/KEY: modified_base
<222> LOCATION: (2977)..(2978)
<223> OTHER INFORMATION: UNA monomer
<220> FEATURE:
<221> NAME/KEY: modified_base
<222> LOCATION: (2980)..(2980)
<223> OTHER INFORMATION: UNA monomer
<220> FEATURE:
<221> NAME/KEY: modified_base
<222> LOCATION: (2984)..(2984)
<223> OTHER INFORMATION: UNA monomer
<220> FEATURE:
<221> NAME/KEY: modified_base
<222> LOCATION: (2993)..(2993)
<223> OTHER INFORMATION: UNA monomer
<220> FEATURE:
<221> NAME/KEY: modified_base
<222> LOCATION: (3000)..(3001)
<223> OTHER INFORMATION: UNA monomer
<220> FEATURE:
<221> NAME/KEY: modified_base
<222> LOCATION: (3005)..(3006)
<223> OTHER INFORMATION: UNA monomer
<220> FEATURE:
<221> NAME/KEY: modified_base
<222> LOCATION: (3008)..(3008)
<223> OTHER INFORMATION: UNA monomer
<220> FEATURE:
<221> NAME/KEY: modified_base
<222> LOCATION: (3013)..(3013)
<223> OTHER INFORMATION: UNA monomer
<220> FEATURE:
<221> NAME/KEY: modified_base <222> LOCATION: (3015)..(3016)
<223> OTHER INFORMATION: UNA monomer
<220> FEATURE:
<221> NAME/KEY: modified_base
<222> LOCATION: (3019)..(3021)
<223> OTHER INFORMATION: UNA monomer
<220> FEATURE:
<221> NAME/KEY: modified_base
<222> LOCATION: (3024)..(3024)
<223> OTHER INFORMATION: UNA monomer
<220> FEATURE:
<221> NAME/KEY: modified_base
<222> LOCATION: (3027)..(3027)
<223> OTHER INFORMATION: UNA monomer
<220> FEATURE:
<221> NAME/KEY: modified_base
<222> LOCATION: (3029)..(3029)
<223> OTHER INFORMATION: UNA monomer
<220> FEATURE:
<221> NAME/KEY: modified_base
<222> LOCATION: (3031)..(3032)
<223> OTHER INFORMATION: UNA monomer
<220> FEATURE:
<221> NAME/KEY: modified_base
<222> LOCATION: (3035)..(3036)
<223> OTHER INFORMATION: UNA monomer
<220> FEATURE:
<221> NAME/KEY: modified_base
<222> LOCATION: (3039)..(3039)
<223> OTHER INFORMATION: UNA monomer
<220> FEATURE:
<221> NAME/KEY: modified_base
<222> LOCATION: (3043)..(3043)
<223> OTHER INFORMATION: UNA monomer
<220> FEATURE:
<221> NAME/KEY: modified_base
<222> LOCATION: (3045)..(3045)
<223> OTHER INFORMATION: UNA monomer
<220> FEATURE:
<221> NAME/KEY: modified_base
<222> LOCATION: (3051)..(3051)
<223> OTHER INFORMATION: UNA monomer
<220> FEATURE:
<221> NAME/KEY: modified_base
<222> LOCATION: (3053)..(3054)
<223> OTHER INFORMATION: UNA monomer
<220> FEATURE:
<221> NAME/KEY: modified_base
<222> LOCATION: (3056)..(3056)
<223> OTHER INFORMATION: UNA monomer
<220> FEATURE:
<221> NAME/KEY: modified_base
<222> LOCATION: (3060)..(3060)
<223> OTHER INFORMATION: UNA monomer
<220> FEATURE:
<221> NAME/KEY: modified_base
<222> LOCATION: (3067)..(3067)
<223> OTHER INFORMATION: UNA monomer
<220> FEATURE:
<221> NAME/KEY: modified_base
<222> LOCATION: (3077)..(3077)
<223> OTHER INFORMATION: UNA monomer
<220> FEATURE:
<221> NAME/KEY: modified_base
<222> LOCATION: (3079)..(3079)
<223> OTHER INFORMATION: UNA monomer
<220> FEATURE:
<221> NAME/KEY: modified_base
<222> LOCATION: (3085)..(3087)
<223> OTHER INFORMATION: UNA monomer
<220> FEATURE:
<221> NAME/KEY: modified_base
<222> LOCATION: (3089)..(3090)
<223> OTHER INFORMATION: UNA monomer
<220> FEATURE:
<221> NAME/KEY: modified_base
<222> LOCATION: (3096)..(3096)
<223> OTHER INFORMATION: UNA monomer
<220> FEATURE:

<221> NAME/KEY: modified_base
<222> LOCATION: (3099)..(3100)
<223> OTHER INFORMATION: UNA monomer
<220> FEATURE:
<221> NAME/KEY: modified_base
<222> LOCATION: (3106)..(3108)
<223> OTHER INFORMATION: UNA monomer
<220> FEATURE:
<221> NAME/KEY: modified_base
<222> LOCATION: (3110)..(3110)
<223> OTHER INFORMATION: UNA monomer
<220> FEATURE:
<221> NAME/KEY: modified_base
<222> LOCATION: (3119)..(3121)
<223> OTHER INFORMATION: UNA monomer
<220> FEATURE:
<221> NAME/KEY: modified_base
<222> LOCATION: (3124)..(3125)
<223> OTHER INFORMATION: UNA monomer
<220> FEATURE:
<221> NAME/KEY: modified_base
<222> LOCATION: (3129)..(3130)
<223> OTHER INFORMATION: UNA monomer
<220> FEATURE:
<221> NAME/KEY: modified_base
<222> LOCATION: (3134)..(3135)
<223> OTHER INFORMATION: UNA monomer
<220> FEATURE:
<221> NAME/KEY: modified_base
<222> LOCATION: (3140)..(3140)
<223> OTHER INFORMATION: UNA monomer
<220> FEATURE:
<221> NAME/KEY: modified_base
<222> LOCATION: (3142)..(3142)
<223> OTHER INFORMATION: UNA monomer
<220> FEATURE:
<221> NAME/KEY: modified_base
<222> LOCATION: (3144)..(3144)
<223> OTHER INFORMATION: UNA monomer
<220> FEATURE:
<221> NAME/KEY: modified_base
<222> LOCATION: (3149)..(3149)
<223> OTHER INFORMATION: UNA monomer
<220> FEATURE:
<221> NAME/KEY: modified_base
<222> LOCATION: (3157)..(3158)
<223> OTHER INFORMATION: UNA monomer
<220> FEATURE:
<221> NAME/KEY: modified_base
<222> LOCATION: (3162)..(3163)
<223> OTHER INFORMATION: UNA monomer
<220> FEATURE:
<221> NAME/KEY: modified_base
<222> LOCATION: (3167)..(3167)
<223> OTHER INFORMATION: UNA monomer
<220> FEATURE:
<221> NAME/KEY: modified_base
<222> LOCATION: (3173)..(3174)
<223> OTHER INFORMATION: UNA monomer
<220> FEATURE:
<221> NAME/KEY: modified_base
<222> LOCATION: (3176)..(3178)
<223> OTHER INFORMATION: UNA monomer
<220> FEATURE:
<221> NAME/KEY: modified_base
<222> LOCATION: (3183)..(3183)
<223> OTHER INFORMATION: UNA monomer
<220> FEATURE:
<221> NAME/KEY: modified_base
<222> LOCATION: (3188)..(3188)
<223> OTHER INFORMATION: UNA monomer
<220> FEATURE:
<221> NAME/KEY: modified_base
<222> LOCATION: (3191)..(3191)
<223> OTHER INFORMATION: UNA monomer
<220> FEATURE:
<221> NAME/KEY: modified_base
<222> LOCATION: (3195)..(3195)
<223> OTHER INFORMATION: UNA monomer <220> FEATURE:
<221> NAME/KEY: modified_base
<222> LOCATION: (3197)..(3197)
<223> OTHER INFORMATION: UNA monomer
<220> FEATURE:
<221> NAME/KEY: modified_base
<222> LOCATION: (3201)..(3202)
<223> OTHER INFORMATION: UNA monomer
<220> FEATURE:
<221> NAME/KEY: modified_base
<222> LOCATION: (3204)..(3204)
<223> OTHER INFORMATION: UNA monomer
<220> FEATURE:
<221> NAME/KEY: modified_base
<222> LOCATION: (3208)..(3209)
<223> OTHER INFORMATION: UNA monomer
<220> FEATURE:
<221> NAME/KEY: modified_base
<222> LOCATION: (3213)..(3213)
<223> OTHER INFORMATION: UNA monomer
<220> FEATURE:
<221> NAME/KEY: modified_base
<222> LOCATION: (3218)..(3218)
<223> OTHER INFORMATION: UNA monomer
<220> FEATURE:
<221> NAME/KEY: modified_base
<222> LOCATION: (3238)..(3238)
<223> OTHER INFORMATION: UNA monomer
<220> FEATURE:
<221> NAME/KEY: modified_base
<222> LOCATION: (3240)..(3241)
<223> OTHER INFORMATION: UNA monomer
<220> FEATURE:
<221> NAME/KEY: modified_base
<222> LOCATION: (3243)..(3243)
<223> OTHER INFORMATION: UNA monomer
<220> FEATURE:
<221> NAME/KEY: modified_base
<222> LOCATION: (3245)..(3247)
<223> OTHER INFORMATION: UNA monomer
<220> FEATURE:
<221> NAME/KEY: modified_base
<222> LOCATION: (3249)..(3249)
<223> OTHER INFORMATION: UNA monomer
<220> FEATURE:
<221> NAME/KEY: modified_base
<222> LOCATION: (3251)..(3251)
<223> OTHER INFORMATION: UNA monomer
<220> FEATURE:
<221> NAME/KEY: modified_base
<222> LOCATION: (3255)..(3255)
<223> OTHER INFORMATION: UNA monomer
<220> FEATURE:
<221> NAME/KEY: modified_base
<222> LOCATION: (3262)..(3263)
<223> OTHER INFORMATION: UNA monomer
<220> FEATURE:
<221> NAME/KEY: modified_base
<222> LOCATION: (3267)..(3267)
<223> OTHER INFORMATION: UNA monomer
<220> FEATURE:
<221> NAME/KEY: modified_base
<222> LOCATION: (3270)..(3274)
<223> OTHER INFORMATION: UNA monomer
<220> FEATURE:
<221> NAME/KEY: modified_base
<222> LOCATION: (3276)..(3277)
<223> OTHER INFORMATION: UNA monomer
<220> FEATURE:
<221> NAME/KEY: modified_base
<222> LOCATION: (3279)..(3279)
<223> OTHER INFORMATION: UNA monomer
<220> FEATURE:
<221> NAME/KEY: modified_base
<222> LOCATION: (3282)..(3282)
<223> OTHER INFORMATION: UNA monomer
<220> FEATURE:
<221> NAME/KEY: modified_base
<222> LOCATION: (3284)..(3287)

<223> OTHER INFORMATION: UNA monomer
<220> FEATURE:
<221> NAME/KEY: modified_base
<222> LOCATION: (3292)..(3292)
<223> OTHER INFORMATION: UNA monomer
<220> FEATURE:
<221> NAME/KEY: modified_base
<222> LOCATION: (3295)..(3295)
<223> OTHER INFORMATION: UNA monomer
<220> FEATURE:
<221> NAME/KEY: modified_base
<222> LOCATION: (3306)..(3306)
<223> OTHER INFORMATION: UNA monomer
<220> FEATURE:
<221> NAME/KEY: modified_base
<222> LOCATION: (3309)..(3312)
<223> OTHER INFORMATION: UNA monomer
<220> FEATURE:
<221> NAME/KEY: modified_base
<222> LOCATION: (3314)..(3315)
<223> OTHER INFORMATION: UNA monomer
<220> FEATURE:
<221> NAME/KEY: modified_base
<222> LOCATION: (3320)..(3321)
<223> OTHER INFORMATION: UNA monomer
<220> FEATURE:
<221> NAME/KEY: modified_base
<222> LOCATION: (3327)..(3327)
<223> OTHER INFORMATION: UNA monomer
<220> FEATURE:
<221> NAME/KEY: modified_base
<222> LOCATION: (3329)..(3329)
<223> OTHER INFORMATION: UNA monomer
<220> FEATURE:
<221> NAME/KEY: modified_base
<222> LOCATION: (3332)..(3332)
<223> OTHER INFORMATION: UNA monomer
<220> FEATURE:
<221> NAME/KEY: modified_base
<222> LOCATION: (3335)..(3335)
<223> OTHER INFORMATION: UNA monomer
<220> FEATURE:
<221> NAME/KEY: modified_base
<222> LOCATION: (3338)..(3339)
<223> OTHER INFORMATION: UNA monomer
<220> FEATURE:
<221> NAME/KEY: modified_base
<222> LOCATION: (3342)..(3342)
<223> OTHER INFORMATION: UNA monomer
<220> FEATURE:
<221> NAME/KEY: modified_base
<222> LOCATION: (3349)..(3349)
<223> OTHER INFORMATION: UNA monomer
<220> FEATURE:
<221> NAME/KEY: modified_base
<222> LOCATION: (3351)..(3351)
<223> OTHER INFORMATION: UNA monomer
<220> FEATURE:
<221> NAME/KEY: modified_base
<222> LOCATION: (3353)..(3353)
<223> OTHER INFORMATION: UNA monomer
<220> FEATURE:
<221> NAME/KEY: modified_base
<222> LOCATION: (3366)..(3366)
<223> OTHER INFORMATION: UNA monomer
<220> FEATURE:
<221> NAME/KEY: modified_base
<222> LOCATION: (3368)..(3369)
<223> OTHER INFORMATION: UNA monomer
<220> FEATURE:
<221> NAME/KEY: modified_base
<222> LOCATION: (3371)..(3374)
<223> OTHER INFORMATION: UNA monomer
<220> FEATURE:
<221> NAME/KEY: modified_base
<222> LOCATION: (3379)..(3381)
<223> OTHER INFORMATION: UNA monomer
<220> FEATURE:
<221> NAME/KEY: modified_base <222> LOCATION: (3387)..(3387)
<223> OTHER INFORMATION: UNA monomer
<220> FEATURE:
<221> NAME/KEY: modified_base
<222> LOCATION: (3392)..(3392)
<223> OTHER INFORMATION: UNA monomer
<220> FEATURE:
<221> NAME/KEY: modified_base
<222> LOCATION: (3399)..(3399)
<223> OTHER INFORMATION: UNA monomer
<220> FEATURE:
<221> NAME/KEY: modified_base
<222> LOCATION: (3402)..(3402)
<223> OTHER INFORMATION: UNA monomer
<220> FEATURE:
<221> NAME/KEY: modified_base
<222> LOCATION: (3404)..(3404)
<223> OTHER INFORMATION: UNA monomer
<220> FEATURE:
<221> NAME/KEY: modified_base
<222> LOCATION: (3407)..(3408)
<223> OTHER INFORMATION: UNA monomer
<220> FEATURE:
<221> NAME/KEY: modified_base
<222> LOCATION: (3411)..(3411)
<223> OTHER INFORMATION: UNA monomer
<220> FEATURE:
<221> NAME/KEY: modified_base
<222> LOCATION: (3414)..(3414)
<223> OTHER INFORMATION: UNA monomer
<220> FEATURE:
<221> NAME/KEY: modified_base
<222> LOCATION: (3416)..(3416)
<223> OTHER INFORMATION: UNA monomer
<220> FEATURE:
<221> NAME/KEY: modified_base
<222> LOCATION: (3419)..(3419)
<223> OTHER INFORMATION: UNA monomer
<220> FEATURE:
<221> NAME/KEY: modified_base
<222> LOCATION: (3423)..(3423)
<223> OTHER INFORMATION: UNA monomer
<220> FEATURE:
<221> NAME/KEY: modified_base
<222> LOCATION: (3431)..(3433)
<223> OTHER INFORMATION: UNA monomer
<220> FEATURE:
<221> NAME/KEY: modified_base
<222> LOCATION: (3435)..(3435)
<223> OTHER INFORMATION: UNA monomer
<220> FEATURE:
<221> NAME/KEY: modified_base
<222> LOCATION: (3442)..(3442)
<223> OTHER INFORMATION: UNA monomer
<220> FEATURE:
<221> NAME/KEY: modified_base
<222> LOCATION: (3447)..(3448)
<223> OTHER INFORMATION: UNA monomer
<220> FEATURE:
<221> NAME/KEY: modified_base
<222> LOCATION: (3450)..(3450)
<223> OTHER INFORMATION: UNA monomer
<220> FEATURE:
<221> NAME/KEY: modified_base
<222> LOCATION: (3456)..(3456)
<223> OTHER INFORMATION: UNA monomer
<220> FEATURE:
<221> NAME/KEY: modified_base
<222> LOCATION: (3459)..(3459)
<223> OTHER INFORMATION: UNA monomer
<220> FEATURE:
<221> NAME/KEY: modified_base
<222> LOCATION: (3461)..(3461)
<223> OTHER INFORMATION: UNA monomer
<220> FEATURE:
<221> NAME/KEY: modified_base
<222> LOCATION: (3463)..(3463)
<223> OTHER INFORMATION: UNA monomer
<220> FEATURE:

<221> NAME/KEY: modified_base
<222> LOCATION: (3466)..(3466)
<223> OTHER INFORMATION: UNA monomer
<220> FEATURE:
<221> NAME/KEY: modified_base
<222> LOCATION: (3469)..(3469)
<223> OTHER INFORMATION: UNA monomer
<220> FEATURE:
<221> NAME/KEY: modified_base
<222> LOCATION: (3473)..(3473)
<223> OTHER INFORMATION: UNA monomer
<220> FEATURE:
<221> NAME/KEY: modified_base
<222> LOCATION: (3478)..(3478)
<223> OTHER INFORMATION: UNA monomer
<220> FEATURE:
<221> NAME/KEY: modified_base
<222> LOCATION: (3480)..(3480)
<223> OTHER INFORMATION: UNA monomer
<220> FEATURE:
<221> NAME/KEY: modified_base
<222> LOCATION: (3482)..(3482)
<223> OTHER INFORMATION: UNA monomer
<220> FEATURE:
<221> NAME/KEY: modified_base
<222> LOCATION: (3489)..(3490)
<223> OTHER INFORMATION: UNA monomer
<220> FEATURE:
<221> NAME/KEY: modified_base
<222> LOCATION: (3493)..(3493)
<223> OTHER INFORMATION: UNA monomer
<220> FEATURE:
<221> NAME/KEY: modified_base
<222> LOCATION: (3495)..(3495)
<223> OTHER INFORMATION: UNA monomer
<220> FEATURE:
<221> NAME/KEY: modified_base
<222> LOCATION: (3500)..(3500)
<223> OTHER INFORMATION: UNA monomer
<220> FEATURE:
<221> NAME/KEY: modified_base
<222> LOCATION: (3503)..(3504)
<223> OTHER INFORMATION: UNA monomer
<220> FEATURE:
<221> NAME/KEY: modified_base
<222> LOCATION: (3510)..(3510)
<223> OTHER INFORMATION: UNA monomer
<220> FEATURE:
<221> NAME/KEY: modified_base
<222> LOCATION: (3513)..(3513)
<223> OTHER INFORMATION: UNA monomer
<220> FEATURE:
<221> NAME/KEY: modified_base
<222> LOCATION: (3515)..(3515)
<223> OTHER INFORMATION: UNA monomer
<220> FEATURE:
<221> NAME/KEY: modified_base
<222> LOCATION: (3521)..(3522)
<223> OTHER INFORMATION: UNA monomer
<220> FEATURE:
<221> NAME/KEY: modified_base
<222> LOCATION: (3524)..(3524)
<223> OTHER INFORMATION: UNA monomer
<220> FEATURE:
<221> NAME/KEY: modified_base
<222> LOCATION: (3529)..(3529)
<223> OTHER INFORMATION: UNA monomer
<220> FEATURE:
<221> NAME/KEY: modified_base
<222> LOCATION: (3536)..(3538)
<223> OTHER INFORMATION: UNA monomer
<220> FEATURE:
<221> NAME/KEY: modified_base
<222> LOCATION: (3545)..(3545)
<223> OTHER INFORMATION: UNA monomer
<220> FEATURE:
<221> NAME/KEY: modified_base
<222> LOCATION: (3547)..(3547)
<223> OTHER INFORMATION: UNA monomer <220> FEATURE:
<221> NAME/KEY: modified_base
<222> LOCATION: (3549)..(3549)
<223> OTHER INFORMATION: UNA monomer
<220> FEATURE:
<221> NAME/KEY: modified_base
<222> LOCATION: (3552)..(3552)
<223> OTHER INFORMATION: UNA monomer
<220> FEATURE:
<221> NAME/KEY: modified_base
<222> LOCATION: (3558)..(3558)
<223> OTHER INFORMATION: UNA monomer
<220> FEATURE:
<221> NAME/KEY: modified_base
<222> LOCATION: (3561)..(3562)
<223> OTHER INFORMATION: UNA monomer
<220> FEATURE:
<221> NAME/KEY: modified_base
<222> LOCATION: (3564)..(3564)
<223> OTHER INFORMATION: UNA monomer
<220> FEATURE:
<221> NAME/KEY: modified_base
<222> LOCATION: (3567)..(3567)
<223> OTHER INFORMATION: UNA monomer
<220> FEATURE:
<221> NAME/KEY: modified_base
<222> LOCATION: (3570)..(3572)
<223> OTHER INFORMATION: UNA monomer
<220> FEATURE:
<221> NAME/KEY: modified_base
<222> LOCATION: (3576)..(3576)
<223> OTHER INFORMATION: UNA monomer
<220> FEATURE:
<221> NAME/KEY: modified_base
<222> LOCATION: (3579)..(3579)
<223> OTHER INFORMATION: UNA monomer
<220> FEATURE:
<221> NAME/KEY: modified_base
<222> LOCATION: (3587)..(3587)
<223> OTHER INFORMATION: UNA monomer
<220> FEATURE:
<221> NAME/KEY: modified_base
<222> LOCATION: (3591)..(3591)
<223> OTHER INFORMATION: UNA monomer
<220> FEATURE:
<221> NAME/KEY: modified_base
<222> LOCATION: (3598)..(3599)
<223> OTHER INFORMATION: UNA monomer
<220> FEATURE:
<221> NAME/KEY: modified_base
<222> LOCATION: (3601)..(3603)
<223> OTHER INFORMATION: UNA monomer
<220> FEATURE:
<221> NAME/KEY: modified_base
<222> LOCATION: (3608)..(3608)
<223> OTHER INFORMATION: UNA monomer
<220> FEATURE:
<221> NAME/KEY: modified_base
<222> LOCATION: (3611)..(3611)
<223> OTHER INFORMATION: UNA monomer
<220> FEATURE:
<221> NAME/KEY: modified_base
<222> LOCATION: (3623)..(3623)
<223> OTHER INFORMATION: UNA monomer
<220> FEATURE:
<221> NAME/KEY: modified_base
<222> LOCATION: (3635)..(3635)
<223> OTHER INFORMATION: UNA monomer
<220> FEATURE:
<221> NAME/KEY: modified_base
<222> LOCATION: (3644)..(3644)
<223> OTHER INFORMATION: UNA monomer
<220> FEATURE:
<221> NAME/KEY: modified_base
<222> LOCATION: (3649)..(3650)
<223> OTHER INFORMATION: UNA monomer
<220> FEATURE:
<221> NAME/KEY: modified_base
<222> LOCATION: (3663)..(3663)

<223> OTHER INFORMATION: UNA monomer
<220> FEATURE:
<221> NAME/KEY: modified_base
<222> LOCATION: (3666)..(3666)
<223> OTHER INFORMATION: UNA monomer
<220> FEATURE:
<221> NAME/KEY: modified_base
<222> LOCATION: (3669)..(3669)
<223> OTHER INFORMATION: UNA monomer
<220> FEATURE:
<221> NAME/KEY: modified_base
<222> LOCATION: (3677)..(3677)
<223> OTHER INFORMATION: UNA monomer
<220> FEATURE:
<221> NAME/KEY: modified_base
<222> LOCATION: (3681)..(3681)
<223> OTHER INFORMATION: UNA monomer
<220> FEATURE:
<221> NAME/KEY: modified_base
<222> LOCATION: (3689)..(3689)
<223> OTHER INFORMATION: UNA monomer
<220> FEATURE:
<221> NAME/KEY: modified_base
<222> LOCATION: (3702)..(3705)
<223> OTHER INFORMATION: UNA monomer
<220> FEATURE:
<221> NAME/KEY: modified_base
<222> LOCATION: (3708)..(3708)
<223> OTHER INFORMATION: UNA monomer
<220> FEATURE:
<221> NAME/KEY: modified_base
<222> LOCATION: (3710)..(3710)
<223> OTHER INFORMATION: UNA monomer
<220> FEATURE:
<221> NAME/KEY: modified_base
<222> LOCATION: (3714)..(3714)
<223> OTHER INFORMATION: UNA monomer
<220> FEATURE:
<221> NAME/KEY: modified_base
<222> LOCATION: (3722)..(3723)
<223> OTHER INFORMATION: UNA monomer
<220> FEATURE:
<221> NAME/KEY: modified_base
<222> LOCATION: (3726)..(3726)
<223> OTHER INFORMATION: UNA monomer
<220> FEATURE:
<221> NAME/KEY: modified_base
<222> LOCATION: (3739)..(3741)
<223> OTHER INFORMATION: UNA monomer
<220> FEATURE:
<221> NAME/KEY: modified_base
<222> LOCATION: (3743)..(3745)
<223> OTHER INFORMATION: UNA monomer
<220> FEATURE:
<221> NAME/KEY: modified_base
<222> LOCATION: (3747)..(3747)
<223> OTHER INFORMATION: UNA monomer
<220> FEATURE:
<221> NAME/KEY: modified_base
<222> LOCATION: (3756)..(3756)
<223> OTHER INFORMATION: UNA monomer
<220> FEATURE:
<221> NAME/KEY: modified_base
<222> LOCATION: (3759)..(3761)
<223> OTHER INFORMATION: UNA monomer
<220> FEATURE:
<221> NAME/KEY: modified_base
<222> LOCATION: (3765)..(3766)
<223> OTHER INFORMATION: UNA monomer
<220> FEATURE:
<221> NAME/KEY: modified_base
<222> LOCATION: (3768)..(3768)
<223> OTHER INFORMATION: UNA monomer
<220> FEATURE:
<221> NAME/KEY: modified_base
<222> LOCATION: (3775)..(3775)
<223> OTHER INFORMATION: UNA monomer
<220> FEATURE:
<221> NAME/KEY: modified_base <222> LOCATION: (3779)..(3779)
<223> OTHER INFORMATION: UNA monomer
<220> FEATURE:
<221> NAME/KEY: modified_base
<222> LOCATION: (3783)..(3783)
<223> OTHER INFORMATION: UNA monomer
<220> FEATURE:
<221> NAME/KEY: modified_base
<222> LOCATION: (3788)..(3788)
<223> OTHER INFORMATION: UNA monomer
<220> FEATURE:
<221> NAME/KEY: modified_base
<222> LOCATION: (3798)..(3798)
<223> OTHER INFORMATION: UNA monomer
<220> FEATURE:
<221> NAME/KEY: modified_base
<222> LOCATION: (3807)..(3807)
<223> OTHER INFORMATION: UNA monomer
<220> FEATURE:
<221> NAME/KEY: modified_base
<222> LOCATION: (3821)..(3821)
<223> OTHER INFORMATION: UNA monomer
<220> FEATURE:
<221> NAME/KEY: modified_base
<222> LOCATION: (3840)..(3840)
<223> OTHER INFORMATION: UNA monomer
<220> FEATURE:
<221> NAME/KEY: modified_base
<222> LOCATION: (3844)..(3844)
<223> OTHER INFORMATION: UNA monomer
<220> FEATURE:
<221> NAME/KEY: modified_base
<222> LOCATION: (3846)..(3846)
<223> OTHER INFORMATION: UNA monomer
<220> FEATURE:
<221> NAME/KEY: modified_base
<222> LOCATION: (3849)..(3849)
<223> OTHER INFORMATION: UNA monomer
<220> FEATURE:
<221> NAME/KEY: modified_base
<222> LOCATION: (3851)..(3851)
<223> OTHER INFORMATION: UNA monomer
<220> FEATURE:
<221> NAME/KEY: modified_base
<222> LOCATION: (3857)..(3858)
<223> OTHER INFORMATION: UNA monomer
<220> FEATURE:
<221> NAME/KEY: modified_base
<222> LOCATION: (3860)..(3860)
<223> OTHER INFORMATION: UNA monomer
<220> FEATURE:
<221> NAME/KEY: modified_base
<222> LOCATION: (3866)..(3866)
<223> OTHER INFORMATION: UNA monomer
<220> FEATURE:
<221> NAME/KEY: modified_base
<222> LOCATION: (3870)..(3870)
<223> OTHER INFORMATION: UNA monomer
<220> FEATURE:
<221> NAME/KEY: modified_base
<222> LOCATION: (3874)..(3874)
<223> OTHER INFORMATION: UNA monomer
<220> FEATURE:
<221> NAME/KEY: modified_base
<222> LOCATION: (3876)..(3876)
<223> OTHER INFORMATION: UNA monomer
<220> FEATURE:
<221> NAME/KEY: modified_base
<222> LOCATION: (3879)..(3879)
<223> OTHER INFORMATION: UNA monomer
<220> FEATURE:
<221> NAME/KEY: modified_base
<222> LOCATION: (3881)..(3882)
<223> OTHER INFORMATION: UNA monomer
<220> FEATURE:
<221> NAME/KEY: modified_base
<222> LOCATION: (3886)..(3886)
<223> OTHER INFORMATION: UNA monomer
<220> FEATURE:

<221> NAME/KEY: modified_base
<222> LOCATION: (3889)..(3890)
<223> OTHER INFORMATION: UNA monomer
<220> FEATURE:
<221> NAME/KEY: modified_base
<222> LOCATION: (3893)..(3893)
<223> OTHER INFORMATION: UNA monomer
<220> FEATURE:
<221> NAME/KEY: modified_base
<222> LOCATION: (3898)..(3899)
<223> OTHER INFORMATION: UNA monomer
<220> FEATURE:
<221> NAME/KEY: modified_base
<222> LOCATION: (3901)..(3901)
<223> OTHER INFORMATION: UNA monomer
<220> FEATURE:
<221> NAME/KEY: modified_base
<222> LOCATION: (3912)..(3912)
<223> OTHER INFORMATION: UNA monomer
<220> FEATURE:
<221> NAME/KEY: modified_base
<222> LOCATION: (3914)..(3917)
<223> OTHER INFORMATION: UNA monomer
<220> FEATURE:
<221> NAME/KEY: modified_base
<222> LOCATION: (3921)..(3922)
<223> OTHER INFORMATION: UNA monomer
<220> FEATURE:
<221> NAME/KEY: modified_base
<222> LOCATION: (3924)..(3924)
<223> OTHER INFORMATION: UNA monomer
<220> FEATURE:
<221> NAME/KEY: modified_base
<222> LOCATION: (3927)..(3927)
<223> OTHER INFORMATION: UNA monomer
<220> FEATURE:
<221> NAME/KEY: modified_base
<222> LOCATION: (3932)..(3932)
<223> OTHER INFORMATION: UNA monomer
<220> FEATURE:
<221> NAME/KEY: modified_base
<222> LOCATION: (3938)..(3938)
<223> OTHER INFORMATION: UNA monomer
<220> FEATURE:
<221> NAME/KEY: modified_base
<222> LOCATION: (3948)..(3948)
<223> OTHER INFORMATION: UNA monomer
<220> FEATURE:
<221> NAME/KEY: modified_base
<222> LOCATION: (3957)..(3957)
<223> OTHER INFORMATION: UNA monomer
<220> FEATURE:
<221> NAME/KEY: modified_base
<222> LOCATION: (3959)..(3959)
<223> OTHER INFORMATION: UNA monomer
<220> FEATURE:
<221> NAME/KEY: modified_base
<222> LOCATION: (3965)..(3965)
<223> OTHER INFORMATION: UNA monomer
<220> FEATURE:
<221> NAME/KEY: modified_base
<222> LOCATION: (3967)..(3967)
<223> OTHER INFORMATION: UNA monomer
<220> FEATURE:
<221> NAME/KEY: modified_base
<222> LOCATION: (3970)..(3970)
<223> OTHER INFORMATION: UNA monomer
<220> FEATURE:
<221> NAME/KEY: modified_base
<222> LOCATION: (3972)..(3972)
<223> OTHER INFORMATION: UNA monomer
<220> FEATURE:
<221> NAME/KEY: modified_base
<222> LOCATION: (3975)..(3975)
<223> OTHER INFORMATION: UNA monomer
<220> FEATURE:
<221> NAME/KEY: modified_base
<222> LOCATION: (3979)..(3979)
<223> OTHER INFORMATION: UNA monomer <220> FEATURE:
<221> NAME/KEY: modified_base
<222> LOCATION: (3992)..(3992)
<223> OTHER INFORMATION: UNA monomer
<220> FEATURE:
<221> NAME/KEY: modified_base
<222> LOCATION: (4003)..(4005)
<223> OTHER INFORMATION: UNA monomer
<220> FEATURE:
<221> NAME/KEY: modified_base
<222> LOCATION: (4013)..(4013)
<223> OTHER INFORMATION: UNA monomer
<220> FEATURE:
<221> NAME/KEY: modified_base
<222> LOCATION: (4015)..(4017)
<223> OTHER INFORMATION: UNA monomer
<220> FEATURE:
<221> NAME/KEY: modified_base
<222> LOCATION: (4020)..(4020)
<223> OTHER INFORMATION: UNA monomer
<220> FEATURE:
<221> NAME/KEY: modified_base
<222> LOCATION: (4022)..(4024)
<223> OTHER INFORMATION: UNA monomer
<220> FEATURE:
<221> NAME/KEY: modified_base
<222> LOCATION: (4035)..(4036)
<223> OTHER INFORMATION: UNA monomer
<220> FEATURE:
<221> NAME/KEY: modified_base
<222> LOCATION: (4041)..(4043)
<223> OTHER INFORMATION: UNA monomer
<220> FEATURE:
<221> NAME/KEY: modified_base
<222> LOCATION: (4047)..(4047)
<223> OTHER INFORMATION: UNA monomer
<220> FEATURE:
<221> NAME/KEY: modified_base
<222> LOCATION: (4056)..(4056)
<223> OTHER INFORMATION: UNA monomer
<220> FEATURE:
<221> NAME/KEY: modified_base
<222> LOCATION: (4062)..(4062)
<223> OTHER INFORMATION: UNA monomer
<220> FEATURE:
<221> NAME/KEY: modified_base
<222> LOCATION: (4064)..(4064)
<223> OTHER INFORMATION: UNA monomer
<220> FEATURE:
<221> NAME/KEY: modified_base
<222> LOCATION: (4067)..(4068)
<223> OTHER INFORMATION: UNA monomer
<220> FEATURE:
<221> NAME/KEY: modified_base
<222> LOCATION: (4077)..(4077)
<223> OTHER INFORMATION: UNA monomer
<220> FEATURE:
<221> NAME/KEY: modified_base
<222> LOCATION: (4082)..(4082)
<223> OTHER INFORMATION: UNA monomer
<220> FEATURE:
<221> NAME/KEY: modified_base
<222> LOCATION: (4084)..(4084)
<223> OTHER INFORMATION: UNA monomer
<220> FEATURE:
<221> NAME/KEY: modified_base
<222> LOCATION: (4092)..(4092)
<223> OTHER INFORMATION: UNA monomer
<220> FEATURE:
<221> NAME/KEY: modified_base
<222> LOCATION: (4095)..(4096)
<223> OTHER INFORMATION: UNA monomer
<220> FEATURE:
<221> NAME/KEY: modified_base
<222> LOCATION: (4098)..(4098)
<223> OTHER INFORMATION: UNA monomer
<220> FEATURE:
<221> NAME/KEY: modified_base
<222> LOCATION: (4104)..(4105)

<223> OTHER INFORMATION: UNA monomer
<220> FEATURE:
<221> NAME/KEY: modified_base
<222> LOCATION: (4110)..(4110)
<223> OTHER INFORMATION: UNA monomer
<220> FEATURE:
<221> NAME/KEY: modified_base
<222> LOCATION: (4113)..(4114)
<223> OTHER INFORMATION: UNA monomer
<220> FEATURE:
<221> NAME/KEY: modified_base
<222> LOCATION: (4117)..(4117)
<223> OTHER INFORMATION: UNA monomer
<220> FEATURE:
<221> NAME/KEY: modified_base
<222> LOCATION: (4119)..(4119)
<223> OTHER INFORMATION: UNA monomer
<220> FEATURE:
<221> NAME/KEY: modified_base
<222> LOCATION: (4123)..(4123)
<223> OTHER INFORMATION: UNA monomer
<220> FEATURE:
<221> NAME/KEY: modified_base
<222> LOCATION: (4125)..(4125)
<223> OTHER INFORMATION: UNA monomer
<220> FEATURE:
<221> NAME/KEY: modified_base
<222> LOCATION: (4130)..(4130)
<223> OTHER INFORMATION: UNA monomer
<220> FEATURE:
<221> NAME/KEY: modified_base
<222> LOCATION: (4137)..(4137)
<223> OTHER INFORMATION: UNA monomer
<220> FEATURE:
<221> NAME/KEY: modified_base
<222> LOCATION: (4140)..(4143)
<223> OTHER INFORMATION: UNA monomer
<220> FEATURE:
<221> NAME/KEY: modified_base
<222> LOCATION: (4148)..(4148)
<223> OTHER INFORMATION: UNA monomer
<220> FEATURE:
<221> NAME/KEY: modified_base
<222> LOCATION: (4154)..(4154)
<223> OTHER INFORMATION: UNA monomer
<220> FEATURE:
<221> NAME/KEY: modified_base
<222> LOCATION: (4157)..(4158)
<223> OTHER INFORMATION: UNA monomer
<220> FEATURE:
<221> NAME/KEY: modified_base
<222> LOCATION: (4160)..(4160)
<223> OTHER INFORMATION: UNA monomer
<220> FEATURE:
<221> NAME/KEY: modified_base
<222> LOCATION: (4167)..(4167)
<223> OTHER INFORMATION: UNA monomer
<220> FEATURE:
<221> NAME/KEY: modified_base
<222> LOCATION: (4172)..(4172)
<223> OTHER INFORMATION: UNA monomer
<220> FEATURE:
<221> NAME/KEY: modified_base
<222> LOCATION: (4174)..(4176)
<223> OTHER INFORMATION: UNA monomer
<220> FEATURE:
<221> NAME/KEY: modified_base
<222> LOCATION: (4179)..(4179)
<223> OTHER INFORMATION: UNA monomer
<220> FEATURE:
<221> NAME/KEY: modified_base
<222> LOCATION: (4192)..(4192)
<223> OTHER INFORMATION: UNA monomer
<220> FEATURE:
<221> NAME/KEY: modified_base
<222> LOCATION: (4200)..(4202)
<223> OTHER INFORMATION: UNA monomer
<220> FEATURE:
<221> NAME/KEY: modified_base <222> LOCATION: (4208)..(4209)
<223> OTHER INFORMATION: UNA monomer
<220> FEATURE:
<221> NAME/KEY: modified_base
<222> LOCATION: (4222)..(4223)
<223> OTHER INFORMATION: UNA monomer
<220> FEATURE:
<221> NAME/KEY: modified_base
<222> LOCATION: (4226)..(4227)
<223> OTHER INFORMATION: UNA monomer
<220> FEATURE:
<221> NAME/KEY: modified_base
<222> LOCATION: (4230)..(4230)
<223> OTHER INFORMATION: UNA monomer
<220> FEATURE:
<221> NAME/KEY: modified_base
<222> LOCATION: (4235)..(4236)
<223> OTHER INFORMATION: UNA monomer
<220> FEATURE:
<221> NAME/KEY: modified_base
<222> LOCATION: (4241)..(4241)
<223> OTHER INFORMATION: UNA monomer
<220> FEATURE:
<221> NAME/KEY: modified_base
<222> LOCATION: (4248)..(4250)
<223> OTHER INFORMATION: UNA monomer
<220> FEATURE:
<221> NAME/KEY: modified_base
<222> LOCATION: (4254)..(4254)
<223> OTHER INFORMATION: UNA monomer
<220> FEATURE:
<221> NAME/KEY: modified_base
<222> LOCATION: (4260)..(4260)
<223> OTHER INFORMATION: UNA monomer
<220> FEATURE:
<221> NAME/KEY: modified_base
<222> LOCATION: (4263)..(4263)
<223> OTHER INFORMATION: UNA monomer
<220> FEATURE:
<221> NAME/KEY: modified_base
<222> LOCATION: (4265)..(4265)
<223> OTHER INFORMATION: UNA monomer
<220> FEATURE:
<221> NAME/KEY: modified_base
<222> LOCATION: (4268)..(4270)
<223> OTHER INFORMATION: UNA monomer
<220> FEATURE:
<221> NAME/KEY: modified_base
<222> LOCATION: (4273)..(4273)
<223> OTHER INFORMATION: UNA monomer
<220> FEATURE:
<221> NAME/KEY: modified_base
<222> LOCATION: (4275)..(4275)
<223> OTHER INFORMATION: UNA monomer
<220> FEATURE:
<221> NAME/KEY: modified_base
<222> LOCATION: (4280)..(4282)
<223> OTHER INFORMATION: UNA monomer
<220> FEATURE:
<221> NAME/KEY: modified_base
<222> LOCATION: (4284)..(4284)
<223> OTHER INFORMATION: UNA monomer
<220> FEATURE:
<221> NAME/KEY: modified_base
<222> LOCATION: (4290)..(4290)
<223> OTHER INFORMATION: UNA monomer
<220> FEATURE:
<221> NAME/KEY: modified_base
<222> LOCATION: (4294)..(4295)
<223> OTHER INFORMATION: UNA monomer
<220> FEATURE:
<221> NAME/KEY: modified_base
<222> LOCATION: (4302)..(4302)
<223> OTHER INFORMATION: UNA monomer
<220> FEATURE:
<221> NAME/KEY: modified_base
<222> LOCATION: (4309)..(4309)
<223> OTHER INFORMATION: UNA monomer
<220> FEATURE:

<221> NAME/KEY: modified_base
<222> LOCATION: (4314)..(4314)
<223> OTHER INFORMATION: UNA monomer
<220> FEATURE:
<221> NAME/KEY: modified_base
<222> LOCATION: (4316)..(4317)
<223> OTHER INFORMATION: UNA monomer
<220> FEATURE:
<221> NAME/KEY: modified_base
<222> LOCATION: (4320)..(4320)
<223> OTHER INFORMATION: UNA monomer
<220> FEATURE:
<221> NAME/KEY: modified_base
<222> LOCATION: (4326)..(4328)
<223> OTHER INFORMATION: UNA monomer
<220> FEATURE:
<221> NAME/KEY: modified_base
<222> LOCATION: (4332)..(4333)
<223> OTHER INFORMATION: UNA monomer
<220> FEATURE:
<221> NAME/KEY: modified_base
<222> LOCATION: (4335)..(4335)
<223> OTHER INFORMATION: UNA monomer
<220> FEATURE:
<221> NAME/KEY: modified_base
<222> LOCATION: (4347)..(4347)
<223> OTHER INFORMATION: UNA monomer
<220> FEATURE:
<221> NAME/KEY: modified_base
<222> LOCATION: (4351)..(4351)
<223> OTHER INFORMATION: UNA monomer
<220> FEATURE:
<221> NAME/KEY: modified_base
<222> LOCATION: (4355)..(4355)
<223> OTHER INFORMATION: UNA monomer
<220> FEATURE:
<221> NAME/KEY: modified_base
<222> LOCATION: (4357)..(4357)
<223> OTHER INFORMATION: UNA monomer
<220> FEATURE:
<221> NAME/KEY: modified_base
<222> LOCATION: (4362)..(4362)
<223> OTHER INFORMATION: UNA monomer
<220> FEATURE:
<221> NAME/KEY: modified_base
<222> LOCATION: (4364)..(4365)
<223> OTHER INFORMATION: UNA monomer
<220> FEATURE:
<221> NAME/KEY: modified_base
<222> LOCATION: (4369)..(4369)
<223> OTHER INFORMATION: UNA monomer
<220> FEATURE:
<221> NAME/KEY: modified_base
<222> LOCATION: (4371)..(4374)
<223> OTHER INFORMATION: UNA monomer
<220> FEATURE:
<221> NAME/KEY: modified_base
<222> LOCATION: (4376)..(4377)
<223> OTHER INFORMATION: UNA monomer
<220> FEATURE:
<221> NAME/KEY: modified_base
<222> LOCATION: (4380)..(4380)
<223> OTHER INFORMATION: UNA monomer
<220> FEATURE:
<221> NAME/KEY: modified_base
<222> LOCATION: (4387)..(4388)
<223> OTHER INFORMATION: UNA monomer
<220> FEATURE:
<221> NAME/KEY: modified_base
<222> LOCATION: (4390)..(4390)
<223> OTHER INFORMATION: UNA monomer
<220> FEATURE:
<221> NAME/KEY: modified_base
<222> LOCATION: (4392)..(4396)
<223> OTHER INFORMATION: UNA monomer
<220> FEATURE:
<221> NAME/KEY: modified_base
<222> LOCATION: (4402)..(4403)
<223> OTHER INFORMATION: UNA monomer <220> FEATURE:
<221> NAME/KEY: modified_base
<222> LOCATION: (4406)..(4406)
<223> OTHER INFORMATION: UNA monomer
<220> FEATURE:
<221> NAME/KEY: modified_base
<222> LOCATION: (4419)..(4419)
<223> OTHER INFORMATION: UNA monomer
<220> FEATURE:
<221> NAME/KEY: modified_base
<222> LOCATION: (4422)..(4422)
<223> OTHER INFORMATION: UNA monomer
<220> FEATURE:
<221> NAME/KEY: modified_base
<222> LOCATION: (4431)..(4431)
<223> OTHER INFORMATION: UNA monomer
<220> FEATURE:
<221> NAME/KEY: modified_base
<222> LOCATION: (4433)..(4433)
<223> OTHER INFORMATION: UNA monomer
<220> FEATURE:
<221> NAME/KEY: modified_base
<222> LOCATION: (4436)..(4439)
<223> OTHER INFORMATION: UNA monomer
<220> FEATURE:
<221> NAME/KEY: modified_base
<222> LOCATION: (4442)..(4443)
<223> OTHER INFORMATION: UNA monomer
<220> FEATURE:
<221> NAME/KEY: modified_base
<222> LOCATION: (4449)..(4449)
<223> OTHER INFORMATION: UNA monomer
<220> FEATURE:
<221> NAME/KEY: modified_base
<222> LOCATION: (4451)..(4452)
<223> OTHER INFORMATION: UNA monomer
<220> FEATURE:
<221> NAME/KEY: modified_base
<222> LOCATION: (4454)..(4456)
<223> OTHER INFORMATION: UNA monomer
<220> FEATURE:
<221> NAME/KEY: modified_base
<222> LOCATION: (4464)..(4465)
<223> OTHER INFORMATION: UNA monomer
<220> FEATURE:
<221> NAME/KEY: modified_base
<222> LOCATION: (4467)..(4467)
<223> OTHER INFORMATION: UNA monomer
<220> FEATURE:
<221> NAME/KEY: modified_base
<222> LOCATION: (4469)..(4470)
<223> OTHER INFORMATION: UNA monomer
<220> FEATURE:
<221> NAME/KEY: modified_base
<222> LOCATION: (4473)..(4473)
<223> OTHER INFORMATION: UNA monomer
<220> FEATURE:
<221> NAME/KEY: modified_base
<222> LOCATION: (4475)..(4476)
<223> OTHER INFORMATION: UNA monomer
<220> FEATURE:
<221> NAME/KEY: modified_base
<222> LOCATION: (4483)..(4483)
<223> OTHER INFORMATION: UNA monomer
<220> FEATURE:
<221> NAME/KEY: modified_base
<222> LOCATION: (4488)..(4489)
<223> OTHER INFORMATION: UNA monomer
<220> FEATURE:
<221> NAME/KEY: modified_base
<222> LOCATION: (4499)..(4500)
<223> OTHER INFORMATION: UNA monomer
<220> FEATURE:
<221> NAME/KEY: modified_base
<222> LOCATION: (4508)..(4508)
<223> OTHER INFORMATION: UNA monomer
<220> FEATURE:
<221> NAME/KEY: modified_base
<222> LOCATION: (4515)..(4515)

<223> OTHER INFORMATION: UNA monomer
<220> FEATURE:
<221> NAME/KEY: modified_base
<222> LOCATION: (4521)..(4521)
<223> OTHER INFORMATION: UNA monomer
<220> FEATURE:
<221> NAME/KEY: modified_base
<222> LOCATION: (4528)..(4528)
<223> OTHER INFORMATION: UNA monomer
<220> FEATURE:
<221> NAME/KEY: modified_base
<222> LOCATION: (4531)..(4531)
<223> OTHER INFORMATION: UNA monomer
<220> FEATURE:
<221> NAME/KEY: modified_base
<222> LOCATION: (4533)..(4533)
<223> OTHER INFORMATION: UNA monomer
<220> FEATURE:
<221> NAME/KEY: modified_base
<222> LOCATION: (4536)..(4538)
<223> OTHER INFORMATION: UNA monomer
<220> FEATURE:
<221> NAME/KEY: modified_base
<222> LOCATION: (4543)..(4543)
<223> OTHER INFORMATION: UNA monomer
<220> FEATURE:
<221> NAME/KEY: modified_base
<222> LOCATION: (4545)..(4545)
<223> OTHER INFORMATION: UNA monomer
<220> FEATURE:
<221> NAME/KEY: modified_base
<222> LOCATION: (4558)..(4558)
<223> OTHER INFORMATION: UNA monomer
<220> FEATURE:
<221> NAME/KEY: modified_base
<222> LOCATION: (4561)..(4561)
<223> OTHER INFORMATION: UNA monomer
<220> FEATURE:
<221> NAME/KEY: modified_base
<222> LOCATION: (4565)..(4566)
<223> OTHER INFORMATION: UNA monomer
<220> FEATURE:
<221> NAME/KEY: modified_base
<222> LOCATION: (4569)..(4569)
<223> OTHER INFORMATION: UNA monomer
<220> FEATURE:
<221> NAME/KEY: modified_base
<222> LOCATION: (4572)..(4572)
<223> OTHER INFORMATION: UNA monomer
<220> FEATURE:
<221> NAME/KEY: modified_base
<222> LOCATION: (4574)..(4575)
<223> OTHER INFORMATION: UNA monomer
<220> FEATURE:
<221> NAME/KEY: modified_base
<222> LOCATION: (4577)..(4578)
<223> OTHER INFORMATION: UNA monomer
<220> FEATURE:
<221> NAME/KEY: modified_base
<222> LOCATION: (4586)..(4588)
<223> OTHER INFORMATION: UNA monomer
<220> FEATURE:
<221> NAME/KEY: modified_base
<222> LOCATION: (4590)..(4590)
<223> OTHER INFORMATION: UNA monomer
<220> FEATURE:
<221> NAME/KEY: modified_base
<222> LOCATION: (4593)..(4595)
<223> OTHER INFORMATION: UNA monomer
<220> FEATURE:
<221> NAME/KEY: modified_base
<222> LOCATION: (4597)..(4597)
<223> OTHER INFORMATION: UNA monomer

<400> SEQUENCE: 151 augggacaca guaaacagau ucgaauuuua cuucugaacg aaauggagaa acuggaaaag 60 acccucuuca gacuugaaca aggguaugag cuacaguucc gauuaggccc aacuuuacag 120

```
ggaaaagcag uuaccgugua uacaaauuac ccauuuccug gagaaacauu uaauagagaa    180
aaauuccguu cucuggauug ggaaaaucca acagaaagag aagaugauuc ugauaaauac    240
uguaaacuua aucugcaaca aucugguuca uuucaguauu auuuccuuca aggaaaugag    300
aaaaguggug gagguuacau aguuguggac cccauuuuac guguuggugc ugauaaucau    360
gugcuacccu uggacugugu uacucuucag acauuuuuag cuaaguguuu gggaccuuuu    420
gaugaauggg aaagcagacu uaggguugca aaagaaucag gcuacaacau gauucauuuu    480
accccauugc agacucuugg acuaucuagg ucaugcuacu cccuugccaa ucaguuagaa    540
uuaaauccug acuuuucaag accuaauaga aaguauaccu ggaaugaugu uggacagcua    600
guggaaaaau uaaaaaagga auggaauguu auuuguauua cugauguugu cuacaaucau    660
acugcugcua auaguaaaug gauccaggaa cauccagaau gugccuauaa ucuugugaau    720
ucuccacacu uaaaaccugc cugggucuua gacagagcac uuuggcguuu cuccugugau    780
guugcagaag ggaaauacaa agaaaaggga auaccugcuu ugauugaaaa ugaucaccau    840
augaauucca uccgaaaaau aauuugggag gauauuuuuc caaagcuuaa acucugggaa    900
uuuuuccaag uagaugucaa caaagcgguu gagcaauuua gaagacuucu uacacaagaa    960
aauaggcgag uaaccaaguc ugauccaaac caacaccuua cgauuauuca agauccugaa   1020
uacagacggu uuggcuguac uguagauaug aacauugcac uaacgacuuu cauaccacau   1080
gacaaggggc cagcagcaau ugaagaaugc uguaauuggu uucauaaaag aauggaggaa   1140
uuaaauucag agaagcaucg acucauuaac uaucaucagg aacaggcagu uaauugccuu   1200
uugggaaaug uguuuuauga acgacuggcu ggccaugguc caaaacuagg accugucacu   1260
agaaagcauc cuuuaguuac cagguauuuu acuuucccau uugaagagau agacuucucc   1320
auggaagaau cuaugauuca ucugccaaau aaagcuuguu uucugauggc acacaaugga   1380
uggguaaugg gagaugaucc ucuucgaaac uuugcugaac cggguucaga aguuuaccua   1440
aggagagaac uuauuugcug gggagacagu guuaaauuac gcuaugggaa uaaaccagag   1500
gacuguccuu aucucugggc acacaugaaa aaauacacug aaauaacugc aacuuauuuc   1560
cagggaguac gucuugauaa cugccacuca acaccucuuc acguagcuga guacauguug   1620
gaugcugcua ggaauuugca acccaauuua uauguaguag cugaacuguu cacaggaagu   1680
gaagaucugg acaaugucuu uguuacuaga cugggcauua guuccuuaau aagagaggca   1740
augagugcau auaauaguca ugaagagggc agauuaguuu accgauaugg aggagaaccu   1800
guuggauccu uuguucagcc cuguuugagg ccuuuaaugc cagcuauugc acaugcccug   1860
uuuauggaua uuacgcauga uaaugagugu ccuauugugc auagaucagc guaugaugcu   1920
cuuccaagua cuacaauugu uucuauggca uguugugcua guggaaguac aagaggcuau   1980
gaugaauuag ugccucauca gauuucagug guuucugaag aacgguuuua cacuaagugg   2040
aauccugaag cauugccuuc aaacacaggu gaaguuaauu uccaaagcgg cauuauugca   2100
gccaggugug cuaucaguaa acuucaucag gagcuuggag ccaaggguuu uauucaggug   2160
uauguggauc aaguugauga agacauagug gcaguaacaa gacacucacc uagcauccau   2220
cagucuguug uggcuguauc uagaacugcu uucaggaauc ccaagacuuc auuuuacagc   2280
aaggaagugc cucaaaugug caucccuggc aaaauugaag aaguaguucu ugaagcuaga   2340
acuauugaga gaaacacgaa accuuauagg aaggaugaga auucaaucaa uggaacacca   2400
gauaucacag uagaaauuag agaacauauu cagcuuaaug aaaguaaaau uguuaaacaa   2460
```

```
gcuggaguug ccacaaaagg gcccaaugaa uauauucaag aaauagaauu ugaaaacuug   2520
ucuccaggaa guguuauuau auucagaguu agucuugauc cacaugcaca agucgcuguu   2580
ggaauucuuc gaaaucaucu gacacaauuc aguccucacu uuaaaucugg cagccuagcu   2640
guugacaaug cagauccuau auuaaaaauu ccuuuugcuu cucuugccuc cagauuaacu   2700
uuggcugagc uaaaucagau ccuuuaccga ugugaaucag aagaaaagga agauggugga   2760
gggugcuaug acauaccaaa cuggucagcc cuuaaauaug caggucuuca agguuuaaug   2820
ucuguauugg cagaaauaag accaaagaau gacuuggggc auccuuuuug uaauaauuug   2880
agaucuggag auuggaugau ugacuauguc aguaaccggc uuauuucacg aucaggaacu   2940
auugcugaag uugguaaaug guugcaggcu auguucuucu accugaagca gaucccacgu   3000
uaccuuaucc cauguuacuu ugaugcuaua uuaauuggug cauauaccac ucuucuggau   3060
acagcaugga agcagauguc aagcuuuguu cagaaugguu caaccuuugu gaaacaccuu   3120
ucauuggguu caguucaacu guguggagua ggaaaauucc cuucccugcc aauucuuuca   3180
ccugcccuaa uggauguacc uuauagguua aaugagauca caaaagaaaa ggagcaaugu   3240
uguguuucuc uagcugcagg cuuaccucau uuuucuucug guauuuuccg cugcugggga   3300
agggauacuu uuauugcacu uagagguaua cugcugauua cuggacgcua uguagaagcc   3360
aggaauauua uuuuagcauu ugcggguacc cugaggcaug gucucauucc uaaucuacug   3420
ggugaaggaa uuuaugccag auacaauugu cgggaugcug uguggugggug gcugcagugu   3480
auccaggauu acuguaaaau gguuccaaau ggucuagaca uucucaagug cccaguuucc   3540
agaauguauc cuacagauga uucugcuccu uugccugcug gcacacugga ucagccauug   3600
uuugaaguca uacaggaagc aaugcaaaaa cacaugcagg gcauacaguu ccgagaaagg   3660
aaugcugguc cccagauaga ucgaaacaug aaggacgaag guuuuaauau aacugcagga   3720
guugaugaag aaacaggauu uguuuaugga ggaaaucguu ucaauugugg cacauggaug   3780
gauaaaaugg gagaaaguga cagagcuaga aacagaggaa ucccagccac accaagagau   3840
gggucugcug uggaaauugu gggccugagu aaaucugcug uucgcugguu gcuggaauua   3900
uccaaaaaaa auauuuuccc uuaucaugaa gucacaguaa aaagacaugg aaaggcuaua   3960
aaggucucau augaugagug gaacagaaaa auacaagaca acuuugaaaa gcuauuucau   4020
guuuccgaag acccuucaga uuuaaaugaa aagcauccaa aucugguuca caaacguggc   4080
auauacaaag auaguuaugg agcuucaagu ccuuggugug acuaucagcu caggccuaau   4140
uuuaccauag caaugguugu ggccccugag cucuuuacua cagaaaaagc auggaaagcu   4200
uuggagauug cagaaaaaaa auugcuuggu ccccuuggca ugaaaacuuu agauccagau   4260
gauaugguuu acuguggaau uuaugacaau gcauuagaca augacaacua caaucuugcu   4320
aaagguuuca auuaucacca aggaccugag uggcuguggc cuauugggua uuuucuucgu   4380
gcaaaauuau auuuuuccag auugaugggc ccggagacua cugcaaagac uauaguuuug   4440
guuaaaaaug uucuuucccg acauuauguu caucuugaga gaucccuug gaaaggacuu   4500
ccagaacuga ccaaugagaa ugcccaguac uguccuuuca gcugugaaac acaagccugg   4560
ucaauugcua cuauucuuga gacacuuuau gauuuauag                          4599
```

<210> SEQ ID NO 152
<211> LENGTH: 2128
<212> TYPE: RNA
<213> ORGANISM: Artificial Sequence
<220> FEATURE:
<223> OTHER INFORMATION: Description of Artificial Sequence: Synthetic

```
      polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (2125)..(2127)
<223> OTHER INFORMATION: UNA monomer

<400> SEQUENCE: 152

augagggucc ugggugggcg cugcggggcg cugcuggcgu gucuccuccu agugcuuccc      60

gucucagagg caaacuuuug uuuauauuuu agaaaugauu uuauauacaa ccgugcaugc     120

auuucuguau uggucggcuu aucuggaugc aauuuuuucu auucuauaug cuuuuuguca     180

aagcaacagg cuucacaagu ccugguuagg aagcgucgug caaauucuuu acuugaagaa     240

accaaacagg guaaucuuga aagagaaugc aucgaagaac ugugcaauaa agaagaagcc     300

agggaggucu uugaaaauga cccggaaacg gauuauuuuu auccaaaaua cuuaguuugu     360

cuucgcucuu uucaaacugg guuauucacu gcugcacguc agucaacuaa ugcuuauccu     420

gaccuaagaa gcugugucaa ugccauucca gaccagugua guccucugcc augcaaugaa     480

gauggauaua ugagcugcaa agauggaaaa gcuucuuuua cuugcacuug uaaaccaggu     540

uggcaaggag aaaaguguga auuugacaua aaugaaugca aagaucccuc aaauauaaau     600

ggagguugca gucaaauuug ugauaauaca ccuggaaguu accacuguuc cuguaaaaau     660

gguuuuguua ugcuuucaaa uaagaaagau uguaaagaug uggaugaaug cucuuugaag     720

ccaagcauuu guggcacagc ugugugcaag aacaucccag gagauuuuga augugaaugc     780

cccgaaggcu acagauauaa ucucaaauca aagucuugug aagauauaga ugaaugcucu     840

gagaacaugu gugcucagcu uugugucaau uacccuggag guuacacuug cuauugugau     900

gggaagaaag gauucaaacu ugcccaagau cagaagaguu gugagguugu uucagugugc     960

cuucccuuga accuugacac aaaguaugaa uuacuuuacu uggcggagca guuugcaggg    1020

guuguuuuau auuuaaaauu ucguuugcca gaaaucagca gauuuucagc agaauuugau    1080

uuccggacau augauucaga aggcgugaua cuguacgcag aaucuaucga ucacucagcg    1140

uggcuccuga uugcacuucg ugguggaaag auugaaguuc agcuuaagaa ugaacauaca    1200

uccaaaauca caacuggagg ugauguuauu aauaaugguc uauggaauau ggugucugug    1260

gaagaauuag aacauaguau uagcauuaaa auagcuaaag aagcugugau ggauauaaau    1320

aaaccuggac cccuuuuuaa gccggaaaau ggauugcugg aaaccaaagu auacuuugca    1380

ggauucccuc ggaaagugga aagugaacuc auuaaaccga uuaacccucg ucuagaugga    1440

uguauacgaa gcuggaauuu gaugaagcaa ggagcuucug gaauaaagga aauuauucaa    1500

gaaaaacaaa auaagcauug ccugguuacu guggagaagg gcuccuacua uccugguucu    1560

ggaauugcuc aauuucacau agauuauaau aauguaucca gugcugaggg uuggcaugua    1620

aaugugaccu ugaauauucg uccauccacg ggcacuggug uuaugcuugc cuugguuucu    1680

gguaacaaca cagugcccuu ugcugugucc uugguggacu ccaccucuga aaaaucacag    1740

gauauucugu uaucuguuga aaauacugua auauaucgga uacaggcccu aagucuaugu    1800

uccgaucaac aaucucaucu ggaauuuaga gucaacagaa acaaucugga guugucgaca    1860

ccacuuaaaa uagaaaccau cucccaugaa gaccuucaaa gacaacuugc cgucuuggac    1920

aaagcaauga aagcaaaagu ggccacauac cugggugggcc uuccagaugu uccauucagu    1980

gccacaccag ugaaugccuu uuauaauggc ugcauggaag ugaauauuaa ugguguacag    2040
```

uuggaucugg augaagccau uucuaaacau aaugauauua gagcucacuc auguccauca 2100 guuuggaaaa agacaaagaa uucuuuaa 2128

<210> SEQ ID NO 153
<211> LENGTH: 2127
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (8)..(8)
<223> OTHER INFORMATION: UNA monomer
<220> FEATURE:
<221> NAME/KEY: modified_base
<222> LOCATION: (11)..(11)
<223> OTHER INFORMATION: UNA monomer
<220> FEATURE:
<221> NAME/KEY: modified_base
<222> LOCATION: (15)..(15)
<223> OTHER INFORMATION: UNA monomer
<220> FEATURE:
<221> NAME/KEY: modified_base
<222> LOCATION: (22)..(22)
<223> OTHER INFORMATION: UNA monomer
<220> FEATURE:
<221> NAME/KEY: modified_base
<222> LOCATION: (32)..(32)
<223> OTHER INFORMATION: UNA monomer
<220> FEATURE:
<221> NAME/KEY: modified_base
<222> LOCATION: (35)..(35)
<223> OTHER INFORMATION: UNA monomer
<220> FEATURE:
<221> NAME/KEY: modified_base
<222> LOCATION: (40)..(40)
<223> OTHER INFORMATION: UNA monomer
<220> FEATURE:
<221> NAME/KEY: modified_base
<222> LOCATION: (42)..(42)
<223> OTHER INFORMATION: UNA monomer
<220> FEATURE:
<221> NAME/KEY: modified_base
<222> LOCATION: (44)..(44)
<223> OTHER INFORMATION: UNA monomer
<220> FEATURE:
<221> NAME/KEY: modified_base
<222> LOCATION: (47)..(47)
<223> OTHER INFORMATION: UNA monomer
<220> FEATURE:
<221> NAME/KEY: modified_base
<222> LOCATION: (50)..(50)
<223> OTHER INFORMATION: UNA monomer
<220> FEATURE:
<221> NAME/KEY: modified_base
<222> LOCATION: (53)..(53)
<223> OTHER INFORMATION: UNA monomer
<220> FEATURE:
<221> NAME/KEY: modified_base
<222> LOCATION: (56)..(57)
<223> OTHER INFORMATION: UNA monomer
<220> FEATURE:
<221> NAME/KEY: modified_base
<222> LOCATION: (62)..(62)
<223> OTHER INFORMATION: UNA monomer
<220> FEATURE:
<221> NAME/KEY: modified_base
<222> LOCATION: (64)..(64)
<223> OTHER INFORMATION: UNA monomer
<220> FEATURE:
<221> NAME/KEY: modified_base <222> LOCATION: (76)..(79)
<223> OTHER INFORMATION: UNA monomer
<220> FEATURE:
<221> NAME/KEY: modified_base
<222> LOCATION: (81)..(83)
<223> OTHER INFORMATION: UNA monomer
<220> FEATURE:
<221> NAME/KEY: modified_base
<222> LOCATION: (85)..(85)
<223> OTHER INFORMATION: UNA monomer
<220> FEATURE:
<221> NAME/KEY: modified_base
<222> LOCATION: (87)..(90)
<223> OTHER INFORMATION: UNA monomer
<220> FEATURE:
<221> NAME/KEY: modified_base
<222> LOCATION: (96)..(96)
<223> OTHER INFORMATION: UNA monomer
<220> FEATURE:
<221> NAME/KEY: modified_base
<222> LOCATION: (99)..(102)
<223> OTHER INFORMATION: UNA monomer
<220> FEATURE:
<221> NAME/KEY: modified_base
<222> LOCATION: (104)..(104)
<223> OTHER INFORMATION: UNA monomer
<220> FEATURE:
<221> NAME/KEY: modified_base
<222> LOCATION: (106)..(106)
<223> OTHER INFORMATION: UNA monomer
<220> FEATURE:
<221> NAME/KEY: modified_base
<222> LOCATION: (114)..(114)
<223> OTHER INFORMATION: UNA monomer
<220> FEATURE:
<221> NAME/KEY: modified_base
<222> LOCATION: (118)..(118)
<223> OTHER INFORMATION: UNA monomer
<220> FEATURE:
<221> NAME/KEY: modified_base
<222> LOCATION: (122)..(124)
<223> OTHER INFORMATION: UNA monomer
<220> FEATURE:
<221> NAME/KEY: modified_base
<222> LOCATION: (126)..(126)
<223> OTHER INFORMATION: UNA monomer
<220> FEATURE:
<221> NAME/KEY: modified_base
<222> LOCATION: (128)..(128)
<223> OTHER INFORMATION: UNA monomer
<220> FEATURE:
<221> NAME/KEY: modified_base
<222> LOCATION: (130)..(131)
<223> OTHER INFORMATION: UNA monomer
<220> FEATURE:
<221> NAME/KEY: modified_base
<222> LOCATION: (134)..(134)
<223> OTHER INFORMATION: UNA monomer
<220> FEATURE:
<221> NAME/KEY: modified_base
<222> LOCATION: (139)..(140)
<223> OTHER INFORMATION: UNA monomer
<220> FEATURE:
<221> NAME/KEY: modified_base
<222> LOCATION: (142)..(142)
<223> OTHER INFORMATION: UNA monomer
<220> FEATURE:
<221> NAME/KEY: modified_base
<222> LOCATION: (144)..(144)
<223> OTHER INFORMATION: UNA monomer
<220> FEATURE:
<221> NAME/KEY: modified_base
<222> LOCATION: (148)..(148)
<223> OTHER INFORMATION: UNA monomer
<220> FEATURE:
<221> NAME/KEY: modified_base
<222> LOCATION: (153)..(158)
<223> OTHER INFORMATION: UNA monomer
<220> FEATURE:

<221> NAME/KEY: modified_base
<222> LOCATION: (160)..(160)
<223> OTHER INFORMATION: UNA monomer
<220> FEATURE:
<221> NAME/KEY: modified_base
<222> LOCATION: (162)..(163)
<223> OTHER INFORMATION: UNA monomer
<220> FEATURE:
<221> NAME/KEY: modified_base
<222> LOCATION: (165)..(165)
<223> OTHER INFORMATION: UNA monomer
<220> FEATURE:
<221> NAME/KEY: modified_base
<222> LOCATION: (167)..(167)
<223> OTHER INFORMATION: UNA monomer
<220> FEATURE:
<221> NAME/KEY: modified_base
<222> LOCATION: (169)..(169)
<223> OTHER INFORMATION: UNA monomer
<220> FEATURE:
<221> NAME/KEY: modified_base
<222> LOCATION: (172)..(176)
<223> OTHER INFORMATION: UNA monomer
<220> FEATURE:
<221> NAME/KEY: modified_base
<222> LOCATION: (178)..(178)
<223> OTHER INFORMATION: UNA monomer
<220> FEATURE:
<221> NAME/KEY: modified_base
<222> LOCATION: (192)..(193)
<223> OTHER INFORMATION: UNA monomer
<220> FEATURE:
<221> NAME/KEY: modified_base
<222> LOCATION: (200)..(200)
<223> OTHER INFORMATION: UNA monomer
<220> FEATURE:
<221> NAME/KEY: modified_base
<222> LOCATION: (203)..(203)
<223> OTHER INFORMATION: UNA monomer
<220> FEATURE:
<221> NAME/KEY: modified_base
<222> LOCATION: (206)..(207)
<223> OTHER INFORMATION: UNA monomer
<220> FEATURE:
<221> NAME/KEY: modified_base
<222> LOCATION: (216)..(216)
<223> OTHER INFORMATION: UNA monomer
<220> FEATURE:
<221> NAME/KEY: modified_base
<222> LOCATION: (219)..(219)
<223> OTHER INFORMATION: UNA monomer
<220> FEATURE:
<221> NAME/KEY: modified_base
<222> LOCATION: (225)..(226)
<223> OTHER INFORMATION: UNA monomer
<220> FEATURE:
<221> NAME/KEY: modified_base
<222> LOCATION: (228)..(230)
<223> OTHER INFORMATION: UNA monomer
<220> FEATURE:
<221> NAME/KEY: modified_base
<222> LOCATION: (233)..(234)
<223> OTHER INFORMATION: UNA monomer
<220> FEATURE:
<221> NAME/KEY: modified_base
<222> LOCATION: (252)..(252)
<223> OTHER INFORMATION: UNA monomer
<220> FEATURE:
<221> NAME/KEY: modified_base
<222> LOCATION: (255)..(255)
<223> OTHER INFORMATION: UNA monomer
<220> FEATURE:
<221> NAME/KEY: modified_base
<222> LOCATION: (257)..(258)
<223> OTHER INFORMATION: UNA monomer
<220> FEATURE:
<221> NAME/KEY: modified_base
<222> LOCATION: (268)..(268)
<223> OTHER INFORMATION: UNA monomer <220> FEATURE:
<221> NAME/KEY: modified_base
<222> LOCATION: (272)..(272)
<223> OTHER INFORMATION: UNA monomer
<220> FEATURE:
<221> NAME/KEY: modified_base
<222> LOCATION: (281)..(281)
<223> OTHER INFORMATION: UNA monomer
<220> FEATURE:
<221> NAME/KEY: modified_base
<222> LOCATION: (283)..(283)
<223> OTHER INFORMATION: UNA monomer
<220> FEATURE:
<221> NAME/KEY: modified_base
<222> LOCATION: (288)..(288)
<223> OTHER INFORMATION: UNA monomer
<220> FEATURE:
<221> NAME/KEY: modified_base
<222> LOCATION: (308)..(308)
<223> OTHER INFORMATION: UNA monomer
<220> FEATURE:
<221> NAME/KEY: modified_base
<222> LOCATION: (310)..(312)
<223> OTHER INFORMATION: UNA monomer
<220> FEATURE:
<221> NAME/KEY: modified_base
<222> LOCATION: (318)..(318)
<223> OTHER INFORMATION: UNA monomer
<220> FEATURE:
<221> NAME/KEY: modified_base
<222> LOCATION: (333)..(334)
<223> OTHER INFORMATION: UNA monomer
<220> FEATURE:
<221> NAME/KEY: modified_base
<222> LOCATION: (336)..(340)
<223> OTHER INFORMATION: UNA monomer
<220> FEATURE:
<221> NAME/KEY: modified_base
<222> LOCATION: (342)..(342)
<223> OTHER INFORMATION: UNA monomer
<220> FEATURE:
<221> NAME/KEY: modified_base
<222> LOCATION: (349)..(349)
<223> OTHER INFORMATION: UNA monomer
<220> FEATURE:
<221> NAME/KEY: modified_base
<222> LOCATION: (352)..(353)
<223> OTHER INFORMATION: UNA monomer
<220> FEATURE:
<221> NAME/KEY: modified_base
<222> LOCATION: (356)..(358)
<223> OTHER INFORMATION: UNA monomer
<220> FEATURE:
<221> NAME/KEY: modified_base
<222> LOCATION: (360)..(360)
<223> OTHER INFORMATION: UNA monomer
<220> FEATURE:
<221> NAME/KEY: modified_base
<222> LOCATION: (362)..(363)
<223> OTHER INFORMATION: UNA monomer
<220> FEATURE:
<221> NAME/KEY: modified_base
<222> LOCATION: (367)..(367)
<223> OTHER INFORMATION: UNA monomer
<220> FEATURE:
<221> NAME/KEY: modified_base
<222> LOCATION: (369)..(372)
<223> OTHER INFORMATION: UNA monomer
<220> FEATURE:
<221> NAME/KEY: modified_base
<222> LOCATION: (378)..(378)
<223> OTHER INFORMATION: UNA monomer
<220> FEATURE:
<221> NAME/KEY: modified_base
<222> LOCATION: (382)..(383)
<223> OTHER INFORMATION: UNA monomer
<220> FEATURE:
<221> NAME/KEY: modified_base
<222> LOCATION: (385)..(386)

<223> OTHER INFORMATION: UNA monomer
<220> FEATURE:
<221> NAME/KEY: modified_base
<222> LOCATION: (390)..(390)
<223> OTHER INFORMATION: UNA monomer
<220> FEATURE:
<221> NAME/KEY: modified_base
<222> LOCATION: (393)..(393)
<223> OTHER INFORMATION: UNA monomer
<220> FEATURE:
<221> NAME/KEY: modified_base
<222> LOCATION: (399)..(399)
<223> OTHER INFORMATION: UNA monomer
<220> FEATURE:
<221> NAME/KEY: modified_base
<222> LOCATION: (403)..(403)
<223> OTHER INFORMATION: UNA monomer
<220> FEATURE:
<221> NAME/KEY: modified_base
<222> LOCATION: (408)..(408)
<223> OTHER INFORMATION: UNA monomer
<220> FEATURE:
<221> NAME/KEY: modified_base
<222> LOCATION: (411)..(411)
<223> OTHER INFORMATION: UNA monomer
<220> FEATURE:
<221> NAME/KEY: modified_base
<222> LOCATION: (414)..(415)
<223> OTHER INFORMATION: UNA monomer
<220> FEATURE:
<221> NAME/KEY: modified_base
<222> LOCATION: (417)..(417)
<223> OTHER INFORMATION: UNA monomer
<220> FEATURE:
<221> NAME/KEY: modified_base
<222> LOCATION: (420)..(420)
<223> OTHER INFORMATION: UNA monomer
<220> FEATURE:
<221> NAME/KEY: modified_base
<222> LOCATION: (425)..(425)
<223> OTHER INFORMATION: UNA monomer
<220> FEATURE:
<221> NAME/KEY: modified_base
<222> LOCATION: (433)..(433)
<223> OTHER INFORMATION: UNA monomer
<220> FEATURE:
<221> NAME/KEY: modified_base
<222> LOCATION: (435)..(435)
<223> OTHER INFORMATION: UNA monomer
<220> FEATURE:
<221> NAME/KEY: modified_base
<222> LOCATION: (437)..(437)
<223> OTHER INFORMATION: UNA monomer
<220> FEATURE:
<221> NAME/KEY: modified_base
<222> LOCATION: (441)..(441)
<223> OTHER INFORMATION: UNA monomer
<220> FEATURE:
<221> NAME/KEY: modified_base
<222> LOCATION: (446)..(447)
<223> OTHER INFORMATION: UNA monomer
<220> FEATURE:
<221> NAME/KEY: modified_base
<222> LOCATION: (457)..(457)
<223> OTHER INFORMATION: UNA monomer
<220> FEATURE:
<221> NAME/KEY: modified_base
<222> LOCATION: (459)..(459)
<223> OTHER INFORMATION: UNA monomer
<220> FEATURE:
<221> NAME/KEY: modified_base
<222> LOCATION: (462)..(462)
<223> OTHER INFORMATION: UNA monomer
<220> FEATURE:
<221> NAME/KEY: modified_base
<222> LOCATION: (465)..(465)
<223> OTHER INFORMATION: UNA monomer
<220> FEATURE:
<221> NAME/KEY: modified_base <222> LOCATION: (467)..(467)
<223> OTHER INFORMATION: UNA monomer
<220> FEATURE:
<221> NAME/KEY: modified_base
<222> LOCATION: (472)..(472)
<223> OTHER INFORMATION: UNA monomer
<220> FEATURE:
<221> NAME/KEY: modified_base
<222> LOCATION: (477)..(477)
<223> OTHER INFORMATION: UNA monomer
<220> FEATURE:
<221> NAME/KEY: modified_base
<222> LOCATION: (483)..(483)
<223> OTHER INFORMATION: UNA monomer
<220> FEATURE:
<221> NAME/KEY: modified_base
<222> LOCATION: (487)..(487)
<223> OTHER INFORMATION: UNA monomer
<220> FEATURE:
<221> NAME/KEY: modified_base
<222> LOCATION: (489)..(489)
<223> OTHER INFORMATION: UNA monomer
<220> FEATURE:
<221> NAME/KEY: modified_base
<222> LOCATION: (491)..(491)
<223> OTHER INFORMATION: UNA monomer
<220> FEATURE:
<221> NAME/KEY: modified_base
<222> LOCATION: (496)..(496)
<223> OTHER INFORMATION: UNA monomer
<220> FEATURE:
<221> NAME/KEY: modified_base
<222> LOCATION: (504)..(504)
<223> OTHER INFORMATION: UNA monomer
<220> FEATURE:
<221> NAME/KEY: modified_base
<222> LOCATION: (513)..(514)
<223> OTHER INFORMATION: UNA monomer
<220> FEATURE:
<221> NAME/KEY: modified_base
<222> LOCATION: (516)..(519)
<223> OTHER INFORMATION: UNA monomer
<220> FEATURE:
<221> NAME/KEY: modified_base
<222> LOCATION: (522)..(523)
<223> OTHER INFORMATION: UNA monomer
<220> FEATURE:
<221> NAME/KEY: modified_base
<222> LOCATION: (528)..(529)
<223> OTHER INFORMATION: UNA monomer
<220> FEATURE:
<221> NAME/KEY: modified_base
<222> LOCATION: (531)..(531)
<223> OTHER INFORMATION: UNA monomer
<220> FEATURE:
<221> NAME/KEY: modified_base
<222> LOCATION: (540)..(541)
<223> OTHER INFORMATION: UNA monomer
<220> FEATURE:
<221> NAME/KEY: modified_base
<222> LOCATION: (556)..(556)
<223> OTHER INFORMATION: UNA monomer
<220> FEATURE:
<221> NAME/KEY: modified_base
<222> LOCATION: (558)..(558)
<223> OTHER INFORMATION: UNA monomer
<220> FEATURE:
<221> NAME/KEY: modified_base
<222> LOCATION: (562)..(564)
<223> OTHER INFORMATION: UNA monomer
<220> FEATURE:
<221> NAME/KEY: modified_base
<222> LOCATION: (569)..(569)
<223> OTHER INFORMATION: UNA monomer
<220> FEATURE:
<221> NAME/KEY: modified_base
<222> LOCATION: (573)..(573)
<223> OTHER INFORMATION: UNA monomer
<220> FEATURE:

<221> NAME/KEY: modified_base
<222> LOCATION: (577)..(577)
<223> OTHER INFORMATION: UNA monomer
<220> FEATURE:
<221> NAME/KEY: modified_base
<222> LOCATION: (585)..(585)
<223> OTHER INFORMATION: UNA monomer
<220> FEATURE:
<221> NAME/KEY: modified_base
<222> LOCATION: (589)..(589)
<223> OTHER INFORMATION: UNA monomer
<220> FEATURE:
<221> NAME/KEY: modified_base
<222> LOCATION: (594)..(594)
<223> OTHER INFORMATION: UNA monomer
<220> FEATURE:
<221> NAME/KEY: modified_base
<222> LOCATION: (596)..(596)
<223> OTHER INFORMATION: UNA monomer
<220> FEATURE:
<221> NAME/KEY: modified_base
<222> LOCATION: (600)..(600)
<223> OTHER INFORMATION: UNA monomer
<220> FEATURE:
<221> NAME/KEY: modified_base
<222> LOCATION: (606)..(607)
<223> OTHER INFORMATION: UNA monomer
<220> FEATURE:
<221> NAME/KEY: modified_base
<222> LOCATION: (612)..(612)
<223> OTHER INFORMATION: UNA monomer
<220> FEATURE:
<221> NAME/KEY: modified_base
<222> LOCATION: (617)..(619)
<223> OTHER INFORMATION: UNA monomer
<220> FEATURE:
<221> NAME/KEY: modified_base
<222> LOCATION: (621)..(621)
<223> OTHER INFORMATION: UNA monomer
<220> FEATURE:
<221> NAME/KEY: modified_base
<222> LOCATION: (624)..(624)
<223> OTHER INFORMATION: UNA monomer
<220> FEATURE:
<221> NAME/KEY: modified_base
<222> LOCATION: (627)..(627)
<223> OTHER INFORMATION: UNA monomer
<220> FEATURE:
<221> NAME/KEY: modified_base
<222> LOCATION: (633)..(633)
<223> OTHER INFORMATION: UNA monomer
<220> FEATURE:
<221> NAME/KEY: modified_base
<222> LOCATION: (639)..(640)
<223> OTHER INFORMATION: UNA monomer
<220> FEATURE:
<221> NAME/KEY: modified_base
<222> LOCATION: (646)..(646)
<223> OTHER INFORMATION: UNA monomer
<220> FEATURE:
<221> NAME/KEY: modified_base
<222> LOCATION: (648)..(649)
<223> OTHER INFORMATION: UNA monomer
<220> FEATURE:
<221> NAME/KEY: modified_base
<222> LOCATION: (652)..(652)
<223> OTHER INFORMATION: UNA monomer
<220> FEATURE:
<221> NAME/KEY: modified_base
<222> LOCATION: (654)..(654)
<223> OTHER INFORMATION: UNA monomer
<220> FEATURE:
<221> NAME/KEY: modified_base
<222> LOCATION: (660)..(660)
<223> OTHER INFORMATION: UNA monomer
<220> FEATURE:
<221> NAME/KEY: modified_base
<222> LOCATION: (663)..(666)
<223> OTHER INFORMATION: UNA monomer <220> FEATURE:
<221> NAME/KEY: modified_base
<222> LOCATION: (668)..(669)
<223> OTHER INFORMATION: UNA monomer
<220> FEATURE:
<221> NAME/KEY: modified_base
<222> LOCATION: (671)..(671)
<223> OTHER INFORMATION: UNA monomer
<220> FEATURE:
<221> NAME/KEY: modified_base
<222> LOCATION: (674)..(676)
<223> OTHER INFORMATION: UNA monomer
<220> FEATURE:
<221> NAME/KEY: modified_base
<222> LOCATION: (681)..(681)
<223> OTHER INFORMATION: UNA monomer
<220> FEATURE:
<221> NAME/KEY: modified_base
<222> LOCATION: (690)..(691)
<223> OTHER INFORMATION: UNA monomer
<220> FEATURE:
<221> NAME/KEY: modified_base
<222> LOCATION: (693)..(693)
<223> OTHER INFORMATION: UNA monomer
<220> FEATURE:
<221> NAME/KEY: modified_base
<222> LOCATION: (699)..(699)
<223> OTHER INFORMATION: UNA monomer
<220> FEATURE:
<221> NAME/KEY: modified_base
<222> LOCATION: (701)..(701)
<223> OTHER INFORMATION: UNA monomer
<220> FEATURE:
<221> NAME/KEY: modified_base
<222> LOCATION: (705)..(705)
<223> OTHER INFORMATION: UNA monomer
<220> FEATURE:
<221> NAME/KEY: modified_base
<222> LOCATION: (709)..(709)
<223> OTHER INFORMATION: UNA monomer
<220> FEATURE:
<221> NAME/KEY: modified_base
<222> LOCATION: (712)..(712)
<223> OTHER INFORMATION: UNA monomer
<220> FEATURE:
<221> NAME/KEY: modified_base
<222> LOCATION: (714)..(716)
<223> OTHER INFORMATION: UNA monomer
<220> FEATURE:
<221> NAME/KEY: modified_base
<222> LOCATION: (728)..(730)
<223> OTHER INFORMATION: UNA monomer
<220> FEATURE:
<221> NAME/KEY: modified_base
<222> LOCATION: (732)..(732)
<223> OTHER INFORMATION: UNA monomer
<220> FEATURE:
<221> NAME/KEY: modified_base
<222> LOCATION: (741)..(741)
<223> OTHER INFORMATION: UNA monomer
<220> FEATURE:
<221> NAME/KEY: modified_base
<222> LOCATION: (743)..(743)
<223> OTHER INFORMATION: UNA monomer
<220> FEATURE:
<221> NAME/KEY: modified_base
<222> LOCATION: (745)..(745)
<223> OTHER INFORMATION: UNA monomer
<220> FEATURE:
<221> NAME/KEY: modified_base
<222> LOCATION: (755)..(755)
<223> OTHER INFORMATION: UNA monomer
<220> FEATURE:
<221> NAME/KEY: modified_base
<222> LOCATION: (765)..(768)
<223> OTHER INFORMATION: UNA monomer
<220> FEATURE:
<221> NAME/KEY: modified_base
<222> LOCATION: (772)..(772)

<223> OTHER INFORMATION: UNA monomer
<220> FEATURE:
<221> NAME/KEY: modified_base
<222> LOCATION: (774)..(774)
<223> OTHER INFORMATION: UNA monomer
<220> FEATURE:
<221> NAME/KEY: modified_base
<222> LOCATION: (778)..(778)
<223> OTHER INFORMATION: UNA monomer
<220> FEATURE:
<221> NAME/KEY: modified_base
<222> LOCATION: (790)..(790)
<223> OTHER INFORMATION: UNA monomer
<220> FEATURE:
<221> NAME/KEY: modified_base
<222> LOCATION: (796)..(796)
<223> OTHER INFORMATION: UNA monomer
<220> FEATURE:
<221> NAME/KEY: modified_base
<222> LOCATION: (798)..(798)
<223> OTHER INFORMATION: UNA monomer
<220> FEATURE:
<221> NAME/KEY: modified_base
<222> LOCATION: (801)..(801)
<223> OTHER INFORMATION: UNA monomer
<220> FEATURE:
<221> NAME/KEY: modified_base
<222> LOCATION: (803)..(803)
<223> OTHER INFORMATION: UNA monomer
<220> FEATURE:
<221> NAME/KEY: modified_base
<222> LOCATION: (808)..(808)
<223> OTHER INFORMATION: UNA monomer
<220> FEATURE:
<221> NAME/KEY: modified_base
<222> LOCATION: (814)..(814)
<223> OTHER INFORMATION: UNA monomer
<220> FEATURE:
<221> NAME/KEY: modified_base
<222> LOCATION: (816)..(817)
<223> OTHER INFORMATION: UNA monomer
<220> FEATURE:
<221> NAME/KEY: modified_base
<222> LOCATION: (819)..(819)
<223> OTHER INFORMATION: UNA monomer
<220> FEATURE:
<221> NAME/KEY: modified_base
<222> LOCATION: (825)..(825)
<223> OTHER INFORMATION: UNA monomer
<220> FEATURE:
<221> NAME/KEY: modified_base
<222> LOCATION: (827)..(827)
<223> OTHER INFORMATION: UNA monomer
<220> FEATURE:
<221> NAME/KEY: modified_base
<222> LOCATION: (831)..(831)
<223> OTHER INFORMATION: UNA monomer
<220> FEATURE:
<221> NAME/KEY: modified_base
<222> LOCATION: (835)..(835)
<223> OTHER INFORMATION: UNA monomer
<220> FEATURE:
<221> NAME/KEY: modified_base
<222> LOCATION: (838)..(838)
<223> OTHER INFORMATION: UNA monomer
<220> FEATURE:
<221> NAME/KEY: modified_base
<222> LOCATION: (840)..(840)
<223> OTHER INFORMATION: UNA monomer
<220> FEATURE:
<221> NAME/KEY: modified_base
<222> LOCATION: (848)..(848)
<223> OTHER INFORMATION: UNA monomer
<220> FEATURE:
<221> NAME/KEY: modified_base
<222> LOCATION: (850)..(850)
<223> OTHER INFORMATION: UNA monomer
<220> FEATURE:
<221> NAME/KEY: modified_base <222> LOCATION: (852)..(852)
<223> OTHER INFORMATION: UNA monomer
<220> FEATURE:
<221> NAME/KEY: modified_base
<222> LOCATION: (855)..(855)
<223> OTHER INFORMATION: UNA monomer
<220> FEATURE:
<221> NAME/KEY: modified_base
<222> LOCATION: (860)..(862)
<223> OTHER INFORMATION: UNA monomer
<220> FEATURE:
<221> NAME/KEY: modified_base
<222> LOCATION: (864)..(864)
<223> OTHER INFORMATION: UNA monomer
<220> FEATURE:
<221> NAME/KEY: modified_base
<222> LOCATION: (866)..(866)
<223> OTHER INFORMATION: UNA monomer
<220> FEATURE:
<221> NAME/KEY: modified_base
<222> LOCATION: (870)..(871)
<223> OTHER INFORMATION: UNA monomer
<220> FEATURE:
<221> NAME/KEY: modified_base
<222> LOCATION: (876)..(876)
<223> OTHER INFORMATION: UNA monomer
<220> FEATURE:
<221> NAME/KEY: modified_base
<222> LOCATION: (882)..(883)
<223> OTHER INFORMATION: UNA monomer
<220> FEATURE:
<221> NAME/KEY: modified_base
<222> LOCATION: (888)..(889)
<223> OTHER INFORMATION: UNA monomer
<220> FEATURE:
<221> NAME/KEY: modified_base
<222> LOCATION: (892)..(892)
<223> OTHER INFORMATION: UNA monomer
<220> FEATURE:
<221> NAME/KEY: modified_base
<222> LOCATION: (894)..(895)
<223> OTHER INFORMATION: UNA monomer
<220> FEATURE:
<221> NAME/KEY: modified_base
<222> LOCATION: (897)..(897)
<223> OTHER INFORMATION: UNA monomer
<220> FEATURE:
<221> NAME/KEY: modified_base
<222> LOCATION: (900)..(900)
<223> OTHER INFORMATION: UNA monomer
<220> FEATURE:
<221> NAME/KEY: modified_base
<222> LOCATION: (913)..(914)
<223> OTHER INFORMATION: UNA monomer
<220> FEATURE:
<221> NAME/KEY: modified_base
<222> LOCATION: (920)..(921)
<223> OTHER INFORMATION: UNA monomer
<220> FEATURE:
<221> NAME/KEY: modified_base
<222> LOCATION: (930)..(930)
<223> OTHER INFORMATION: UNA monomer
<220> FEATURE:
<221> NAME/KEY: modified_base
<222> LOCATION: (939)..(940)
<223> OTHER INFORMATION: UNA monomer
<220> FEATURE:
<221> NAME/KEY: modified_base
<222> LOCATION: (942)..(942)
<223> OTHER INFORMATION: UNA monomer
<220> FEATURE:
<221> NAME/KEY: modified_base
<222> LOCATION: (947)..(948)
<223> OTHER INFORMATION: UNA monomer
<220> FEATURE:
<221> NAME/KEY: modified_base
<222> LOCATION: (950)..(952)
<223> OTHER INFORMATION: UNA monomer
<220> FEATURE:

<221> NAME/KEY: modified_base
<222> LOCATION: (956)..(956)
<223> OTHER INFORMATION: UNA monomer
<220> FEATURE:
<221> NAME/KEY: modified_base
<222> LOCATION: (958)..(958)
<223> OTHER INFORMATION: UNA monomer
<220> FEATURE:
<221> NAME/KEY: modified_base
<222> LOCATION: (962)..(963)
<223> OTHER INFORMATION: UNA monomer
<220> FEATURE:
<221> NAME/KEY: modified_base
<222> LOCATION: (967)..(968)
<223> OTHER INFORMATION: UNA monomer
<220> FEATURE:
<221> NAME/KEY: modified_base
<222> LOCATION: (974)..(975)
<223> OTHER INFORMATION: UNA monomer
<220> FEATURE:
<221> NAME/KEY: modified_base
<222> LOCATION: (985)..(985)
<223> OTHER INFORMATION: UNA monomer
<220> FEATURE:
<221> NAME/KEY: modified_base
<222> LOCATION: (987)..(987)
<223> OTHER INFORMATION: UNA monomer
<220> FEATURE:
<221> NAME/KEY: modified_base
<222> LOCATION: (991)..(992)
<223> OTHER INFORMATION: UNA monomer
<220> FEATURE:
<221> NAME/KEY: modified_base
<222> LOCATION: (995)..(997)
<223> OTHER INFORMATION: UNA monomer
<220> FEATURE:
<221> NAME/KEY: modified_base
<222> LOCATION: (1000)..(1001)
<223> OTHER INFORMATION: UNA monomer
<220> FEATURE:
<221> NAME/KEY: modified_base
<222> LOCATION: (1012)..(1014)
<223> OTHER INFORMATION: UNA monomer
<220> FEATURE:
<221> NAME/KEY: modified_base
<222> LOCATION: (1022)..(1023)
<223> OTHER INFORMATION: UNA monomer
<220> FEATURE:
<221> NAME/KEY: modified_base
<222> LOCATION: (1025)..(1028)
<223> OTHER INFORMATION: UNA monomer
<220> FEATURE:
<221> NAME/KEY: modified_base
<222> LOCATION: (1030)..(1030)
<223> OTHER INFORMATION: UNA monomer
<220> FEATURE:
<221> NAME/KEY: modified_base
<222> LOCATION: (1032)..(1034)
<223> OTHER INFORMATION: UNA monomer
<220> FEATURE:
<221> NAME/KEY: modified_base
<222> LOCATION: (1039)..(1041)
<223> OTHER INFORMATION: UNA monomer
<220> FEATURE:
<221> NAME/KEY: modified_base
<222> LOCATION: (1044)..(1046)
<223> OTHER INFORMATION: UNA monomer
<220> FEATURE:
<221> NAME/KEY: modified_base
<222> LOCATION: (1055)..(1055)
<223> OTHER INFORMATION: UNA monomer
<220> FEATURE:
<221> NAME/KEY: modified_base
<222> LOCATION: (1063)..(1066)
<223> OTHER INFORMATION: UNA monomer
<220> FEATURE:
<221> NAME/KEY: modified_base
<222> LOCATION: (1075)..(1077)
<223> OTHER INFORMATION: UNA monomer <220> FEATURE:
<221> NAME/KEY: modified_base
<222> LOCATION: (1080)..(1082)
<223> OTHER INFORMATION: UNA monomer
<220> FEATURE:
<221> NAME/KEY: modified_base
<222> LOCATION: (1090)..(1090)
<223> OTHER INFORMATION: UNA monomer
<220> FEATURE:
<221> NAME/KEY: modified_base
<222> LOCATION: (1092)..(1092)
<223> OTHER INFORMATION: UNA monomer
<220> FEATURE:
<221> NAME/KEY: modified_base
<222> LOCATION: (1095)..(1096)
<223> OTHER INFORMATION: UNA monomer
<220> FEATURE:
<221> NAME/KEY: modified_base
<222> LOCATION: (1106)..(1106)
<223> OTHER INFORMATION: UNA monomer
<220> FEATURE:
<221> NAME/KEY: modified_base
<222> LOCATION: (1109)..(1109)
<223> OTHER INFORMATION: UNA monomer
<220> FEATURE:
<221> NAME/KEY: modified_base
<222> LOCATION: (1112)..(1112)
<223> OTHER INFORMATION: UNA monomer
<220> FEATURE:
<221> NAME/KEY: modified_base
<222> LOCATION: (1114)..(1114)
<223> OTHER INFORMATION: UNA monomer
<220> FEATURE:
<221> NAME/KEY: modified_base
<222> LOCATION: (1123)..(1123)
<223> OTHER INFORMATION: UNA monomer
<220> FEATURE:
<221> NAME/KEY: modified_base
<222> LOCATION: (1125)..(1125)
<223> OTHER INFORMATION: UNA monomer
<220> FEATURE:
<221> NAME/KEY: modified_base
<222> LOCATION: (1127)..(1127)
<223> OTHER INFORMATION: UNA monomer
<220> FEATURE:
<221> NAME/KEY: modified_base
<222> LOCATION: (1131)..(1131)
<223> OTHER INFORMATION: UNA monomer
<220> FEATURE:
<221> NAME/KEY: modified_base
<222> LOCATION: (1135)..(1135)
<223> OTHER INFORMATION: UNA monomer
<220> FEATURE:
<221> NAME/KEY: modified_base
<222> LOCATION: (1141)..(1141)
<223> OTHER INFORMATION: UNA monomer
<220> FEATURE:
<221> NAME/KEY: modified_base
<222> LOCATION: (1145)..(1145)
<223> OTHER INFORMATION: UNA monomer
<220> FEATURE:
<221> NAME/KEY: modified_base
<222> LOCATION: (1148)..(1148)
<223> OTHER INFORMATION: UNA monomer
<220> FEATURE:
<221> NAME/KEY: modified_base
<222> LOCATION: (1151)..(1152)
<223> OTHER INFORMATION: UNA monomer
<220> FEATURE:
<221> NAME/KEY: modified_base
<222> LOCATION: (1157)..(1158)
<223> OTHER INFORMATION: UNA monomer
<220> FEATURE:
<221> NAME/KEY: modified_base
<222> LOCATION: (1161)..(1161)
<223> OTHER INFORMATION: UNA monomer
<220> FEATURE:
<221> NAME/KEY: modified_base
<222> LOCATION: (1164)..(1164)

<223> OTHER INFORMATION: UNA monomer
<220> FEATURE:
<221> NAME/KEY: modified_base
<222> LOCATION: (1172)..(1173)
<223> OTHER INFORMATION: UNA monomer
<220> FEATURE:
<221> NAME/KEY: modified_base
<222> LOCATION: (1178)..(1179)
<223> OTHER INFORMATION: UNA monomer
<220> FEATURE:
<221> NAME/KEY: modified_base
<222> LOCATION: (1184)..(1185)
<223> OTHER INFORMATION: UNA monomer
<220> FEATURE:
<221> NAME/KEY: modified_base
<222> LOCATION: (1191)..(1191)
<223> OTHER INFORMATION: UNA monomer
<220> FEATURE:
<221> NAME/KEY: modified_base
<222> LOCATION: (1197)..(1197)
<223> OTHER INFORMATION: UNA monomer
<220> FEATURE:
<221> NAME/KEY: modified_base
<222> LOCATION: (1201)..(1201)
<223> OTHER INFORMATION: UNA monomer
<220> FEATURE:
<221> NAME/KEY: modified_base
<222> LOCATION: (1208)..(1208)
<223> OTHER INFORMATION: UNA monomer
<220> FEATURE:
<221> NAME/KEY: modified_base
<222> LOCATION: (1215)..(1215)
<223> OTHER INFORMATION: UNA monomer
<220> FEATURE:
<221> NAME/KEY: modified_base
<222> LOCATION: (1221)..(1221)
<223> OTHER INFORMATION: UNA monomer
<220> FEATURE:
<221> NAME/KEY: modified_base
<222> LOCATION: (1224)..(1224)
<223> OTHER INFORMATION: UNA monomer
<220> FEATURE:
<221> NAME/KEY: modified_base
<222> LOCATION: (1226)..(1227)
<223> OTHER INFORMATION: UNA monomer
<220> FEATURE:
<221> NAME/KEY: modified_base
<222> LOCATION: (1229)..(1230)
<223> OTHER INFORMATION: UNA monomer
<220> FEATURE:
<221> NAME/KEY: modified_base
<222> LOCATION: (1233)..(1233)
<223> OTHER INFORMATION: UNA monomer
<220> FEATURE:
<221> NAME/KEY: modified_base
<222> LOCATION: (1236)..(1236)
<223> OTHER INFORMATION: UNA monomer
<220> FEATURE:
<221> NAME/KEY: modified_base
<222> LOCATION: (1239)..(1239)
<223> OTHER INFORMATION: UNA monomer
<220> FEATURE:
<221> NAME/KEY: modified_base
<222> LOCATION: (1241)..(1241)
<223> OTHER INFORMATION: UNA monomer
<220> FEATURE:
<221> NAME/KEY: modified_base
<222> LOCATION: (1243)..(1243)
<223> OTHER INFORMATION: UNA monomer
<220> FEATURE:
<221> NAME/KEY: modified_base
<222> LOCATION: (1248)..(1248)
<223> OTHER INFORMATION: UNA monomer
<220> FEATURE:
<221> NAME/KEY: modified_base
<222> LOCATION: (1250)..(1250)
<223> OTHER INFORMATION: UNA monomer
<220> FEATURE:
<221> NAME/KEY: modified_base <222> LOCATION: (1253)..(1253)
<223> OTHER INFORMATION: UNA monomer
<220> FEATURE:
<221> NAME/KEY: modified_base
<222> LOCATION: (1255)..(1255)
<223> OTHER INFORMATION: UNA monomer
<220> FEATURE:
<221> NAME/KEY: modified_base
<222> LOCATION: (1257)..(1257)
<223> OTHER INFORMATION: UNA monomer
<220> FEATURE:
<221> NAME/KEY: modified_base
<222> LOCATION: (1259)..(1259)
<223> OTHER INFORMATION: UNA monomer
<220> FEATURE:
<221> NAME/KEY: modified_base
<222> LOCATION: (1267)..(1268)
<223> OTHER INFORMATION: UNA monomer
<220> FEATURE:
<221> NAME/KEY: modified_base
<222> LOCATION: (1275)..(1275)
<223> OTHER INFORMATION: UNA monomer
<220> FEATURE:
<221> NAME/KEY: modified_base
<222> LOCATION: (1278)..(1278)
<223> OTHER INFORMATION: UNA monomer
<220> FEATURE:
<221> NAME/KEY: modified_base
<222> LOCATION: (1280)..(1281)
<223> OTHER INFORMATION: UNA monomer
<220> FEATURE:
<221> NAME/KEY: modified_base
<222> LOCATION: (1286)..(1287)
<223> OTHER INFORMATION: UNA monomer
<220> FEATURE:
<221> NAME/KEY: modified_base
<222> LOCATION: (1292)..(1292)
<223> OTHER INFORMATION: UNA monomer
<220> FEATURE:
<221> NAME/KEY: modified_base
<222> LOCATION: (1296)..(1296)
<223> OTHER INFORMATION: UNA monomer
<220> FEATURE:
<221> NAME/KEY: modified_base
<222> LOCATION: (1305)..(1305)
<223> OTHER INFORMATION: UNA monomer
<220> FEATURE:
<221> NAME/KEY: modified_base
<222> LOCATION: (1307)..(1307)
<223> OTHER INFORMATION: UNA monomer
<220> FEATURE:
<221> NAME/KEY: modified_base
<222> LOCATION: (1310)..(1310)
<223> OTHER INFORMATION: UNA monomer
<220> FEATURE:
<221> NAME/KEY: modified_base
<222> LOCATION: (1314)..(1314)
<223> OTHER INFORMATION: UNA monomer
<220> FEATURE:
<221> NAME/KEY: modified_base
<222> LOCATION: (1316)..(1316)
<223> OTHER INFORMATION: UNA monomer
<220> FEATURE:
<221> NAME/KEY: modified_base
<222> LOCATION: (1320)..(1320)
<223> OTHER INFORMATION: UNA monomer
<220> FEATURE:
<221> NAME/KEY: modified_base
<222> LOCATION: (1326)..(1326)
<223> OTHER INFORMATION: UNA monomer
<220> FEATURE:
<221> NAME/KEY: modified_base
<222> LOCATION: (1334)..(1338)
<223> OTHER INFORMATION: UNA monomer
<220> FEATURE:
<221> NAME/KEY: modified_base
<222> LOCATION: (1350)..(1350)
<223> OTHER INFORMATION: UNA monomer
<220> FEATURE:

<221> NAME/KEY: modified_base
<222> LOCATION: (1354)..(1355)
<223> OTHER INFORMATION: UNA monomer
<220> FEATURE:
<221> NAME/KEY: modified_base
<222> LOCATION: (1358)..(1358)
<223> OTHER INFORMATION: UNA monomer
<220> FEATURE:
<221> NAME/KEY: modified_base
<222> LOCATION: (1370)..(1370)
<223> OTHER INFORMATION: UNA monomer
<220> FEATURE:
<221> NAME/KEY: modified_base
<222> LOCATION: (1372)..(1372)
<223> OTHER INFORMATION: UNA monomer
<220> FEATURE:
<221> NAME/KEY: modified_base
<222> LOCATION: (1375)..(1377)
<223> OTHER INFORMATION: UNA monomer
<220> FEATURE:
<221> NAME/KEY: modified_base
<222> LOCATION: (1384)..(1385)
<223> OTHER INFORMATION: UNA monomer
<220> FEATURE:
<221> NAME/KEY: modified_base
<222> LOCATION: (1389)..(1389)
<223> OTHER INFORMATION: UNA monomer
<220> FEATURE:
<221> NAME/KEY: modified_base
<222> LOCATION: (1397)..(1397)
<223> OTHER INFORMATION: UNA monomer
<220> FEATURE:
<221> NAME/KEY: modified_base
<222> LOCATION: (1404)..(1404)
<223> OTHER INFORMATION: UNA monomer
<220> FEATURE:
<221> NAME/KEY: modified_base
<222> LOCATION: (1409)..(1409)
<223> OTHER INFORMATION: UNA monomer
<220> FEATURE:
<221> NAME/KEY: modified_base
<222> LOCATION: (1412)..(1413)
<223> OTHER INFORMATION: UNA monomer
<220> FEATURE:
<221> NAME/KEY: modified_base
<222> LOCATION: (1421)..(1422)
<223> OTHER INFORMATION: UNA monomer
<220> FEATURE:
<221> NAME/KEY: modified_base
<222> LOCATION: (1428)..(1428)
<223> OTHER INFORMATION: UNA monomer
<220> FEATURE:
<221> NAME/KEY: modified_base
<222> LOCATION: (1431)..(1431)
<223> OTHER INFORMATION: UNA monomer
<220> FEATURE:
<221> NAME/KEY: modified_base
<222> LOCATION: (1433)..(1433)
<223> OTHER INFORMATION: UNA monomer
<220> FEATURE:
<221> NAME/KEY: modified_base
<222> LOCATION: (1437)..(1437)
<223> OTHER INFORMATION: UNA monomer
<220> FEATURE:
<221> NAME/KEY: modified_base
<222> LOCATION: (1441)..(1441)
<223> OTHER INFORMATION: UNA monomer
<220> FEATURE:
<221> NAME/KEY: modified_base
<222> LOCATION: (1443)..(1443)
<223> OTHER INFORMATION: UNA monomer
<220> FEATURE:
<221> NAME/KEY: modified_base
<222> LOCATION: (1445)..(1445)
<223> OTHER INFORMATION: UNA monomer
<220> FEATURE:
<221> NAME/KEY: modified_base
<222> LOCATION: (1453)..(1453)
<223> OTHER INFORMATION: UNA monomer <220> FEATURE:
<221> NAME/KEY: modified_base
<222> LOCATION: (1458)..(1460)
<223> OTHER INFORMATION: UNA monomer
<220> FEATURE:
<221> NAME/KEY: modified_base
<222> LOCATION: (1463)..(1463)
<223> OTHER INFORMATION: UNA monomer
<220> FEATURE:
<221> NAME/KEY: modified_base
<222> LOCATION: (1476)..(1477)
<223> OTHER INFORMATION: UNA monomer
<220> FEATURE:
<221> NAME/KEY: modified_base
<222> LOCATION: (1479)..(1479)
<223> OTHER INFORMATION: UNA monomer
<220> FEATURE:
<221> NAME/KEY: modified_base
<222> LOCATION: (1484)..(1484)
<223> OTHER INFORMATION: UNA monomer
<220> FEATURE:
<221> NAME/KEY: modified_base
<222> LOCATION: (1493)..(1494)
<223> OTHER INFORMATION: UNA monomer
<220> FEATURE:
<221> NAME/KEY: modified_base
<222> LOCATION: (1496)..(1497)
<223> OTHER INFORMATION: UNA monomer
<220> FEATURE:
<221> NAME/KEY: modified_base
<222> LOCATION: (1512)..(1512)
<223> OTHER INFORMATION: UNA monomer
<220> FEATURE:
<221> NAME/KEY: modified_base
<222> LOCATION: (1518)..(1519)
<223> OTHER INFORMATION: UNA monomer
<220> FEATURE:
<221> NAME/KEY: modified_base
<222> LOCATION: (1523)..(1523)
<223> OTHER INFORMATION: UNA monomer
<220> FEATURE:
<221> NAME/KEY: modified_base
<222> LOCATION: (1526)..(1527)
<223> OTHER INFORMATION: UNA monomer
<220> FEATURE:
<221> NAME/KEY: modified_base
<222> LOCATION: (1530)..(1530)
<223> OTHER INFORMATION: UNA monomer
<220> FEATURE:
<221> NAME/KEY: modified_base
<222> LOCATION: (1532)..(1532)
<223> OTHER INFORMATION: UNA monomer
<220> FEATURE:
<221> NAME/KEY: modified_base
<222> LOCATION: (1543)..(1543)
<223> OTHER INFORMATION: UNA monomer
<220> FEATURE:
<221> NAME/KEY: modified_base
<222> LOCATION: (1546)..(1546)
<223> OTHER INFORMATION: UNA monomer
<220> FEATURE:
<221> NAME/KEY: modified_base
<222> LOCATION: (1549)..(1549)
<223> OTHER INFORMATION: UNA monomer
<220> FEATURE:
<221> NAME/KEY: modified_base
<222> LOCATION: (1551)..(1551)
<223> OTHER INFORMATION: UNA monomer
<220> FEATURE:
<221> NAME/KEY: modified_base
<222> LOCATION: (1554)..(1554)
<223> OTHER INFORMATION: UNA monomer
<220> FEATURE:
<221> NAME/KEY: modified_base
<222> LOCATION: (1557)..(1558)
<223> OTHER INFORMATION: UNA monomer
<220> FEATURE:
<221> NAME/KEY: modified_base
<222> LOCATION: (1560)..(1560)

<223> OTHER INFORMATION: UNA monomer
<220> FEATURE:
<221> NAME/KEY: modified_base
<222> LOCATION: (1565)..(1566)
<223> OTHER INFORMATION: UNA monomer
<220> FEATURE:
<221> NAME/KEY: modified_base
<222> LOCATION: (1569)..(1569)
<223> OTHER INFORMATION: UNA monomer
<220> FEATURE:
<221> NAME/KEY: modified_base
<222> LOCATION: (1573)..(1575)
<223> OTHER INFORMATION: UNA monomer
<220> FEATURE:
<221> NAME/KEY: modified_base
<222> LOCATION: (1580)..(1580)
<223> OTHER INFORMATION: UNA monomer
<220> FEATURE:
<221> NAME/KEY: modified_base
<222> LOCATION: (1584)..(1585)
<223> OTHER INFORMATION: UNA monomer
<220> FEATURE:
<221> NAME/KEY: modified_base
<222> LOCATION: (1587)..(1587)
<223> OTHER INFORMATION: UNA monomer
<220> FEATURE:
<221> NAME/KEY: modified_base
<222> LOCATION: (1590)..(1590)
<223> OTHER INFORMATION: UNA monomer
<220> FEATURE:
<221> NAME/KEY: modified_base
<222> LOCATION: (1593)..(1593)
<223> OTHER INFORMATION: UNA monomer
<220> FEATURE:
<221> NAME/KEY: modified_base
<222> LOCATION: (1595)..(1595)
<223> OTHER INFORMATION: UNA monomer
<220> FEATURE:
<221> NAME/KEY: modified_base
<222> LOCATION: (1597)..(1597)
<223> OTHER INFORMATION: UNA monomer
<220> FEATURE:
<221> NAME/KEY: modified_base
<222> LOCATION: (1602)..(1602)
<223> OTHER INFORMATION: UNA monomer
<220> FEATURE:
<221> NAME/KEY: modified_base
<222> LOCATION: (1605)..(1605)
<223> OTHER INFORMATION: UNA monomer
<220> FEATURE:
<221> NAME/KEY: modified_base
<222> LOCATION: (1611)..(1612)
<223> OTHER INFORMATION: UNA monomer
<220> FEATURE:
<221> NAME/KEY: modified_base
<222> LOCATION: (1617)..(1617)
<223> OTHER INFORMATION: UNA monomer
<220> FEATURE:
<221> NAME/KEY: modified_base
<222> LOCATION: (1619)..(1619)
<223> OTHER INFORMATION: UNA monomer
<220> FEATURE:
<221> NAME/KEY: modified_base
<222> LOCATION: (1623)..(1623)
<223> OTHER INFORMATION: UNA monomer
<220> FEATURE:
<221> NAME/KEY: modified_base
<222> LOCATION: (1625)..(1625)
<223> OTHER INFORMATION: UNA monomer
<220> FEATURE:
<221> NAME/KEY: modified_base
<222> LOCATION: (1630)..(1631)
<223> OTHER INFORMATION: UNA monomer
<220> FEATURE:
<221> NAME/KEY: modified_base
<222> LOCATION: (1635)..(1635)
<223> OTHER INFORMATION: UNA monomer
<220> FEATURE:
<221> NAME/KEY: modified_base <222> LOCATION: (1637)..(1638)
<223> OTHER INFORMATION: UNA monomer
<220> FEATURE:
<221> NAME/KEY: modified_base
<222> LOCATION: (1641)..(1641)
<223> OTHER INFORMATION: UNA monomer
<220> FEATURE:
<221> NAME/KEY: modified_base
<222> LOCATION: (1645)..(1645)
<223> OTHER INFORMATION: UNA monomer
<220> FEATURE:
<221> NAME/KEY: modified_base
<222> LOCATION: (1656)..(1656)
<223> OTHER INFORMATION: UNA monomer
<220> FEATURE:
<221> NAME/KEY: modified_base
<222> LOCATION: (1659)..(1659)
<223> OTHER INFORMATION: UNA monomer
<220> FEATURE:
<221> NAME/KEY: modified_base
<222> LOCATION: (1661)..(1662)
<223> OTHER INFORMATION: UNA monomer
<220> FEATURE:
<221> NAME/KEY: modified_base
<222> LOCATION: (1664)..(1664)
<223> OTHER INFORMATION: UNA monomer
<220> FEATURE:
<221> NAME/KEY: modified_base
<222> LOCATION: (1667)..(1668)
<223> OTHER INFORMATION: UNA monomer
<220> FEATURE:
<221> NAME/KEY: modified_base
<222> LOCATION: (1672)..(1673)
<223> OTHER INFORMATION: UNA monomer
<220> FEATURE:
<221> NAME/KEY: modified_base
<222> LOCATION: (1676)..(1678)
<223> OTHER INFORMATION: UNA monomer
<220> FEATURE:
<221> NAME/KEY: modified_base
<222> LOCATION: (1680)..(1680)
<223> OTHER INFORMATION: UNA monomer
<220> FEATURE:
<221> NAME/KEY: modified_base
<222> LOCATION: (1683)..(1683)
<223> OTHER INFORMATION: UNA monomer
<220> FEATURE:
<221> NAME/KEY: modified_base
<222> LOCATION: (1694)..(1694)
<223> OTHER INFORMATION: UNA monomer
<220> FEATURE:
<221> NAME/KEY: modified_base
<222> LOCATION: (1699)..(1701)
<223> OTHER INFORMATION: UNA monomer
<220> FEATURE:
<221> NAME/KEY: modified_base
<222> LOCATION: (1704)..(1704)
<223> OTHER INFORMATION: UNA monomer
<220> FEATURE:
<221> NAME/KEY: modified_base
<222> LOCATION: (1706)..(1706)
<223> OTHER INFORMATION: UNA monomer
<220> FEATURE:
<221> NAME/KEY: modified_base
<222> LOCATION: (1708)..(1708)
<223> OTHER INFORMATION: UNA monomer
<220> FEATURE:
<221> NAME/KEY: modified_base
<222> LOCATION: (1711)..(1712)
<223> OTHER INFORMATION: UNA monomer
<220> FEATURE:
<221> NAME/KEY: modified_base
<222> LOCATION: (1715)..(1715)
<223> OTHER INFORMATION: UNA monomer
<220> FEATURE:
<221> NAME/KEY: modified_base
<222> LOCATION: (1720)..(1720)
<223> OTHER INFORMATION: UNA monomer
<220> FEATURE:

<221> NAME/KEY: modified_base
<222> LOCATION: (1726)..(1726)
<223> OTHER INFORMATION: UNA monomer
<220> FEATURE:
<221> NAME/KEY: modified_base
<222> LOCATION: (1728)..(1728)
<223> OTHER INFORMATION: UNA monomer
<220> FEATURE:
<221> NAME/KEY: modified_base
<222> LOCATION: (1735)..(1735)
<223> OTHER INFORMATION: UNA monomer
<220> FEATURE:
<221> NAME/KEY: modified_base
<222> LOCATION: (1743)..(1743)
<223> OTHER INFORMATION: UNA monomer
<220> FEATURE:
<221> NAME/KEY: modified_base
<222> LOCATION: (1745)..(1746)
<223> OTHER INFORMATION: UNA monomer
<220> FEATURE:
<221> NAME/KEY: modified_base
<222> LOCATION: (1748)..(1748)
<223> OTHER INFORMATION: UNA monomer
<220> FEATURE:
<221> NAME/KEY: modified_base
<222> LOCATION: (1750)..(1751)
<223> OTHER INFORMATION: UNA monomer
<220> FEATURE:
<221> NAME/KEY: modified_base
<222> LOCATION: (1753)..(1753)
<223> OTHER INFORMATION: UNA monomer
<220> FEATURE:
<221> NAME/KEY: modified_base
<222> LOCATION: (1755)..(1755)
<223> OTHER INFORMATION: UNA monomer
<220> FEATURE:
<221> NAME/KEY: modified_base
<222> LOCATION: (1757)..(1758)
<223> OTHER INFORMATION: UNA monomer
<220> FEATURE:
<221> NAME/KEY: modified_base
<222> LOCATION: (1764)..(1764)
<223> OTHER INFORMATION: UNA monomer
<220> FEATURE:
<221> NAME/KEY: modified_base
<222> LOCATION: (1767)..(1767)
<223> OTHER INFORMATION: UNA monomer
<220> FEATURE:
<221> NAME/KEY: modified_base
<222> LOCATION: (1769)..(1769)
<223> OTHER INFORMATION: UNA monomer
<220> FEATURE:
<221> NAME/KEY: modified_base
<222> LOCATION: (1772)..(1772)
<223> OTHER INFORMATION: UNA monomer
<220> FEATURE:
<221> NAME/KEY: modified_base
<222> LOCATION: (1774)..(1774)
<223> OTHER INFORMATION: UNA monomer
<220> FEATURE:
<221> NAME/KEY: modified_base
<222> LOCATION: (1776)..(1776)
<223> OTHER INFORMATION: UNA monomer
<220> FEATURE:
<221> NAME/KEY: modified_base
<222> LOCATION: (1781)..(1781)
<223> OTHER INFORMATION: UNA monomer
<220> FEATURE:
<221> NAME/KEY: modified_base
<222> LOCATION: (1790)..(1790)
<223> OTHER INFORMATION: UNA monomer
<220> FEATURE:
<221> NAME/KEY: modified_base
<222> LOCATION: (1794)..(1794)
<223> OTHER INFORMATION: UNA monomer
<220> FEATURE:
<221> NAME/KEY: modified_base
<222> LOCATION: (1796)..(1796)
<223> OTHER INFORMATION: UNA monomer <220> FEATURE:
<221> NAME/KEY: modified_base
<222> LOCATION: (1798)..(1798)
<223> OTHER INFORMATION: UNA monomer
<220> FEATURE:
<221> NAME/KEY: modified_base
<222> LOCATION: (1800)..(1801)
<223> OTHER INFORMATION: UNA monomer
<220> FEATURE:
<221> NAME/KEY: modified_base
<222> LOCATION: (1806)..(1806)
<223> OTHER INFORMATION: UNA monomer
<220> FEATURE:
<221> NAME/KEY: modified_base
<222> LOCATION: (1813)..(1813)
<223> OTHER INFORMATION: UNA monomer
<220> FEATURE:
<221> NAME/KEY: modified_base
<222> LOCATION: (1815)..(1815)
<223> OTHER INFORMATION: UNA monomer
<220> FEATURE:
<221> NAME/KEY: modified_base
<222> LOCATION: (1818)..(1818)
<223> OTHER INFORMATION: UNA monomer
<220> FEATURE:
<221> NAME/KEY: modified_base
<222> LOCATION: (1820)..(1820)
<223> OTHER INFORMATION: UNA monomer
<220> FEATURE:
<221> NAME/KEY: modified_base
<222> LOCATION: (1825)..(1827)
<223> OTHER INFORMATION: UNA monomer
<220> FEATURE:
<221> NAME/KEY: modified_base
<222> LOCATION: (1832)..(1832)
<223> OTHER INFORMATION: UNA monomer
<220> FEATURE:
<221> NAME/KEY: modified_base
<222> LOCATION: (1845)..(1845)
<223> OTHER INFORMATION: UNA monomer
<220> FEATURE:
<221> NAME/KEY: modified_base
<222> LOCATION: (1847)..(1847)
<223> OTHER INFORMATION: UNA monomer
<220> FEATURE:
<221> NAME/KEY: modified_base
<222> LOCATION: (1852)..(1853)
<223> OTHER INFORMATION: UNA monomer
<220> FEATURE:
<221> NAME/KEY: modified_base
<222> LOCATION: (1855)..(1855)
<223> OTHER INFORMATION: UNA monomer
<220> FEATURE:
<221> NAME/KEY: modified_base
<222> LOCATION: (1865)..(1866)
<223> OTHER INFORMATION: UNA monomer
<220> FEATURE:
<221> NAME/KEY: modified_base
<222> LOCATION: (1871)..(1871)
<223> OTHER INFORMATION: UNA monomer
<220> FEATURE:
<221> NAME/KEY: modified_base
<222> LOCATION: (1880)..(1880)
<223> OTHER INFORMATION: UNA monomer
<220> FEATURE:
<221> NAME/KEY: modified_base
<222> LOCATION: (1882)..(1882)
<223> OTHER INFORMATION: UNA monomer
<220> FEATURE:
<221> NAME/KEY: modified_base
<222> LOCATION: (1887)..(1887)
<223> OTHER INFORMATION: UNA monomer
<220> FEATURE:
<221> NAME/KEY: modified_base
<222> LOCATION: (1895)..(1896)
<223> OTHER INFORMATION: UNA monomer
<220> FEATURE:
<221> NAME/KEY: modified_base
<222> LOCATION: (1907)..(1908)

<223> OTHER INFORMATION: UNA monomer
<220> FEATURE:
<221> NAME/KEY: modified_base
<222> LOCATION: (1913)..(1913)
<223> OTHER INFORMATION: UNA monomer
<220> FEATURE:
<221> NAME/KEY: modified_base
<222> LOCATION: (1915)..(1916)
<223> OTHER INFORMATION: UNA monomer
<220> FEATURE:
<221> NAME/KEY: modified_base
<222> LOCATION: (1928)..(1928)
<223> OTHER INFORMATION: UNA monomer
<220> FEATURE:
<221> NAME/KEY: modified_base
<222> LOCATION: (1940)..(1940)
<223> OTHER INFORMATION: UNA monomer
<220> FEATURE:
<221> NAME/KEY: modified_base
<222> LOCATION: (1948)..(1948)
<223> OTHER INFORMATION: UNA monomer
<220> FEATURE:
<221> NAME/KEY: modified_base
<222> LOCATION: (1952)..(1952)
<223> OTHER INFORMATION: UNA monomer
<220> FEATURE:
<221> NAME/KEY: modified_base
<222> LOCATION: (1956)..(1956)
<223> OTHER INFORMATION: UNA monomer
<220> FEATURE:
<221> NAME/KEY: modified_base
<222> LOCATION: (1961)..(1962)
<223> OTHER INFORMATION: UNA monomer
<220> FEATURE:
<221> NAME/KEY: modified_base
<222> LOCATION: (1968)..(1968)
<223> OTHER INFORMATION: UNA monomer
<220> FEATURE:
<221> NAME/KEY: modified_base
<222> LOCATION: (1970)..(1971)
<223> OTHER INFORMATION: UNA monomer
<220> FEATURE:
<221> NAME/KEY: modified_base
<222> LOCATION: (1975)..(1976)
<223> OTHER INFORMATION: UNA monomer
<220> FEATURE:
<221> NAME/KEY: modified_base
<222> LOCATION: (1980)..(1980)
<223> OTHER INFORMATION: UNA monomer
<220> FEATURE:
<221> NAME/KEY: modified_base
<222> LOCATION: (1991)..(1991)
<223> OTHER INFORMATION: UNA monomer
<220> FEATURE:
<221> NAME/KEY: modified_base
<222> LOCATION: (1995)..(1995)
<223> OTHER INFORMATION: UNA monomer
<220> FEATURE:
<221> NAME/KEY: modified_base
<222> LOCATION: (1999)..(2002)
<223> OTHER INFORMATION: UNA monomer
<220> FEATURE:
<221> NAME/KEY: modified_base
<222> LOCATION: (2004)..(2004)
<223> OTHER INFORMATION: UNA monomer
<220> FEATURE:
<221> NAME/KEY: modified_base
<222> LOCATION: (2007)..(2007)
<223> OTHER INFORMATION: UNA monomer
<220> FEATURE:
<221> NAME/KEY: modified_base
<222> LOCATION: (2011)..(2011)
<223> OTHER INFORMATION: UNA monomer
<220> FEATURE:
<221> NAME/KEY: modified_base
<222> LOCATION: (2015)..(2015)
<223> OTHER INFORMATION: UNA monomer
<220> FEATURE:
<221> NAME/KEY: modified_base <222> LOCATION: (2021)..(2021)
<223> OTHER INFORMATION: UNA monomer
<220> FEATURE:
<221> NAME/KEY: modified_base
<222> LOCATION: (2025)..(2025)
<223> OTHER INFORMATION: UNA monomer
<220> FEATURE:
<221> NAME/KEY: modified_base
<222> LOCATION: (2027)..(2028)
<223> OTHER INFORMATION: UNA monomer
<220> FEATURE:
<221> NAME/KEY: modified_base
<222> LOCATION: (2031)..(2031)
<223> OTHER INFORMATION: UNA monomer
<220> FEATURE:
<221> NAME/KEY: modified_base
<222> LOCATION: (2034)..(2034)
<223> OTHER INFORMATION: UNA monomer
<220> FEATURE:
<221> NAME/KEY: modified_base
<222> LOCATION: (2036)..(2036)
<223> OTHER INFORMATION: UNA monomer
<220> FEATURE:
<221> NAME/KEY: modified_base
<222> LOCATION: (2041)..(2042)
<223> OTHER INFORMATION: UNA monomer
<220> FEATURE:
<221> NAME/KEY: modified_base
<222> LOCATION: (2046)..(2046)
<223> OTHER INFORMATION: UNA monomer
<220> FEATURE:
<221> NAME/KEY: modified_base
<222> LOCATION: (2048)..(2048)
<223> OTHER INFORMATION: UNA monomer
<220> FEATURE:
<221> NAME/KEY: modified_base
<222> LOCATION: (2052)..(2052)
<223> OTHER INFORMATION: UNA monomer
<220> FEATURE:
<221> NAME/KEY: modified_base
<222> LOCATION: (2060)..(2062)
<223> OTHER INFORMATION: UNA monomer
<220> FEATURE:
<221> NAME/KEY: modified_base
<222> LOCATION: (2064)..(2064)
<223> OTHER INFORMATION: UNA monomer
<220> FEATURE:
<221> NAME/KEY: modified_base
<222> LOCATION: (2070)..(2070)
<223> OTHER INFORMATION: UNA monomer
<220> FEATURE:
<221> NAME/KEY: modified_base
<222> LOCATION: (2073)..(2073)
<223> OTHER INFORMATION: UNA monomer
<220> FEATURE:
<221> NAME/KEY: modified_base
<222> LOCATION: (2076)..(2076)
<223> OTHER INFORMATION: UNA monomer
<220> FEATURE:
<221> NAME/KEY: modified_base
<222> LOCATION: (2078)..(2079)
<223> OTHER INFORMATION: UNA monomer
<220> FEATURE:
<221> NAME/KEY: modified_base
<222> LOCATION: (2085)..(2085)
<223> OTHER INFORMATION: UNA monomer
<220> FEATURE:
<221> NAME/KEY: modified_base
<222> LOCATION: (2089)..(2089)
<223> OTHER INFORMATION: UNA monomer
<220> FEATURE:
<221> NAME/KEY: modified_base
<222> LOCATION: (2092)..(2092)
<223> OTHER INFORMATION: UNA monomer
<220> FEATURE:
<221> NAME/KEY: modified_base
<222> LOCATION: (2094)..(2094)
<223> OTHER INFORMATION: UNA monomer
<220> FEATURE:

<221> NAME/KEY: modified_base
<222> LOCATION: (2098)..(2098)
<223> OTHER INFORMATION: UNA monomer
<220> FEATURE:
<221> NAME/KEY: modified_base
<222> LOCATION: (2102)..(2104)
<223> OTHER INFORMATION: UNA monomer
<220> FEATURE:
<221> NAME/KEY: modified_base
<222> LOCATION: (2121)..(2122)
<223> OTHER INFORMATION: UNA monomer
<220> FEATURE:
<221> NAME/KEY: modified_base
<222> LOCATION: (2124)..(2125)
<223> OTHER INFORMATION: UNA monomer

<400> SEQUENCE: 153 augagggucc ugggugggcg cugcggggcg cugcuggcgu gucuccuccu agugcuuccc 60 gucucagagg caaacuuuug uuuauauuuu agaaaugauu uuauauacaa ccgugcaugc 120 auuucuguau uggucggcuu aucuggaugc aauuuuuucu auucuauaug cuuuuuguca 180 aagcaacagg cuucacaagu ccugguuagg aagcgucgug caaauucuuu acuugaagaa 240 accaaacagg guaaucuuga aagagaaugc aucgaagaac ugugcaauaa agaagaagcc 300 agggaggucu uugaaaauga cccggaaacg gauuauuuuu auccaaaaua cuuaguuugu 360 cuucgcucuu uucaaacugg guuauucacu gcugcacguc agucaacuaa ugcuuauccu 420 gaccuaagaa gcugugucaa ugccauucca gaccagugua guccucugcc augcaaugaa 480 gauggauaua ugagcugcaa agauggaaaa gcuucuuuua cuugcacuug uaaaccaggu 540 uggcaaggag aaaaguguga auuugacaua aaugaaugca aagaucccuc aaauauaaau 600 ggagguugca gucaaauuug ugauaauaca ccuggaaguu accacuguuc cuguaaaaau 660 gguuuuguua ugcuuucaaa uaagaaagau uguaaagaug uggaugaaug cucuuugaag 720 ccaagcauuu guggcacagc ugugugcaag aacaucccag gagauuuuga augugaaugc 780 cccgaaggcu acagauauaa ucucaaauca aagucuugug aagauauaga ugaaugcucu 840 gagaacaugu gugcucagcu uugugucaau uacccuggag guuacacuug cuauugugau 900 gggaagaaag gauucaaacu ugcccaagau cagaagaguu gugagguugu uucagugugc 960 cuucccuuga accuugacac aaaguaugaa uuacuuuacu uggcggagca guuugcaggg 1020 guuguuuuau auuuaaaauu ucguuugcca gaaaucagca gauuuucagc agaauuugau 1080 uuccggacau augauucaga aggcgugaua cuguacgcag aaucuaucga ucacucagcg 1140 uggcuccuga uugcacuucg ugguggaaag auugaaguuc agcuuaagaa ugaacauaca 1200 uccaaaauca caacuggagg ugauguuauu aauaaugguc uauggaauau ggugucugug 1260 gaagaauuag aacauaguau uagcauuaaa auagcuaaag aagcugugau ggauauaaau 1320 aaaccuggac cccuuuuuaa gccggaaaau ggauugcugg aaaccaaagu auacuuugca 1380 ggauucccuc ggaaagugga aagugaacuc auuaaaccga uuaacccucg ucuagaugga 1440 uguauacgaa gcuggaauuu gaugaagcaa ggagcuucug gaauaaagga aauuauucaa 1500 gaaaaacaaa auaagcauug ccugguuacu guggagaagg gcuccuacua uccugguucu 1560 ggaauugcuc aauuucacau agauuauaau aauguaucca gugcugaggg uuggcaugua 1620 aaugugaccu ugaauauucg uccauccacg ggcacuggug uuaugcuugc cuugguuucu 1680 gguaacaaca cagugcccuu ugcugugucc uugguggacu ccaccucuga aaaaucacag 1740 gauauucugu uaucuguuga aaauacugua auauaucgga uacaggcccu aagucuaugu 1800 uccgaucaac aaucucaucu ggaauuuaga gucaacagaa acaaucugga guugucgaca 1860

```
ccacuuaaaa uagaaaccau cucccaugaa gaccuucaaa gacaacuugc cgucuuggac   1920

aaagcaauga aagcaaaagu ggccacauac cugggugggcc uuccagaugu uccauucagu   1980

gccacaccag ugaaugccuu uuauaauggc ugcauggaag ugaauauuaa ugguguacag   2040

uuggaucugg augaagccau uucuaaacau aaugauauua gagcucacuc auguccauca   2100

guuuggaaaa agacaaagaa uucuuaa                                       2127
```

<210> SEQ ID NO 154
<211> LENGTH: 1725
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (1722)..(1724)
<223> OTHER INFORMATION: UNA monomer

<400> SEQUENCE: 154

```
augucgaucc aggagaacau aucaucccug cagcuucggu caugggucuc uaagucccaa     60

agagacuuag caaaguccau ccugauuggg gcuccaggag ggccagcggg guaucugcgg    120

cgggccagug uggcccaacu gacccaggag cugggcacug ccuucuucca gcagcagcag    180

cugccagcug cuauggcaga caccuuccug gaacaccucu gccuacugga cauugacucc    240

gagcccgugg cugcucgcag uaccagcauc auugccacca ucgggccagc aucucgcucc    300

guggagcgcc ucaaggagau gaucaaggcc gggaugaaca uugcgcgacu caacuucucc    360

cacggcuccc acgaguacca ugcugagucc aucgccaacg uccgggaggc gguggagagc    420

uuugcagguu ccccacucag cuaccggccc guggccaucg cccuggacac caagggaccg    480

gagauccgca cugggauccu gcagggggu ccagagucgg aaguggagcu ggugaagggc    540

ucccaggugc uggugacugu ggaccccgcg uuccggacgc gggggaacgc gaacaccgug    600

ugggugggacu accccaauau uguccggguc gugccggugg ggggccgcau cuacauugac    660

gacgggcuca ucucccuagu gguccagaaa aucggcccag agggacuggu gacccaagug    720

gagaacggcg gcguccuggg cagccggaag ggcgugaacu ugccaggggc ccagguggac    780

uugcccgggc uguccgagca ggacguccga gaccugcgcu ucggggugga gcaugggggug    840

gacaucgucu uugccuccuu ugugcggaaa gccagcgacg uggcugccgu cagggcugcu    900

cuggguccgg aaggacacgg caucaagauc aucagcaaaa uugagaacca cgaaggcgug    960

aagagguuug augaaauccu ggaggugagc gacggcauca ugguggcacg gggggaccua   1020

ggcaucgaga ucccagcaga gaagguuuuc cuggcucaga agaugaugau ugggcgcugc   1080

aacuuggcgg gcaagccugu ugucugugcc acacagaugc uggagagcau gauuaccaag   1140

ccccggccaa cgagggcaga gacaagcgau gucgccaaug cugugcugga uggggcugac   1200

ugcaucaugc ugucagggga gacugccaag ggcaacuucc cuguggaagc ggugaagaug   1260

cagcaugcga uugcccggga ggcagaggcc gcaguguacc accggcagcu guuugaggag   1320

cuacgucggg cagcgccacu aagccgugau cccacugagg ucaccgccau uggugcugug   1380

gaggcugccu ucaagugcug ugcugcugcc aucauugugc ugaccacaac uggccgcuca   1440

gcccagcuuc ugucucggua ccgaccucgg gcagcaguca uugcugucac ccgcucugcc   1500
```

caggcugccc gccaggucca cuuaugccga ggagucuucc ccuugcuuua ccgugaaccu 1560 ccagaagcca ucugggcaga ugauguagau cgccgggugc aauuuggcau ugaaagugga 1620 aagcuccgug gcuuccuccg uguuggagac cuggugauug uggugacagg cuggcgaccu 1680 ggcuccggcu acaccaacau caugcgggug cuaagcauau ccuga 1725

<210> SEQ ID NO 155
<211> LENGTH: 1725
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (4)..(4)
<223> OTHER INFORMATION: UNA monomer
<220> FEATURE:
<221> NAME/KEY: modified_base
<222> LOCATION: (8)..(8)
<223> OTHER INFORMATION: UNA monomer
<220> FEATURE:
<221> NAME/KEY: modified_base
<222> LOCATION: (20)..(20)
<223> OTHER INFORMATION: UNA monomer
<220> FEATURE:
<221> NAME/KEY: modified_base
<222> LOCATION: (22)..(22)
<223> OTHER INFORMATION: UNA monomer
<220> FEATURE:
<221> NAME/KEY: modified_base
<222> LOCATION: (25)..(25)
<223> OTHER INFORMATION: UNA monomer
<220> FEATURE:
<221> NAME/KEY: modified_base
<222> LOCATION: (29)..(29)
<223> OTHER INFORMATION: UNA monomer
<220> FEATURE:
<221> NAME/KEY: modified_base
<222> LOCATION: (35)..(36)
<223> OTHER INFORMATION: UNA monomer
<220> FEATURE:
<221> NAME/KEY: modified_base
<222> LOCATION: (40)..(40)
<223> OTHER INFORMATION: UNA monomer
<220> FEATURE:
<221> NAME/KEY: modified_base
<222> LOCATION: (43)..(43)
<223> OTHER INFORMATION: UNA monomer
<220> FEATURE:
<221> NAME/KEY: modified_base
<222> LOCATION: (47)..(47)
<223> OTHER INFORMATION: UNA monomer
<220> FEATURE:
<221> NAME/KEY: modified_base
<222> LOCATION: (49)..(49)
<223> OTHER INFORMATION: UNA monomer
<220> FEATURE:
<221> NAME/KEY: modified_base
<222> LOCATION: (51)..(51)
<223> OTHER INFORMATION: UNA monomer
<220> FEATURE:
<221> NAME/KEY: modified_base
<222> LOCATION: (55)..(55)
<223> OTHER INFORMATION: UNA monomer
<220> FEATURE:
<221> NAME/KEY: modified_base
<222> LOCATION: (67)..(68)
<223> OTHER INFORMATION: UNA monomer
<220> FEATURE:
<221> NAME/KEY: modified_base <222> LOCATION: (76)..(76)
<223> OTHER INFORMATION: UNA monomer
<220> FEATURE:
<221> NAME/KEY: modified_base
<222> LOCATION: (80)..(80)
<223> OTHER INFORMATION: UNA monomer
<220> FEATURE:
<221> NAME/KEY: modified_base
<222> LOCATION: (83)..(83)
<223> OTHER INFORMATION: UNA monomer
<220> FEATURE:
<221> NAME/KEY: modified_base
<222> LOCATION: (86)..(87)
<223> OTHER INFORMATION: UNA monomer
<220> FEATURE:
<221> NAME/KEY: modified_base
<222> LOCATION: (93)..(93)
<223> OTHER INFORMATION: UNA monomer
<220> FEATURE:
<221> NAME/KEY: modified_base
<222> LOCATION: (112)..(112)
<223> OTHER INFORMATION: UNA monomer
<220> FEATURE:
<221> NAME/KEY: modified_base
<222> LOCATION: (114)..(114)
<223> OTHER INFORMATION: UNA monomer
<220> FEATURE:
<221> NAME/KEY: modified_base
<222> LOCATION: (116)..(116)
<223> OTHER INFORMATION: UNA monomer
<220> FEATURE:
<221> NAME/KEY: modified_base
<222> LOCATION: (129)..(129)
<223> OTHER INFORMATION: UNA monomer
<220> FEATURE:
<221> NAME/KEY: modified_base
<222> LOCATION: (131)..(131)
<223> OTHER INFORMATION: UNA monomer
<220> FEATURE:
<221> NAME/KEY: modified_base
<222> LOCATION: (140)..(140)
<223> OTHER INFORMATION: UNA monomer
<220> FEATURE:
<221> NAME/KEY: modified_base
<222> LOCATION: (152)..(152)
<223> OTHER INFORMATION: UNA monomer
<220> FEATURE:
<221> NAME/KEY: modified_base
<222> LOCATION: (159)..(159)
<223> OTHER INFORMATION: UNA monomer
<220> FEATURE:
<221> NAME/KEY: modified_base
<222> LOCATION: (163)..(164)
<223> OTHER INFORMATION: UNA monomer
<220> FEATURE:
<221> NAME/KEY: modified_base
<222> LOCATION: (166)..(167)
<223> OTHER INFORMATION: UNA monomer
<220> FEATURE:
<221> NAME/KEY: modified_base
<222> LOCATION: (182)..(182)
<223> OTHER INFORMATION: UNA monomer
<220> FEATURE:
<221> NAME/KEY: modified_base
<222> LOCATION: (189)..(189)
<223> OTHER INFORMATION: UNA monomer
<220> FEATURE:
<221> NAME/KEY: modified_base
<222> LOCATION: (192)..(192)
<223> OTHER INFORMATION: UNA monomer
<220> FEATURE:
<221> NAME/KEY: modified_base
<222> LOCATION: (194)..(194)
<223> OTHER INFORMATION: UNA monomer
<220> FEATURE:
<221> NAME/KEY: modified_base
<222> LOCATION: (205)..(206)
<223> OTHER INFORMATION: UNA monomer
<220> FEATURE:

<221> NAME/KEY: modified_base
<222> LOCATION: (209)..(209)
<223> OTHER INFORMATION: UNA monomer
<220> FEATURE:
<221> NAME/KEY: modified_base
<222> LOCATION: (218)..(218)
<223> OTHER INFORMATION: UNA monomer
<220> FEATURE:
<221> NAME/KEY: modified_base
<222> LOCATION: (220)..(220)
<223> OTHER INFORMATION: UNA monomer
<220> FEATURE:
<221> NAME/KEY: modified_base
<222> LOCATION: (224)..(224)
<223> OTHER INFORMATION: UNA monomer
<220> FEATURE:
<221> NAME/KEY: modified_base
<222> LOCATION: (227)..(227)
<223> OTHER INFORMATION: UNA monomer
<220> FEATURE:
<221> NAME/KEY: modified_base
<222> LOCATION: (233)..(234)
<223> OTHER INFORMATION: UNA monomer
<220> FEATURE:
<221> NAME/KEY: modified_base
<222> LOCATION: (238)..(238)
<223> OTHER INFORMATION: UNA monomer
<220> FEATURE:
<221> NAME/KEY: modified_base
<222> LOCATION: (248)..(248)
<223> OTHER INFORMATION: UNA monomer
<220> FEATURE:
<221> NAME/KEY: modified_base
<222> LOCATION: (252)..(252)
<223> OTHER INFORMATION: UNA monomer
<220> FEATURE:
<221> NAME/KEY: modified_base
<222> LOCATION: (255)..(255)
<223> OTHER INFORMATION: UNA monomer
<220> FEATURE:
<221> NAME/KEY: modified_base
<222> LOCATION: (261)..(261)
<223> OTHER INFORMATION: UNA monomer
<220> FEATURE:
<221> NAME/KEY: modified_base
<222> LOCATION: (269)..(269)
<223> OTHER INFORMATION: UNA monomer
<220> FEATURE:
<221> NAME/KEY: modified_base
<222> LOCATION: (272)..(273)
<223> OTHER INFORMATION: UNA monomer
<220> FEATURE:
<221> NAME/KEY: modified_base
<222> LOCATION: (281)..(281)
<223> OTHER INFORMATION: UNA monomer
<220> FEATURE:
<221> NAME/KEY: modified_base
<222> LOCATION: (292)..(292)
<223> OTHER INFORMATION: UNA monomer
<220> FEATURE:
<221> NAME/KEY: modified_base
<222> LOCATION: (294)..(294)
<223> OTHER INFORMATION: UNA monomer
<220> FEATURE:
<221> NAME/KEY: modified_base
<222> LOCATION: (298)..(298)
<223> OTHER INFORMATION: UNA monomer
<220> FEATURE:
<221> NAME/KEY: modified_base
<222> LOCATION: (302)..(302)
<223> OTHER INFORMATION: UNA monomer
<220> FEATURE:
<221> NAME/KEY: modified_base
<222> LOCATION: (311)..(311)
<223> OTHER INFORMATION: UNA monomer
<220> FEATURE:
<221> NAME/KEY: modified_base
<222> LOCATION: (320)..(320)
<223> OTHER INFORMATION: UNA monomer <220> FEATURE:
<221> NAME/KEY: modified_base
<222> LOCATION: (323)..(323)
<223> OTHER INFORMATION: UNA monomer
<220> FEATURE:
<221> NAME/KEY: modified_base
<222> LOCATION: (335)..(335)
<223> OTHER INFORMATION: UNA monomer
<220> FEATURE:
<221> NAME/KEY: modified_base
<222> LOCATION: (341)..(342)
<223> OTHER INFORMATION: UNA monomer
<220> FEATURE:
<221> NAME/KEY: modified_base
<222> LOCATION: (350)..(350)
<223> OTHER INFORMATION: UNA monomer
<220> FEATURE:
<221> NAME/KEY: modified_base
<222> LOCATION: (355)..(356)
<223> OTHER INFORMATION: UNA monomer
<220> FEATURE:
<221> NAME/KEY: modified_base
<222> LOCATION: (358)..(358)
<223> OTHER INFORMATION: UNA monomer
<220> FEATURE:
<221> NAME/KEY: modified_base
<222> LOCATION: (367)..(367)
<223> OTHER INFORMATION: UNA monomer
<220> FEATURE:
<221> NAME/KEY: modified_base
<222> LOCATION: (376)..(376)
<223> OTHER INFORMATION: UNA monomer
<220> FEATURE:
<221> NAME/KEY: modified_base
<222> LOCATION: (381)..(381)
<223> OTHER INFORMATION: UNA monomer
<220> FEATURE:
<221> NAME/KEY: modified_base
<222> LOCATION: (384)..(384)
<223> OTHER INFORMATION: UNA monomer
<220> FEATURE:
<221> NAME/KEY: modified_base
<222> LOCATION: (388)..(388)
<223> OTHER INFORMATION: UNA monomer
<220> FEATURE:
<221> NAME/KEY: modified_base
<222> LOCATION: (392)..(392)
<223> OTHER INFORMATION: UNA monomer
<220> FEATURE:
<221> NAME/KEY: modified_base
<222> LOCATION: (401)..(401)
<223> OTHER INFORMATION: UNA monomer
<220> FEATURE:
<221> NAME/KEY: modified_base
<222> LOCATION: (413)..(413)
<223> OTHER INFORMATION: UNA monomer
<220> FEATURE:
<221> NAME/KEY: modified_base
<222> LOCATION: (421)..(423)
<223> OTHER INFORMATION: UNA monomer
<220> FEATURE:
<221> NAME/KEY: modified_base
<222> LOCATION: (429)..(430)
<223> OTHER INFORMATION: UNA monomer
<220> FEATURE:
<221> NAME/KEY: modified_base
<222> LOCATION: (437)..(437)
<223> OTHER INFORMATION: UNA monomer
<220> FEATURE:
<221> NAME/KEY: modified_base
<222> LOCATION: (442)..(442)
<223> OTHER INFORMATION: UNA monomer
<220> FEATURE:
<221> NAME/KEY: modified_base
<222> LOCATION: (452)..(452)
<223> OTHER INFORMATION: UNA monomer
<220> FEATURE:
<221> NAME/KEY: modified_base
<222> LOCATION: (458)..(458)

<223> OTHER INFORMATION: UNA monomer
<220> FEATURE:
<221> NAME/KEY: modified_base
<222> LOCATION: (464)..(464)
<223> OTHER INFORMATION: UNA monomer
<220> FEATURE:
<221> NAME/KEY: modified_base
<222> LOCATION: (485)..(485)
<223> OTHER INFORMATION: UNA monomer
<220> FEATURE:
<221> NAME/KEY: modified_base
<222> LOCATION: (492)..(492)
<223> OTHER INFORMATION: UNA monomer
<220> FEATURE:
<221> NAME/KEY: modified_base
<222> LOCATION: (497)..(497)
<223> OTHER INFORMATION: UNA monomer
<220> FEATURE:
<221> NAME/KEY: modified_base
<222> LOCATION: (500)..(500)
<223> OTHER INFORMATION: UNA monomer
<220> FEATURE:
<221> NAME/KEY: modified_base
<222> LOCATION: (510)..(510)
<223> OTHER INFORMATION: UNA monomer
<220> FEATURE:
<221> NAME/KEY: modified_base
<222> LOCATION: (517)..(517)
<223> OTHER INFORMATION: UNA monomer
<220> FEATURE:
<221> NAME/KEY: modified_base
<222> LOCATION: (524)..(524)
<223> OTHER INFORMATION: UNA monomer
<220> FEATURE:
<221> NAME/KEY: modified_base
<222> LOCATION: (530)..(530)
<223> OTHER INFORMATION: UNA monomer
<220> FEATURE:
<221> NAME/KEY: modified_base
<222> LOCATION: (533)..(533)
<223> OTHER INFORMATION: UNA monomer
<220> FEATURE:
<221> NAME/KEY: modified_base
<222> LOCATION: (541)..(541)
<223> OTHER INFORMATION: UNA monomer
<220> FEATURE:
<221> NAME/KEY: modified_base
<222> LOCATION: (548)..(548)
<223> OTHER INFORMATION: UNA monomer
<220> FEATURE:
<221> NAME/KEY: modified_base
<222> LOCATION: (551)..(551)
<223> OTHER INFORMATION: UNA monomer
<220> FEATURE:
<221> NAME/KEY: modified_base
<222> LOCATION: (554)..(554)
<223> OTHER INFORMATION: UNA monomer
<220> FEATURE:
<221> NAME/KEY: modified_base
<222> LOCATION: (558)..(558)
<223> OTHER INFORMATION: UNA monomer
<220> FEATURE:
<221> NAME/KEY: modified_base
<222> LOCATION: (560)..(560)
<223> OTHER INFORMATION: UNA monomer
<220> FEATURE:
<221> NAME/KEY: modified_base
<222> LOCATION: (571)..(572)
<223> OTHER INFORMATION: UNA monomer
<220> FEATURE:
<221> NAME/KEY: modified_base
<222> LOCATION: (599)..(599)
<223> OTHER INFORMATION: UNA monomer
<220> FEATURE:
<221> NAME/KEY: modified_base
<222> LOCATION: (601)..(601)
<223> OTHER INFORMATION: UNA monomer
<220> FEATURE:
<221> NAME/KEY: modified_base <222> LOCATION: (605)..(605)
<223> OTHER INFORMATION: UNA monomer
<220> FEATURE:
<221> NAME/KEY: modified_base
<222> LOCATION: (610)..(610)
<223> OTHER INFORMATION: UNA monomer
<220> FEATURE:
<221> NAME/KEY: modified_base
<222> LOCATION: (618)..(618)
<223> OTHER INFORMATION: UNA monomer
<220> FEATURE:
<221> NAME/KEY: modified_base
<222> LOCATION: (620)..(621)
<223> OTHER INFORMATION: UNA monomer
<220> FEATURE:
<221> NAME/KEY: modified_base
<222> LOCATION: (623)..(623)
<223> OTHER INFORMATION: UNA monomer
<220> FEATURE:
<221> NAME/KEY: modified_base
<222> LOCATION: (629)..(629)
<223> OTHER INFORMATION: UNA monomer
<220> FEATURE:
<221> NAME/KEY: modified_base
<222> LOCATION: (632)..(632)
<223> OTHER INFORMATION: UNA monomer
<220> FEATURE:
<221> NAME/KEY: modified_base
<222> LOCATION: (638)..(638)
<223> OTHER INFORMATION: UNA monomer
<220> FEATURE:
<221> NAME/KEY: modified_base
<222> LOCATION: (650)..(650)
<223> OTHER INFORMATION: UNA monomer
<220> FEATURE:
<221> NAME/KEY: modified_base
<222> LOCATION: (652)..(652)
<223> OTHER INFORMATION: UNA monomer
<220> FEATURE:
<221> NAME/KEY: modified_base
<222> LOCATION: (656)..(657)
<223> OTHER INFORMATION: UNA monomer
<220> FEATURE:
<221> NAME/KEY: modified_base
<222> LOCATION: (668)..(668)
<223> OTHER INFORMATION: UNA monomer
<220> FEATURE:
<221> NAME/KEY: modified_base
<222> LOCATION: (671)..(671)
<223> OTHER INFORMATION: UNA monomer
<220> FEATURE:
<221> NAME/KEY: modified_base
<222> LOCATION: (673)..(673)
<223> OTHER INFORMATION: UNA monomer
<220> FEATURE:
<221> NAME/KEY: modified_base
<222> LOCATION: (677)..(677)
<223> OTHER INFORMATION: UNA monomer
<220> FEATURE:
<221> NAME/KEY: modified_base
<222> LOCATION: (680)..(680)
<223> OTHER INFORMATION: UNA monomer
<220> FEATURE:
<221> NAME/KEY: modified_base
<222> LOCATION: (683)..(683)
<223> OTHER INFORMATION: UNA monomer
<220> FEATURE:
<221> NAME/KEY: modified_base
<222> LOCATION: (692)..(692)
<223> OTHER INFORMATION: UNA monomer
<220> FEATURE:
<221> NAME/KEY: modified_base
<222> LOCATION: (707)..(707)
<223> OTHER INFORMATION: UNA monomer
<220> FEATURE:
<221> NAME/KEY: modified_base
<222> LOCATION: (710)..(710)
<223> OTHER INFORMATION: UNA monomer
<220> FEATURE:

<221> NAME/KEY: modified_base
<222> LOCATION: (719)..(719)
<223> OTHER INFORMATION: UNA monomer
<220> FEATURE:
<221> NAME/KEY: modified_base
<222> LOCATION: (734)..(734)
<223> OTHER INFORMATION: UNA monomer
<220> FEATURE:
<221> NAME/KEY: modified_base
<222> LOCATION: (737)..(737)
<223> OTHER INFORMATION: UNA monomer
<220> FEATURE:
<221> NAME/KEY: modified_base
<222> LOCATION: (755)..(755)
<223> OTHER INFORMATION: UNA monomer
<220> FEATURE:
<221> NAME/KEY: modified_base
<222> LOCATION: (760)..(761)
<223> OTHER INFORMATION: UNA monomer
<220> FEATURE:
<221> NAME/KEY: modified_base
<222> LOCATION: (776)..(776)
<223> OTHER INFORMATION: UNA monomer
<220> FEATURE:
<221> NAME/KEY: modified_base
<222> LOCATION: (781)..(782)
<223> OTHER INFORMATION: UNA monomer
<220> FEATURE:
<221> NAME/KEY: modified_base
<222> LOCATION: (791)..(791)
<223> OTHER INFORMATION: UNA monomer
<220> FEATURE:
<221> NAME/KEY: modified_base
<222> LOCATION: (793)..(793)
<223> OTHER INFORMATION: UNA monomer
<220> FEATURE:
<221> NAME/KEY: modified_base
<222> LOCATION: (806)..(806)
<223> OTHER INFORMATION: UNA monomer
<220> FEATURE:
<221> NAME/KEY: modified_base
<222> LOCATION: (815)..(815)
<223> OTHER INFORMATION: UNA monomer
<220> FEATURE:
<221> NAME/KEY: modified_base
<222> LOCATION: (820)..(821)
<223> OTHER INFORMATION: UNA monomer
<220> FEATURE:
<221> NAME/KEY: modified_base
<222> LOCATION: (827)..(827)
<223> OTHER INFORMATION: UNA monomer
<220> FEATURE:
<221> NAME/KEY: modified_base
<222> LOCATION: (834)..(834)
<223> OTHER INFORMATION: UNA monomer
<220> FEATURE:
<221> NAME/KEY: modified_base
<222> LOCATION: (839)..(839)
<223> OTHER INFORMATION: UNA monomer
<220> FEATURE:
<221> NAME/KEY: modified_base
<222> LOCATION: (845)..(845)
<223> OTHER INFORMATION: UNA monomer
<220> FEATURE:
<221> NAME/KEY: modified_base
<222> LOCATION: (848)..(848)
<223> OTHER INFORMATION: UNA monomer
<220> FEATURE:
<221> NAME/KEY: modified_base
<222> LOCATION: (850)..(852)
<223> OTHER INFORMATION: UNA monomer
<220> FEATURE:
<221> NAME/KEY: modified_base
<222> LOCATION: (856)..(856)
<223> OTHER INFORMATION: UNA monomer
<220> FEATURE:
<221> NAME/KEY: modified_base
<222> LOCATION: (859)..(861)
<223> OTHER INFORMATION: UNA monomer <220> FEATURE:
<221> NAME/KEY: modified_base
<222> LOCATION: (863)..(863)
<223> OTHER INFORMATION: UNA monomer
<220> FEATURE:
<221> NAME/KEY: modified_base
<222> LOCATION: (881)..(881)
<223> OTHER INFORMATION: UNA monomer
<220> FEATURE:
<221> NAME/KEY: modified_base
<222> LOCATION: (885)..(885)
<223> OTHER INFORMATION: UNA monomer
<220> FEATURE:
<221> NAME/KEY: modified_base
<222> LOCATION: (890)..(890)
<223> OTHER INFORMATION: UNA monomer
<220> FEATURE:
<221> NAME/KEY: modified_base
<222> LOCATION: (897)..(897)
<223> OTHER INFORMATION: UNA monomer
<220> FEATURE:
<221> NAME/KEY: modified_base
<222> LOCATION: (900)..(900)
<223> OTHER INFORMATION: UNA monomer
<220> FEATURE:
<221> NAME/KEY: modified_base
<222> LOCATION: (902)..(902)
<223> OTHER INFORMATION: UNA monomer
<220> FEATURE:
<221> NAME/KEY: modified_base
<222> LOCATION: (906)..(906)
<223> OTHER INFORMATION: UNA monomer
<220> FEATURE:
<221> NAME/KEY: modified_base
<222> LOCATION: (923)..(923)
<223> OTHER INFORMATION: UNA monomer
<220> FEATURE:
<221> NAME/KEY: modified_base
<222> LOCATION: (929)..(929)
<223> OTHER INFORMATION: UNA monomer
<220> FEATURE:
<221> NAME/KEY: modified_base
<222> LOCATION: (932)..(932)
<223> OTHER INFORMATION: UNA monomer
<220> FEATURE:
<221> NAME/KEY: modified_base
<222> LOCATION: (941)..(942)
<223> OTHER INFORMATION: UNA monomer
<220> FEATURE:
<221> NAME/KEY: modified_base
<222> LOCATION: (959)..(959)
<223> OTHER INFORMATION: UNA monomer
<220> FEATURE:
<221> NAME/KEY: modified_base
<222> LOCATION: (967)..(969)
<223> OTHER INFORMATION: UNA monomer
<220> FEATURE:
<221> NAME/KEY: modified_base
<222> LOCATION: (972)..(972)
<223> OTHER INFORMATION: UNA monomer
<220> FEATURE:
<221> NAME/KEY: modified_base
<222> LOCATION: (977)..(977)
<223> OTHER INFORMATION: UNA monomer
<220> FEATURE:
<221> NAME/KEY: modified_base
<222> LOCATION: (980)..(980)
<223> OTHER INFORMATION: UNA monomer
<220> FEATURE:
<221> NAME/KEY: modified_base
<222> LOCATION: (986)..(986)
<223> OTHER INFORMATION: UNA monomer
<220> FEATURE:
<221> NAME/KEY: modified_base
<222> LOCATION: (998)..(998)
<223> OTHER INFORMATION: UNA monomer
<220> FEATURE:
<221> NAME/KEY: modified_base
<222> LOCATION: (1001)..(1001)

<223> OTHER INFORMATION: UNA monomer
<220> FEATURE:
<221> NAME/KEY: modified_base
<222> LOCATION: (1004)..(1004)
<223> OTHER INFORMATION: UNA monomer
<220> FEATURE:
<221> NAME/KEY: modified_base
<222> LOCATION: (1019)..(1019)
<223> OTHER INFORMATION: UNA monomer
<220> FEATURE:
<221> NAME/KEY: modified_base
<222> LOCATION: (1025)..(1025)
<223> OTHER INFORMATION: UNA monomer
<220> FEATURE:
<221> NAME/KEY: modified_base
<222> LOCATION: (1031)..(1031)
<223> OTHER INFORMATION: UNA monomer
<220> FEATURE:
<221> NAME/KEY: modified_base
<222> LOCATION: (1046)..(1049)
<223> OTHER INFORMATION: UNA monomer
<220> FEATURE:
<221> NAME/KEY: modified_base
<222> LOCATION: (1052)..(1052)
<223> OTHER INFORMATION: UNA monomer
<220> FEATURE:
<221> NAME/KEY: modified_base
<222> LOCATION: (1056)..(1056)
<223> OTHER INFORMATION: UNA monomer
<220> FEATURE:
<221> NAME/KEY: modified_base
<222> LOCATION: (1064)..(1064)
<223> OTHER INFORMATION: UNA monomer
<220> FEATURE:
<221> NAME/KEY: modified_base
<222> LOCATION: (1067)..(1067)
<223> OTHER INFORMATION: UNA monomer
<220> FEATURE:
<221> NAME/KEY: modified_base
<222> LOCATION: (1070)..(1071)
<223> OTHER INFORMATION: UNA monomer
<220> FEATURE:
<221> NAME/KEY: modified_base
<222> LOCATION: (1078)..(1078)
<223> OTHER INFORMATION: UNA monomer
<220> FEATURE:
<221> NAME/KEY: modified_base
<222> LOCATION: (1084)..(1085)
<223> OTHER INFORMATION: UNA monomer
<220> FEATURE:
<221> NAME/KEY: modified_base
<222> LOCATION: (1098)..(1098)
<223> OTHER INFORMATION: UNA monomer
<220> FEATURE:
<221> NAME/KEY: modified_base
<222> LOCATION: (1100)..(1101)
<223> OTHER INFORMATION: UNA monomer
<220> FEATURE:
<221> NAME/KEY: modified_base
<222> LOCATION: (1103)..(1103)
<223> OTHER INFORMATION: UNA monomer
<220> FEATURE:
<221> NAME/KEY: modified_base
<222> LOCATION: (1105)..(1105)
<223> OTHER INFORMATION: UNA monomer
<220> FEATURE:
<221> NAME/KEY: modified_base
<222> LOCATION: (1107)..(1107)
<223> OTHER INFORMATION: UNA monomer
<220> FEATURE:
<221> NAME/KEY: modified_base
<222> LOCATION: (1118)..(1118)
<223> OTHER INFORMATION: UNA monomer
<220> FEATURE:
<221> NAME/KEY: modified_base
<222> LOCATION: (1121)..(1121)
<223> OTHER INFORMATION: UNA monomer
<220> FEATURE:
<221> NAME/KEY: modified_base <222> LOCATION: (1130)..(1130)
<223> OTHER INFORMATION: UNA monomer
<220> FEATURE:
<221> NAME/KEY: modified_base
<222> LOCATION: (1133)..(1134)
<223> OTHER INFORMATION: UNA monomer
<220> FEATURE:
<221> NAME/KEY: modified_base
<222> LOCATION: (1170)..(1170)
<223> OTHER INFORMATION: UNA monomer
<220> FEATURE:
<221> NAME/KEY: modified_base
<222> LOCATION: (1172)..(1172)
<223> OTHER INFORMATION: UNA monomer
<220> FEATURE:
<221> NAME/KEY: modified_base
<222> LOCATION: (1179)..(1179)
<223> OTHER INFORMATION: UNA monomer
<220> FEATURE:
<221> NAME/KEY: modified_base
<222> LOCATION: (1182)..(1182)
<223> OTHER INFORMATION: UNA monomer
<220> FEATURE:
<221> NAME/KEY: modified_base
<222> LOCATION: (1184)..(1184)
<223> OTHER INFORMATION: UNA monomer
<220> FEATURE:
<221> NAME/KEY: modified_base
<222> LOCATION: (1187)..(1187)
<223> OTHER INFORMATION: UNA monomer
<220> FEATURE:
<221> NAME/KEY: modified_base
<222> LOCATION: (1191)..(1191)
<223> OTHER INFORMATION: UNA monomer
<220> FEATURE:
<221> NAME/KEY: modified_base
<222> LOCATION: (1197)..(1197)
<223> OTHER INFORMATION: UNA monomer
<220> FEATURE:
<221> NAME/KEY: modified_base
<222> LOCATION: (1201)..(1201)
<223> OTHER INFORMATION: UNA monomer
<220> FEATURE:
<221> NAME/KEY: modified_base
<222> LOCATION: (1205)..(1205)
<223> OTHER INFORMATION: UNA monomer
<220> FEATURE:
<221> NAME/KEY: modified_base
<222> LOCATION: (1208)..(1208)
<223> OTHER INFORMATION: UNA monomer
<220> FEATURE:
<221> NAME/KEY: modified_base
<222> LOCATION: (1211)..(1211)
<223> OTHER INFORMATION: UNA monomer
<220> FEATURE:
<221> NAME/KEY: modified_base
<222> LOCATION: (1213)..(1213)
<223> OTHER INFORMATION: UNA monomer
<220> FEATURE:
<221> NAME/KEY: modified_base
<222> LOCATION: (1224)..(1224)
<223> OTHER INFORMATION: UNA monomer
<220> FEATURE:
<221> NAME/KEY: modified_base
<222> LOCATION: (1237)..(1238)
<223> OTHER INFORMATION: UNA monomer
<220> FEATURE:
<221> NAME/KEY: modified_base
<222> LOCATION: (1242)..(1242)
<223> OTHER INFORMATION: UNA monomer
<220> FEATURE:
<221> NAME/KEY: modified_base
<222> LOCATION: (1244)..(1244)
<223> OTHER INFORMATION: UNA monomer
<220> FEATURE:
<221> NAME/KEY: modified_base
<222> LOCATION: (1253)..(1253)
<223> OTHER INFORMATION: UNA monomer
<220> FEATURE:

<221> NAME/KEY: modified_base
<222> LOCATION: (1259)..(1259)
<223> OTHER INFORMATION: UNA monomer
<220> FEATURE:
<221> NAME/KEY: modified_base
<222> LOCATION: (1266)..(1266)
<223> OTHER INFORMATION: UNA monomer
<220> FEATURE:
<221> NAME/KEY: modified_base
<222> LOCATION: (1271)..(1272)
<223> OTHER INFORMATION: UNA monomer
<220> FEATURE:
<221> NAME/KEY: modified_base
<222> LOCATION: (1295)..(1295)
<223> OTHER INFORMATION: UNA monomer
<220> FEATURE:
<221> NAME/KEY: modified_base
<222> LOCATION: (1297)..(1297)
<223> OTHER INFORMATION: UNA monomer
<220> FEATURE:
<221> NAME/KEY: modified_base
<222> LOCATION: (1310)..(1310)
<223> OTHER INFORMATION: UNA monomer
<220> FEATURE:
<221> NAME/KEY: modified_base
<222> LOCATION: (1312)..(1314)
<223> OTHER INFORMATION: UNA monomer
<220> FEATURE:
<221> NAME/KEY: modified_base
<222> LOCATION: (1322)..(1322)
<223> OTHER INFORMATION: UNA monomer
<220> FEATURE:
<221> NAME/KEY: modified_base
<222> LOCATION: (1326)..(1326)
<223> OTHER INFORMATION: UNA monomer
<220> FEATURE:
<221> NAME/KEY: modified_base
<222> LOCATION: (1340)..(1340)
<223> OTHER INFORMATION: UNA monomer
<220> FEATURE:
<221> NAME/KEY: modified_base
<222> LOCATION: (1347)..(1347)
<223> OTHER INFORMATION: UNA monomer
<220> FEATURE:
<221> NAME/KEY: modified_base
<222> LOCATION: (1350)..(1350)
<223> OTHER INFORMATION: UNA monomer
<220> FEATURE:
<221> NAME/KEY: modified_base
<222> LOCATION: (1356)..(1356)
<223> OTHER INFORMATION: UNA monomer
<220> FEATURE:
<221> NAME/KEY: modified_base
<222> LOCATION: (1361)..(1361)
<223> OTHER INFORMATION: UNA monomer
<220> FEATURE:
<221> NAME/KEY: modified_base
<222> LOCATION: (1370)..(1371)
<223> OTHER INFORMATION: UNA monomer
<220> FEATURE:
<221> NAME/KEY: modified_base
<222> LOCATION: (1374)..(1374)
<223> OTHER INFORMATION: UNA monomer
<220> FEATURE:
<221> NAME/KEY: modified_base
<222> LOCATION: (1377)..(1377)
<223> OTHER INFORMATION: UNA monomer
<220> FEATURE:
<221> NAME/KEY: modified_base
<222> LOCATION: (1379)..(1379)
<223> OTHER INFORMATION: UNA monomer
<220> FEATURE:
<221> NAME/KEY: modified_base
<222> LOCATION: (1386)..(1386)
<223> OTHER INFORMATION: UNA monomer
<220> FEATURE:
<221> NAME/KEY: modified_base
<222> LOCATION: (1390)..(1391)
<223> OTHER INFORMATION: UNA monomer <220> FEATURE:
<221> NAME/KEY: modified_base
<222> LOCATION: (1396)..(1396)
<223> OTHER INFORMATION: UNA monomer
<220> FEATURE:
<221> NAME/KEY: modified_base
<222> LOCATION: (1399)..(1399)
<223> OTHER INFORMATION: UNA monomer
<220> FEATURE:
<221> NAME/KEY: modified_base
<222> LOCATION: (1401)..(1401)
<223> OTHER INFORMATION: UNA monomer
<220> FEATURE:
<221> NAME/KEY: modified_base
<222> LOCATION: (1404)..(1404)
<223> OTHER INFORMATION: UNA monomer
<220> FEATURE:
<221> NAME/KEY: modified_base
<222> LOCATION: (1407)..(1407)
<223> OTHER INFORMATION: UNA monomer
<220> FEATURE:
<221> NAME/KEY: modified_base
<222> LOCATION: (1412)..(1412)
<223> OTHER INFORMATION: UNA monomer
<220> FEATURE:
<221> NAME/KEY: modified_base
<222> LOCATION: (1415)..(1416)
<223> OTHER INFORMATION: UNA monomer
<220> FEATURE:
<221> NAME/KEY: modified_base
<222> LOCATION: (1418)..(1418)
<223> OTHER INFORMATION: UNA monomer
<220> FEATURE:
<221> NAME/KEY: modified_base
<222> LOCATION: (1421)..(1421)
<223> OTHER INFORMATION: UNA monomer
<220> FEATURE:
<221> NAME/KEY: modified_base
<222> LOCATION: (1431)..(1431)
<223> OTHER INFORMATION: UNA monomer
<220> FEATURE:
<221> NAME/KEY: modified_base
<222> LOCATION: (1438)..(1438)
<223> OTHER INFORMATION: UNA monomer
<220> FEATURE:
<221> NAME/KEY: modified_base
<222> LOCATION: (1448)..(1449)
<223> OTHER INFORMATION: UNA monomer
<220> FEATURE:
<221> NAME/KEY: modified_base
<222> LOCATION: (1451)..(1451)
<223> OTHER INFORMATION: UNA monomer
<220> FEATURE:
<221> NAME/KEY: modified_base
<222> LOCATION: (1453)..(1453)
<223> OTHER INFORMATION: UNA monomer
<220> FEATURE:
<221> NAME/KEY: modified_base
<222> LOCATION: (1455)..(1455)
<223> OTHER INFORMATION: UNA monomer
<220> FEATURE:
<221> NAME/KEY: modified_base
<222> LOCATION: (1459)..(1459)
<223> OTHER INFORMATION: UNA monomer
<220> FEATURE:
<221> NAME/KEY: modified_base
<222> LOCATION: (1467)..(1467)
<223> OTHER INFORMATION: UNA monomer
<220> FEATURE:
<221> NAME/KEY: modified_base
<222> LOCATION: (1478)..(1478)
<223> OTHER INFORMATION: UNA monomer
<220> FEATURE:
<221> NAME/KEY: modified_base
<222> LOCATION: (1481)..(1482)
<223> OTHER INFORMATION: UNA monomer
<220> FEATURE:
<221> NAME/KEY: modified_base
<222> LOCATION: (1485)..(1485)

<223> OTHER INFORMATION: UNA monomer
<220> FEATURE:
<221> NAME/KEY: modified_base
<222> LOCATION: (1487)..(1487)
<223> OTHER INFORMATION: UNA monomer
<220> FEATURE:
<221> NAME/KEY: modified_base
<222> LOCATION: (1495)..(1495)
<223> OTHER INFORMATION: UNA monomer
<220> FEATURE:
<221> NAME/KEY: modified_base
<222> LOCATION: (1497)..(1497)
<223> OTHER INFORMATION: UNA monomer
<220> FEATURE:
<221> NAME/KEY: modified_base
<222> LOCATION: (1506)..(1506)
<223> OTHER INFORMATION: UNA monomer
<220> FEATURE:
<221> NAME/KEY: modified_base
<222> LOCATION: (1517)..(1517)
<223> OTHER INFORMATION: UNA monomer
<220> FEATURE:
<221> NAME/KEY: modified_base
<222> LOCATION: (1522)..(1523)
<223> OTHER INFORMATION: UNA monomer
<220> FEATURE:
<221> NAME/KEY: modified_base
<222> LOCATION: (1525)..(1525)
<223> OTHER INFORMATION: UNA monomer
<220> FEATURE:
<221> NAME/KEY: modified_base
<222> LOCATION: (1535)..(1535)
<223> OTHER INFORMATION: UNA monomer
<220> FEATURE:
<221> NAME/KEY: modified_base
<222> LOCATION: (1537)..(1538)
<223> OTHER INFORMATION: UNA monomer
<220> FEATURE:
<221> NAME/KEY: modified_base
<222> LOCATION: (1543)..(1544)
<223> OTHER INFORMATION: UNA monomer
<220> FEATURE:
<221> NAME/KEY: modified_base
<222> LOCATION: (1547)..(1549)
<223> OTHER INFORMATION: UNA monomer
<220> FEATURE:
<221> NAME/KEY: modified_base
<222> LOCATION: (1554)..(1554)
<223> OTHER INFORMATION: UNA monomer
<220> FEATURE:
<221> NAME/KEY: modified_base
<222> LOCATION: (1560)..(1560)
<223> OTHER INFORMATION: UNA monomer
<220> FEATURE:
<221> NAME/KEY: modified_base
<222> LOCATION: (1571)..(1571)
<223> OTHER INFORMATION: UNA monomer
<220> FEATURE:
<221> NAME/KEY: modified_base
<222> LOCATION: (1573)..(1573)
<223> OTHER INFORMATION: UNA monomer
<220> FEATURE:
<221> NAME/KEY: modified_base
<222> LOCATION: (1581)..(1581)
<223> OTHER INFORMATION: UNA monomer
<220> FEATURE:
<221> NAME/KEY: modified_base
<222> LOCATION: (1584)..(1584)
<223> OTHER INFORMATION: UNA monomer
<220> FEATURE:
<221> NAME/KEY: modified_base
<222> LOCATION: (1586)..(1586)
<223> OTHER INFORMATION: UNA monomer
<220> FEATURE:
<221> NAME/KEY: modified_base
<222> LOCATION: (1590)..(1590)
<223> OTHER INFORMATION: UNA monomer
<220> FEATURE:
<221> NAME/KEY: modified_base <222> LOCATION: (1598)..(1598)
<223> OTHER INFORMATION: UNA monomer
<220> FEATURE:
<221> NAME/KEY: modified_base
<222> LOCATION: (1603)..(1605)
<223> OTHER INFORMATION: UNA monomer
<220> FEATURE:
<221> NAME/KEY: modified_base
<222> LOCATION: (1610)..(1611)
<223> OTHER INFORMATION: UNA monomer
<220> FEATURE:
<221> NAME/KEY: modified_base
<222> LOCATION: (1617)..(1617)
<223> OTHER INFORMATION: UNA monomer
<220> FEATURE:
<221> NAME/KEY: modified_base
<222> LOCATION: (1625)..(1625)
<223> OTHER INFORMATION: UNA monomer
<220> FEATURE:
<221> NAME/KEY: modified_base
<222> LOCATION: (1629)..(1629)
<223> OTHER INFORMATION: UNA monomer
<220> FEATURE:
<221> NAME/KEY: modified_base
<222> LOCATION: (1633)..(1634)
<223> OTHER INFORMATION: UNA monomer
<220> FEATURE:
<221> NAME/KEY: modified_base
<222> LOCATION: (1637)..(1637)
<223> OTHER INFORMATION: UNA monomer
<220> FEATURE:
<221> NAME/KEY: modified_base
<222> LOCATION: (1641)..(1641)
<223> OTHER INFORMATION: UNA monomer
<220> FEATURE:
<221> NAME/KEY: modified_base
<222> LOCATION: (1643)..(1644)
<223> OTHER INFORMATION: UNA monomer
<220> FEATURE:
<221> NAME/KEY: modified_base
<222> LOCATION: (1652)..(1652)
<223> OTHER INFORMATION: UNA monomer
<220> FEATURE:
<221> NAME/KEY: modified_base
<222> LOCATION: (1655)..(1655)
<223> OTHER INFORMATION: UNA monomer
<220> FEATURE:
<221> NAME/KEY: modified_base
<222> LOCATION: (1658)..(1659)
<223> OTHER INFORMATION: UNA monomer
<220> FEATURE:
<221> NAME/KEY: modified_base
<222> LOCATION: (1661)..(1661)
<223> OTHER INFORMATION: UNA monomer
<220> FEATURE:
<221> NAME/KEY: modified_base
<222> LOCATION: (1664)..(1664)
<223> OTHER INFORMATION: UNA monomer
<220> FEATURE:
<221> NAME/KEY: modified_base
<222> LOCATION: (1672)..(1672)
<223> OTHER INFORMATION: UNA monomer
<220> FEATURE:
<221> NAME/KEY: modified_base
<222> LOCATION: (1680)..(1680)
<223> OTHER INFORMATION: UNA monomer
<220> FEATURE:
<221> NAME/KEY: modified_base
<222> LOCATION: (1684)..(1684)
<223> OTHER INFORMATION: UNA monomer
<220> FEATURE:
<221> NAME/KEY: modified_base
<222> LOCATION: (1690)..(1690)
<223> OTHER INFORMATION: UNA monomer
<220> FEATURE:
<221> NAME/KEY: modified_base
<222> LOCATION: (1700)..(1700)
<223> OTHER INFORMATION: UNA monomer
<220> FEATURE:

<221> NAME/KEY: modified_base
<222> LOCATION: (1703)..(1703)
<223> OTHER INFORMATION: UNA monomer
<220> FEATURE:
<221> NAME/KEY: modified_base
<222> LOCATION: (1709)..(1709)
<223> OTHER INFORMATION: UNA monomer
<220> FEATURE:
<221> NAME/KEY: modified_base
<222> LOCATION: (1712)..(1712)
<223> OTHER INFORMATION: UNA monomer
<220> FEATURE:
<221> NAME/KEY: modified_base
<222> LOCATION: (1718)..(1718)
<223> OTHER INFORMATION: UNA monomer
<220> FEATURE:
<221> NAME/KEY: modified_base
<222> LOCATION: (1720)..(1720)
<223> OTHER INFORMATION: UNA monomer
<220> FEATURE:
<221> NAME/KEY: modified_base
<222> LOCATION: (1723)..(1723)
<223> OTHER INFORMATION: UNA monomer

<400> SEQUENCE: 155 augucgaucc aggagaacau aucaucccug cagcuucggu caugggucuc uaagucccaa 60 agagacuuag caaaguccau ccugauuggg gcuccaggag ggccagcggg guaucugcgg 120 cgggccagug uggcccaacu gacccaggag cugggcacug ccuucuucca gcagcagcag 180 cugccagcug cuauggcaga caccuuccug gaacaccucu gccuacugga cauugacucc 240 gagcccgugg cugcucgcag uaccagcauc auugccacca ucgggccagc aucucgcucc 300 guggagcgcc ucaaggagau gaucaaggcc gggaugaaca uugcgcgacu caacuucucc 360 cacggcuccc acgaguacca ugcugagucc aucgccaacg uccgggaggc gguggagagc 420 uuugcagguu ccccacucag cuaccggccc guggccaucg cccuggacac caagggaccg 480 gagauccgca cugggauccu gcagggggu ccagagucgg aaguggagcu ggugaagggc 540 ucccaggugc uggugacugu ggaccccgcg uuccggacgc gggggaacgc gaacaccgug 600 ugggugggacu accccaauau uguccggguc gugccggugg ggggccgcau cuacauugac 660 gacgggcuca ucucccuagu gguccagaaa aucggcccag agggacuggu gacccaagug 720 gagaacggcg gcguccuggg cagccggaag ggcgugaacu ugccaggggc ccagguggac 780 uugcccgggc uguccgagca ggacguccga gaccugcgcu ucggggugga gcaugggggug 840 gacaucgucu uugccuccuu ugugcggaaa gccagcgacg uggcugccgu cagggcugcu 900 cuggguccgg aaggacacgg caucaagauc aucagcaaaa uugagaacca cgaaggcgug 960 aagagguuug augaaauccu ggaggugagc gacggcauca ugguggcacg gggggaccua 1020 ggcaucgaga ucccagcaga gaagguuuuc cuggcucaga agaugaugau ugggcgcugc 1080 aacuuggcgg gcaagccugu ugucugugcc acacagaugc uggagagcau gauuaccaag 1140 ccccggccaa cgagggcaga gacaagcgau gucgccaaug cugugcugga uggggcugac 1200 ugcaucaugc ugucagggga gacugccaag ggcaacuucc cuguggaagc ggugaagaug 1260 cagcaugcga uugcccggga ggcagaggcc gcaguguacc accggcagcu guuugaggag 1320 cuacgucggg cagcgccacu aagccgugau cccacugagg ucaccgccau uggugcugug 1380 gaggcugccu ucaagugcug ugcugcugcc aucauugugc ugaccacaac uggccgcuca 1440 gcccagcuuc ugucucggua ccgaccucgg gcagcaguca uugcugucac ccgcucugcc 1500 caggcugccc gccaggucca cuuaugccga ggagucuucc ccuugcuuua ccgugaaccu 1560 ccagaagcca ucugggcaga ugauguagau cgccgggugc aauuuggcau ugaaagugga 1620 aagcuccgug gcuuccuccg uguuggagac cuggugauug uggugacagg cuggcgaccu 1680 ggcuccggcu acaccaacau caugcgggug cuaagcauau ccuga 1725

<210> SEQ ID NO 156
<211> LENGTH: 1359
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (1356)..(1358)
<223> OTHER INFORMATION: UNA monomer

<400> SEQUENCE: 156 auguccacug cgguccugga aaacccaggc uugggcagga aacucucuga cuuuggacag 60 gaaacaagcu auauugaaga caacugcaau caaaauggug ccauaucacu gaucuucuca 120 cucaaagaag aaguuggugc auuggccaaa guauugcgcu uauuugagga gaaugaugua 180 aaccugaccc acauugaauc uagaccuucu cguuuaaaga aagaugagua ugaauuuuuc 240 acccauuugg auaaacguag ccugccugcu cugacaaaca ucaucaagau cuugaggcau 300 gacauuggug ccacugucca ugagcuuuca cgagauaaga agaaagacac agugcccugg 360 uucccaagaa ccauucaaga gcuggacaga uuugccaauc agauucucag cuauggagcg 420 gaacuggaug cugaccaccc ugguuuuaaa gauccugugu accgugcaag acggaagcag 480 uuugcugaca uugccuacaa cuaccgccau gggcagccca ucccucgagu ggaauacaug 540 gaggaagaaa agaaaacaug gggcacagug uucaagacuc ugaaguccuu guauaaaacc 600 caugcuugcu augaguacaa ucacauuuuu ccacuucuug aaaaguacug uggcuuccau 660 gaagauaaca uuccccagcu ggaagacguu ucucaauucc ugcagacuug cacugguuuc 720 cgccuccgac cuguggcugg ccugcuuucc ucucgggauu ucuuggugug ccuggccuuc 780 cgagucuucc acugcacaca guacaucaga cauggaucca agcccaugua uacccccgaa 840 ccugacaucu gccaugagcu guuggggacau gugcccuugu uuucagaucg cagcuuugcc 900 caguuuuccc aggaaauugg ccuugccucu cugggugcac cugaugaaua cauugaaaag 960 cucgccacaa uuuacugguu uacuguggag uuugggcucu gcaaacaagg agacuccaua 1020 aaggcauaug gugcugggcu ccugucaucc uuuggugaau uacaguacug cuuaucagag 1080 aagccaaagc uucucccccu ggagcuggag aagacagcca uccaaaauua cacugucacg 1140 gaguuccagc cccuguauua cguggcagag aguuuuaaug augccaagga gaaaguaagg 1200 aacuuugcug ccacaauacc ucggcccuuc ucaguucgcu acgacccaua cacccaaagg 1260 auugaggucu uggacaauac ccagcagcuu aagauuuugg cugauuccau uaacagugaa 1320 auuggaaucc uuugcagugc ccuccagaaa auaaaguaa 1359

<210> SEQ ID NO 157
<211> LENGTH: 1360
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:

<221> NAME/KEY: modified_base
<222> LOCATION: (3)..(3)
<223> OTHER INFORMATION: UNA monomer
<220> FEATURE:
<221> NAME/KEY: modified_base
<222> LOCATION: (21)..(21)
<223> OTHER INFORMATION: UNA monomer
<220> FEATURE:
<221> NAME/KEY: modified_base
<222> LOCATION: (39)..(39)
<223> OTHER INFORMATION: UNA monomer
<220> FEATURE:
<221> NAME/KEY: modified_base
<222> LOCATION: (57)..(57)
<223> OTHER INFORMATION: UNA monomer
<220> FEATURE:
<221> NAME/KEY: modified_base
<222> LOCATION: (75)..(75)
<223> OTHER INFORMATION: UNA monomer
<220> FEATURE:
<221> NAME/KEY: modified_base
<222> LOCATION: (93)..(93)
<223> OTHER INFORMATION: UNA monomer
<220> FEATURE:
<221> NAME/KEY: modified_base
<222> LOCATION: (111)..(111)
<223> OTHER INFORMATION: UNA monomer
<220> FEATURE:
<221> NAME/KEY: modified_base
<222> LOCATION: (129)..(129)
<223> OTHER INFORMATION: UNA monomer
<220> FEATURE:
<221> NAME/KEY: modified_base
<222> LOCATION: (147)..(147)
<223> OTHER INFORMATION: UNA monomer
<220> FEATURE:
<221> NAME/KEY: modified_base
<222> LOCATION: (165)..(165)
<223> OTHER INFORMATION: UNA monomer
<220> FEATURE:
<221> NAME/KEY: modified_base
<222> LOCATION: (183)..(183)
<223> OTHER INFORMATION: UNA monomer
<220> FEATURE:
<221> NAME/KEY: modified_base
<222> LOCATION: (201)..(201)
<223> OTHER INFORMATION: UNA monomer
<220> FEATURE:
<221> NAME/KEY: modified_base
<222> LOCATION: (219)..(219)
<223> OTHER INFORMATION: UNA monomer
<220> FEATURE:
<221> NAME/KEY: modified_base
<222> LOCATION: (237)..(237)
<223> OTHER INFORMATION: UNA monomer
<220> FEATURE:
<221> NAME/KEY: modified_base
<222> LOCATION: (255)..(255)
<223> OTHER INFORMATION: UNA monomer
<220> FEATURE:
<221> NAME/KEY: modified_base
<222> LOCATION: (273)..(273)
<223> OTHER INFORMATION: UNA monomer
<220> FEATURE:
<221> NAME/KEY: modified_base
<222> LOCATION: (291)..(291)
<223> OTHER INFORMATION: UNA monomer
<220> FEATURE:
<221> NAME/KEY: modified_base
<222> LOCATION: (309)..(309)
<223> OTHER INFORMATION: UNA monomer
<220> FEATURE:
<221> NAME/KEY: modified_base
<222> LOCATION: (327)..(327)
<223> OTHER INFORMATION: UNA monomer
<220> FEATURE:
<221> NAME/KEY: modified_base
<222> LOCATION: (345)..(345)
<223> OTHER INFORMATION: UNA monomer <220> FEATURE:
<221> NAME/KEY: modified_base
<222> LOCATION: (363)..(363)
<223> OTHER INFORMATION: UNA monomer
<220> FEATURE:
<221> NAME/KEY: modified_base
<222> LOCATION: (381)..(381)
<223> OTHER INFORMATION: UNA monomer
<220> FEATURE:
<221> NAME/KEY: modified_base
<222> LOCATION: (399)..(399)
<223> OTHER INFORMATION: UNA monomer
<220> FEATURE:
<221> NAME/KEY: modified_base
<222> LOCATION: (417)..(417)
<223> OTHER INFORMATION: UNA monomer
<220> FEATURE:
<221> NAME/KEY: modified_base
<222> LOCATION: (435)..(435)
<223> OTHER INFORMATION: UNA monomer
<220> FEATURE:
<221> NAME/KEY: modified_base
<222> LOCATION: (453)..(453)
<223> OTHER INFORMATION: UNA monomer
<220> FEATURE:
<221> NAME/KEY: modified_base
<222> LOCATION: (471)..(471)
<223> OTHER INFORMATION: UNA monomer
<220> FEATURE:
<221> NAME/KEY: modified_base
<222> LOCATION: (489)..(489)
<223> OTHER INFORMATION: UNA monomer
<220> FEATURE:
<221> NAME/KEY: modified_base
<222> LOCATION: (507)..(507)
<223> OTHER INFORMATION: UNA monomer
<220> FEATURE:
<221> NAME/KEY: modified_base
<222> LOCATION: (525)..(525)
<223> OTHER INFORMATION: UNA monomer
<220> FEATURE:
<221> NAME/KEY: modified_base
<222> LOCATION: (579)..(579)
<223> OTHER INFORMATION: UNA monomer
<220> FEATURE:
<221> NAME/KEY: modified_base
<222> LOCATION: (597)..(597)
<223> OTHER INFORMATION: UNA monomer
<220> FEATURE:
<221> NAME/KEY: modified_base
<222> LOCATION: (615)..(615)
<223> OTHER INFORMATION: UNA monomer
<220> FEATURE:
<221> NAME/KEY: modified_base
<222> LOCATION: (633)..(633)
<223> OTHER INFORMATION: UNA monomer
<220> FEATURE:
<221> NAME/KEY: modified_base
<222> LOCATION: (651)..(651)
<223> OTHER INFORMATION: UNA monomer
<220> FEATURE:
<221> NAME/KEY: modified_base
<222> LOCATION: (669)..(669)
<223> OTHER INFORMATION: UNA monomer
<220> FEATURE:
<221> NAME/KEY: modified_base
<222> LOCATION: (687)..(687)
<223> OTHER INFORMATION: UNA monomer
<220> FEATURE:
<221> NAME/KEY: modified_base
<222> LOCATION: (705)..(705)
<223> OTHER INFORMATION: UNA monomer
<220> FEATURE:
<221> NAME/KEY: modified_base
<222> LOCATION: (723)..(723)
<223> OTHER INFORMATION: UNA monomer
<220> FEATURE:
<221> NAME/KEY: modified_base
<222> LOCATION: (741)..(741)

<223> OTHER INFORMATION: UNA monomer
<220> FEATURE:
<221> NAME/KEY: modified_base
<222> LOCATION: (759)..(759)
<223> OTHER INFORMATION: UNA monomer
<220> FEATURE:
<221> NAME/KEY: modified_base
<222> LOCATION: (777)..(777)
<223> OTHER INFORMATION: UNA monomer
<220> FEATURE:
<221> NAME/KEY: modified_base
<222> LOCATION: (795)..(795)
<223> OTHER INFORMATION: UNA monomer
<220> FEATURE:
<221> NAME/KEY: modified_base
<222> LOCATION: (813)..(813)
<223> OTHER INFORMATION: UNA monomer
<220> FEATURE:
<221> NAME/KEY: modified_base
<222> LOCATION: (831)..(831)
<223> OTHER INFORMATION: UNA monomer
<220> FEATURE:
<221> NAME/KEY: modified_base
<222> LOCATION: (849)..(849)
<223> OTHER INFORMATION: UNA monomer
<220> FEATURE:
<221> NAME/KEY: modified_base
<222> LOCATION: (867)..(867)
<223> OTHER INFORMATION: UNA monomer
<220> FEATURE:
<221> NAME/KEY: modified_base
<222> LOCATION: (885)..(885)
<223> OTHER INFORMATION: UNA monomer
<220> FEATURE:
<221> NAME/KEY: modified_base
<222> LOCATION: (903)..(903)
<223> OTHER INFORMATION: UNA monomer
<220> FEATURE:
<221> NAME/KEY: modified_base
<222> LOCATION: (921)..(921)
<223> OTHER INFORMATION: UNA monomer
<220> FEATURE:
<221> NAME/KEY: modified_base
<222> LOCATION: (939)..(939)
<223> OTHER INFORMATION: UNA monomer
<220> FEATURE:
<221> NAME/KEY: modified_base
<222> LOCATION: (957)..(957)
<223> OTHER INFORMATION: UNA monomer
<220> FEATURE:
<221> NAME/KEY: modified_base
<222> LOCATION: (975)..(975)
<223> OTHER INFORMATION: UNA monomer
<220> FEATURE:
<221> NAME/KEY: modified_base
<222> LOCATION: (993)..(993)
<223> OTHER INFORMATION: UNA monomer
<220> FEATURE:
<221> NAME/KEY: modified_base
<222> LOCATION: (1011)..(1011)
<223> OTHER INFORMATION: UNA monomer
<220> FEATURE:
<221> NAME/KEY: modified_base
<222> LOCATION: (1029)..(1029)
<223> OTHER INFORMATION: UNA monomer
<220> FEATURE:
<221> NAME/KEY: modified_base
<222> LOCATION: (1047)..(1047)
<223> OTHER INFORMATION: UNA monomer
<220> FEATURE:
<221> NAME/KEY: modified_base
<222> LOCATION: (1065)..(1065)
<223> OTHER INFORMATION: UNA monomer
<220> FEATURE:
<221> NAME/KEY: modified_base
<222> LOCATION: (1083)..(1083)
<223> OTHER INFORMATION: UNA monomer
<220> FEATURE:
<221> NAME/KEY: modified_base <222> LOCATION: (1101)..(1101)
<223> OTHER INFORMATION: UNA monomer
<220> FEATURE:
<221> NAME/KEY: modified_base
<222> LOCATION: (1119)..(1119)
<223> OTHER INFORMATION: UNA monomer
<220> FEATURE:
<221> NAME/KEY: modified_base
<222> LOCATION: (1137)..(1137)
<223> OTHER INFORMATION: UNA monomer
<220> FEATURE:
<221> NAME/KEY: modified_base
<222> LOCATION: (1155)..(1155)
<223> OTHER INFORMATION: UNA monomer
<220> FEATURE:
<221> NAME/KEY: modified_base
<222> LOCATION: (1173)..(1173)
<223> OTHER INFORMATION: UNA monomer
<220> FEATURE:
<221> NAME/KEY: modified_base
<222> LOCATION: (1191)..(1191)
<223> OTHER INFORMATION: UNA monomer
<220> FEATURE:
<221> NAME/KEY: modified_base
<222> LOCATION: (1209)..(1209)
<223> OTHER INFORMATION: UNA monomer
<220> FEATURE:
<221> NAME/KEY: modified_base
<222> LOCATION: (1227)..(1227)
<223> OTHER INFORMATION: UNA monomer
<220> FEATURE:
<221> NAME/KEY: modified_base
<222> LOCATION: (1245)..(1245)
<223> OTHER INFORMATION: UNA monomer
<220> FEATURE:
<221> NAME/KEY: modified_base
<222> LOCATION: (1263)..(1263)
<223> OTHER INFORMATION: UNA monomer
<220> FEATURE:
<221> NAME/KEY: modified_base
<222> LOCATION: (1281)..(1281)
<223> OTHER INFORMATION: UNA monomer
<220> FEATURE:
<221> NAME/KEY: modified_base
<222> LOCATION: (1299)..(1299)
<223> OTHER INFORMATION: UNA monomer
<220> FEATURE:
<221> NAME/KEY: modified_base
<222> LOCATION: (1317)..(1317)
<223> OTHER INFORMATION: UNA monomer
<220> FEATURE:
<221> NAME/KEY: modified_base
<222> LOCATION: (1335)..(1335)
<223> OTHER INFORMATION: UNA monomer
<220> FEATURE:
<221> NAME/KEY: modified_base
<222> LOCATION: (1353)..(1353)
<223> OTHER INFORMATION: UNA monomer
<220> FEATURE:
<221> NAME/KEY: modified_base
<222> LOCATION: (1359)..(1359)
<223> OTHER INFORMATION: UNA monomer

<400> SEQUENCE: 157 auguccacug cgguccugga aaacccaggc uugggcagga aacucucuga cuuuggacag 60 gaaacaagcu auauugaaga caacugcaau caaaauggug ccauaucacu gaucuucuca 120 cucaaagaag aaguuggugc auuggccaaa guauugcgcu uauuugagga gaaugaugua 180 aaccugaccc acauugaauc uagaccuucu cguuuaaaga aagaugagua ugaauuuuuc 240 acccauuugg auaaacguag ccugccugcu cugacaaaca ucaucaagau cuugaggcau 300 gacauuggug ccacugucca ugagcuuuca cgagauaaga agaaagacac agugcccugg 360 uucccaagaa ccauucaaga gcuggacaga uuugccaauc agauucucag cuauggagcg 420

```
gaacuggaug cugaccaccc ugguuuuaaa gauccugugu accgugcaag acggaagcag    480

uuugcugaca uugccuacaa cuaccgccau gggcagccca ucccucgagu ggaauacaug    540

gaggaagaaa agaaaacaug gggcacagug uucaagacuc ugaaguccuu guauaaaacc    600

caugcuugcu augaguacaa ucacauuuuu ccacuucuug aaaaguacug uggcuuccau    660

gaagauaaca uuccccagcu ggaagacguu ucucaauucc ugcagacuug cacugguuuc    720

cgccuccgac cuguggcugg ccugcuuucc ucucgggauu ucuugggugg ccuggccuuc    780

cgagucuucc acugcacaca guacaucaga cauggaucca agcccaugua uacccccgaa    840

ccugacaucu gccaugagcu guugggacau gugcccuugu uuucagaucg cagcuuugcc    900

caguuuuccc aggaaauugg ccuugccucu cugggugcac cugaugaaua cauugaaaag    960

cucgccacaa uuuacugguu uacuguggag uuugggcucu gcaaacaagg agacuccaua   1020

aaggcauaug gugcugggcu ccugucaucc uuuggugaau uacaguacug cuuaucagag   1080

aagccaaagc uucucccccu ggagcuggag aagacagcca uccaaaauua cacugucacg   1140

gaguuccagc cccuguauua cguggcagag aguuuuaaug augccaagga ggaaaguaag   1200

gaacuuugcu gccacaauac cucggcccuu cucaguucgc uacgacccau acacccaaag   1260

gauugagguc uuggacaaua cccagcagcu uaagauuuug gcugauucca uuaacaguga   1320

aauuggaauc cuuugcagug cccuccagaa aauaaaguaa                         1360
```

```
<210> SEQ ID NO 158
<211> LENGTH: 1359
<212> TYPE: RNA
<213> ORGANISM: Artificial Sequence
<220> FEATURE:
<223> OTHER INFORMATION: Description of Artificial Sequence: Synthetic
      polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (4)..(4)
<223> OTHER INFORMATION: UNA monomer
<220> FEATURE:
<221> NAME/KEY: modified_base
<222> LOCATION: (9)..(9)
<223> OTHER INFORMATION: UNA monomer
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (17)..(17)
<223> OTHER INFORMATION: UNA monomer
<220> FEATURE:
<221> NAME/KEY: modified_base
<222> LOCATION: (31)..(32)
<223> OTHER INFORMATION: UNA monomer
<220> FEATURE:
<221> NAME/KEY: modified_base
<222> LOCATION: (44)..(44)
<223> OTHER INFORMATION: UNA monomer
<220> FEATURE:
<221> NAME/KEY: modified_base
<222> LOCATION: (46)..(46)
<223> OTHER INFORMATION: UNA monomer
<220> FEATURE:
<221> NAME/KEY: modified_base
<222> LOCATION: (48)..(48)
<223> OTHER INFORMATION: UNA monomer
<220> FEATURE:
<221> NAME/KEY: modified_base
<222> LOCATION: (52)..(54)
```

<223> OTHER INFORMATION: UNA monomer
<220> FEATURE:
<221> NAME/KEY: modified_base
<222> LOCATION: (70)..(70)
<223> OTHER INFORMATION: UNA monomer
<220> FEATURE:
<221> NAME/KEY: modified_base
<222> LOCATION: (72)..(72)
<223> OTHER INFORMATION: UNA monomer
<220> FEATURE:
<221> NAME/KEY: modified_base
<222> LOCATION: (74)..(75)
<223> OTHER INFORMATION: UNA monomer
<220> FEATURE:
<221> NAME/KEY: modified_base
<222> LOCATION: (85)..(85)
<223> OTHER INFORMATION: UNA monomer
<220> FEATURE:
<221> NAME/KEY: modified_base
<222> LOCATION: (90)..(90)
<223> OTHER INFORMATION: UNA monomer
<220> FEATURE:
<221> NAME/KEY: modified_base
<222> LOCATION: (96)..(96)
<223> OTHER INFORMATION: UNA monomer
<220> FEATURE:
<221> NAME/KEY: modified_base
<222> LOCATION: (99)..(99)
<223> OTHER INFORMATION: UNA monomer
<220> FEATURE:
<221> NAME/KEY: modified_base
<222> LOCATION: (104)..(104)
<223> OTHER INFORMATION: UNA monomer
<220> FEATURE:
<221> NAME/KEY: modified_base
<222> LOCATION: (106)..(106)
<223> OTHER INFORMATION: UNA monomer
<220> FEATURE:
<221> NAME/KEY: modified_base
<222> LOCATION: (110)..(110)
<223> OTHER INFORMATION: UNA monomer
<220> FEATURE:
<221> NAME/KEY: modified_base
<222> LOCATION: (113)..(113)
<223> OTHER INFORMATION: UNA monomer
<220> FEATURE:
<221> NAME/KEY: modified_base
<222> LOCATION: (115)..(116)
<223> OTHER INFORMATION: UNA monomer
<220> FEATURE:
<221> NAME/KEY: modified_base
<222> LOCATION: (118)..(118)
<223> OTHER INFORMATION: UNA monomer
<220> FEATURE:
<221> NAME/KEY: modified_base
<222> LOCATION: (122)..(122)
<223> OTHER INFORMATION: UNA monomer
<220> FEATURE:
<221> NAME/KEY: modified_base
<222> LOCATION: (134)..(135)
<223> OTHER INFORMATION: UNA monomer
<220> FEATURE:
<221> NAME/KEY: modified_base
<222> LOCATION: (138)..(138)
<223> OTHER INFORMATION: UNA monomer
<220> FEATURE:
<221> NAME/KEY: modified_base
<222> LOCATION: (142)..(143)
<223> OTHER INFORMATION: UNA monomer
<220> FEATURE:
<221> NAME/KEY: modified_base
<222> LOCATION: (152)..(152)
<223> OTHER INFORMATION: UNA monomer
<220> FEATURE:
<221> NAME/KEY: modified_base
<222> LOCATION: (154)..(155)
<223> OTHER INFORMATION: UNA monomer
<220> FEATURE:
<221> NAME/KEY: modified_base <222> LOCATION: (160)..(161)
<223> OTHER INFORMATION: UNA monomer
<220> FEATURE:
<221> NAME/KEY: modified_base
<222> LOCATION: (163)..(165)
<223> OTHER INFORMATION: UNA monomer
<220> FEATURE:
<221> NAME/KEY: modified_base
<222> LOCATION: (174)..(174)
<223> OTHER INFORMATION: UNA monomer
<220> FEATURE:
<221> NAME/KEY: modified_base
<222> LOCATION: (177)..(177)
<223> OTHER INFORMATION: UNA monomer
<220> FEATURE:
<221> NAME/KEY: modified_base
<222> LOCATION: (179)..(179)
<223> OTHER INFORMATION: UNA monomer
<220> FEATURE:
<221> NAME/KEY: modified_base
<222> LOCATION: (185)..(185)
<223> OTHER INFORMATION: UNA monomer
<220> FEATURE:
<221> NAME/KEY: modified_base
<222> LOCATION: (194)..(195)
<223> OTHER INFORMATION: UNA monomer
<220> FEATURE:
<221> NAME/KEY: modified_base
<222> LOCATION: (199)..(199)
<223> OTHER INFORMATION: UNA monomer
<220> FEATURE:
<221> NAME/KEY: modified_base
<222> LOCATION: (201)..(201)
<223> OTHER INFORMATION: UNA monomer
<220> FEATURE:
<221> NAME/KEY: modified_base
<222> LOCATION: (207)..(208)
<223> OTHER INFORMATION: UNA monomer
<220> FEATURE:
<221> NAME/KEY: modified_base
<222> LOCATION: (210)..(210)
<223> OTHER INFORMATION: UNA monomer
<220> FEATURE:
<221> NAME/KEY: modified_base
<222> LOCATION: (213)..(215)
<223> OTHER INFORMATION: UNA monomer
<220> FEATURE:
<221> NAME/KEY: modified_base
<222> LOCATION: (225)..(225)
<223> OTHER INFORMATION: UNA monomer
<220> FEATURE:
<221> NAME/KEY: modified_base
<222> LOCATION: (229)..(229)
<223> OTHER INFORMATION: UNA monomer
<220> FEATURE:
<221> NAME/KEY: modified_base
<222> LOCATION: (231)..(231)
<223> OTHER INFORMATION: UNA monomer
<220> FEATURE:
<221> NAME/KEY: modified_base
<222> LOCATION: (235)..(239)
<223> OTHER INFORMATION: UNA monomer
<220> FEATURE:
<221> NAME/KEY: modified_base
<222> LOCATION: (246)..(248)
<223> OTHER INFORMATION: UNA monomer
<220> FEATURE:
<221> NAME/KEY: modified_base
<222> LOCATION: (252)..(252)
<223> OTHER INFORMATION: UNA monomer
<220> FEATURE:
<221> NAME/KEY: modified_base
<222> LOCATION: (258)..(258)
<223> OTHER INFORMATION: UNA monomer
<220> FEATURE:
<221> NAME/KEY: modified_base
<222> LOCATION: (263)..(263)
<223> OTHER INFORMATION: UNA monomer
<220> FEATURE:

<221> NAME/KEY: modified_base
<222> LOCATION: (267)..(267)
<223> OTHER INFORMATION: UNA monomer
<220> FEATURE:
<221> NAME/KEY: modified_base
<222> LOCATION: (270)..(270)
<223> OTHER INFORMATION: UNA monomer
<220> FEATURE:
<221> NAME/KEY: modified_base
<222> LOCATION: (272)..(272)
<223> OTHER INFORMATION: UNA monomer
<220> FEATURE:
<221> NAME/KEY: modified_base
<222> LOCATION: (281)..(281)
<223> OTHER INFORMATION: UNA monomer
<220> FEATURE:
<221> NAME/KEY: modified_base
<222> LOCATION: (284)..(284)
<223> OTHER INFORMATION: UNA monomer
<220> FEATURE:
<221> NAME/KEY: modified_base
<222> LOCATION: (290)..(290)
<223> OTHER INFORMATION: UNA monomer
<220> FEATURE:
<221> NAME/KEY: modified_base
<222> LOCATION: (292)..(293)
<223> OTHER INFORMATION: UNA monomer
<220> FEATURE:
<221> NAME/KEY: modified_base
<222> LOCATION: (300)..(300)
<223> OTHER INFORMATION: UNA monomer
<220> FEATURE:
<221> NAME/KEY: modified_base
<222> LOCATION: (305)..(306)
<223> OTHER INFORMATION: UNA monomer
<220> FEATURE:
<221> NAME/KEY: modified_base
<222> LOCATION: (309)..(309)
<223> OTHER INFORMATION: UNA monomer
<220> FEATURE:
<221> NAME/KEY: modified_base
<222> LOCATION: (315)..(315)
<223> OTHER INFORMATION: UNA monomer
<220> FEATURE:
<221> NAME/KEY: modified_base
<222> LOCATION: (317)..(317)
<223> OTHER INFORMATION: UNA monomer
<220> FEATURE:
<221> NAME/KEY: modified_base
<222> LOCATION: (321)..(321)
<223> OTHER INFORMATION: UNA monomer
<220> FEATURE:
<221> NAME/KEY: modified_base
<222> LOCATION: (326)..(328)
<223> OTHER INFORMATION: UNA monomer
<220> FEATURE:
<221> NAME/KEY: modified_base
<222> LOCATION: (336)..(336)
<223> OTHER INFORMATION: UNA monomer
<220> FEATURE:
<221> NAME/KEY: modified_base
<222> LOCATION: (353)..(353)
<223> OTHER INFORMATION: UNA monomer
<220> FEATURE:
<221> NAME/KEY: modified_base
<222> LOCATION: (358)..(358)
<223> OTHER INFORMATION: UNA monomer
<220> FEATURE:
<221> NAME/KEY: modified_base
<222> LOCATION: (361)..(362)
<223> OTHER INFORMATION: UNA monomer
<220> FEATURE:
<221> NAME/KEY: modified_base
<222> LOCATION: (374)..(375)
<223> OTHER INFORMATION: UNA monomer
<220> FEATURE:
<221> NAME/KEY: modified_base
<222> LOCATION: (383)..(383)
<223> OTHER INFORMATION: UNA monomer <220> FEATURE:
<221> NAME/KEY: modified_base
<222> LOCATION: (391)..(393)
<223> OTHER INFORMATION: UNA monomer
<220> FEATURE:
<221> NAME/KEY: modified_base
<222> LOCATION: (399)..(399)
<223> OTHER INFORMATION: UNA monomer
<220> FEATURE:
<221> NAME/KEY: modified_base
<222> LOCATION: (404)..(405)
<223> OTHER INFORMATION: UNA monomer
<220> FEATURE:
<221> NAME/KEY: modified_base
<222> LOCATION: (407)..(407)
<223> OTHER INFORMATION: UNA monomer
<220> FEATURE:
<221> NAME/KEY: modified_base
<222> LOCATION: (412)..(412)
<223> OTHER INFORMATION: UNA monomer
<220> FEATURE:
<221> NAME/KEY: modified_base
<222> LOCATION: (414)..(414)
<223> OTHER INFORMATION: UNA monomer
<220> FEATURE:
<221> NAME/KEY: modified_base
<222> LOCATION: (425)..(425)
<223> OTHER INFORMATION: UNA monomer
<220> FEATURE:
<221> NAME/KEY: modified_base
<222> LOCATION: (429)..(429)
<223> OTHER INFORMATION: UNA monomer
<220> FEATURE:
<221> NAME/KEY: modified_base
<222> LOCATION: (432)..(432)
<223> OTHER INFORMATION: UNA monomer
<220> FEATURE:
<221> NAME/KEY: modified_base
<222> LOCATION: (441)..(441)
<223> OTHER INFORMATION: UNA monomer
<220> FEATURE:
<221> NAME/KEY: modified_base
<222> LOCATION: (444)..(447)
<223> OTHER INFORMATION: UNA monomer
<220> FEATURE:
<221> NAME/KEY: modified_base
<222> LOCATION: (453)..(453)
<223> OTHER INFORMATION: UNA monomer
<220> FEATURE:
<221> NAME/KEY: modified_base
<222> LOCATION: (456)..(456)
<223> OTHER INFORMATION: UNA monomer
<220> FEATURE:
<221> NAME/KEY: modified_base
<222> LOCATION: (458)..(458)
<223> OTHER INFORMATION: UNA monomer
<220> FEATURE:
<221> NAME/KEY: modified_base
<222> LOCATION: (460)..(460)
<223> OTHER INFORMATION: UNA monomer
<220> FEATURE:
<221> NAME/KEY: modified_base
<222> LOCATION: (465)..(465)
<223> OTHER INFORMATION: UNA monomer
<220> FEATURE:
<221> NAME/KEY: modified_base
<222> LOCATION: (481)..(483)
<223> OTHER INFORMATION: UNA monomer
<220> FEATURE:
<221> NAME/KEY: modified_base
<222> LOCATION: (486)..(486)
<223> OTHER INFORMATION: UNA monomer
<220> FEATURE:
<221> NAME/KEY: modified_base
<222> LOCATION: (491)..(492)
<223> OTHER INFORMATION: UNA monomer
<220> FEATURE:
<221> NAME/KEY: modified_base
<222> LOCATION: (496)..(496)

<223> OTHER INFORMATION: UNA monomer
<220> FEATURE:
<221> NAME/KEY: modified_base
<222> LOCATION: (502)..(502)
<223> OTHER INFORMATION: UNA monomer
<220> FEATURE:
<221> NAME/KEY: modified_base
<222> LOCATION: (510)..(510)
<223> OTHER INFORMATION: UNA monomer
<220> FEATURE:
<221> NAME/KEY: modified_base
<222> LOCATION: (521)..(521)
<223> OTHER INFORMATION: UNA monomer
<220> FEATURE:
<221> NAME/KEY: modified_base
<222> LOCATION: (525)..(525)
<223> OTHER INFORMATION: UNA monomer
<220> FEATURE:
<221> NAME/KEY: modified_base
<222> LOCATION: (530)..(530)
<223> OTHER INFORMATION: UNA monomer
<220> FEATURE:
<221> NAME/KEY: modified_base
<222> LOCATION: (535)..(535)
<223> OTHER INFORMATION: UNA monomer
<220> FEATURE:
<221> NAME/KEY: modified_base
<222> LOCATION: (539)..(539)
<223> OTHER INFORMATION: UNA monomer
<220> FEATURE:
<221> NAME/KEY: modified_base
<222> LOCATION: (559)..(559)
<223> OTHER INFORMATION: UNA monomer
<220> FEATURE:
<221> NAME/KEY: modified_base
<222> LOCATION: (569)..(569)
<223> OTHER INFORMATION: UNA monomer
<220> FEATURE:
<221> NAME/KEY: modified_base
<222> LOCATION: (571)..(572)
<223> OTHER INFORMATION: UNA monomer
<220> FEATURE:
<221> NAME/KEY: modified_base
<222> LOCATION: (579)..(579)
<223> OTHER INFORMATION: UNA monomer
<220> FEATURE:
<221> NAME/KEY: modified_base
<222> LOCATION: (581)..(581)
<223> OTHER INFORMATION: UNA monomer
<220> FEATURE:
<221> NAME/KEY: modified_base
<222> LOCATION: (586)..(586)
<223> OTHER INFORMATION: UNA monomer
<220> FEATURE:
<221> NAME/KEY: modified_base
<222> LOCATION: (589)..(590)
<223> OTHER INFORMATION: UNA monomer
<220> FEATURE:
<221> NAME/KEY: modified_base
<222> LOCATION: (592)..(592)
<223> OTHER INFORMATION: UNA monomer
<220> FEATURE:
<221> NAME/KEY: modified_base
<222> LOCATION: (594)..(594)
<223> OTHER INFORMATION: UNA monomer
<220> FEATURE:
<221> NAME/KEY: modified_base
<222> LOCATION: (603)..(603)
<223> OTHER INFORMATION: UNA monomer
<220> FEATURE:
<221> NAME/KEY: modified_base
<222> LOCATION: (606)..(607)
<223> OTHER INFORMATION: UNA monomer
<220> FEATURE:
<221> NAME/KEY: modified_base
<222> LOCATION: (610)..(610)
<223> OTHER INFORMATION: UNA monomer
<220> FEATURE:
<221> NAME/KEY: modified_base <222> LOCATION: (612)..(612)
<223> OTHER INFORMATION: UNA monomer
<220> FEATURE:
<221> NAME/KEY: modified_base
<222> LOCATION: (616)..(616)
<223> OTHER INFORMATION: UNA monomer
<220> FEATURE:
<221> NAME/KEY: modified_base
<222> LOCATION: (621)..(621)
<223> OTHER INFORMATION: UNA monomer
<220> FEATURE:
<221> NAME/KEY: modified_base
<222> LOCATION: (626)..(630)
<223> OTHER INFORMATION: UNA monomer
<220> FEATURE:
<221> NAME/KEY: modified_base
<222> LOCATION: (635)..(636)
<223> OTHER INFORMATION: UNA monomer
<220> FEATURE:
<221> NAME/KEY: modified_base
<222> LOCATION: (638)..(639)
<223> OTHER INFORMATION: UNA monomer
<220> FEATURE:
<221> NAME/KEY: modified_base
<222> LOCATION: (646)..(646)
<223> OTHER INFORMATION: UNA monomer
<220> FEATURE:
<221> NAME/KEY: modified_base
<222> LOCATION: (649)..(649)
<223> OTHER INFORMATION: UNA monomer
<220> FEATURE:
<221> NAME/KEY: modified_base
<222> LOCATION: (651)..(651)
<223> OTHER INFORMATION: UNA monomer
<220> FEATURE:
<221> NAME/KEY: modified_base
<222> LOCATION: (655)..(656)
<223> OTHER INFORMATION: UNA monomer
<220> FEATURE:
<221> NAME/KEY: modified_base
<222> LOCATION: (660)..(660)
<223> OTHER INFORMATION: UNA monomer
<220> FEATURE:
<221> NAME/KEY: modified_base
<222> LOCATION: (666)..(666)
<223> OTHER INFORMATION: UNA monomer
<220> FEATURE:
<221> NAME/KEY: modified_base
<222> LOCATION: (671)..(672)
<223> OTHER INFORMATION: UNA monomer
<220> FEATURE:
<221> NAME/KEY: modified_base
<222> LOCATION: (680)..(680)
<223> OTHER INFORMATION: UNA monomer
<220> FEATURE:
<221> NAME/KEY: modified_base
<222> LOCATION: (689)..(691)
<223> OTHER INFORMATION: UNA monomer
<220> FEATURE:
<221> NAME/KEY: modified_base
<222> LOCATION: (693)..(693)
<223> OTHER INFORMATION: UNA monomer
<220> FEATURE:
<221> NAME/KEY: modified_base
<222> LOCATION: (697)..(698)
<223> OTHER INFORMATION: UNA monomer
<220> FEATURE:
<221> NAME/KEY: modified_base
<222> LOCATION: (701)..(701)
<223> OTHER INFORMATION: UNA monomer
<220> FEATURE:
<221> NAME/KEY: modified_base
<222> LOCATION: (708)..(709)
<223> OTHER INFORMATION: UNA monomer
<220> FEATURE:
<221> NAME/KEY: modified_base
<222> LOCATION: (714)..(714)
<223> OTHER INFORMATION: UNA monomer
<220> FEATURE:

<221> NAME/KEY: modified_base
<222> LOCATION: (717)..(719)
<223> OTHER INFORMATION: UNA monomer
<220> FEATURE:
<221> NAME/KEY: modified_base
<222> LOCATION: (725)..(725)
<223> OTHER INFORMATION: UNA monomer
<220> FEATURE:
<221> NAME/KEY: modified_base
<222> LOCATION: (732)..(732)
<223> OTHER INFORMATION: UNA monomer
<220> FEATURE:
<221> NAME/KEY: modified_base
<222> LOCATION: (734)..(734)
<223> OTHER INFORMATION: UNA monomer
<220> FEATURE:
<221> NAME/KEY: modified_base
<222> LOCATION: (738)..(738)
<223> OTHER INFORMATION: UNA monomer
<220> FEATURE:
<221> NAME/KEY: modified_base
<222> LOCATION: (743)..(743)
<223> OTHER INFORMATION: UNA monomer
<220> FEATURE:
<221> NAME/KEY: modified_base
<222> LOCATION: (746)..(748)
<223> OTHER INFORMATION: UNA monomer
<220> FEATURE:
<221> NAME/KEY: modified_base
<222> LOCATION: (751)..(751)
<223> OTHER INFORMATION: UNA monomer
<220> FEATURE:
<221> NAME/KEY: modified_base
<222> LOCATION: (753)..(753)
<223> OTHER INFORMATION: UNA monomer
<220> FEATURE:
<221> NAME/KEY: modified_base
<222> LOCATION: (759)..(761)
<223> OTHER INFORMATION: UNA monomer
<220> FEATURE:
<221> NAME/KEY: modified_base
<222> LOCATION: (763)..(764)
<223> OTHER INFORMATION: UNA monomer
<220> FEATURE:
<221> NAME/KEY: modified_base
<222> LOCATION: (768)..(768)
<223> OTHER INFORMATION: UNA monomer
<220> FEATURE:
<221> NAME/KEY: modified_base
<222> LOCATION: (773)..(773)
<223> OTHER INFORMATION: UNA monomer
<220> FEATURE:
<221> NAME/KEY: modified_base
<222> LOCATION: (778)..(779)
<223> OTHER INFORMATION: UNA monomer
<220> FEATURE:
<221> NAME/KEY: modified_base
<222> LOCATION: (785)..(785)
<223> OTHER INFORMATION: UNA monomer
<220> FEATURE:
<221> NAME/KEY: modified_base
<222> LOCATION: (787)..(788)
<223> OTHER INFORMATION: UNA monomer
<220> FEATURE:
<221> NAME/KEY: modified_base
<222> LOCATION: (793)..(793)
<223> OTHER INFORMATION: UNA monomer
<220> FEATURE:
<221> NAME/KEY: modified_base
<222> LOCATION: (802)..(802)
<223> OTHER INFORMATION: UNA monomer
<220> FEATURE:
<221> NAME/KEY: modified_base
<222> LOCATION: (806)..(806)
<223> OTHER INFORMATION: UNA monomer
<220> FEATURE:
<221> NAME/KEY: modified_base
<222> LOCATION: (813)..(813)
<223> OTHER INFORMATION: UNA monomer <220> FEATURE:
<221> NAME/KEY: modified_base
<222> LOCATION: (817)..(817)
<223> OTHER INFORMATION: UNA monomer
<220> FEATURE:
<221> NAME/KEY: modified_base
<222> LOCATION: (827)..(827)
<223> OTHER INFORMATION: UNA monomer
<220> FEATURE:
<221> NAME/KEY: modified_base
<222> LOCATION: (829)..(829)
<223> OTHER INFORMATION: UNA monomer
<220> FEATURE:
<221> NAME/KEY: modified_base
<222> LOCATION: (831)..(831)
<223> OTHER INFORMATION: UNA monomer
<220> FEATURE:
<221> NAME/KEY: modified_base
<222> LOCATION: (843)..(843)
<223> OTHER INFORMATION: UNA monomer
<220> FEATURE:
<221> NAME/KEY: modified_base
<222> LOCATION: (848)..(848)
<223> OTHER INFORMATION: UNA monomer
<220> FEATURE:
<221> NAME/KEY: modified_base
<222> LOCATION: (850)..(850)
<223> OTHER INFORMATION: UNA monomer
<220> FEATURE:
<221> NAME/KEY: modified_base
<222> LOCATION: (855)..(855)
<223> OTHER INFORMATION: UNA monomer
<220> FEATURE:
<221> NAME/KEY: modified_base
<222> LOCATION: (860)..(860)
<223> OTHER INFORMATION: UNA monomer
<220> FEATURE:
<221> NAME/KEY: modified_base
<222> LOCATION: (862)..(863)
<223> OTHER INFORMATION: UNA monomer
<220> FEATURE:
<221> NAME/KEY: modified_base
<222> LOCATION: (870)..(870)
<223> OTHER INFORMATION: UNA monomer
<220> FEATURE:
<221> NAME/KEY: modified_base
<222> LOCATION: (872)..(872)
<223> OTHER INFORMATION: UNA monomer
<220> FEATURE:
<221> NAME/KEY: modified_base
<222> LOCATION: (877)..(878)
<223> OTHER INFORMATION: UNA monomer
<220> FEATURE:
<221> NAME/KEY: modified_base
<222> LOCATION: (880)..(883)
<223> OTHER INFORMATION: UNA monomer
<220> FEATURE:
<221> NAME/KEY: modified_base
<222> LOCATION: (888)..(888)
<223> OTHER INFORMATION: UNA monomer
<220> FEATURE:
<221> NAME/KEY: modified_base
<222> LOCATION: (895)..(897)
<223> OTHER INFORMATION: UNA monomer
<220> FEATURE:
<221> NAME/KEY: modified_base
<222> LOCATION: (904)..(907)
<223> OTHER INFORMATION: UNA monomer
<220> FEATURE:
<221> NAME/KEY: modified_base
<222> LOCATION: (917)..(918)
<223> OTHER INFORMATION: UNA monomer
<220> FEATURE:
<221> NAME/KEY: modified_base
<222> LOCATION: (923)..(924)
<223> OTHER INFORMATION: UNA monomer
<220> FEATURE:
<221> NAME/KEY: modified_base
<222> LOCATION: (928)..(928)

<223> OTHER INFORMATION: UNA monomer
<220> FEATURE:
<221> NAME/KEY: modified_base
<222> LOCATION: (930)..(930)
<223> OTHER INFORMATION: UNA monomer
<220> FEATURE:
<221> NAME/KEY: modified_base
<222> LOCATION: (932)..(932)
<223> OTHER INFORMATION: UNA monomer
<220> FEATURE:
<221> NAME/KEY: modified_base
<222> LOCATION: (936)..(936)
<223> OTHER INFORMATION: UNA monomer
<220> FEATURE:
<221> NAME/KEY: modified_base
<222> LOCATION: (942)..(942)
<223> OTHER INFORMATION: UNA monomer
<220> FEATURE:
<221> NAME/KEY: modified_base
<222> LOCATION: (945)..(945)
<223> OTHER INFORMATION: UNA monomer
<220> FEATURE:
<221> NAME/KEY: modified_base
<222> LOCATION: (949)..(949)
<223> OTHER INFORMATION: UNA monomer
<220> FEATURE:
<221> NAME/KEY: modified_base
<222> LOCATION: (953)..(954)
<223> OTHER INFORMATION: UNA monomer
<220> FEATURE:
<221> NAME/KEY: modified_base
<222> LOCATION: (962)..(962)
<223> OTHER INFORMATION: UNA monomer
<220> FEATURE:
<221> NAME/KEY: modified_base
<222> LOCATION: (971)..(973)
<223> OTHER INFORMATION: UNA monomer
<220> FEATURE:
<221> NAME/KEY: modified_base
<222> LOCATION: (976)..(976)
<223> OTHER INFORMATION: UNA monomer
<220> FEATURE:
<221> NAME/KEY: modified_base
<222> LOCATION: (979)..(981)
<223> OTHER INFORMATION: UNA monomer
<220> FEATURE:
<221> NAME/KEY: modified_base
<222> LOCATION: (984)..(984)
<223> OTHER INFORMATION: UNA monomer
<220> FEATURE:
<221> NAME/KEY: modified_base
<222> LOCATION: (986)..(986)
<223> OTHER INFORMATION: UNA monomer
<220> FEATURE:
<221> NAME/KEY: modified_base
<222> LOCATION: (991)..(993)
<223> OTHER INFORMATION: UNA monomer
<220> FEATURE:
<221> NAME/KEY: modified_base
<222> LOCATION: (998)..(998)
<223> OTHER INFORMATION: UNA monomer
<220> FEATURE:
<221> NAME/KEY: modified_base
<222> LOCATION: (1000)..(1000)
<223> OTHER INFORMATION: UNA monomer
<220> FEATURE:
<221> NAME/KEY: modified_base
<222> LOCATION: (1015)..(1015)
<223> OTHER INFORMATION: UNA monomer
<220> FEATURE:
<221> NAME/KEY: modified_base
<222> LOCATION: (1019)..(1019)
<223> OTHER INFORMATION: UNA monomer
<220> FEATURE:
<221> NAME/KEY: modified_base
<222> LOCATION: (1027)..(1027)
<223> OTHER INFORMATION: UNA monomer
<220> FEATURE:
<221> NAME/KEY: modified_base <222> LOCATION: (1029)..(1029)
<223> OTHER INFORMATION: UNA monomer
<220> FEATURE:
<221> NAME/KEY: modified_base
<222> LOCATION: (1032)..(1032)
<223> OTHER INFORMATION: UNA monomer
<220> FEATURE:
<221> NAME/KEY: modified_base
<222> LOCATION: (1035)..(1035)
<223> OTHER INFORMATION: UNA monomer
<220> FEATURE:
<221> NAME/KEY: modified_base
<222> LOCATION: (1040)..(1040)
<223> OTHER INFORMATION: UNA monomer
<220> FEATURE:
<221> NAME/KEY: modified_base
<222> LOCATION: (1043)..(1043)
<223> OTHER INFORMATION: UNA monomer
<220> FEATURE:
<221> NAME/KEY: modified_base
<222> LOCATION: (1045)..(1045)
<223> OTHER INFORMATION: UNA monomer
<220> FEATURE:
<221> NAME/KEY: modified_base
<222> LOCATION: (1048)..(1048)
<223> OTHER INFORMATION: UNA monomer
<220> FEATURE:
<221> NAME/KEY: modified_base
<222> LOCATION: (1051)..(1053)
<223> OTHER INFORMATION: UNA monomer
<220> FEATURE:
<221> NAME/KEY: modified_base
<222> LOCATION: (1056)..(1056)
<223> OTHER INFORMATION: UNA monomer
<220> FEATURE:
<221> NAME/KEY: modified_base
<222> LOCATION: (1060)..(1061)
<223> OTHER INFORMATION: UNA monomer
<220> FEATURE:
<221> NAME/KEY: modified_base
<222> LOCATION: (1066)..(1066)
<223> OTHER INFORMATION: UNA monomer
<220> FEATURE:
<221> NAME/KEY: modified_base
<222> LOCATION: (1069)..(1069)
<223> OTHER INFORMATION: UNA monomer
<220> FEATURE:
<221> NAME/KEY: modified_base
<222> LOCATION: (1072)..(1073)
<223> OTHER INFORMATION: UNA monomer
<220> FEATURE:
<221> NAME/KEY: modified_base
<222> LOCATION: (1075)..(1075)
<223> OTHER INFORMATION: UNA monomer
<220> FEATURE:
<221> NAME/KEY: modified_base
<222> LOCATION: (1091)..(1092)
<223> OTHER INFORMATION: UNA monomer
<220> FEATURE:
<221> NAME/KEY: modified_base
<222> LOCATION: (1094)..(1094)
<223> OTHER INFORMATION: UNA monomer
<220> FEATURE:
<221> NAME/KEY: modified_base
<222> LOCATION: (1100)..(1100)
<223> OTHER INFORMATION: UNA monomer
<220> FEATURE:
<221> NAME/KEY: modified_base
<222> LOCATION: (1106)..(1106)
<223> OTHER INFORMATION: UNA monomer
<220> FEATURE:
<221> NAME/KEY: modified_base
<222> LOCATION: (1121)..(1121)
<223> OTHER INFORMATION: UNA monomer
<220> FEATURE:
<221> NAME/KEY: modified_base
<222> LOCATION: (1128)..(1129)
<223> OTHER INFORMATION: UNA monomer
<220> FEATURE:

<221> NAME/KEY: modified_base
<222> LOCATION: (1134)..(1134)
<223> OTHER INFORMATION: UNA monomer
<220> FEATURE:
<221> NAME/KEY: modified_base
<222> LOCATION: (1136)..(1136)
<223> OTHER INFORMATION: UNA monomer
<220> FEATURE:
<221> NAME/KEY: modified_base
<222> LOCATION: (1144)..(1145)
<223> OTHER INFORMATION: UNA monomer
<220> FEATURE:
<221> NAME/KEY: modified_base
<222> LOCATION: (1154)..(1154)
<223> OTHER INFORMATION: UNA monomer
<220> FEATURE:
<221> NAME/KEY: modified_base
<222> LOCATION: (1156)..(1156)
<223> OTHER INFORMATION: UNA monomer
<220> FEATURE:
<221> NAME/KEY: modified_base
<222> LOCATION: (1158)..(1159)
<223> OTHER INFORMATION: UNA monomer
<220> FEATURE:
<221> NAME/KEY: modified_base
<222> LOCATION: (1163)..(1163)
<223> OTHER INFORMATION: UNA monomer
<220> FEATURE:
<221> NAME/KEY: modified_base
<222> LOCATION: (1173)..(1176)
<223> OTHER INFORMATION: UNA monomer
<220> FEATURE:
<221> NAME/KEY: modified_base
<222> LOCATION: (1179)..(1179)
<223> OTHER INFORMATION: UNA monomer
<220> FEATURE:
<221> NAME/KEY: modified_base
<222> LOCATION: (1182)..(1182)
<223> OTHER INFORMATION: UNA monomer
<220> FEATURE:
<221> NAME/KEY: modified_base
<222> LOCATION: (1196)..(1196)
<223> OTHER INFORMATION: UNA monomer
<220> FEATURE:
<221> NAME/KEY: modified_base
<222> LOCATION: (1204)..(1206)
<223> OTHER INFORMATION: UNA monomer
<220> FEATURE:
<221> NAME/KEY: modified_base
<222> LOCATION: (1209)..(1209)
<223> OTHER INFORMATION: UNA monomer
<220> FEATURE:
<221> NAME/KEY: modified_base
<222> LOCATION: (1217)..(1217)
<223> OTHER INFORMATION: UNA monomer
<220> FEATURE:
<221> NAME/KEY: modified_base
<222> LOCATION: (1221)..(1221)
<223> OTHER INFORMATION: UNA monomer
<220> FEATURE:
<221> NAME/KEY: modified_base
<222> LOCATION: (1228)..(1229)
<223> OTHER INFORMATION: UNA monomer
<220> FEATURE:
<221> NAME/KEY: modified_base
<222> LOCATION: (1231)..(1231)
<223> OTHER INFORMATION: UNA monomer
<220> FEATURE:
<221> NAME/KEY: modified_base
<222> LOCATION: (1235)..(1236)
<223> OTHER INFORMATION: UNA monomer
<220> FEATURE:
<221> NAME/KEY: modified_base
<222> LOCATION: (1240)..(1240)
<223> OTHER INFORMATION: UNA monomer
<220> FEATURE:
<221> NAME/KEY: modified_base
<222> LOCATION: (1249)..(1249)
<223> OTHER INFORMATION: UNA monomer <220> FEATURE:
<221> NAME/KEY: modified_base
<222> LOCATION: (1262)..(1263)
<223> OTHER INFORMATION: UNA monomer
<220> FEATURE:
<221> NAME/KEY: modified_base
<222> LOCATION: (1268)..(1268)
<223> OTHER INFORMATION: UNA monomer
<220> FEATURE:
<221> NAME/KEY: modified_base
<222> LOCATION: (1270)..(1271)
<223> OTHER INFORMATION: UNA monomer
<220> FEATURE:
<221> NAME/KEY: modified_base
<222> LOCATION: (1278)..(1278)
<223> OTHER INFORMATION: UNA monomer
<220> FEATURE:
<221> NAME/KEY: modified_base
<222> LOCATION: (1289)..(1290)
<223> OTHER INFORMATION: UNA monomer
<220> FEATURE:
<221> NAME/KEY: modified_base
<222> LOCATION: (1295)..(1298)
<223> OTHER INFORMATION: UNA monomer
<220> FEATURE:
<221> NAME/KEY: modified_base
<222> LOCATION: (1302)..(1302)
<223> OTHER INFORMATION: UNA monomer
<220> FEATURE:
<221> NAME/KEY: modified_base
<222> LOCATION: (1305)..(1306)
<223> OTHER INFORMATION: UNA monomer
<220> FEATURE:
<221> NAME/KEY: modified_base
<222> LOCATION: (1310)..(1311)
<223> OTHER INFORMATION: UNA monomer
<220> FEATURE:
<221> NAME/KEY: modified_base
<222> LOCATION: (1317)..(1317)
<223> OTHER INFORMATION: UNA monomer
<220> FEATURE:
<221> NAME/KEY: modified_base
<222> LOCATION: (1322)..(1323)
<223> OTHER INFORMATION: UNA monomer
<220> FEATURE:
<221> NAME/KEY: modified_base
<222> LOCATION: (1328)..(1328)
<223> OTHER INFORMATION: UNA monomer
<220> FEATURE:
<221> NAME/KEY: modified_base
<222> LOCATION: (1331)..(1333)
<223> OTHER INFORMATION: UNA monomer
<220> FEATURE:
<221> NAME/KEY: modified_base
<222> LOCATION: (1338)..(1338)
<223> OTHER INFORMATION: UNA monomer
<220> FEATURE:
<221> NAME/KEY: modified_base
<222> LOCATION: (1343)..(1343)
<223> OTHER INFORMATION: UNA monomer
<220> FEATURE:
<221> NAME/KEY: modified_base
<222> LOCATION: (1352)..(1352)
<223> OTHER INFORMATION: UNA monomer
<220> FEATURE:
<221> NAME/KEY: modified_base
<222> LOCATION: (1357)..(1357)
<223> OTHER INFORMATION: UNA monomer

<400> SEQUENCE: 158 auguccacug cgguccugga aaacccaggc uugggcagga aacucucuga cuuuggacag 60 gaaacaagcu auauugaaga caacugcaau caaaauggug ccauaucacu gaucuucuca 120 cucaaagaag aaguuggugc auuggccaaa guauugcgcu uauuugagga gaaugaugua 180 aaccugaccc acauugaauc uagaccuucu cguuuaaaga aagaugagua ugaauuuuuc 240

```
acccauuugg auaaacguag ccugccugcu cugacaaaca ucaucaagau cuugaggcau    300

gacauuggug ccacugucca ugagcuuuca cgagauaaga agaaagacac agugcccugg    360

uucccaagaa ccauucaaga gcuggacaga uuugccaauc agauucucag cuauggagcg    420

gaacuggaug cugaccaccc ugguuuuaaa gauccugugu accgugcaag acggaagcag    480

uuugcugaca uugccuacaa cuaccgccau gggcagccca ucccucgagu ggaauacaug    540

gaggaagaaa agaaaacaug gggcacagug uucaagacuc ugaaguccuu guauaaaacc    600

caugcuugcu augaguacaa ucacauuuuu ccacuucuug aaaaguacug uggcuuccau    660

gaagauaaca uuccccagcu ggaagacguu ucucaauucc ugcagacuug cacugguuuc    720

cgccuccgac cuguggcugg ccugcuuucc ucucgggauu ucuugggugg ccuggccuuc    780

cgagucuucc acugcacaca guacaucaga cauggaucca agcccaugua uacccccgaa    840

ccugacaucu gccaugagcu guugggacau gugcccuugu uuucagaucg cagcuuugcc    900

caguuuuccc aggaaauugg ccuugccucu cugggugcac cugaugaaua cauugaaaag    960

cucgccacaa uuuacugguu uacuguggag uuugggcucu gcaaacaagg agacuccaua   1020

aaggcauaug gugcugggcu ccugucaucc uuuggugaau uacaguacug cuuaucagag   1080

aagccaaagc uucucccccu ggagcuggag aagacagcca uccaaaauua cacugucacg   1140

gaguuccagc cccuguauua cguggcagag aguuuuaaug augccaagga gaaaguaagg   1200

aacuuugcug ccacaauacc ucggcccuuc ucaguucgcu acgacccaua cacccaaagg   1260

auugaggucu uggacaauac ccagcagcuu aagauuuugg cugauuccau uaacagugaa   1320

auuggaaucc uuugcagugc ccuccagaaa auaaaguaa                          1359
```

<210> SEQ ID NO 159
<211> LENGTH: 132
<212> TYPE: RNA
<213> ORGANISM: Tobacco etch virus

<400> SEQUENCE: 159

```
ucaacacaac auauacaaaa acaaacgaau cucaagcaau caagcauucu acuucuauug     60

cagcaauuua aaucauuucu uuuaaagcaa aagcaauuuu cugaaaauuu ucaccauuua    120

cgaacgauag cc                                                        132
```

<210> SEQ ID NO 160
<211> LENGTH: 132
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (6)..(6)
<223> OTHER INFORMATION: UNA monomer
<220> FEATURE:
<221> NAME/KEY: modified_base
<222> LOCATION: (10)..(10)
<223> OTHER INFORMATION: UNA monomer
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (19)..(19)

<223> OTHER INFORMATION: UNA monomer
<220> FEATURE:
<221> NAME/KEY: modified_base
<222> LOCATION: (23)..(23)
<223> OTHER INFORMATION: UNA monomer
<220> FEATURE:
<221> NAME/KEY: modified_base
<222> LOCATION: (27)..(27)
<223> OTHER INFORMATION: UNA monomer
<220> FEATURE:
<221> NAME/KEY: modified_base
<222> LOCATION: (31)..(31)
<223> OTHER INFORMATION: UNA monomer
<220> FEATURE:
<221> NAME/KEY: modified_base
<222> LOCATION: (35)..(35)
<223> OTHER INFORMATION: UNA monomer
<220> FEATURE:
<221> NAME/KEY: modified_base
<222> LOCATION: (39)..(39)
<223> OTHER INFORMATION: UNA monomer
<220> FEATURE:
<221> NAME/KEY: modified_base
<222> LOCATION: (43)..(43)
<223> OTHER INFORMATION: UNA monomer
<220> FEATURE:
<221> NAME/KEY: modified_base
<222> LOCATION: (47)..(47)
<223> OTHER INFORMATION: UNA monomer
<220> FEATURE:
<221> NAME/KEY: modified_base
<222> LOCATION: (51)..(51)
<223> OTHER INFORMATION: UNA monomer
<220> FEATURE:
<221> NAME/KEY: modified_base
<222> LOCATION: (55)..(55)
<223> OTHER INFORMATION: UNA monomer
<220> FEATURE:
<221> NAME/KEY: modified_base
<222> LOCATION: (59)..(59)
<223> OTHER INFORMATION: UNA monomer
<220> FEATURE:
<221> NAME/KEY: modified_base
<222> LOCATION: (63)..(63)
<223> OTHER INFORMATION: UNA monomer
<220> FEATURE:
<221> NAME/KEY: modified_base
<222> LOCATION: (67)..(67)
<223> OTHER INFORMATION: UNA monomer
<220> FEATURE:
<221> NAME/KEY: modified_base
<222> LOCATION: (71)..(71)
<223> OTHER INFORMATION: UNA monomer
<220> FEATURE:
<221> NAME/KEY: modified_base
<222> LOCATION: (75)..(75)
<223> OTHER INFORMATION: UNA monomer
<220> FEATURE:
<221> NAME/KEY: modified_base
<222> LOCATION: (79)..(79)
<223> OTHER INFORMATION: UNA monomer
<220> FEATURE:
<221> NAME/KEY: modified_base
<222> LOCATION: (83)..(83)
<223> OTHER INFORMATION: UNA monomer
<220> FEATURE:
<221> NAME/KEY: modified_base
<222> LOCATION: (87)..(87)
<223> OTHER INFORMATION: UNA monomer
<220> FEATURE:
<221> NAME/KEY: modified_base
<222> LOCATION: (91)..(91)
<223> OTHER INFORMATION: UNA monomer
<220> FEATURE:
<221> NAME/KEY: modified_base
<222> LOCATION: (95)..(95)
<223> OTHER INFORMATION: UNA monomer
<220> FEATURE:
<221> NAME/KEY: modified_base <222> LOCATION: (99)..(99)
<223> OTHER INFORMATION: UNA monomer
<220> FEATURE:
<221> NAME/KEY: modified_base
<222> LOCATION: (103)..(103)
<223> OTHER INFORMATION: UNA monomer
<220> FEATURE:
<221> NAME/KEY: modified_base
<222> LOCATION: (107)..(107)
<223> OTHER INFORMATION: UNA monomer
<220> FEATURE:
<221> NAME/KEY: modified_base
<222> LOCATION: (111)..(111)
<223> OTHER INFORMATION: UNA monomer
<220> FEATURE:
<221> NAME/KEY: modified_base
<222> LOCATION: (115)..(115)
<223> OTHER INFORMATION: UNA monomer
<220> FEATURE:
<221> NAME/KEY: modified_base
<222> LOCATION: (119)..(119)
<223> OTHER INFORMATION: UNA monomer
<220> FEATURE:
<221> NAME/KEY: modified_base
<222> LOCATION: (123)..(123)
<223> OTHER INFORMATION: UNA monomer
<220> FEATURE:
<221> NAME/KEY: modified_base
<222> LOCATION: (127)..(127)
<223> OTHER INFORMATION: UNA monomer
<220> FEATURE:
<221> NAME/KEY: modified_base
<222> LOCATION: (131)..(131)
<223> OTHER INFORMATION: UNA monomer

<400> SEQUENCE: 160 ucaacacaac auauacaaaa acaaacgaau cucaagcaau caagcauucu acuucuauug 60 cagcaauuua aaucauuucu uuuaaagcaa aagcaauuuu cugaaaauuu ucaccauuua 120 cgaacgauag cc 132

<210> SEQ ID NO 161
<211> LENGTH: 132
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(2)
<223> OTHER INFORMATION: UNA monomer
<220> FEATURE:
<221> NAME/KEY: modified_base
<222> LOCATION: (32)..(32)
<223> OTHER INFORMATION: UNA monomer
<220> FEATURE:
<221> NAME/KEY: modified_base
<222> LOCATION: (62)..(62)
<223> OTHER INFORMATION: UNA monomer
<220> FEATURE:
<221> NAME/KEY: modified_base
<222> LOCATION: (92)..(92)
<223> OTHER INFORMATION: UNA monomer
<220> FEATURE:
<221> NAME/KEY: modified_base
<222> LOCATION: (131)..(131)
<223> OTHER INFORMATION: UNA monomer

<400> SEQUENCE: 161 ucaacacaac auauacaaaa caaacgaauc ucaagcaauc aagcauucua cuucuauugc 60 agcaauuuaa aucauuucuu uuaaagcaaa agcaauuuuc ugaaaauuuu caccauuuac 120 gaacgauagc cc 132

<210> SEQ ID NO 162
<211> LENGTH: 131
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (2)..(4)
<223> OTHER INFORMATION: UNA monomer
<220> FEATURE:
<221> NAME/KEY: modified_base
<222> LOCATION: (128)..(130)
<223> OTHER INFORMATION: UNA monomer

<400> SEQUENCE: 162 ucaacacaac auauacaaaa caaacgaauc ucaagcaauc aagcauucua cuucuauugc 60 agcaauuuaa aucauuucuu uuaaagcaaa agcaauuuuc ugaaaauuuu caccauuuac 120 gaacgauagc c 131

<210> SEQ ID NO 163
<211> LENGTH: 131
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (1)..(1)
<223> OTHER INFORMATION: UNA monomer
<220> FEATURE:
<221> NAME/KEY: modified_base
<222> LOCATION: (12)..(12)
<223> OTHER INFORMATION: UNA monomer
<220> FEATURE:
<221> NAME/KEY: modified_base
<222> LOCATION: (14)..(14)
<223> OTHER INFORMATION: UNA monomer
<220> FEATURE:
<221> NAME/KEY: modified_base
<222> LOCATION: (29)..(29)
<223> OTHER INFORMATION: UNA monomer
<220> FEATURE:
<221> NAME/KEY: modified_base
<222> LOCATION: (31)..(31)
<223> OTHER INFORMATION: UNA monomer
<220> FEATURE:
<221> NAME/KEY: modified_base
<222> LOCATION: (39)..(39)
<223> OTHER INFORMATION: UNA monomer
<220> FEATURE:
<221> NAME/KEY: modified_base
<222> LOCATION: (46)..(47)
<223> OTHER INFORMATION: UNA monomer
<220> FEATURE:
<221> NAME/KEY: modified_base
<222> LOCATION: (49)..(49)
<223> OTHER INFORMATION: UNA monomer
<220> FEATURE:
<221> NAME/KEY: modified_base
<222> LOCATION: (52)..(53)
<223> OTHER INFORMATION: UNA monomer
<220> FEATURE:
<221> NAME/KEY: modified_base
<222> LOCATION: (55)..(55)
<223> OTHER INFORMATION: UNA monomer
<220> FEATURE:
<221> NAME/KEY: modified_base
<222> LOCATION: (57)..(58)
<223> OTHER INFORMATION: UNA monomer
<220> FEATURE:

<221> NAME/KEY: modified_base
<222> LOCATION: (66)..(68)
<223> OTHER INFORMATION: UNA monomer
<220> FEATURE:
<221> NAME/KEY: modified_base
<222> LOCATION: (72)..(72)
<223> OTHER INFORMATION: UNA monomer
<220> FEATURE:
<221> NAME/KEY: modified_base
<222> LOCATION: (75)..(77)
<223> OTHER INFORMATION: UNA monomer
<220> FEATURE:
<221> NAME/KEY: modified_base
<222> LOCATION: (79)..(82)
<223> OTHER INFORMATION: UNA monomer
<220> FEATURE:
<221> NAME/KEY: modified_base
<222> LOCATION: (96)..(99)
<223> OTHER INFORMATION: UNA monomer
<220> FEATURE:
<221> NAME/KEY: modified_base
<222> LOCATION: (101)..(101)
<223> OTHER INFORMATION: UNA monomer
<220> FEATURE:
<221> NAME/KEY: modified_base
<222> LOCATION: (107)..(110)
<223> OTHER INFORMATION: UNA monomer
<220> FEATURE:
<221> NAME/KEY: modified_base
<222> LOCATION: (116)..(118)
<223> OTHER INFORMATION: UNA monomer
<220> FEATURE:
<221> NAME/KEY: modified_base
<222> LOCATION: (127)..(127)
<223> OTHER INFORMATION: UNA monomer

<400> SEQUENCE: 163 ucaacacaac auauacaaaa caaacgaauc ucaagcaauc aagcauucua cuucuauugc 60 agcaauuuaa aucauuucuu uuaaagcaaa agcaauuuuc ugaaaauuuu caccauuuac 120 gaacgauagc c 131

<210> SEQ ID NO 164
<211> LENGTH: 131
<212> TYPE: RNA
<213> ORGANISM: Artificial Sequence
<220> FEATURE:
<223> OTHER INFORMATION: Description of Artificial Sequence: Synthetic
polynucleotide
<220> FEATURE:
<221> NAME/KEY: modified_base
<222> LOCATION: (1)..(131)
<223> OTHER INFORMATION: UNA monomer

<400> SEQUENCE: 164 ucaacacaac auauacaaaa caaacgaauc ucaagcaauc aagcauucua cuucuauugc 60 agcaauuuaa aucauuucuu uuaaagcaaa agcaauuuuc ugaaaauuuu caccauuuac 120 gaacgauagc c 131

<210> SEQ ID NO 165
<211> LENGTH: 29
<212> TYPE: DNA
<213> ORGANISM: Artificial Sequence
<220> FEATURE:
<223> OTHER INFORMATION: Description of Artificial Sequence: Synthetic
oligonucleotide

<400> SEQUENCE: 165 cttcctactc aggctttatt caaagacca 29

-continued

```
<210> SEQ ID NO 166
<211> LENGTH: 30
<212> TYPE: RNA
<213> ORGANISM: Artificial Sequence
<220> FEATURE:
<223> OTHER INFORMATION: Description of Artificial Sequence: Synthetic
      oligonucleotide
<220> FEATURE:
<223> OTHER INFORMATION: 5'- Phosphorylation
<220> FEATURE:
<221> NAME/KEY: modified_base
<222> LOCATION: (26)..(30)
<223> OTHER INFORMATION: UNA monomer
<220> FEATURE:
<223> OTHER INFORMATION: 3'-(C3 Spacer)

<400> SEQUENCE: 166

aaaaaaaaaa aaaaaaaaaa aaaaaaaaaa                                    30
```

What is claimed is:

1. A messenger unlocked nucleic acid (mUNA) molecule, comprising: one or more unlocked nucleic acid (UNA) monomers, each independently having a structure of the formula:

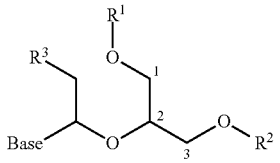

wherein $R^1$ and $R^2$ are each independently H or a phosphodiester linkage,

Base is a nucleobase selected from the group consisting of uracil, thymine, cytosine, 5-methylcytosine, adenine, guanine, inosine, pseudouracil, 1-methylpseudouracil, and 5-methoxyuracil, and $R^3$ is selected from the group consisting of —$OR^4$, $SR^4$, —$N(R^4)_2$, —NH(C═O)$R^4$, morpholino, piperazin-1-yl, or 4-alkanoyl-piperazin-1-yl;

wherein each $R^4$ is independently selected from the group consisting of H, alkyl, a cholesterol, a lipid molecule, a polyamine, an amino acid, and a polypeptide; and nucleic acid monomers wherein the mUNA molecule is translatable to express a polypeptide or protein.

2. The molecule of claim 1, wherein the molecule comprises from 200 to 12,000 monomers.

3. The molecule of claim 1, wherein the molecule comprises from 1 to 100 UNA monomers.

4. The molecule of claim 1, wherein the molecule comprises one or more modified nucleic acid nucleotides, or one or more chemically-modified nucleic acid nucleotides.

5. The molecule of claim 1, wherein the molecule comprises a 5' cap, a 5' untranslated region of monomers, a coding region of monomers, a 3' untranslated region of monomers, and a tail region of monomers.

6. The molecule of claim 5, wherein the molecule comprises a translation enhancer in a 5' or 3' untranslated region.

7. The molecule of claim 1, wherein the molecule is translatable in vivo or in vitro.

8. The molecule of claim 1, wherein a translation product of the molecule is an active peptide or protein.

9. The molecule of claim 1, wherein a translation product of the molecule is human EPO, human Factor IX, or human alpha-1-antitrypsin.

10. The molecule of claim 1, wherein the molecule exhibits at least 2-fold increased translation efficiency in vivo as compared to a native mRNA that encodes the same translation product.

11. The molecule of claim 1, wherein the molecule comprises a sequence selected from SEQ ID NOs:1-164.

12. A composition comprising a mUNA molecule of claim 1 and a pharmaceutically acceptable carrier.

13. A vaccine or immunization composition comprising a mUNA molecule of claim 1.

14. The composition of claim 12, wherein the carrier is a nanoparticle or liposome.

15. A method for producing a polypeptide or protein in vivo, the method comprising administering to a mammal a composition of claim 12.

16. The method of claim 15, wherein the polypeptide or protein is deficient in a disease or condition described in Table 1.

17. The method of claim 15, wherein the protein is human EPO, human Factor IX, or human alpha-1-antitrypsin.

18. The molecule of claim 4, wherein the one or more modified nucleic acid nucleotides is selected from the group consisting of 2'-O-methyl ribonucleotides; 2'-O-methyl purine nucleotides; 2'-deoxy-2'-fluoro ribonucleotides; 2'-deoxy-2'-fluoro pyrimidine nucleotides; 2'-deoxy ribonucleotides; 2'-deoxy purine nucleotides; 5-C-methyl-nucleotides; inverted deoxyabasic monomer residues; 3'-end stabilized nucleotides; 3'-glyceryl nucleotides; 3'-inverted abasic nucleotides; 3'-inverted thymidine; locked nucleic acid nucleotides (LNA); 2'-O,4'-C-methylene-(D-ribofuranosyl) nucleotides; 2'-methoxyethoxy (MOE) nucleotides; 2'-methyl-thio-ethyl; 2'-deoxy-2'-fluoro nucleotides; 2'-O-methyl nucleotides; 2',4'-constrained 2'-O-Methoxyethyl (cMOE); 2'-O-Ethyl (cEt) Modified DNAs; 2'-amino nucleotides; 2'-O-amino nucleotides; 2'-C-allyl nucleotides; 2'-O-allyl nucleotides; $N^6$-methyladenosine nucleotides; nucleotide monomers with modified bases including 5-(3-amino)propyluridine, 5-(2-mercapto)ethyluridine, 5-bromouridine, 8-bromoguanosine, or 7-deazaadenosine; 2'-O-aminopropyl substituted nucleotides; and nucleotide monomers in which the 2'-OH group is replaced with a 2'-R, a 2'-OR, a 2'-halogen, a 2'-SR, or a 2'-amino, wherein R is H, alkyl, alkenyl, or alkynyl.

19. The molecule of claim 4, wherein the one or more modified nucleic acid nucleotides is selected from the group consisting of pseudouridine (psi-uridine), 1-methylpseudouridine, 5-methylcytosine, and 5-methoxyuridine.

* * * * *